US007640980B2

(12) United States Patent
Vinegar et al.

(10) Patent No.: US 7,640,980 B2
(45) Date of Patent: Jan. 5, 2010

(54) THERMAL PROCESSES FOR SUBSURFACE FORMATIONS

(75) Inventors: Harold J. Vinegar, Bellaire, TX (US); Mark Gregory Picha, Houston, TX (US); Lanny Gene Schoeling, Katy, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 12/080,928

(22) Filed: Apr. 7, 2008

(65) Prior Publication Data

US 2009/0071647 A1 Mar. 19, 2009

Related U.S. Application Data

(63) Continuation of application No. 11/582,567, filed on Oct. 17, 2006, now Pat. No. 7,360,588, which is a continuation of application No. 10/831,351, filed on Apr. 23, 2004, now Pat. No. 7,121,342.

(60) Provisional application No. 60/465,279, filed on Apr. 24, 2003, provisional application No. 60/514,593, filed on Oct. 24, 2003.

(51) Int. Cl.

| | |
|---|---|
| ***E21B 36/00*** | (2006.01) |
| ***E21B 43/16*** | (2006.01) |
| ***E21B 43/18*** | (2006.01) |

(52) U.S. Cl. ..... 166/268; 166/302; 166/369; 405/52; 405/129.35

(58) Field of Classification Search ..... 166/268, 166/272.1, 302, 369, 402; 405/52, 129.35, 405/130

See application file for complete search history.

(56) References Cited

U.S. PATENT DOCUMENTS

| | | | |
|---|---|---|---|
| 48,994 | A | 7/1865 | Parry |
| 94,813 | A | 9/1869 | Dickey |
| 326,439 | A | 9/1885 | McEachen |
| 345,586 | A | 7/1886 | Hall |
| 760,304 | A | 5/1904 | Butler |
| 1,269,747 | A | 6/1918 | Rogers |
| 1,342,741 | A | 6/1920 | Day |

(Continued)

FOREIGN PATENT DOCUMENTS

| | | |
|---|---|---|
| CA | 899987 | 5/1972 |
| CA | 983704 | 2/1976 |
| CA | 1165361 | 4/1984 |

(Continued)

OTHER PUBLICATIONS

Kalkreuth et al., "Conversion characteristics of selected Canadian coals based on hydrogenation and pyrolysis experiments," Geological Survey of Canada, Paper 89-8, 1989, pp. 108-114, XP001014535.

(Continued)

*Primary Examiner*—George Suchfield

(57) ABSTRACT

A process may include providing heat from one or more heaters to at least a portion of a subsurface formation. Heat may transfer from one or more heaters to a part of a formation. In some embodiments, heat from the one or more heat sources may pyrolyze at least some hydrocarbons in a part of a subsurface formation. Hydrocarbons and/or other products may be produced from a subsurface formation. Certain embodiments describe apparatus, methods, and/or processes used in treating a subsurface or hydrocarbon containing formation.

18 Claims, 98 Drawing Sheets

U.S. PATENT DOCUMENTS

| | | | |
|---|---|---|---|
| 1,457,479 | A | 6/1923 | Wolcott |
| 1,510,655 | A | 6/1924 | Clark |
| 1,634,236 | A | 6/1927 | Ranney |
| 1,646,599 | A | 10/1927 | Schaefer |
| 1,666,488 | A | 4/1928 | Crawshaw |
| 1,681,523 | A | 8/1928 | Downey et al. |
| 1,913,395 | A | 6/1933 | Karrick |
| 2,244,255 | A | 6/1941 | Looman |
| 2,244,256 | A | 6/1941 | Looman |
| 2,319,702 | A | 5/1943 | Moon |
| 2,365,591 | A | 12/1944 | Ranney |
| 2,375,689 | A | 5/1945 | Reeder |
| 2,381,256 | A | 8/1945 | Callaway |
| 2,390,770 | A | 12/1945 | Barton et al. |
| 2,423,674 | A | 7/1947 | Agren |
| 2,444,755 | A | 7/1948 | Steffen |
| 2,466,945 | A | 4/1949 | Greene |
| 2,472,445 | A | 6/1949 | Sprong |
| 2,481,051 | A | 9/1949 | Uren |
| 2,484,063 | A | 10/1949 | Ackley |
| 2,497,868 | A | 2/1950 | Dalin |
| 2,548,360 | A | 4/1951 | Germain |
| 2,584,605 | A | 2/1952 | Meriam et al. |
| 2,593,477 | A | 4/1952 | Newman et al. |
| 2,595,979 | A | 5/1952 | Pevere et al. |
| 2,623,596 | A | 12/1952 | Whorton et al. |
| 2,630,306 | A | 3/1953 | Evans |
| 2,630,307 | A | 3/1953 | Martin |
| 2,634,961 | A | 4/1953 | Ljungstrom |
| 2,642,943 | A | 6/1953 | Smith et al. |
| 2,670,802 | A | 3/1954 | Ackley |
| 2,685,930 | A | 8/1954 | Albaugh |
| 2,695,163 | A | 11/1954 | Pearce et al. |
| 2,703,621 | A | 3/1955 | Ford |
| 2,714,930 | A | 8/1955 | Carpenter |
| 2,732,195 | A | 1/1956 | Ljungstrom |
| 2,734,579 | A | 2/1956 | Elkins |
| 2,743,906 | A | 5/1956 | Coyle |
| 2,771,954 | A | 11/1956 | Jenks et al. |
| 2,777,679 | A | 1/1957 | Ljungstrom |
| 2,780,449 | A | 2/1957 | Fisher et al. |
| 2,780,450 | A | 2/1957 | Ljungstrom |
| 2,786,660 | A | 3/1957 | Alleman |
| 2,789,805 | A | 4/1957 | Ljungstrom |
| 2,793,696 | A | 5/1957 | Morse |
| 2,794,504 | A | 6/1957 | Carpenter |
| 2,799,341 | A | 7/1957 | Maly |
| 2,801,089 | A | 7/1957 | Scott, Jr. |
| 2,803,305 | A | 8/1957 | Behning et al. |
| 2,804,149 | A | 8/1957 | Kile |
| 2,819,761 | A | 1/1958 | Popham et al. |
| 2,825,408 | A | 3/1958 | Watson |
| 2,841,375 | A | 7/1958 | Salomonsson |
| 2,857,002 | A | 10/1958 | Pevere et al. |
| 2,862,558 | A | 12/1958 | Dixon |
| 2,889,882 | A | 6/1959 | Schleicher |
| 2,890,754 | A | 6/1959 | Hoffstrom et al. |
| 2,890,755 | A | 6/1959 | Eurenius et al. |
| 2,902,270 | A | 9/1959 | Salomonsson et al. |
| 2,906,337 | A | 9/1959 | Henning |
| 2,906,340 | A | 9/1959 | Herzog |
| 2,914,309 | A | 11/1959 | Salomonsson |
| 2,923,535 | A | 2/1960 | Ljungstrom |
| 2,932,352 | A | 4/1960 | Stegemeier |
| 2,939,689 | A | 6/1960 | Ljungstrom |
| 2,942,223 | A | 6/1960 | Lennox et al. |
| 2,952,449 | A | 9/1960 | Bays |
| 2,954,826 | A | 10/1960 | Sievers |
| 2,958,519 | A | 11/1960 | Hurley |
| 2,969,226 | A | 1/1961 | Huntington |
| 2,970,826 | A | 2/1961 | Woodruff |
| 2,974,937 | A | 3/1961 | Kiel |
| 2,991,046 | A | 7/1961 | Yahn |
| 2,994,376 | A | 8/1961 | Crawford et al. |
| 2,997,105 | A | 8/1961 | Campion et al. |
| 2,998,457 | A | 8/1961 | Paulsen |
| 3,004,596 | A | 10/1961 | Parker et al. |
| 3,004,601 | A | 10/1961 | Bodine |
| 3,004,603 | A | 10/1961 | Rogers et al. |
| 3,007,521 | A | 11/1961 | Trantham et al. |
| 3,010,513 | A | 11/1961 | Gerner |
| 3,010,516 | A | 11/1961 | Schleicher |
| 3,016,053 | A | 1/1962 | Medovick |
| 3,017,168 | A | 1/1962 | Carr |
| 3,026,940 | A | 3/1962 | Spitz |
| 3,032,102 | A | 5/1962 | Parker |
| 3,036,632 | A | 5/1962 | Koch et al. |
| 3,044,545 | A | 7/1962 | Tooke |
| 3,048,221 | A | 8/1962 | Tek |
| 3,050,123 | A | 8/1962 | Scott |
| 3,051,235 | A | 8/1962 | Banks |
| 3,057,404 | A | 10/1962 | Berstrom |
| 3,058,730 | A | 10/1962 | Bays |
| 3,061,009 | A | 10/1962 | Shirley |
| 3,062,282 | A | 11/1962 | Schleicher |
| 3,079,085 | A | 2/1963 | Clark, Jr. et al. |
| 3,084,919 | A | 4/1963 | Slater |
| 3,095,031 | A | 6/1963 | Eurenius et al. |
| 3,097,690 | A | 7/1963 | Terwilliger et al. |
| 3,105,545 | A | 10/1963 | Prats et al. |
| 3,106,244 | A | 10/1963 | Parker |
| 3,110,345 | A | 11/1963 | Reed et al. |
| 3,113,619 | A | 12/1963 | Reichle |
| 3,113,620 | A | 12/1963 | Hemminger |
| 3,113,623 | A | 12/1963 | Krueger |
| 3,114,417 | A | 12/1963 | McCarthy |
| 3,116,792 | A | 1/1964 | Purre |
| 3,120,264 | A | 2/1964 | Barron |
| 3,127,935 | A | 4/1964 | Poettmann et al. |
| 3,127,936 | A | 4/1964 | Eurenius |
| 3,131,763 | A | 5/1964 | Kunetka et al. |
| 3,132,692 | A | 5/1964 | Marx et al. |
| 3,137,347 | A | 6/1964 | Parker |
| 3,138,203 | A | 6/1964 | Weiss et al. |
| 3,139,928 | A | 7/1964 | Broussard |
| 3,142,336 | A | 7/1964 | Doscher |
| 3,149,670 | A | 9/1964 | Grant |
| 3,149,672 | A | 9/1964 | Orkiszewski et al. |
| 3,150,715 | A | 9/1964 | Dietz |
| 3,163,745 | A | 12/1964 | Boston |
| 3,164,207 | A | 1/1965 | Thessen et al. |
| 3,165,154 | A | 1/1965 | Santourian |
| 3,170,842 | A | 2/1965 | Kehler |
| 3,181,613 | A | 5/1965 | Krueger |
| 3,182,721 | A | 5/1965 | Hardy |
| 3,183,675 | A | 5/1965 | Schroeder |
| 3,191,679 | A | 6/1965 | Miller |
| 3,205,942 | A | 9/1965 | Sandberg |
| 3,205,944 | A | 9/1965 | Walton |
| 3,205,946 | A | 9/1965 | Prats et al. |
| 3,207,220 | A | 9/1965 | Williams |
| 3,208,531 | A | 9/1965 | Tamplen |
| 3,209,825 | A | 10/1965 | Alexander et al. |
| 3,221,505 | A | 12/1965 | Goodwin et al. |
| 3,221,811 | A | 12/1965 | Prats |
| 3,223,166 | A | 12/1965 | Hunt et al. |
| 3,233,668 | A | 2/1966 | Hamilton et al. |
| 3,237,689 | A | 3/1966 | Justheim |
| 3,241,611 | A | 3/1966 | Dougan |
| 3,244,231 | A | 4/1966 | Greckel et al. |
| 3,246,695 | A | 4/1966 | Robinson |
| 3,250,327 | A | 5/1966 | Crider |
| 3,262,741 | A | 7/1966 | Edmonds et al. |
| 3,267,680 | A | 8/1966 | Schlumberger |

3,273,640 A 9/1966 Huntington
3,275,076 A 9/1966 Sharp
3,278,234 A 10/1966 Helvenston et al.
3,284,281 A 11/1966 Thomas
3,285,335 A 11/1966 Reistle, Jr.
3,288,648 A 11/1966 Jones
3,294,167 A 12/1966 Vogel
3,302,707 A 2/1967 Slusser
3,310,109 A 3/1967 Marx et al.
3,316,344 A 4/1967 Kidd et al.
3,316,962 A 5/1967 Lange
3,332,480 A 7/1967 Parrish
3,338,306 A 8/1967 Cook
3,342,258 A 9/1967 Prats
3,342,267 A 9/1967 Cotter et al.
3,349,845 A 10/1967 Holbert et al.
3,352,355 A 11/1967 Putman
3,358,756 A 12/1967 Vogel
3,362,751 A 1/1968 Tinlin
3,372,754 A 3/1968 McDonald
3,379,248 A 4/1968 Strange
3,380,913 A 4/1968 Henderson
3,386,508 A 6/1968 Bielstein et al.
3,389,975 A 6/1968 Van Nostrand
3,399,623 A 9/1968 Creed
3,410,977 A 11/1968 Ando
3,412,011 A 11/1968 Lindsay
3,434,541 A 3/1969 Cook et al.
3,454,365 A 7/1969 Lumpkin et al.
3,455,383 A 7/1969 Prats et al.
3,465,819 A 9/1969 Dixon
3,477,058 A 11/1969 Vedder et al.
3,485,300 A 12/1969 Engle
3,492,463 A 1/1970 Wringer et al.
3,497,000 A 2/1970 Hujsak et al.
3,501,201 A 3/1970 Closmann et al.
3,502,372 A 3/1970 Prats
3,513,913 A 5/1970 Bruist
3,515,837 A 6/1970 Ando
3,526,095 A 9/1970 Peck
3,528,501 A 9/1970 Parker
3,529,682 A 9/1970 Coyne et al.
3,537,528 A 11/1970 Herce et al.
3,542,131 A 11/1970 Walton et al.
3,547,192 A 12/1970 Claridge et al.
3,547,193 A 12/1970 Gill
3,554,285 A 1/1971 Meldau
3,562,401 A 2/1971 Long
3,565,171 A 2/1971 Closmann
3,572,838 A 3/1971 Templeton
3,578,080 A 5/1971 Closmann
3,580,987 A 5/1971 Priaroggia
3,593,789 A 7/1971 Prats
3,593,790 A 7/1971 Herce
3,595,082 A 7/1971 Miller et al.
3,599,714 A 8/1971 Messman et al.
3,605,890 A 9/1971 Holm
3,614,986 A 10/1971 Gill
3,617,471 A 11/1971 Schlinger et al.
3,618,663 A 11/1971 Needham
3,622,071 A 11/1971 Coggins et al.
3,629,551 A 12/1971 Ando
RE27,309 E 3/1972 Scott et al.
3,661,423 A 5/1972 Garrett
3,675,715 A 7/1972 Speller, Jr.
3,679,812 A 7/1972 Owens
3,680,633 A 8/1972 Bennett
3,700,280 A 10/1972 Papadopoulos et al.
3,757,860 A 9/1973 Pritchett
3,759,328 A 9/1973 Ueber et al.
3,759,574 A 9/1973 Beard
3,766,982 A 10/1973 Justheim
3,770,398 A 11/1973 Abraham et al.
3,775,185 A 11/1973 Kunz et al.
3,779,602 A 12/1973 Beard et al.
3,794,113 A 2/1974 Strange et al.
3,794,116 A 2/1974 Higgins
3,804,169 A 4/1974 Closmann
3,804,172 A 4/1974 Closmann et al.
3,809,159 A 5/1974 Young et al.
3,812,913 A 5/1974 Hardy et al.
3,853,185 A 12/1974 Dahl et al.
3,870,063 A 3/1975 Hayward
3,874,733 A 4/1975 Poundstone et al.
3,881,551 A 5/1975 Terry et al.
3,882,941 A 5/1975 Pelofsky
3,892,270 A 7/1975 Lindquist
3,893,918 A 7/1975 Favret, Jr.
3,894,769 A 7/1975 Tham et al.
3,907,045 A 9/1975 Dahl et al.
3,922,148 A 11/1975 Child
3,924,680 A 12/1975 Terry
3,933,447 A 1/1976 Pasini, III et al.
3,941,421 A 3/1976 Burton, III et al.
3,947,656 A 3/1976 Lodi
3,947,683 A 3/1976 Schultz et al.
3,948,319 A 4/1976 Pritchett
3,948,755 A 4/1976 McCollum et al.
3,950,029 A 4/1976 Timmins
3,952,802 A 4/1976 Terry
3,954,140 A 5/1976 Hendrick
3,973,628 A 8/1976 Colgate
3,986,349 A 10/1976 Egan
3,986,556 A 10/1976 Haynes
3,986,557 A 10/1976 Striegler et al.
3,987,851 A 10/1976 Tham
3,992,474 A 11/1976 Sobel
3,993,132 A 11/1976 Cram et al.
3,994,340 A 11/1976 Anderson et al.
3,994,341 A 11/1976 Anderson et al.
3,999,607 A 12/1976 Pennington et al.
4,005,752 A 2/1977 Cha
4,006,778 A 2/1977 Redford et al.
4,008,762 A 2/1977 Fisher et al.
4,010,800 A 3/1977 Terry
4,014,575 A 3/1977 French et al.
4,016,239 A 4/1977 Fenton
4,017,319 A 4/1977 Greskovich et al.
4,018,280 A 4/1977 Daviduk et al.
4,019,575 A 4/1977 Pisio et al.
4,026,357 A 5/1977 Redford
4,029,360 A 6/1977 French
4,031,956 A 6/1977 Terry
4,037,655 A 7/1977 Carpenter
4,037,658 A 7/1977 Anderson
4,042,026 A 8/1977 Pusch et al.
4,043,393 A 8/1977 Fisher et al.
4,048,637 A 9/1977 Jacomini
4,049,053 A 9/1977 Fisher et al.
4,057,293 A 11/1977 Garrett
4,059,308 A 11/1977 Pearson et al.
4,064,943 A 12/1977 Cavin
4,065,183 A 12/1977 Hill et al.
4,067,390 A 1/1978 Camacho et al.
4,069,868 A 1/1978 Terry
4,076,761 A 2/1978 Chang et al.
4,083,604 A 4/1978 Bohn et al.
4,084,637 A 4/1978 Todd
4,085,803 A 4/1978 Butler
4,087,130 A 5/1978 Garrett
4,089,372 A 5/1978 Terry
4,089,373 A 5/1978 Reynolds et al.
4,089,374 A 5/1978 Terry
4,091,869 A 5/1978 Hoyer
4,093,025 A 6/1978 Terry
4,093,026 A 6/1978 Ridley 4,096,163 A 6/1978 Chang et al.
4,099,567 A 7/1978 Terry
4,114,688 A 9/1978 Terry
4,119,349 A 10/1978 Albulescu et al.
4,125,159 A 11/1978 Vann
4,130,575 A 12/1978 Jorn et al.
4,133,825 A 1/1979 Stroud et al.
4,138,442 A 2/1979 Chang et al.
4,140,180 A 2/1979 Bridges et al.
4,140,181 A 2/1979 Ridley et al.
4,144,935 A 3/1979 Bridges et al.
4,148,359 A 4/1979 Laumbach et al.
4,151,877 A 5/1979 French
RE30,019 E 6/1979 Lindquist
4,158,467 A 6/1979 Larson et al.
4,160,479 A 7/1979 Richardson et al.
4,162,707 A 7/1979 Yan
4,167,213 A 9/1979 Stoltz et al.
4,169,506 A 10/1979 Berry
4,183,405 A 1/1980 Magnie
4,184,548 A 1/1980 Ginsburgh et al.
4,185,692 A 1/1980 Terry
4,186,801 A 2/1980 Madgavkar et al.
4,193,451 A 3/1980 Dauphine
4,197,911 A 4/1980 Anada
4,199,024 A 4/1980 Rose et al.
4,199,025 A 4/1980 Carpenter
4,228,853 A 10/1980 Harvey et al.
4,228,854 A 10/1980 Sacuta
4,232,902 A 11/1980 Cuevas
4,234,230 A 11/1980 Weichman
4,243,101 A 1/1981 Grupping
4,243,511 A 1/1981 Allred
4,248,306 A 2/1981 Van Huisen et al.
4,250,230 A 2/1981 Terry
4,250,962 A 2/1981 Madgavkar et al.
4,252,191 A 2/1981 Pusch et al.
4,256,945 A 3/1981 Carter et al.
4,258,955 A 3/1981 Habib, Jr.
4,260,018 A 4/1981 Shum et al.
4,260,192 A 4/1981 Shafer
4,265,307 A 5/1981 Elkins
4,273,188 A 6/1981 Vogel et al.
4,274,487 A 6/1981 Hollingsworth et al.
4,277,416 A 7/1981 Grant
4,282,587 A 8/1981 Silverman
4,285,547 A 8/1981 Weichman
RE30,738 E 9/1981 Bridges et al.
4,289,354 A 9/1981 Zakiewicz
4,290,650 A 9/1981 Thompson
4,299,086 A 11/1981 Madgavkar et al.
4,299,285 A 11/1981 Tsai et al.
4,303,126 A 12/1981 Blevins
4,305,463 A 12/1981 Zakiewicz
4,306,621 A 12/1981 Boyd et al.
4,311,340 A 1/1982 Lyons et al.
4,319,635 A 3/1982 Jones
4,323,848 A 4/1982 Kuckes
4,324,292 A 4/1982 Jacobs et al.
4,344,483 A 8/1982 Fisher et al.
4,353,418 A 10/1982 Hoekstra et al.
4,359,687 A 11/1982 Vinegar et al.
4,363,361 A 12/1982 Madgavkar et al.
4,366,668 A 1/1983 Madgavkar et al.
4,372,398 A 2/1983 Kuckes
4,375,302 A 3/1983 Kalmar
4,378,048 A 3/1983 Madgavkar et al.
4,380,930 A 4/1983 Podhrasky et al.
4,381,641 A 5/1983 Madgavkar et al.
4,384,613 A 5/1983 Owen et al.
4,384,614 A 5/1983 Justheim
4,384,948 A 5/1983 Barger
4,385,661 A 5/1983 Fox
4,390,067 A 6/1983 Wilman
4,390,973 A 6/1983 Rietsch
4,396,062 A 8/1983 Iskander
4,397,732 A 8/1983 Hoover et al.
4,398,151 A 8/1983 Vinegar et al.
4,399,866 A 8/1983 Dearth
4,401,099 A 8/1983 Collier
4,401,162 A 8/1983 Osborne
4,401,163 A 8/1983 Elkins
4,407,973 A 10/1983 van Dijk et al.
4,409,090 A 10/1983 Hanson et al.
4,410,042 A 10/1983 Shu
4,412,124 A 10/1983 Kobayashi
4,412,585 A 11/1983 Bouck
4,415,034 A 11/1983 Bouck
4,417,782 A 11/1983 Clarke et al.
4,418,752 A 12/1983 Boyer et al.
4,423,311 A 12/1983 Varney, Sr.
4,425,967 A 1/1984 Hoekstra
4,428,700 A 1/1984 Lenneman
4,429,745 A 2/1984 Cook
4,437,519 A 3/1984 Cha et al.
4,439,307 A 3/1984 Jaquay et al.
4,440,224 A 4/1984 Kreinin et al.
4,442,896 A 4/1984 Reale et al.
4,443,762 A 4/1984 Kuckes
4,444,255 A 4/1984 Geoffrey et al.
4,444,258 A 4/1984 Kalmar
4,445,574 A 5/1984 Vann
4,446,917 A 5/1984 Todd
4,448,251 A 5/1984 Stine
4,448,252 A 5/1984 Stoddard et al.
4,452,491 A 6/1984 Seglin et al.
4,455,215 A 6/1984 Jarrott et al.
4,456,065 A 6/1984 Heim et al.
4,457,365 A 7/1984 Kasevich et al.
4,457,374 A 7/1984 Hoekstra et al.
4,458,757 A 7/1984 Bock et al.
4,458,767 A 7/1984 Hoehn, Jr.
4,460,044 A 7/1984 Porter
4,463,807 A 8/1984 Stoddard et al.
4,474,238 A 10/1984 Gentry et al.
4,476,927 A 10/1984 Riggs
4,479,541 A 10/1984 Wang
4,483,398 A 11/1984 Peters
4,485,868 A 12/1984 Sresty et al.
4,485,869 A 12/1984 Sresty et al.
4,487,257 A 12/1984 Dauphine
4,489,782 A 12/1984 Perkins
4,491,179 A 1/1985 Pirson et al.
4,498,531 A 2/1985 Vrolyk
4,498,535 A 2/1985 Bridges
4,499,209 A 2/1985 Hoek et al.
4,501,326 A 2/1985 Edmunds
4,501,445 A 2/1985 Gregoli
4,502,010 A 2/1985 Kuckes
4,508,170 A 4/1985 Littman
4,513,816 A 4/1985 Hubert
4,518,548 A 5/1985 Yarbrough
4,524,113 A 6/1985 Lesieur
4,524,826 A 6/1985 Savage
4,524,827 A 6/1985 Bridges et al.
4,529,939 A 7/1985 Kuckes
4,530,401 A 7/1985 Hartman et al.
4,537,252 A 8/1985 Puri
4,538,682 A 9/1985 McManus et al.
4,540,882 A 9/1985 Vinegar et al.
4,542,648 A 9/1985 Vinegar et al.
4,544,478 A 10/1985 Kelley
4,545,435 A 10/1985 Bridges et al.
4,549,396 A 10/1985 Garwood et al.
4,552,214 A 11/1985 Forgac et al.
4,570,715 A 2/1986 Van Meurs et al.

4,571,491 A 2/1986 Vinegar et al.
4,572,299 A 2/1986 Van Egmond et al.
4,573,530 A 3/1986 Audeh et al.
4,576,231 A 3/1986 Dowling et al.
4,577,503 A 3/1986 Imaino et al.
4,577,690 A 3/1986 Medlin
4,577,691 A 3/1986 Huang et al.
4,583,046 A 4/1986 Vinegar et al.
4,583,242 A 4/1986 Vinegar et al.
4,585,066 A 4/1986 Moore et al.
4,592,423 A 6/1986 Savage et al.
4,594,468 A 6/1986 Minderhoud
4,597,441 A 7/1986 Ware et al.
4,597,444 A 7/1986 Hutchinson
4,598,392 A 7/1986 Pann
4,598,770 A 7/1986 Shu et al.
4,598,772 A 7/1986 Holmes
4,605,489 A 8/1986 Madgavkar
4,605,680 A 8/1986 Beuther et al.
4,608,818 A 9/1986 Goebel et al.
4,609,041 A 9/1986 Magda
4,613,754 A 9/1986 Vinegar et al.
4,616,705 A 10/1986 Stegemeier et al.
4,623,264 A 11/1986 Mitchell
4,623,401 A 11/1986 Derbyshire et al.
4,623,444 A 11/1986 Che et al.
4,626,665 A 12/1986 Fort, III
4,634,187 A 1/1987 Huff et al.
4,635,197 A 1/1987 Vinegar et al.
4,637,464 A 1/1987 Forgac et al.
4,640,352 A 2/1987 Van Meurs et al.
4,640,353 A 2/1987 Schuh
4,644,283 A 2/1987 Vinegar et al.
4,645,906 A 2/1987 Yagnik et al.
4,651,825 A 3/1987 Wilson
4,658,215 A 4/1987 Vinegar et al.
4,662,437 A 5/1987 Renfro et al.
4,662,438 A 5/1987 Taflove et al.
4,662,439 A 5/1987 Puri
4,662,443 A 5/1987 Puri et al.
4,663,711 A 5/1987 Vinegar et al.
4,669,542 A 6/1987 Venkatesan
4,671,102 A 6/1987 Vinegar et al.
4,682,652 A 7/1987 Huang et al.
4,683,947 A 8/1987 Fernbacher et al.
4,691,771 A 9/1987 Ware et al.
4,694,907 A 9/1987 Stahl et al.
4,695,713 A 9/1987 Krumme
4,696,345 A 9/1987 Hsueh
4,698,583 A 10/1987 Sandberg
4,700,142 A 10/1987 Kuckes
4,701,587 A 10/1987 Carter et al.
4,702,758 A 10/1987 Geer
4,704,514 A 11/1987 Van Edmond et al.
4,706,751 A 11/1987 Gondouin
4,716,960 A 1/1988 Eastlund et al.
4,717,814 A 1/1988 Krumme
4,719,423 A 1/1988 Vinegar et al.
4,728,412 A 3/1988 Soderberg
4,728,892 A 3/1988 Vinegar et al.
4,730,162 A 3/1988 Vinegar et al.
4,733,057 A 3/1988 Stanzel et al.
4,734,115 A 3/1988 Howard et al.
4,737,267 A 4/1988 Pao et al.
4,743,854 A 5/1988 Vinegar et al.
4,744,245 A 5/1988 White
4,752,673 A 6/1988 Krumme
4,756,367 A 7/1988 Puri et al.
4,762,425 A 8/1988 Shakkottai et al.
4,766,958 A 8/1988 Faecke
4,769,602 A 9/1988 Vinegar et al.
4,769,606 A 9/1988 Vinegar et al.
4,772,634 A 9/1988 Farooque
4,776,638 A 10/1988 Hahn
4,778,586 A 10/1988 Bain et al.
4,785,163 A 11/1988 Sandberg
4,787,452 A 11/1988 Jennings, Jr.
4,791,373 A 12/1988 Kuckes
4,793,409 A 12/1988 Bridges et al.
4,793,656 A 12/1988 Siddoway et al.
4,794,226 A 12/1988 Derbyshire
4,808,925 A 2/1989 Baird
4,814,587 A 3/1989 Carter et al.
4,815,790 A 3/1989 Rosar et al.
4,815,791 A 3/1989 Schmidt et al.
4,817,711 A 4/1989 Jeambey
4,818,370 A 4/1989 Gregoli et al.
4,821,798 A 4/1989 Bridges et al.
4,823,890 A 4/1989 Lang
4,827,761 A 5/1989 Vinegar et al.
4,828,031 A 5/1989 Davis
4,831,600 A 5/1989 Hornby et al.
4,845,434 A 7/1989 Kuckes
4,848,460 A 7/1989 Johnson, Jr. et al.
4,848,924 A 7/1989 Nuspl et al.
4,849,360 A 7/1989 Norris et al.
4,849,611 A 7/1989 Whitney et al.
4,856,341 A 8/1989 Vinegar et al.
4,856,587 A 8/1989 Nielson
4,860,544 A 8/1989 Krieg et al.
4,866,983 A 9/1989 Vinegar et al.
4,883,582 A 11/1989 McCants
4,884,455 A 12/1989 Vinegar et al.
4,885,080 A 12/1989 Brown et al.
4,886,118 A 12/1989 Van Meurs et al.
4,893,504 A 1/1990 OMeara, Jr. et al.
4,895,206 A 1/1990 Price
4,912,971 A 4/1990 Jeambey
4,913,065 A 4/1990 Hemsath
4,926,941 A 5/1990 Glandt et al.
4,927,857 A 5/1990 McShea, III et al.
4,928,765 A 5/1990 Nielson
4,931,171 A 6/1990 Piotter
4,933,640 A 6/1990 Kuckes
4,974,425 A 12/1990 Krieg et al.
4,982,786 A 1/1991 Jennings, Jr.
4,983,319 A 1/1991 Gregoli et al.
4,984,594 A 1/1991 Vinegar et al.
4,985,313 A 1/1991 Penneck et al.
4,987,368 A 1/1991 Vinegar
4,988,389 A 1/1991 Adamache et al.
4,994,093 A 2/1991 Wetzel et al.
5,008,085 A 4/1991 Bain et al.
5,011,329 A 4/1991 Nelson et al.
5,014,788 A 5/1991 Puri et al.
5,020,596 A 6/1991 Hemsath
5,027,896 A 7/1991 Anderson
5,041,210 A 8/1991 Merrill, Jr. et al.
5,042,579 A 8/1991 Glandt et al.
5,046,559 A 9/1991 Glandt
5,050,386 A 9/1991 Krieg et al.
5,054,551 A 10/1991 Duerksen
5,055,180 A 10/1991 Klaila
5,059,303 A 10/1991 Taylor et al.
5,060,287 A 10/1991 Van Egmond
5,060,726 A 10/1991 Glandt et al.
5,064,006 A 11/1991 Waters et al.
5,065,501 A 11/1991 Henschen et al.
5,065,818 A 11/1991 Van Egmond
5,066,852 A 11/1991 Willbanks
5,073,625 A 12/1991 Derbyshire
5,074,365 A 12/1991 Kuckes
5,082,054 A 1/1992 Kiamanesh
5,082,055 A 1/1992 Hemsath
5,085,276 A 2/1992 Rivas et al.
5,097,903 A 3/1992 Wilensky 5,099,918 A 3/1992 Bridges et al.
5,103,920 A 4/1992 Patton
5,109,928 A 5/1992 McCants
5,126,037 A 6/1992 Showalter
5,133,406 A 7/1992 Puri
5,145,003 A 9/1992 Duerksen
5,152,341 A 10/1992 Kaservich
5,168,927 A 12/1992 Stegemeier et al.
5,182,427 A 1/1993 McGaffigan
5,182,792 A 1/1993 Goncalves
5,189,283 A 2/1993 Carl, Jr. et al.
5,190,405 A 3/1993 Vinegar et al.
5,201,219 A 4/1993 Bandurski et al.
5,207,273 A 5/1993 Cates et al.
5,209,987 A 5/1993 Penneck et al.
5,211,230 A 5/1993 Ostapovich et al.
5,217,075 A 6/1993 Wittrisch
5,217,076 A 6/1993 Masek
5,218,301 A 6/1993 Kuckes
5,226,961 A 7/1993 Nahm et al.
5,229,102 A 7/1993 Minet et al.
5,229,583 A 7/1993 van Egmond et al.
5,236,039 A 8/1993 Edelstein et al.
5,246,071 A 9/1993 Chu
5,255,742 A 10/1993 Mikus
5,258,755 A 11/1993 Kuckes
5,261,490 A 11/1993 Ebinuma
5,284,878 A 2/1994 Studer et al.
5,285,846 A 2/1994 Mohn
5,289,882 A 3/1994 Moore
5,295,763 A 3/1994 Stenborg et al.
5,297,626 A 3/1994 Vinegar et al.
5,305,212 A 4/1994 Kuckes
5,305,239 A 4/1994 Kinra
5,305,829 A 4/1994 Kumar
5,306,640 A 4/1994 Vinegar et al.
5,316,664 A 5/1994 Gregoli et al.
5,318,116 A 6/1994 Vinegar et al.
5,325,918 A 7/1994 Berryman et al.
5,332,036 A 7/1994 Shirley et al.
5,339,897 A 8/1994 Leaute
5,339,904 A 8/1994 Jennings, Jr.
5,340,467 A 8/1994 Gregoli et al.
5,343,152 A 8/1994 Kuckes
5,349,859 A 9/1994 Kleppe
5,360,067 A 11/1994 Meo, III
5,363,094 A 11/1994 Staron et al.
5,366,012 A 11/1994 Lohbeck
5,377,756 A 1/1995 Northrop et al.
5,388,640 A 2/1995 Puri et al.
5,388,641 A 2/1995 Yee et al.
5,388,642 A 2/1995 Puri et al.
5,388,643 A 2/1995 Yee et al.
5,388,645 A 2/1995 Puri et al.
5,391,291 A 2/1995 Winquist et al.
5,392,854 A 2/1995 Vinegar et al.
5,400,430 A 3/1995 Nenniger
5,402,847 A 4/1995 Wilson et al.
5,404,952 A 4/1995 Vinegar et al.
5,409,071 A 4/1995 Wellington et al.
5,411,086 A 5/1995 Burcham et al.
5,411,089 A 5/1995 Vinegar et al.
5,411,104 A 5/1995 Stanley
5,415,231 A 5/1995 Northrop et al.
5,431,224 A 7/1995 Laali
5,433,271 A 7/1995 Vinegar et al.
5,435,666 A 7/1995 Hassett et al.
5,437,506 A 8/1995 Gray
5,439,054 A 8/1995 Chaback et al.
5,454,666 A 10/1995 Chaback et al.
5,456,315 A 10/1995 Kisman et al.
5,485,089 A 1/1996 Kuckes
5,491,969 A 2/1996 Cohn et al.
5,497,087 A 3/1996 Vinegar et al.
5,498,960 A 3/1996 Vinegar et al.
5,512,732 A 4/1996 Yagnik et al.
5,512,830 A 4/1996 Kuckes
5,513,710 A 5/1996 Kuckes
5,515,931 A 5/1996 Kuckes
5,517,593 A 5/1996 Nenniger et al.
5,525,322 A 6/1996 Willms
5,541,517 A 7/1996 Hartmann et al.
5,545,803 A 8/1996 Heath et al.
5,553,189 A 9/1996 Stegemeier et al.
5,554,453 A 9/1996 Steinfeld et al.
5,566,755 A 10/1996 Seidle et al.
5,566,756 A 10/1996 Chaback et al.
5,571,403 A 11/1996 Scott et al.
5,579,575 A 12/1996 Lamome et al.
5,589,775 A 12/1996 Kuckes
5,621,844 A 4/1997 Bridges
5,621,845 A 4/1997 Bridges et al.
5,624,188 A 4/1997 West
5,626,191 A 5/1997 Greaves et al.
5,632,336 A 5/1997 Notz et al.
5,652,389 A 7/1997 Schaps et al.
5,656,239 A 8/1997 Stegemeier et al.
5,657,826 A 8/1997 Kuckes
5,676,212 A 10/1997 Kuckes
RE35,696 E 12/1997 Mikus
5,713,415 A 2/1998 Bridges
5,725,059 A 3/1998 Kuckes
5,747,750 A 5/1998 Bailey et al.
5,751,895 A 5/1998 Bridges
5,759,022 A 6/1998 Koppang et al.
5,760,307 A 6/1998 Latimer et al.
5,767,584 A 6/1998 Gore et al.
5,769,569 A 6/1998 Hosseini
5,777,229 A 7/1998 Geier et al.
5,782,301 A 7/1998 Neuroth et al.
5,802,870 A 9/1998 Arnold et al.
5,826,655 A 10/1998 Snow et al.
5,828,797 A 10/1998 Minott et al.
5,861,137 A 1/1999 Edlund
5,862,858 A 1/1999 Wellington et al.
5,868,202 A 2/1999 Hsu
5,891,829 A 4/1999 Vallejos et al.
5,899,269 A 5/1999 Wellington et al.
5,899,958 A 5/1999 Dowell et al.
5,911,898 A 6/1999 Jacobs et al.
5,923,170 A 7/1999 Kuckes
5,926,437 A 7/1999 Ortiz
5,935,421 A 8/1999 Brons et al.
5,955,039 A 9/1999 Dowdy
5,968,349 A 10/1999 Duyvesteyn et al.
5,984,010 A 11/1999 Elias et al.
5,984,582 A 11/1999 Schwert
5,985,138 A 11/1999 Humphreys
5,997,214 A 12/1999 de Rouffignac et al.
5,999,489 A 12/1999 Lazaratos
6,015,015 A 1/2000 Luft et al.
6,016,867 A 1/2000 Gregoli et al.
6,016,868 A 1/2000 Gregoli et al.
RE36,569 E 2/2000 Kuckes
6,019,172 A 2/2000 Wellington et al.
6,023,554 A 2/2000 Vinegar et al.
6,026,914 A 2/2000 Adams et al.
6,035,701 A 3/2000 Lowry et al.
6,039,121 A 3/2000 Kisman
6,049,508 A 4/2000 Deflandre
6,056,057 A 5/2000 Vinegar et al.
6,065,538 A 5/2000 Reimers et al.
6,078,868 A 6/2000 Dubinsky
6,079,499 A 6/2000 Mikus et al.
6,084,826 A 7/2000 Leggett, III
6,085,512 A 7/2000 Agee et al.

6,088,294 A 7/2000 Leggett, III et al.
6,094,048 A 7/2000 Vinegar et al.
6,099,208 A 8/2000 McAlister
6,102,122 A 8/2000 de Rouffignac
6,102,137 A 8/2000 Ward et al.
6,102,622 A 8/2000 Vinegar et al.
6,109,358 A 8/2000 McPhee et al.
6,112,808 A 9/2000 Isted
6,152,987 A 11/2000 Ma et al.
6,155,117 A 12/2000 Stevens et al.
6,172,124 B1 1/2001 Wolflick et al.
6,173,775 B1 1/2001 Elias et al.
6,187,465 B1 2/2001 Galloway
6,192,748 B1 2/2001 Miller
6,193,010 B1 2/2001 Minto
6,196,350 B1 3/2001 Minto
6,209,640 B1 4/2001 Reimers et al.
6,234,259 B1 5/2001 Kuckes
6,244,338 B1 6/2001 Mones
6,257,334 B1 7/2001 Cyr et al.
6,269,310 B1 7/2001 Washbourne
6,288,372 B1 9/2001 Sandberg et al.
6,328,104 B1 12/2001 Graue
6,353,706 B1 3/2002 Bridges
6,354,373 B1 3/2002 Vercaemer et al.
6,357,526 B1 3/2002 Abdel-Halim et al.
6,388,947 B1 5/2002 Washbourne et al.
6,389,814 B2 5/2002 Viteri et al.
6,412,559 B1 7/2002 Gunter et al.
6,422,318 B1 7/2002 Rider
6,427,124 B1 7/2002 Dubinsky et al.
6,429,784 B1 8/2002 Beique et al.
6,466,020 B2 10/2002 Kuckes
6,485,232 B1 11/2002 Vinegar et al.
6,540,018 B1 4/2003 Vinegar
6,581,684 B2 6/2003 Wellington et al.
6,584,406 B1 6/2003 Harmon et al.
6,585,046 B2 7/2003 Neuroth et al.
6,588,266 B2 7/2003 Tubel et al.
6,588,503 B2 7/2003 Karanikas et al.
6,588,504 B2 7/2003 Wellington et al.
6,591,906 B2 7/2003 Wellington et al.
6,591,907 B2 7/2003 Zhang et al.
6,607,033 B2 8/2003 Wellington et al.
6,609,570 B2 8/2003 Wellington et al.
6,609,761 B1 8/2003 Ramey et al.
6,679,326 B2 1/2004 Zakiewicz
6,679,332 B2 1/2004 Vinegar et al.
6,684,948 B1 2/2004 Savage
6,688,387 B1 2/2004 Wellington et al.
6,698,515 B2 3/2004 Karanikas et al.
6,702,016 B2 3/2004 de Rouffignac et al.
6,708,758 B2 3/2004 de Rouffignac et al.
6,712,135 B2 3/2004 Wellington et al.
6,712,136 B2 3/2004 de Rouffignac et al.
6,712,137 B2 3/2004 Vinegar et al.
6,715,546 B2 4/2004 Vinegar et al.
6,715,547 B2 4/2004 Vinegar et al.
6,715,548 B2 4/2004 Wellington et al.
6,715,549 B2 4/2004 Wellington et al.
6,719,047 B2 4/2004 Fowler et al.
6,722,429 B2 4/2004 de Rouffignac et al.
6,722,430 B2 4/2004 Vinegar et al.
6,722,431 B2 4/2004 Karanikas et al.
6,725,920 B2 4/2004 Zhang et al.
6,725,921 B2 4/2004 de Rouffignac et al.
6,725,928 B2 4/2004 Vinegar et al.
6,729,395 B2 5/2004 Shahin, Jr. et al.
6,729,396 B2 5/2004 Vinegar et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,736,215 B2 5/2004 Maher et al.
6,739,393 B2 5/2004 Vinegar et al.
6,739,394 B2 5/2004 Vinegar et al.
6,742,587 B2 6/2004 Vinegar et al.
6,742,588 B2 6/2004 Wellington et al.
6,742,589 B2 6/2004 Berchenko et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,749,021 B2 6/2004 Vinegar et al.
6,752,210 B2 6/2004 de Rouffignac et al.
6,758,268 B2 7/2004 Vinegar et al.
6,761,216 B2 7/2004 Vinegar et al.
6,763,886 B2 7/2004 Schoeling et al.
6,769,483 B2 8/2004 de Rouffignac et al.
6,769,485 B2 8/2004 Vinegar et al.
6,782,947 B2 8/2004 de Rouffignac et al.
6,805,194 B2 10/2004 Davidson et al.
6,805,195 B2 10/2004 Vinegar et al.
6,820,688 B2 11/2004 Vinegar et al.
6,854,534 B2 2/2005 Livingstone
6,854,929 B2 2/2005 Vinegar et al.
6,866,097 B2 3/2005 Vinegar et al.
6,871,707 B2 3/2005 Karanikas et al.
6,877,554 B2 4/2005 Stegemeier et al.
6,877,555 B2 4/2005 Karanikas et al.
6,880,633 B2 4/2005 Wellington et al.
6,880,635 B2 4/2005 Vinegar et al.
6,910,537 B2 6/2005 Brown et al.
6,913,079 B2 7/2005 Tubel
6,918,443 B2 7/2005 Wellington et al.
6,918,444 B2 7/2005 Passey
6,923,257 B2 8/2005 Wellington et al.
6,923,258 B2 8/2005 Wellington et al.
6,929,067 B2 8/2005 Vinegar et al.
6,932,155 B2 * 8/2005 Vinegar et al. ..... 166/245
6,942,037 B1 9/2005 Arnold
6,948,562 B2 * 9/2005 Wellington et al. ..... 166/272.1
6,948,563 B2 9/2005 Wellington et al.
6,951,247 B2 10/2005 de Rouffignac et al.
6,951,250 B2 10/2005 Reddy et al.
6,953,087 B2 10/2005 de Rouffignac et al.
6,958,704 B2 10/2005 Vinegar et al.
6,959,761 B2 11/2005 Berchenko et al.
6,964,300 B2 11/2005 Vinegar et al.
6,966,372 B2 11/2005 Wellington et al.
6,966,374 B2 11/2005 Vinegar et al.
6,969,123 B2 11/2005 Vinegar et al.
6,973,967 B2 12/2005 Stegemeier et al.
6,981,548 B2 1/2006 Wellington et al.
6,981,553 B2 1/2006 Stegemeier et al.
6,991,032 B2 1/2006 Berchenko et al.
6,991,033 B2 1/2006 Wellington et al.
6,991,045 B2 1/2006 Vinegar et al.
6,994,169 B2 2/2006 Zhang et al.
6,997,518 B2 2/2006 Vinegar et al.
7,004,247 B2 2/2006 Cole et al.
7,032,660 B2 4/2006 Vinegar et al.
7,040,400 B2 5/2006 de Rouffignac et al.
7,048,051 B2 5/2006 McQueen
7,055,600 B2 6/2006 Messier et al.
7,063,145 B2 6/2006 Veenstra et al.
7,066,254 B2 6/2006 Vinegar et al.
7,066,257 B2 6/2006 Wellington et al.
7,073,578 B2 7/2006 Vinegar et al.
7,086,465 B2 8/2006 Wellington et al.
7,086,468 B2 8/2006 de Rouffignac et al.
7,090,013 B2 8/2006 Wellington et al.
7,096,941 B2 8/2006 de Rouffignac et al.
7,096,942 B1 8/2006 de Rouffignac et al.
7,096,953 B2 8/2006 de Rouffignac et al.

7,100,994 B2 9/2006 Vinegar et al.
7,104,319 B2 9/2006 Vinegar et al.
7,114,566 B2 10/2006 Vinegar et al.
7,121,341 B2 10/2006 Vinegar et al.
7,121,342 B2 10/2006 Vinegar et al.
7,128,153 B2 10/2006 Vinegar et al.
7,147,057 B2 12/2006 Steele et al.
7,147,059 B2 12/2006 Vinegar et al.
7,156,176 B2 1/2007 Vinegar et al.
7,165,615 B2 1/2007 Vinegar et al.
7,170,424 B2 1/2007 Vinegar et al.
7,204,327 B2 4/2007 Livingstone
7,219,734 B2 5/2007 Bai et al.
7,225,866 B2 6/2007 Berchenko et al.
7,320,364 B2 1/2008 Fairbanks
7,353,872 B2 4/2008 Sandberg et al.
7,357,180 B2 4/2008 Vinegar et al.
7,360,588 B2 4/2008 Vinegar et al.
7,370,704 B2 5/2008 Harris
7,383,877 B2 6/2008 Vinegar et al.
7,424,915 B2 9/2008 Vinegar et al.
7,431,076 B2 10/2008 Sandberg et al.
7,435,037 B2 10/2008 McKinzie, II
7,461,691 B2 12/2008 Vinegar et al.
7,481,274 B2 1/2009 Vinegar et al.
7,490,665 B2 2/2009 Sandberg et al.
7,500,528 B2 3/2009 McKinzie et al.
7,510,000 B2 3/2009 Pastor-Sanz et al.
7,527,094 B2 5/2009 McKinzie et al.
7,533,719 B2 5/2009 Hinson et al.
7,540,324 B2 6/2009 de Rouffignac et al.
7,549,470 B2 6/2009 Vinegar et al.
7,556,095 B2 7/2009 Vinegar
7,556,096 B2 7/2009 Vinegar et al.
2001/0049342 A1 12/2001 Passey et al.
2002/0018697 A1 2/2002 Vinegar et al.
2002/0027001 A1 3/2002 Wellington et al.
2002/0028070 A1 3/2002 Holen
2002/0029881 A1 3/2002 de Rouffignac et al.
2002/0029882 A1 3/2002 de Rouffignac et al.
2002/0029884 A1 3/2002 de Rouffignac et al.
2002/0029885 A1 3/2002 de Rouffignac et al.
2002/0033253 A1 3/2002 de Rouffignac et al.
2002/0033254 A1 3/2002 Karanikas et al.
2002/0033255 A1 3/2002 Fowler et al.
2002/0033256 A1 3/2002 Wellington et al.
2002/0033257 A1 3/2002 Shahin, Jr. et al.
2002/0033280 A1 3/2002 Schoeling et al.
2002/0034380 A1 3/2002 Maher et al.
2002/0035307 A1 3/2002 Vinegar et al.
2002/0036083 A1 3/2002 de Rouffignac et al.
2002/0036084 A1 3/2002 Vinegar et al.
2002/0036085 A1 3/2002 Bass et al.
2002/0036089 A1 3/2002 Vinegar et al.
2002/0036103 A1 3/2002 de Rouffignac et al.
2002/0038069 A1 3/2002 Wellington et al.
2002/0038705 A1 4/2002 Wellington et al.
2002/0038706 A1 4/2002 Zhang et al.
2002/0038708 A1 4/2002 Wellington et al.
2002/0038709 A1 4/2002 Wellington et al.
2002/0038710 A1 4/2002 Maher et al.
2002/0038711 A1 4/2002 de Rouffignac et al.
2002/0038712 A1 4/2002 Vinegar et al.
2002/0039486 A1 4/2002 de Rouffignac et al.
2002/0040173 A1 4/2002 de Rouffignac et al.
2002/0040177 A1 4/2002 Maher et al.
2002/0040778 A1 4/2002 Wellington et al.
2002/0040779 A1 4/2002 Wellington et al.
2002/0040780 A1 4/2002 Wellington et al.
2002/0040781 A1 4/2002 Keedy et al.
2002/0043365 A1 4/2002 Berchenko et al.
2002/0043366 A1 4/2002 Wellington et al.
2002/0043367 A1 4/2002 de Rouffignac et al.
2002/0043405 A1 4/2002 Vinegar et al.
2002/0045553 A1 4/2002 Vinegar et al.
2002/0046832 A1 4/2002 Zhang et al.
2002/0046837 A1 4/2002 Wellington et al.
2002/0046838 A1 4/2002 Karanikas et al.
2002/0046839 A1 4/2002 Vinegar et al.
2002/0046883 A1 4/2002 Wellington et al.
2002/0049358 A1 4/2002 Vinegar et al.
2002/0049360 A1 4/2002 Wellington et al.
2002/0050352 A1 5/2002 Wellington et al.
2002/0050353 A1 5/2002 Berchencko et al.
2002/0050356 A1 5/2002 Vinegar et al.
2002/0050357 A1 5/2002 Wellington et al.
2002/0052297 A1 5/2002 de Rouffignac et al.
2002/0053429 A1 5/2002 Stegemeier et al.
2002/0053431 A1 5/2002 Wellington et al.
2002/0053432 A1 5/2002 Berchenko et al.
2002/0053435 A1 5/2002 Vinegar et al.
2002/0053436 A1 5/2002 Vinegar et al.
2002/0056551 A1 5/2002 Wellington et al.
2002/0056552 A1 5/2002 Wellington et al.
2002/0057905 A1 5/2002 Wellington et al.
2002/0062051 A1 5/2002 Wellington et al.
2002/0062052 A1 5/2002 de Rouffignac et al.
2002/0062959 A1 5/2002 Wellington et al.
2002/0062961 A1 5/2002 Vinegar et al.
2002/0066565 A1 6/2002 de Rouffignac et al.
2002/0074117 A1 6/2002 Shahin, Jr. et al.
2002/0076212 A1 6/2002 Zhang et al.
2002/0077515 A1 6/2002 Wellington et al.
2002/0084074 A1 7/2002 de Rouffignac et al.
2002/0096320 A1 7/2002 Wellington et al.
2002/0104654 A1 8/2002 Vinegar et al.
2002/0108753 A1 8/2002 Vinegar et al.
2002/0112890 A1 8/2002 Wentworth et al.
2002/0112987 A1 8/2002 Hou et al.
2002/0117303 A1 8/2002 Vinegar et al.
2002/0132862 A1 9/2002 Vinegar et al.
2002/0153141 A1 10/2002 Hartman et al.
2002/0170708 A1 11/2002 Vinegar et al.
2002/0191968 A1 12/2002 Vinegar et al.
2002/0191969 A1 12/2002 Wellington et al.
2003/0006039 A1 1/2003 Zhang et al.
2003/0019626 A1 1/2003 Vinegar et al.
2003/0024699 A1 2/2003 Vinegar et al.
2003/0029617 A1 2/2003 Brown et al.
2003/0038734 A1 2/2003 Hirsch et al.
2003/0051872 A1 3/2003 de Rouffignac
2003/0062154 A1 4/2003 Vinegar et al.
2003/0062164 A1 4/2003 Wellington et al.
2003/0066642 A1 4/2003 Wellington et al.
2003/0066644 A1 4/2003 Karanikas et al.
2003/0070807 A1 4/2003 Wellington et al.
2003/0075318 A1 4/2003 Keedy et al.
2003/0079877 A1 5/2003 Wellington et al.
2003/0080604 A1 5/2003 Vinegar et al.
2003/0085034 A1 5/2003 Wellington et al.
2003/0098149 A1* 5/2003 Wellington et al. ..... 166/52
2003/0098605 A1 5/2003 Vinegar et al.
2003/0100451 A1 5/2003 Messier et al.
2003/0102124 A1 6/2003 Vinegar et al.
2003/0102125 A1 6/2003 Wellington et al.
2003/0102126 A1 6/2003 Sumnu-Dindoruk et al.
2003/0102130 A1 6/2003 Vinegar et al.
2003/0111223 A1 6/2003 de Rouffignac et al.
2003/0116315 A1 6/2003 Wellington et al.
2003/0131989 A1 7/2003 Zakiewicz
2003/0131993 A1 7/2003 Zhang et al.
2003/0131994 A1 7/2003 Vinegar et al.
2003/0131995 A1 7/2003 de Rouffignac et al.
2003/0131996 A1 7/2003 Vinegar et al.
2003/0141066 A1 7/2003 Karanikas et al.
2003/0141067 A1 7/2003 de Rouffignac et al.

2003/0141068 A1 7/2003 de Rouffignac et al.
2003/0142964 A1 7/2003 Wellington et al.
2003/0146002 A1 8/2003 Vinegar et al.
2003/0148894 A1 8/2003 Vinegar et al.
2003/0155111 A1 8/2003 Vinegar et al.
2003/0157380 A1 8/2003 Assarabowski et al.
2003/0164234 A1 9/2003 de Rouffignac et al.
2003/0164238 A1 9/2003 Vinegar et al.
2003/0164239 A1 9/2003 Wellington et al.
2003/0173072 A1* 9/2003 Vinegar et al. ..... 166/66.5
2003/0173078 A1 9/2003 Wellington et al.
2003/0173080 A1 9/2003 Berchenko et al.
2003/0173081 A1 9/2003 Vingegar et al.
2003/0173088 A1 9/2003 Livingstone
2003/0178191 A1 9/2003 Maher et al.
2003/0183390 A1 10/2003 Veenstra et al.
2003/0192691 A1 10/2003 Vinegar et al.
2003/0192693 A1 10/2003 Wellington
2003/0196788 A1 10/2003 Vinegar et al.
2003/0196789 A1 10/2003 Wellington et al.
2003/0196801 A1 10/2003 Vinegar et al.
2003/0196810 A1 10/2003 Vinegar et al.
2003/0201098 A1 10/2003 Karanikas et al.
2003/0205378 A1 11/2003 Wellington et al.
2003/0209348 A1 11/2003 Ward et al.
2003/0213594 A1 11/2003 Wellington et al.
2004/0015023 A1 1/2004 Wellington et al.
2004/0020642 A1 2/2004 Vinegar et al.
2004/0035582 A1 2/2004 Zupanick
2004/0040715 A1 3/2004 Wellington et al.
2004/0069486 A1 4/2004 Vinegar et al.
2004/0140096 A1 7/2004 Sandberg et al.
2004/0144540 A1 7/2004 Sandberg et al.
2004/0144541 A1 7/2004 Picha et al.
2004/0146288 A1 7/2004 Vinegar et al.
2005/0006097 A1 1/2005 Sandberg et al.
2005/0269077 A1 12/2005 Sandberg
2005/0269088 A1 12/2005 Vinegar et al.
2005/0269089 A1 12/2005 Sandberg et al.
2005/0269090 A1 12/2005 Vinegar et al.
2005/0269091 A1 12/2005 Pastor-Sanz et al.
2005/0269092 A1 12/2005 Vinegar
2005/0269093 A1 12/2005 Sandberg et al.
2005/0269094 A1 12/2005 Harris
2005/0269095 A1 12/2005 Fairbanks
2005/0269313 A1 12/2005 Vinegar et al.
2006/0005968 A1 1/2006 Vinegar et al.
2006/0213657 A1 9/2006 Berchenko et al.
2006/0289536 A1 12/2006 Vinegar et al.
2007/0045265 A1 3/2007 McKinzie et al.
2007/0045266 A1 3/2007 Sandberg et al.
2007/0045267 A1 3/2007 Vinegar et al.
2007/0045268 A1 3/2007 Vinegar et al.
2007/0095536 A1 5/2007 Vinegar et al.
2007/0095537 A1 5/2007 Vinegar et al.
2007/0108200 A1 5/2007 McKinzie et al.
2007/0108201 A1 5/2007 Vinegar et al.
2007/0119098 A1 5/2007 Diaz et al.
2007/0131411 A1 6/2007 Vinegar et al.
2007/0131415 A1 6/2007 Vinegar et al.
2007/0131427 A1 6/2007 Li et al.
2008/0017370 A1 1/2008 Vinegar et al.
2008/0017380 A1 1/2008 Vinegar et al.
2008/0035346 A1 2/2008 Nair et al.
2008/0035347 A1 2/2008 Brady et al.
2008/0035705 A1 2/2008 Menotti
2008/0038144 A1 2/2008 Maziasz et al.
2008/0107577 A1 5/2008 Vinegar et al.
2008/0128134 A1 6/2008 Mudunuri et al.
2008/0135244 A1 6/2008 Miller et al.
2008/0135253 A1 6/2008 Vinegar et al.
2008/0135254 A1 6/2008 Vinegar et al.
2008/0142216 A1 6/2008 Vinegar et al.
2008/0142217 A1 6/2008 Pietersen et al.
2008/0173442 A1 7/2008 Vinegar et al.
2008/0173444 A1 7/2008 Stone et al.
2008/0174115 A1 7/2008 Lambirth
2008/0185147 A1 8/2008 Vinegar et al.
2008/0217003 A1 9/2008 Kuhlman et al.
2008/0217004 A1 9/2008 de Rouffignac
2008/0217015 A1 9/2008 Vinegar et al.
2008/0217016 A1 9/2008 Stegemeier et al.
2008/0217321 A1 9/2008 Vinegar et al.
2008/0236831 A1 10/2008 Hsu
2008/0277113 A1 11/2008 Stegemeier et al.
2008/0283246 A1 11/2008 Karanikas et al.
2009/0014180 A1 1/2009 Stegemeier et al.
2009/0014181 A1 1/2009 Vinegar et al.
2009/0071652 A1 3/2009 Vinegar et al.
2009/0078461 A1 3/2009 Mansure et al.
2009/0084547 A1 4/2009 Farmayan et al.
2009/0090158 A1 4/2009 Davidson et al.
2009/0090509 A1 4/2009 Vinegar et al.
2009/0095476 A1 4/2009 Nguyen et al.
2009/0095477 A1 4/2009 Nguyen et al.
2009/0095478 A1 4/2009 Karanikas et al.
2009/0095479 A1 4/2009 Karanikas et al.
2009/0095480 A1 4/2009 Vinegar et al.
2009/0101346 A1 4/2009 Vinegar et al.
2009/0120646 A1 5/2009 Kim et al.
2009/0126929 A1 5/2009 Vinegar

FOREIGN PATENT DOCUMENTS

CA 1168283 5/1984
CA 1196594 11/1985
CA 1253555 5/1989
CA 1288043 8/1991
CA 2015460 10/1991
EP 107927 5/1984
EP 130671 9/1985
EP 294809 12/1988
EP 357314 9/1993
EP 0570228 11/1993
EP 0940558 9/1999
GB 156396 1/1921
GB 674082 7/1950
GB 697189 9/1953
GB 1010023 11/1965
GB 1204405 9/1970
GB 1454324 11/1976
GB 1501310 2/1978
GB 1588693 4/1981
GB 2086416 5/1982
SE 121737 5/1948
SE 123136 11/1948
SE 123137 11/1948
SE 123138 11/1948
SE 126674 11/1949
SU 1836876 12/1990
WO 9506093 3/1995
WO 9512742 5/1995
WO 9512743 5/1995
WO 9512744 5/1995
WO 9512745 5/1995
WO 9512746 5/1995
WO 9533122 12/1995
WO 9701017 1/1997
WO 97/07321 2/1997
WO 97/23924 7/1997
WO 9850179 11/1998
WO 9901640 1/1999
WO 00/19061 4/2000
WO 0181505 11/2001
WO 0181723 11/2001

OTHER PUBLICATIONS

Kirk et al., Coal, Encyclopedia of Chemical Technology, Wiley, New York, 4th edition, 1991, vol. 6, pp. 423-488.
The VertiTrak System Brochure, Baker Hughes, INT-01-1307A4, 2001, 8 pages.
Singer et al., "Thermal, Mechanical, and Physical Properties of Selected Bituminous Coals and Cokes," US Department of Interior, Bureau of Mines, 1979, Government Report No. 8364.
Rogers, R. E., Coalbed Methane: Principles and Practice, Prentice-Hall, Inc. 1994, pp. 68-97.
Department of Energy Coal Sample Bank and Database http://www.energy.psu.edu/arg/doesb.htm, Jun. 4, 2002.
Rogers, R. E., Coalbed Methane: Principles and Practice, Prentice-Hall, Inc. 1994, pp. 164-165.
Shreve, B. Norris, Chemical Process Industries, McGraw Hill Book Company, 1956, 3rd Ed., pp. 312-316.
Hobson, G. D., Modern Petroleum Technology, Halsted Press, Applied Science Publishers Ltd. 1973, pp. 786-787.
Van Krevelen, COAL: Typology-Physics-Chemistry-Constitution, 1993, pp. 27, 42, 52, 322, 323, 324, 325, 326, 526, 527, 726.
Genrich et al., "A Simplified Performance-Predictive Model for In-situ Combustion Processes", Society of Petroleum Engineers Reservoir Engineering, May 1988, pp. 410-418.
Adegbesan et al., "Low-Temperature-Oxidation Kinetic Parameters for in-Situ Combustion: Numerical Simulation", SPE Reservoir Engineering, Nov. 1987, pp. 573-582.
"Brief: Magnetostatic Well-Tracking Technique for Drilling Horizontal Parallel Wells" J. Petroleum Technology, 1995, pp. 119-120.
Nekut et al., "Rotating Magnet Ranging—A New Drilling Guidance Technology", Vector Magnetics, Presentation, Jun. 2000, p. 1-24.
"Temperature Monitoring Using Fiber-Optic Sensors", www.steamtech.com\fiberoptics.html, Aug. 4, 2003, 6 pages.
"Fiber Optic Permanent Reservoir Monitoring Systems: Bringing a Continuous Stream of Reservoir Information to the Surface", www.SensorTran.com/DTS%20whitepaper1.pdf, downloaded Aug. 4, 2003, 13 pages.
"Catalytic Glow Plugs and Ignitors", www.holdfastmac.com.au/howglowplug.html, Aug. 4, 2003, 6 pages.
Hurtig et al., "Distributed Fiber Optics for Temperature Sensing in Building and other Structures," Proceedings of the 24th Annual Conference of the IEEE Industrial Electronics Society, Aug. 4, 1998, pp. 1829-1834.
Yamamoto et al., "Borehole Acoustic Reflection Survey Experiments in Horizontal Wells for Accurate Well Positioning", SPE/Petroleum Society of CIM, Nov. 2000, 7 pages.
Coates et al., "Single-well Sonic Imaging: High -Definition Reservoir Cross-sections from Horizontal Wells", SPE/Petroleum Society of CIM 65457, Nov. 2000, 10 pages.
Esmersoy et al., "Acoustic imaging of reservoir structure from a horizontal well", Submitted to Leading Edge, Jan. 2001, 17 pages.
Watanabe et al., "Reflector Imaging Using Borehole Acoustic Reflection Survey", Proc. Fourth Well Logging Symp. Japan, Soc. Prof. Well Log Anal., Paper Q, 1998, 8 pages.
Porter, H. P., Petroleum Dictionary for Oil, Field, and Factory, The Gulf Publishing Company, 1948, 4th Ed., p. 312.
European "International Search Report" for International Application No. PCT/EP 01/04657 mailed on Aug. 21, 2001; 3 pages.
European "International Search Report" for International Application No. PCT/EP 01/04658 mailed on Aug. 21, 2001; 2 pages.
European "International Search Report" for International Application No. PCT/EP 01/04659 mailed on Aug. 21, 2001; 2 pages.
European "International Search Report" for International Application No. PCT/EP 01/04665 mailed on Aug. 21, 2001; 3 pages.
European "International Search Report" for International Application No. PCT/EP 01/04670 mailed on Aug. 21, 2001; 2 pages.
European "International Search Report" for International Application No. PCT/EP 01/04645 mailed on Aug. 27, 2001; 3 pages.
European "International Search Report" for International Application No. PCT/EP 01/04666 mailed Dec. 21, 2001; 7 pages.
European "International Search Report" for International Application No. PCT/EP 01/11730 mailed Dec. 21, 2001; 2 pages.
European "International Search Report" for International Application No. PCT/EP 01/04644 mailed Jan. 2, 2002; 9 pages.
European "International Search Report" for International Application No. PCT/EP 01/11819 mailed Mar. 1, 2002; 2 pages.
PCT "International Search Report" for International Application No. PCT/US 02/34209 mailed on Feb. 19, 2003; 7 pages.
PCT "International Search Report" for International Application No. PCT/US 02/34212 mailed on Feb. 19, 2003; 8 pages.
PCT "International Search Report" for International Application No. PCT/US 02/34265 mailed on Feb. 19, 2003; 8 pages.
PCT "International Search Report" for International Application No. PCT/US 02/34536 mailed on Feb. 19, 2003; 7 pages.
PCT "International Search Report" for International Application No. PCT/US 02/34385 mailed on Feb. 21, 2003; 6 pages.
PCT "International Search Report" for International Application No. PCT/US 02/34207 mailed on Feb. 28, 2003; 7 pages.
PCT "International Search Report" for International Application No. PCT/US 02/12941 faxed on Apr. 30, 2003; 6 pages.
PCT "International Search Report" for International Application No. PCT/US 02/34198 mailed on May 7, 2003; 4 pages.
PCT "International Search Report" for International Application No. PCT/US 02/34201 mailed on May 7, 2003; 7 pages.
PCT "International Search Report" for International Application No. PCT/US 02/34203 mailed on May 7, 2003; 7 pages.
PCT "International Search Report" for International Application No. PCT/US 02/34210 mailed on May 7, 2003; 7 pages.
PCT "International Search Report" for International Application No. PCT/US 02/34263 mailed on May 7, 2003; 7 pages.
PCT "International Search Report" for International Application No. PCT/US 02/34266 mailed on May 7, 2003; 12 pages.
PCT "International Search Report" for International Application No. PCT/US 02/34384 mailed on May 7, 2003; 8 pages.
PCT "International Search Report" for International Application No. PCT/US 02/34533 mailed on May 7, 2003; 7 pages.
Tests of a Mechanism for H2 S Release During Coal Pyrolysis, Coburn et al., May 31, 1991, (6 pages).
Kinetic Studies of Gas Evolution During Pyrolysis of Subbituminous Coal, J. H. Campbell et al., May 11, 1976, (14 pages).
Excavation of the Partial Seam Crip Underground Coal Gasification Test Site, Robert J. Cena, Aug. 14, 1987, (11 pages).
Evolution of Sulfur Gases During Coal Pyrolysis, Oh et al., Feb. 3, 1988, (11 pages).
Coal Pyrolysis and Methane Decomposition In the Presence of a Hot Char Bed, Peters et al., Aug. 1983, (21 pages).
The Thermal and Structural Properties of the Coal in the Big Coal Seam, R.E. Glass, In Situ, 8(2), 1984, pp. 193-205.
Investigation of the Temperature Variation of the Thermal Conductivity and Thermal Diffusivity of Coal, Badzioch et al., Fuel, vol. 43, No. 4, Jul. 1964, pp. 267-280.
Pyrolysis Kinetics and Maturation of Coals from the San Juan Basin, John G. Reynolds & Alan K. Burnham, Dec. 1992, (30 pages).
Numerical Model of Coal Gasification in a Packed Bed, A.M. Winslow, Apr. 1976 (27 pages).
LLL In-Situ Coal Gasification Program, Stephens et al., Jun. 14, 1976 (12 pages).
Pyrolysis of Subbituminous Coal as it Relates to in-Situ Coal Gasification, J.H. Campbell, Jan. 17, 1977 (20 pages).
The Historical Development of Underground Coal Gasification, D. Olness & D.W. Gregg, Jun. 30, 1977 (60 pages).
Laboratory Measurements of Groundwater Leaching and Transport of Pollutants Produced During Underground Coal Gasification, V.A. Dalton & J.H. Campbell, Mar. 1, 1978 (21 pages).
The Hoe Creek II Field Experiment of Underground Coal Gasification, Preliminary Results, Aiman et al., Feb. 27, 1978 (26 pages).
Ground-Water and Subsidence Investigations of the LLL In Situ Coal Gasification Experiments, Mead et al, Jul. 17-20, 1978 (31 pages).
Geotechnical Instrumentation Applied to In Situ Coal Gasification Induced Subsidence, Ganow et al. Jun. 21, 1978 (16 pages).
The Use of Tracers in Laboratory and Field Tests of Underground Coal Gasification and Oil Shale Retorting, Lyczkowski et al., Jun. 16, 1978 (19 pages).
Underground Gasification of Rocky Mountain Coal, D.R. Stephens and R.W. Hill, Jul. 18, 1978 (15 pages).

High-BTU Gas Via In Situ Coal Gasification, Stephens et al., Oct. 1978 (41 pages).
A One-Dimensional Model for In Situ Coal Gasification, Thorsness et al., Aug. 25, 1978 (76 pages).
Control Aspects of Underground Coal Gasification: LLL Investigations of Ground-Water and Subsidence Effects, Mead et al., Nov. 10, 1978 (21 pages).
Environmental Controls for Underground Coal Gasification: Ground-Water Effects and Control Technologies, Warren Mead & Ellen Raber, Mar. 14, 1980 (19 pages).
Results from the Third LLL Underground Coal Gasification Experiment at Hoe Creek, Hill et al., May 20, 1980 (12 pages).
Results From the Hoe Creek No. 3 Underground Coal Gasification Experiment, Thorsness et al., May 1980, (11 pages).
Steam Tracer Experiment at the Hoe Creek No. 3 Underground Coal Gasification Field Test, C.B. Thorsness, Nov. 26, 1980 (51 pages).
Computer Models to Support Investigations of Surface Subsidence and Associated Ground Motion Induced by Underground Coal Gasification, R.T. Langland & B.C. Trent, Jul. 1981 (16 pages).
Burn Cavity Growth During the Hoe Creek No. 3 Underground Coal Gasification Experiment, R.W. Hill, Jun. 8, 1981 (28 pages).
The Controlled Retracting Injection Point (Crip) System: A Modified Stream Method for In Site Coal Gasification, R.W. Hill & M.J. Shannon, Apr. 15, 1981 (11 pages).
Coal Block Gasification Experiments: Laboratory Results and Field Plans: C.B. Thorsness & R.W. Hill, Jul. 1981 (23 pages).
Underground Coal Gasification—A Leading Contender in the Synfuels Industry, D.R. Stephens, Oct. 27, 1981 (42 pages).
Computer Models to Support Investigations of Surface Subsidence and Associated Ground Motion Induced by Underground Coal Gasification, B.C. Trent & R.T. Langland, Aug. 1981 (40 pages).
The Hoe Creek Experiements: LLNL's Underground Coal Gasification Project in Wyoming, D.R. Stephens, Oct. 1981 (162 pages).
Technical Underground Coal Gasification Summation: 1982 Status, Stephens et al., Jul. 1982 (22 pages).
Underground Coal Gasification Using Oxygen and Steam, Stephens et al., Jan. 19, 1984 (37 pages).
On-line, Mass Spectrometric Determination of Ammonia From Oil Shale Pyrolysis Using Isobutane Chemical Ionization, Crawford et al., Mar. 1988 (16 pages).
Catalytic Activity of Oxidized (Combusted) Oil Shale for Removal of Nitrogen Oxides with Ammonia as a Reductant in Combustion Gas Streams, Part II, Reynolds et al., Jan. 4, 1993 (9 pages).
A Laboratory Apparatus for Controlled Time/Temperature Retorting of Oil Shale, Stout et al., Nov. 1, 1976 (19 pages).
Analysis of Multiple Gas-Solid Reactions During the Gasification of Char in Oil Shale Blocks, Braun et al., Apr. 1981 (14 pages).
Wong et al., "Source and Kinetics of Sulfur Species in Oil Shale Pyrolysis Gas by Triple Quadruple Mass Spectrometry," Oct. 1983, 14 pages.
Cena et al., The Centralia Partial Seam CRIP Underground Coal Gasification Experiment, Jun. 1984, 38 pages.
Hill et al., "Results of the Centralia Underground Coal Gasification Field Test," Aug. 1984, 18 pages.
Cena et al., Excavation of the Partial Seam CRIP Underground Coal Gasification Test Site, Aug. 14, 1987, 11 pages.
Cena et al., "Assessment of the CRIP Process for Underground Coal Gasification: The Rocky Mountain I Test," Aug. 1, 1988, 22 pages.
Camp et al., "Mild Coal Gasification-Product Separation, Pilot-Unit Support, Twin Screw Heat Transfer, and H2S Evolution," Aug. 9, 1991, 12 pages.
Stone et al., "Underground Coal Gasification Site Selection and Characterization in Washington State and Gasification Test Designs," Sep. 10, 1980, 62 pages.
Schoeling et al., "Pilot Test Demonstrates How Carbon Dioxide Enhances Coal Bed Methane Recovery," Petroleum Technology Digest, Sep. 2000, pp. 14-15.
A303 Reaction Kinetics Between CO2 and Oil Shale Char, A.K. Burnham, Mar. 22, 1978 (18 pages).
A304 Reaction Kinetics Between CO2 and Oil Shale Residual Carbon. I. Effect of Heating Rate on Reactivity, Alan K. Burnham, Jul. 11, 1978 (22 pages).
A305 High-Pressure Pyrolysis of Colorado Oil Shale, Alan K. Burnham & Mary F. Singleton, Oct. 1982 (23 pages).
A306 A Possible Mechanism Of Alkene/Alkane Production in Oil Shale Retorting, A.K. Burnham, R.L. Ward, Nov. 26, 1980 (20 pages).
A307 Enthalpy Relations For Eastern Oil Shale, David W. Camp, Nov. 1987 (13 pages).
A308 Oil Shale Retorting: Part 3 A Correlation of Shale Oil 1-Alkene/n-Alkane Ratios With Yield, Coburn et al., Aug. 1, 1977 (18 pages).
A309 The Composition of Green River Shale Oil, Glen L. Cook, et al., 1968 (12 pages).
A311 Thermal Degradation of Green River Kerogen at 150° to 350° C. Rate of Production Formation, J.J. Cummins & W.E. Robinson, 1972 (18 pages).
A312 Retorting of Green River Oil Shale Under High-Pressure Hydrogen Atmospheres, LaRue et al., Jun. 1977 (38 pages).
A313 Retorting and Combustion Processes In Surface Oil-Shale Retorts, A.E. Lewis & R.L. Braun, May 2, 1980 (12 pages).
A314 Oil Shale Retorting Processes: A Technical Overview, Lewis et al., Mar. 1984 (18 pages).
A315 Study of Gas Evolution During Oil Shale Pyrolysis by TQMS, Oh et al., Feb. 1988 (10 pages).
A316 The Permittivity and Electrical Conductivity of Oil Shale, A.J. Piwinskii & A. Duba, Apr. 28, 1975 (12 pages).
A317 Oil Degradation During Oil Shale Retorting, J.H. Raley & R.L. Braun, May 24, 1976 (14 pages).
A318 Kinetic Analysis of California Oil Shale By Programmed Temperature Microphyrolysis, John G. Reynolds & Alan K. Burnham, Dec. 9, 1991 (14 pages).
A319 Analysis of Oil Shale and Petroleum Source Rock Pyrolysis by Triple Quadrupole Mass Spectrometry: Comparisons of Gas Evolution at the Heating Rate of 10° C./Min., Reynolds et al. Oct. 5, 1990 (57 pages).
A321 Fluidized-Bed Pyrolysis of Oil Shale, J.H. Richardson & E.B. Huss, Oct. 1981 (27 pages).
A322 Retorting Kinetics for Oil Shale From Fluidized-Bed Pyrolysis, Richardson et al., Dec. 1981 (30 pages).
A323 Recent Experimental Developments in Retorting Oil Shale at the Lawrence Livermore Laboratory, Albert J. Rothman, Aug. 1978 (32 pages).
A324 The Lawrence Livermore Laboratory Oil Shale Retorts, Sandholtz et al. Sep. 18, 1978 (30 pages).
A325 Operating Laboratory Oil Shale Retorts In An In-Situ Mode, W. A. Sandholtz et al., Aug. 18, 1977 (16 pages).
A326 Some Relationships of Thermal Effects to Rubble-Bed Structure and Gas-Flow Patterns in Oil Shale Retorts, W. A. Sandholtz, Mar. 1980 (19 pages).
A327 Assay Products from Green River Oil Shale, Singleton et al., Feb. 18, 1986 (213 pages).
A328 Biomarkers in Oil Shale: Occurrence and Applications, Singleton et al., Oct. 1982 (28 pages).
A329 Occurrence of Biomarkers in Green River Shale Oil, Singleton et al., Mar. 1983 (29 pages).
A330 An Instrumentation Proposal for Retorts in the Demonstration Phase of Oil Shale Development, Clyde J. Sisemore, Apr. 19, 1977, (34 pages).
A302 Pyrolysis Kinetics for Green River Oil Shale From the Saline Zone, Burnham et al., Feb. 1982 (33 pages).
A332 SO2 Emissions from the Oxidation of Retorted Oil Shale, Taylor et al., Nov. 1981 (9 pages).
A333 Nitric Oxide (NO) Reduction by Retorted Oil Shale, R.W. Taylor & C.J. Morris, Oct. 1983 (16 pages).
A334 Coproduction of Oil and Electric Power from Colorado Oil Shale, P. Henrik Wallman, Sep. 24, 1991 (20 pages).
A335 13C NMR Studies of Shale Oil, Raymond L. Ward & Alan K. Burnham, Aug. 1982 (22 pages).
A336 Identification by 13C NMR of Carbon Types in Shale Oil and their Relationship to Pyrolysis Conditions, Raymond L. Ward & Alan K. Burnham, Sep. 1983 (27 pages).
A337 A Laboratory Study of Green River Oil Shale Retorting Under Pressure In a Nitrogen Atmosphere, Wise et al., Sep. 1976 (24 pages).

A338 Quantitative Analysis and Evolution of Sulfur-Containing Gases from Oil Shale Pyrolysis by Triple Quadrupole Mass Spectrometry, Wong et al., Nov. 1983 (34 pages).
A339 Quantitative Analysis & Kinetics of Trace Sulfur Gas Species from Oil Shale Pyrolysis by Triple Quadrupole Mass Spectrometry (TQMS), Wong et al., Jul. 5-7, 1983 (34 pages).
A340 Application of Self-Adaptive Detector System on a Triple Quadrupole MS/MS to High Expolsives and Sulfur-Containing Pyrolysis Gases from Oil Shale, Carla M. Wong & Richard W. Crawford, Oct. 1983 (17 pages).
A341 An Evaluation of Triple Quadrupole MS/MS for On-Line Gas Analyses of Trace Sulfur Compounds from Oil Shale Processing, Wong et al., Jan. 1985 (30 pages).
A301 General Model of Oil Shale Pyrolysis, Alan K. Burnham & Robert L. Braun, Nov. 1983 (22 pages).
C106 In Situ Measurement of Some Thermoporoelastic Parameters of a Granite, Berchenko et al., Poromechanics, A Tribute to Maurice Biot, 1998, p. 545-550.
D10 Tar and Pitch, G. Collin and H. Hoeke. Ullmann's Encyclopedia of Industrial Chemistry, vol. A 26, 1995, p. 91-127.
E12 Cortez et al., UK Patent Application GB 2,068,014 A, Date of Publication: Aug. 5, 1981.
E13 Wellington et al., U.S. Appl. No. 60/273,354, filed Mar. 5, 2001.
G9 Geology for Petroleum Exploration, Drilling, and Production. Hyne, Norman J. McGraw-Hill Book Company, 1984, p. 264.
A228. Some Effects of Pressure on Oil-Shale Retorting, Society of Petroleum Engineers Journal, J.H. Bae, Sep. 1969; pp. 287-292.
A229. New in situ shale-oil recovery process uses hot natural gas; The Oil & Gas Journal; May 16, 1966, p. 151.
A230. Evaluation of Downhole Electric Impedance Heating Systems for Paraffin Control in Oil Wells; Industry Applications Society 37th Annual Petroleum and Chemical Industry Conference; The Institute of Electrical and Electronics Engineers Inc., Bosch et al., Sep. 1990, pp. 223-227.
A231. New System Stops Paraffin Build-up; Petroleum Engineer, Eastlund et al., Jan. 1989, (3 pages).
A232. Oil Shale Retorting: Effects of Particle Size and Heating Rate on Oil Evolution and Intraparticle Oil Degradation; Campbell et al. In Situ 2(1), 1978, pp. 1-47.
A235. Molecular Mechanism of Oil Shale Pyrolysis in Nitrogen and Hydrogen Atmospheres, Hershkowitz et al.; Geochemistry and Chemistry of Oil Shales, American Chemical Society, May 1983 pp. 301-316.
A236. The Characteristics of a Low Temperature in Situ Shale Oil; George Richard Hill & Paul Dougan, Quarterly of the Colorado School of Mines, 1967; pp. 75-90.
A237. Direct Production Of A Low Pour Point High Gravity Shale Oil; Hill et al., I & EC Product Research and Development, 6(1), Mar. 1967; pp. 52-59.
A239. The Benefits of In Situ Upgrading Reactions to the Integrated Operations of the Orinoco Heavy-Oil Fields and Downstream Facilities, Myron Kuhlman, Society of Petroleum Engineers, Jun. 2000; pp. 1-14.
A240. Monitoring Oil Shale Retorts by Off-Gas Alkene/Alkane Ratios, John H. Raley, Fuel, vol. 59, Jun. 1980, pp. 419-424.
A241. The Shale Oil Question, Old and New Viewpoints, A Lecture in the Engineering Science Academy, Dr. Fredrik Ljungstrom, Feb. 23, 1950, published in Teknisk Trdskrift, Jan. 1951 p. 33-40.
A242. Underground Shale Oil Pyrolysis According to the Ljungstroem Method; Svenska Skifferolje Aktiebolaget (Swedish Shale Oil Corp.), IVA, vol. 24, 1953, No. 3, pp. 118-123.
A243. Kinetics of Low-Temperature Pyrolysis of Oil Shale by the IITRI RF Process, Sresty et al.; 15th Oil Shale Symposium, Colorado School of Mines, Apr. 1982 pp. 1-13.
A245. Application of a Microretort to Problems in Shale Pyrolysis, A. W. Weitkamp & L.C. Gutberlet, Ind. Eng. Chem. Process Des. Develop. vol. 9, No. 3, 1970, pp. 386-395.
A246. Oil Shale, Yen et al., Developments in Petroleum Science 5, 1976, pp. 187-189, 197-198.
A247. The Composition of Green River Shale Oils, Glenn L. Cook, et al., United Nations Symposium on the Development and Utilization of Oil Shale Resources, 1968, pp. 1-23.
A248. High-Pressure Pyrolysis of Green River Oil Shale, Burnham et al., Geochemistry and Chemistry of Oil Shales, American Chemical Society, 1983, pp. 335-351.
A249. Geochemistry and Pyrolysis of Oil Shales, Tissot et al., Geochemistry and Chemistry of Oil Shales, American Chemical Society, 1983, pp. 1-11.
A250. A Possible Mechanism of Alkene/Alkane Production, Burnham et al., Oil Shale, Tar Sands, and Related Materials, American Chemical Society, 1981, pp. 79-92.
A251. The Ljungstroem In-Situ Method of Shale Oil Recovery, G. Salomonsson, Oil Shale and Cannel Coal, vol. 2, Proceedings of the Second Oil Shale and Cannel Coal Conference, Institute of Petroleum, 1951, London, pp. 260-280.
A252. Developments in Technology for Green River Oil Shale, G.U. Dinneen, United Nations Symposium on the Development and Utilization of Oil Shale Resources, Laramie Petroleum Research Center, Bureau of Mines, 1968, pp. 1-20.
A253.The Thermal and Structural Properties of a Hanna Basin Coal, R.E. Glass, Transactions of the ASME, vol. 106, Jun. 1984, pp. 266-271.
A256. On the Mechanism of Kerogen Pyrolysis, Alan K. Burnham & James A. Happe, Jan. 10, 1984 (17 pages).
A257 Comparison of Methods for Measuring Kerogen Pyrolysis Rates and Fitting Kinetic Parameters, Burnham et al., Mar. 23, 1987, (29 pages).
A258 Further Comparison of Methods for Measuring Kerogen Pyrolysis Rates and Fitting Kinetic Parameters, Burnham et al., Sep. 1987, (16 pages).
A293 Shale Oil Cracking Kinetics and Diagnostics, Bissell et al., Nov. 1983, (27 pages).
A294 Mathematical Modeling of Modified In Situ and Aboveground Oil Shale Retorting, Robert L. Braun, Jan. 1981 (45 pages).
A295 Progress Report on Computer Model for In Situ Oil Shale Retorting, R.L. Braun & R.C.Y. Chin, Jul. 14, 1977 (34 pages).
A297 Chemical Kinetics and Oil Shale Process Design, Alan K. Burnham, Jul. 1993 (16 pages).
A298 Reaction Kinetics and Diagnostics For Oil Shale Retorting, Alan K. Burnham, Oct. 19, 1981 (32 pages).
A299 Reaction Kinetics Between Steam and Oil Shale Char, A.K. Burnham, Oct. 1978 (8 pages).
A300 General Kinetic Model of Oil Shale Pyrolysis, Alan K. Burnham & Robert L. Braun, Dec. 1984 (25 pages).
PCT "International Search Report" for International Application No. PCT/US 02/34266 mailed on May 15, 2003; 12 pages.
PCT "International Search Report" for International Application No. PCT/US 02/34272 mailed on May 15, 2003; 11 pages.
PCT "International Search Report" for International Application No. PCT/US 02/34274 mailed on Jun. 4, 2003; 9 pages.
PCT "International Search Report" for International Application No. PCT/US 02/34198 mailed on Aug. 7, 2003; 9 pages.
PCT "International Search Report" for International Application No. PCT/US 02/13311 mailed on Oct. 14, 2003; 8 pages.
PCT "International Preliminary Examination Report" for International Application No. PCT/US 02/34198 mailed on Jan. 23, 2004; 6 pages.
PCT "International Preliminary Examination Report" for International Application No. PCT/US 02/34201 mailed on Jan. 23, 2004; 5 pages.
PCT "International Preliminary Examination Report" for International Application No. PCT/US 02/34203 mailed on Jan. 23, 2004; 5 pages.
PCT "International Preliminary Examination Report" for International Application No. PCT/US 02/34207 mailed on Jan. 23, 2004; 5 pages.
PCT "International Preliminary Examination Report" for International Application No. PCT/US 02/34209 mailed on Jan. 23, 2004; 5 pages.
PCT "International Preliminary Examination Report" for International Application No. PCT/US 02/34210 mailed on Jan. 23, 2004; 5 pages.
PCT "International Preliminary Examination Report" for International Application No. PCT/US 02/34212 mailed on Jan. 23, 2004; 6 pages.

PCT "International Preliminary Examination Report" for International Application No. PCT/US 02/34263 mailed on Jan. 23, 2004; 5 pages.
PCT "International Preliminary Examination Report" for International Application No. PCT/US 02/34265 mailed on Jan. 23, 2004; 6 pages.
PCT "International Preliminary Examination Report" for International Application No. PCT/US 02/34266 mailed on Jan. 23, 2004; 9 pages.
PCT "International Preliminary Examination Report" for International Application No. PCT/US 02/34272 mailed on Jan. 23, 2004; 9 pages.
PCT "International Preliminary Examination Report" for International Application No. PCT/US 02/34274 mailed on Jan. 23, 2004; 5 pages.
PCT "International Preliminary Examination Report" for International Application No. PCT/US 02/34384 mailed on Jan. 23, 2004; 6 pages.
PCT "International Preliminary Examination Report" for International Application No. PCT/US 02/34533 mailed on Jan. 23, 2004; 5 pages.
PCT "International Preliminary Examination Report" for International Application No. PCT/US 02/34536 mailed on Jan. 23, 2004; 5 pages.
PCT "International Search Report" for International Application No. PCT/US 03/34101 mailed on Mar. 2, 2004; 7 pages.
PCT "International Search Report" for International Application No. PCT/US 03/33851 mailed on Mar. 29, 2004; 2 pages.
PCT "International Search Report" for International Application No. PCT/US 03/33850 mailed on Apr. 28, 2004; 2 pages.
PCT "International Search Report" for International Application No. PCT/US 02/34264 mailed on Dec. 2, 2004; 7 pages.
PCT "International Search Report" for International Application No. PCT/US02/13121 mailed Dec. 2004; 7 pages.
PCT "Written Opinion" for International Application No. PCT/US02/13121 mailed Feb. 24, 2005; 6 pages.
PCT "International Search Report and Written Opinion" for International Application No. PCT/US04/12784 mailed Jan. 31, 2006; 11 pages.
Moreno, James B., et al., Sandia National Laboratories, "Methods and Energy Sources for Heating Subsurface Geological Formations, Task 1: Heat Delivery Systems," Nov. 20, 2002, pp. 1-166.
BB01. Beal, C. "The Viscosity of Air, Water, Natural Gas, Crude Oil and Its Associated Gases at Oil Field Temperatures and Pressures" TP 2018 in Petroleum Technology, Mar. 1946, pp. 94-115.
BB02. Cary, J. W., Mayland, H. F., "Salt and Water Movement in Unsaturated Frozen Soil" Soil Science Society of America, Proceedings, Jul.-Aug. 1972, vol. 36, No. 4, pp. 549-555.
BB03. Dash, J. G. "Thermomolecular Pressure in Surface Melting: Motivation for Frost Heave" Science, Dec. 22, 1989, vol. 246, pp. 1591-1593.
BB04. Gross et al. "Recent Experimental Work on Solute Redistribution at the Ice/Water Interface. Implications for Electrical Properties and Interface Process" J. de Physique Colloque C1, supplement au No. 3, vol. 48, Mar. 1987, pp. C1-527-C1529.
BB05. Hallet, B. "Solute Redistribution in Freezing Ground" Proceeding of the Third International Conference on Permafrost, Edmonton, Alberta, 1978, pp. 86-91.
BB06. Harris, J.S. "Ground Freezing in Practice" Telford, 1995, pp. 1-264.
BB07. Hofmann et al. "Redistribution of Soil Water and Solutes in Fine and Coarse Textured Soils After Freezing" Proc. Intl. Symp. On Agricultural, Range, and Forest Lands, Mar. 21-22, 1990, Spokane, CCREL Special Report 90-1, K. R. Cooley, Ed., pp. 263-270.
BB09. Iskandar, I. K. "Effect of Freezing on the Level of Contaminants in Uncontrolled Hazardous Waste Sites" U.S. Army Corp of Engineers Special Report 86-19, Jul. 1986, pp. 1-33.
BB10. Oberlander et al. "Mitigative Techniques for Ground-Water Contamination Associated with Severe Nuclear Accidents", NUREG/CR-4251, PNL-5461. vol. 1, Aug. 1985, pp. 4.103-4.110.
BB11. Matthews et al. "Pressure Buildup and Flow Tests in Wells" Society of Petroleum Engineers, 1967, pp. 1-172.
BB12. Sanger, F. J. "Ground Freezing in Construction" J. Proceedings of the American Society of Civil Engineers, Jan. 1968, pp. 131-156.
BB13. Sullivan, Jr. et al. "Comparison of Numerical Simulations with Experimental Data for a Prototype Artificial Ground Freezing" Proc. Intl. Symp. On Frozen Soil Impacts on Agricultural, Range, and Forest Lands, CCREL Special Report 90-1, K. R. Cooley, ed., pp. 36-43.
BB14. Swatzell et al. "Frozen Soil Barrier Technology" U.S. Dept. Of Energy, Innovative Technology Summary Report, Apr. 1995, 32 pp.
BB15. "Frozen Soil Barrier" U.S. Dept. of Energy, Innovative Technology Summary Report, DOE/EM-0483, Oct. 1999, 27 pp.
T02 Burnham, Alan, K. "Oil Shale Retorting Dependence of timing and composition on temperature and heating rate", Jan. 27, 1995, (23 pages).
T04 Campbell, et al., "Kinetics of oil generation from Colorado Oil Shale" IPC Business Press, Fuel, 1978, (3 pages).
T07 Hill et al., "The Characteristics of a Low Temperature in situ Shale Oil" American Institute of Mining, Metallurgical & Petroleum Engineers, 1967 (pp. 75-90).
T13 SSAB report, "A Brief Description of the Ljungstrom Method for Shale Oil Production," 1950, (12 pages).
T14 Salomonsson G., SSAB report, The Lungstrom In Situ-Method for Shale Oil Recovery, 1950 (28 pages).
T15 "Swedish shale oil-Production method in Sweden," Organisation for European Economic Co-operation, 1952, (70 pages).
T16 SSAB report, "Kvarn Torp" 1958, (36 pages).
T17 SSAB report, "Kvarn Torp" 1951 (35 pages).
T19 Vogel et al. "An Analog Computer for Studying Heat Transfrer during a Thermal Recovery Process," AIME Petroleum Transactions, 1955 (pp. 205-212).
T20 "Skiferolja Genom Uppvarmning Av Skifferberget," Faxin Department och Namder, 1941, (3 pages).
T22 Ronnby, E. "Kvarntorp-Sveriges Storsta skifferoljeindustri," 1943, (9 pages).
T23 SAAB report, "The Swedish Shale Oil Industry," 1948 (8 pages).
T24 Gejrot et al., "The Shale Oil Industry in Sweden," Carlo Colombo Publishers-Rome, Proceedings of the Fourth World Petroleum Congress, 1955 (8 pages).
T25 Hedback, T. J., The Swedish Shale as Raw Material for Production of Power, Oil and Gas, XIth Sectional Meeting World Power Conference, 1957 (9 pages).
T26 SAAB, "Santa Cruz, California, Field Test of the Lins Method for the Recovery of Oil from Sand", 1955 vol. 1, (141 pages) English.
T27 SAAB, "Santa Cruz, California, Field Test of the Lins Method for the Recovery of Oil from Sand-Figures", 1955 vol. 2, (146 pages) English.
T27 SAAB, "Santa Cruz, California, Field Test of the Lins Method for the Recovery of Oil from Sand-Figures", 1955 vol. 2, (146 pages) English.
T28 "Santa Cruz, California, Field Test of the Lins Method for the Recovery of Oil from Sand-Memorandum re: tests", 1955 vol. 3, (256 pages) English.
T29 Helander, R.E., "Santa Cruz, California, Field Test of Carbon Steel Burner Casings for the Lins Method of Oil Recovery", 1959 (38 pages) English.
T30 Helander et al., Santa Cruz, California, Field Test of Fluidized Bed Burners for the Lins Method of Oil Recovery 1959, (86 pages) English.
T31 SSAB report, "Bradford Residual Oil, Athabasa Ft. McMurray" 1951, (207 pages), partial translation.
T32 "Lins Burner Test Results-English" 1959-1960.
T37 SSAB report, "Assessment of Future Mining Alternatives of Shale and Dolomite," 1962, (59 pages) Swedish.
T38 SSAB report. "Kartong 2 Shale: Ljungstromsanlaggningen" (104 pages) Swedish.
T40 SAAB report, "Swedish Geological Survey Report, Plan to Delineate Oil shale Resource in Narkes Area (near Kvarntorp)," 1941 (13 pages). Swedish.
T33 SSAB "Annual Reports, SSAB Laboratory, Address Annually Issues-Shale and Ash, Oil, Gas, Waste Water, Analytical," 1953-1954, 166 pages. (Swedish).

T36 SSAB report, "Cost Comparison of Mining and Processing of Shale and Dolomite Using Various Production Alternatives", 1960; 64 pages. (Swedish).

T41 SAAB report, "Recovery Efficiency," 1941, (61 pages). Swedish.

T42 SAAB report, "Geologic Work Conducted to Assess Possibility of Expanding Shale Mining Area in Kvarntorp; Drilling Results, Seismic Results," 1942 (79 pages). Swedish.

T43 SSAB report, "Ojematinigar vid Norrtorp," 1945 (141 pages).

T44 SSAB report, "Inhopplingschema, Norrtorp II 20/3-17/8", 1945 (50 pages). Swedish.

T45 SSAB report, "Secondary Recovery after LINS," 1945 (78 pages).

T46 SSAB report, "Maps and Diagrams, Geology," 1947 (137 pages). Swedish.

T47 SSAB report, Styrehseprotoholl, 1943 (10 pages). Swedish.

T48 SSAB report, "Early Shale Retorting Trials" 1951-1952, (134 pages). Swedish.

T49 SSAB report, "Analysis of Lujunstrom Oil and its Use as Liquid Fuel," Thesis by E. Pals, 1949 (83 pages). Swedish.

T50 SSAB report, "Environmental Sulphur and Effect on Vegetation," 1951 (50 pages). Swedish.

T51 SSAB report, "Tar Sands", vol. 135 1953 (20 pages, pp. 12-15 translated). Swedish.

T52 SSAB report, "Assessment of Skanes Area (Southern Sweden) Shales as Fuel Source," 1954 (54 pages). Swedish.

T53 SSAB report, "From as Utre Dn Text Geology Reserves," 1960 (93 pages). Swedish.

T54 SSAB report, "Kvarntorps-Environmental Area Asessment," 1981 (50 pages). Swedish.

U.S. Patent and Trademark Office, "Office Communication," for U.S. Appl. No. 11/788,861 mailed Dec. 16, 2008; available in PAIR.

* cited by examiner

THERMAL PROCESSES FOR SUBSURFACE FORMATIONS

PRIORITY CLAIM

This application is a continuation of U.S. patent application Ser. No. 11/582,567 filed Oct. 17, 2006 now U.S. Pat. No. 7,360,588 to Vinegar et al., which is a continuation of application Ser. No. 10/831,351, filed Apr. 23, 2004, now U.S. Pat. No. 7,121,342 to Vinegar et al, each of which is incorporated by reference as if fully set forth herein. This application claims priority to Provisional Patent Application No. 60/465,279 entitled "ICP IMPROVEMENTS" filed on Apr. 24, 2003, and to Provisional Patent Application No. 60/514,593 entitled "IN SITU THERMAL PROCESSING OF A HYDROCARBON CONTAINING FORMATION" filed on Oct. 24, 2003.

RELATED PATENTS

This patent application incorporates by reference in its entirety U.S. Pat. No. 6,991,045 to Vinegar et al.

BACKGROUND

1. Field of the Invention

The present invention relates generally to methods and systems for production of hydrocarbons, hydrogen, and/or other products from various subsurface formations such as hydrocarbon containing formations.

2. Description of Related Art

Hydrocarbons obtained from subterranean (e.g., sedimentary) formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations. Chemical and/or physical properties of hydrocarbon material in a subterranean formation may need to be changed to allow hydrocarbon material to be more easily removed from the subterranean formation. The chemical and physical changes may include in situ reactions that produce removable fluids, composition changes, solubility changes, density changes, phase changes, and/or viscosity changes of the hydrocarbon material in the formation. A fluid may be, but is not limited to, a gas, a liquid, an emulsion, a slurry, and/or a stream of solid particles that has flow characteristics similar to liquid flow.

A wellbore may be formed in a formation. In some embodiments, logging while drilling (LWD), seismic while drilling (SWD), and/or measurement while drilling (MWD) techniques may be used to determine a location of a wellbore while the wellbore is being drilled. Examples of these techniques are disclosed in U.S. Pat. No. 5,899,958 to Dowell et al.; U.S. Pat. No. 6,078,868 to Dubinsky; U.S. Pat. No. 6,084,826 to Leggett, III; U.S. Pat. No. 6,088,294 to Leggett, III et al.; and U.S. Pat. No. 6,427,124 to Dubinsky et al., each of which is incorporated by reference as if fully set forth herein.

In some embodiments, a casing or other pipe system may be placed or formed in a wellbore. U.S. Pat. No. 4,572,299 issued to Van Egmond et al., which is incorporated by reference as if fully set forth herein, describes spooling an electric heater into a well. In some embodiments, components of a piping system may be welded together. Quality of formed wells may be monitored by various techniques. In some embodiments, quality of welds may be inspected by a hybrid electromagnetic acoustic transmission technique known as EMAT. EMAT is described in U.S. Pat. No. 5,652,389 to Schaps et al.; U.S. Pat. No. 5,760,307 to Latimer et al.; U.S. Pat. No. 5,777,229 to Geier et al.; and U.S. Pat. No. 6,155,117 to Stevens et al., each of which is incorporated by reference as if fully set forth herein.

In some embodiments, an expandable tubular may be used in a wellbore. Expandable tubulars are described in U.S. Pat. No. 5,366,012 to Lohbeck, and U.S. Pat. No. 6,354,373 to Vercaemer et al., each of which is incorporated by reference as if fully set forth herein.

Heaters may be placed in wellbores to heat a formation during an in situ process. Examples of in situ processes utilizing downhole heaters are illustrated in U.S. Pat. No. 2,634,961 to Ljungstrom; U.S. Pat. No. 2,732,195 to Ljungstrom; U.S. Pat. No. 2,780,450 to Ljungstrom; U.S. Pat. No. 2,789,805 to Ljungstrom; U.S. Pat. No. 2,923,535 to Ljungstrom; and U.S. Pat. No. 4,886,118 to Van Meurs et al.; each of which is incorporated by reference as if fully set forth herein.

Application of heat to oil shale formations is described in U.S. Pat. No. 2,923,535 to Ljungstrom and U.S. Pat. No. 4,886,118 to Van Meurs et al. Heat may be applied to the oil shale formation to pyrolyze kerogen in the oil shale formation. The heat may also fracture the formation to increase permeability of the formation. The increased permeability may allow formation fluid to travel to a production well where the fluid is removed from the oil shale formation. In some processes disclosed by Ljungstrom, for example, an oxygen containing gaseous medium is introduced to a permeable stratum, preferably while still hot from a preheating step, to initiate combustion.

A heat source may be used to heat a subterranean formation. Electric heaters may be used to heat the subterranean formation by radiation and/or conduction. An electric heater may resistively heat an element. U.S. Pat. No. 2,548,360 to Germain, which is incorporated by reference as if fully set forth herein, describes an electric heating element placed in a viscous oil in a wellbore. The heater element heats and thins the oil to allow the oil to be pumped from the wellbore. U.S. Pat. No. 4,716,960 to Eastlund et al., which is incorporated by reference as if fully set forth herein, describes electrically heating tubing of a petroleum well by passing a relatively low voltage current through the tubing to prevent formation of solids. U.S. Pat. No. 5,065,818 to Van Egmond, which is incorporated by reference as if fully set forth herein, describes an electric heating element that is cemented into a well borehole without a casing surrounding the heating element.

U.S. Pat. No. 6,023,554 to Vinegar et al., which is incorporated by reference as if fully set forth herein, describes an electric heating element that is positioned in a casing. The heating element generates radiant energy that heats the casing. A granular solid fill material may be placed between the casing and the formation. The casing may conductively heat the fill material, which in turn conductively heats the formation.

U.S. Pat. No. 4,570,715 to Van Meurs et al., which is incorporated by reference as if fully set forth herein, describes an electric heating element. The heating element has an electrically conductive core, a surrounding layer of insulating material, and a surrounding metallic sheath. The conductive core may have a relatively low resistance at high temperatures. The insulating material may have electrical resistance, compressive strength, and heat conductivity properties that are relatively high at high temperatures. The insulating layer may inhibit arcing from the core to the metallic sheath. The metallic sheath may have tensile strength and creep resistance properties that are relatively high at high temperatures.

U.S. Pat. No. 5,060,287 to Van Egmond, which is incorporated by reference as if fully set forth herein, describes an electrical heating element having a copper-nickel alloy core.

Combustion of a fuel may be used to heat a formation. Combusting a fuel to heat a formation may be more economical than using electricity to heat a formation. Several different types of heaters may use fuel combustion as a heat source that heats a formation. The combustion may take place in portions of the formation, in a well, and/or near the surface. Previous combustion methods have included using a fireflood. An oxidizer is pumped into the formation. The oxidizer and hydrocarbons in the formation are then ignited to advance a fire front towards a production well. Oxidizer pumped into the formation typically flows through the formation along fracture lines in the formation. Ignition of the oxidizer and hydrocarbons may not result in the fire front flowing uniformly through the formation.

A flameless combustor may be used to combust fuel in a well. U.S. Pat. No. 5,255,742 to Mikus; U.S. Pat. No. 5,404,952 to Vinegar et al.; U.S. Pat. No. 5,862,858 to Wellington et al.; and U.S. Pat. No. 5,899,269 to Wellington et al., which are incorporated by reference as if fully set forth herein, describe flameless combustors. Flameless combustion may be established by preheating a fuel and air mixture to a temperature above an auto-ignition temperature of the mixture. The fuel and air may be mixed in a heating zone to react. A catalytic surface may be provided in the heated zone to lower the auto-ignition temperature of the fuel and air mixture.

In some embodiments, a flameless distributed combustor may include a membrane or membranes that allow for separation of desired components of exhaust gas. Examples of flameless distributed combustors that use membranes are illustrated in U.S. Provisional Application 60/273,354 filed on Mar. 5, 2001; U.S. Patent Application Publication No. 2003-0068260 filed on Mar. 5, 2002; U.S. Provisional Application 60/273,353 filed on Mar. 5, 2001; and U.S. Patent Application Publication No. 2003-0068269 filed on Mar. 5, 2002, each of which is incorporated by reference as if fully set forth herein.

Heat may be supplied to a formation from a surface heater. The surface heater may produce combustion gases that are circulated through wellbores to heat the formation. Alternately, a surface burner may be used to heat a heat transfer fluid that is passed through a wellbore to heat the formation. Examples of fired heaters, or surface burners that may be used to heat a subterranean formation, are illustrated in U.S. Pat. No. 6,056,057 to Vinegar et al. and U.S. Pat. No. 6,079,499 to Mikus et al., which are both incorporated by reference as if fully set forth herein.

Downhole conditions may be monitored during an in situ process. Downhole conditions may be monitored using temperature sensors, pressure sensors, and other instrumentation. A thermowell and temperature logging process, such as that described in U.S. Pat. No. 4,616,705 issued to Stegemeier et al., which is incorporated by reference as if fully set forth herein, may be used to monitor temperature. Sound waves may be used to measure temperature. Using sound waves to measure temperature is described in U.S. Pat. No. 5,624,188 to West; U.S. Pat. No. 5,437,506 to Gray; U.S. Pat. No. 5,349,859 to Kleppe; U.S. Pat. No. 4,848,924 to Nuspl et al.; U.S. Pat. No. 4,762,425 to Shakkottai et al.; and U.S. Pat. No. 3,595,082 to Miller, Jr., which are incorporated by reference as if fully set forth herein.

Coal is often mined and used as a fuel in an electricity generating power plant. Most coal that is used as a fuel to generate electricity is mined. A significant number of coal formations are not suitable for economical mining. For example, mining coal from steeply dipping coal seams, from relatively thin coal seams (e.g., less than about 1 meter thick), and/or from deep coal seams may not be economically feasible. Deep coal seams include coal seams that are at, or extend to, depths of greater than about 3000 feet (about 914 m) below surface level. The energy conversion efficiency of burning coal to generate electricity is relatively low as compared to burning fuels such as natural gas. Also, burning coal to generate electricity often generates significant amounts of carbon dioxide, oxides of sulfur, and oxides of nitrogen that may be released into the atmosphere.

Some hydrocarbon formation may include oxygen containing compounds. Treating a formation that includes oxygen containing compounds may allow for the production of phenolic compounds and phenol. Separation of the phenol from a hydrocarbon mixture may be desirable. Production of phenol from a mixture of xylenols is described in U.S. Pat. No. 2,998,457 issued to Paulsen, et al., which is incorporated by reference as if fully set forth herein.

Synthesis gas may be produced in reactors or in situ in a subterranean formation. Synthesis gas may be produced in a reactor by partially oxidizing methane with oxygen. In situ production of synthesis gas may be economically desirable to avoid the expense of building, operating, and maintaining a surface synthesis gas production facility. U.S. Pat. No. 4,250,230 to Terry, which is incorporated by reference as if fully set forth herein, describes a system for in situ gasification of coal. A subterranean coal seam is burned from a first well towards a production well. Methane, hydrocarbons, $H_2$, CO, and other fluids may be removed from the formation through the production well. The $H_2$ and CO may be separated from the remaining fluid. The $H_2$ and CO may be sent to fuel cells to generate electricity.

U.S. Pat. No. 4,057,293 to Garrett, which is incorporated by reference as if fully set forth herein, discloses a process for producing synthesis gas. A portion of a rubble pile is burned to heat the rubble pile to a temperature that generates liquid and gaseous hydrocarbons by pyrolysis. After pyrolysis, the rubble is further heated, and steam or steam and air are introduced to the rubble pile to generate synthesis gas.

U.S. Pat. No. 5,554,453 to Steinfeld et al., which is incorporated by reference as if fully set forth herein, describes an ex situ coal gasifier that supplies fuel gas to a fuel cell. The fuel cell produces electricity. A catalytic burner is used to burn exhaust gas from the fuel cell with an oxidant gas to generate heat in the gasifier.

Properties of condensed hydrocarbon fluids produced by ex situ retorting of coal are reported in Great Britain Published Patent Application No. GB 2,068,014 A, which is incorporated by reference as if fully set forth herein. The properties of the condensed hydrocarbons may serve as a baseline for comparing the properties of condensed hydrocarbon fluid obtained from in situ processes.

Synthesis gas may be used in a wide variety of processes to make chemical compounds and/or to produce electricity. Synthesis gas may be converted to hydrocarbons using a Fischer-Tropsch process. U.S. Pat. No. 4,096,163 to Chang et al.; U.S. Pat. No. 4,594,468 to Minderhoud; U.S. Pat. No. 6,085,512 to Agee et al.; and U.S. Pat. No. 6,172,124 to Wolflick et al., which are incorporated by reference as if fully set forth herein, describe conversion processes. Synthesis gas may be used to produce methane. Examples of a catalytic methanation process are illustrated in U.S. Pat. No. 3,922,148 to Child; U.S. Pat. No. 4,130,575 to Jorn et al.; and U.S. Pat. No. 4,133,825 to Stroud et al., which are incorporated by reference as if fully set forth herein. Synthesis gas may be used to produce methanol. Examples of processes for production of methanol are described in U.S. Pat. Nos. 4,407,973 to van Dijk et al., U.S. Pat. No. 4,927,857 to McShea, III et al., and U.S. Pat. No. 4,994,093 to Wetzel et al., each of which is incorporated by reference as if fully set forth herein. Synthesis gas may be used to produce engine fuels. Examples of processes for producing engine fuels are described in U.S. Pat. No. 4,076,761 to Chang et al., U.S. Pat. No. 4,138,442 to Chang et al., and U.S. Pat. No. 4,605,680 to Beuther et al., each of which is incorporated by reference as if fully set forth herein.

Carbon dioxide may be produced from combustion of fuel and from many chemical processes. Carbon dioxide may be used for various purposes, such as, but not limited to, a feed stream for a dry ice production facility, supercritical fluid in a low temperature supercritical fluid process, a flooding agent for coal bed demethanation, and a flooding agent for enhanced oil recovery. Although some carbon dioxide is productively used, many tons of carbon dioxide are vented to the atmosphere. In some processes, carbon dioxide may be sequestered in a formation. U.S. Pat. No. 5,566,756 to Chaback et al., which is incorporated by reference as if fully set forth herein, describes carbon dioxide sequestration.

Retorting processes for oil shale may be generally divided into two major types: aboveground (surface) and underground (in situ). Aboveground retorting of oil shale typically involves mining and construction of metal vessels capable of withstanding high temperatures. The quality of oil produced from such retorting may be poor, thereby requiring costly upgrading. Aboveground retorting may also adversely affect environmental and water resources due to mining, transporting, processing, and/or disposing of the retorted material. Many U.S. patents have been issued relating to aboveground retorting of oil shale. Currently available aboveground retorting processes include, for example, direct, indirect, and/or combination heating methods.

In situ retorting typically involves retorting oil shale without removing the oil shale from the ground by mining. "Modified" in situ processes typically require some mining to develop underground retort chambers. An example of a "modified" in situ process includes a method developed by Occidental Petroleum that involves mining approximately 20% of the oil shale in a formation, explosively rubblizing the remainder of the oil shale to fill up the mined out area, and combusting the oil shale by gravity stable combustion in which combustion is initiated from the top of the retort. Other examples of "modified" in situ processes include the "Rubble In Situ Extraction" ("RISE") method developed by the Lawrence Livermore Laboratory ("LLL") and radio-frequency methods developed by IIT Research Institute ("IITRI") and LLL, which involve tunneling and mining drifts to install an array of radio-frequency antennas in an oil shale formation.

Obtaining permeability in an oil shale formation (e.g., between injection and production wells) tends to be difficult because oil shale is often substantially impermeable. Many methods have attempted to link injection and production wells. These methods include: hydraulic fracturing such as methods investigated by Dow Chemical and Laramie Energy Research Center; electrical fracturing (e.g., by methods investigated by Laramie Energy Research Center); acid leaching of limestone cavities (e.g., by methods investigated by Dow Chemical); steam injection into permeable nahcolite zones to dissolve the nahcolite (e.g., by methods investigated by Shell Oil and Equity Oil); fracturing with chemical explosives (e.g., by methods investigated by Talley Energy Systems); fracturing with nuclear explosives (e.g., by methods investigated by Project Bronco); and combinations of these methods. Many of these methods, however, have relatively high operating costs and lack sufficient injection capacity.

An example of an in situ retorting process is illustrated in U.S. Pat. No. 3,241,611 to Dougan, which is incorporated by reference as if fully set forth herein. Dougan discloses a method involving the use of natural gas for conveying kerogen-decomposing heat to the formation. The heated natural gas may be used as a solvent for thermally decomposed kerogen. The heated natural gas exercises a solvent-stripping action with respect to the oil shale by penetrating pores that exist in the shale. The natural gas carrier fluid, accompanied by decomposition product vapors and gases, passes through extraction wells into product recovery lines, and into and through condensers interposed in such lines, where the decomposition vapors condense, leaving the natural gas carrier fluid to flow through a heater and into an injection well drilled into the deposit of oil shale.

Large deposits of heavy hydrocarbons (e.g., heavy oil and/or tar) contained in relatively permeable formations (e.g., in tar sands) are found in North America, South America, Africa, and Asia. Tar can be surface-mined and upgraded to lighter hydrocarbons such as crude oil, naphtha, kerosene, and/or gas oil. Surface milling processes may further separate the bitumen from sand. The separated bitumen may be converted to light hydrocarbons using conventional refinery methods. Mining and upgrading tar sand is usually substantially more expensive than producing lighter hydrocarbons from conventional oil reservoirs.

U.S. Pat. No. 5,340,467 to Gregoli et al. and U.S. Pat. No. 5,316,467 to Gregoli et al., which are incorporated by reference as if fully set forth herein, describe adding water and a chemical additive to tar sand to form a slurry. The slurry may be separated into hydrocarbons and water.

U.S. Pat. No. 4,409,090 to Hanson et al., which is incorporated by reference as if fully set forth herein, describes physically separating tar sand into a bitumen-rich concentrate that may have some remaining sand. The bitumen-rich concentrate may be further separated from sand in a fluidized bed.

U.S. Pat. No. 5,985,138 to Humphreys and U.S. Pat. No. 5,968,349 to Duyvesteyn et al., which are incorporated by reference as if fully set forth herein, describe mining tar sand and physically separating bitumen from the tar sand. Further processing of bitumen in treatment facilities may upgrade oil produced from bitumen.

In situ production of hydrocarbons from tar sand may be accomplished by heating and/or injecting a gas into the formation. U.S. Pat. No. 5,211,230 to Ostapovich et al. and U.S. Pat. No. 5,339,897 to Leaute, which are incorporated by reference as if fully set forth herein, describe a horizontal production well located in an oil-bearing reservoir. A vertical conduit may be used to inject an oxidant gas into the reservoir for in situ combustion.

U.S. Pat. No. 2,780,450 to Ljungstrom describes heating bituminous geological formations in situ to convert or crack a liquid tar-like substance into oils and gases.

U.S. Pat. No. 4,597,441 to Ware et al., which is incorporated by reference as if fully set forth herein, describes contacting oil, heat, and hydrogen simultaneously in a reservoir. Hydrogenation may enhance recovery of oil from the reservoir.

U.S. Pat. No. 5,046,559 to Glandt and U.S. Pat. No. 5,060,726 to Glandt et al., which are incorporated by reference as if fully set forth herein, describe preheating a portion of a tar sand formation between an injector well and a producer well. Steam may be injected from the injector well into the formation to produce hydrocarbons at the producer well.

Substantial reserves of heavy hydrocarbons are known to exist in formations that have relatively low permeability. For example, billions of barrels of oil reserves are known to exist in diatomaceous formations in California. Several methods have been proposed and/or used for producing heavy hydrocarbons from relatively low permeability formations.

U.S. Pat. No. 5,415,231 to Northrop et al., which is incorporated by reference as if fully set forth herein, describes a method for recovering hydrocarbons (e.g., oil) from a low permeability subterranean reservoir of the type comprised primarily of diatomite. A first slug or volume of a heated fluid (e.g., 60% quality steam) is injected into the reservoir at a pressure greater than the fracturing pressure of the reservoir. The well is then shut in and the reservoir is allowed to soak for a prescribed period (e.g., 10 days or more) to allow the oil to be displaced by the steam into the fractures. The well is then produced until the production rate drops below an economical level. A second slug of steam is then injected and the cycles are repeated.

U.S. Pat. No. 4,530,401 to Hartman et al., which is incorporated by reference as if fully set forth herein, describes a method for the recovery of viscous oil from a subterranean, viscous oil-containing formation by injecting steam into the formation.

U.S. Pat. No. 4,640,352 to Van Meurs et al., which is incorporated by reference as if fully set forth herein, describes a method for recovering hydrocarbons (e.g., heavy hydrocarbons) from a low permeability subterranean reservoir of the type comprised primarily of diatomite.

U.S. Pat. No. 5,339,897 to Leaute describes a method and apparatus for recovering and/or upgrading hydrocarbons utilizing in situ combustion and horizontal wells.

U.S. Pat. No. 5,431,224 to Laali, which is incorporated by reference as if fully set forth herein, describes a method for improving hydrocarbon flow from low permeability tight reservoir rock.

U.S. Pat. No. 5,297,626 Vinegar et al. U.S. Pat. No. and 5,392,854 to Vinegar et al., which are incorporated by reference as if fully set forth herein, describe processes wherein oil containing subterranean formations are heated. The following patents are incorporated herein by reference: U.S. Pat. No. 6,152,987 to Ma et al.; U.S. Pat. No. 5,525,322 to Willms; U.S. Pat. No. 5,861,137 to Edlund; and U.S. Pat. No. 5,229,102 to Minet et al.

As outlined above, there has been a significant amount of effort to develop methods and systems to economically produce hydrocarbons, hydrogen, and/or other products from hydrocarbon containing formations. At present, however, there are still many hydrocarbon containing formations from which hydrocarbons, hydrogen, and/or other products cannot be economically produced. Thus, there is still a need for improved methods and systems for production of hydrocarbons, hydrogen, and/or other products from various hydrocarbon containing formations.

U.S. Pat. No. RE 36,569 to Kuckes, which is incorporated by reference as if fully set forth herein, describes a method for determining distance from a borehole to a nearby, substantially parallel target well for use in guiding the drilling of the borehole. The method includes positioning a magnetic field sensor in the borehole at a known depth and providing a magnetic field source in the target well.

U.S. Pat. No. 5,515,931 to Kuckes and U.S. Pat. No. 5,657,826 to Kuckes, which are incorporated by reference as if fully set forth herein, describe single guide wire systems for use in directional drilling of boreholes. The systems include a guide wire extending generally parallel to the desired path of the borehole.

U.S. Pat. No. 5,725,059 to Kuckes et al., which is incorporated by reference as if fully set forth herein, describes a method and apparatus for steering boreholes for use in creating a subsurface barrier layer. The method includes drilling a first reference borehole, retracting the drill stem while injecting a sealing material into the earth around the borehole, and simultaneously pulling a guide wire into the borehole. The guide wire is used to produce a corresponding magnetic field in the earth around the reference borehole. The vector components of the magnetic field are used to determine the distance and direction from the borehole being drilled to the reference borehole in order to steer the borehole being drilled. U.S. Pat. No. 5,512,830 to Kuckes; U.S. Pat. No. 5,676,212 to Kuckes; U.S. Pat. No. 5,541,517 to Hartmann et al.; U.S. Pat. No. 5,589,775 to Kuckes; U.S. Pat. No. 5,787,997 to Hartmann; and U.S. Pat. No. 5,923,170 to Kuckes, each of which is incorporated by reference as if fully set forth herein, describe methods for measurement of the distance and direction between boreholes using magnetic or electromagnetic fields.

During some in situ process embodiments, cement may be used. In some embodiments, sulfur cement may be utilized. U.S. Pat. No. 4,518,548 to Yarbrough and U.S. Pat. No. 4,428,700 to Lennemann, which are both incorporated by reference as if fully set forth herein, describe sulfur cements. Above about 160° C., molten sulfur changes from a form with eight sulfurs in a ring to an open chain form. When the rings open and if hydrogen sulfide is present, the hydrogen sulfide may terminate the chains, and the viscosity will not increase significantly, but the viscosity will increase. If hydrogen sulfide has been stripped from the molten sulfur, then the short chains may join and form very long molecules. The viscosity may increase dramatically. Molten sulfur may be kept in a range from about 110° C. to about 130° C. to keep the sulfur in the eight chain ring form.

SUMMARY

In some heat source embodiments and freeze well embodiments, wells in the formation may have two entries into the formation at the surface. In some embodiments, wells with two entries into the formation are formed using river crossing rigs to drill the wells.

In an embodiment, a method of treating a hydrocarbon containing formation in situ may include providing heat from one or more heaters to at least a portion of the formation. The heat may be allowed to transfer from one or more of the heaters to a section of the formation. Hydrogen may be provided to the section. A mixture may be produced from the formation. In some embodiments, a flow rate of the hydrogen may be controlled as a function of the amount of hydrogen in the mixture produced from the formation.

In an embodiment, a method of treating a hydrocarbon containing formation may include providing heat from one or more heaters to at least a portion of the formation. Hydrogen may be provided to a section of the formation. Heat may be allowed to transfer from one or more of the heaters to the section of the formation. Production of hydrogen may be controlled from production wells in the formation. In some embodiments, production of hydrogen from one or more production wells may be controlled by selectively and preferentially producing the mixture from the formation as a liquid.

In an embodiment, a method of treating a hydrocarbon containing formation in situ may include providing heat from one or more heaters to a portion of the formation. Heat may be allowed to transfer from one or more of the heaters to a section of the formation. A mixture including hydrogen and a carrier fluid may be provided to the section. In some embodiments, production of hydrogen from the formation may be controlled. In certain embodiments, formation fluid may be produced from the formation.

In an embodiment, a method of treating a hydrocarbon containing formation in situ may include providing a barrier to at least a portion of the formation to inhibit migration of fluids from a treatment area of the formation. Heat may be allowed to transfer from one or more of the heaters to a section of the formation. In some embodiments, production of hydrogen from the formation may be controlled. In certain embodiments, a mixture may be produced from the formation.

In an embodiment, a method of treating a hydrocarbon containing formation in situ may include providing a refrigerant to barrier wells placed in a portion of the formation. A frozen barrier zone may be established to inhibit migration of fluids from a treatment area. Hydrogen may be provided to the treatment area. Heat may be provided from one or more heaters to the treatment area. Heat may be allowed to transfer from one or more of the heaters to a section of the formation. In some embodiments, production of hydrogen from the section may be controlled. In certain embodiments, a mixture may be produced from the formation.

In an embodiment, a method for producing phenolic compounds from a hydrocarbon containing formation that includes an oxygen containing hydrocarbon resource may include providing heat from one or more heaters to at least a portion of the formation. The heat may be allowed to transfer from one or more of the heaters to a section of the formation. Formation fluid may be produced from the formation. In some embodiments, at least one condition in at least a portion of the formation may be controlled to selectively produce phenolic compounds in the formation fluid. In certain embodiments, controlling at least one condition includes controlling hydrogen production from the formation.

In an embodiment, a method for forming at least one opening in a geological formation may include forming a portion of an opening in the formation. An acoustic wave may be provided to at least a portion of the formation. The acoustic wave may propagate between at least one geological discontinuity of the formation and at least a portion of the opening. At least one reflection of the acoustic wave may be sensed in at least a portion of the opening. The sensed reflection may be used to assess an approximate location of at least a portion of the opening of the formation. In some embodiments, an additional portion of the opening may be formed based on the assessed approximate location of at least a portion of the opening.

In an embodiment, a method for heating a hydrocarbon formation may include providing heat to the formation from one or more heaters in one or more openings in the formation. At least a portion of one of the openings may be formed in the formation. An acoustic wave may be provided to at least a portion of the formation. The acoustic wave may propagate between at least one geological discontinuity of the formation and at least a portion of the opening. At least one reflection of the acoustic wave may be sensed in at least a portion of the opening. In some embodiments, the sensed reflection may be used to assess an approximate location of at least a portion of the opening in the formation.

In an embodiment, a method for forming a wellbore in a hydrocarbon containing formation may include forming a first opening of the wellbore beginning at the earth's surface and ending underground. A second opening of the wellbore may be formed beginning at the earth's surface and ending underground proximate the first opening. The openings may be coupled underground using an expandable conduit.

In some embodiments, a method for forming a wellbore may include forming an opening in a hydrocarbon containing formation. An explosive system may be provided to the opening. A controlled explosion may be provided in the opening using the explosive system. The controlled explosion may increase a permeability of at least some of the formation surrounding the opening. In certain embodiments, a heater may be installed in the opening.

In an embodiment, a method for treating a hydrocarbon containing formation may include providing heat from one or more heaters to at least a portion of the formation. At least one heater may be located in at least one wellbore in the formation. At least one wellbore may be sized, at least in part, based on a determination of formation expansion caused by heating of the formation so that formation expansion caused by heating of the formation is not sufficient to cause substantial deformation of one or more heaters in the sized wellbores. The ratio of the outside diameter of a heater to the inside diameter of a wellbore may be less than about 0.75. In certain embodiments, heat may be allowed to transfer from the one or more heaters to a part of the formation. In some embodiments, a mixture may be produced from the formation.

In an embodiment, a method for treating a hydrocarbon containing formation may include providing heat from one or more heaters to at least a portion of the formation. At least one of the heaters may be positioned in at least one wellbore in the formation. In some embodiments, heating from one or more of the heaters may be controlled to inhibit substantial deformation of one or more of the heaters caused by thermal formation expansion against one or more of the heaters. Heat may be allowed to transfer from one or more of the heaters to a part of the formation. In some embodiments, a mixture may be produced from the formation.

In an embodiment, a system for heating at least a part of a hydrocarbon containing formation may include an elongated heater. The elongated heater may be located in an opening in the formation. At least a portion of the formation may have a richness of at least about 30 gal/tons of hydrocarbons per ton of formation, as measured by Fischer Assay. The heater may provide heat to at least a part of the formation during use such that at least a part of the formation is heated to at least about 250° C. In some embodiments, an initial diameter of the opening may be at least 1.5 times the largest transverse cross-sectional dimension of the heater in the opening and proximate the portion of the formation being heated. The heater may be designed to inhibit deformation of the heater due to expansion of the formation caused by heating of the formation.

In some embodiments, a method for treating a hydrocarbon containing formation may include providing heat from one or more heaters. The provided heat may be allowed to transfer to one or more zones in the formation. Heating in the zones may be controlled such that a heating rate is maintained below a selected value for a selected length of time. For example, heating in the zones may be controlled such that a heating rate is maintained below about 20° C./day for at least about 15 days. In certain embodiments, heating may be controlled in zones with a selected assessed permeability and/or a selected clay content.

In an embodiment, a method for treating a hydrocarbon containing formation may include heating a first volume of the formation using a first set of heaters. A second volume of the formation may be heated using a second set of heaters. The first volume may be spaced apart from the second volume by a third volume of the formation. The first volume, second volume, and/or third volume may be sized, shaped, and/or located to inhibit deformation of subsurface equipment caused by geomechanical motion of the formation during heating.

In an embodiment, a method for treating a hydrocarbon containing formation may include heating a first volume of the formation using a first set of heaters. A second volume of the formation may be heated using a second set of heaters. In some embodiments, the first volume of the formation may be spaced apart from the second volume by a third volume of the formation. The third volume of the formation may be heated using a third set of heaters. In certain embodiments, the third set of heaters may begin heating at a selected time after the first set of heaters and the second set of heaters. Heat from the first, second, and third volumes of the formation may be allowed to transfer to at least a part of the formation. A mixture may be produced from the formation.

In an embodiment, a mixture may be produced through a production well. The production well may include one or more collection devices. Collection devices may include baffles or trays. A collection device may collect fluids that condense in an overburden section of a production well. The condensed fluids may be removed (e.g., pumped) to the surface of the production well as a liquid. Collecting condensed fluids in a collection device may inhibit fluids from refluxing into the formation.

In an embodiment, a system for heating at least a part of a subsurface formation may include an AC power supply or a modulated DC power supply and one or more electrical conductors. The one or more electrical conductors may be electrically coupled to the power supply and placed in the opening in the formation. In some embodiments, at least one of the electrical conductors may include a heater section. The heater section may include an electrically resistive ferromagnetic material. The electrically resistive ferromagnetic material may provide an electrically resistive heat output when alternating current or modulated direct current is applied to the ferromagnetic material. Due to decreasing electrical resistance of the heater section when the ferromagnetic material is near or above a selected temperature, the heater section may provide a reduced amount of heat near or above the selected temperature during use. In certain embodiments, the system may allow heat to transfer from the heater section to a part of the formation.

In an embodiment, a method for heating a subsurface formation may include applying an alternating current or modulated direct current to one or more electrical conductors located in the subsurface formation to provide an electrically resistive heat output. At least one of the electrical conductors may include an electrically resistive ferromagnetic material that provides heat when alternating current or modulated direct current flows through the electrically resistive ferromagnetic material. In some embodiments, the one or more electrical conductors that include an electrically resistive ferromagnetic material may provide a reduced amount of heat above or near a selected temperature. In certain embodiments, heat may be allowed to transfer from the electrically resistive ferromagnetic material to a part of the subsurface formation.

In an embodiment, a method for heating a subsurface formation may include applying an alternating current or modulated direct current to one or more electrical conductors placed in an opening in the formation. At least one of the electrical conductors may include one or more electrically resistive sections. An electrically resistive heat output may be provided from at least one of the electrically resistive sections. In some embodiments, at least one of the electrically resistive sections may provide a reduced amount of heat above or near a selected temperature. The reduced amount of heat may be about 20% or less of the heat output at about 50° C. below the selected temperature. In certain embodiments, heat may be allowed to transfer from at least one of the electrically resistive sections to at least a part of the formation.

In an embodiment, a method for heating a subsurface formation may include applying alternating current or modulated direct current to one or more electrical conductors placed in an opening in the formation. At least one of the electrical conductors may include an electrically resistive ferromagnetic material that provides an electrically resistive heat output when alternating current or modulated direct current is applied to the ferromagnetic material. In some embodiments, alternating current or modulated direct current may be applied to the ferromagnetic material when the ferromagnetic material is about 50° C. below a Curie temperature of the ferromagnetic material to provide an initial electrically resistive heat output. In certain embodiments, the temperature of the ferromagnetic material may be allowed to approach or rise above the Curie temperature of the ferromagnetic material. Heat output from at least one of the electrical conductors may be allowed to decline below the initial electrically resistive heat output as a result of a change in resistance of the electrical conductors caused by the temperature of the ferromagnetic material approaching or rising above the Curie temperature of the ferromagnetic material.

In an embodiment, a heater system may include a power supply to provide alternating current or modulated direct current above about 200 volts (or above about 650 volts or above about 1000 volts) and an electrical conductor comprising one or more ferromagnetic sections. The electrical conductor may be electrically coupled to the power supply. At least one of the ferromagnetic sections may provide an electrically resistive heat output during application of alternating current or modulated direct current to the electrical conductor such that heat can transfer to material adjacent to one or more of the ferromagnetic sections. In some embodiments, one or more of the ferromagnetic sections may provide a reduced amount of heat above or near a selected temperature during use. In certain embodiments, the selected temperature is at or about the Curie temperature of the ferromagnetic section.

In an embodiment, a heater system may include a power supply to provide alternating current or modulated direct current at a voltage above about 200 volts (or above about 650 volts or above about 1000 volts) and an electrical conductor coupled to the power supply. The electrical conductor may include one or more electrically resistive sections. At least one of the electrically resistive sections may include an electrically resistive ferromagnetic material. The electrical conductor may provide an electrically resistive heat output during application of the alternating current or modulated direct current to the electrical conductor. In some embodiments, the electrical conductor may provide a reduced amount of heat above or near a selected temperature. The reduced amount of heat may be about 20% or less of the heat output at about 50° C. below the selected temperature during use. In certain embodiments, the selected temperature is at or about the Curie temperature of the ferromagnetic material.

In an embodiment, a heater system may include an AC supply. An electrical conductor may be electrically coupled to the AC supply. The AC supply may provide alternating current at a frequency between about 100 Hz and about 1000 Hz. The electrical conductor may include at least one electrically resistive section. The electrically resistive section may provide an electrically resistive heat output during application of the alternating current to the electrically resistive section during use. In some embodiments, the electrical conductor may include an electrically resistive ferromagnetic material. The electrical conductor may provide a reduced amount of heat above or near a selected temperature. In certain embodiments, the selected temperature may be within about 50° C. of the Curie temperature of the ferromagnetic material.

In an embodiment, a method of heating may include providing alternating current at a frequency between about 100 Hz and about 1000 Hz to an electrical conductor to provide an electrically resistive heat output. The electrical conductor may include one or more electrically resistive sections. At least one of the electrically resistive sections may include an electrically resistive ferromagnetic material. In some embodiments, at least one of the electrically resistive sections may provide a reduced amount of heat above or near a selected temperature. In certain embodiments, the selected temperature may be within about 50° C. of the Curie temperature of the ferromagnetic material.

In an embodiment, a heater system may include an AC supply to provide alternating current at a frequency between about 100 Hz and about 1000 Hz and an electrical conductor electrically coupled to the AC supply. The electrical conductor may include at least one electrically resistive section to provide an electrically resistive heat output during application of the AC from the AC supply to the electrically resistive section during use. In some embodiments, the electrical conductor may include an electrically resistive ferromagnetic material. The electrical conductor may provide a reduced amount of heat above or near a selected temperature. The reduced amount of heat may be about 20% or less of the heat output at about 50° C. below the selected temperature. In certain embodiments, the selected temperature is at or about the Curie temperature of the ferromagnetic material.

In an embodiment, a heater may include an electrical conductor to generate an electrically resistive heat output during application of alternating current or modulated direct current to the electrical conductor. The electrical conductor may include an electrically resistive ferromagnetic material at least partially surrounding a non-ferromagnetic material such that the heater provides a reduced amount of heat above or near a selected temperature. In some embodiments, the heater may include an electrical insulator at least partially surrounding the electrical conductor. In certain embodiments, the heater may include a sheath at least partially surrounding the electrical insulator.

In an embodiment, a method of heating a subsurface formation may include providing alternating current or modulated direct current to an electrical conductor to provide an electrically resistive heat output. The electrical conductor may include an electrically resistive ferromagnetic material at least partially surrounding a non-ferromagnetic material such that the electrical conductor provides a reduced amount of heat above or near a selected temperature. In some embodiments, an electrical insulator may at least partially surround the electrical conductor. In certain embodiments, a sheath may at least partially surround the electrical insulator. Heat may be allowed to transfer from the electrical conductor to at least part of the subsurface formation.

In an embodiment, a heater may include an electrical conductor to generate an electrically resistive heat output during application of alternating current or modulated direct current to the electrical conductor. The electrical conductor may include an electrically resistive ferromagnetic alloy at least partially surrounding a non-ferromagnetic material such that the heater provides a reduced amount of heat above or near a selected temperature. The ferromagnetic alloy may include nickel. In some embodiments, an electrical insulator may at least partially surround the electrical conductor. In certain embodiments, a sheath may at least partially surround the electrical insulator.

In an embodiment, a heater may include an electrical conductor to generate an electrically resistive heat output during application of alternating current or modulated direct current to the electrical conductor. The electrical conductor may include an electrically resistive ferromagnetic material at least partially surrounding a non-ferromagnetic material such that the heater provides a reduced amount of heat above or near a selected temperature. In some embodiments, the heater may include a conduit at least partially surrounding the electrical conductor. In certain embodiments, a centralizer may maintain a separation distance between the electrical conductor and the conduit.

In an embodiment, a method of heating a subsurface formation may include providing alternating current or modulated direct current to an electrical conductor to provide an electrically resistive heat output. The electrical conductor may include an electrically resistive ferromagnetic material at least partially surrounding a non-ferromagnetic material such that the electrical conductor provides a reduced amount of heat above or near a selected temperature. In some embodiments, a conduit may at least partially surround the electrical conductor. In certain embodiments, a centralizer may maintain a separation distance between the electrical conductor and the conduit. Heat may be allowed to transfer from the electrical conductor to at least part of the subsurface formation.

In an embodiment, a heater may include an electrical conductor. The electrical conductor may generate an electrically resistive heat output when alternating electrical current is applied to the electrical conductor. The heater may include a conduit at least partially surrounding the electrical conductor. A centralizer may maintain a separation distance between the electrical conductor and the conduit. In some embodiments, the electrical conductor may include an electrically resistive ferromagnetic material at least partially surrounding a non-ferromagnetic material. In certain embodiments, the ferromagnetic material may provide a reduced amount of heat above or near a selected temperature. The reduced amount of heat may be about 20% or less of the heat output at about 50° C. below the selected temperature.

In an embodiment, a system for heating a part of a hydrocarbon containing formation may include a conduit and one or more electrical conductors to be placed in an opening in the formation. The conduit may allow fluids to be produced from the formation. At least one of the electrical conductors may include a heater section. The heater section may include an electrically resistive ferromagnetic material to provide an electrically resistive heat output when alternating current or modulated direct current is applied to the ferromagnetic material. The ferromagnetic material may provide a reduced amount of heat above or near a selected temperature during use. In some embodiments, the reduced heat output may inhibit a temperature rise of the ferromagnetic material above a temperature that causes undesired degradation of hydrocarbon material adjacent to the ferromagnetic material. In certain embodiments, the system may allow heat to transfer from the heater section to a part of the formation such that the heat reduces the viscosity of fluids in the formation and/or fluids at, near, and/or in the opening.

A temperature limited heater may have various configurations. The heater may include a ferromagnetic member exclusively or may include layers of electrical conductors (both ferromagnetic and non-ferromagnetic) and electrical insulators. Each conductor layer may include two or more ferromagnetic and/or non-ferromagnetic materials positioned along the heater axis. The current passing through a non-ferromagnetic portion of a heater may produce little or no heat output. The combination of materials may allow the resistance profile of the heater to be tailored to a desired specification.

Heater materials may be selected to enhance physical properties of a heater. For example, heater materials may be selected such that inner layers expand to a greater degree than outer layers with increasing temperature, resulting in a tight-packed structure. An outer layer of a heater may be corrosion resistant. Structural support may be provided by selecting outer layer material with high creep strength or by selecting a thick-walled conduit. Various impermeable layers may be included to inhibit metal migration through the heater.

A desired ratio of resistance (alternating current or modulated direct current) through the ferromagnetic material just below the Curie temperature to the resistance just above the Curie temperature (i.e., turndown ratio) may be achieved with a selection of ferromagnetic material. Alternatively, a desired turndown ratio may be achieved by selectively applying electrical current to the material and/or coupling the ferromagnetic material to non-ferromagnetic materials. Above the Curie temperature, resistance may be substantially independent of applied electrical current. Below the Curie temperature, resistance through the ferromagnetic material may decrease as the current increases, resulting in a lower turndown ratio.

The overall structure of a temperature limited heater may be designed to allow the heater to be spooled for deployment by a coiled tubing rig. Alternatively, a heater may be manufactured in sections and assembled on-site. A heater may include heating and non-heating sections. In some embodiments, a heating section of a heater may be placed in a wellbore proximate a portion of a hydrocarbon containing formation. A non-heating section of the heater may be placed in the wellbore proximate the overburden. In certain embodiments, a heater may have a heating section with a first Curie temperature in a wellbore proximate a portion of a hydrocarbon containing formation. The heater may have a heating section with a second Curie temperature in the wellbore proximate the overburden. The heating section in the overburden may inhibit certain formation fluids (e.g., water and light hydrocarbons) from refluxing in the wellbore proximate the hydrocarbon containing portion by maintaining fluids in the vapor phase in the wellbore proximate the overburden region.

In some embodiments, a temperature limited heater may have a fluid located in a space between an electrical conductor and a conduit. The conduit may at least partially surround the electrical conductor. The fluid may have a higher thermal conductivity than air at 1 atm and a temperature in the space. The fluid may be electrically insulating to inhibit arcing between the electrical conductor and the conduit. In some embodiments, the fluid may be helium.

In certain embodiments, an electrical power supply may provide a relatively constant amount of current to an electrical conductor in a heater (e.g., a temperature limited heater). The provided current may remain within a desired percentage of a selected constant current value when a load of the electrical conductor changes. For example, the provided current may remain within about 15% of a selected constant current value. In some embodiments, the provided current may remain within about 10% or within about 5% of a selected constant current value.

In certain embodiments, a variable capacitor may be coupled to an electrical conductor of a heater (e.g., a temperature limited heater). The variable capacitor may maintain a power factor of the electrical conductor above a selected value. For example, the variable capacitor may maintain a power factor of an electrical conductor above about 0.85, above about 0.9, or above about 0.95.

In some embodiments, a frequency of electrical current applied to an electrical conductor in a heater (e.g., a temperature limited heater) may be varied. The frequency may be varied based on one or more subsurface conditions (e.g., temperature or pressure) at or near the electrical conductor. A frequency of electrical current applied to an electrical conductor may be varied to adjust a turndown ratio of the electrical conductor.

In an embodiment, non-modulated direct current may be applied to an electrical conductor of a heater for an initial time period. The electrical conductor may include ferromagnetic material. As a temperature of the electrical conductor nears the Curie temperature of the ferromagnetic material, applied current may be switched to modulated direct current or alternating current. Switching to modulated direct current or alternating current may allow the heater to operate as a temperature limited heater at or near the Curie temperature of the ferromagnetic material.

In some embodiments, a temperature limited heater may include a support member. The support member may have a relatively high creep strength at higher temperatures (e.g., near a Curie temperature of the heater). The support member may allow more flexibility in the selection of materials for and in the design of a temperature limited heater.

In some embodiments, temperature limited heaters may be used in combination with other heaters in a wellbore. For example, a combustion heater (e.g., a downhole combustor, a natural distributed combustor, or a flameless distributed combustor) may be placed in a wellbore with a temperature limited heater. The temperature limited heater may preheat the formation, ignite combustion, and/or provide additional heat control for the combustion heater.

In an embodiment, a method for treating a hydrocarbon containing formation may include applying alternating current or modulated direct current to one or more electrical conductors located in an opening in the formation to provide an electrically resistive heat output. At least one of the electrical conductors may include an electrically resistive ferromagnetic material that provides heat when alternating current or modulated direct current flows through the electrically resistive ferromagnetic material. In some embodiments, the electrically resistive ferromagnetic material may provide a reduced amount of heat above or near a selected temperature. In certain embodiments, the heat may be allowed to transfer from the electrically resistive ferromagnetic material to a part of the formation so that a viscosity of fluids at or near the opening in the formation is reduced. Fluids may be produced through the opening.

In an embodiment, a method for treating a hydrocarbon containing formation may include applying an alternating electrical current to one or more electrical conductors located in an opening in the formation to provide an electrically resistive heat output. At least one of the electrical conductors may include an electrically resistive ferromagnetic material that provides heat when alternating current or modulated direct current flows through the electrically resistive ferromagnetic material. The electrically resistive ferromagnetic material may provide a reduced amount of heat above or near a selected temperature. In some embodiments, heat may be allowed to transfer from the electrically resistive ferromagnetic material to a part of the formation to enhance radial flow of fluids from portions of the formation surrounding the opening to the opening. In some embodiments, fluids may be produced through the opening.

In an embodiment, a method for heating a hydrocarbon containing formation may include applying an electrical current to one or more electrical conductors placed in an opening in the formation. In some embodiments, the applied electrical current may be alternating current or modulated direct current. At least one of the electrical conductors may include one or more electrically resistive sections. A heat output may be provided from at least one of the electrically resistive sections. In some embodiments, at least one of the electrically resistive sections may provide a reduced amount of heat above or near a selected temperature. The reduced amount of heat may be about 20% or less of the heat output at about 50° C. below the selected temperature. In certain embodiments, heat may be allowed to transfer from at least one of the electrically resistive sections to at least a part of the formation such that a temperature in the formation at or near the opening is maintained between about 150° C. and about 250° C. to reduce a viscosity of fluids at or near the opening in the formation. The reduced viscosity fluid may be produced through the opening. In some embodiments, reduced viscosity fluids may be gas lifted to the surface through the opening.

In an embodiment, a system for treating a formation in situ may include five or more oxidizers and one or more conduits. The oxidizers may be placed in an opening in the formation. At least one of the conduits may provide oxidizing fluid to the oxidizers, and at least one of the conduits may provide fuel to the oxidizers. The oxidizers may allow combustion of a mixture of the fuel and the oxidizing fluid to produce heat and exhaust gas. In some embodiments, at least a portion of exhaust gas from at least one of the oxidizers may be mixed with at least a portion of the oxidizing fluid provided to at least another one of the oxidizers.

In an embodiment, a method of treating a formation in situ may include providing fuel and oxidizing fluid to oxidizers positioned in an opening in the formation. At least a portion of the fuel may be mixed with at least a portion of the oxidizing fluid to form a fuel/oxidizing fluid mixture. The fuel/oxidizing fluid mixture may be ignited in the oxidizers. The fuel/oxidizing fluid mixture may be allowed to react in the oxidizers to produce heat and exhaust gas. At least a portion of the exhaust from one or more of the oxidizers may be mixed with the oxidizing fluid provided to another one or more of the oxidizers. Heat may be allowed to transfer from the exhaust gas to a portion of the formation.

In an embodiment, a system for treating a formation in situ may include one or more heater assemblies positionable in an opening in the formation. The system may include an optical sensor positionable along a length of at least one of the heater assemblies. Each heater assembly may include five or more heaters. The optical sensor may transmit one or more signals. The system may include one or more instruments to transmit light to the optical sensor and receive light backwards scattered from the optical sensor. In some embodiments, the heaters may transfer heat to the formation to establish a pyrolysis zone in the formation.

BRIEF DESCRIPTION OF THE DRAWINGS

Advantages of the present invention may become apparent to those skilled in the art with the benefit of the following detailed description and upon reference to the accompanying drawings in which:

FIG. 137 depicts an embodiment of a three-phase temperature limited heater, with a portion shown in cross section.

FIG. 138 depicts an embodiment of a three-phase temperature limited heater, with a portion shown in cross section.

FIG. 139 depicts an embodiment of temperature limited heaters coupled together in a three-phase configuration.

FIG. 140 depicts an embodiment of a temperature limited heater with current return through the formation.

FIG. 141 depicts a representation of an embodiment of a three-phase temperature limited heater with current connection through the formation.

FIG. 142 depicts an aerial view of the embodiment shown in FIG. 141.

FIG. 143 depicts a representation of an embodiment of a three-phase temperature limited heater with a common current connection through the formation.

FIG. 144 depicts an embodiment for heating and producing from a formation with a temperature limited heater in a production wellbore.

FIG. 145 depicts an embodiment for heating and producing from a formation with a temperature limited heater and a production wellbore.

FIG. 146 depicts an embodiment of a heating/production assembly that may be located in a wellbore for gas lifting.

FIG. 147 depicts an embodiment of a heating/production assembly that may be located in a wellbore for gas lifting.

FIG. 148 depicts an embodiment of a production conduit and a heater.

Figure 149:
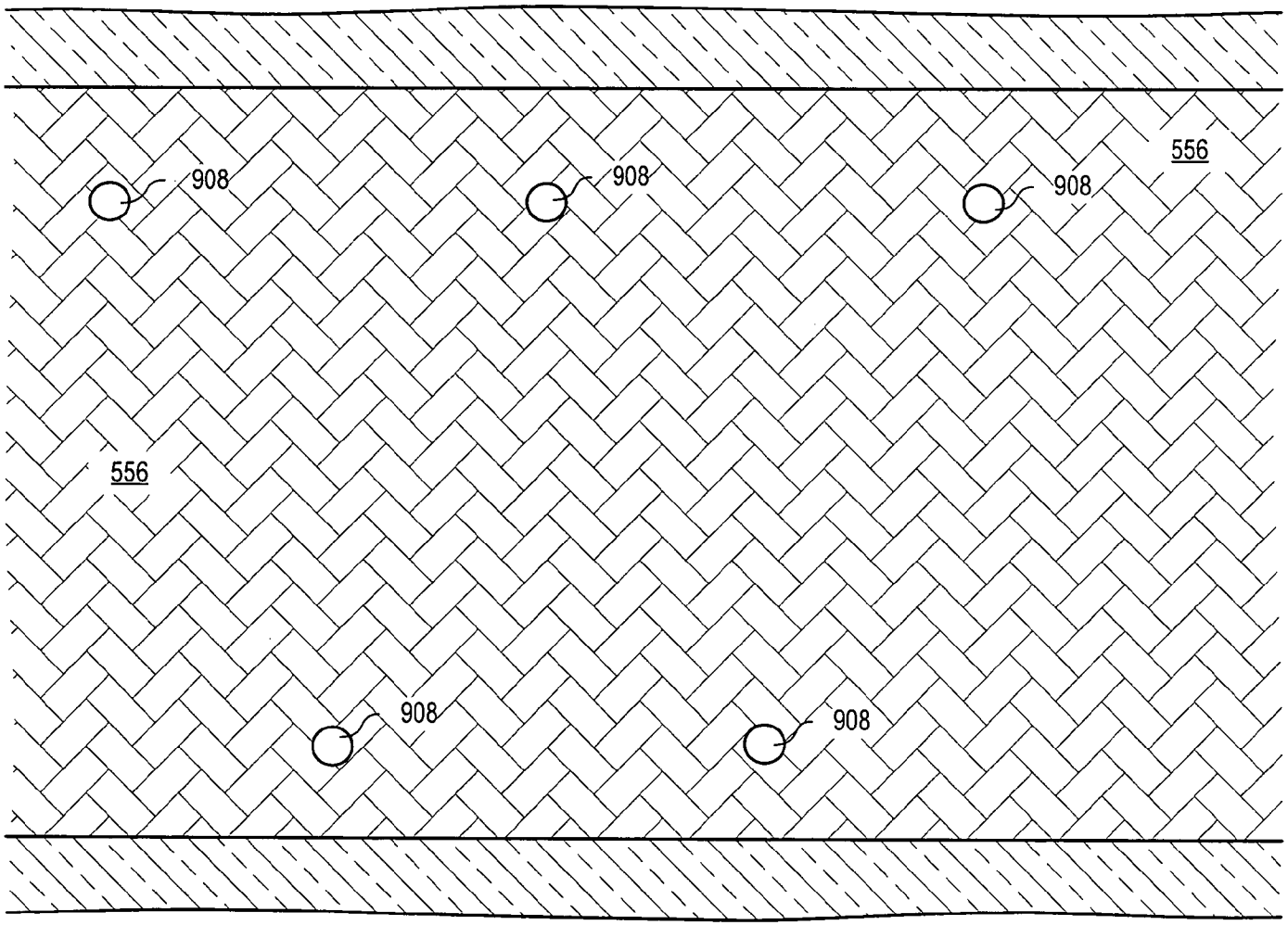

FIG. 149 depicts an embodiment for treating a formation.

Figure 150:
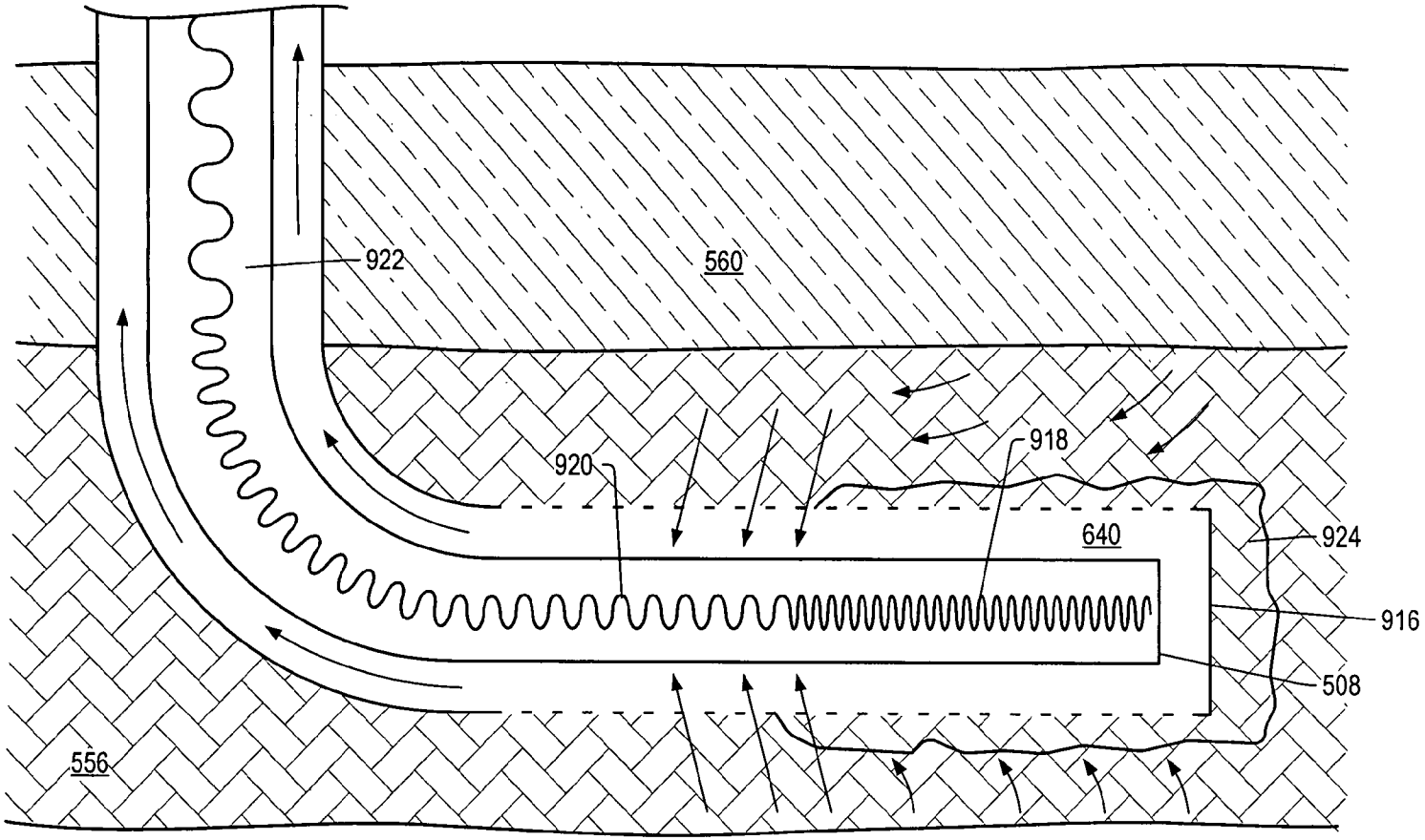

FIG. 150 depicts an embodiment of a heater well with selective heating.

Figure 151:
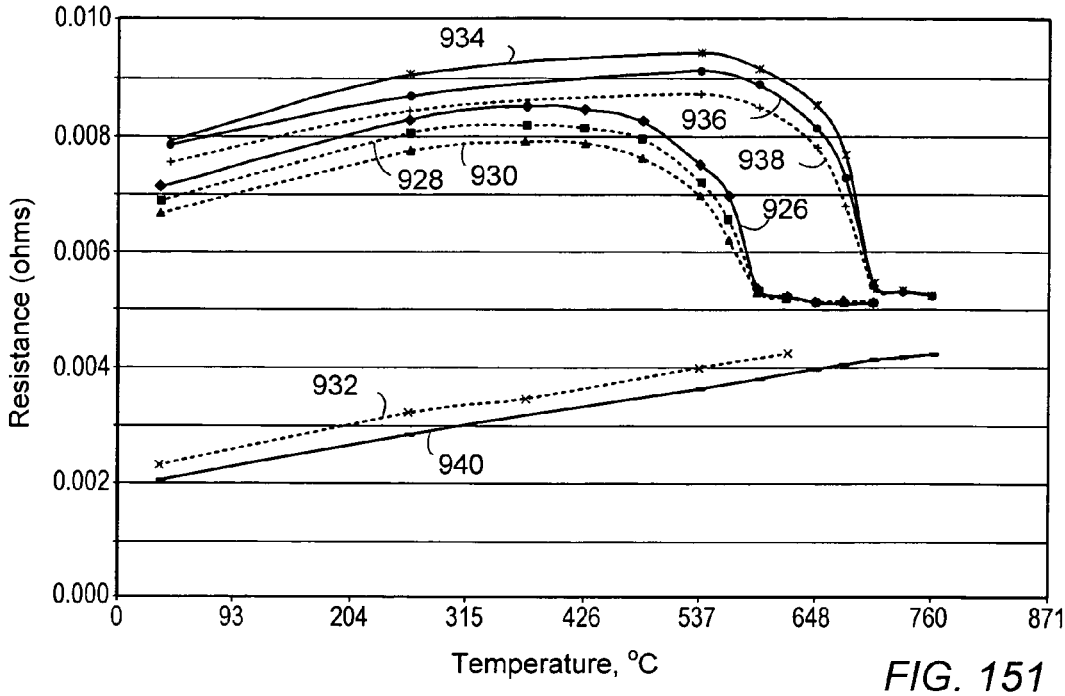

FIG. 151 depicts electrical resistance versus temperature at various applied electrical currents for a 446 stainless steel rod.

Figure 152:
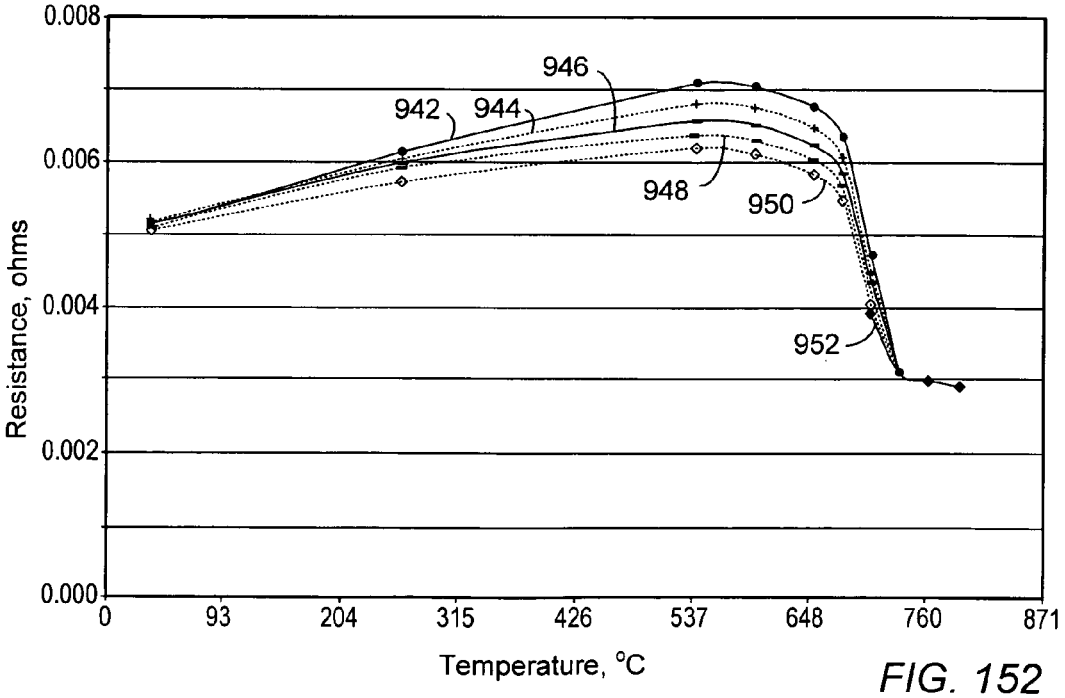

FIG. 152 shows resistance profiles as a function of temperature at various applied electrical currents for a copper rod contained in a conduit of Sumitomo HCM12A.

Figure 153:
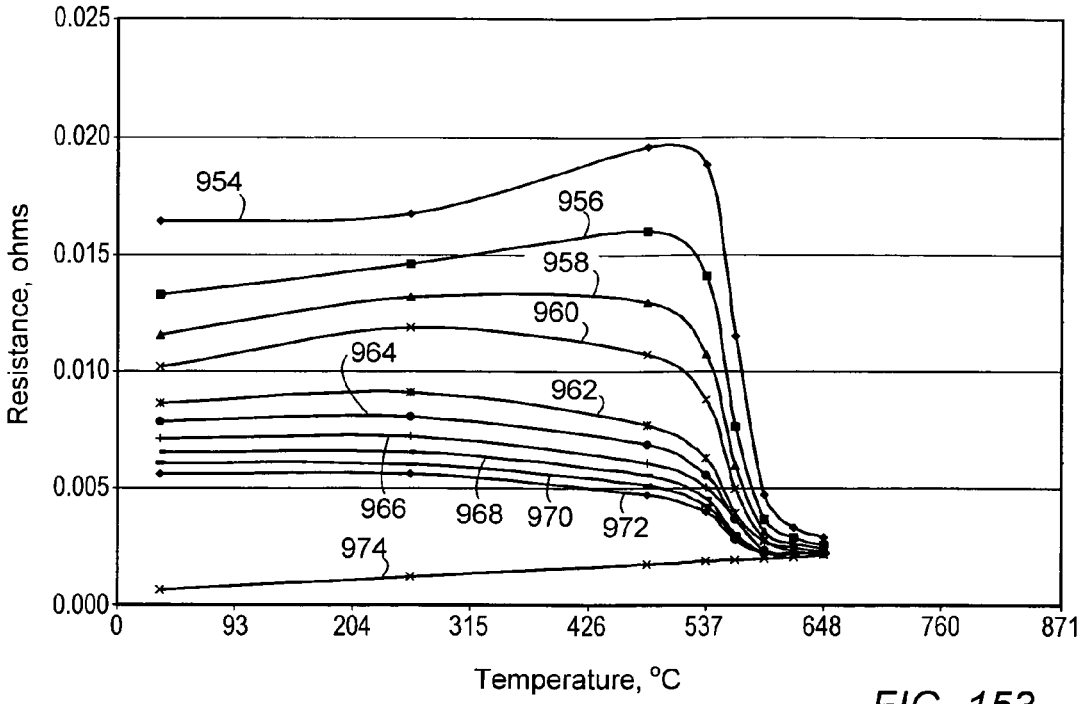

FIG. 153 depicts electrical resistance versus temperature at various applied electrical currents for a temperature limited heater.

Figure 154:
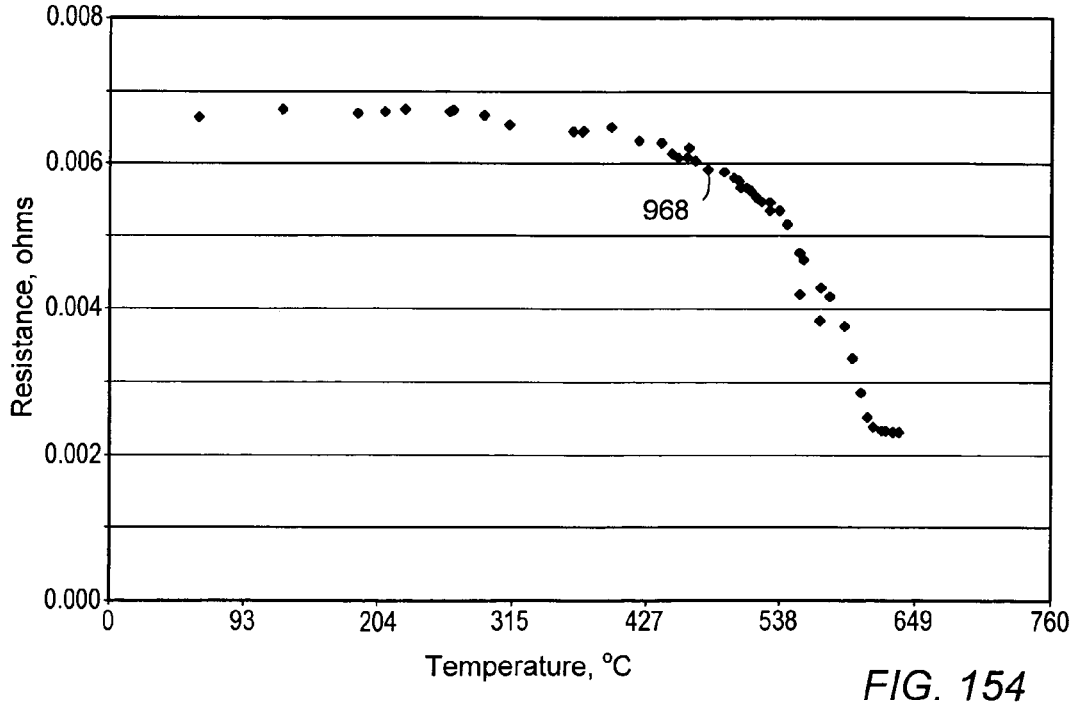

FIG. 154 depicts raw data for a temperature limited heater.

Figure 155:
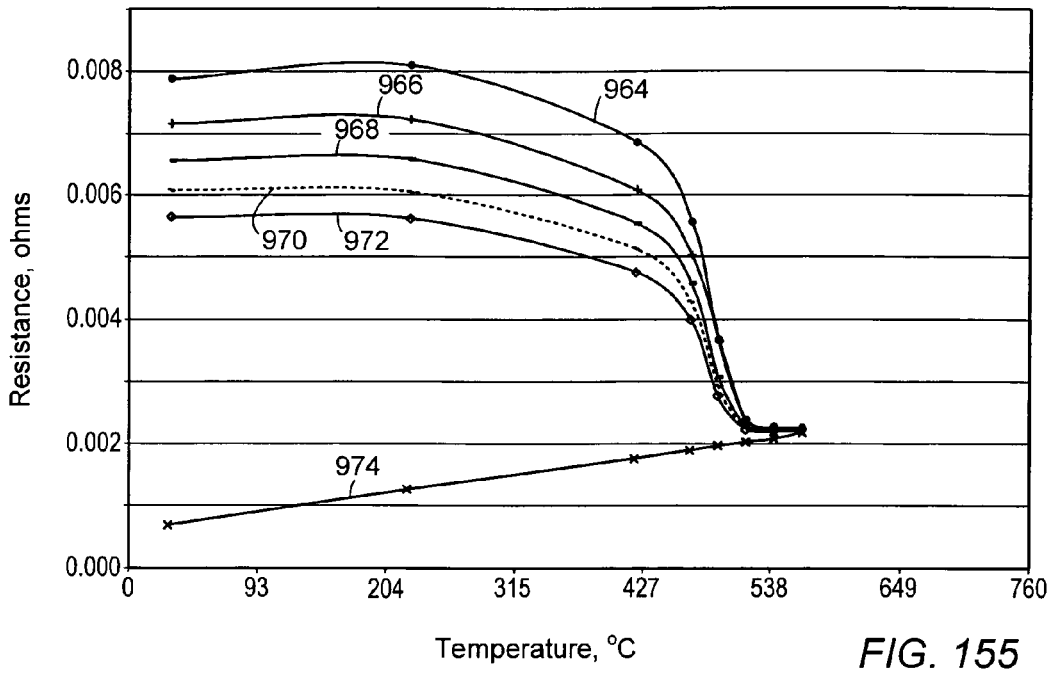

FIG. 155 depicts electrical resistance versus temperature at various applied electrical currents for a temperature limited heater.

Figure 156:
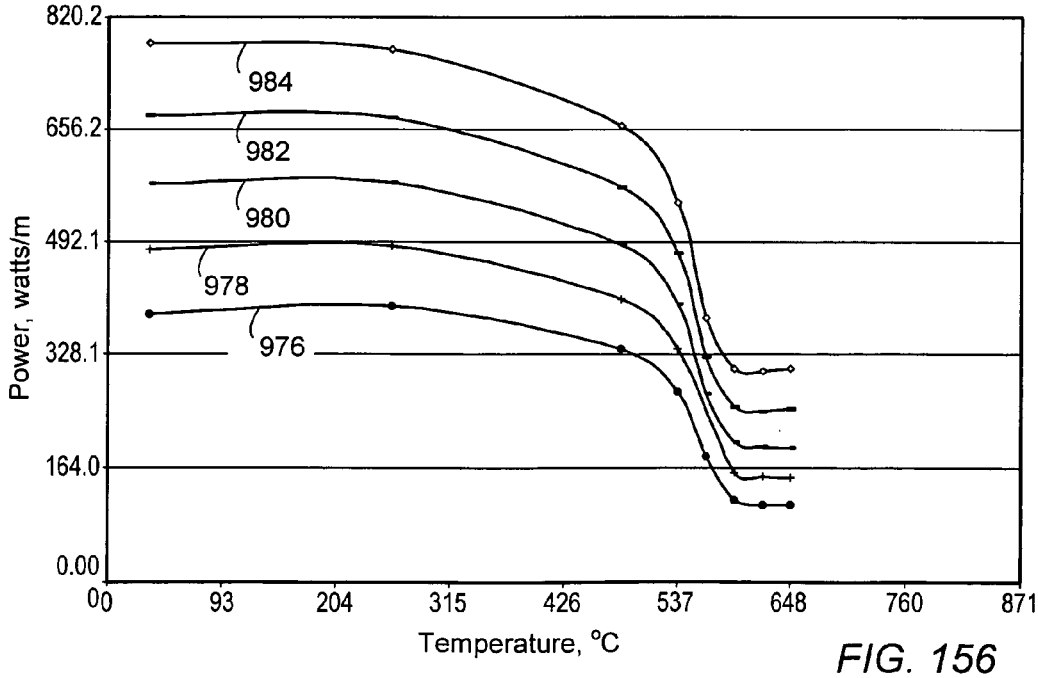

FIG. 156 depicts power versus temperature at various applied electrical currents for a temperature limited heater.

Figure 157:
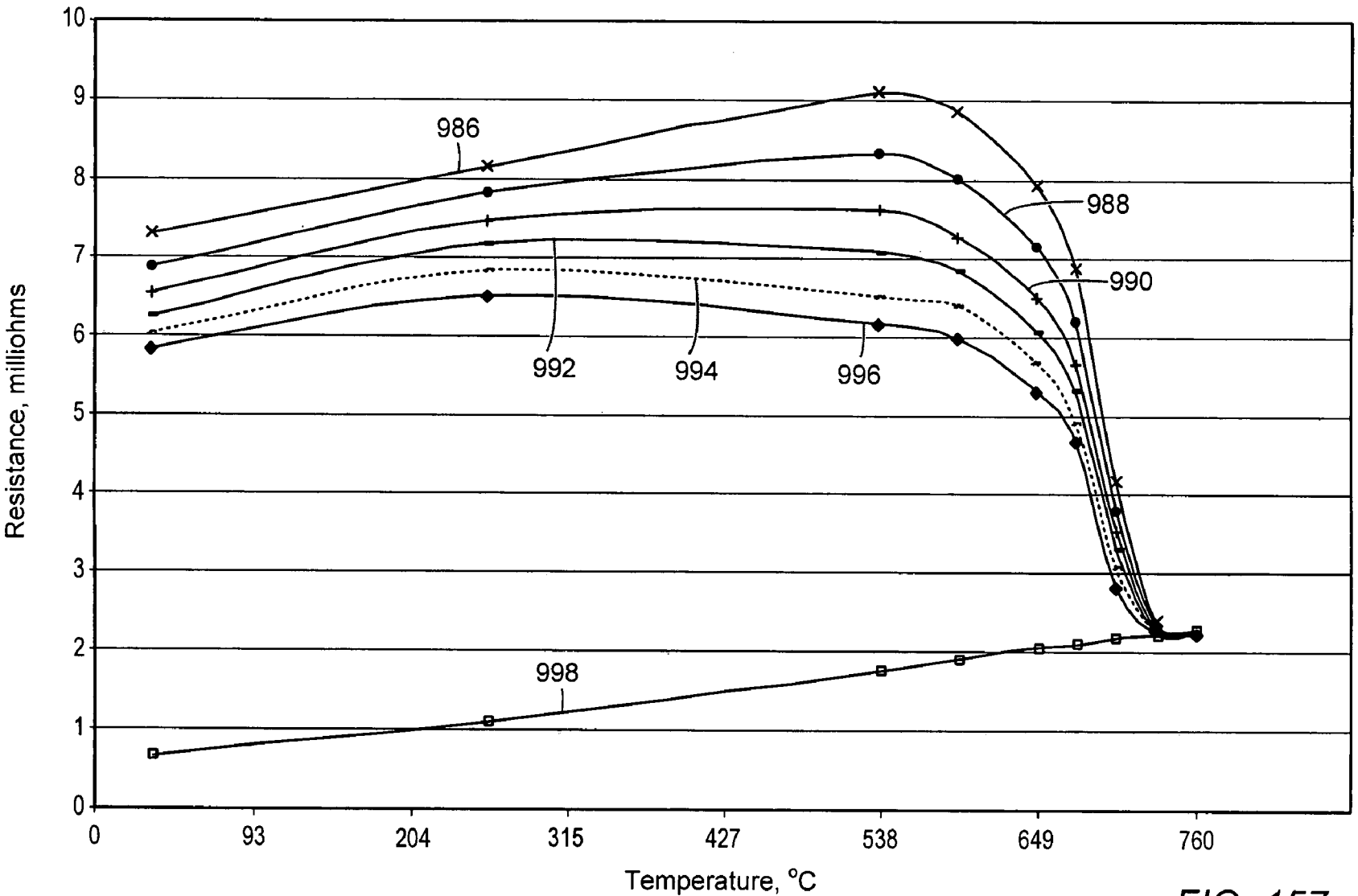

FIG. 157 depicts electrical resistance versus temperature at various applied electrical currents for a temperature limited heater.

Figure 158:
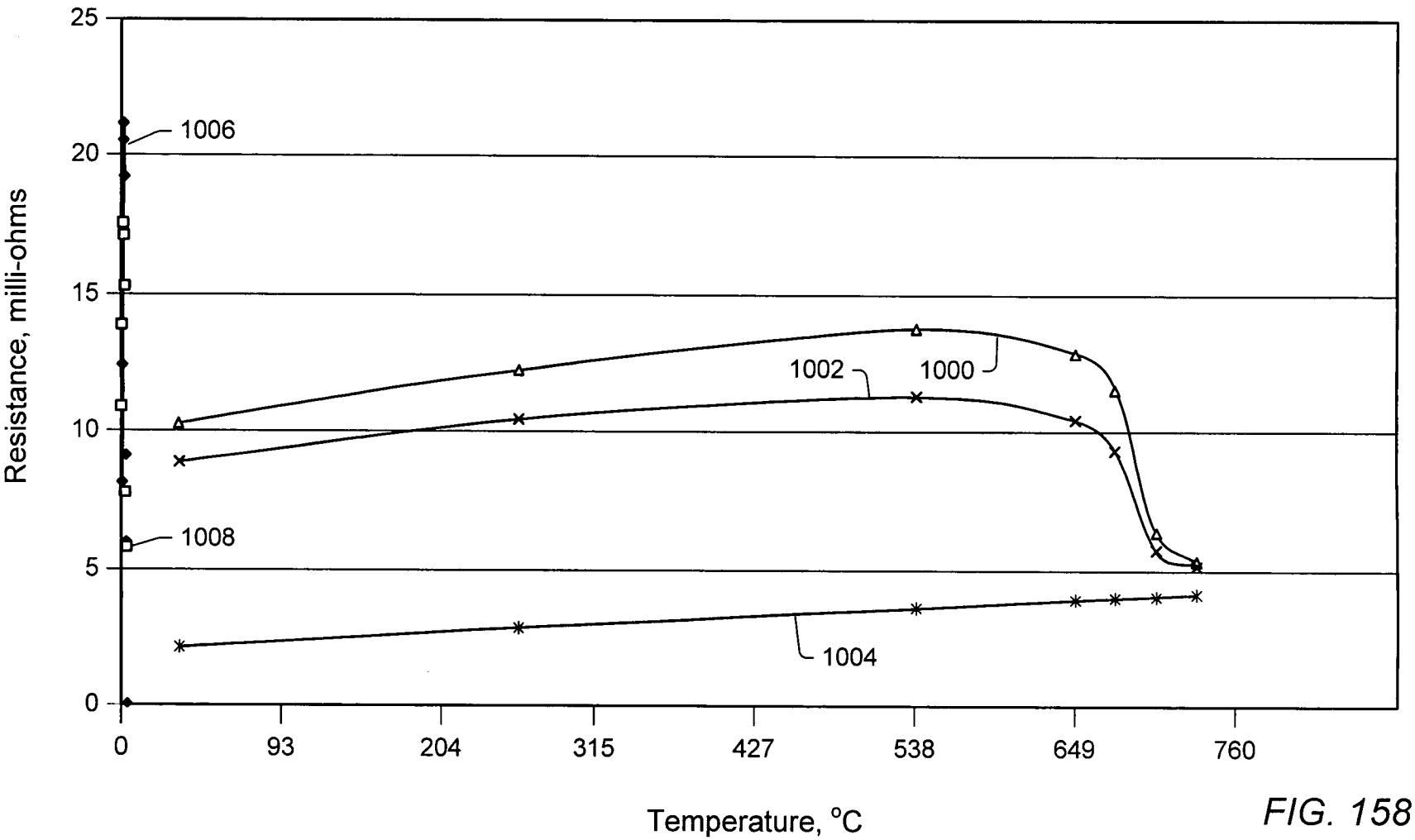

FIG. 158 depicts data of electrical resistance versus temperature for a solid 2.54 cm diameter, 1.8 m long 410 stainless steel rod at various applied electrical currents.

Figure 159:
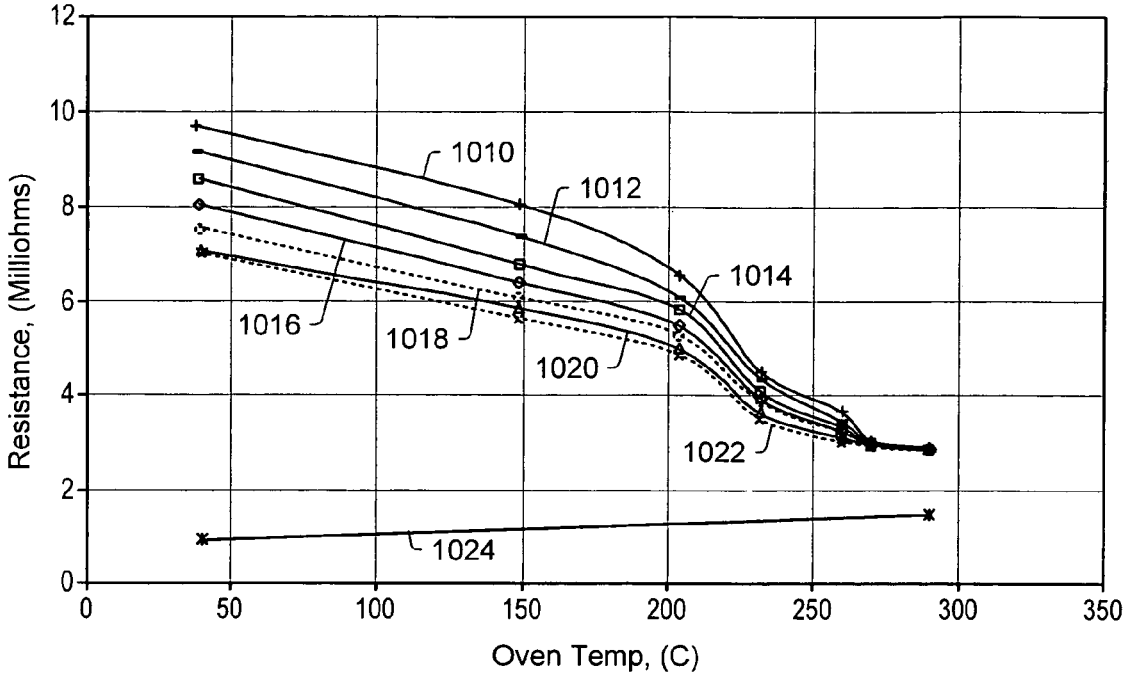

FIG. 159 depicts data of electrical resistance versus temperature for a composite 1.9 cm, 1.8 m long alloy 42-6 rod with a copper core (the rod has an outside diameter to copper diameter ratio of 2:1) at various applied electrical currents.

Figure 160:
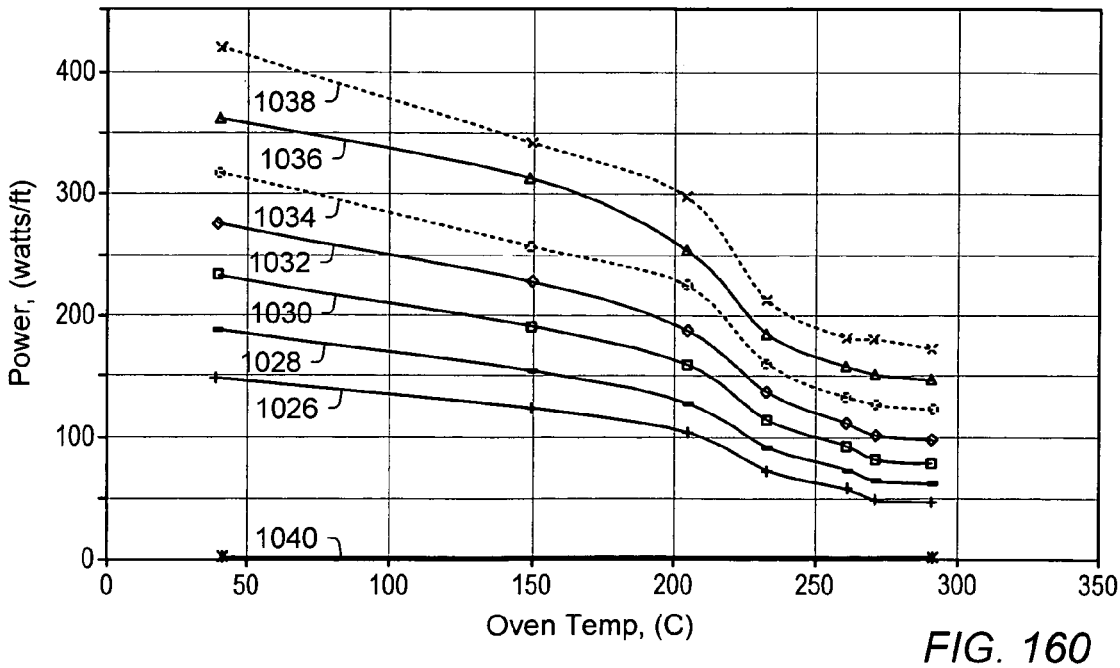

FIG. 160 depicts data of power output versus temperature for a composite 1.9 cm, 1.8 m long alloy 42-6 rod with a copper core (the rod has an outside diameter to copper diameter ratio of 2:1) at various applied electrical currents.

Figure 161:
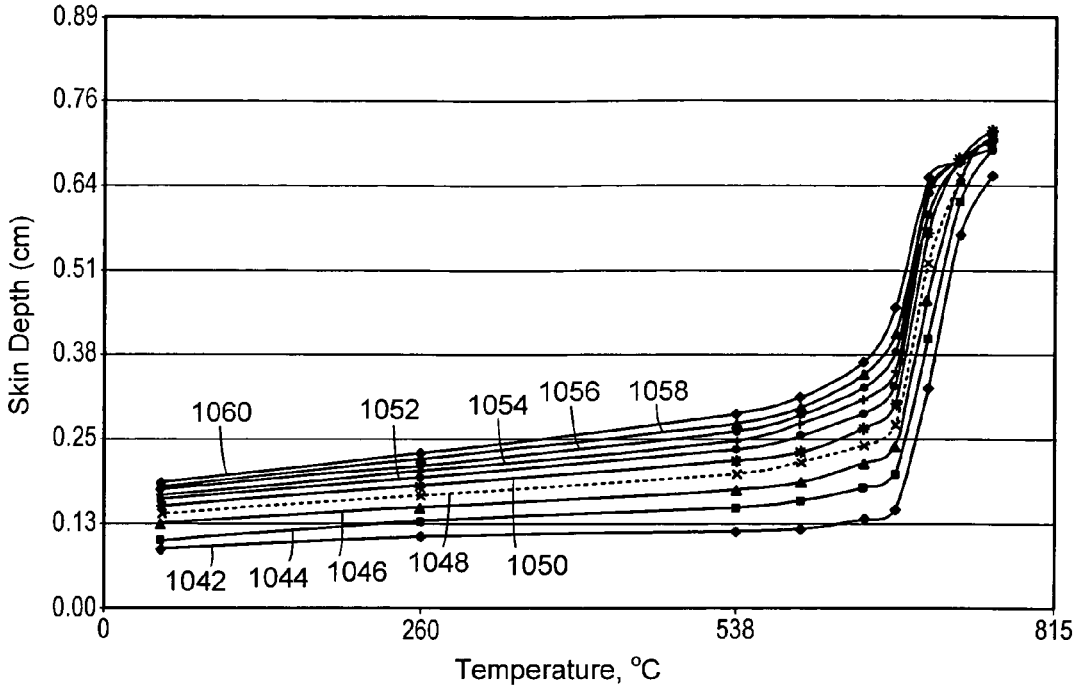

FIG. 161 depicts data for values of skin depth versus temperature for a solid 2.54 cm diameter, 1.8 m long 410 stainless steel rod at various applied AC electrical currents.

Figure 162:
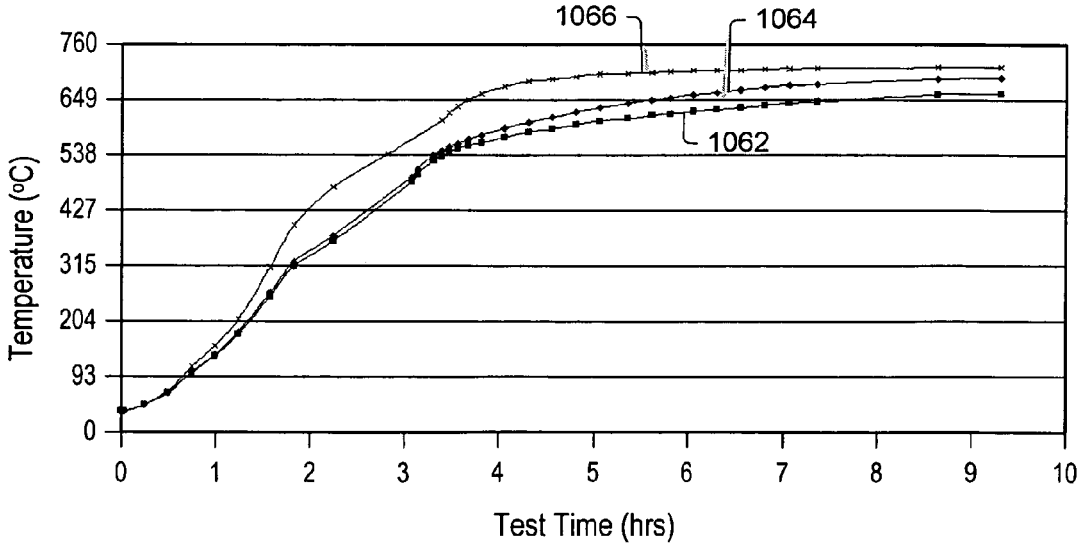

FIG. 162 depicts temperature versus time for a temperature limited heater.

Figure 163:
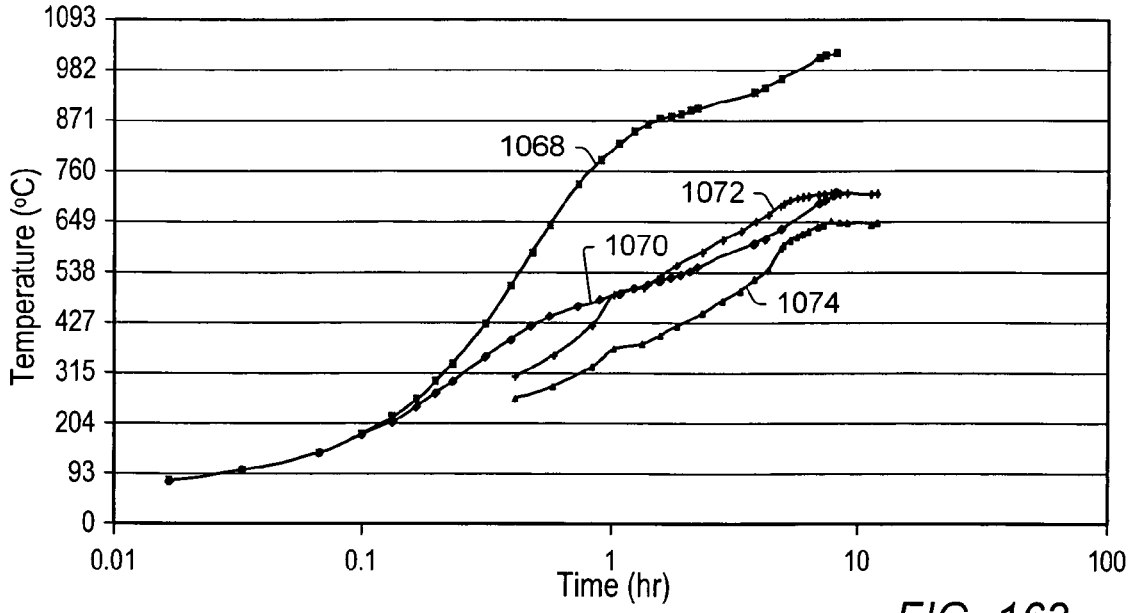

FIG. 163 depicts temperature versus log time data for a 2.5 cm solid 410 stainless steel rod and a 2.5 cm solid 304 stainless steel rod.

Figure 164:
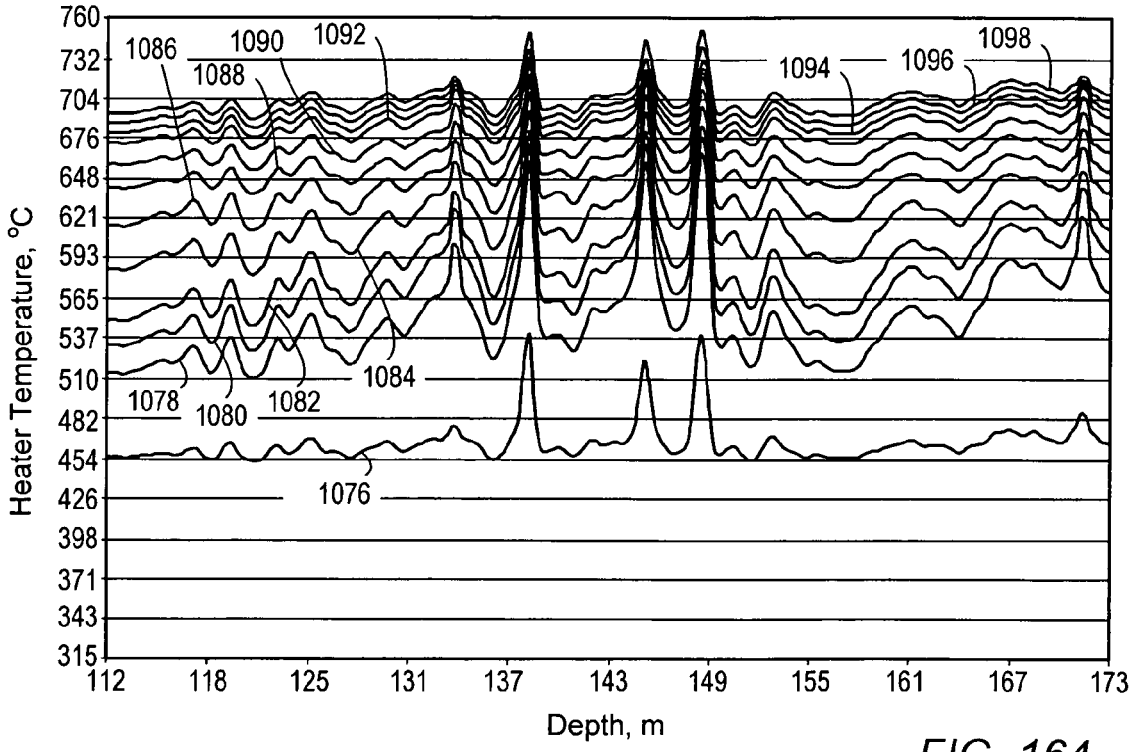

FIG. 164 displays temperature of the center conductor of a conductor-in-conduit heater as a function of formation depth for a Curie temperature heater with a turndown ratio of 2:1.

Figure 165:
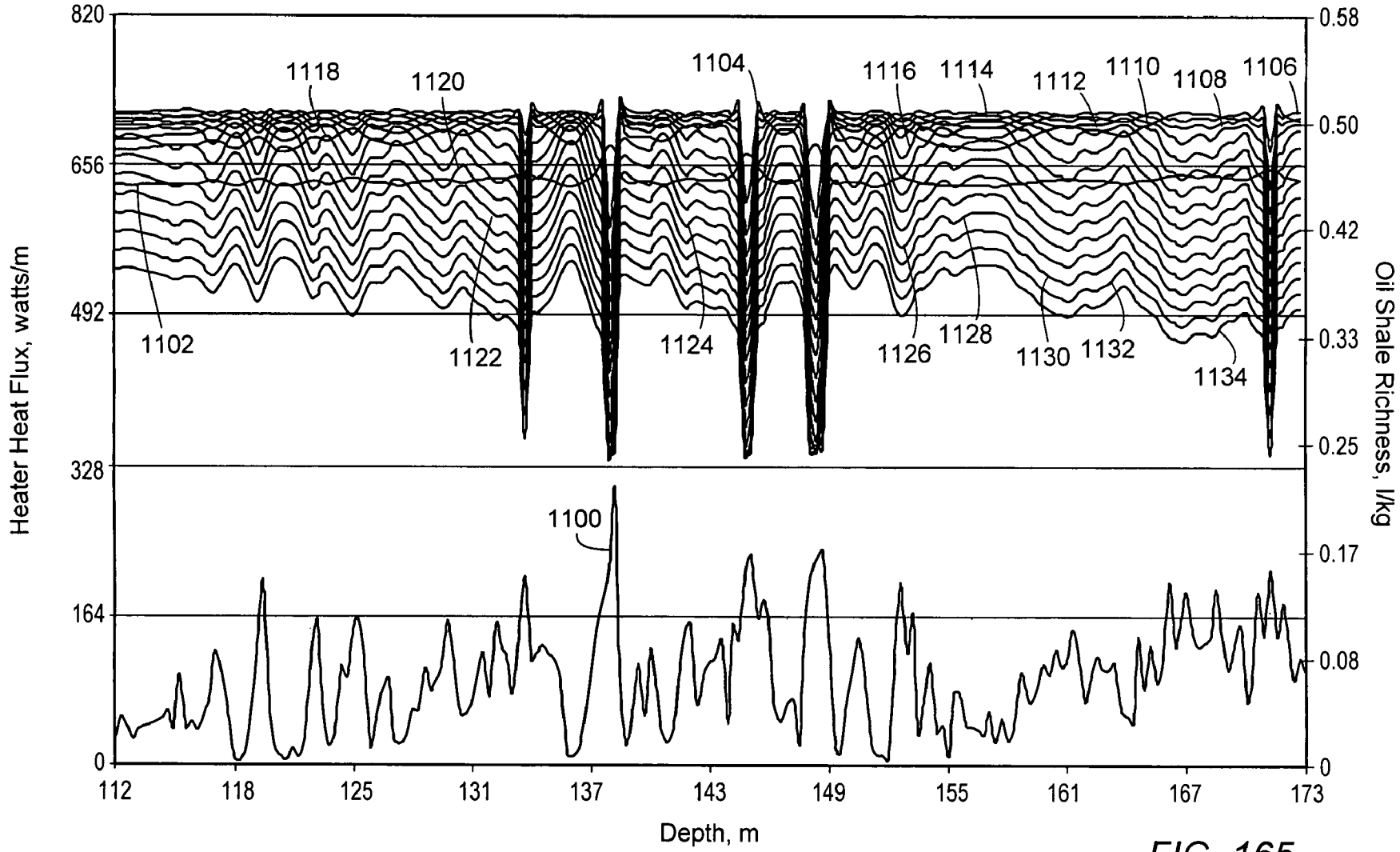

FIG. 165 displays heater heat flux through a formation for a turndown ratio of 2:1 along with the oil shale richness profile.

Figure 166:
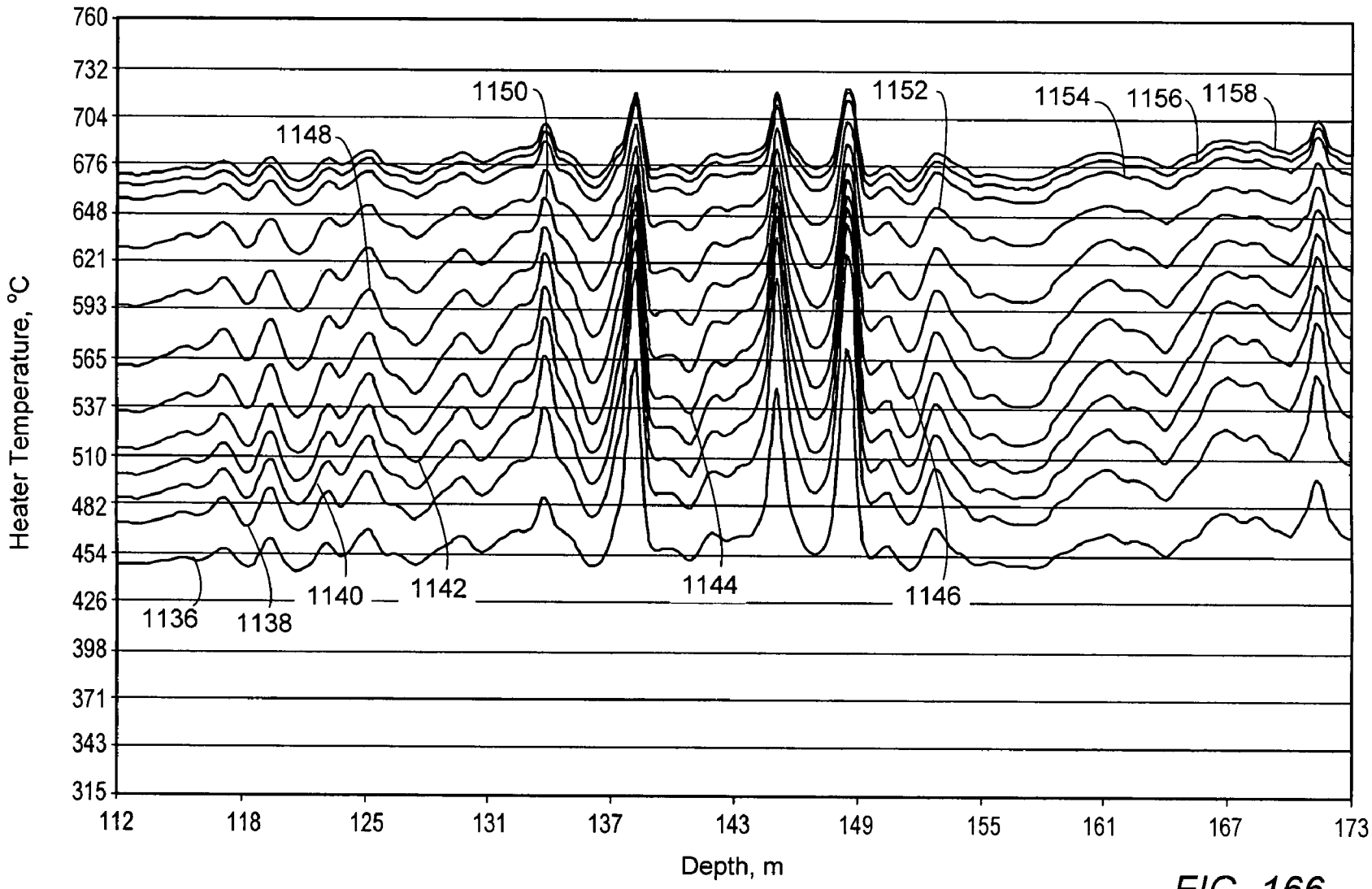

FIG. 166 displays heater temperature as a function of formation depth for a turndown ratio of 3:1.

Figure 167:
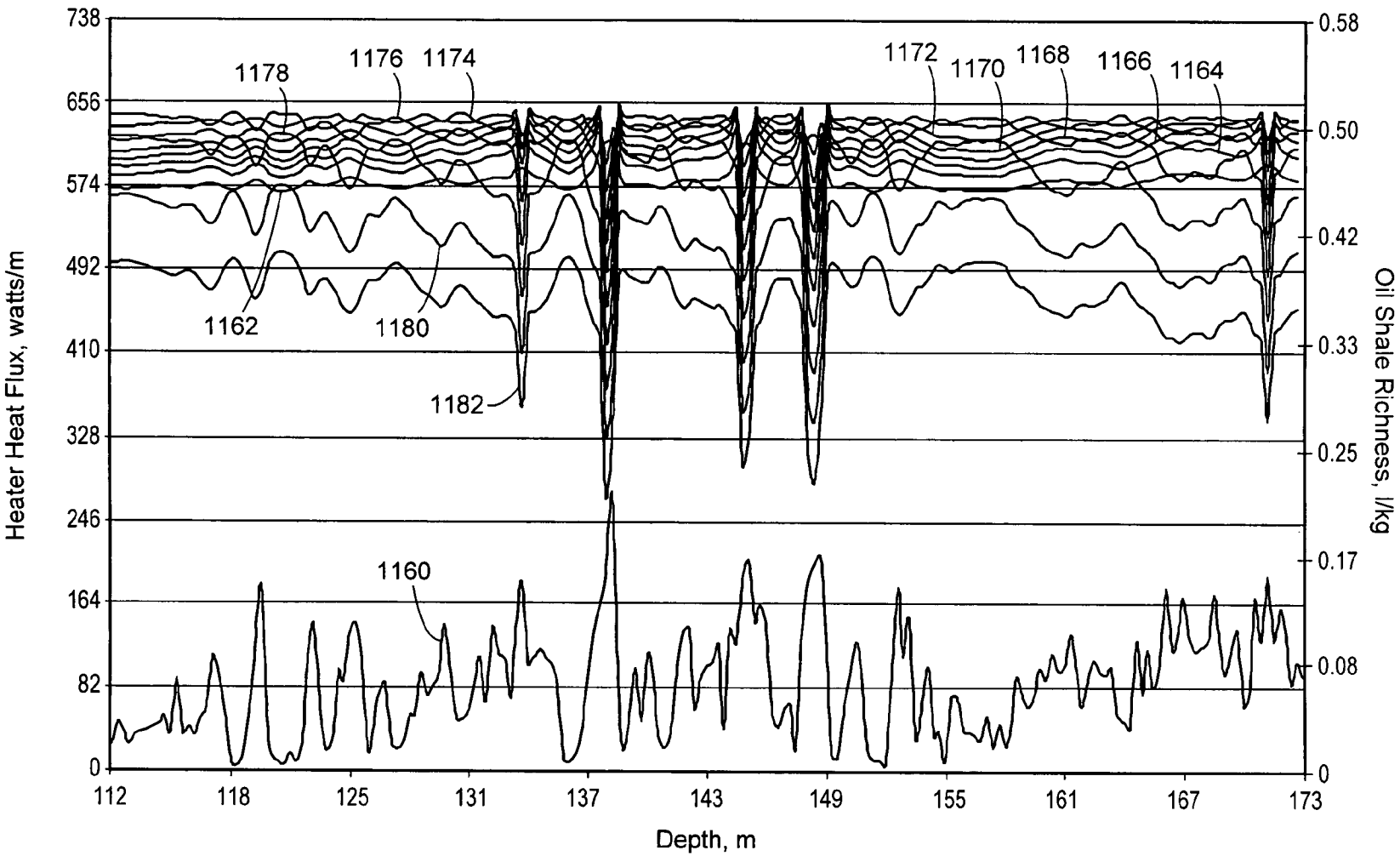

FIG. 167 displays heater heat flux through a formation for a turndown ratio of 3:1 along with the oil shale richness profile.

Figure 168:
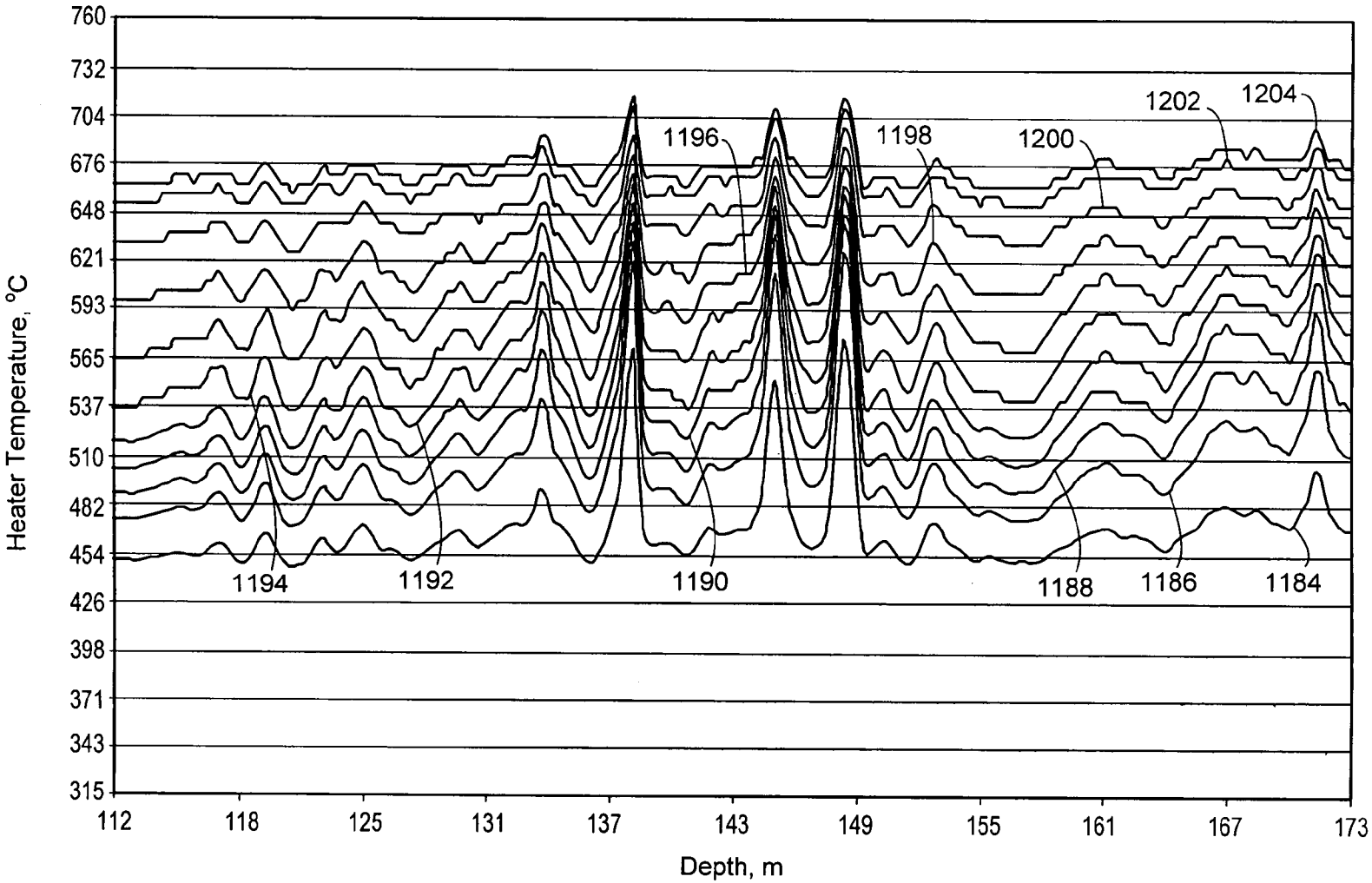

FIG. 168 displays heater temperature as a function of formation depth for a turndown ratio of 4:1.

Figure 169:
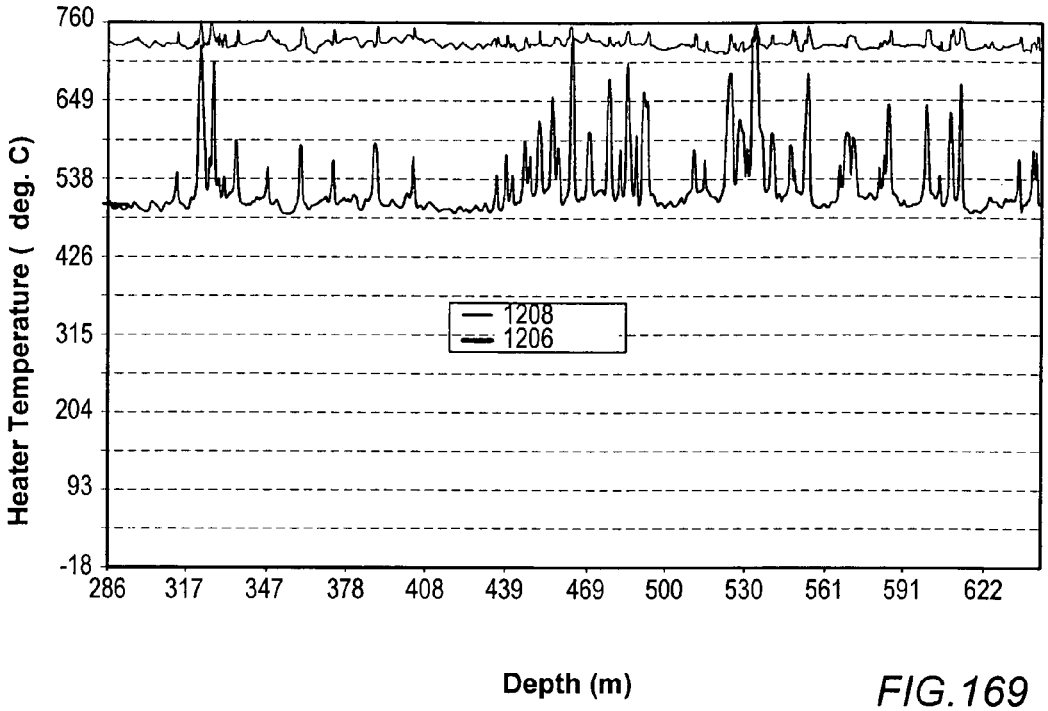

FIG. 169 depicts heater temperature versus depth for heaters used in a simulation for heating oil shale.

Figure 170:
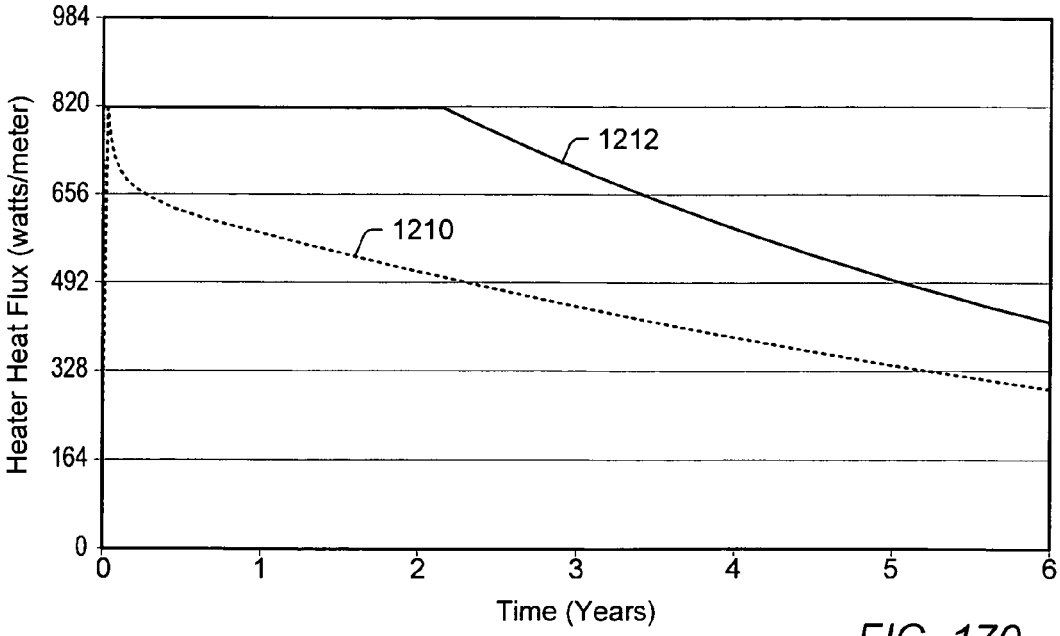

FIG. 170 depicts heater heat flux versus time for heaters used in a simulation for heating oil shale.

Figure 171:
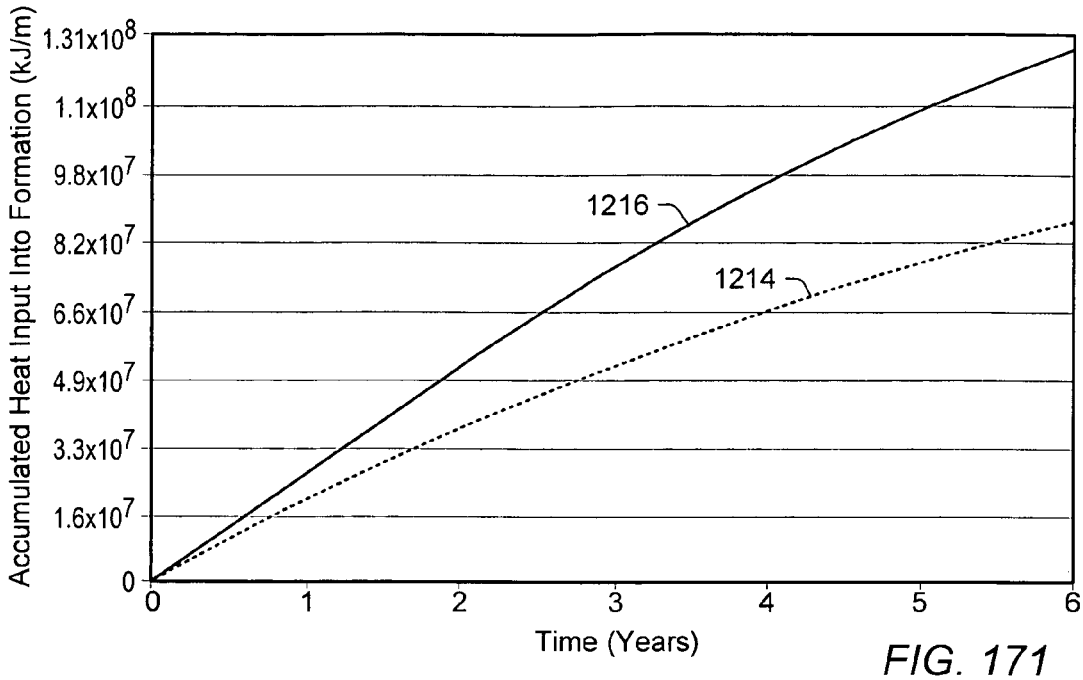

FIG. 171 depicts accumulated heat input versus time in a simulation for heating oil shale.

Figure 172:
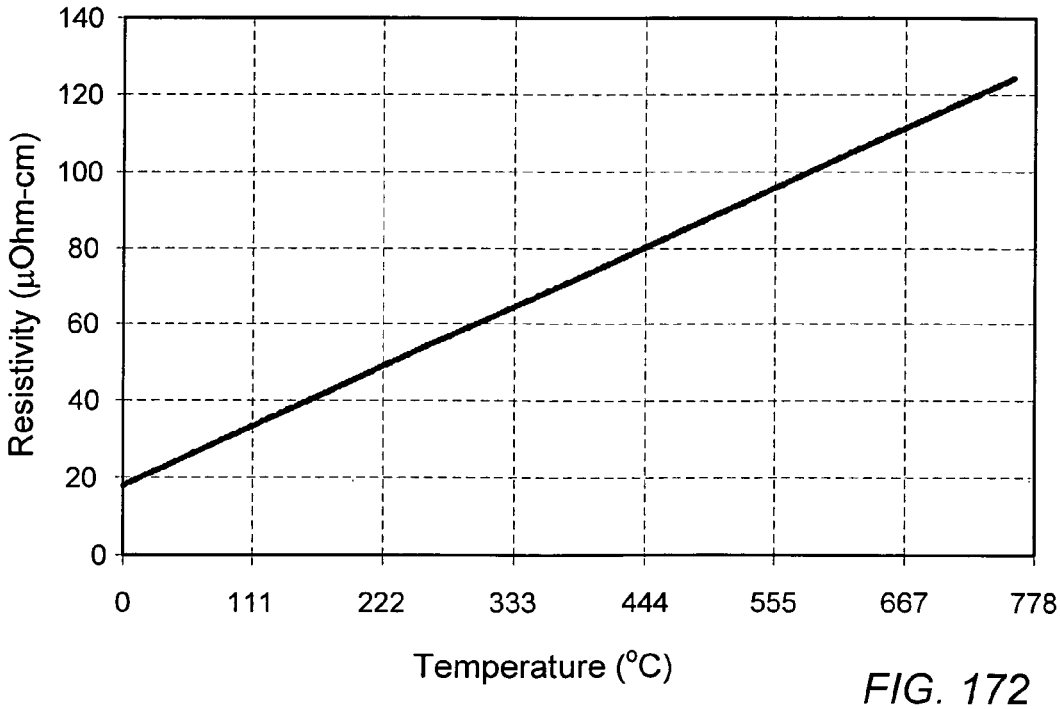

FIG. 172 shows DC (direct current) resistivity versus temperature for a 1% carbon steel temperature limited heater.

Figure 173:
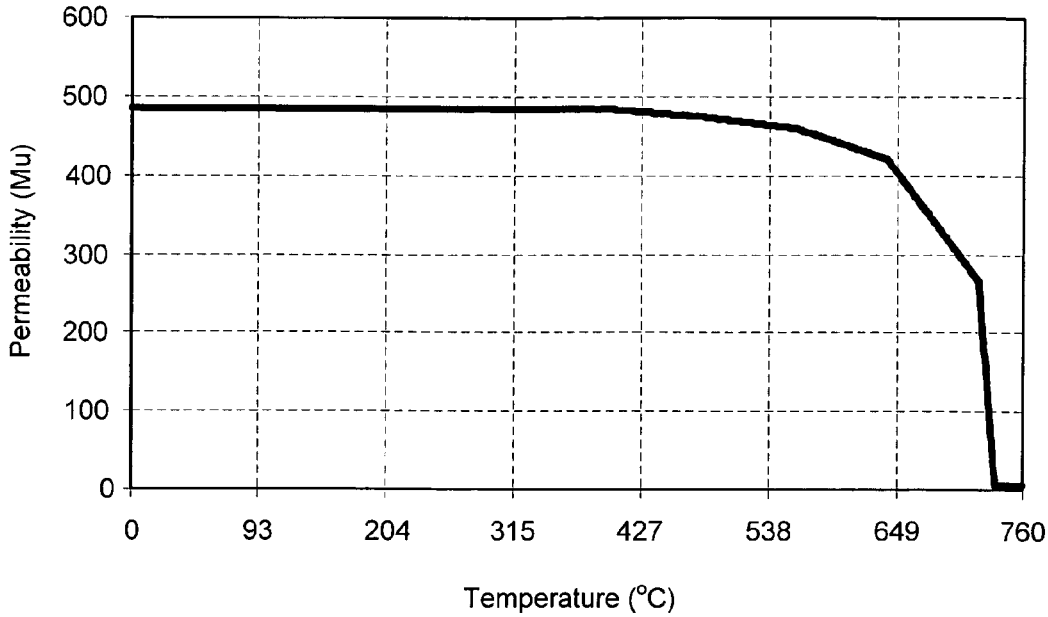

FIG. 173 shows magnetic permeability versus temperature for a 1% carbon steel temperature limited heater.

Figure 174:
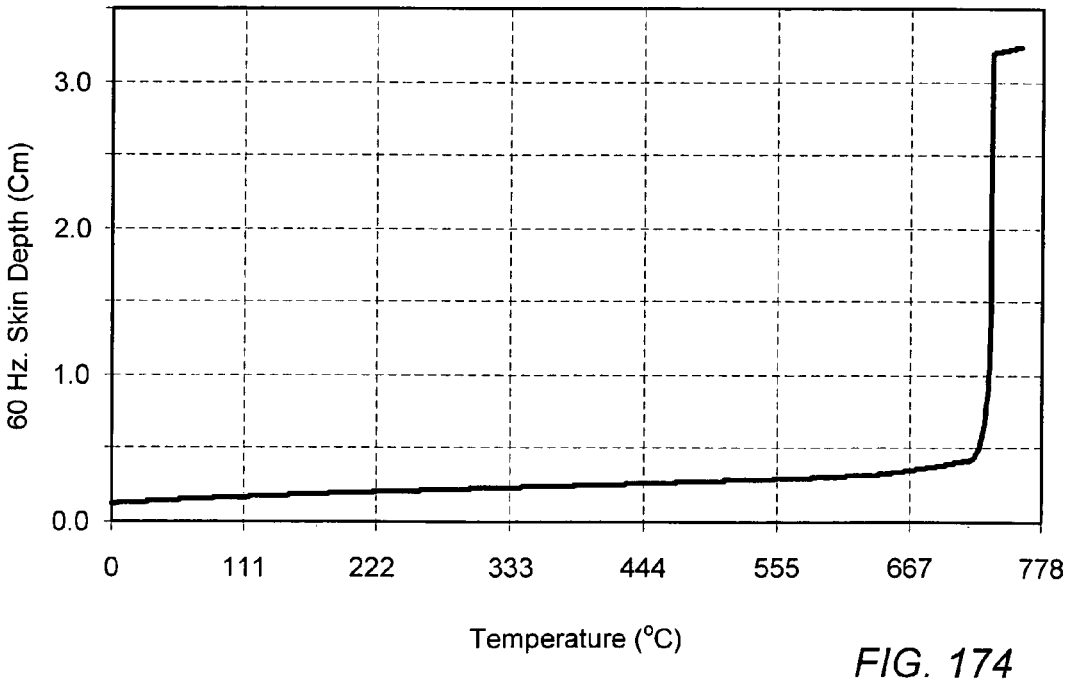

FIG. 174 shows skin depth versus temperature for a 1% carbon steel temperature limited heater at 60 Hz.

Figure 175:
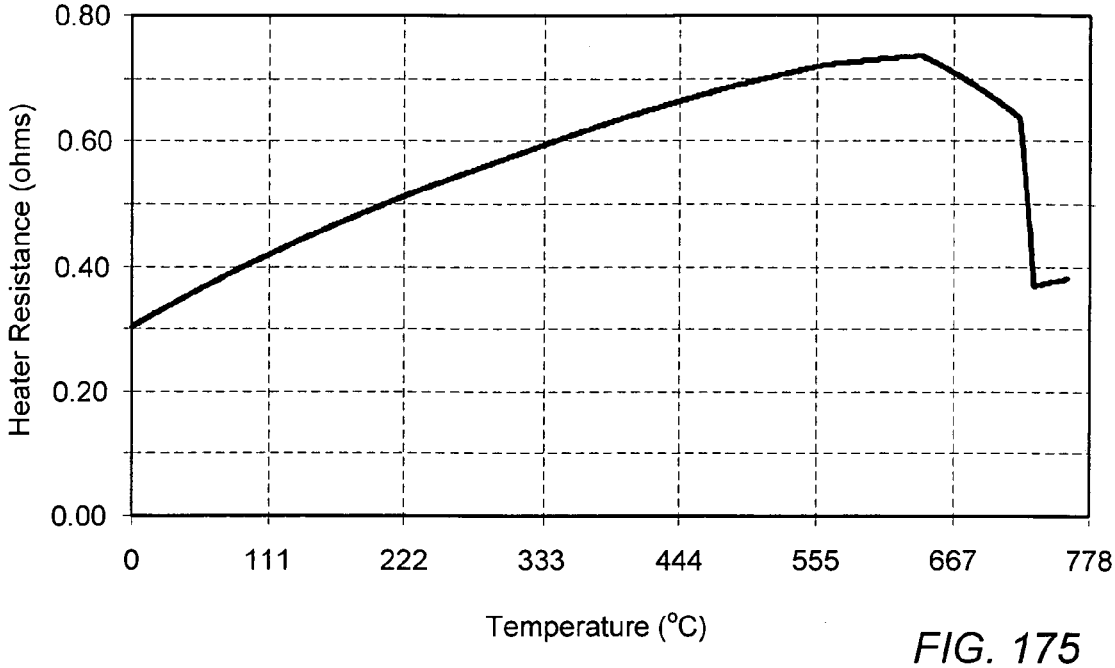

FIG. 175 shows AC resistance versus temperature for a carbon steel pipe at 60 Hz.

Figure 176:
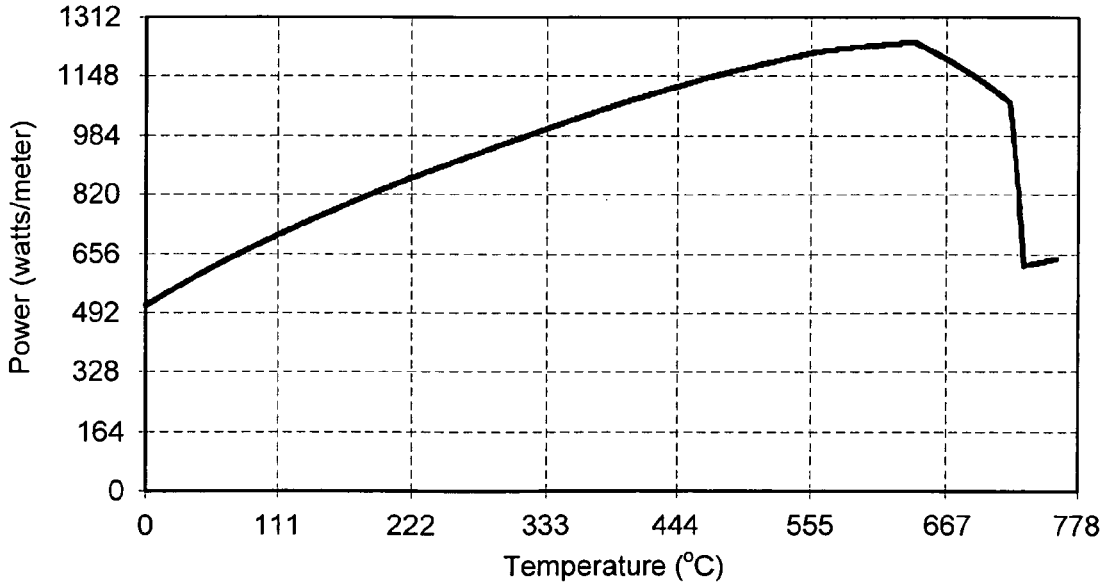

FIG. 176 shows heater power versus temperature for a 1" Schedule XXS carbon steel pipe, at 600 A (constant) and 60 Hz.

Figure 177:
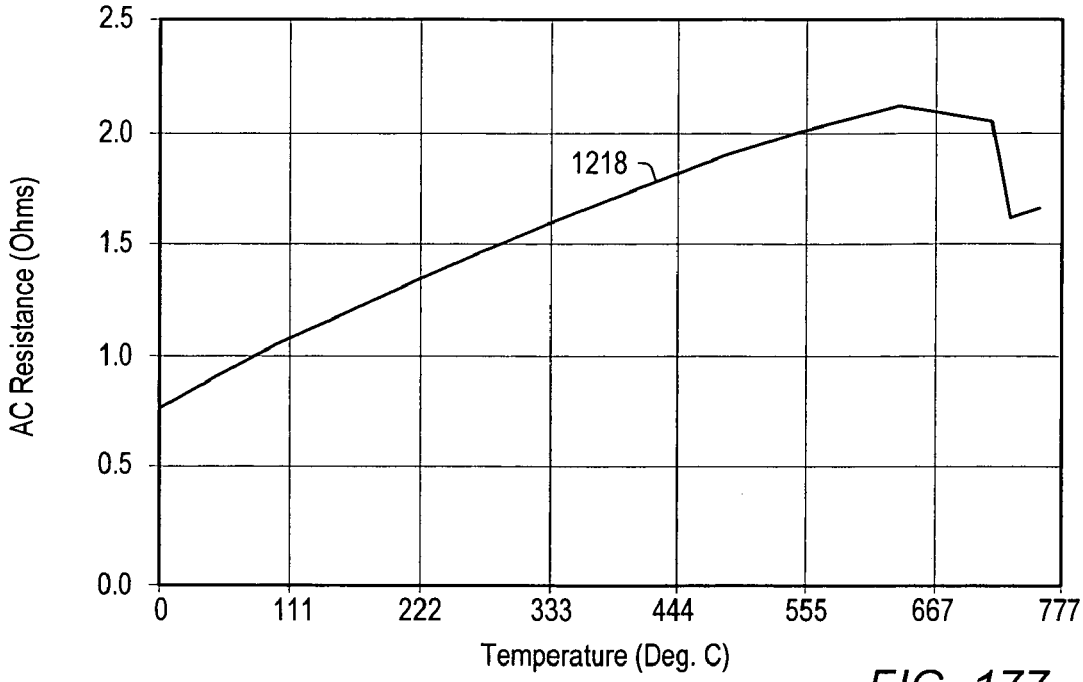

FIG. 177 depicts AC resistance versus temperature for a 1.5 cm diameter iron conductor.

Figure 178:
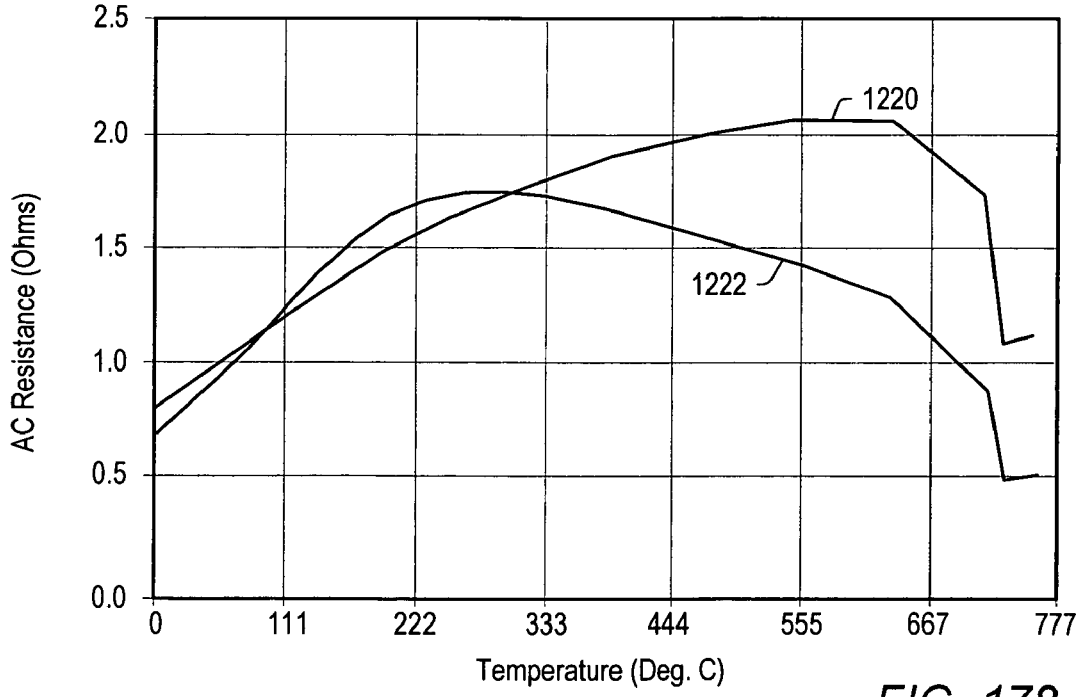

FIG. 178 depicts AC resistance versus temperature for a 1.5 cm diameter composite conductor of iron and copper.

Figure 179:
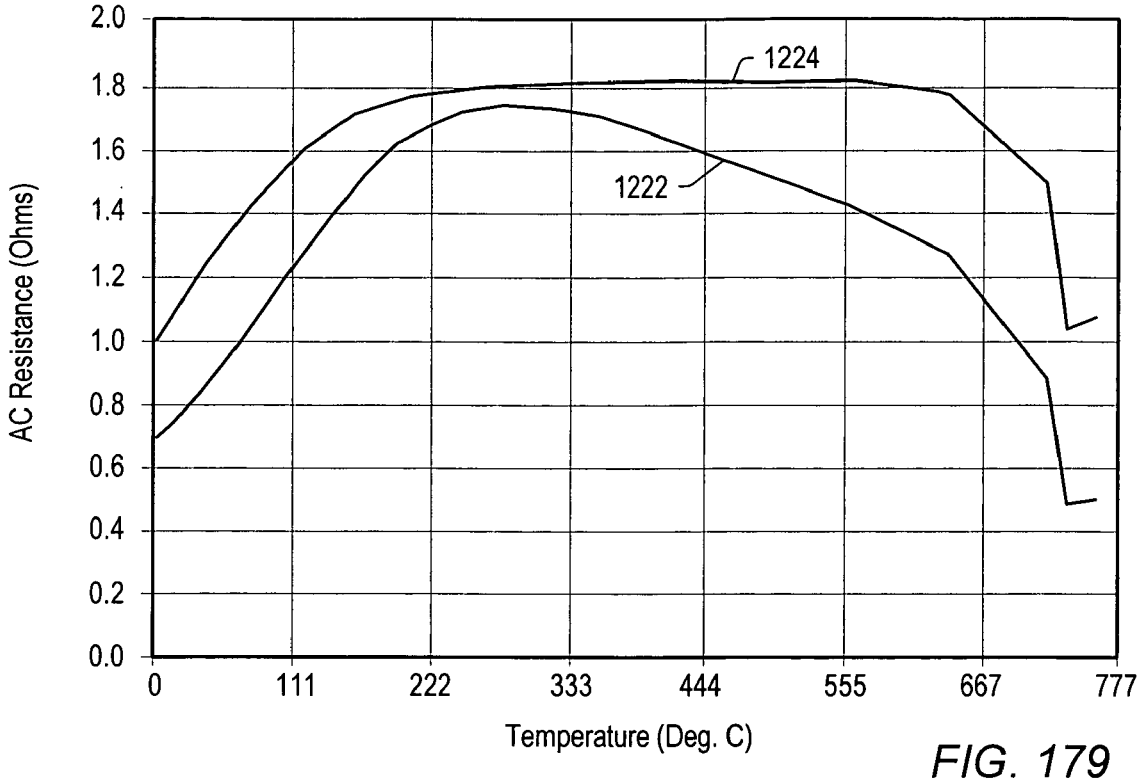

FIG. 179 depicts AC resistance versus temperature for a 1.3 cm diameter composite conductor of iron and copper and for a 1.5 cm diameter composite conductor of iron and copper.

Figure 180:
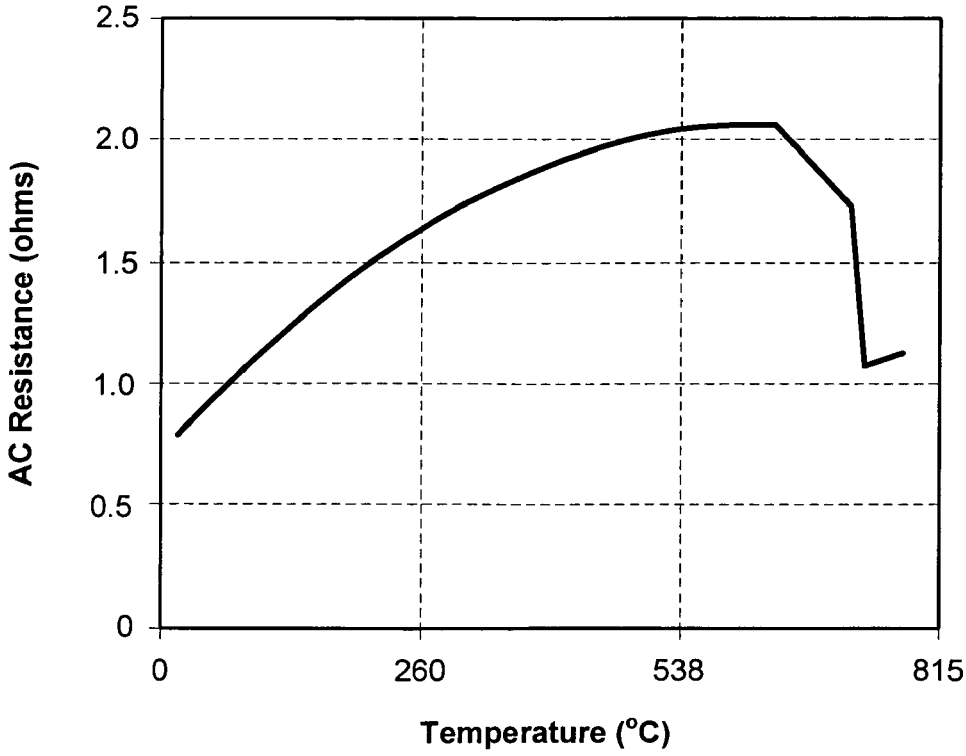

FIG. 180 depicts AC resistance versus temperature using analytical equations.

Figure 181:
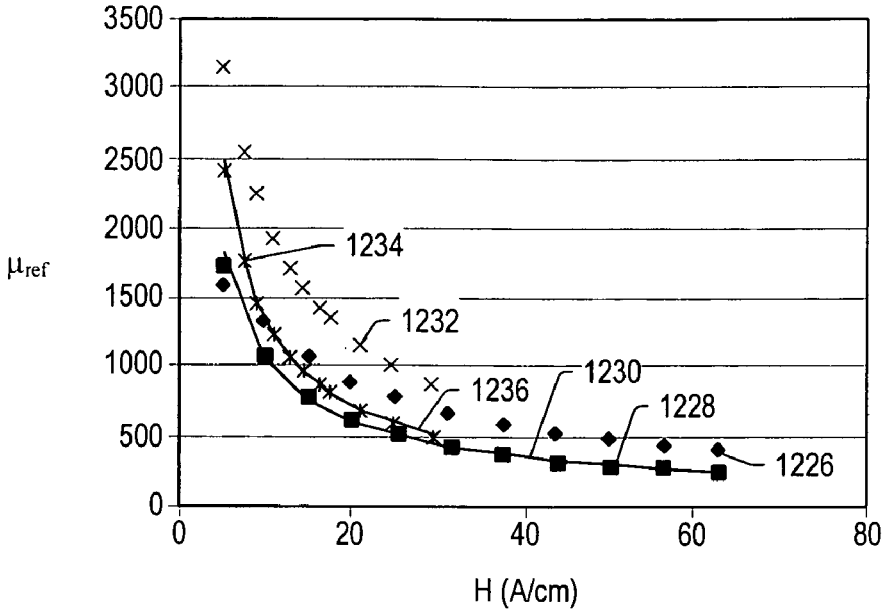

FIG. 181 shows a plot of data of measured values of the relative magnetic permeability versus magnetic field.

Figure 182:
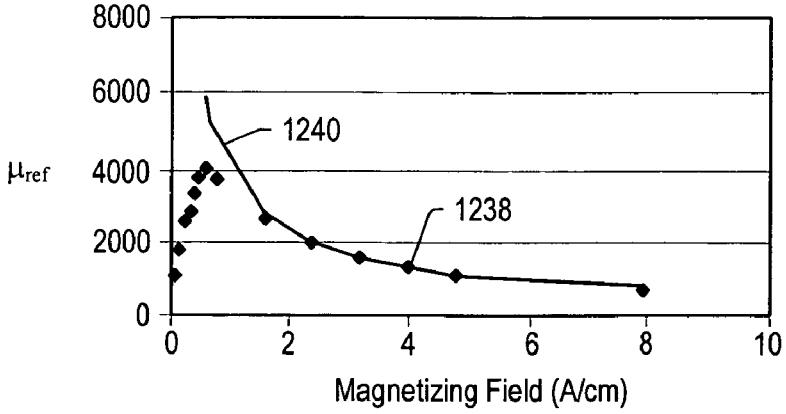

FIG. 182 shows a plot of data of measured values of the relative magnetic permeability versus magnetic field.

Figure 183:
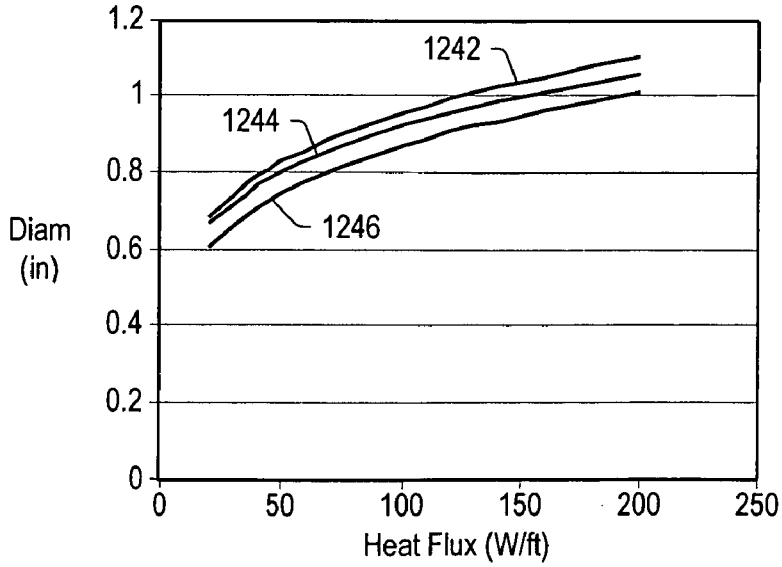

FIG. 183 depicts the rod diameter required as a function of heat flux to obtain a $\tau$ of 2 for three materials.

Figure 184:
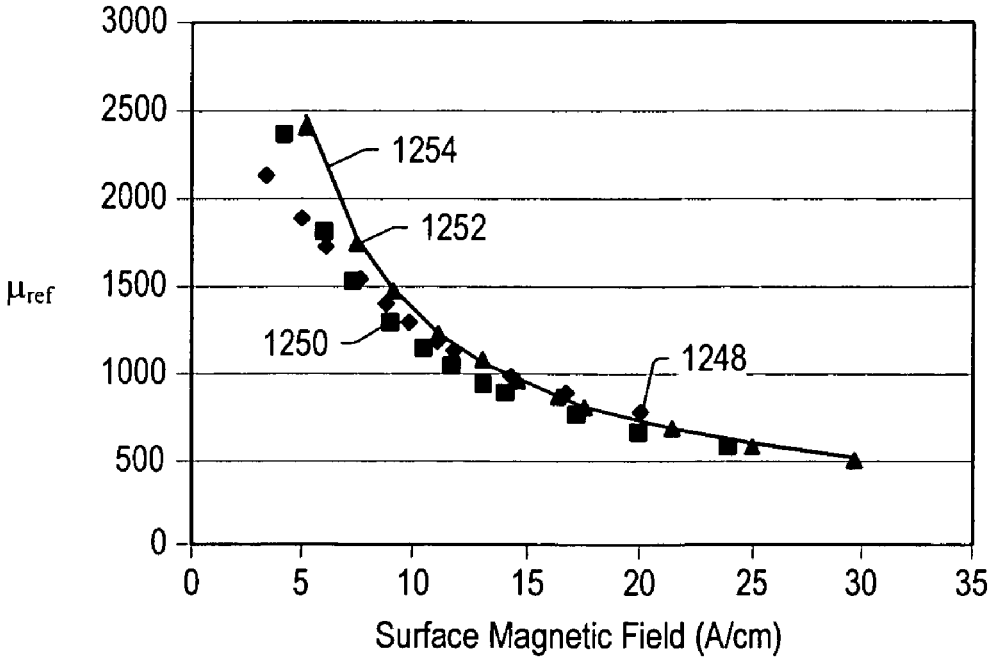

FIG. 184 shows the $\mu_r^{eff}$ versus H data and curve for three sizes of rod.

Figure 185:
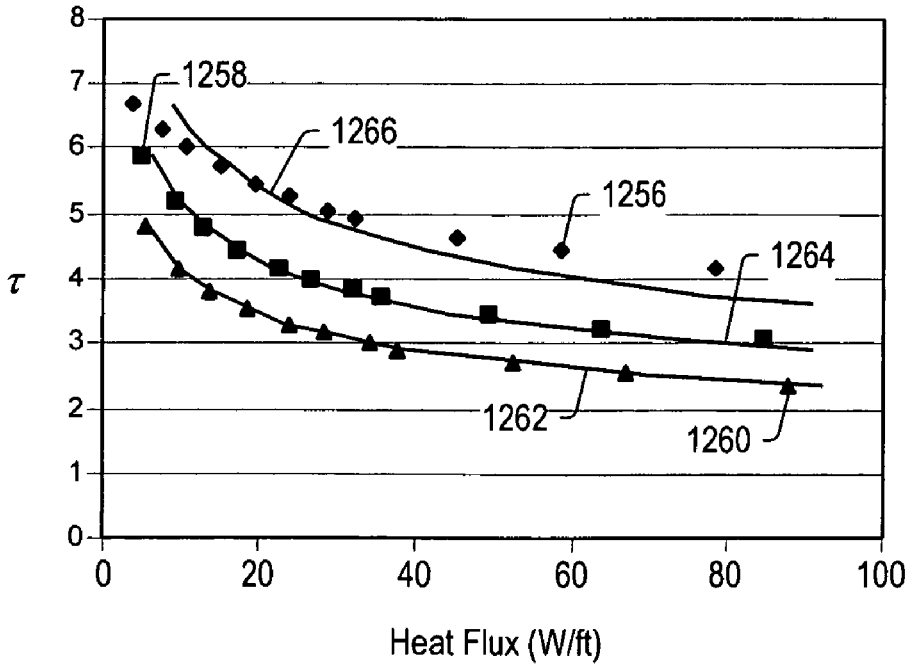

FIG. 185 depicts a comparison of results of carrying out a procedure.

Figures 186, 187:
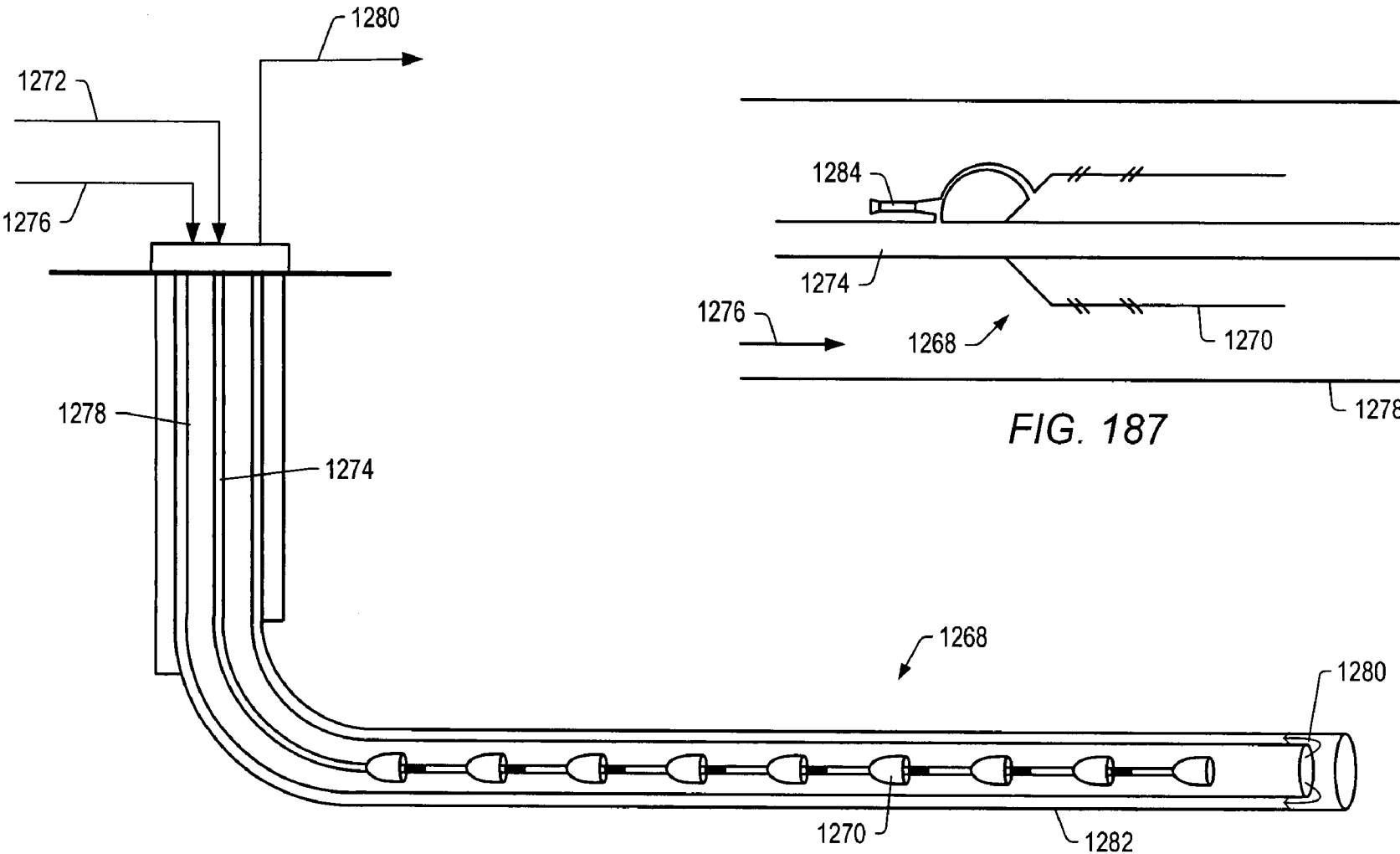

FIG. 186 depicts a schematic representation of an embodiment of a downhole oxidizer assembly.

FIG. 187 depicts a schematic representation of an embodiment of a venturi device coupled to a fuel conduit.

Figure 188:
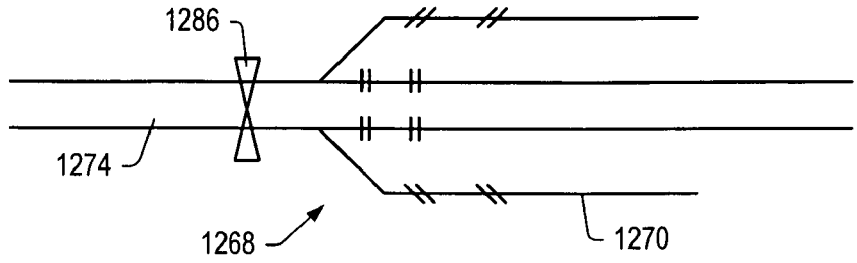

FIG. 188 depicts a schematic representation of an embodiment of a portion of an oxidizer assembly including a valve coupled to a fuel conduit.

Figure 189:
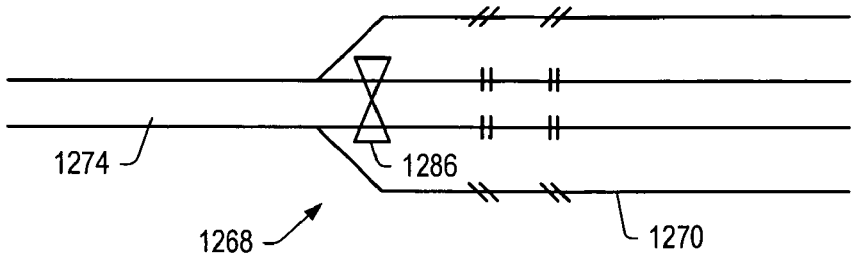

FIG. 189 depicts a schematic representation of an embodiment of a portion of an oxidizer assembly including a valve coupled to a fuel conduit.

Figure 190:
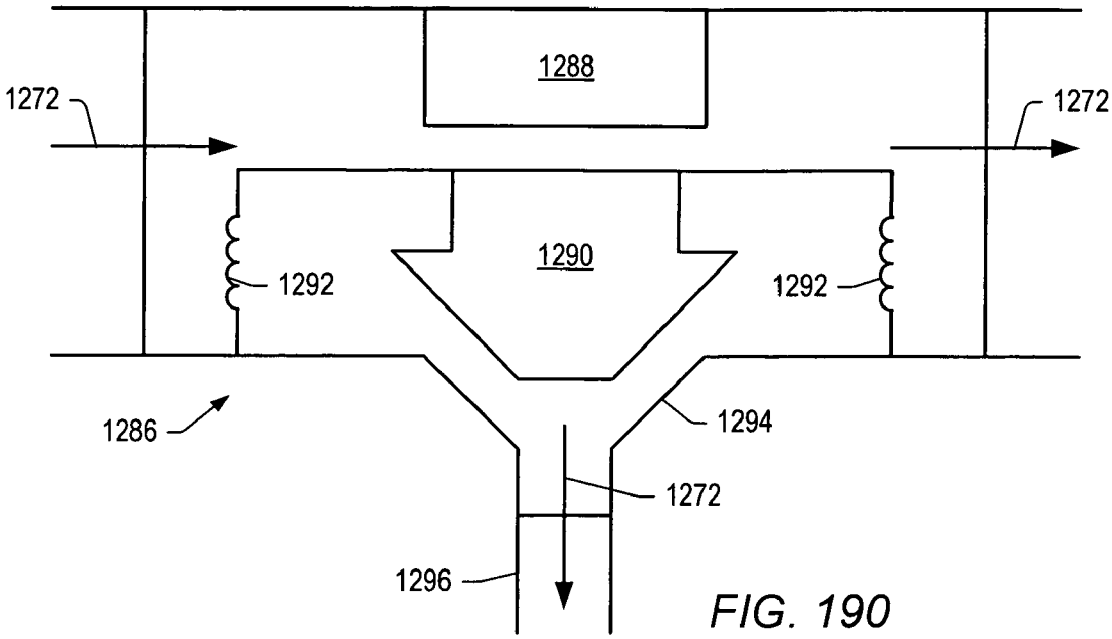

FIG. 190 depicts a schematic representation of an embodiment of a valve.

Figure 191:
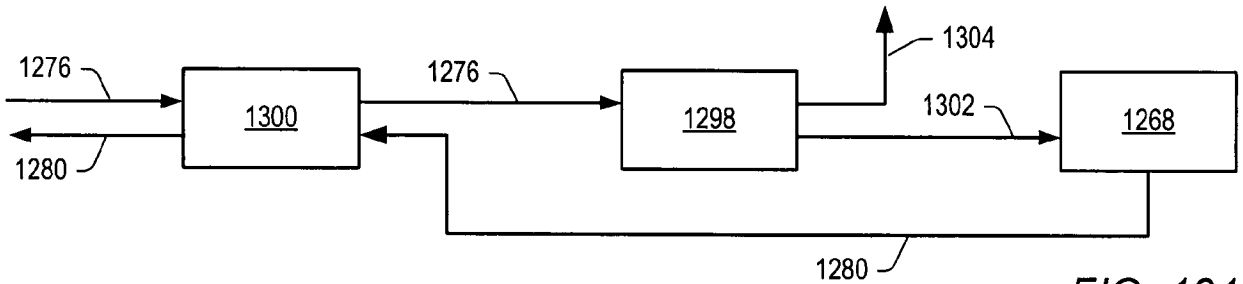

FIG. 191 depicts a schematic representation of an embodiment of a membrane system for increasing oxygen content in an oxidizing fluid.

Figure 192:
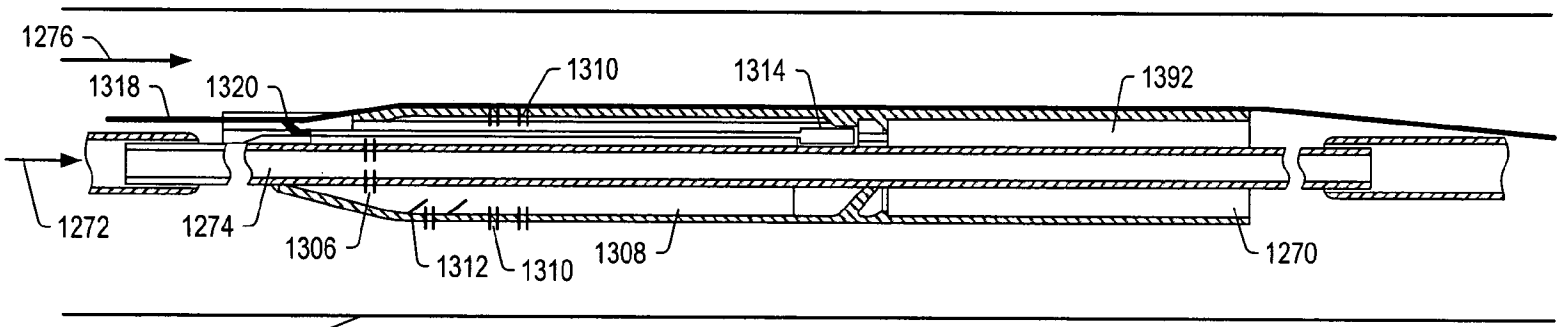

FIG. 192 depicts a cross-sectional representation of an embodiment of an oxidizer that may be used in a downhole oxidizer assembly.

Figure 193:
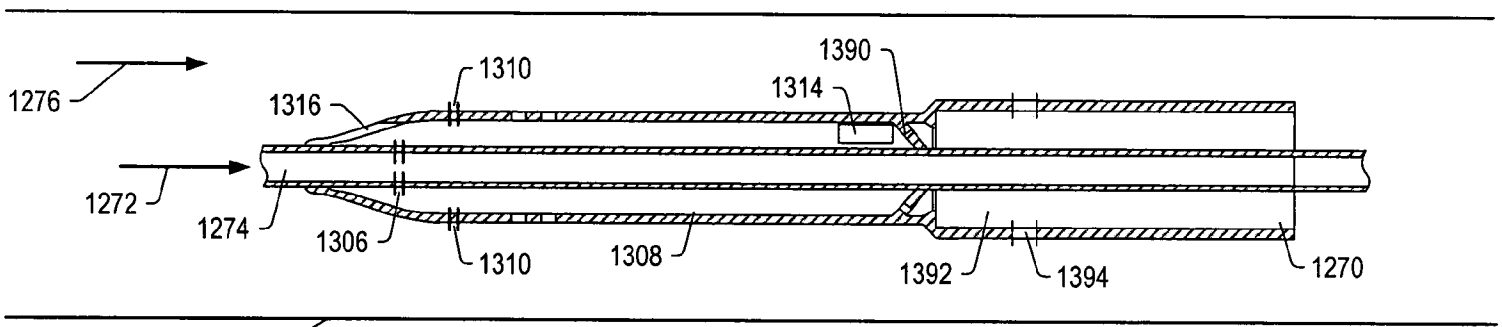

FIG. 193 depicts a cross-sectional representation of an embodiment of an oxidizer that may be used in a downhole oxidizer assembly.

Figure 194:
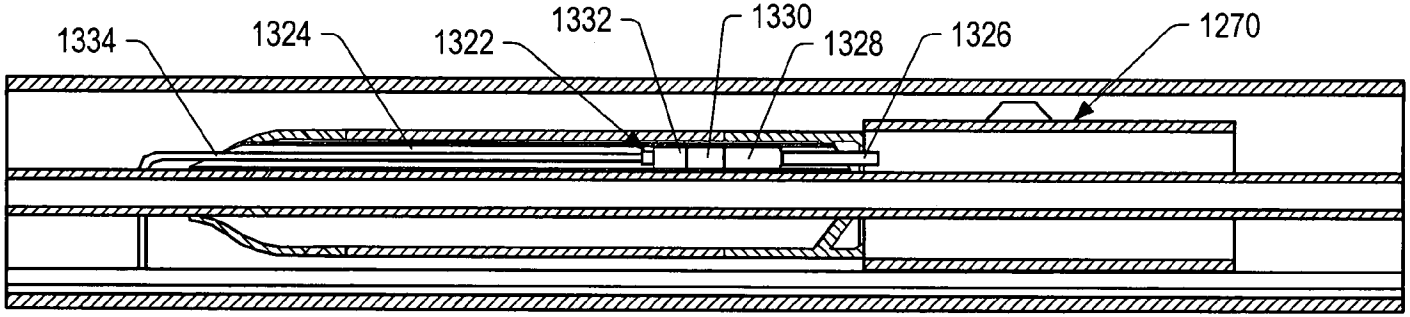

FIG. 194 depicts an embodiment of an ignition system positioned in a cross-sectional representation of an oxidizer.

Figure 195:
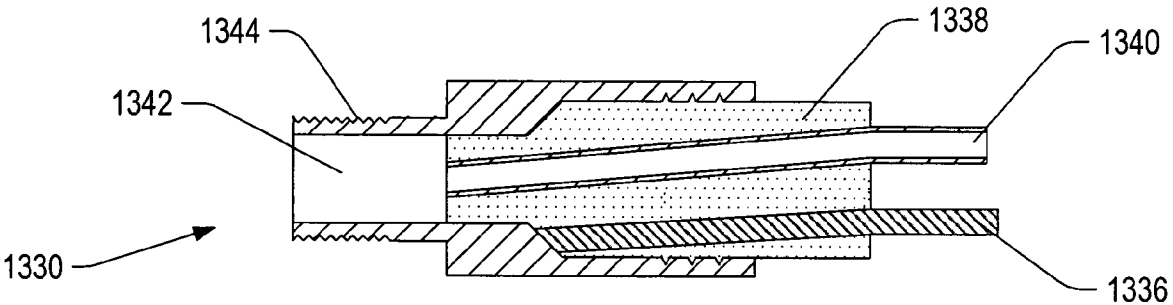

FIG. 195 depicts a cross-sectional representation of an embodiment of a transitional piece of an ignition system.

Figure 196:
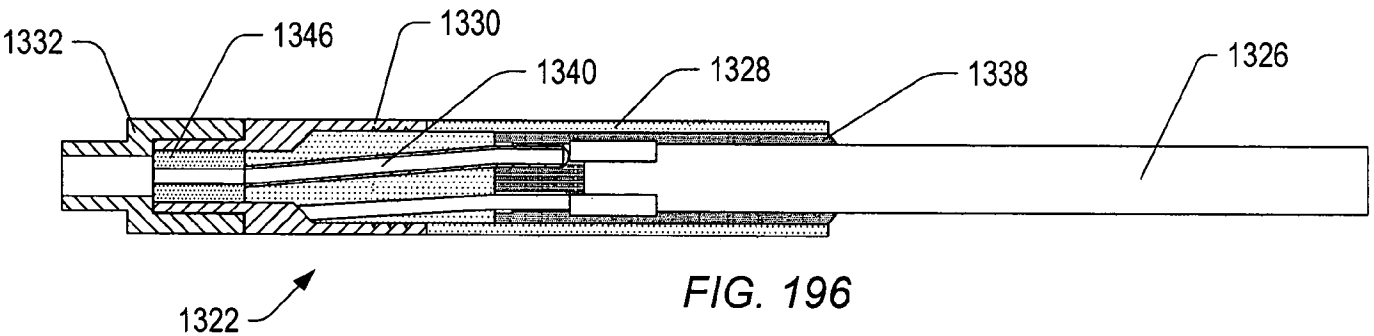

FIG. 196 depicts a cross-sectional representation of an embodiment of an ignition system.

Figure 197:
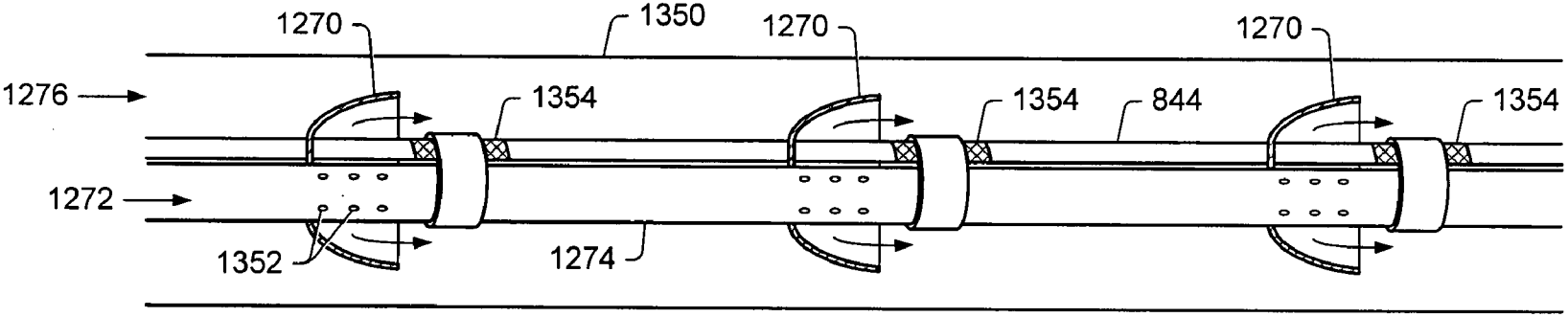

FIG. 197 depicts an embodiment of a downhole oxidizer heater with temperature limited heater ignition sources.

Figure 198:
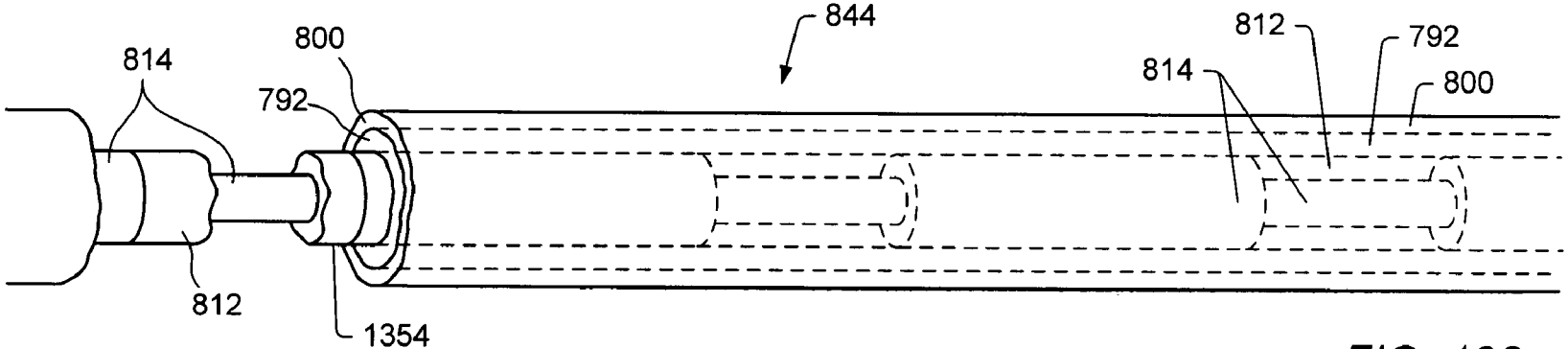

FIG. 198 depicts an embodiment of an insulated conductor.

Figure 199:
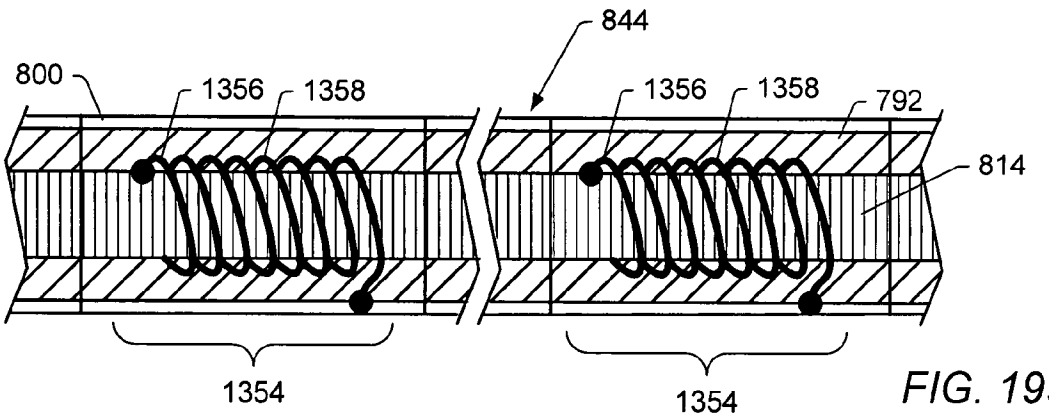

FIG. 199 depicts an embodiment of an insulated conductor with igniter sections.

Figure 200:
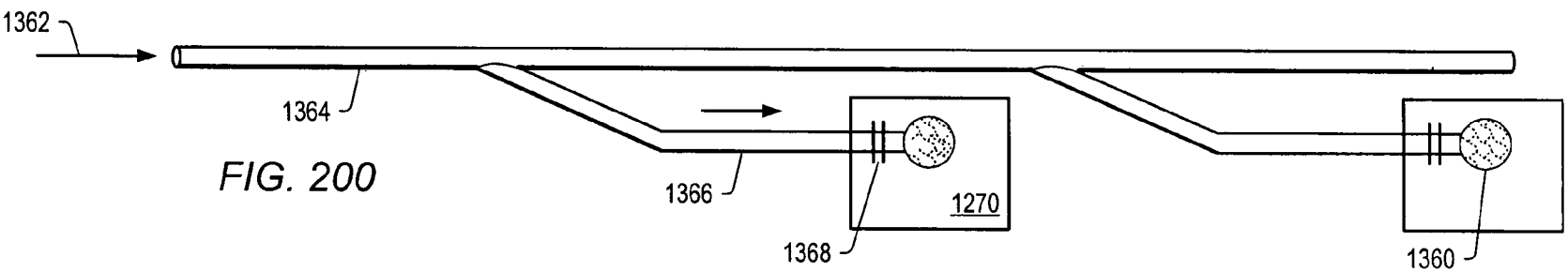

FIG. 200 depicts a schematic representation of an embodiment of a mechanical ignition source.

Figure 201:
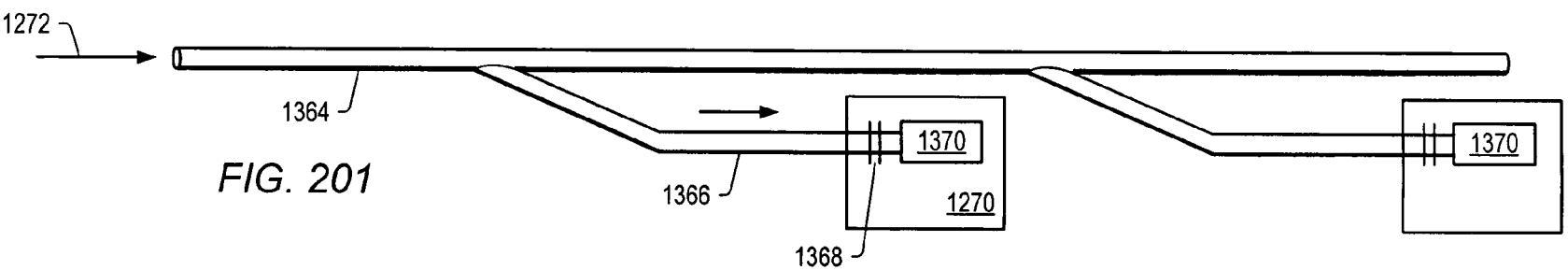

FIG. 201 depicts a catalytic material proximate an oxidizer in a downhole oxidizer assembly.

Figure 202:
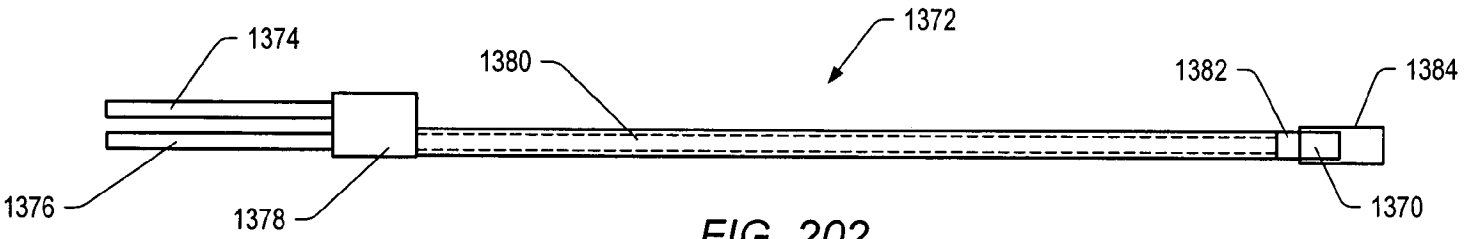

FIG. 202 depicts an embodiment of a catalytic igniter system.

Figure 203:
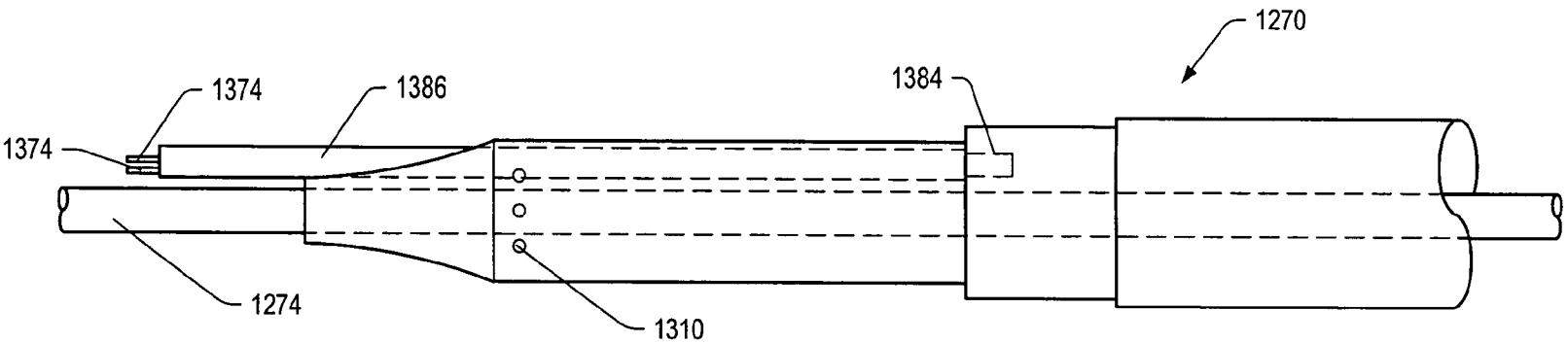

FIG. 203 depicts a cross-sectional representation of a portion of an oxidizer that uses a catalytic igniter system.

Figure 204:
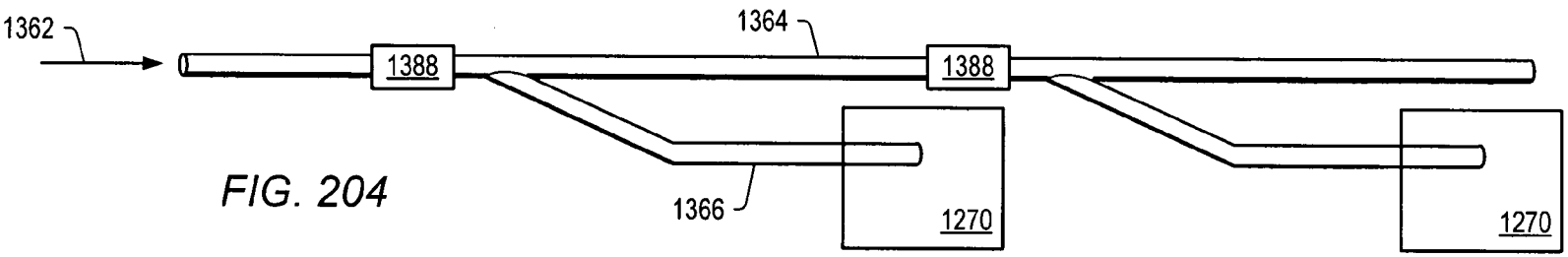

FIG. 204 depicts tubing with ignition points to trigger exploding pellets.

Figure 205:
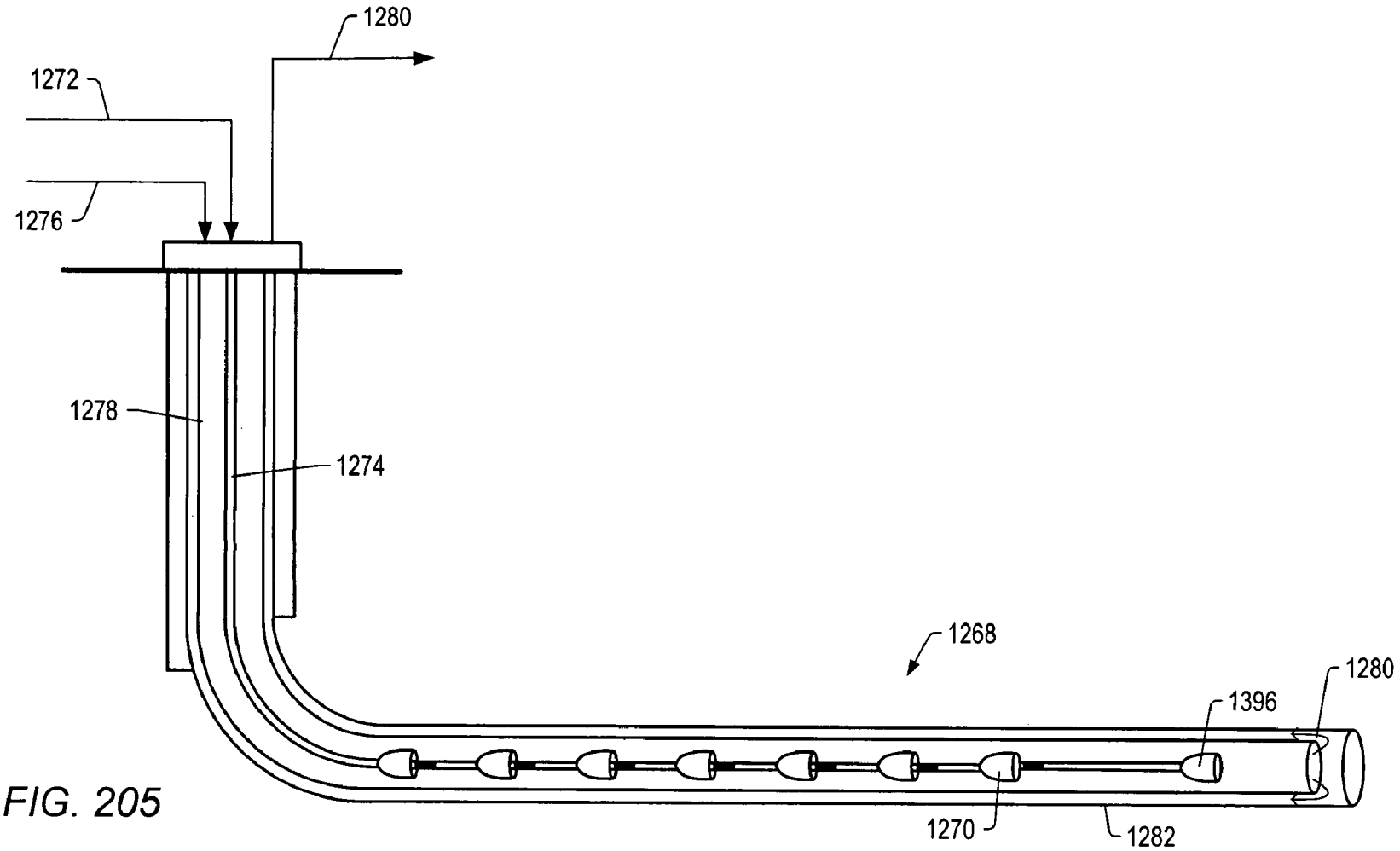

FIG. 205 depicts an embodiment of a downhole oxidizer assembly.

Figure 206:
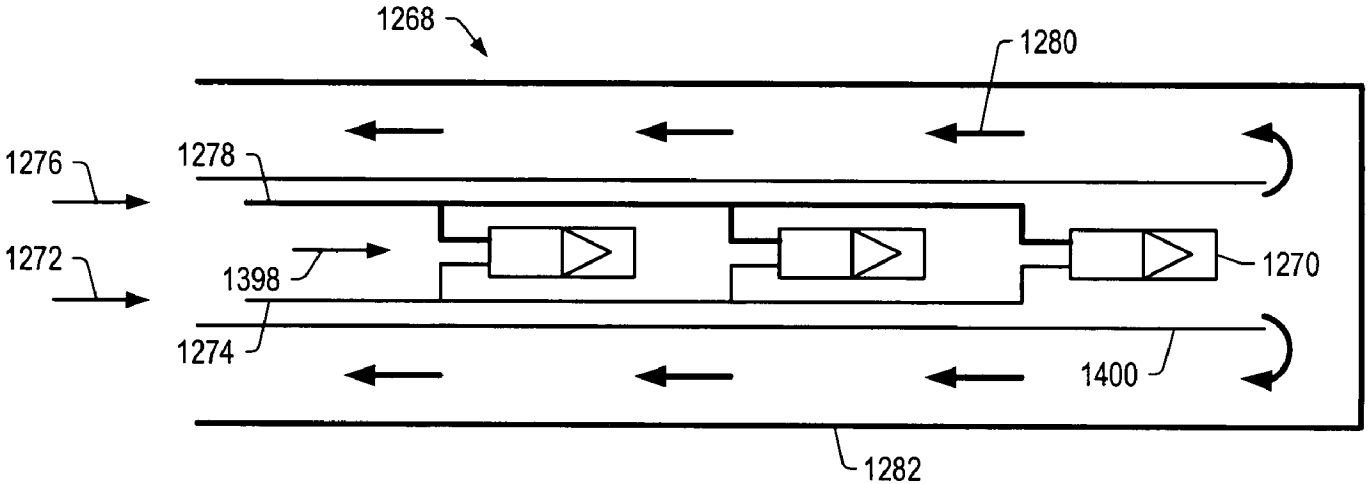

FIG. 206 depicts a schematic representation of a portion of a downhole oxidizer assembly with substantially parallel fuel and oxidizer conduits.

Figure 207:
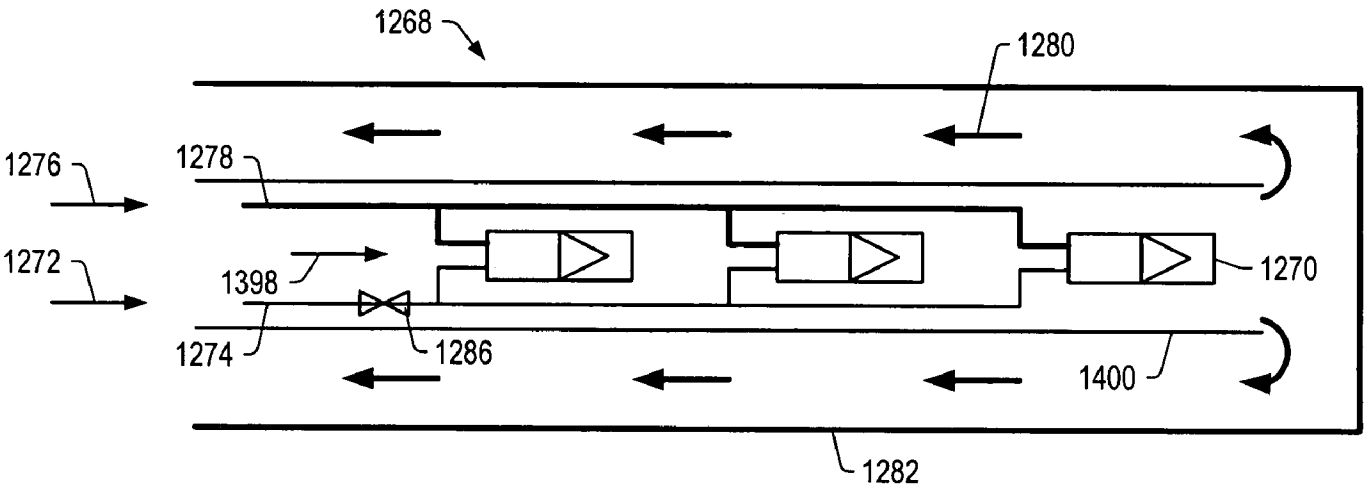

FIG. 207 depicts a schematic representation of a portion of a downhole oxidizer assembly with substantially parallel fuel and oxidizer conduits.

Figure 208:
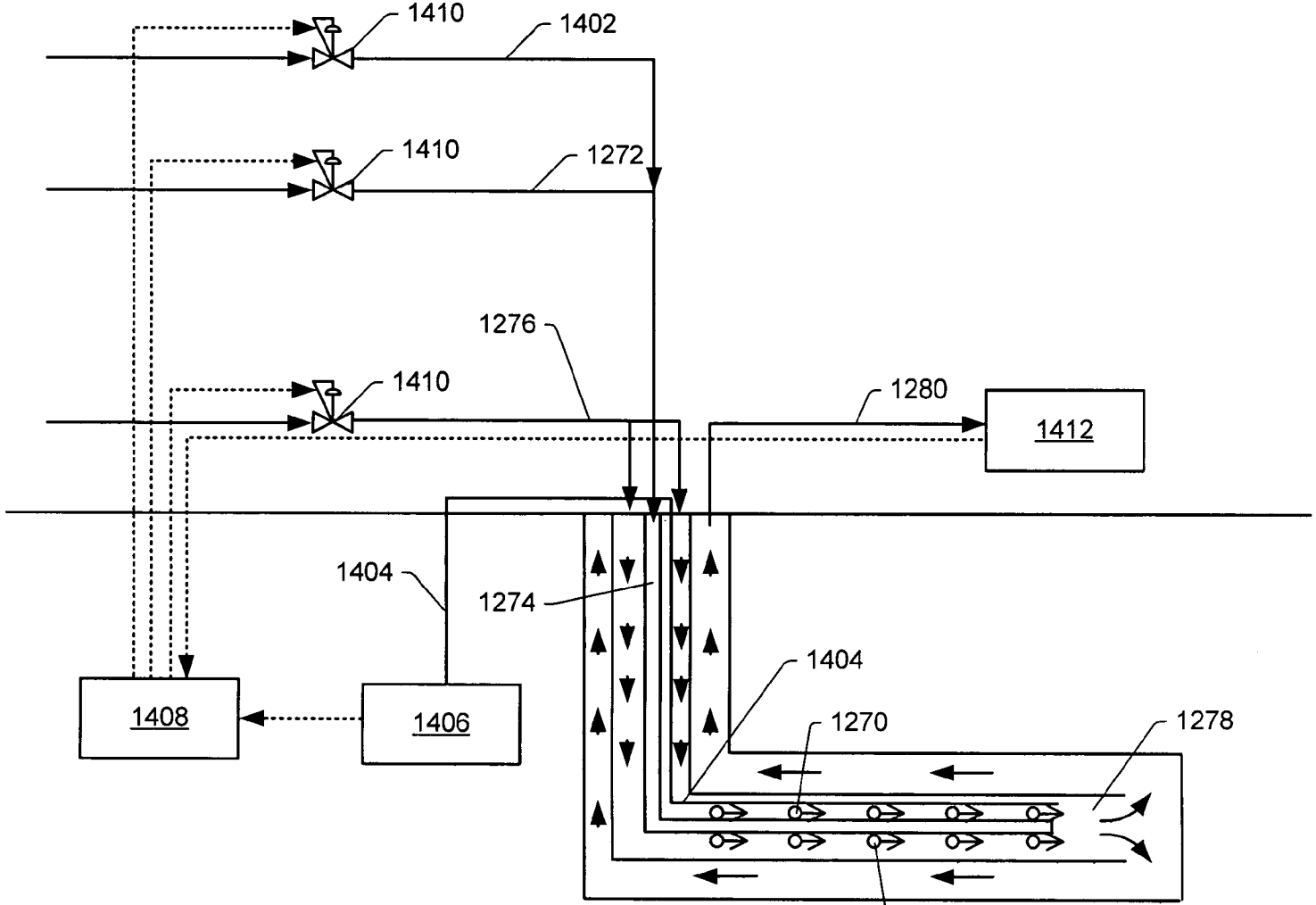

FIG. 208 depicts a schematic representation of an embodiment of a downhole oxidizer assembly coupled to a fiber optic system.

Figure 209:
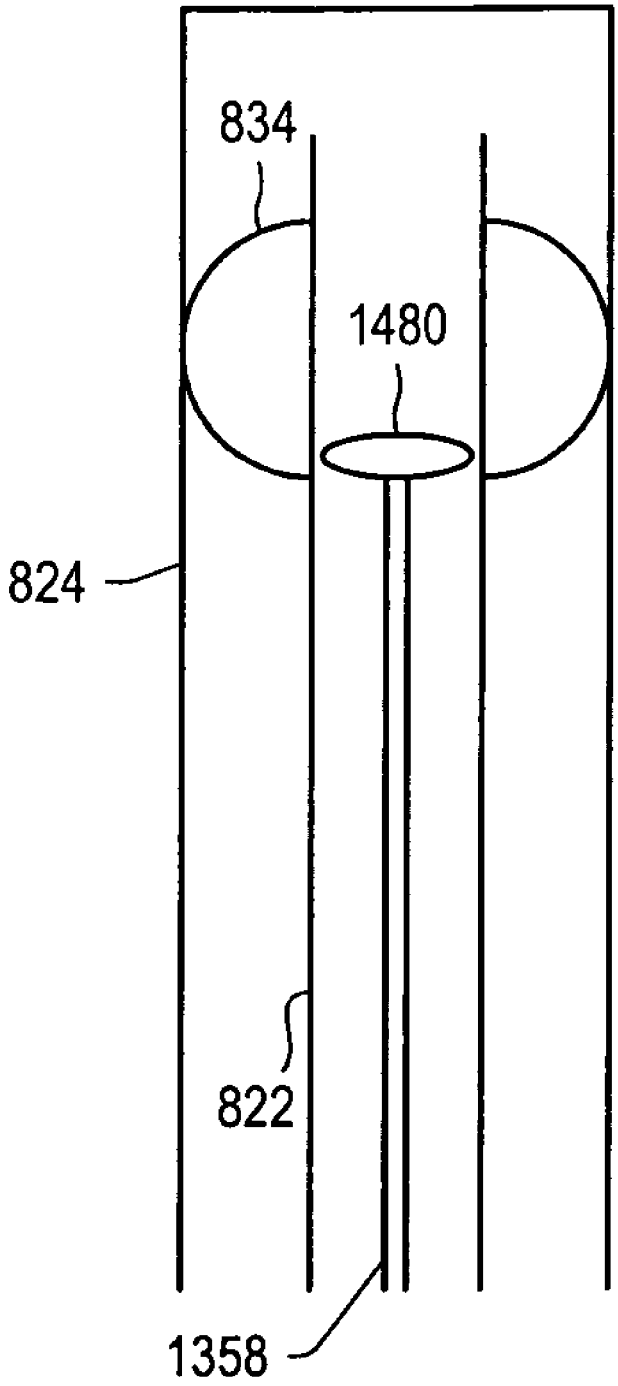

FIG. 209 depicts an embodiment of a fiber optic cable sleeve in a conductor-in-conduit heater.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The following description generally relates to systems and methods for treating a hydrocarbon containing formation (e.g., a formation containing coal (including lignite, sapropelic coal, etc.), oil shale, carbonaceous shale, shungites, kerogen, bitumen, oil, kerogen and oil in a low permeability matrix, heavy hydrocarbons, asphaltites, natural mineral waxes, formations in which kerogen is blocking production of other hydrocarbons, etc.). Such formations may be treated to yield relatively high quality products including, but not limited to, hydrocarbons and hydrogen.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids (e.g., hydrogen ($H_2$), nitrogen ($N_2$), carbon monoxide, carbon dioxide, hydrogen sulfide, water, and ammonia).

A "formation" includes one or more hydrocarbon containing layers, one or more non-hydrocarbon layers, an overburden, and/or an underburden. An "overburden" and/or an "underburden" includes one or more different types of impermeable materials. For example, overburden and/or underburden may include rock, shale, mudstone, or wet/tight carbonate (i.e., an impermeable carbonate without hydrocarbons). In some embodiments of in situ conversion processes, an overburden and/or an underburden may include a hydrocarbon containing layer or hydrocarbon containing layers that are relatively impermeable and are not subjected to temperatures during in situ conversion processing that results in significant characteristic changes of the hydrocarbon containing layers of the overburden and/or underburden. For example, an underburden may contain shale or mudstone. In some cases, the overburden and/or underburden may be somewhat permeable.

"Kerogen" is a solid, insoluble hydrocarbon that has been converted by natural degradation (e.g., by diagenesis) and that principally contains carbon, hydrogen, nitrogen, oxygen, and sulfur. Coal and oil shale are typical examples of materials that contain kerogen. "Bitumen" is a non-crystalline solid or viscous hydrocarbon material that is substantially soluble in carbon disulfide. "Oil" is a fluid containing a mixture of condensable hydrocarbons.

"Formation fluids" and "produced fluids" refer to fluids removed from a hydrocarbon containing formation and may include pyrolyzation fluid, synthesis gas, mobilized hydrocarbon, and water (steam). The term "mobilized fluid" refers to fluids in a hydrocarbon containing formation that are able to flow as a result of thermal treatment of the formation. Formation fluids may include hydrocarbon fluids as well as non-hydrocarbon fluids.

"Carbon number" refers to the number of carbon atoms in a molecule. A hydrocarbon fluid may include various hydrocarbons with different carbon numbers. The hydrocarbon fluid may be described by a carbon number distribution. Carbon numbers and/or carbon number distributions may be determined by true boiling point distribution and/or gas-liquid chromatography.

A "heat source" is any system for providing heat to at least a portion of a formation substantially by conductive and/or radiative heat transfer. For example, a heat source may include electric heaters such as an insulated conductor, an elongated member, and/or a conductor disposed in a conduit, as described in embodiments herein. A heat source may also include systems that generate heat by burning a fuel external to or in a formation, such as surface burners, downhole gas burners, flameless distributed combustors, and natural distributed combustors, as described in embodiments herein. In some embodiments, heat provided to or generated in one or more heat sources may be supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electric resistance heaters, some heat sources may provide heat from combustion, and some heat sources may provide heat from one or more other energy sources (e.g., chemical reactions, solar energy, wind energy, biomass, or other sources of renewable energy). A chemical reaction may include an exothermic reaction (e.g., an oxidation reaction). A heat source may also include a heater that provides heat to a zone proximate and/or surrounding a heating location such as a heater well.

A "heater" is any system for generating heat in a well or a near wellbore region. Heaters may be, but are not limited to, electric heaters, burners, combustors that react with material in or produced from a formation (e.g., natural distributed combustors), and/or combinations thereof. A "unit of heat sources" or a "unit of heaters" refers to a number of heat sources or heaters that form a template that is repeated to create a pattern of heat sources or heaters in a formation.

The term "wellbore" refers to a hole in a formation made by drilling or insertion of a conduit into the formation. A wellbore may have a substantially circular cross section, or another cross-sectional shape (e.g., elliptical, oval, square, rectangular, triangular, or other regular or irregular shape). As used herein, the terms "well" and "opening," when referring to an opening in the formation may be used interchangeably with the term "wellbore."

"Natural distributed combustor" refers to a heater that uses an oxidant to oxidize at least a portion of the carbon proximate a wellbore in a hydrocarbon containing formation to generate heat. Most of the combustion products produced in the natural distributed combustor are removed through the wellbore.

"Orifices" refer to openings (e.g., openings in conduits) having a wide variety of sizes and cross-sectional shapes including, but not limited to, circles, ovals, squares, rectangles, triangles, slits, or other regular or irregular shapes.

"Insulated conductor" refers to any elongated material that is able to conduct electricity and that is covered, in whole or in part, by an electrically insulating material. The term "self-controls" refers to controlling an output of a heater without external control of any type.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (e.g., a relatively permeable formation such as a tar sands formation) that is reacted or reacting to form a pyrolyzation fluid.

"Cracking" refers to a process involving decomposition and molecular recombination of organic compounds to produce a greater number of molecules than were initially present. In cracking, a series of reactions take place accompanied by a transfer of hydrogen atoms between molecules. For example, naphtha may undergo a thermal cracking reaction to form ethene and $H_2$.

"Superposition of heat" refers to providing heat from two or more heat sources to a selected section of a formation such that the temperature of the formation at least at one location between the heat sources is influenced by the heat sources.

"Thermal conductivity" is a property of a material that describes the rate at which heat flows, in steady state, between two surfaces of the material for a given temperature difference between the two surfaces.

"Fluid pressure" is a pressure generated by a fluid in a formation. "Lithostatic pressure" (sometimes referred to as "lithostatic stress") is a pressure in a formation equal to a weight per unit area of an overlying rock mass. "Hydrostatic pressure" is a pressure in a formation exerted by a column of water.

"Condensable hydrocarbons" are hydrocarbons that condense at 25° C. and one atmosphere absolute pressure. Condensable hydrocarbons may include a mixture of hydrocarbons having carbon numbers greater than 4.

"Non-condensable hydrocarbons" are hydrocarbons that do not condense at 25° C. and one atmosphere absolute pressure. Non-condensable hydrocarbons may include hydrocarbons having carbon numbers less than 5.

"Olefins" are molecules that include unsaturated hydrocarbons having one or more non-aromatic carbon-carbon double bonds.

"Synthesis gas" is a mixture including hydrogen and carbon monoxide. Additional components of synthesis gas may include water, carbon dioxide, nitrogen, methane, and other gases. Synthesis gas may be generated by a variety of processes and feedstocks. Synthesis gas may be used for synthesizing a wide range of compounds.

"Reforming" is a reaction of hydrocarbons (such as methane or naphtha) with steam to produce CO and $H_2$ as major products. Reforming may be conducted in the presence of a catalyst, although reforming can also be performed thermally without a catalyst.

"Sequestration" refers to storing a gas that is a by-product of a process rather than venting the gas to the atmosphere.

A "dipping" formation refers to a formation that slopes downward or inclines from a plane parallel to the Earth's surface, assuming the plane is flat (i.e., a "horizontal" plane). A "dip" is an angle that a stratum or similar feature makes with a horizontal plane. A "steeply dipping" hydrocarbon containing formation refers to a hydrocarbon containing formation lying at an angle of at least 20° from a horizontal plane. "Down dip" refers to downward along a direction parallel to a dip in a formation. "Up dip" refers to upward along a direction parallel to a dip of a formation. "Strike" refers to the course or bearing of hydrocarbon material that is normal to the direction of dip.

"Subsidence" is a downward movement of a portion of a formation relative to an initial elevation of the surface.

"Thickness" of a layer refers to the thickness of a cross section of the layer, wherein the cross section is normal to a face of the layer.

"Coring" is a process that generally includes drilling a hole into a formation and removing a substantially solid mass of the formation from the hole.

A "surface unit" is an ex situ treatment unit.

"Selected mobilized section" refers to a section of a formation that is at an average temperature within a mobilization temperature range. "Selected pyrolyzation section" refers to a section of a formation (e.g., a relatively permeable formation such as a tar sands formation) that is at an average temperature within a pyrolyzation temperature range.

"Enriched air" refers to air having a larger mole fraction of oxygen than air in the atmosphere. Air is typically enriched to increase combustion-supporting ability of the air.

"Heavy hydrocarbons" are viscous hydrocarbon fluids. Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may also include aromatics or other complex ring hydrocarbons.

Heavy hydrocarbons may be found in a relatively permeable formation. The relatively permeable formation may include heavy hydrocarbons entrained in, for example, sand or carbonate. "Relatively permeable" is defined, with respect to formations or portions thereof, as an average permeability of 10 millidarcy or more (e.g., 10 or 100 millidarcy). "Relatively low permeability" is defined, with respect to formations or portions thereof, as an average permeability of less than about 10 millidarcy. One darcy is equal to about 0.99 square micrometers. An impermeable layer generally has a permeability of less than about 0.1 millidarcy.

"Tar" is a viscous hydrocarbon that generally has a viscosity greater than about 10,000 centipoise at 15° C. The specific gravity of tar generally is greater than 1.000. Tar may have an API gravity less than 10°.

A "tar sands formation" is a formation in which hydrocarbons are predominantly present in the form of heavy hydrocarbons and/or tar entrained in a mineral grain framework or other host lithology (e.g., sand or carbonate).

In some cases, a portion or all of a hydrocarbon portion of a relatively permeable formation may be predominantly heavy hydrocarbons and/or tar with no supporting mineral grain framework and only floating (or no) mineral matter (e.g., asphalt lakes).

Certain types of formations that include heavy hydrocarbons may also be, but are not limited to, natural mineral waxes (e.g., ozocerite), or natural asphaltites (e.g., gilsonite, albertite, impsonite, wurtzilite, grahamite, and glance pitch). "Natural mineral waxes" typically occur in substantially tubular veins that may be several meters wide, several kilometers long, and hundreds of meters deep. "Natural asphaltites" include solid hydrocarbons of an aromatic composition and typically occur in large veins. In situ recovery of hydrocarbons from formations such as natural mineral waxes and natural asphaltites may include melting to form liquid hydrocarbons and/or solution mining of hydrocarbons from the formations.

"Upgrade" refers to increasing the quality of hydrocarbons. For example, upgrading heavy hydrocarbons may result in an increase in the API gravity of the heavy hydrocarbons.

"Low viscosity zone" refers to a section of a formation where at least a portion of the fluids are mobilized.

"Thermal fracture" refers to fractures created in a formation caused by expansion or contraction of a formation and/or fluids in the formation, which is in turn caused by increasing/decreasing the temperature of the formation and/or fluids in the formation, and/or by increasing/decreasing a pressure of fluids in the formation due to heating.

"Vertical hydraulic fracture" refers to a fracture at least partially propagated along a vertical plane in a formation, wherein the fracture is created through injection of fluids into the formation.

Figure 1:
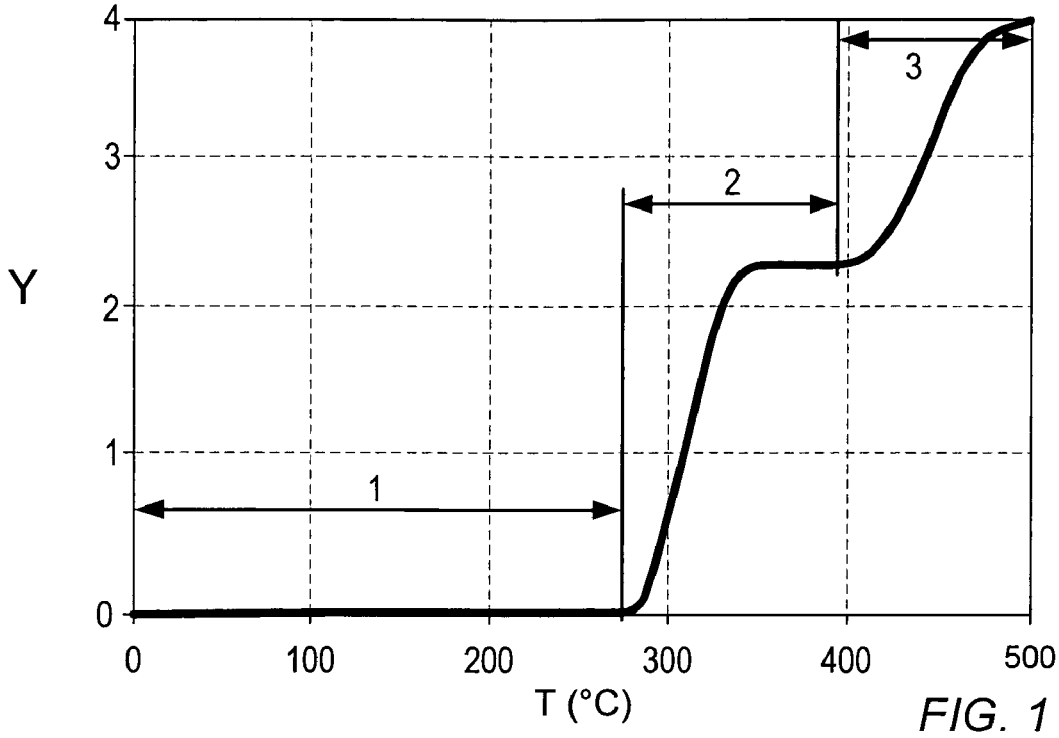
FIG. 1 depicts an illustration of stages of heating a hydrocarbon containing formation.

Hydrocarbons in formations may be treated in various ways to produce many different products. In certain embodiments, such formations may be treated in stages. FIG. 1 illustrates several stages of heating a hydrocarbon containing formation. FIG. 1 also depicts an example of yield (barrels of oil equivalent per ton) (y axis) of formation fluids from a hydrocarbon containing formation versus temperature (° C.) (x axis) of the formation.

Desorption of methane and vaporization of water occurs during stage 1 heating. Heating of the formation through stage 1 may be performed as quickly as possible. For example, when a hydrocarbon containing formation is initially heated, hydrocarbons in the formation may desorb adsorbed methane. The desorbed methane may be produced from the formation. If the hydrocarbon containing formation is heated further, water in the hydrocarbon containing formation may be vaporized. Water may occupy, in some hydrocarbon containing formations, between about 10% and about 50% of the pore volume in the formation. In other formations, water may occupy larger or smaller portions of the pore volume. Water typically is vaporized in a formation between about 160° C. and about 285° C. at pressures of about 6 bars absolute to 70 bars absolute. In some embodiments, the vaporized water may produce wettability changes in the formation and/or increase formation pressure. The wettability changes and/or increased pressure may affect pyrolysis reactions or other reactions in the formation. In certain embodiments, the vaporized water may be produced from the formation. In other embodiments, the vaporized water may be used for steam extraction and/or distillation in the formation or outside the formation. Removing the water from and increasing the pore volume in the formation may increase the storage space for hydrocarbons in the pore volume.

After stage 1 heating, the formation may be heated further, such that a temperature in the formation reaches (at least) an initial pyrolyzation temperature (e.g., a temperature at the lower end of the temperature range shown as stage 2). Hydrocarbons in the formation may be pyrolyzed throughout stage 2. A pyrolysis temperature range may vary depending on types of hydrocarbons in the formation. A pyrolysis temperature range may include temperatures between about 250° C. and about 900° C. A pyrolysis temperature range for producing desired products may extend through only a portion of the total pyrolysis temperature range. In some embodiments, a pyrolysis temperature range for producing desired products may include temperatures between about 250° C. to about 400° C. If a temperature of hydrocarbons in a formation is slowly raised through a temperature range from about 250° C. to about 400° C., production of pyrolysis products may be substantially complete when the temperature approaches 400° C. Heating the hydrocarbon containing formation with a plurality of heat sources may establish thermal gradients around the heat sources that slowly raise the temperature of hydrocarbons in the formation through a pyrolysis temperature range.

In some in situ conversion embodiments, a temperature of the hydrocarbons to be subjected to pyrolysis may not be slowly increased throughout a temperature range from about 250° C. to about 400° C. The hydrocarbons in the formation may be heated to a desired temperature (e.g., about 325° C.). Other temperatures may be selected as the desired temperature. Superposition of heat from heat sources may allow the desired temperature to be relatively quickly and efficiently established in the formation. Energy input into the formation from the heat sources may be adjusted to maintain the temperature in the formation substantially at the desired temperature. The hydrocarbons may be maintained substantially at the desired temperature until pyrolysis declines such that production of desired formation fluids from the formation becomes uneconomical. Parts of a formation that are subjected to pyrolysis may include regions brought into a pyrolysis temperature range by heat transfer from only one heat source.

Formation fluids including pyrolyzation fluids may be produced from the formation. The pyrolyzation fluids may include, but are not limited to, hydrocarbons, hydrogen, carbon dioxide, carbon monoxide, hydrogen sulfide, ammonia, nitrogen, water, and mixtures thereof. As the temperature of the formation increases, the amount of condensable hydrocarbons in the produced formation fluid may decrease. At high temperatures, the formation may produce mostly methane and/or hydrogen. If a hydrocarbon containing formation is heated throughout an entire pyrolysis range, the formation may produce only small amounts of hydrogen towards an upper limit of the pyrolysis range. After all of the available hydrogen is depleted, a minimal amount of fluid production from the formation will typically occur.

After pyrolysis of hydrocarbons, a large amount of carbon and some hydrogen may still be present in the formation. A significant portion of remaining carbon in the formation can be produced from the formation in the form of synthesis gas. Synthesis gas generation may take place during stage 3 heating depicted in FIG. 1. Stage 3 may include heating a hydrocarbon containing formation to a temperature sufficient to allow synthesis gas generation. For example, synthesis gas may be produced in a temperature range from about 400° C. to about 1200° C. The temperature of the formation when the synthesis gas generating fluid is introduced to the formation may determine the composition of synthesis gas produced in the formation. If a synthesis gas generating fluid is introduced into a formation at a temperature sufficient to allow synthesis gas generation, synthesis gas may be generated in the formation. The generated synthesis gas may be removed from the formation through a production well or production wells. A large volume of synthesis gas may be produced during generation of synthesis gas.

Total energy content of fluids produced from a hydrocarbon containing formation may stay relatively constant throughout pyrolysis and synthesis gas generation. During pyrolysis at relatively low formation temperatures, a significant portion of the produced fluid may be condensable hydrocarbons that have a high energy content. At higher pyrolysis temperatures, however, less of the formation fluid may include condensable hydrocarbons. More non-condensable formation fluids may be produced from the formation. Energy content per unit volume of the produced fluid may decline slightly during generation of predominantly non-condensable formation fluids. During synthesis gas generation, energy content per unit volume of produced synthesis gas declines significantly compared to energy content of pyrolyzation fluid. The volume of the produced synthesis gas, however, will in many instances increase substantially, thereby compensating for the decreased energy content.

Figure 2:
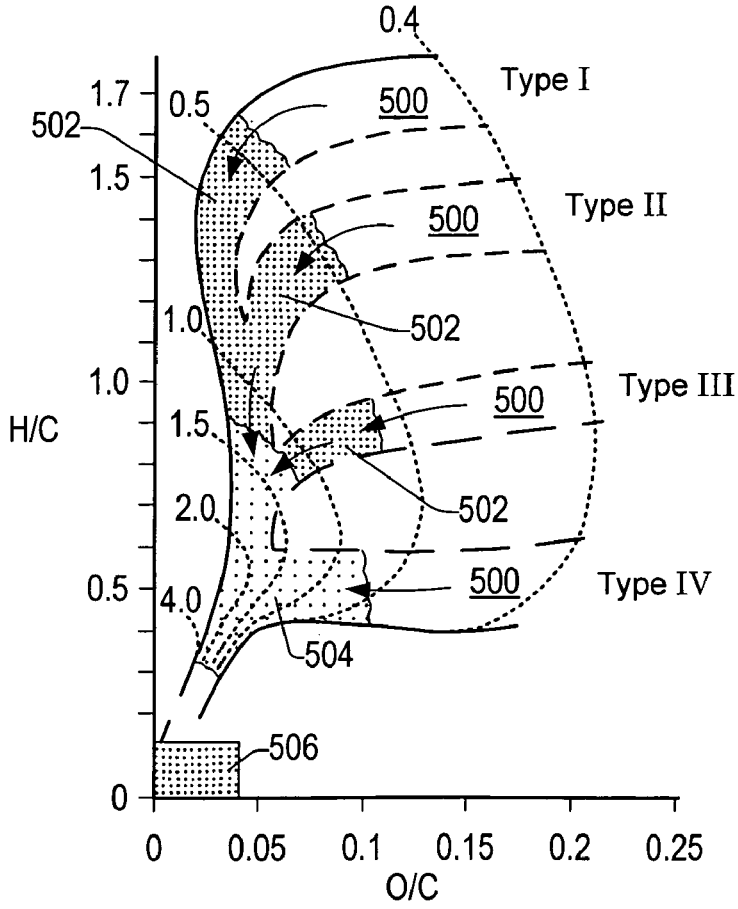
FIG. 2 depicts a diagram that presents several properties of kerogen resources.

FIG. 2 depicts a van Krevelen diagram. The van Krevelen diagram is a plot of atomic hydrogen to carbon ratio (y axis) versus atomic oxygen to carbon ratio (x axis) for various types of kerogen. The van Krevelen diagram shows the maturation sequence for various types of kerogen that typically occurs over geological time due to temperature, pressure, and biochemical degradation. The maturation sequence may be accelerated by heating in situ at a controlled rate and/or a controlled pressure.

A van Krevelen diagram may be useful for selecting a resource for practicing various embodiments. Treating a formation containing kerogen in region 500 may produce carbon dioxide, non-condensable hydrocarbons, hydrogen, and water, along with a relatively small amount of condensable hydrocarbons. Treating a formation containing kerogen in region 502 may produce condensable and non-condensable hydrocarbons, carbon dioxide, hydrogen, and water. Treating a formation containing kerogen in region 504 will in many instances produce methane and hydrogen. A formation containing kerogen in region 502 may be selected for treatment because treating region 502 kerogen may produce large quantities of valuable hydrocarbons, and low quantities of undesirable products such as carbon dioxide and water. A region 502 kerogen may produce large quantities of valuable hydrocarbons and low quantities of undesirable products because the region 502 kerogen has already undergone dehydration and/or decarboxylation over geological time. In addition, region 502 kerogen can be further treated to make other useful products (e.g., methane, hydrogen, and/or synthesis gas) as the kerogen transforms to region 504 kerogen.

If a formation containing kerogen in region 500 or region 502 is selected for in situ conversion, in situ thermal treatment may accelerate maturation of the kerogen along paths represented by arrows in FIG. 2. For example, region 500 kerogen may transform to region 502 kerogen and possibly then to region 504 kerogen. Region 502 kerogen may transform to region 504 kerogen. In situ conversion may expedite maturation of kerogen and allow production of valuable products from the kerogen.

If region 500 kerogen is treated, a substantial amount of carbon dioxide may be produced due to decarboxylation of hydrocarbons in the formation. In addition to carbon dioxide, region 500 kerogen may produce some hydrocarbons (e.g., methane). Treating region 500 kerogen may produce substantial amounts of water due to dehydration of kerogen in the formation. Production of water from kerogen may leave hydrocarbons remaining in the formation enriched in carbon. Oxygen content of the hydrocarbons may decrease faster than hydrogen content of the hydrocarbons during production of such water and carbon dioxide from the formation. Therefore, production of such water and carbon dioxide from region 500 kerogen may result in a larger decrease in the atomic oxygen to carbon ratio than in the atomic hydrogen to carbon ratio (see region 500 arrows in FIG. 2 which depict more horizontal than vertical movement).

If region 502 kerogen is treated, some of the hydrocarbons in the formation may be pyrolyzed to produce condensable and non-condensable hydrocarbons. For example, treating region 502 kerogen may result in production of oil from hydrocarbons, as well as some carbon dioxide and water. In situ conversion of region 502 kerogen may produce significantly less carbon dioxide and water than is produced during in situ conversion of region 500 kerogen. Therefore, the atomic hydrogen to carbon ratio of the kerogen may decrease rapidly as the kerogen in region 502 is treated. The atomic oxygen to carbon ratio of region 502 kerogen may decrease much slower than the atomic hydrogen to carbon ratio of region 502 kerogen.

Kerogen in region 504 may be treated to generate methane and hydrogen. For example, if such kerogen was previously treated (e.g., the kerogen was previously region 502 kerogen), then after pyrolysis longer hydrocarbon chains of the hydrocarbons may have cracked and been produced from the formation. Carbon and hydrogen, however, may still be present in the formation.

If kerogen in region 504 is heated to a synthesis gas generating temperature and a synthesis gas generating fluid (e.g., steam) is added to the region 504 kerogen, then at least a portion of remaining hydrocarbons in the formation may be produced from the formation in the form of synthesis gas. For region 504 kerogen, the atomic hydrogen to carbon ratio and the atomic oxygen to carbon ratio in the hydrocarbons may significantly decrease as the temperature rises. Hydrocarbons in the formation may be transformed into relatively pure carbon in region 504. Heating region 504 kerogen to still higher temperatures may transform such kerogen into graphite 506.

A hydrocarbon containing formation may have a number of properties that depend on a composition of the hydrocarbons in the formation. Such properties may affect the composition and amount of products that are produced from a hydrocarbon containing formation during in situ conversion. Properties of a hydrocarbon containing formation may be used to determine if and/or how a hydrocarbon containing formation is to be subjected to in situ conversion.

Kerogen is composed of organic matter that has been transformed due to a maturation process. Hydrocarbon containing formations may include kerogen. The maturation process for kerogen may include two stages: a biochemical stage and a geochemical stage. The biochemical stage typically involves degradation of organic material by aerobic and/or anaerobic organisms. The geochemical stage typically involves conversion of organic matter due to temperature changes and significant pressures. During maturation, oil and gas may be produced as the organic matter of the kerogen is transformed.

The van Krevelen diagram shown in FIG. 2 classifies various natural deposits of kerogen. For example, kerogen may be classified into four distinct groups: type I, type II, type III, and type IV, which are illustrated by the four branches of the van Krevelen diagram. The van Krevelen diagram shows the maturation sequence for kerogen that typically occurs over geological time due to temperature and pressure. Classification of kerogen type may depend upon precursor materials of the kerogen. The precursor materials transform over time into macerals. Macerals are microscopic structures that have different structures and properties depending on the precursor materials from which they are derived. A hydrocarbon containing formation described as a type I or type II kerogen may primarily contain macerals from the liptinite group. Liptinites are derived from plants, specifically the lipid rich and resinous parts of plants. The concentration of hydrogen in liptinite may be as high as 9% by weight. In addition, liptinite has a relatively high hydrogen to carbon ratio and a relatively low atomic oxygen to carbon ratio.

A type I kerogen may be classified as an alginite, since type I kerogen developed primarily from algal bodies. Type I kerogen may result from deposits made in lacustrine environments. Type II kerogen may develop from organic matter that was deposited in marine environments.

Type III kerogen may generally include vitrinite macerals. Vitrinite is derived from cell walls and/or woody tissues (e.g., stems, branches, leaves, and roots). Type III kerogen may be present in most humic coals. Type III kerogen may develop from organic matter that was deposited in swamps. Type IV kerogen includes the inertinite maceral group. The inertinite maceral group is composed of plant material such as leaves, bark, and stems that have undergone oxidation during the early peat stages of burial diagenesis. Inertinite maceral is chemically similar to vitrinite, but has a high carbon content and low hydrogen content.

The dashed lines in FIG. 2 correspond to vitrinite reflectance. Vitrinite reflectance is a measure of maturation. As kerogen undergoes maturation, the composition of the kerogen usually changes due to expulsion of volatile matter (e.g., carbon dioxide, methane, and oil) from the kerogen. Rank classifications of kerogen indicate the level to which kerogen has matured. For example, as kerogen undergoes maturation, the rank of kerogen increases. As rank increases, the volatile matter in, and producible from, the kerogen tends to decrease. In addition, the moisture content of kerogen generally decreases as the rank increases. At higher ranks, the moisture content may reach a relatively constant value.

Each hydrocarbon containing layer of a formation may have a potential formation fluid yield or richness. Richness may vary in a hydrocarbon layer and between different hydrocarbon layers in a formation. Richness may depend on many factors including the conditions under which the hydrocarbon containing layer was formed, an amount of hydrocarbons in the layer, and/or a composition of hydrocarbons in the layer. Richness of a hydrocarbon layer may be estimated in various ways. For example, richness may be measured by a Fischer Assay. The Fischer Assay is a standard method which involves heating a sample of a hydrocarbon containing layer to approximately 500° C. in one hour, collecting products produced from the heated sample, and quantifying products. A sample of a hydrocarbon containing layer may be obtained from a hydrocarbon containing formation by a method such as coring or any other sample retrieval method.

An in situ conversion process may be used to treat formations with hydrocarbon layers that have thicknesses greater than about 10 m. Thick formations may allow for placement of heat sources so that superposition of heat from the heat sources efficiently heats the formation to a desired temperature. Formations having hydrocarbon layers that are less than 10 m thick may also be treated using an in situ conversion process. In some in situ conversion embodiments of thin hydrocarbon layer formations, heat sources may be inserted in or adjacent to the hydrocarbon layer along a length of the hydrocarbon layer (e.g., with horizontal or directional drilling). Heat losses to layers above and below the thin hydrocarbon layer or thin hydrocarbon layers may be offset by an amount and/or a quality of fluid produced from the formation.

Figure 3:
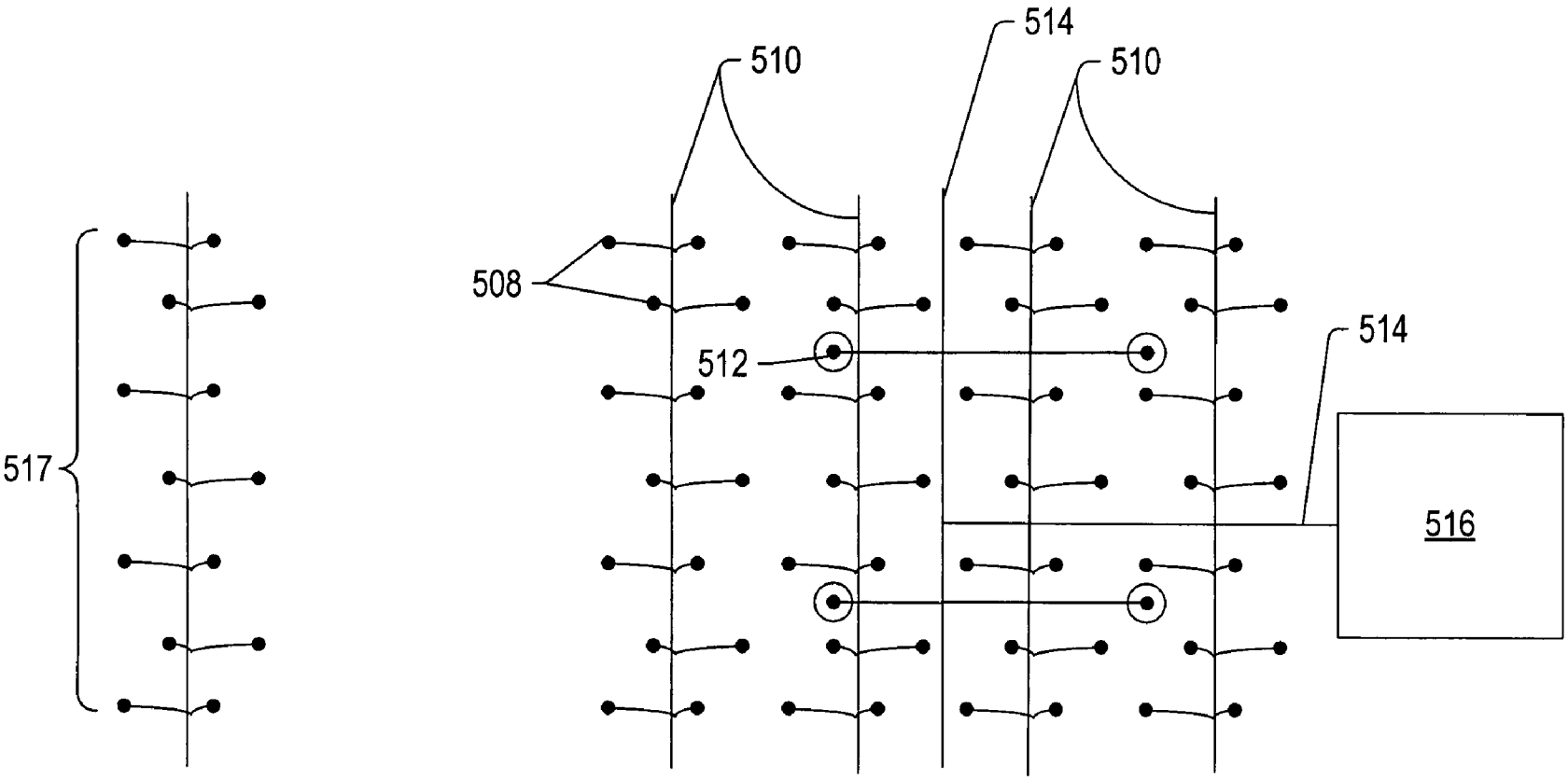
FIG. 3 shows a schematic view of an embodiment of a portion of an in situ conversion system for treating a hydrocarbon containing formation.

FIG. 3 depicts a schematic view of an embodiment of a portion of an in situ conversion system for treating a hydrocarbon containing formation. Heat sources 508 may be placed in at least a portion of the hydrocarbon containing formation. Heat sources 508 may include, for example, electric heaters such as insulated conductors, conductor-in-conduit heaters, surface burners, flameless distributed combustors, and/or natural distributed combustors. Heat sources 508 may also include other types of heaters. Heat sources 508 may provide heat to at least a portion of a hydrocarbon containing formation. Energy may be supplied to heat sources 508 through supply lines 510. Supply lines 510 may be structurally different depending on the type of heat source or heat sources used to heat the formation. Supply lines 510 for heat sources may transmit electricity for electric heaters, may transport fuel for combustors, or may transport heat exchange fluid that is circulated in the formation.

Production wells 512 may be used to remove formation fluid from the formation. Formation fluid produced from production wells 512 may be transported through collection piping 514 to treatment facilities 516. Formation fluids may also be produced from heat sources 508. For example, fluid may be produced from heat sources 508 to control pressure in the formation adjacent to the heat sources. Fluid produced from heat sources 508 may be transported through tubing or piping to collection piping 514 or the produced fluid may be transported through tubing or piping directly to treatment facilities 516. Treatment facilities 516 may include separation units, reaction units, upgrading units, fuel cells, turbines, storage vessels, and/or other systems and units for processing produced formation fluids.

An in situ conversion system for treating hydrocarbons may include barrier wells 517. Barrier wells may be used to form a barrier around a treatment area. The barrier may inhibit fluid flow into and/or out of the treatment area. Barrier wells may be, but are not limited to, dewatering wells, vacuum wells, capture wells, injection wells, grout wells, freeze wells, or combinations thereof. In some embodiments, barrier wells 517 may be dewatering wells. Dewatering wells may remove liquid water and/or inhibit liquid water from entering a portion of a hydrocarbon containing formation to be heated, or to a formation being heated. A plurality of water wells may surround all or a portion of a formation to be heated. In the embodiment depicted in FIG. 3, the dewatering wells are shown extending only along one side of heat sources 508, but dewatering wells typically encircle all heat sources 508 used, or to be used, to heat the formation.

As shown in FIG. 3, in addition to heat sources 508, one or more production wells 512 will typically be placed in the portion of the hydrocarbon containing formation. Formation fluids may be produced through production well 512. In some embodiments, production well 512 may include a heat source. The heat source may heat the portions of the formation at or near the production well and allow for vapor phase removal of formation fluids. The need for high temperature pumping of liquids from the production well may be reduced or eliminated. Avoiding or limiting high temperature pumping of liquids may significantly decrease production costs. Providing heating at or through the production well may: (1) inhibit condensation and/or refluxing of production fluid when such production fluid is moving in the production well proximate the overburden, (2) increase heat input into the formation, and/or (3) increase formation permeability at or proximate the production well. In some in situ conversion process embodiments, an amount of heat supplied to production wells is significantly less than an amount of heat applied to heat sources that heat the formation.

In certain embodiments, production wells may include collection devices (e.g., trays) to inhibit fluids from refluxing into the formation. Refluxing may be a problem in formations with relatively thick overburdens (e.g., about 150 m, about 300 m, or thicker overburdens found in oil shale formations). Cooling of fluids in thick overburdens may be inhibited by heating all or portions of a production well in an overburden. Providing heat in the overburden, however, may be costly and/or may lead to increased cracking or coking in the overburden. One or more collection devices may be used to collect refluxing fluids in an overburden of a production well. Fluids collected in a collection device may be removed from the collection device using, for example, a pump or gas lifting.

Figure 4:
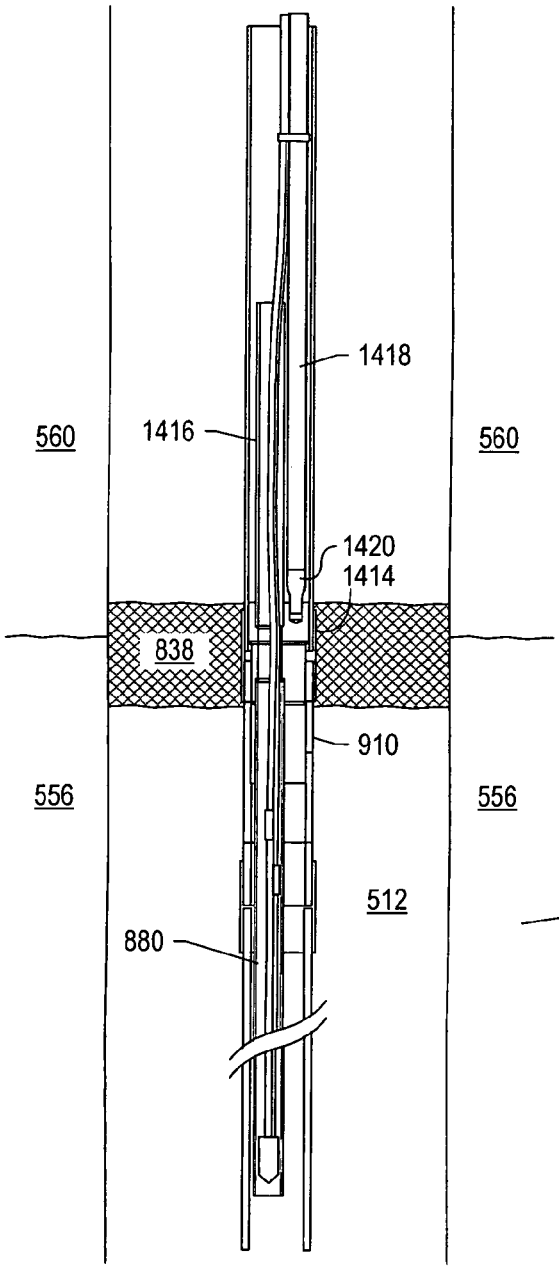
FIG. 4 depicts an embodiment of a collection device in a production well.

FIG. 4 depicts an embodiment of a collection device in a production well. Production well 512 may include production conduit 910. Collection device 1414 may be coupled to or located proximate production conduit 910 in overburden 560. Collection device 1414 may be located at or near a junction of overburden 560 and hydrocarbon layer 556. In certain embodiments, collection device 1414 is a tray or baffle that allows vapor to move upwards through a hole or conduit in the collection device but inhibits passage of fluid downwards inside production conduit 910. Packing material 838 may inhibit flow of fluids between an overburden portion and a hydrocarbon layer portion of production well 512.

In some embodiments, production well 512 or production conduit 910 may include heater 880 to maintain vapor production in production conduit 910. Heater 880 may provide heat to vaporize liquids in a portion of production well 512 proximate hydrocarbon layer 556. Heater 880 may be located in production conduit 910 or may be coupled to the production conduit (e.g., coupled to the outside of the production conduit). In some embodiments, heater 880 may have a separate feedthrough through packing material 838.

Vapors in production conduit 910 may cool as the vapors rise towards the surface in the production conduit. In some embodiments, a portion of the vapors may condense in the production conduit. Collection device 1414 may include riser 1416. Riser 1416 may be a conduit or tube extending from collection device 1414. Vapors may flow through riser 1416. Vapors (e.g., steam and high boiling point hydrocarbons) may condense on the walls of production conduit above riser 1416. Condensed fluid may run down the walls of production conduit 910 and collect in the annular space of the production conduit above collection device 1414. Condensed fluid may be produced through the annulus of production conduit 910.

Collection device 1414 may inhibit condensed fluid inside production well 512 from passing from overburden 560 into a heated part of the production well. Fluids collected in collection device 1414 may be removed from the collection device by pump 1420 through conduit 1418. Pump 1420 may be, but is not limited to being, a sucker rod pump, an electrical pump, or a progressive cavity pump (Moyno style). In some embodiments, fluids may be gas lifted through conduit 1418. Producing condensed fluid may reduce costs associated with removing heat from fluids at a wellhead of a production well.

In some embodiments, an injection conduit may be used to inject a diluent into production conduit 910 to dilute fluids and inhibit clogging in the production conduit, pump 1420, and conduit 1418. In some embodiments, riser 1416 may extend to the surface of production well 512. Riser 1416 may have perforations or openings at or near the bottom of the riser to allow condensed fluid to collect at collection device 1414. In certain embodiments, one or more collection devices 1414 may be used to fractionate or distill fluids as the fluids are produced from a formation.

Figure 5:
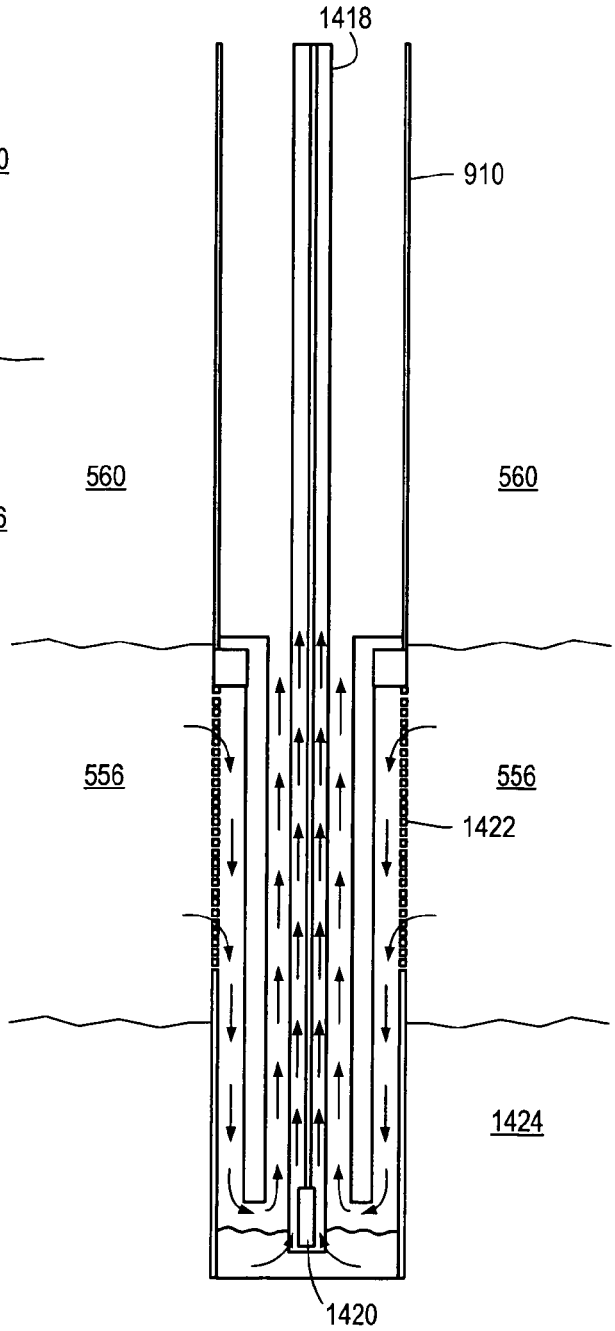
FIG. 5 depicts an embodiment a shroud assembly in a production well.

In some embodiments, fluids (gases and liquids) may be directed to a bottom of a production well using a shroud assembly. The fluids may be produced from the bottom of the production well. FIG. 5 depicts an embodiment a shroud assembly in a production well. Shroud assembly 1422 may be located on a portion of production conduit 910 proximate hydrocarbon layer 556. Hydrocarbon layer 556 may be heated using heaters located in other portions of the formation and/or a heater located in production conduit 910. Shroud assembly 1422 may have openings (e.g., perforations, slits, or slots) that allow fluids to enter production conduit 910 from hydrocarbon layer 556. Fluids (e.g., gas and liquid) may be directed by shroud assembly 1422 towards cool zone 1424 (as shown by arrows in FIG. 5). Cool zone 1424 may be an underburden of the formation. Steam and high boiling point hydrocarbons may condense along the wall of production conduit 910 in cool zone 1424. Liquids and condensed vapors may collect in cool zone 1424. Collected liquids and condensed vapors may be pumped to the surface through conduit 1418 using pump 1420. Gases and low boiling point vapors may travel up the annulus of production conduit 910 outside conduit 1418. Gases and low boiling point vapors may be reheated while passing proximate heated hydrocarbon layer 556.

Different types of barriers may be used to form a perimeter barrier around a treatment area. In some embodiments, the barrier is a frozen barrier formed by freeze wells positioned at desired locations around the treatment area. The perimeter barrier may be, but is not limited to, a frozen barrier surrounding the treatment area, dewatering wells, a grout wall formed in the formation, a sulfur cement barrier, a barrier formed by a gel produced in the formation, a barrier formed by precipitation of salts in the formation, a barrier formed by a polymerization reaction in the formation, and/or sheets driven into the formation.

A frozen barrier defining a treatment area may be formed by freeze wells. Vertical and/or horizontally positioned freeze wells may be positioned around sides of a treatment area. If upward or downward water seepage will occur, or may occur, into a treatment area, horizontally positioned freeze wells may be used to form an upper and/or lower barrier for the treatment area. In some embodiments, an upper barrier and/or a lower barrier may be needed to inhibit migration of fluid from the treatment area. In some embodiments, an upper barrier and/or a lower barrier may not be necessary if an upper or lower layer is substantially impermeable (e.g., a substantially unfractured shale layer).

Heat sources, production wells, injection wells, and/or dewatering wells may be installed in a treatment area prior to, simultaneously with, or after installation of a barrier (e.g., freeze wells). In some embodiments, portions of heat sources, production wells, injection wells, and/or dewatering wells that pass through a low temperature zone created by a freeze well or freeze wells may be insulated and/or heat traced so that the low temperature zone does not adversely affect the functioning of the heat sources, production wells, injection wells and/or dewatering wells passing through the low temperature zone.

Upon isolation of a treatment area with a barrier, dewatering wells may be used to remove water from the treatment area. Dewatering wells may be employed to remove some or substantially all of the water in the treatment area. Removing water from the treatment area may reduce the pressure in the treatment area. Removing water and/or reducing the pressure in the treatment area may facilitate production of methane from the treatment area. Removing water with dewatering wells may increase the amount of methane produced from the treatment area and/or the production rate of methane from the treatment area.

One problem that may be associated with removing water to increase production of methane from a treatment area is the continuing decrease in pressure in the treatment area. Pressure in the treatment area may continue to drop as water is removed. Removal of all or almost all of the water in the treatment area may result in pressure adjacent to a production well or production wells in the treatment area decreasing to near or sub-atmospheric pressure. A rate of production of methane may significantly decrease when the pressure becomes too low. Also, methane produced from the treatment area at low pressure may need to be recompressed for transport. Recompressing produced methane can significantly increase production costs of methane. When the pressure of the produced methane drops below about 200 psi, compression costs may increase significantly.

In some embodiments, injection wells may be positioned in treatment areas. In an embodiment, injection wells may be positioned just inside of a barrier. In some embodiments, injection wells may be positioned in a pattern throughout a treatment area. Injection wells may be used to inject carbon dioxide and/or other drive fluids into the treatment area. Carbon dioxide injection may have several beneficial effects. Injecting carbon dioxide in the treatment area may stabilize and/or increase the pressure (e.g., bottom hole pressure) in the treatment area as water and/or methane is removed from the treatment area. Increasing and/or stabilizing the pressure at a level above atmospheric pressure may increase the rate and/or pressure of the methane produced from the treatment area. Increasing the pressure of produced methane from the treatment area may reduce costs associated with recompressing the methane for transport.

Injecting carbon dioxide into a treatment area may have benefits in addition to pressure control. Perimeter barriers formed around the treatment area may develop breaks and/or fractures during production of the treatment area. Breaks and/or fractures may exist in the perimeter barrier due to incomplete formation of the barrier. Fractures in the barrier may allow water from portions of the formation surrounding the treatment area to enter the treatment area. Water entering the treatment area from surrounding portions may make removal of a substantial portion of or all of the water in the treatment area difficult. The presence or influx of water may reduce production of methane from the treatment area. Injecting carbon dioxide into the treatment area may increase the pressure in the treatment area above the pressure of surrounding portions of the formation. Increasing pressure in the treatment area near or above the pressure of surrounding portions of the formation may inhibit water from entering the treatment area through any fractures in the perimeter barrier.

Injecting carbon dioxide into a treatment area may assist in displacing methane in the treatment area. Carbon dioxide may be more readily adsorbed than methane on coal at a particular temperature. Injected carbon dioxide may adsorb onto the coal in the treatment area. The adsorbed carbon dioxide may displace sorbed methane in the treatment area. Displacing sorbed methane with carbon dioxide may have the added benefit of sequestering carbon dioxide in the treatment area. Sequestering carbon dioxide underground in hydrocarbon containing formations may have positive environmental benefits.

Treatment areas isolated by barriers may be subjected to various in situ processing procedures. Heater wells may be formed in the treatment area. Some or all dewatering wells and/or injections wells may be converted to heater wells. Heat sources may be positioned in the heater wells. Heat sources may be activated to begin heating the formation. Heat from the heat sources may release methane entrained in the formation. The methane may be produced from production wells in the treatment area. The methane may be released during initial heating of the treatment area to a pyrolysis temperature range. In some embodiments, a portion of the formation may be heated to release entrained methane without the need to heat the formation to an initial pyrolysis temperature. The temperature may be raised until production of methane decreases below a desired rate.

In some embodiments, formations (e.g., a coal formation) are divided into several portions or treatment areas. The treatment areas may be isolated from each other by barriers. In some embodiments, treatment areas may form a pattern. In an embodiment the formation may be divided into 0.5 mile squares. In some embodiments, treatment areas may be positioned adjacent each other. Adjacent treatment areas may share a portion of a perimeter barrier.

Before, during, and/or after production of a first treatment area, a second perimeter barrier may be formed around a second treatment area. The barriers around the first and second treatment areas may share a common portion. After the first treatment area has been developed (e.g., water removed, methane produced, and/or subjected to an in situ process) and a second perimeter barrier formed, water may be pumped from the second treatment area using dewatering wells. Water pumped from the second treatment area may be pumped into the first treatment area for storage. After pumping water from the second treatment area, the second treatment area may be developed (e.g., water removed, methane produced, pyrolysis fluid production, and/or synthesis gas production). Storing water pumped from one treatment area in another treatment area may be economically beneficial. Water stored underground in a post-treatment area may not have to be treated and/or purified. Storing water underground may have positive environmental benefits, such as reducing the environmental impact of pumping brine from treatment areas to the surface.

Computer simulations were conducted to demonstrate the utility of using freeze well barriers and/or carbon dioxide injection for increasing production of fluids from a hydrocarbon containing formation. Simulations were conducted utilizing a Comet2 Numerical Simulator. Simulations focused on the effect of frozen barriers and/or on the effect of carbon dioxide injection on methane production from coal formations. Three simulations were run. In each of the simulations, the coal formation was dewatered, and fluids including methane were produced. Each of the simulations used the following properties: 320 acre (about 1.3 $km^2$) pattern; coal thickness of 30 ft (about 9.1 m); coal depth of 3250 ft (about 991 m); initial pressure of 1650 psi (about 114 bars); initial horizontal permeability of 10.5 millidarcy (md); vertical permeability of 0 md; a cleat porosity of 0.2%; stress sensitive permeability added during simulation run; and 400 barrels/day (about 63.6 $m^3$/day) aquifer influx. The first simulation did not include barriers or carbon dioxide injection. In the second simulation, a frozen barrier was present to isolate the formation from adjacent formations and/or aquifers. In the third simulation, carbon dioxide was injected into the treatment area defined by a frozen barrier.

Figure 6:
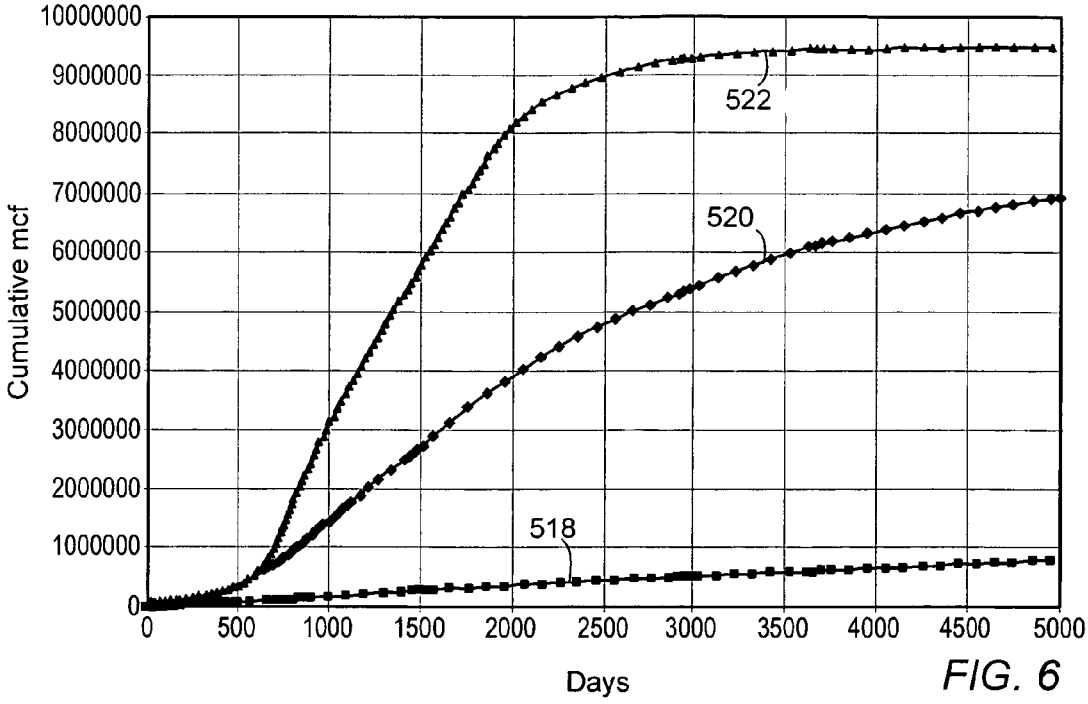
FIG. 6 depicts a plot of cumulative methane production over a period of about 5000 days for three different computer simulations of a coal formation.

FIG. 6 depicts a plot of cumulative methane production for the three simulations over a period of about 5000 days. First simulation curve 518 shows that cumulative methane production from the first simulation (no barrier or carbon dioxide injection) was relatively steady and never rose above 1 million mcf over the 5000 day period. Second simulation curve 520 shows that cumulative methane increased relative to the first simulation. The second simulation predicted cumulative methane production of about 7 million mcf after about 5000 days. Third simulation curve 522 shows that cumulative methane production for the third simulation increased and reached an endpoint of production quicker than for the other two simulations. The third simulation predicted cumulative methane production of about 9.5 million mcf after about 3500 days.

Figure 7:
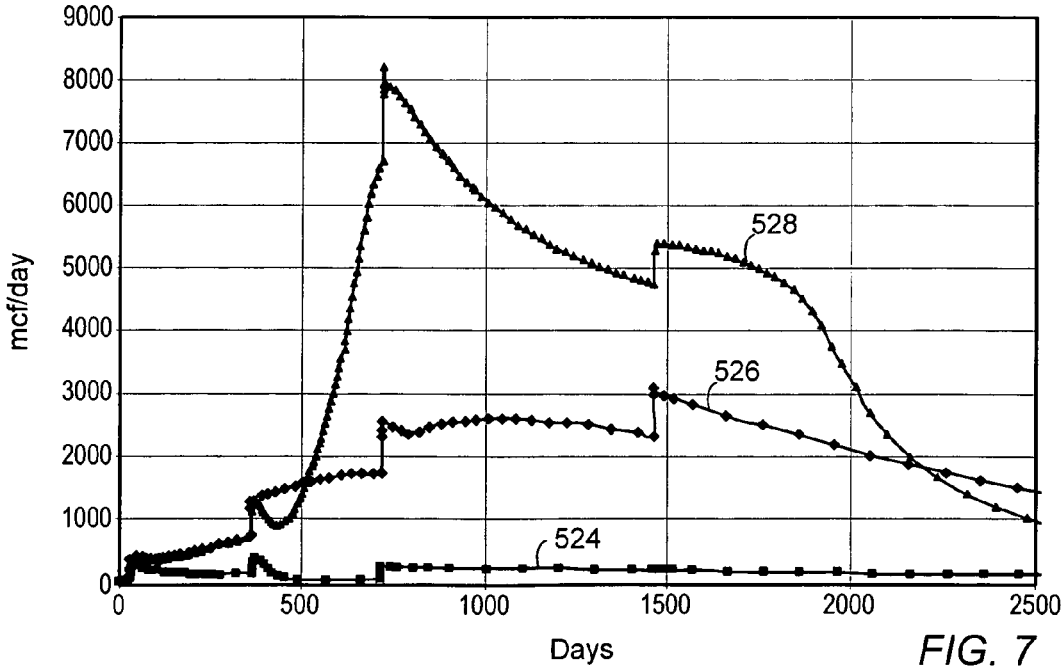
FIG. 7 depicts a plot of methane production rates per day over a period of about 2500 days for three different computer simulations of a coal formation.

FIG. 7 depicts a plot of methane production rates per day over a period of about 2500 days for the three computer simulations. Curve 524 depicts methane production rate per day for the first simulation. The methane production was relatively steady throughout the observed period. The methane production averaged about 100 mcf/day. Curve 526 depicts daily methane production rate for the second simulation (with a frozen barrier). The daily production rate was significantly greater that the production rate for the simulation without the barrier. Methane production rate topped out at about 3000 mcf/day at about day 1470 for the second simulation. Curve 528 depicts methane production rate for the third simulation (with a frozen barrier and with carbon dioxide injection). The methane production rate was high and showed a significant increase in between about day 480 and about day 745. After the maximum production rate was achieved around day 745, the rate of production decreased, but remained higher than the production rates of the other two simulations until about day 2200.

Figure 8:
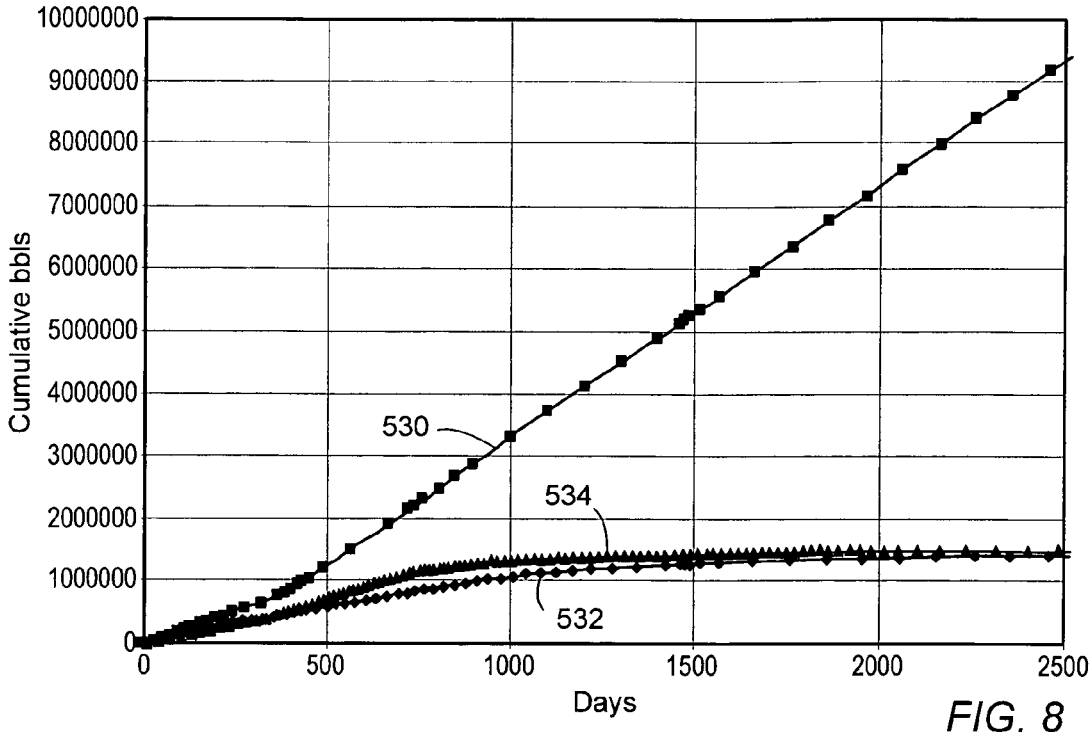
FIG. 8 depicts a plot of cumulative water production over a period of about 2500 days for three different computer simulations of a coal formation.

FIG. 8 depicts a plot of cumulative water production over a period of about 2500 days for the three different computer simulations. Curve 530 depicts cumulative water production for the first simulation. Water production continues throughout the entire simulation time frame. Curve 532 depicts cumulative water production for the second simulation (with a frozen barrier). Water production from the formation substantially stops after about 1500 days. Curve 534 depicts cumulative water production for the third simulation (with a frozen barrier and with carbon dioxide injection). Water production from the formation depicted in curve 534 is slightly more than the water production from the formation depicted in curve 532, but water production from the formation substantially stops around day 1000. The increase in water production may be due in part to water displaced by the higher pressure achieved by the injection of the carbon dioxide.

Figure 9:
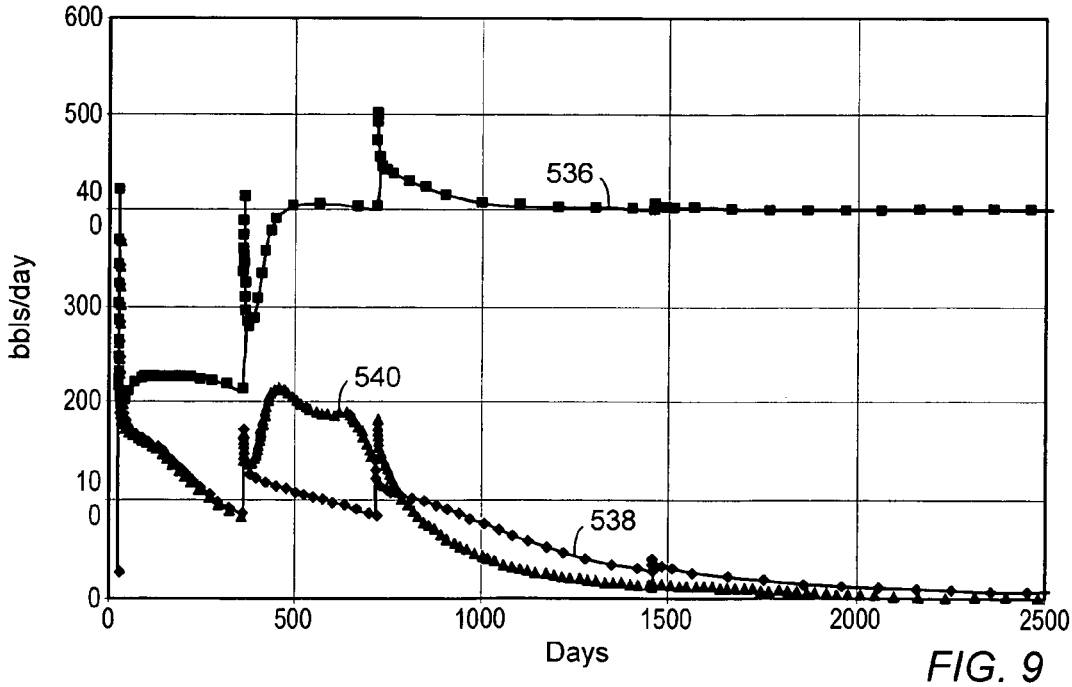
FIG. 9 depicts a plot of water production rates per day over a period of about 2500 days for three different computer simulations of a coal formation.

FIG. 9 depicts a plot of water production rates per day over a period of about 2500 days for the three computer simulations. Curve 536 depicts water production per day for the first simulation (with no barrier). The daily water production rate approaches the assumed aquifer flow rate of 400 bbls/day. Curve 538 for the second simulation (with a frozen barrier) and curve 540 for the third simulation (with a frozen barrier and with carbon dioxide injection) show that the water production rate declines as time progresses. The production rate of water is slightly less after about day 700 for the third simulation. Curves 538 and 540 chart water rate productions per day for the second simulation (with a frozen barrier) and the third simulation (with a frozen barrier and with carbon dioxide injection), respectively. Water production per day for the second simulation approaches zero, but there appears to be some water production from the formation throughout the 2500 day time period. Water production per day for the third simulation appears to reach zero after about day 2000. The injection of carbon dioxide in the formation appears to allow the water production rate to reach about zero barrels per day.

Differences in cumulative water production between the first simulation and the second or third simulation may be due to isolation of the coal formation from surrounding aquifers using frozen barriers. The first simulation included no frozen barrier, so complete or substantial dewatering of the treatment area is unlikely. Without any barrier to isolate the coal formation in the first simulation, water rate production is limited by a number of factors. The factors include, but are not limited to, the effective pumping capacity of dewatering wells and/or permeability of the formation.

Figure 10:
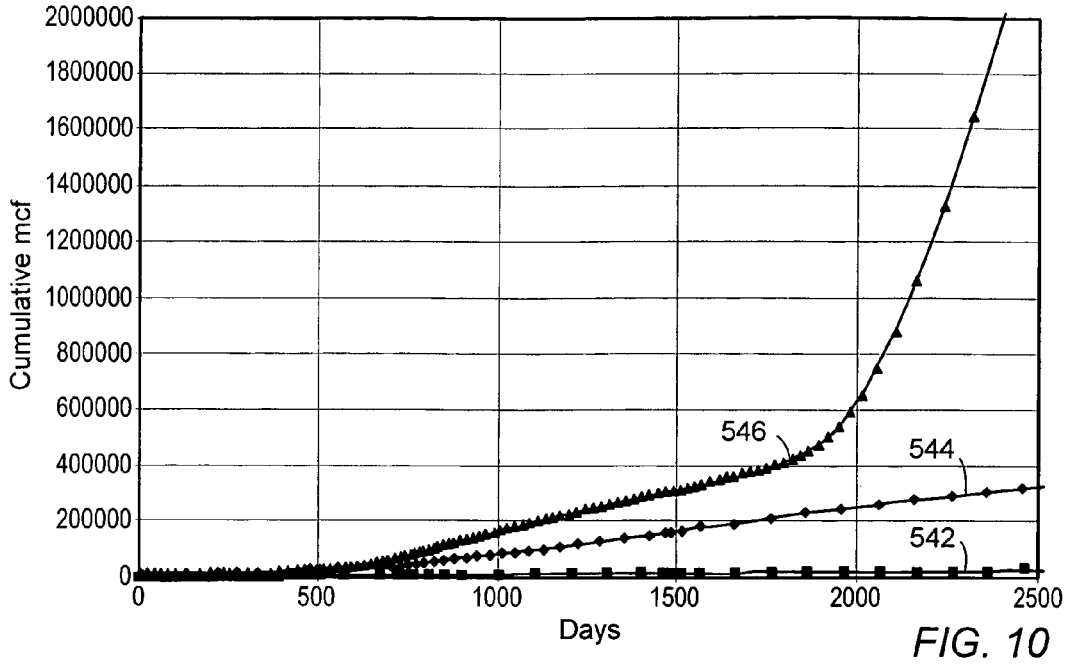
FIG. 10 depicts a plot of cumulative carbon dioxide production over a period of about 2500 days for three different computer simulations of a coal formation.

FIG. 10 depicts a plot of cumulative carbon dioxide production over a period of about 2500 days for the three computer simulations. Curve 542 shows cumulative carbon dioxide production for the first simulation over a period of about 2500 days. Cumulative carbon dioxide production in the first simulation appears to be negligible, compared to carbon dioxide production in the second and third simulations. Curve 544 depicts a substantially steady increase in cumulative carbon dioxide production for the second simulation (with a frozen barrier). Curve 546 shows a substantially constant increase in produced carbon dioxide for the third simulation (with a frozen barrier and carbon dioxide injection) until about day 1750. After about day 1750, cumulative carbon dioxide production begins to increase significantly. The significant increase in carbon dioxide production may indicate that carbon dioxide sorbing surfaces in the formation are, or are nearly, saturated with sorbed carbon dioxide.

At about day 2000, cumulative carbon dioxide production increases sharply for the third simulation (curve 546 in FIG. 10) and cumulative methane production begins to decrease for the third simulation (curve 522 depicted in FIG. 6). The inverse relationship of production of carbon dioxide and methane may be due to the preferred sorption of carbon dioxide over methane in coal. After about day 2000, the formation may be substantially saturated with carbon dioxide, so additional carbon dioxide injection may not be needed. In an embodiment, carbon dioxide injection may be decreased or stopped when a desired methane production rate is attained and/or when the carbon dioxide production rate begins to significantly increase.

Figure 11:
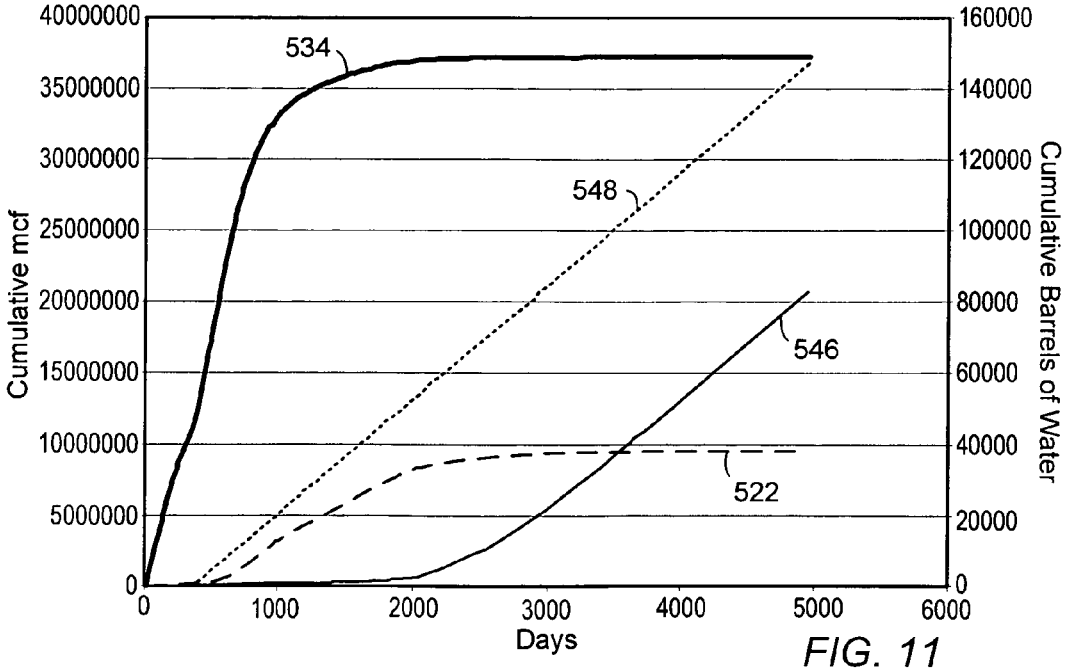
FIG. 11 depicts a plot of cumulative production of methane, carbon dioxide and water, as well as cumulative injection of carbon dioxide during a computer simulated treatment of a coal formation.

FIG. 11 graphically depicts cumulative production or injection relationships for methane, water, and carbon dioxide for the third simulation that models methane production from a coal formation using a frozen barrier and carbon dioxide injection. Curve 522 (also shown in FIG. 6) depicts cumulative methane production. Curve 534 (also shown in FIG. 8) depicts cumulative water production. Curve 546 (also shown in FIG. 10) depicts cumulative carbon dioxide production. Curve 548 depicts cumulative carbon dioxide injection. A substantial amount of methane production has occurred when the curve 546 becomes substantially parallel to curve 548 (at about day 2600).

Figure 12:
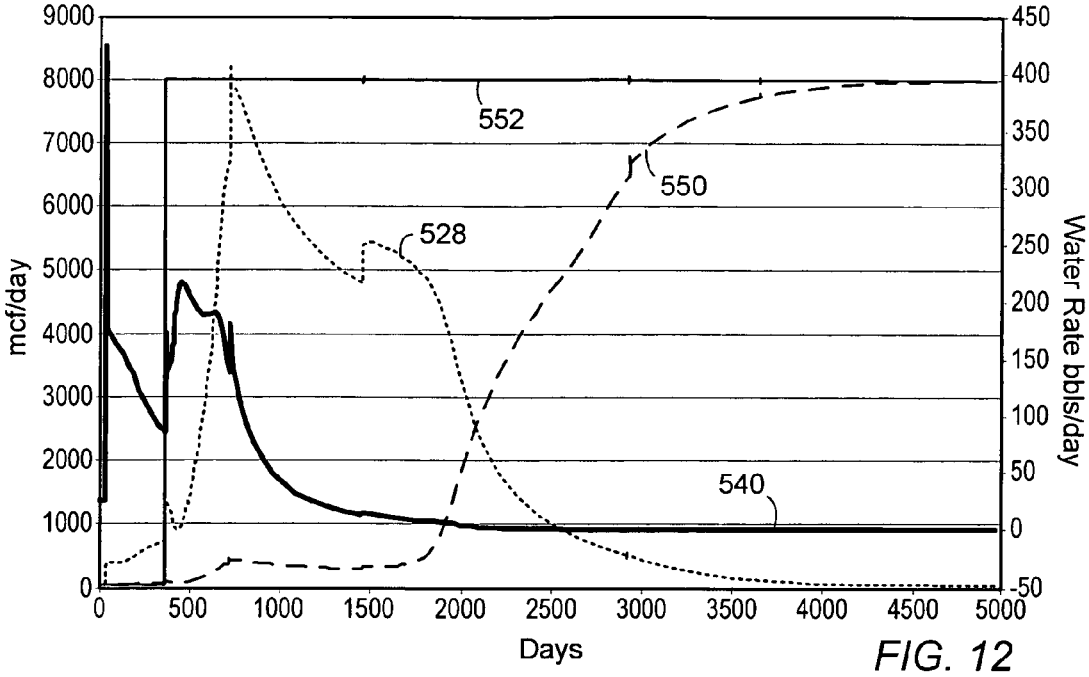
FIG. 12 depicts a plot of methane, carbon dioxide and water production rates per day, as well as carbon dioxide injection rates per day during a computer simulated treatment of a coal formation.

FIG. 12 graphically depicts production rate or injection relationships for methane, water, and carbon dioxide for the third simulation (with a frozen barrier and with carbon dioxide injection). Curve 528 (also shown in FIG. 7) depicts methane production rate from the formation. Curve 540 (also shown in FIG. 9) depicts water production rate from the formation. Curve 550 depicts carbon dioxide production rate from the formation. Curve 552 depicts carbon dioxide injection rate into the formation. FIG. 12 shows that methane production significantly increases as water production begins to decline. When carbon dioxide production begins to significantly increase, methane production begins to significantly decline. FIG. 12 indicates that about 16 bcf of carbon dioxide may be stored in the 320 acre coal formation.

In the first simulation (without a frozen barrier), about 0.7 bcf of methane were produced. In the second simulation (with a frozen barrier), about 6.9 bcf of methane were produced. In the third simulation (with a frozen barrier and with carbon dioxide injection), about 9.5 bcf of methane were produced. The injection of carbon dioxide in a barrier allows for quick recovery of methane from the formation. The injection of carbon dioxide in a barrier allows for the recovery of about 40% more methane as compared to methane recovery from a formation with a barrier when carbon dioxide is not introduced into the formation. Also, the injection of carbon dioxide allows for the sequestration of a significant amount of carbon dioxide in the formation (about 15 bcf in the 320 acre treatment area).

In some formations, coal seams may be separated by lean layers that contain little or no hydrocarbons. For example, coal seams may be separated by shale layers. Some of the coal seams may include fractures that allow for the passage of water through the coal seam. Typically, the lean layers are not fractured and are substantially impermeable.

In some embodiments, a lean layer above a coal seam and a lean layer below the coal seam may form barriers that inhibit water and fluid migration into or out of the coal seam. In some embodiments, a side barrier or barriers may need to be formed to define a treatment area. The treatment area defines a volume of coal that is to be treated. In some formations, a frozen barrier may be formed using a number of freeze wells placed around a perimeter of the treatment area. The freeze wells may be vertically positioned in the formation. In some embodiments, the number of freeze wells needed to form a barrier may be reduced by using a limited number of freeze wells that are oriented along strike, horizontally, or that otherwise generally follow the orientation of the coal seam in which a barrier is to be formed.

For a relatively thin coal seam, only one oriented freeze well may be needed for each side of the barrier. A relatively thin coal seam may be a coal seam that is less than about 4 m thick, less than about 7 m thick, or less than about 10 m thick. For thicker coal seams, two or more oriented freeze wells may be needed for each side of the barrier. The stacked freeze wells may be directionally drilled so that cooling fluid that flows through the freeze wells will form overlapping low temperature zones. The low temperature zones may be sufficiently cold to freeze formation water so that a frozen barrier is formed. Thick coal seams may be coal seams having a thickness of greater than about 6 m, greater than about 9 m, or greater than about 12 m. Flow rate of water through the treatment area may be a factor in determining whether a single freeze well, stacked freeze wells, or stacked freeze wells in multiple rows are needed to form a barrier on a side of a treatment area. In some embodiments, more than one oriented freeze well may be needed to accommodate a length of a treatment area side.

Figure 13:
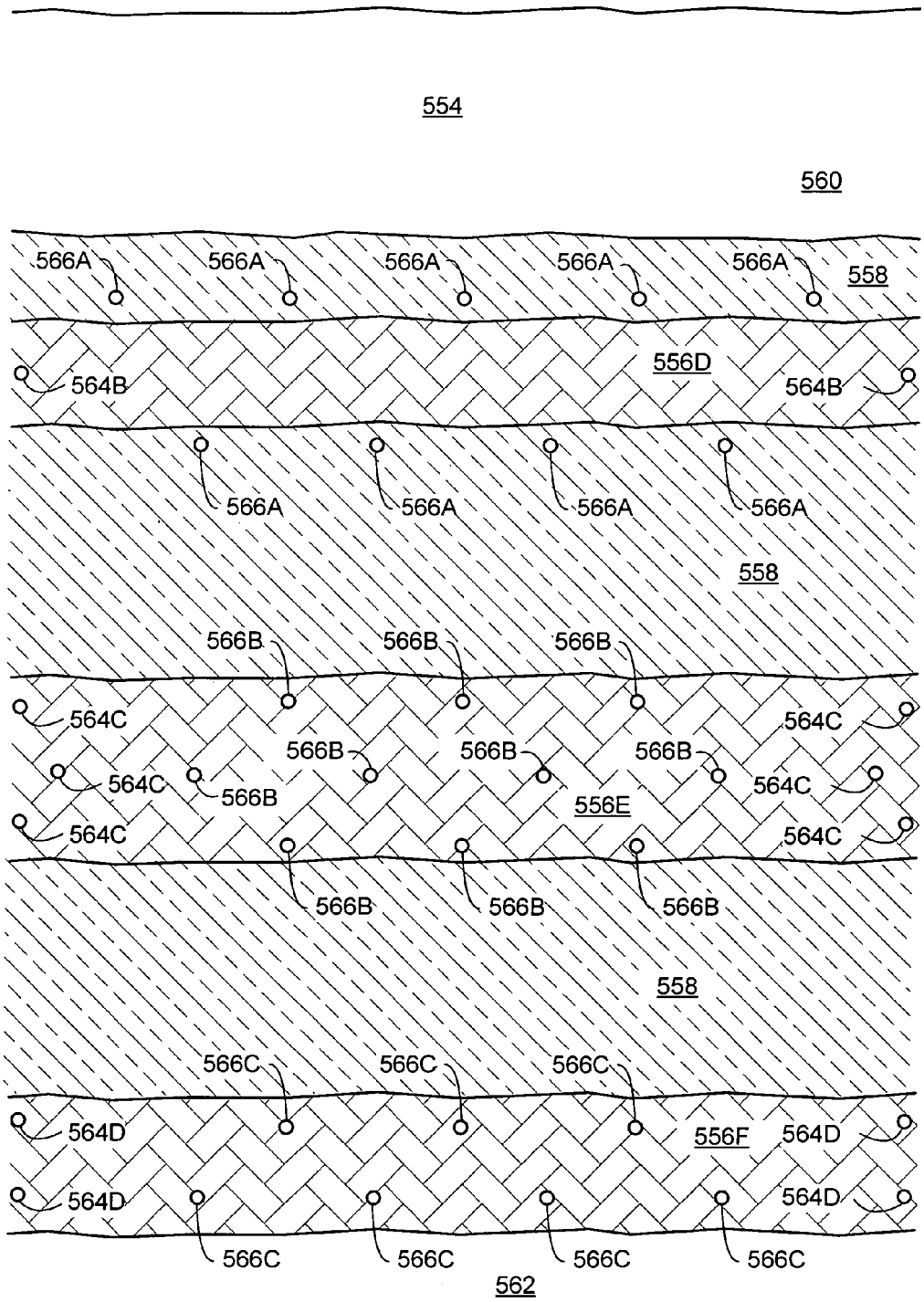
FIG. 13 depicts an embodiment of a cross section of multiple stacked freeze wells in hydrocarbon containing layers.

Multiple freeze wells in a coal seam may be stacked. FIG. 13 depicts an embodiment of a cross section of multiple stacked freeze wells in a hydrocarbon containing layer. Hydrocarbon containing formation 554 may include hydrocarbon layers 556D-F, lean layers 558, overburden 560, and underburden 562. Hydrocarbon layers 556D-F may be coal seams. Hydrocarbon layers 556D-F may be separated by relatively lean hydrocarbon containing layers 558. Lean layers 558 may contain little or no hydrocarbons. Lean layers 558 may be densely packed shale. Lean layers 558 may be substantially impermeable. Water may be inhibited from passing through lean layers 558. Lean layers 558 may inhibit passage of fluid into or out of adjacent hydrocarbon layers.

Hydrocarbon layers 556D-F may be more permeable than lean layers 558. Hydrocarbon layers 556D-F may include cracks and/or fissures. The permeability of hydrocarbon layers 556D-F may allow water to flow through hydrocarbon layers 556D-F. To inhibit water passage and/or fluid passage into or out of hydrocarbon layers 556D-F, barriers may be formed in the formation. For example, hydrocarbon layers 556D-F may include multiple stacked freeze wells 564B-D. The freeze wells may establish a low temperature zone. Water that flows into the low temperature zone may freeze to form a barrier. In embodiments where water may move through certain layers of a formation (such as hydrocarbon layers 556D-F depicted in FIG. 13), the formation of barriers may only be required around the perimeter or on selected sides of the perimeter of a treatment area. Substantially impermeable lean layers 558 may act as natural barriers to fluid flow. In some embodiments, overburden 560 and underburden 562 may be natural barriers to fluid flow.

Freeze wells 564B may form a first barrier. Hydrocarbon layer 556D may be a relatively thin layer (e.g., less than about 6 m thick). Thin hydrocarbon layers, such as hydrocarbon layer 556D, may require only one set of freeze wells 564B on each side of the treatment area to form a perimeter barrier around the hydrocarbon layer.

In some embodiments, hydrocarbon layer 556D may be a relatively rich layer. When hydrocarbon layer 556D is a relatively rich layer, heater wells 566A may be positioned adjacent hydrocarbon layer 556D in lean layers 558. Positioning heater wells 566A adjacent to hydrocarbon layer 556D may eliminate drilling through a portion of the material to be treated, and may avoid overheating and/or coking a portion of the material to be treated that is immediately adjacent to the heater wells.

Freeze wells 564D may form a portion of a perimeter barrier around a part of hydrocarbon layer 556F. Hydrocarbon layer 556F may be a relatively thick coal seam. To form a perimeter barrier and isolate a part of hydrocarbon layer 556F, a "stacked" formation of freeze wells 564D may be used to form sides of a perimeter barrier around a part of the hydrocarbon layer. Stacked freeze wells 564D may isolate relatively thick hydrocarbon containing layer 556F.

In some embodiments, heater wells 566C may be positioned in hydrocarbon layer 556F. Heater wells 566C may be used to conduct in situ processing of hydrocarbon layer 556F. In hydrocarbon layer 556F, heater wells 566C may be positioned in a pattern throughout hydrocarbon layer 556F. In some embodiments, heater wells may be positioned in a staggered "W" pattern. Heater wells 566C are shown in a staggered "W" pattern in hydrocarbon layer 556F in FIG. 13.

Freeze wells 564C may form a portion of a barrier around a part of hydrocarbon layer 556E. Hydrocarbon layer 556E is an example of a relatively thick layer of hydrocarbons. Hydrocarbon layer 556E may be a relatively thick coal seam. A stacked formation of freeze wells 564C may be used to form a perimeter barrier around hydrocarbon layer 556E. Freeze wells 564C may be positioned in a triangular pattern to form an interconnected and thick low temperature zone. Water entering the low temperature zone may freeze to form a barrier that isolates hydrocarbon layer 556E.

In some embodiments, heater wells 566B may be positioned in hydrocarbon layer 556E. Heater wells 566B may be used to conduct in situ processing of hydrocarbon layer 556E. In relatively thick hydrocarbon layer 556E, heater wells 566B may be positioned in a pattern throughout hydrocarbon layer 556E. In some embodiments, heater wells may be positioned in a staggered "X" pattern. Heater wells 566B are shown in a staggered "X" pattern in hydrocarbon layer 556E in FIG. 13.

Hydrocarbon containing formations (e.g., coal formations) may contain two or more hydrocarbon layers. Hydrocarbon layers may be coal seams. Hydrocarbon layers may be separated by layers of material containing little or no producible hydrocarbons. The separating layers may function as natural barriers between hydrocarbon layers. Barriers may be formed adjacent to or in one or more of the hydrocarbon layers to define treatment areas. Barriers in different hydrocarbon layers may be formed at one time or at different times, as desired.

Barriers may isolate one hydrocarbon layer from the rest of the formation, including other hydrocarbon layers.

In an embodiment, barriers may be formed by freeze wells to define a treatment area. Once a hydrocarbon layer is isolated with a perimeter barrier, the hydrocarbon layer may be developed. For example, if one of the hydrocarbon layers is a coal seam, development may include dewatering and/or producing sorbed methane from the coal seam. In some embodiments, hydrocarbon layers may be produced sequentially from the surface down, although hydrocarbon layers may be produced in any desired order. Economic factors may be taken into consideration when deciding which hydrocarbon layers to develop and/or in what order to develop the hydrocarbon layers. Thicker hydrocarbon layers containing more hydrocarbon products may be produced before thinner hydrocarbon layers.

FIG. 13 depicts an embodiment of hydrocarbon containing formation 554 (e.g., a coal formation). Hydrocarbon containing formation 554 may include multiple hydrocarbon layers 556D-F (e.g., coal seams). Hydrocarbon layers 556D-F may contain one or more barriers. Barriers may include freeze wells 564B-D. Freeze wells 564B may be used to form a perimeter barrier isolating hydrocarbon layer 556D. Upon isolation of hydrocarbon layer 556D, hydrocarbon layer 556D may be developed (i.e., by in situ conversion to produce hydrocarbons from hydrocarbon layer 556D). Freeze wells 564C may form a perimeter barrier isolating hydrocarbon layer 556E. Hydrocarbon layer 556E may be isolated before, during, and/or after isolation of hydrocarbon layer 556D. Dewatering wells may be used to remove water in hydrocarbon layer 556E. Water removed from hydrocarbon layer 556E may be transferred to hydrocarbon layer 556D. Hydrocarbon layer 556E may be developed. Hydrocarbon layer 556F may then be developed. Water removed from hydrocarbon layer 556F may be stored in hydrocarbon layer 556E while hydrocarbon layer 556F is being developed.

Sections of freeze wells that are able to form low temperature zones may be only a portion of the overall length of the freeze wells. For example, a portion of each freeze well may be insulated adjacent to an overburden so that heat transfer between the freeze wells and the overburden is inhibited. Insulation of a freeze well may be provided in a number of ways. In one embodiment, an insulating material such as low thermal conductivity cement between the casing and the overburden forms an insulation layer. The cement may be substantially solid or may contain nitrogen or other gases to form a foamed cement. A layer of insulation may be formed by providing, creating, or maintaining an annular space between the overburden casing and the piping containing refrigerant. The annular space may be filled with a gas such as air or nitrogen. In certain embodiments, the pressure in the annular space may be reduced to form a vacuum. The presence of a gas or having a vacuum in the annular space may lower the heat transfer rate between the piping containing refrigerant and the adjacent formation.

Freeze wells may form a low temperature zone along sides of a hydrocarbon containing portion of the formation. The low temperature zone may extend above and/or below a portion of the hydrocarbon containing layer to be treated using an in situ conversion process or an in situ process (e.g., coal bed methane production and/or solution mining). The ability to use only portions of freeze wells to form a low temperature zone may allow for economic use of freeze wells when forming barriers for treatment areas that are relatively deep in the formation (e.g., below about 450 m).

In some in situ conversion embodiments, a low temperature zone may be formed around a treatment area. During heating of the treatment area, water may be released from the treatment area as steam and/or entrained water in formation fluids. In general, when a treatment area is initially heated, water present in the formation is mobilized before substantial quantities of hydrocarbons are produced. The water may be free water (pore water) and/or released water that was attached or bound to clays or minerals (clay bound water). Mobilized water may flow into the low temperature zone. The water may condense and subsequently solidify in the low temperature zone to form a frozen barrier.

Heat sources may not be able to break through a frozen perimeter barrier during thermal treatment of a treatment area. In some embodiments, a frozen perimeter barrier may continue to expand for a significant time after heating is initiated. Thermal diffusivity of a hot, dry formation may be significantly smaller than thermal diffusivity of a frozen formation. The difference in thermal diffusivities between hot, dry formation and frozen formation implies that a cold zone will expand at a faster rate than a hot zone. Even if heat sources are placed relatively close to freeze wells that have formed a frozen barrier (e.g., about 1 m away from freeze wells that have established a frozen barrier), the heat sources will typically not be able to break through the frozen barrier if coolant continues to be supplied to the freeze wells. In certain in situ conversion process (ICP) system embodiments, freeze wells are positioned a significant distance away from the heat sources and other ICP wells. The distance may be about 3 m, 5 m, 10 m, 15 m, or greater.

Freeze wells may be placed in the formation so that there is minimal deviation in orientation of one freeze well relative to an adjacent freeze well. Excessive deviation may create a large separation distance between adjacent freeze wells that may not permit formation of an interconnected low temperature zone between the adjacent freeze wells. Factors that may influence the manner in which freeze wells are inserted into the ground include, but are not limited to, freeze well insertion time, depth that the freeze wells are to be inserted, formation properties, desired well orientation, and economics. Relatively low depth freeze wells may be impacted and/or vibrationally inserted into some formations. Freeze wells may be impacted and/or vibrationally inserted into formations to depths from about 1 m to about 100 m without excessive deviation in orientation of freeze wells relative to adjacent freeze wells in some types of formations. Freeze wells placed deep in a formation or in formations with layers that are difficult to drill through may be placed in the formation by directional drilling and/or geosteering. Directional drilling with steerable motors uses an inclinometer to guide the drilling assembly. Periodic gyro logs are obtained to correct the path. An example of a directional drilling system is VertiTrak™ available from Baker Hughes Inteq (Houston, Tex.). Geosteering uses analysis of geological and survey data from an actively drilling well to estimate stratigraphic and structural position needed to keep the wellbore advancing in a desired direction. The Earth's magnetic field may be used to guide the directional drilling, particularly if multiple readings are obtained when rotating the tool at a fixed depth. Electrical, magnetic, and/or other signals produced in an adjacent freeze well may also be used to guide directionally drilled wells so that a desired spacing between adjacent wells is maintained. Relatively tight control of the spacing between freeze wells is an important factor in minimizing the time for completion of a low temperature zone.

Figure 14:
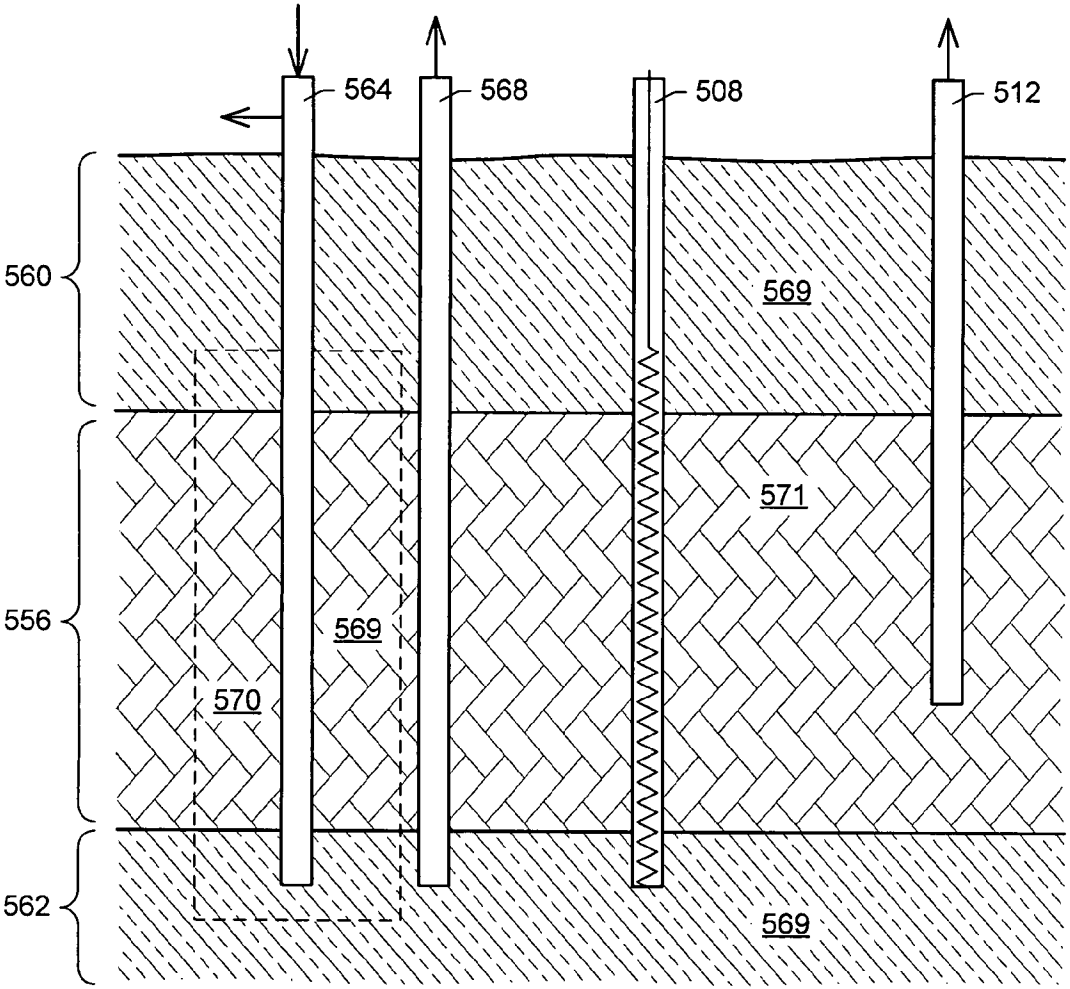
FIG. 14 depicts a side representation of an embodiment of an in situ conversion process system.

As depicted in FIG. 14, freeze wells 564 may be positioned in a portion of a formation. Freeze wells 564 and ICP wells may extend through overburden 560, through hydrocarbon layer 556, and into underburden 562. In some embodiments, portions of freeze wells and ICP wells extending through overburden 560 may be insulated to inhibit heat transfer to or from the surrounding formation.

In some embodiments, dewatering wells 568 may extend into formation 556. Dewatering wells 568 may be used to remove formation water from hydrocarbon containing layer 556 after freeze wells 564 form perimeter barrier 569. Water may flow through hydrocarbon containing layer 556 in an existing fracture system and channels. Only a small number of dewatering wells 568 may be needed to dewater treatment area 571 because the formation may have a large hydraulic permeability due to the existing fracture system and channels. Dewatering wells 568 may be placed relatively close to freeze wells 564. In some embodiments, dewatering wells may be temporarily sealed after dewatering. If dewatering wells are placed close to freeze wells or to a low temperature zone formed by freeze wells, the dewatering wells may be filled with water. Expanding low temperature zone 570 may freeze the water placed in the dewatering wells to seal the dewatering wells. Dewatering wells 568 may be re-opened after completion of in situ conversion. After in situ conversion, dewatering wells 568 may be used during clean-up procedures for injection or removal of fluids.

Various types of refrigeration systems may be used to form a low temperature zone. Determination of an appropriate refrigeration system may be based on many factors, including, but not limited to: type of freeze well; a distance between adjacent freeze wells; refrigerant; time frame in which to form a low temperature zone; depth of the low temperature zone; temperature differential to which the refrigerant will be subjected; chemical and physical properties of the refrigerant; environmental concerns related to potential refrigerant releases, leaks, or spills; economics; formation water flow in the formation; composition and properties of formation water, including the salinity of the formation water; and various properties of the formation such as thermal conductivity, thermal diffusivity, and heat capacity.

A circulated fluid refrigeration system may utilize a liquid refrigerant that is circulated through freeze wells. A liquid circulation system utilizes heat transfer between a circulated liquid and the formation without a significant portion of the refrigerant undergoing a phase change. The liquid may be any type of heat transfer fluid able to function at cold temperatures. Some of the desired properties for a liquid refrigerant are: a low working temperature, low viscosity, high specific heat capacity, high thermal conductivity, low corrosiveness, and low toxicity. A low working temperature of the refrigerant allows for formation of a large low temperature zone around a freeze well. A low working temperature of the liquid should be about −20° C. or lower. Fluids having low working temperatures at or below −20° C. may include certain salt solutions (e.g., solutions containing calcium chloride or lithium chloride). Other salt solutions may include salts of certain organic acids (e.g., potassium formate, potassium acetate, potassium citrate, ammonium formate, ammonium acetate, ammonium citrate, sodium citrate, sodium formate, sodium acetate). An example of a liquid heat transfer fluid based on potassium formate that may be used as a refrigerant below −50° C. is FREEZIUM®, which is available from Kemira Chemicals (Helsinki, Finland). Another liquid refrigerant is a solution of ammonia and water with a weight percent of ammonia between about 20% and about 40% (i.e., aqua ammonia). Aqua ammonia has several properties and characteristics that make use of aqua ammonia as a refrigerant desirable. Such properties and characteristics include, but are not limited to, a very low freezing point, a low viscosity, ready availability, and low cost.

In certain circumstances (e.g., where hydrocarbon containing portions of a formation are deeper than about 300 m), it may be desirable to minimize the number of freeze wells (i.e., increase freeze well spacing) to improve project economics. Using a refrigerant that can go to low temperatures (e.g., aqua ammonia) may allow for the use of a large freeze well spacing.

A refrigerant that is capable of being chilled below a freezing temperature of formation water may be used to form a low temperature zone. The following equation (the Sanger equation) may be used to model the time $t_1$ needed to form a frozen barrier of radius R around a freeze well having a surface temperature of $T_s$:

$$t_1 = \frac{R^2 L_1}{4k_f v_s}\left(2\ln\frac{R}{r_o} - 1 + \frac{c_{vf} v_s}{L_1}\right) \tag{1}$$

in which:

$$L_1 = L\frac{a_r^2 - 1}{2\ln a_r} c_{vu} v_o$$

$$a_r = \frac{R_A}{R}.$$

In these equations, $k_f$ is the thermal conductivity of the frozen material; $c_{vf}$ and $c_{vu}$ are the volumetric heat capacity of the frozen and unfrozen material, respectively; $r_o$ is the radius of the freeze well; $v_s$ is the temperature difference between the freeze well surface temperature $T_s$ and the freezing point of water $T_o$; $v_o$ is the temperature difference between the ambient ground temperature $T_g$ and the freezing point of water $T_o$; L is the volumetric latent heat of freezing of the formation; R is the radius at the frozen-unfrozen interface; and $R_A$ is a radius at which there is no influence from the refrigeration pipe. The temperature of the refrigerant is an adjustable variable that may significantly affect the spacing between refrigeration pipes.

EQN. 1 implies that a large low temperature zone may be formed by using a refrigerant having an initial temperature that is very low. To form a low temperature zone for in situ conversion processes for formations, the use of a refrigerant having an initial cold temperature of about −50° C. or lower may be desirable. Refrigerants having initial temperatures warmer than about −50° C. may also be used, but such refrigerants may require longer times for the low temperature zones produced by individual freeze wells to connect. In addition, such refrigerants may require the use of closer freeze well spacings and/or more freeze wells.

A refrigeration unit may be used to reduce the temperature of a refrigerant liquid to a low working temperature. In some embodiments, the refrigeration unit may utilize an ammonia vaporization cycle. Refrigeration units are available from Cool Man Inc. (Milwaukee, Wis.), Gartner Refrigeration & Manufacturing (Minneapolis, Minn.), and other suppliers. In some embodiments, a cascading refrigeration system may be utilized with a first stage of ammonia and a second stage of carbon dioxide. The circulating refrigerant through the freeze wells may be 30% by weight ammonia in water (aqua ammonia). Alternatively, a single stage carbon dioxide refrigeration system may be used.

In some embodiments, refrigeration units for chilling refrigerant may utilize an absorption-desorption cycle. An absorption refrigeration unit may produce temperatures down to about −60° C. using thermal energy. Thermal energy sources used in the desorption unit of the absorption refrigeration unit may include, but are not limited to, hot water, steam, formation fluid, and/or exhaust gas. In some embodiments, ammonia is used as the refrigerant and water as the absorbent in the absorption refrigeration unit. Absorption refrigeration units are available from Stork Thermeq B.V. (Hengelo, The Netherlands).

A vaporization cycle refrigeration system may be used to form and/or maintain a low temperature zone. A liquid refrigerant may be introduced into a plurality of wells. The refrigerant may absorb heat from the formation and vaporize. The vaporized refrigerant may be circulated to a refrigeration unit that compresses the refrigerant to a liquid and reintroduces the refrigerant into the freeze wells. The refrigerant may be, but is not limited to, aqua ammonia, ammonia, carbon dioxide, or a low molecular weight hydrocarbon (e.g., propane). After vaporization, the fluid may be recompressed to a liquid in a refrigeration unit or refrigeration units and circulated back into the freeze wells. The use of a circulated refrigerant system may allow economical formation and/or maintenance of a long low temperature zone that surrounds a large treatment area. The use of a vaporization cycle refrigeration system may require a high pressure piping system.

Figure 15:
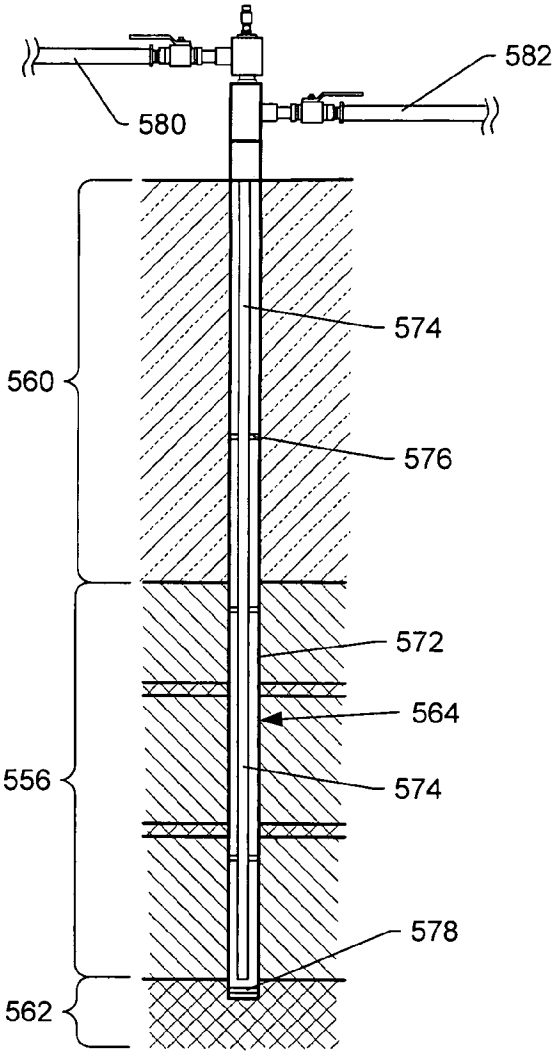
FIG. 15 depicts an embodiment of a freeze well for a circulated liquid refrigeration system, wherein a cutaway view of the freeze well is represented below ground surface.

FIG. 15 depicts an embodiment of freeze well 564. Freeze well 564 may include casing 572, inlet conduit 574, spacers 576, and wellcap 578. Spacers 576 may position inlet conduit 574 in casing 572 so that an annular space is formed between the casing and the conduit. Spacers 576 may promote turbulent flow of refrigerant in the annular space between inlet conduit 574 and casing 572, but the spacers may also cause a significant fluid pressure drop. Turbulent fluid flow in the annular space may be promoted by roughening the inner surface of casing 572, by roughening the outer surface of inlet conduit 574, and/or by having a small cross-sectional area annular space that allows for high refrigerant velocity in the annular space. In some embodiments, spacers are not used.

Refrigerant may flow through cold side conduit 580 from a refrigeration unit to inlet conduit 574 of freeze well 564. The refrigerant may flow through an annular space between inlet conduit 574 and casing 572 to warm side conduit 582. Heat may transfer from the formation to casing 572 and from the casing to the refrigerant in the annular space. Inlet conduit 574 may be insulated to inhibit heat transfer to the refrigerant during passage of the refrigerant into freeze well 564. In an embodiment, inlet conduit 574 is a high density polyethylene tube. At cold temperatures, some polymers may exhibit a large amount of thermal contraction. For example, an 800 ft (about 244 m) initial length of polyethylene conduit subjected to a temperature of −25° C. may contract by 20 ft (about 6 m) or more. If a high density polyethylene conduit, or other polymer conduit, is used, the large thermal contraction of the material must be taken into account in determining the final depth of the freeze well. For example, the freeze well may be drilled deeper than needed, and the conduit may be allowed to shrink back during use. In some embodiments, inlet conduit 574 is an insulated metal tube. In some embodiments, the insulation may be a polymer coating, such as, but not limited to, polyvinylchloride, high density polyethylene, and/or polystyrene.

In some formations, water flow in the formation may be too much to allow for the formation of a freeze well. Water flow may need to be limited to allow for the formation of a frozen barrier. In an embodiment, freeze wells may be positioned between an inner row and an outer row of dewatering wells. The inner row of dewatering wells and the outer row of dewatering wells may be operated to have a minimal pressure differential so that fluid flow between the inner row of dewatering wells and the outer row of dewatering wells is minimized. The dewatering wells may remove formation water between the outer dewatering row and the inner dewatering row. The freeze wells may be initialized after removal of formation water by the dewatering wells. The freeze wells may cool the formation between the inner row and the outer row to form a low temperature zone. The amount of water removed by the dewatering walls may be reduced so that some water flows into the low temperature zone. The water entering the low temperature zone may freeze to form a frozen barrier. After a thickness of the frozen barrier is formed that is large enough to withstand being destroyed when the dewatering wells are stopped, the dewatering wells may be stopped.

Coiled tubing installation may reduce a number of welded connections in a length of casing. Welds in coiled tubing may be pre-tested for integrity (e.g., by hydraulic pressure testing). Coiled tubing may be installed more easily and faster than installation of pipe segments joined together by welded connections.

A transient fluid pulse test may be used to determine or confirm formation of a perimeter barrier. A treatment area may be saturated with formation water after formation of a perimeter barrier. A pulse may be instigated inside a treatment area surrounded by the perimeter barrier. The pulse may be a pressure pulse that is produced by pumping fluid (e.g., water) into or out of a wellbore. In some embodiments, the pressure pulse may be applied in incremental steps of increasing fluid level, and responses may be monitored after each step. After the pressure pulse is applied, the transient response to the pulse may be measured by, for example, measuring pressures at monitor wells and/or in the well in which the pressure pulse was applied. Monitoring wells used to detect pressure pulses may be located outside and/or inside of the treatment area. Caution should be used in raising the pressure too high inside the freeze wall by addition of water to avoid the possibility of dissolving weak portions of the barrier with the added water.

In some embodiments, a pressure pulse may be applied by drawing a vacuum on the formation through a wellbore. If a frozen barrier is formed, a portion of the pulse will be reflected by the frozen barrier back towards the source of the pulse. Sensors may be used to measure response to the pulse. In some embodiments, a pulse or pulses are instigated before freeze wells are initialized. Response to the pulses is measured to provide a base line for future responses. After formation of a perimeter barrier, a pressure pulse initiated inside of the perimeter barrier should not be detected by monitor wells outside of the perimeter barrier. Reflections of the pressure pulse measured in the treatment area may be analyzed to provide information on the establishment, thickness, depth, and other characteristics of the frozen barrier.

In certain embodiments, hydrostatic pressures will tend to change due to natural forces (e.g., tides, water recharge, etc.). A sensitive piezometer (e.g., a quartz crystal sensor) may be able to accurately monitor natural hydrostatic pressure changes. Fluctuations in natural hydrostatic pressure changes may indicate formation of a frozen barrier around a treatment area. For example, if areas surrounding the treatment area undergo natural diurnal hydrostatic pressure changes but the area enclosed by the frozen barrier does not, this is an indication of formation of the frozen barrier.

In some embodiments, a tracer test may be used to determine or confirm formation of a frozen barrier. A tracer fluid may be injected on a first side of a perimeter barrier. Monitor wells on a second side of the perimeter barrier may be operated to detect the tracer fluid. No detection of the tracer fluid by the monitor wells may indicate that the perimeter barrier is formed. The tracer fluid may be, but is not limited to, carbon dioxide, argon, nitrogen, and isotope labeled water or combinations thereof. A gas tracer test may have limited use in saturated formations because the tracer fluid may not be able to travel easily from an injection well to a monitor well through a saturated formation in a short period of time. In a water saturated formation, an isotope labeled water (e.g., deuterated or tritiated water) or a specific ion dissolved in water (e.g., thiocyanate ion) may be used as a tracer fluid.

In an embodiment, heat sources (e.g., heaters) may be used to heat a hydrocarbon containing formation. Because permeability and/or porosity increases in a heated formation, produced vapors may flow considerable distances through the formation with relatively little pressure differential. Increases in permeability may result from a reduction of mass of the heated portion due to vaporization of water, removal of hydrocarbons, and/or creation of fractures. Fluids may flow more easily through the heated portion. In some embodiments, production wells may be provided in upper portions of hydrocarbon layers.

Fluid generated in a hydrocarbon containing formation may move a considerable distance through the hydrocarbon containing formation as a vapor. The considerable distance may be over 1000 m depending on various factors (e.g., permeability of the formation, properties of the fluid, temperature of the formation, and pressure gradient allowing movement of the fluid). Due to increased permeability in formations subjected to in situ conversion and formation fluid removal, production wells may only need to be provided in every other unit of heat sources or every third, fourth, fifth, or sixth units of heat sources.

In an in situ conversion process embodiment, a mixture may be produced from a hydrocarbon containing formation. The mixture may be produced through a heater well disposed in the formation. Producing the mixture through the heater well may increase a production rate of the mixture as compared to a production rate of a mixture produced through a non-heater well. A non-heater well may include a production well. In some embodiments, a production well may be heated to increase a production rate.

A heated production well may inhibit condensation of higher carbon numbers ($C_5$ or above) in the production well. A heated production well may inhibit problems associated with producing a hot, multi-phase fluid from a formation.

A heated production well may have an improved production rate as compared to a non-heated production well. Heat applied to the formation adjacent to the production well from the production well may increase formation permeability adjacent to the production well by vaporizing and removing liquid phase fluid adjacent to the production well and/or by increasing the permeability of the formation adjacent to the production well by formation of macro and/or micro fractures. A heater in a lower portion of a production well may be turned off when superposition of heat from heat sources heats the formation sufficiently to counteract benefits provided by heating from within the production well. In some embodiments, a heater in an upper portion of a production well may remain on after a heater in a lower portion of the well is deactivated. The heater in the upper portion of the well may inhibit condensation and reflux of formation fluid.

Certain in situ conversion embodiments may include providing heat to a first portion of a hydrocarbon containing formation from one or more heat sources. Formation fluids may be produced from the first portion. A second portion of the formation may remain unpyrolyzed by maintaining temperature in the second portion below a pyrolysis temperature of hydrocarbons in the formation. In some embodiments, the second portion or significant sections of the second portion may remain unheated.

A second portion that remains unpyrolyzed may be adjacent to a first portion of the formation that is subjected to pyrolysis. The second portion may provide structural strength to the formation. The second portion may be between the first portion and a third portion. Formation fluids may be produced from the third portion of the formation. A processed formation may have a pattern that resembles a striped or checkerboard pattern with alternating pyrolyzed portions and unpyrolyzed portions. In some in situ conversion embodiments, columns of unpyrolyzed portions of formation may remain in a formation that has undergone in situ conversion.

Unpyrolyzed portions of formation among pyrolyzed portions of formation may provide structural strength to the formation. The structural strength may inhibit subsidence of the formation. Inhibiting subsidence may reduce or eliminate subsidence problems such as changing surface levels and/or decreasing permeability and flow of fluids in the formation due to compaction of the formation.

In some in situ conversion process embodiments, a portion of a hydrocarbon containing formation may be heated at a heating rate in a range from about 0.1° C./day to about 50° C./day. Alternatively, a portion of a hydrocarbon containing formation may be heated at a heating rate in a range of about 0.1° C./day to about 10° C./day. For example, a majority of hydrocarbons may be produced from a formation at a heating rate in a range of about 0.1° C./day to about 10° C./day. In addition, a hydrocarbon containing formation may be heated at a rate of less than about 0.7° C./day through a significant portion of a pyrolysis temperature range. The pyrolysis temperature range may include a range of temperatures as described in above embodiments. For example, the heated portion may be heated at such a rate for a time greater than 50% of the time needed to span the temperature range, more than 75% of the time needed to span the temperature range, or more than 90% of the time needed to span the temperature range.

A rate at which a hydrocarbon containing formation is heated may affect the quantity and quality of the formation fluids produced from the hydrocarbon containing formation. For example, heating at high heating rates (e.g., as is done during a Fischer Assay analysis) may allow for production of a large quantity of condensable hydrocarbons from a hydrocarbon containing formation. The products of such a process may be of a significantly lower quality than would be produced using heating rates less than about 10° C./day. Heating at a rate of temperature increase less than approximately 10° C./day may allow pyrolysis to occur in a pyrolysis temperature range in which production of undesirable products and heavy hydrocarbons may be reduced. In addition, a rate of temperature increase of less than about 3° C./day may further increase the quality of the produced condensable hydrocarbons by further reducing the production of undesirable products and further reducing production of heavy hydrocarbons from a hydrocarbon containing formation.

The heating rate may be selected based on a number of factors including, but not limited to, the maximum temperature possible at the well, a predetermined quality of formation fluids that may be produced from the formation, and/or spacing between heat sources. A quality of hydrocarbon fluids may be defined by an API gravity of condensable hydrocarbons, by olefin content, by the nitrogen, sulfur and/or oxygen content, etc. In an in situ conversion process embodiment, heat may be provided to at least a portion of a hydrocarbon containing formation to produce formation fluids having an API gravity of greater than about 20°. The API gravity may vary, however, depending on a number of factors including the heating rate and pressure in the portion of the formation and the time relative to initiation of the heat sources when the formation fluid is produced.

Subsurface pressure in a hydrocarbon containing formation may correspond to the fluid pressure generated in the formation. Heating hydrocarbons in a hydrocarbon containing formation may generate fluids by pyrolysis. The generated fluids may be vaporized in the formation. Vaporization and pyrolysis reactions may increase the pressure in the formation. Fluids that contribute to the increase in pressure may include, but are not limited to, fluids produced during pyrolysis and water vaporized during heating. As temperatures in a selected section of a heated portion of the formation increase, a pressure in the selected section may increase as a result of increased fluid generation and vaporization of water. Controlling a rate of fluid removal from the formation may allow for control of pressure in the formation.

In some embodiments, pressure in a selected section of a heated portion of a hydrocarbon containing formation may vary depending on factors such as depth, distance from a heat source, richness of the hydrocarbons in the hydrocarbon containing formation, and/or distance from a producer well. Pressure in a formation may be determined at a number of different locations (e.g., near or at production wells, near or at heat sources, or at monitor wells).

Heating of a hydrocarbon containing formation to a pyrolysis temperature range may occur before substantial permeability has been generated in the hydrocarbon containing formation. An initial lack of permeability may inhibit the transport of generated fluids from a pyrolysis zone in the formation to a production well. As heat is initially transferred from a heat source to a hydrocarbon containing formation, a fluid pressure in the hydrocarbon containing formation may increase proximate the heat source. Such an increase in fluid pressure may be caused by generation of fluids during pyrolysis of at least some hydrocarbons in the formation. The increased fluid pressure may be released, monitored, altered, and/or controlled through the heat source. For example, the heat source may include a valve that allows for removal of some fluid from the formation. In some heat source embodiments, heat sources may include open wellbore configurations that inhibit pressure damage to the heat sources.

In some in situ conversion process embodiments, pressure generated by expansion of pyrolysis fluids or other fluids generated in the formation may be allowed to increase although an open path to the production well or any other pressure sink may not yet exist in the formation. The fluid pressure may be allowed to increase towards a lithostatic pressure. Fractures in the hydrocarbon containing formation may form when the fluid approaches the lithostatic pressure. For example, fractures may form from a heat source to a production well. The generation of fractures in the heated portion may relieve some of the pressure in the portion.

In an in situ conversion process embodiment, pressure may be increased in a selected section of a portion of a hydrocarbon containing formation to a selected pressure during pyrolysis. A selected pressure may be in a range from about 2 bars absolute to about 72 bars absolute or, in some embodiments, 2 bars absolute to 36 bars absolute. Alternatively, a selected pressure may be in a range from about 2 bars absolute to about 18 bars absolute. In some in situ conversion process embodiments, a majority of hydrocarbon fluids may be produced from a formation having a pressure in a range from about 2 bars absolute to about 18 bars absolute. The pressure during pyrolysis may vary or be varied. The pressure may be varied to alter and/or control a composition of a formation fluid produced, to control a percentage of condensable fluid as compared to non-condensable fluid, and/or to control an API gravity of fluid being produced. For example, decreasing pressure may result in production of a larger condensable fluid component. The condensable fluid component may contain a larger percentage of olefins.

In some in situ conversion process embodiments, increased pressure due to fluid generation may be maintained in the heated portion of the formation. Maintaining increased pressure in a formation may inhibit formation subsidence during in situ conversion. Increased formation pressure may promote generation of high quality products during pyrolysis. Increased formation pressure may facilitate vapor phase production of fluids from the formation. Vapor phase production may allow for a reduction in size of collection conduits used to transport fluids produced from the formation. Increased formation pressure may reduce or eliminate the need to compress formation fluids at the surface to transport the fluids in collection conduits to treatment facilities.

Increased pressure in the formation may also be maintained to produce more and/or improved formation fluids. In certain in situ conversion process embodiments, significant amounts (e.g., a majority) of the hydrocarbon fluids produced from a formation may be non-condensable hydrocarbons. Pressure may be selectively increased and/or maintained in the formation to promote formation of smaller chain hydrocarbons in the formation. Producing small chain hydrocarbons in the formation may allow more non-condensable hydrocarbons to be produced from the formation. The condensable hydrocarbons produced from the formation at higher pressure may be of a higher quality (e.g., higher API gravity) than condensable hydrocarbons produced from the formation at a lower pressure.

A high pressure may be maintained in a heated portion of a hydrocarbon containing formation to inhibit production of formation fluids having carbon numbers greater than, for example, about 25. Some high carbon number compounds may be entrained in vapor in the formation and may be removed from the formation with the vapor. A high pressure in the formation may inhibit entrainment of high carbon number compounds and/or multi-ring hydrocarbon compounds in the vapor. Increasing pressure in the hydrocarbon containing formation may increase a boiling point of a fluid in the portion. High carbon number compounds and/or multi-ring hydrocarbon compounds may remain in a liquid phase in the formation for significant time periods. The significant time periods may provide sufficient time for the compounds to pyrolyze to form lower carbon number compounds.

Maintaining increased pressure in a heated portion of the formation may surprisingly allow for production of large quantities of hydrocarbons of increased quality. Higher pressures may inhibit vaporization of higher molecular weight hydrocarbons. Inhibiting vaporization of higher molecular weight hydrocarbons may result in higher molecular weight hydrocarbons remaining in the formation. Higher molecular weight hydrocarbons may react with lower molecular weight hydrocarbons in the formation to vaporize the lower molecular weight hydrocarbons. Vaporized hydrocarbons may be more readily transported through the formation.

Generation of lower molecular weight hydrocarbons (and corresponding increased vapor phase transport) is believed to be due, in part, to autogenous generation and reaction of hydrogen in a portion of the hydrocarbon containing formation. For example, maintaining an increased pressure may force hydrogen generated during pyrolysis into a liquid phase (e.g., by dissolving). Heating the portion to a temperature in a pyrolysis temperature range may pyrolyze hydrocarbons in the formation to generate pyrolyzation fluids in a liquid phase. The generated components may include double bonds and/or radicals. $H_2$ in the liquid phase may reduce double bonds of the generated pyrolyzation fluids, thereby reducing a potential for polymerization or formation of long chain compounds from the generated pyrolyzation fluids. In addition, hydrogen may also neutralize radicals in the generated pyrolyzation fluids. Therefore, $H_2$ in the liquid phase may inhibit the generated pyrolyzation fluids from reacting with each other and/or with other compounds in the formation. Shorter chain hydrocarbons may enter the vapor phase and may be produced from the formation.

Operating an in situ conversion process at increased pressure may allow for vapor phase production of formation fluid from the formation. Vapor phase production may permit increased recovery of lighter (and relatively high quality) pyrolyzation fluids. Vapor phase production may result in less formation fluid being left in the formation after the fluid is produced by pyrolysis. Vapor phase production may allow for fewer production wells in the formation than are present using liquid phase or liquid/vapor phase production. Fewer production wells may significantly reduce equipment costs associated with an in situ conversion process.

In an embodiment, a portion of a hydrocarbon containing formation may be heated to increase a partial pressure of $H_2$. In some embodiments, an increased $H_2$ partial pressure may include $H_2$ partial pressures in a range from about 0.5 bars absolute to about 7 bars absolute. Alternatively, an increased $H_2$ partial pressure range may include $H_2$ partial pressures in a range from about 5 bars absolute to about 7 bars absolute. For example, a majority of hydrocarbon fluids may be produced when a $H_2$ partial pressure is in a range of about 5 bars absolute to about 7 bars absolute. The $H_2$ partial pressure may vary depending on, for example, temperature and pressure of the heated portion of the formation.

Maintaining a $H_2$ partial pressure in the formation greater than atmospheric pressure may increase an API value of produced condensable hydrocarbon fluids. Maintaining an increased $H_2$ partial pressure may increase an API value of produced condensable hydrocarbon fluids to greater than about 25° or, in some instances, greater than about 30°. Maintaining an increased $H_2$ partial pressure in a heated portion of a hydrocarbon containing formation may increase a concentration of $H_2$ in the heated portion. The $H_2$ may be available to react with pyrolyzed components of the hydrocarbons. Reaction of $H_2$ with the pyrolyzed components of hydrocarbons may reduce polymerization of olefins into tars and other cross-linked, difficult to upgrade, products. Therefore, production of hydrocarbon fluids having low API gravity values may be inhibited.

Controlling pressure and temperature in a hydrocarbon containing formation may allow properties of the produced formation fluids to be controlled. For example, composition and quality of formation fluids produced from the formation may be altered by altering an average pressure and/or an average temperature in a selected section of a heated portion of the formation. The quality of the produced fluids may be evaluated based on characteristics of the fluid such as, but not limited to, API gravity, percent olefins in the produced formation fluids, ethene to ethane ratio, atomic hydrogen to carbon ratio, percent of hydrocarbons in produced formation fluids having carbon numbers greater than 25, total equivalent production (gas and liquid), total liquids production, and/or liquid yield as a percent of Fischer Assay.

In an in situ conversion process embodiment, heating a portion of a hydrocarbon containing formation in situ to a temperature less than an upper pyrolysis temperature may increase permeability of the heated portion. Permeability may increase due to formation of thermal fractures in the heated portion. Thermal fractures may be generated by thermal expansion of the formation and/or by localized increases in pressure due to vaporization of liquids (e.g., water and/or hydrocarbons) in the formation. As a temperature of the heated portion increases, water in the formation may be vaporized. The vaporized water may escape and/or be removed from the formation. Removal of water may also increase the permeability of the heated portion. In addition, permeability of the heated portion may also increase as a result of mass loss from the formation due to generation of pyrolysis fluids in the formation. Pyrolysis fluid may be removed from the formation through production wells.

Heating the formation from heat sources placed in the formation may allow a permeability of the heated portion of a hydrocarbon containing formation to be substantially uniform. A substantially uniform permeability may inhibit channeling of formation fluids in the formation and allow production from substantially all portions of the heated formation. An assessed (e.g., calculated or estimated) permeability of any selected portion in the formation having a substantially uniform permeability may not vary by more than a factor of 10 from an assessed average permeability of the selected portion.

Permeability of a selected section in the heated portion of the hydrocarbon containing formation may rapidly increase when the selected section is heated by conduction. In some embodiments, pyrolyzing at least a portion of a hydrocarbon containing formation may increase a permeability in a selected section of the portion to greater than about 10 millidarcy, 100 millidarcy, 1 darcy, 10 darcy, 20 darcy, or 50 darcy. A permeability of a selected section of the portion may increase by a factor of more than about 100, 1,000, 10,000, 100,000 or more.

In some in situ conversion process embodiments, superposition (e.g., overlapping influence) of heat from one or more heat sources may result in substantially uniform heating of a portion of a hydrocarbon containing formation. Since formations during heating will typically have a temperature gradient that is highest near heat sources and reduces with increasing distance from the heat sources, "substantially uniform" heating means heating such that temperature in a majority of the section does not vary by more than 100° C. from an assessed average temperature in the majority of the selected section (volume) being treated.

In an embodiment, production of hydrocarbons from a formation is inhibited until at least some hydrocarbons in the formation have been pyrolyzed. A mixture may be produced from the formation at a time when the mixture includes a selected quality in the mixture (e.g., API gravity, hydrogen concentration, aromatic content, etc.). In some embodiments, the selected quality includes an API gravity of at least about 20°, 30°, or 40°. Inhibiting production until at least some hydrocarbons are pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

When production of hydrocarbons from the formation is inhibited, the pressure in the formation tends to increase with temperature in the formation because of thermal expansion and/or phase change of heavy hydrocarbons and other fluids (e.g., water) in the formation. Pressure in the formation may have to be maintained below a selected pressure to inhibit unwanted production, fracturing of the overburden or underburden, and/or coking of hydrocarbons in the formation. The selected pressure may be a lithostatic or hydrostatic pressure of the formation. For example, the selected pressure may be about 150 bars absolute or, in some embodiments, the selected pressure may be about 35 bars absolute. The pressure in the formation may be controlled by controlling production rate from production wells in the formation. In other embodiments, the pressure in the formation is controlled by releasing pressure through one or more pressure relief wells in the formation. Pressure relief wells may be heat sources or separate wells inserted into the formation. Formation fluid removed from the formation through the relief wells may be sent to a treatment facility. Producing at least some hydrocarbons from the formation may inhibit the pressure in the formation from rising above the selected pressure.

A formation may be selected for treatment based on an oxygen content of a part of the formation. The oxygen content of the formation may be indicative of oxygen-containing compounds producible from the formation. For some hydrocarbon containing formations subjected to in situ conversion (e.g., coal formations, oil shale formations with Type II kerogen), between about 1 wt % and about 30 wt % of condensable hydrocarbons in pyrolysis fluid produced from the formation may include oxygen-containing compounds. In certain embodiments, some oxygen-containing compounds (e.g., phenols, and/or phenolic compounds) may have sufficient economic value to justify separating the oxygen-containing compounds from the produced fluid. For example, separation of phenols from the produced stream may allow separated phenols to be sold and may reduce a cost of hydrotreating the produced fluids. "Phenols" and/or "phenolic compounds" refer to aromatic rings with an attached OH group, including substituted aromatic rings such as cresol, xylenol, resorcinol, etc.

A method to enhance the production of phenols from a formation fluid obtained from an in situ thermal conversion process may include controlling conditions in a section of the formation. In some embodiments, temperature, heating rate, pressure, and/or hydrogen partial pressure may be controlled to increase a percentage of oxygen-containing compounds in the pyrolysis fluid or to increase a quantity of oxygen-containing compounds produced from the formation. The quantity of oxygen-containing compounds may be increased by producing more condensable hydrocarbons from the formation.

In some embodiments, a method for treating a hydrocarbon containing formation in situ may include providing hydrogen to a section of the formation under certain conditions. The hydrogen may be provided through a heater well or production well located in or proximate the section. While relatively expensive to make, separate, and/or procure, hydrogen may be advantageously provided to the section when formation conditions promote efficient use of hydrogen. After hydrogen has been provided to the section, controlling the production of hydrogen from the formation may reduce an overall cost of production. Controlling hydrogen production may include, but is not limited to, inhibiting gas production from the formation, controlling a partial pressure of hydrogen in the section or in fluids produced from the section, and/or maintaining a partial pressure of hydrogen in the section or in fluids produced from the section. For example, the section may be shut in for a desired period of time to allow the hydrogen to permeate or "soak" the section. Increasing an amount of hydrogen in the section may increase quantity and/or quality of formation fluid produced (e.g., production of condensable hydrocarbons and/or phenols may be increased).

In some embodiments, hydrogen may be provided to a hydrocarbon containing formation after a section of the formation has reached a desired average temperature (e.g., 290° C., 320° C., 375° C., or 400° C.). Thus, hydrogen may not be provided until the hydrogen will have the maximum desired effect, and such effect is often temperature dependent. Pressure and/or hydrogen partial pressure in the formation may be controlled to allow hydrogen to permeate the treatment area. Formation fluid may be produced after a desired temperature has been reached, after an amount of time has elapsed, after a certain hydrogen partial pressure and/or after a certain formation pressure has been achieved. In some embodiments, production of formation fluid may be controlled to increase production of condensable hydrocarbons and/or phenols.

Hydrogen partial pressure may be controlled in a formation. The hydrogen partial pressure may be controlled to inhibit or limit the amount of introduced hydrogen that is produced from the formation as hydrogen. Hydrogen partial pressure may be controlled (e.g., enhanced) by inhibiting gas production from the formation or reducing production from the formation for a period of time after introduction of hydrogen to the formation. In this manner, hydrogen introduced in the formation is maintained in the formation, and thus provides benefits in the formation. In certain embodiments, hydrogen partial pressure in the formation may be controlled by producing fluid from the formation in a liquid phase (the hydrogen tends to preferentially stay in the gas phase). For example, a submersible pump and/or pressure lift may be used to remove fluid from the formation in a liquid phase. Controlling hydrogen partial pressure may result in an increase in production of condensable hydrocarbons from the formation. Controlling hydrogen partial pressure may result in an increase in production of phenol or phenolic compounds from the formation. As hydrogen permeates the section and/or the formation, the section pressure may decrease and approach an initial pressure measured in the section. Formation fluid may be produced when the pressure of the section (e.g., a pressure measured at a production or monitoring well) approaches a desired production pressure. In some embodiments, an amount of hydrogen in the mixture produced from the formation may be measured by assessing a partial pressure of hydrogen in gases produced from one or more production wells.

In some embodiments, a formation may be heated to a desired average temperature (e.g., 290° C., 320° C., 375° C., or 400° C.). Hydrogen may be provided to a hydrocarbon containing formation until a mixture of hydrogen and formation fluid is produced at a production well. Once production of hydrogen and the formation fluid occurs at the production well, delivery of hydrogen may be decreased and/or stopped. Pressure and/or hydrogen partial pressure in the formation may be controlled to allow hydrogen to permeate the treatment area. Formation fluid may be produced after a desired temperature has been reached, an amount of time has elapsed, and/or a certain hydrogen partial pressure and/or a certain formation pressure has been achieved. In certain embodiments, a rate of production may be reduced based upon an amount of hydrogen produced in produced formation fluid. In certain embodiments, an amount of hydrogen in the mixture produced from the formation may be measured by assessing a partial pressure of hydrogen in gases produced from one or more production wells. In some embodiments, production of formation fluid may be controlled to increase production of condensable hydrocarbons and/or phenols.

In certain embodiments, a perimeter barrier (e.g., a frozen barrier) may be formed around a section of a hydrocarbon containing formation to define a treatment area. Hydrogen may be provided to the treatment area. Pressure in the treatment area may be controlled to allow hydrogen to permeate the treatment area. Heat may be provided by one or more heaters to pyrolyze hydrocarbons in the treatment area. Formation fluid may be produced after a desired temperature has been reached, an amount of time has elapsed, and/or a certain pressure has been achieved. In some embodiments, production of formation fluid may be controlled to increase production of condensable hydrocarbons and/or phenols.

In some embodiments, hydrogen partial pressure may be controlled (e.g., enhanced) by inhibiting gas production from the formation (e.g., shutting in a production well) or reducing production from the formation for a period of time after introduction of hydrogen into the formation. In this manner, hydrogen introduced in the formation is maintained in the formation, and thus provides benefits in the formation. In certain embodiments, hydrogen partial pressure in the formation may be controlled by producing fluid from the formation in a liquid phase (the hydrogen tends to preferentially stay in the gas phase). A submersible pump and/or pressure lift may be used to remove fluid from the formation in a liquid phase. Controlling hydrogen partial pressure may result in an increase in production of condensable hydrocarbons from the formation.

In some embodiments, a valve or valve system may be used to maintain, alter, and/or control pressure in a section of a hydrocarbon containing formation undergoing hydrogen permeation. In some embodiments, pressure in the formation and/or the section may be controlled at injection wells, heater wells, and/or production wells. After hydrogen is introduced into the formation, production of formation fluids and/or pressure control through the valve system may be adjusted to stop or diminish fluid production so that a hydrogen component percentage is at an acceptable level in the produced fluid when production is resumed (i.e., little or no hydrogen introduced into the formation is being produced as hydrogen in the produced fluid). In some embodiments, an initial pressure of the formation may be monitored before introduction of hydrogen into the formation. The pressure of the formation may be monitored after introducing hydrogen into the formation. Introduction of hydrogen in the formation may increase the pressure in the formation. As hydrogen permeates the formation, pressure in the formation may decrease over time. When the pressure in the formation decreases at least to the pressure in the formation before hydrogen is provided, fluid may be produced from the formation.

In some embodiments, hydrogen may be provided to a section of a formation as a mixture of hydrogen and a carrier fluid. A carrier fluid may include, but is not limited to, inert gases, condensable hydrocarbons, methane, carbon dioxide, steam, surfactants, and/or combinations thereof. Providing hydrogen to the formation as part of a mixture may increase the efficiency of hydrogenation reactions in the formation. Increasing the efficiency of hydrogenation reactions may increase an economic value of produced formation fluid. Concentration of hydrogen in the mixture may range from about 1 wt % to about 80 wt %. In some embodiments, concentration of hydrogen in a mixture of hydrogen and carrier fluid provided to a section of a formation may be adjusted by controlling a flow rate of the mixture.

A mixture of hydrogen and a carrier fluid may be provided to a hydrocarbon containing formation after a section of the formation has reached a desired average temperature (e.g., 290° C., 320° C., 375° C., or 400° C.). In certain embodiments, a mixture of hydrogen and a carrier fluid may be provided to a section of a formation before heating the section. After the mixture has been provided to the section, hydrogen production in the section may be controlled by, for example, inhibiting gas production from the formation, controlling a partial pressure of hydrogen in the section or in fluids produced from the section, and/or maintaining a partial pressure of hydrogen in the section or in fluids produced from the section. Pyrolysis fluid may be produced after a desired temperature has been reached, after an amount of time has elapsed, after a certain pressure and/or a certain hydrogen partial pressure has been achieved. For example, permeating a sub-bituminous coal formation with a mixture of hydrogen in methane may increase condensable hydrocarbon production and/or phenol production from the coal.

TABLES 1, 2, and 3 provide a summary of data related to laboratory experiments with coal obtained from the Wyoming Anderson Coal Formation. TABLE 1 summarizes the general characteristics of the coal samples taken from the formation.

In a first experiment, a first coal sample was placed in a vessel and heated uniformly. The vessel was heated at about 2° C. per day until the coal reached about 450° C. A total pressure of the vessel was about 50 psig and a generated hydrogen partial pressure was about 2 psig. In a second experiment, hydropyrolysis of a second coal sample was conducted by heating the coal under a hydrogen rich atmosphere (about 79 mol % hydrogen). The vessel was heated at about 2° C. per day until the second coal sample reached about 490° C. A total pressure of the vessel was about 60 psig and a hydrogen partial pressure was about 48 psig. TABLE 2 summarizes the experimental results from the two experiments performed on coal samples obtained from the Wyoming Anderson Coal Formation.

TABLE 1

| Wyoming Anderson Coal Characteristics | |
|---|---|
| Sample ID | Anderson Coal |
| Site | Buckskin Mine |

TABLE 1-continued

| Wyoming Anderson Coal Characteristics | |
|---|---|
| Basin | Powder River |
| State | Wyoming |
| Age | Paleocene |
| Stratigraphic Unit | Fort Union Fm |
| Rank | SubC |
| % Ro | 0.32 |
| Oil (wt % FA) | 4.61 |
| Gas (wt % FA) | 14.35 |
| Water (wt % FA) | 36.33 |
| Spent Coal (wt % FA) | 44.06 |
| Oil (gal/ton, FA) | 11.16 |

TABLE 1-continued

| Wyoming Anderson Coal Characteristics | |
|---|---|
| Water (gal/ton, FA) | 87.08 |
| Moisture (wt %, as-rec'd) | 28.17 |
| Ash (wt %, as-rec'd) | 4.0 |
| Vol. Matter (wt %, as-rec'd) | 33.83 |
| Fixed Carbon (wt %, as-rec'd) | 34.0 |
| Carbon (wt %, as-rec'd) | 51.57 |
| Hydrogen (wt %, as-rec'd) | 3.44 |
| Oxygen (wt %, as-rec'd) | 11.51 |
| Nitrogen (wt %, as-rec'd) | 0.96 |
| Sulfur (wt %, as-rec'd) | 0.33 |

TABLE 2

| Parameter | Regular Pyrolysis Run | Hydro-Pyrolysis Run |
|---|---|---|
| Heating Rate (° C./day) | 2 | 2 |
| End Temperature (° C.) | 448 | 492 |
| Total Pressure (psig) | 50 | 60 |
| $H_2$-Pressure (psig) | 2 | 48 |
| Constant $H_2$ Sweep Rate (Scf/day/ton, raw coal) | 0 | 272 |
| Avg $H_2$ consuming Rate (Scf/day/ton, raw coal) to 448° C. | 0 | 108 |
| $H_2$ consuming Rate (Scf/day/ton, raw coal) at 448° C. | 0 | 143 |
| Total $H_2$ Injected per bbl oil produced (Scf/bbl) at 448° C. | 0 | 57060 |
| Total $H_2$ consumed per bbl oil produced (Scf/bbl) at 448° C. | 0 | 23119 |
| Avg $H_2$ consuming Rate (Scf/day/ton, raw coal) to 492° C. | 0 | 114 |
| $H_2$ consuming Rate (Scf/day/ton, raw coal) at 492° C. | 0 | 130 |
| Raw Sample Weight (g) | 958 | 600 |
| End Spent Coal (g) | 453.94 | 215.67 |
| Total Oil (g) | 21.60 | 47.53 |
| Total Water (g) | 361.60 | 238.90 |
| End Gas without $H_2/N_2/O_2$ (g) | 109.95 | 108.46 |
| Oil Yield (gal/ton coal) at 448° C. | 7.08 | 20.97 |
| Oil Recovery (vol % FA) at 448° C. | 63.40 | 187.93 |
| Oil API at 448° C. | 32.58 | 18.89 |
| Paraffins (wt %) at 448° C. | 26.89 | 19.54 |
| Cycloparaffins (wt %) at 448° C. | 9.60 | 5.80 |
| Phenols (wt %) at 448° C. | 34.51 | 27.32 |
| Monoaros (wt %) at 448° C. | 19.36 | 16.56 |
| Diaros (wt %) at 448° C. | 9.14 | 20.70 |
| Triaros (wt %) at 448° C. | 0.51 | 8.91 |
| Tetraaros (wt %) at 448° C. | 0.00 | 1.17 |
| Water Yield (gal/ton coal) at 448° C. | 90.33 | 94.34 |
| Water to Oil Ratio (total water) at 448° C. | 12.77 | 4.50 |
| Water to Oil Ratio (pyrolysis water) at 448° C. | 3.20 | 1.27 |
| Gas w/o $H_2/N_2/O_2$ (scf/ton coal) at 448° C. | 2521.71 | 3807.39 |
| Methane (scf/ton coal) at 448° C. | 1048.71 | 1841.53 |
| $C_2$-$C_4$ HC Gas (scf/ton coal) at 448° C. | 234.19 | 612.97 |
| Gas w/o $H_2/N_2/O_2$ (scf-gas/bbl-oil) at 448° C. | 14968.06 | 7624.54 |
| Methane (scf-gas/bbl-oil) at 448° C. | 6224.80 | 3687.78 |
| $C_2$-$C_4$ HC Gas (scf-gas/bbl-oil) at 448° C. | 1390.08 | 1227.51 |
| Gas to Oil Ratio (Gas w/o $H_2/N_2/O_2$) at 448° C. | 14.97 | 7.62 |
| Gas to Oil Ratio ($C_1$-$C_4$ Gas) at 448° C. | 7.61 | 4.92 |
| $C_1$ (mol %) at 448° C. | 41.59 | 48.37 |
| $C_2$ (mol %) at 448° C. | 5.80 | 10.95 |
| $C_3$ (mol %) at 448° C. | 2.46 | 3.87 |
| $C_4$ (mol %) at 448° C. | 1.03 | 1.28 |
| CO (mol %) at 448° C. | 0.89 | 4.40 |
| $CO_2$ (mol %) at 448° C. | 48.10 | 31.11 |
| $H_2S$ (mol %) at 448° C. | 0.13 | 0.02 |
| $NH_3$ (mol %) at 448° C. | 0.004 | 0.000 |
| Oil Yield (gal/ton coal) at 492° C. | | 22.58 |
| Oil Recovery (vol % FA) at 492° C. | | 202.33 |
| Oil API at 492° C. | | 19.70 |
| Paraffins (wt %) at 492° C. | | 20.28 |
| Cycloparaffins (wt %) at 492° C. | | 5.39 |
| Phenolic compounds (wt %) at 492° C. | | 25.29 |
| Monoaros (wt %) at 492° C. | | 16.01 |
| Diaros (wt %) at 492° C. | | 21.84 |
| Triaros (wt %) at 492° C. | | 9.91 |
| Tetraaros (wt %) at 492° C. | | 1.28 |
| Water Yield (gal/ton coal) at 492° C. | | 95.06 |

TABLE 2-continued

| Parameter | Regular Pyrolysis Run | Hydro-Pyrolysis Run |
|---|---|---|
| Water to Oil Ratio (total water) at 492° C. | | 4.21 |
| Water to Oil Ratio (pyrolysis water) at 492° C. | | 1.21 |
| Gas w/o $H_2/N_2/O_2$ (scf/ton coal) at 492° C. | | 4569.68 |
| Methane (scf/ton coal) at 492° C. | | 2429.25 |
| $C_2$-$C_4$ HC Gas (scf/ton coal) at 492° C. | | 762.42 |
| Gas w/o $H_2/N_2/O_2$ (scf-gas/bbl-oil) at 492° C. | | 8499.72 |
| Methane (scf-gas/bbl-oil) at 492° C. | | 4518.47 |
| $C_2$-$C_4$ HC Gas (scf-gas/bbl-oil) at 492° C. | | 1418.12 |
| Gas to Oil Ratio (Gas w/o $H_2/N_2/O_2$) at 492° C. | | 8.50 |
| Gas to Oil Ratio ($C_1$-$C_4$ Gas) at 492° C. | | 5.94 |
| $C_1$ (mol %) at 492° C. | | 53.16 |
| $C_2$ (mol %) at 492° C. | | 12.08 |
| $C_3$ (mol %) at 492° C. | | 3.52 |
| $C_4$ (mol %) at 492° C. | | 1.09 |
| CO (mol %) at 492° C. | | 4.04 |
| $CO_2$ (mol %) at 492° C. | | 26.09 |
| $H_2S$ (mol %) at 492° C. | | 0.02 |
| $NH_3$ (mol %) at 492° C. | | 0.00 |

Figure 16:
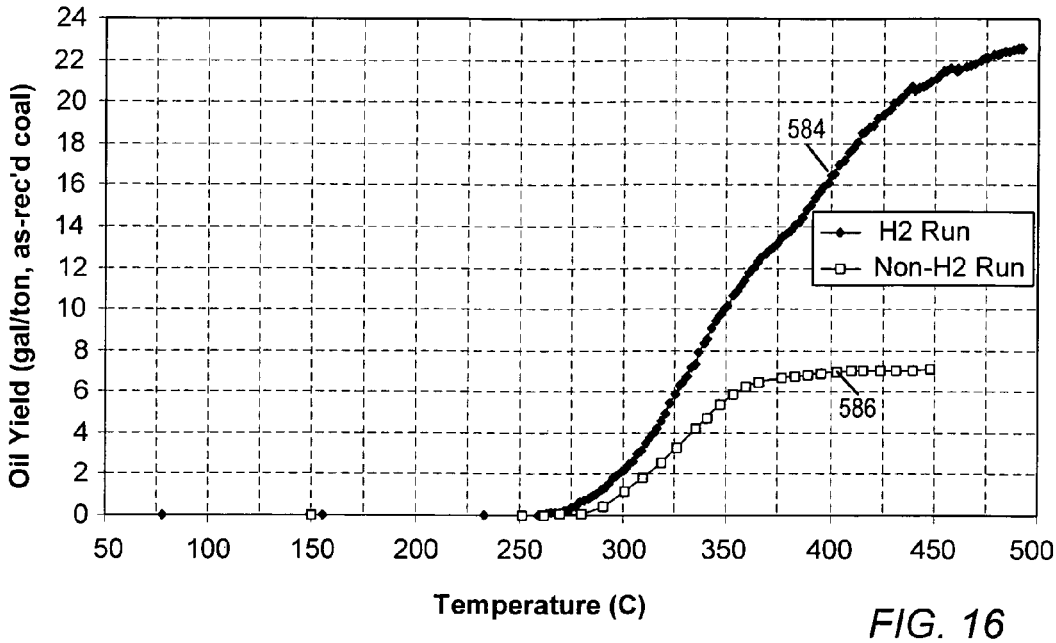
FIG. 16 depicts condensable hydrocarbon production from Wyoming Anderson Coal pyrolysis with hydrogen injection and without hydrogen injection.

FIG. 16 depicts condensable hydrocarbon production from Wyoming Anderson Coal based on the pyrolysis experiment and the hydropyrolysis experiment. Curve 584 depicts data obtained from the hydropyrolysis experiment (i.e., $H_2$ was added to the coal during pyrolysis). Curve 586 depicts data obtained from pyrolysis without the addition of hydrogen during pyrolysis. Condensable hydrocarbon yield at 448° C. was about 7.08 gal/ton of coal for the pyrolysis experiment. Condensable hydrocarbon yield at 448° C. was about 20.97 gal/ton of coal for the hydropyrolysis experiment. FIG. 16 demonstrates an almost three-fold increase in condensable hydrocarbon production when hydrogen is added to the coal.

Figure 17:
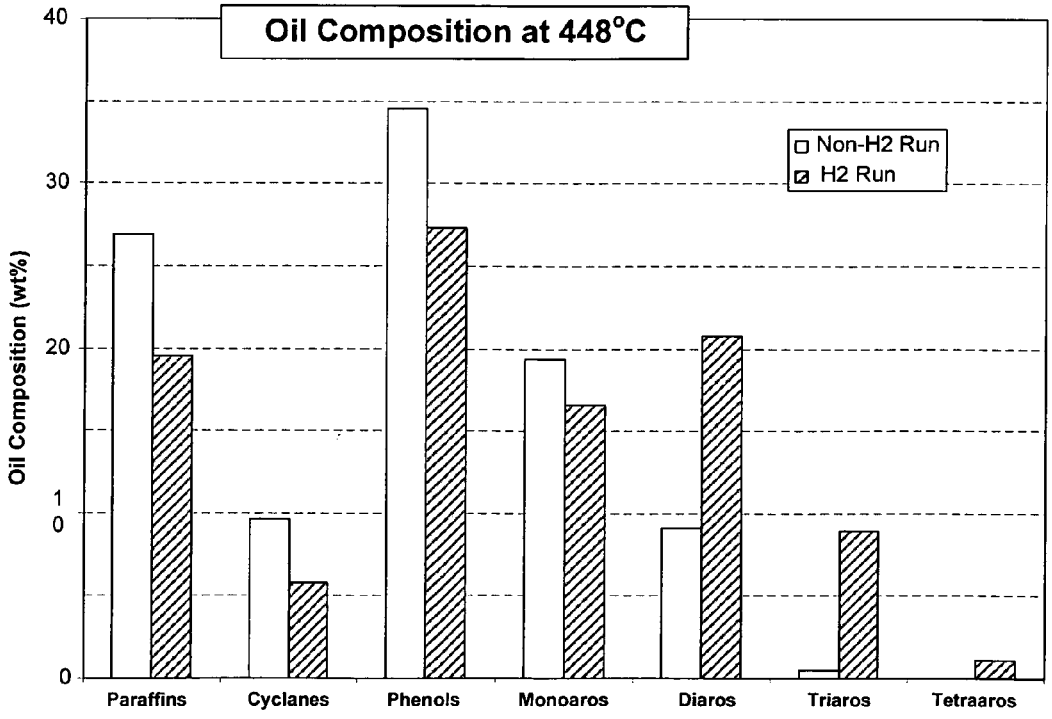
FIG. 17 depicts composition of condensable hydrocarbons produced during pyrolysis and hydropyrolysis experiments on Wyoming Anderson Coal.

FIG. 17 depicts composition of condensable hydrocarbons produced during pyrolysis and hydropyrolysis experiments on Wyoming Anderson Coal. The API gravity of the oil obtained from the pyrolysis experiment at 448° C. was about 33°. The API gravity of the oil obtained from the hydropyrolysis experiment at 448° C. was about 19°. The difference in the API gravity may be due to the greater weight percentage of diaromatics and higher order aromatics in the oil obtained from the hydropyrolysis experiment.

Figure 18:
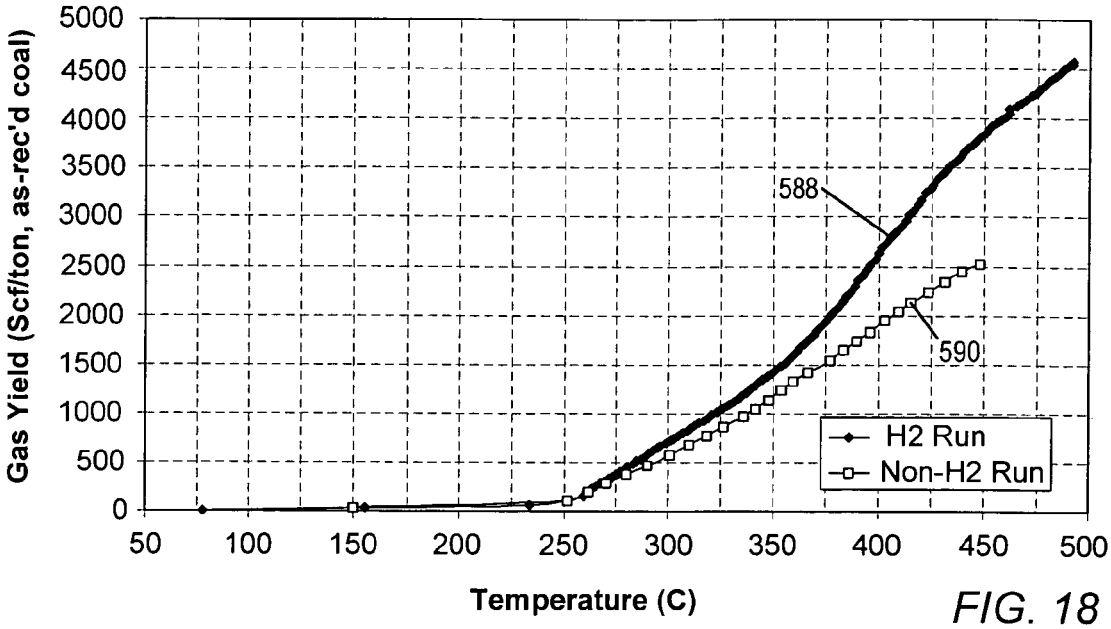
FIG. 18 depicts non-condensable hydrocarbon production from Wyoming Anderson Coal based on a pyrolysis experiment and a hydropyrolysis experiment.

FIG. 18 depicts non-condensable hydrocarbon production from Wyoming Anderson Coal based on the pyrolysis experiment and the hydropyrolysis experiment. Curve 588 depicts data obtained from the hydropyrolysis experiment. Curve 590 depicts data obtained from the pyrolysis experiment. Non-condensable hydrocarbon yield at 448° C. was about 2522 scf/ton of coal for the pyrolysis experiment. Non-condensable hydrocarbon yield at 448° C. was about 3807 scf/ton of coal for the hydropyrolysis experiment.

Figure 19:
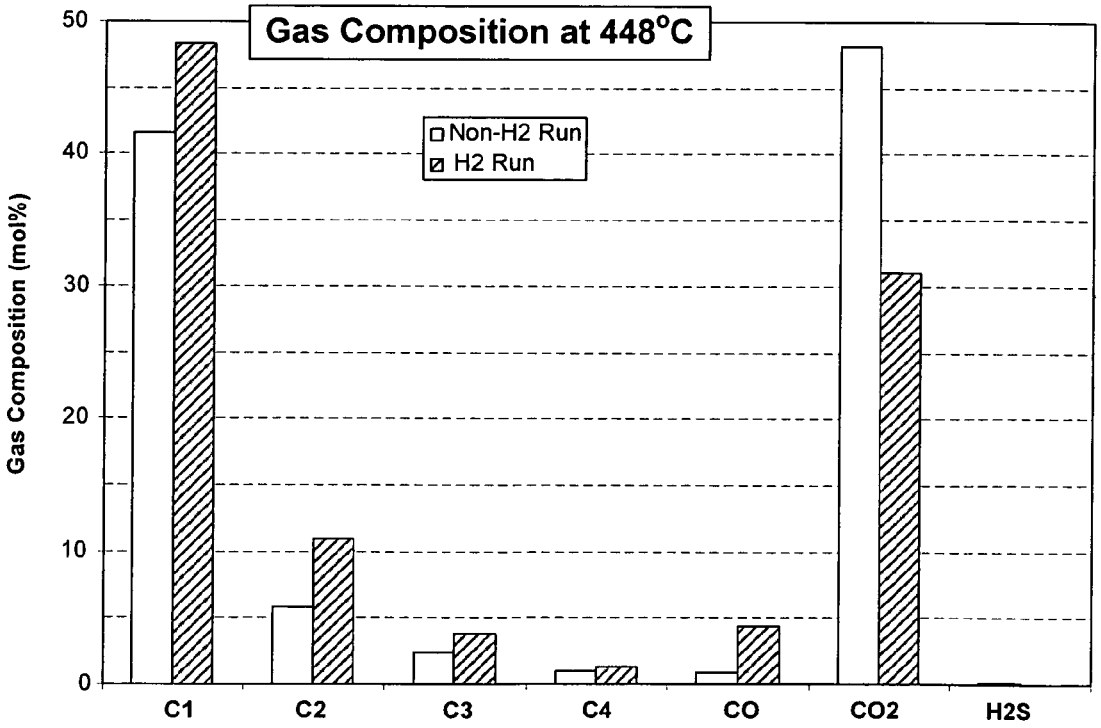
FIG. 19 depicts the composition of non-condensable fluid produced during pyrolysis and hydropyrolysis experiments on Wyoming Anderson Coal.

FIG. 19 depicts the composition of non-condensable fluid produced during pyrolysis and hydropyrolysis experiments on Wyoming Anderson Coal. The non-condensable fluid produced in the hydropyrolysis experiment contained a greater mole percentage of methane (C1) than did the pyrolysis experiment. The non-condensable fluid produced in the hydropyrolysis experiment contained a significantly smaller mole percentage of carbon dioxide than did the non-condensable fluid produced in the pyrolysis experiment.

Figure 20:
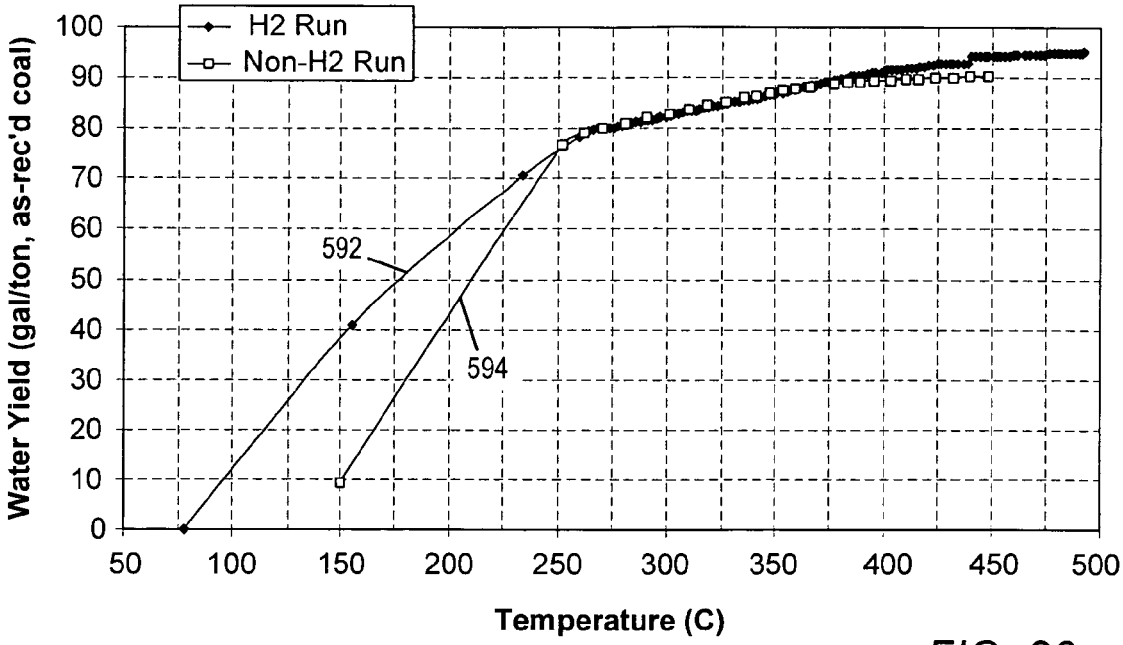
FIG. 20 depicts water production from Wyoming Anderson Coal based on a pyrolysis experiment and a hydropyrolysis experiment.

FIG. 20 depicts water production from Wyoming Anderson Coal based on the pyrolysis experiment and the hydropyrolysis experiment. Curve 592 depicts water yield for the hydropyrolysis experiment. Curve 594 depicts water yield for the pyrolysis experiment. Water yield at 448° C. was about 90 gal/ton of coal for the pyrolysis experiment. Water yield at 448° C. was about 94 gal/ton of coal for the hydropyrolysis experiment. Water yield during pyrolysis from about 250° C. to about 375° C. was substantially the same from both experiments. Water production become higher for the hydropyrolysis experiment at temperatures above about 375° C.

Data obtained from experiments appears to scale to treatment of in situ formations. The pyrolysis experiment and the hydropyrolysis experiment imply that there may be several advantages of introducing hydrogen into a formation when the formation is at pyrolysis temperatures between about 250° C. and about 450° C. The addition of hydrogen may result in a significant increase in condensable hydrocarbons produced from the formation as opposed to producing the formation without the introduction of hydrogen into the formation. The addition of hydrogen may also result in a significant increase in gas yield as compared to a formation that is treated without the introduction of hydrogen. The addition of hydrogen to the formation may also result in a significant decrease in the mole percentage of carbon dioxide that is produced from the formation as compared to a formation that is treated without the introduction of hydrogen. The introduction of hydrogen into the formation during pyrolysis may allow for the treatment of immature coal formations without producing excessive amounts of carbon dioxide during pyrolysis production.

TABLE 3 summarizes the experimental results from nitric oxide ionization spectrometry evaluation (NOISE) analysis of the C5+ fraction taken during the pyrolysis experiment and the hydropyrolysis experiment at about 450° C. Phenol yield was about 1.3 g/kg of coal for the pyrolysis experiment. Phenol yield was about 3.9 g/kg of coal for the hydropyrolysis experiment. Phenol composition in the produced C5+ fraction was about 5.2 wt % for the pyrolysis experiment. Phenol composition in the produced C5+ fraction was about 4.8 wt % for the hydropyrolysis experiment. Phenolic compounds yield was about 8.7 g/kg of coal for the pyrolysis experiment. Phenolic compounds yield was about 22.3 g/kg of coal for the hydropyrolysis experiment. Phenolic compounds composition in the produced C5+ fraction was about 34.5 wt % for the pyrolysis experiment. Phenolic compounds composition in the produced C5+ fraction was about 27.3 wt % for the hydropyrolysis experiment. While the contents of phenol and phenolic compounds in the produced C5+ oil fraction decreased slightly for the hydropyrolysis experiment, about a three fold increase in the yield of total phenol and phenolic compounds was measured when hydrogen was provided to the coal sample. The significant increase in the gram yield of phenolic compounds per kilogram of coal may be attributed to hydrogenation of depolymerized coal fragments during coal hydropyrolysis to produce more condensable hydrocarbon and phenolic compounds and water.

TABLE 3

| Parameter | Regular Pyrolysis Run | Hydro-Pyrolysis Run |
|---|---|---|
| Phenol (wt %) | 5.2 | 4.8 |
| Total Phenol (g/kg coal) | 1.3 | 3.9 |
| Phenolic compounds (wt %) | 34.5 | 27.3 |
| Total Phenolic compounds (g/kg coal) | 8.7 | 22.3 |

Some hydrocarbon containing formations may contain significant amounts of entrained methane. The methane may be referred to as hydrocarbon bed methane. For example, a coal bed may contain significant amounts of entrained methane. If the hydrocarbon formation is a coal formation, the methane may be referred to as coal bed methane. In some types of formations (e.g., coal formations), hydrocarbon bed methane may be produced from a formation without the need to raise the temperature of the formation to pyrolysis temperatures. Hydrocarbon bed methane, or methane from a different source (e.g., methane from a half cycle process and/or a methane cycle process), may be a raw material for producing hydrogen ($H_2$). In some embodiments, hydrogen produced from methane may be introduced into a part of a formation raised to pyrolysis temperatures so that hydropyrolysis occurs in the part. Hydrogen from a separate source (e.g., from a half cycle process and/or a hydrogen cycle process) may supplement the hydrogen obtained from converting methane to hydrogen.

A simulation was run to analyze the ability to use methane conversion to provide hydrogen for hydropyrolyzing a part of a formation. The simulator modeled a coal formation. The modeled formation was the Wyoming Anderson formation. Some properties of the formation are presented in TABLE 1. Some of the data input into the simulator included data obtained from laboratory experiments of hydropyrolysis of coal samples.

The simulator converted a portion of coal bed methane into hydrogen using a steam reformation process. Steam reformation is an industrial process based on the chemical reaction of methane and water to produce carbon monoxide and hydrogen, expressed by EQN. 2.

$$CH_4+H_2O \rightarrow CO+3H_2 \quad (2)$$

The simulator modeled injection of the hydrogen produced from methane conversion into a heated portion of the Wyoming Anderson coal formation. Injected hydrogen was used for hydropyrolyzing hydrocarbons in the heated portion of the Wyoming Anderson coal formation. Hydropyrolysis was used to upgrade coal in the heated portion.

TABLE 4 summarizes the amount of hydrogen injected in the heated portion and the amount consumed during the hydropyrolyzation simulation. Approximately 36% of the injected hydrogen was consumed. TABLE 4 shows the production of oil as a function of injected and consumed hydrogen. TABLE 5 shows how much methane is required to produce the hydrogen required to hydropyrolyze the heated portion of the formation. TABLE 6 demonstrates how much area of the Wyoming Anderson coal formation that must be developed to provide enough methane to convert to hydrogen for hydropyrolysis. TABLE 6 shows that methane from as much as 16 square miles of the coal formation must be developed to hydropyrolyze (based on the amount of hydrogen actually consumed during the hydropyrolysis) 1 square mile of the same coal formation. TABLES 4-6 are based on products produced from hydropyrolysis at about 400° C.

TABLE 4

| Use | Total $H_2$ (scf/ton raw coal) | oil (bbl/ton raw coal) | scf-H2/bbl-oil | vol %: H2-consumed/ H2-injected |
|---|---|---|---|---|
| $H_2$ injected | 2.14E+04 | 3.91E−01 | 54673 | |
| $H_2$ consumed | 7.64E+03 | 3.91E−01 | 19545 | 36 |

TABLE 5

| Use | $CH_4$ (scf/ton raw coal) | $CH_4$ (scf/ac-ft raw coal) | CBM Needed (scf/ac-ft coal) |
|---|---|---|---|
| $H_2$ injected | 7.1272E+03 | 7.7526E+11 | 6.7253E+11 |
| $H_2$ consumed | 2.5479E+03 | 2.7715E+11 | 1.7441E+11 |

TABLE 6

| Coal Thick (ft) | Coal Area ($mi^2$) | Coal Area (acres) | Density (ton/ac-ft) | Coal Mass (ton) | CBM in-place (scf/ton) | Total CBM (scf) |
|---|---|---|---|---|---|---|
| 100 | 62 | 39680 | 1700 | 6.7440E+09 | 100 | 6.7440E+11 |
| 100 | 16 | 10240 | 1700 | 1.7404E+09 | 100 | 1.7404E+11 |
| 100 | 1 | 640 | 1700 | 1.0877E+08 | 100 | 1.0877E+10 |

TABLE 7

| Use | Total $H_2$ (scf/ton raw coal) | oil (bbl/ton raw coal) | scf-$H_2$/bbl-oil | vol %: $H_2$-consumed/ $H_2$-injected |
|---|---|---|---|---|
| $H_2$ injected | 2.85E+04 | 4.99E−01 | 57060 | |
| $H_2$ consumed | 1.15E+04 | 4.99E−01 | 23119 | 41 |

TABLE 8

| Use | $CH_4$ (scf/ton raw coal) | $CH_4$ (scf/ac-ft raw coal) | CBM Needed (scf/ac-ft coal) |
|---|---|---|---|
| $H_2$ injected | 9.4978E+03 | 1.0331E+12 | 8.3281E+11 |
| $H_2$ consumed | 3.8482E+03 | 4.1859E+11 | 2.1828E+11 |

TABLE 9

| Coal Thick (ft) | Coal Area ($mi^2$) | Coal Area (acres) | Density (ton/ac-ft) | Coal Mass (ton) | CBM in-place (scf/ton) | Total CBM (scf) |
|---|---|---|---|---|---|---|
| 100 | 77 | 49280 | 1700 | 8.3756E+09 | 100 | 8.3756E+11 |
| 100 | 21 | 13440 | 1700 | 2.2843E+09 | 100 | 2.2843E+11 |
| 100 | 1 | 640 | 1700 | 1.0877E+08 | 100 | 1.0877E+10 |

TABLES 7-9 present information similar to the information presented in TABLES 4-6, however, data from TABLES 7-9 are based on products produced from hydropyrolysis at about 448° C. Similar results were obtained at 400° C. and at 448° C. At 448° C. more hydrogen was consumed per unit of oil produced.

Figure 21:
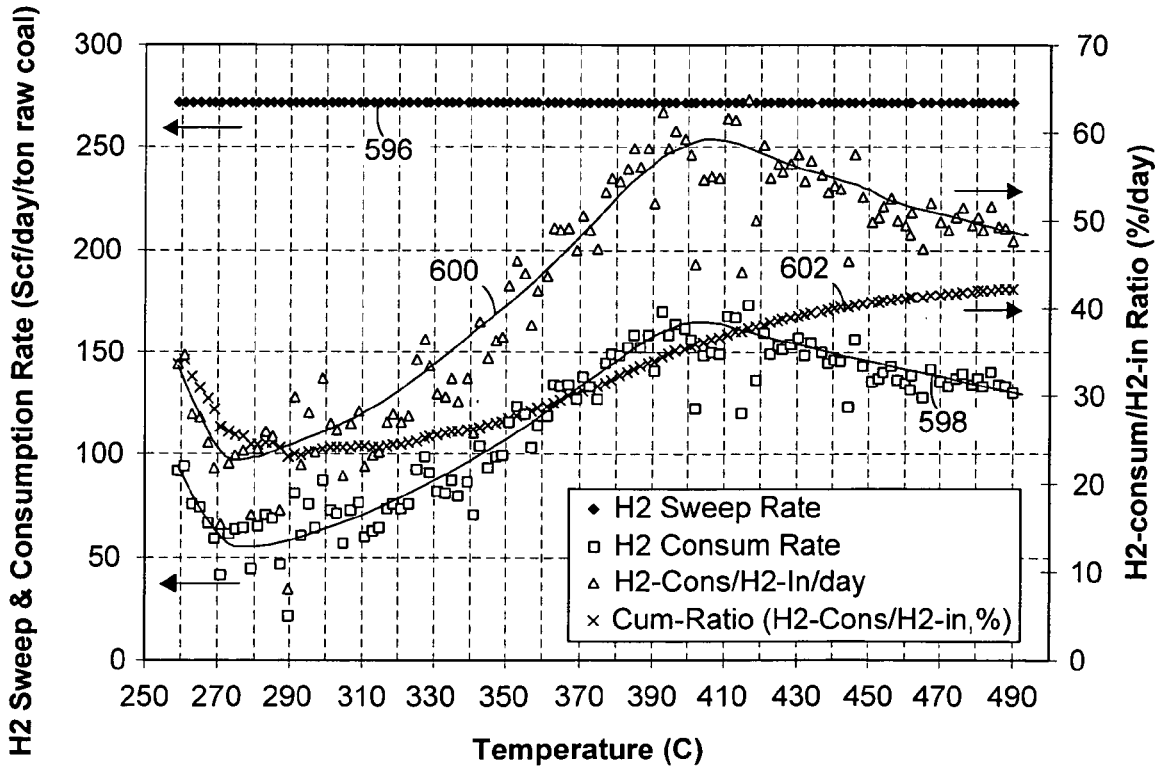
FIG. 21 depicts hydrogen consumption rates in a portion of the Wyoming Anderson Coal formation for a constant rate of hydrogen injection in the formation.

FIG. 21 depicts hydrogen consumption rates per ton of raw coal in a portion of the Wyoming Anderson Coal formation for a constant rate of hydrogen injection in the formation. FIG. 21 depicts hydrogen consumption and injection rates over a range of temperatures. The range of temperatures depicted in FIG. 21 is an example of a pyrolysis temperature range for a coal formation. Curve 596 depicts a substantially constant hydrogen injection rate of about 270 scf/day/ton raw coal over the depicted temperature range. Curve 598 depicts a variable consumption rate of hydrogen when hydrogen is injected at a constant rate. Curve 598 shows a peak consumption rate of hydrogen of about 158 scf/day/ton raw coal at about 392° C. Curve 600 depicts the ratio of hydrogen consumed and hydrogen injected per day. Curve 600 appears to show that hydrogen consumption is greatest around a temperature of about 392° C. Curve 602 depicts the hydrogen consumption rate per hydrogen injected rate per day as a percentage.

Figure 22:
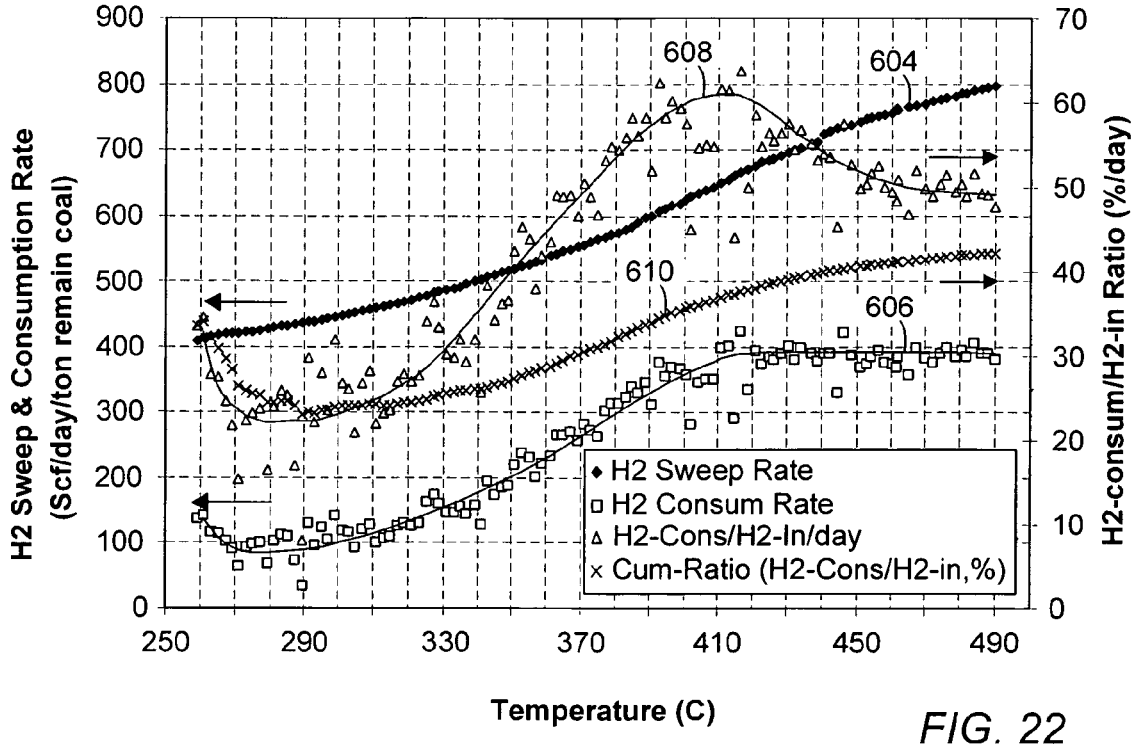
FIG. 22 depicts hydrogen consumption rates per ton of remaining coal in a portion of the Wyoming Anderson Coal formation for a variable rate of hydrogen injection in the formation.

FIG. 22 depicts hydrogen consumption rates per ton of remaining coal in a portion of the Wyoming Anderson Coal formation for a variable rate of hydrogen injection in the formation. FIG. 22 depicts hydrogen consumption and injection rates over a range of temperatures. Curve 604 depicts a hydrogen injection rate per ton of remaining coal. Curve 606 plots a rate of consumption of hydrogen during treatment of the portion of the coal formation. Curve 608 plots hydrogen consumption rates per hydrogen injection rates per day for the portion of the coal formation. Curve 610 plots hydrogen consumption rate per hydrogen injection rate per day as a percentage.

Computer simulations have demonstrated that carbon dioxide may be sequestered in both a deep coal formation and a post treatment coal formation. The Comet2™ Simulator (Advanced Resources International, Houston, Tex.) determined the amount of carbon dioxide that could be sequestered in a San Juan Basin type deep coal formation and a post treatment coal formation. The simulator also determined the amount of methane produced from the San Juan Basin type deep coal formation due to carbon dioxide injection. The model employed for both the deep coal formation and the post treatment coal formation was a 1.3 $km^2$ area, with a repeating 5 spot well pattern. The 5 spot well pattern included four injection wells arranged in a square and one production well at the center of the square. The properties of the San Juan Basin and the post treatment coal formations are shown in TABLE 10. Additional details of simulations of carbon dioxide sequestration in deep coal formations and comparisons with field test results may be found in *Pilot Test Demonstrates How Carbon Dioxide Enhances Coal Bed Methane Recovery*, Lanny Schoeling and Michael McGovern, Petroleum Technology Digest, September 2000, p. 14-15.

TABLE 10

| | Deep Coal Formation (San Juan Basin) | Post treatment coal formation (Post pyrolysis process) |
|---|---|---|
| Coal Thickness (m) | 9 | 9 |
| Coal Depth (m) | 990 | 460 |
| Initial Pressure (bars abs.) | 114 | 2 |
| Initial Temperature (° C.) | 25 | 25 |
| Permeability (md) | 5.5 (horiz.), 0 (vertical) | 10,000 (horiz.), 0 (vertical) |
| Cleat porosity | 0.2% | 40% |

The simulation model accounts for the matrix and dual porosity nature of coal and post treatment coal. For example, coal and post treatment coal are composed of matrix blocks. The spaces between the blocks are called "cleats." Cleat porosity is a measure of available space for flow of fluids in the formation. The relative permeabilities of gases and water in the cleats required for the simulation were derived from field data from the San Juan coal. The same values for relative permeabilities were used in the post treatment coal formation simulations. Carbon dioxide and methane were assumed to have the same relative permeability.

The cleat system of the deep coal formation was modeled as initially saturated with water. Relative permeability data for carbon dioxide and water demonstrate that high water saturation inhibits absorption of carbon dioxide in cleats. Therefore, water is removed from the formation before injecting carbon dioxide into the formation.

In addition, the gases in the cleats may adsorb in the coal matrix. The matrix porosity is a measure of the space available for fluids to adsorb in the matrix. The matrix porosity and surface area were taken into account with experimental mass transfer and isotherm adsorption data for coal and post treatment coal. Therefore, it was not necessary to specify a value of the matrix porosity and surface area in the model. The pressure-volume-temperature (PVT) properties and viscosity required for the model were taken from literature data for the pure component gases.

The preferential adsorption of carbon dioxide over methane on post treatment coal was incorporated into the model based on experimental adsorption data. For example, carbon dioxide may have a significantly higher cumulative adsorption than methane over an entire range of pressures at a specified temperature. Once the carbon dioxide enters in the cleat system, methane diffuses out of and desorbs off the matrix. Similarly, carbon dioxide diffuses into and adsorbs onto the matrix. In addition, carbon dioxide may have a higher cumulative adsorption on a pyrolyzed coal sample than on an unpyrolyzed coal sample.

The simulation modeled a sequestration process over a time period of about 3700 days for the deep coal formation model. Removal of the water in the coal formation was simulated by production from five wells. The production rate of water was about 40 $m^3$/day for about the first 370 days. The production rate of water decreased significantly after the first 370 days. It continued to decrease through the remainder of the simulation run to about zero at the end. Carbon dioxide injection was started at approximately 370 days at a flow rate of about 113,000 standard $m^3$/day (in this context "standard" means 1 atmosphere pressure and 15.5° C.). The injection rate of carbon dioxide was doubled to about 226,000 standard $m^3$/day at approximately 1440 days. The injection rate remained at about 226,000 standard $m^3$/day until the end of the simulation run.

Figure 23:
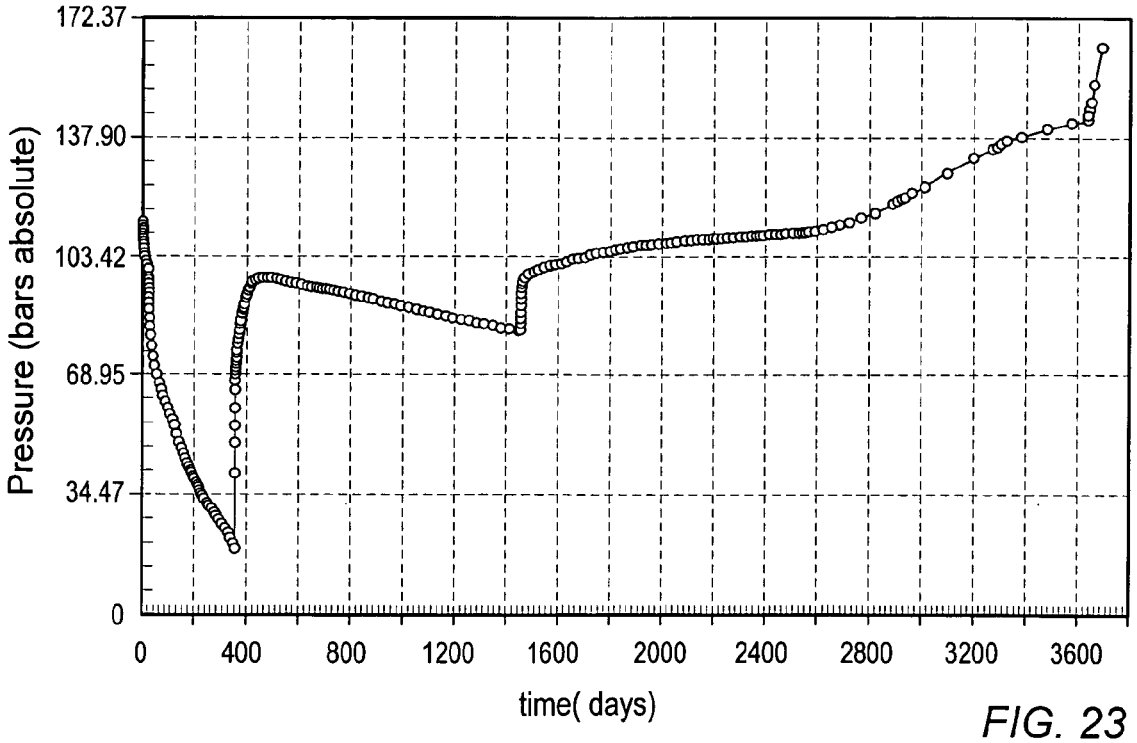
FIG. 23 depicts pressure at a wellhead as a function of time from a numerical simulation.

FIG. 23 illustrates the pressure at the wellhead of the injection wells as a function of time during the simulation. The pressure decreased from about 114 bars absolute to about 19 bars absolute over the first 370 days. The decrease in the pressure was due to removal of water from the coal formation. Pressure started to increase substantially when carbon dioxide injection started at day 370. The pressure reached a maximum of about 98 bars absolute. The pressure began to gradually decrease after day 480. At about day 1440, the pressure increased again to about 98 bars absolute due to an increase in the carbon dioxide injection rate. The pressure gradually increased until about day 3640. The pressure rose significantly at about day 3640 because the production well was closed off.

Figure 24:
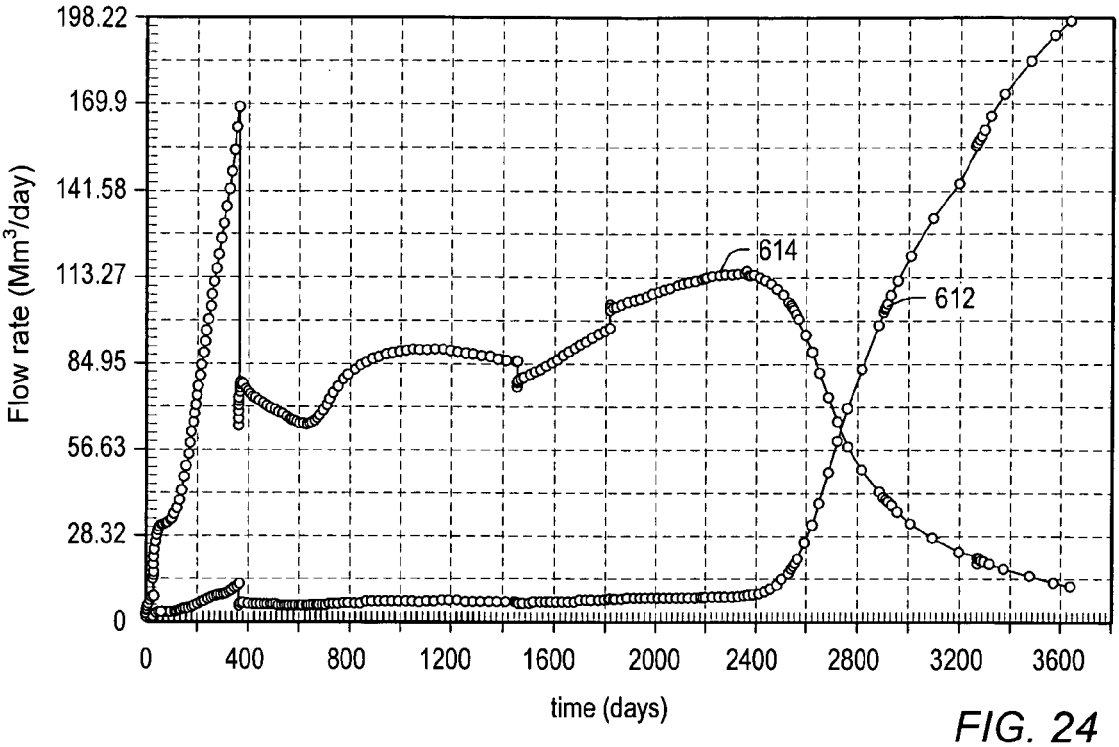
FIG. 24 depicts production rate of carbon dioxide and methane as a function of time from a numerical simulation.

FIG. 24 illustrates the production rate of carbon dioxide 612 and methane 614 as a function of time for the simulation. FIG. 24 shows that carbon dioxide was produced at a rate between about 0-10,000 $m^3$/day during approximately the first 2400 days. The production rate of carbon dioxide was significantly below the injection rate. Therefore, the simulation indicates that most of the injected carbon dioxide was sequestered in the coal formation. However, after about 2400 days, the production rate of carbon dioxide rose significantly due to an onset of saturation of the coal formation.

In addition, FIG. 24 shows that methane was desorbing as carbon dioxide was adsorbing in the coal formation. Between about 370-2400 days, the production rate of methane 614 increased from about 60,000 to about 115,000 standard $m^3$/day. The increase in the methane production rate between about 1440-2400 days was caused by the increase in carbon dioxide injection rate beginning at about day 1440. The production rate of methane started to decrease after about day 2400. This was due to the saturation of the coal formation. The simulation predicted a 50% breakthrough at about day 2700. "Breakthrough" is defined as the ratio of the flow rate of carbon dioxide to the total flow rate of the total produced gas multiplied by 100. The simulation predicted about a 90% breakthrough at about day 3600.

Figure 25:
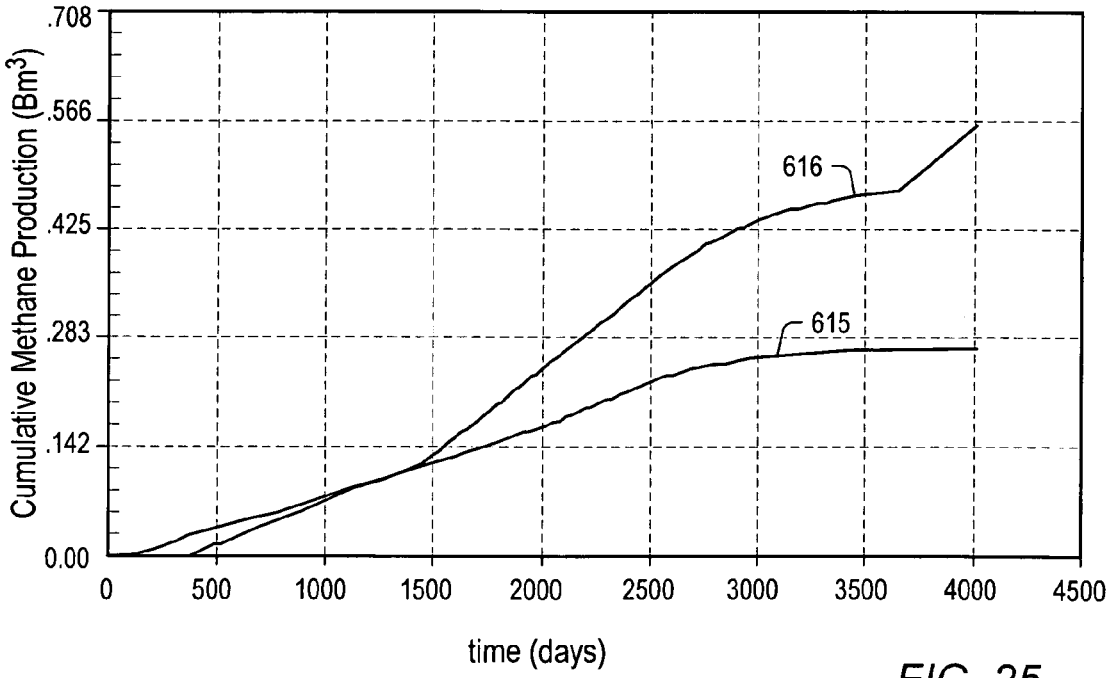
FIG. 25 depicts cumulative methane produced and net carbon dioxide injected as a function of time from a numerical simulation.

FIG. 25 illustrates cumulative methane produced 615 and cumulative net carbon dioxide injected 616 as a function of time during the simulation. The cumulative net carbon dioxide injected is the total carbon dioxide produced subtracted from the total carbon dioxide injected. FIG. 25 shows that by the end of the simulated injection, about twice as much carbon dioxide was stored as methane produced. The methane production was about 0.24 billion standard $m^3$ at 50% carbon dioxide breakthrough. The carbon dioxide sequestration was about 0.39 billion standard $m^3$ at 50% carbon dioxide breakthrough. The methane production was about 0.26 billion standard $m^3$ at 90% carbon dioxide breakthrough. In addition, the carbon dioxide sequestration was about 0.46 billion standard $m^3$ at 90% carbon dioxide breakthrough.

TABLE 10 shows that the permeability and porosity of the simulation in the post treatment coal formation were both significantly higher than in the deep coal formation prior to treatment. In addition, the initial pressure was much lower. The depth of the post treatment coal formation was shallower than the deep coal bed methane formation. The same relative permeability data and PVT data used for the deep coal formation were used for the coal formation simulation. The initial water saturation for the post treatment coal formation was set at 70%. Water was present because it is used to cool the hot spent coal formation to 25° C. The amount of methane initially stored in the post treatment coal is very low.

The simulation modeled a sequestration process over a time period of about 3800 days for the post treatment coal formation model. The simulation modeled removal of water from the post treatment coal formation with production from five wells. During about the first 200 days, the production rate of water was about 680,000 standard $m^3$/day. From about 200-3300 days, the water production rate was between about 210,000 to about 480,000 standard $m^3$/day. Production rate of water was negligible after about 3300 days. Carbon dioxide injection was started at approximately 370 days at a flow rate of about 113,000 standard $m^3$/day. The injection rate of carbon dioxide was increased to about 226,000 standard $m^3$/day at approximately 1440 days. The injection rate remained at 226,000 standard $m^3$/day until the end of the simulated injection.

Figure 26:
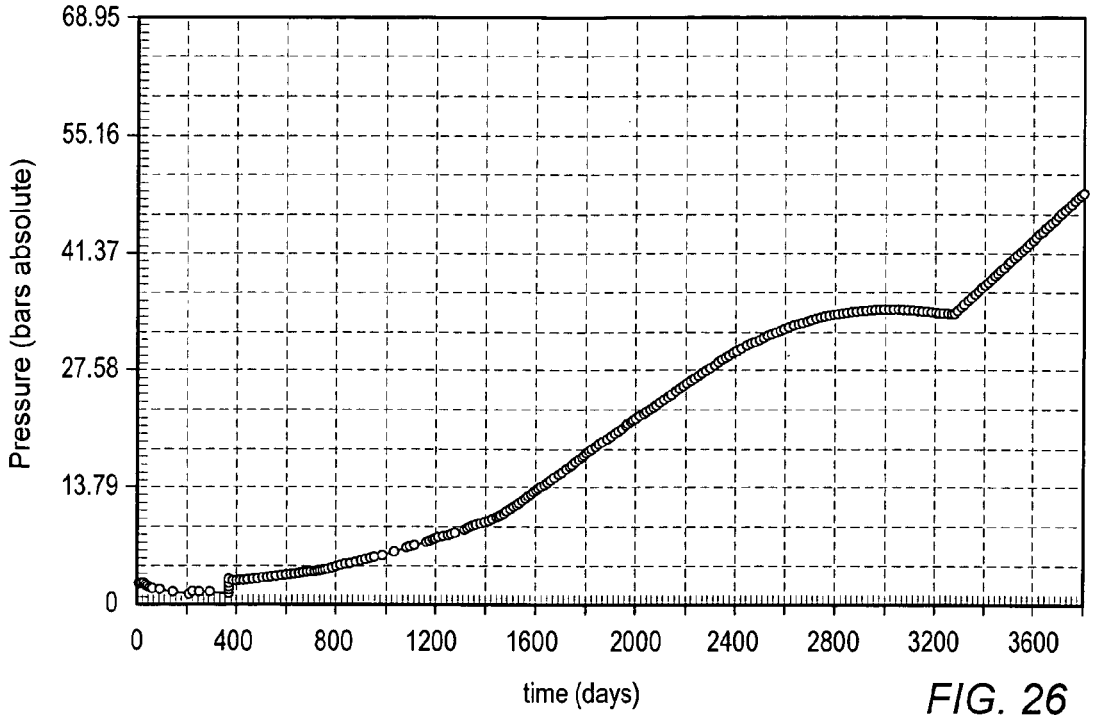
FIG. 26 depicts pressure at wellheads as a function of time from a numerical simulation.

FIG. 26 illustrates the pressure at the wellhead of the injection wells as a function of time during the simulation of the post treatment coal formation model. The pressure was relatively constant up to about day 370. The pressure increased through most of the rest of the simulation run up to about 36 bars absolute. The pressure rose steeply starting at about day 3300 when the production well was closed off.

Figure 27:
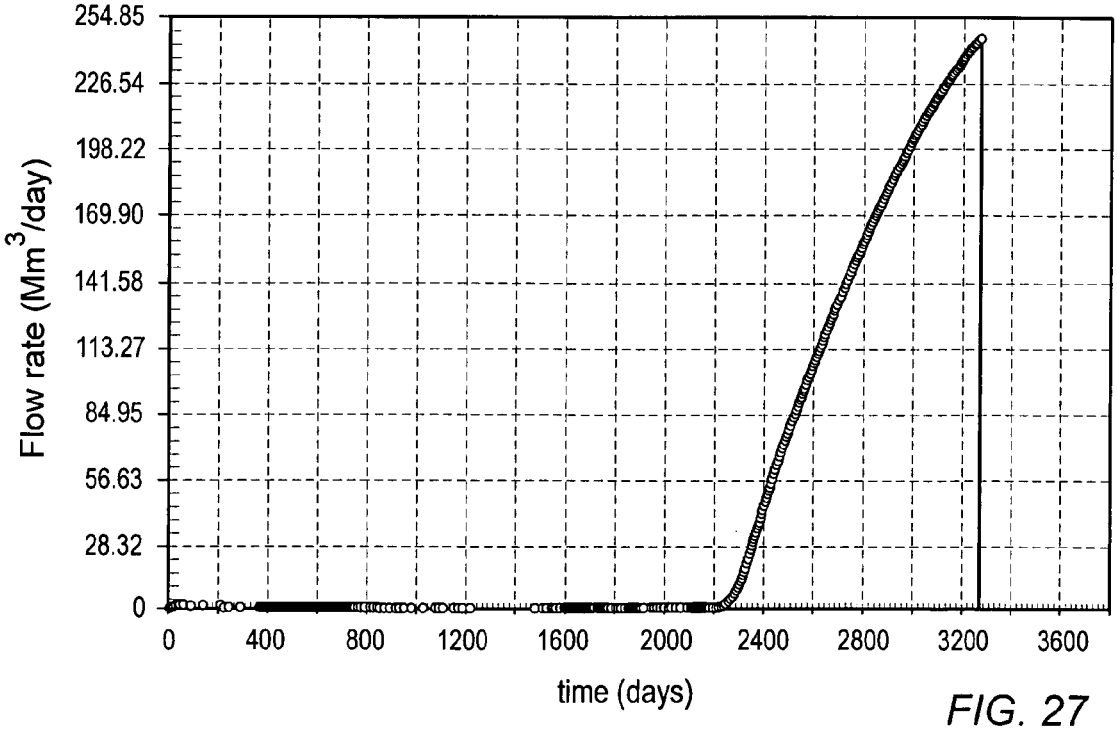
FIG. 27 depicts production rate of carbon dioxide as a function of time from a numerical simulation.

FIG. 27 illustrates the production rate of carbon dioxide as a function of time in the simulation of the post treatment coal formation model. FIG. 27 shows that the production rate of carbon dioxide was almost negligible during approximately the first 2200 days. Therefore, the simulation predicts that nearly all of the injected carbon dioxide is being sequestered in the post treatment coal formation. However, at about day 2240, the produced carbon dioxide began to increase. The production rate of carbon dioxide started to rise significantly due to onset of saturation of the post treatment coal formation.

Figure 28:
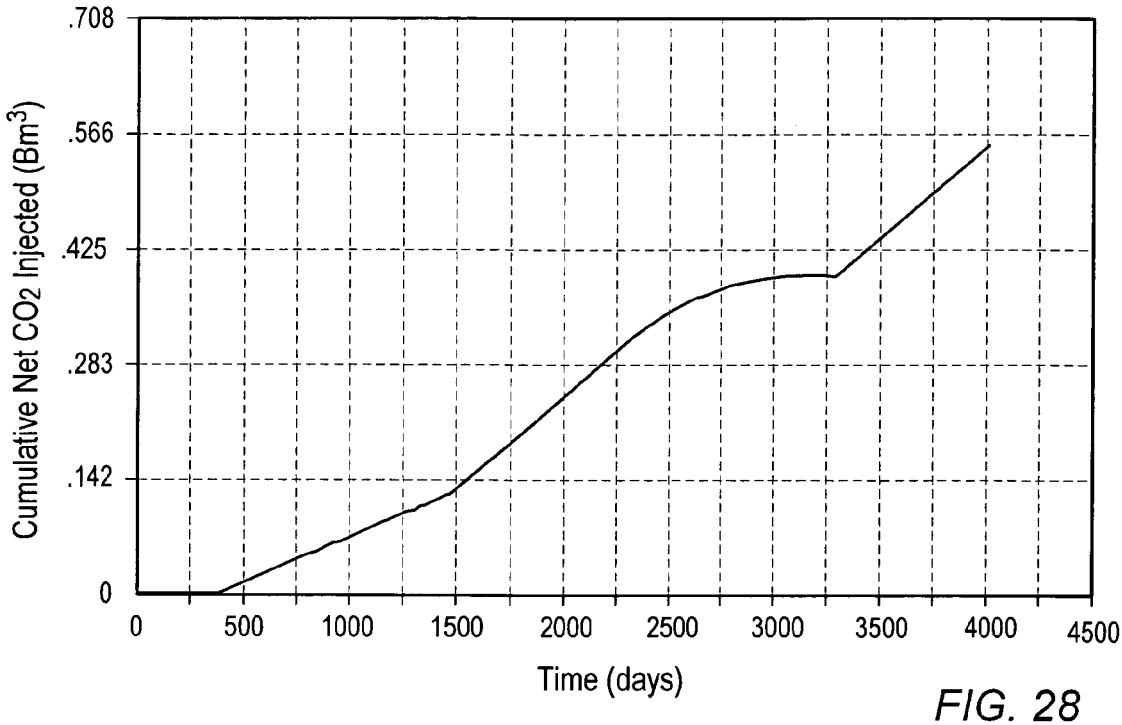
FIG. 28 depicts cumulative net carbon dioxide injected as a function of time from a numerical simulation.

FIG. 28 illustrates cumulative net carbon dioxide injected as a function of time during the simulation in the post treatment coal formation model. The cumulative net carbon dioxide injected is the total carbon dioxide produced subtracted from the total carbon dioxide injected. FIG. 28 shows that the simulation predicts a potential net sequestration of carbon dioxide of 0.56 $Bm^3$. This value is greater than the value of 0.46 $Bm^3$ at 90% carbon dioxide breakthrough in the deep coal formation. However, comparison of FIG. 23 with FIG. 26 shows that sequestration occurs at much lower pressures in the post treatment coal formation model. Therefore, less compression energy was required for sequestration in the post treatment coal formation.

The simulations show that large amounts of carbon dioxide may be sequestered in both deep coal formations and in post treatment coal formations that have been cooled. Carbon dioxide may be sequestered in the post treatment coal formation and/or in coal formations that have not been pyrolyzed.

In some embodiments, carbon dioxide may be sequestered in coal formations that have not undergone in situ treatment processes. In some embodiments, carbon dioxide may be stored in coal formations from which methane has been at least partly extracted and/or displaced. In some embodiments, carbon dioxide may be employed to displace methane in coal formations. In some embodiments, carbon dioxide may be stored in formations that have been subjected to in situ treatment processes. Carbon dioxide at temperatures between 25° C. and 100° C. is more strongly adsorbed in the pyrolyzed coal than methane at 25° C. A carbon dioxide stream passed through post treatment coal tends to displace methane from the post treatment coal.

Although an in situ treatment process is not necessary to prepare a portion of a formation for receiving carbon dioxide, storing carbon dioxide in a formation that has been subjected to an in situ treatment process may offer several advantages. A portion of a formation that has undergone an in situ process may have a higher permeability than a formation that has not been subjected to an in situ process. The high permeability may promote introduction of carbon dioxide into the portion of the formation. The permeability of the portion of the formation may be substantially uniform. The substantially uniform permeability may allow for introduction of carbon dioxide throughout the entire volume of the portion in which the carbon dioxide is to be stored. A portion of a formation that has been subjected to an in situ process may have carbon with little or no material sorbed on the carbon. The available carbon may accept carbon dioxide without the carbon dioxide having to displace or desorb other compounds from the available carbon.

Methane is often used as an energy source. Large deposits of methane exist as methane that is sorbed on coal. Methane sorbed on coal is often referred to as coal bed methane. Producing methane from some coal bed methane resources has been technically unfeasible and/or economically unfeasible. A common problem in producing coal bed methane is managing water during production of the methane. Formations with high water flow rates and/or formations containing large amounts of water (e.g., large aquifers) may make dewatering the formation or a portion of the formation extremely difficult using conventional means (e.g., dewatering wells). In an embodiment, a barrier may be formed to isolate a portion of a formation. The barrier may be a perimeter barrier enclosing the portion of the formation. The barrier may define a volume of the formation referred to as a treatment area.

Formation fluid that includes phenolic compounds may be separated to produce a phenolic compounds stream and a condensate stream. Removing phenolic compounds from formation fluid may reduce a cost of hydrotreating the formation fluid by reducing hydrogen consumption (e.g., hydrogen consumed in the reaction of hydrogen with oxygen to produce water) in hydrotreating units and/or reactors, as well as reducing a volume of fluids being hydrotreated.

In some embodiments, a pattern of injection wells may be formed around a perimeter of a treatment area from which hydrocarbon bed methane is to be produced. Carbon dioxide may be introduced into the formation through the injection wells. The carbon dioxide may swell clays and/or hydrocarbon containing material in the formation adjacent to the injection wells. The swelling may inhibit ingress of water or other formation fluid into the treatment area. The swelling may also inhibit egress of fluid from the treatment area to areas adjacent to the treatment area. Methane may be produced from the treatment area after swelling of clays and/or hydrocarbon material in the formation. The production of methane may include injecting carbon dioxide or other gas into the treatment area to increase the production of methane.

In some embodiments, a formation from which hydrocarbon bed methane has been produced may be subjected to in situ conversion of hydrocarbon material after removal of the methane. During initial heating of the formation, a significant additional quantity of methane may be produced from the formation. In some embodiments, a hydrocarbon formation containing hydrocarbon bed methane may be subjected to an in situ conversion process without first subjecting the formation to a hydrocarbon bed methane removal process.

An in situ conversion process of certain types of formations (e.g., coal formations) may result in the production of significant quantities of phenolic compounds. A phenolic stream may be separated from hydrocarbon fluids produced from the formation. In some embodiments, a phenolic compounds stream may be further separated into various streams by generally known methods (e.g., distillation). For example, a phenolic compounds stream may be separated into a phenol stream, a cresol compounds stream, a xylenol compounds stream, a resorcinol compounds stream and/or any mixture thereof. "Cresol compounds," "xylenol compounds," and/or "resorcinol compounds," as used herein, refer to more than one isomeric structure of the phenolic compound. For example, cresol compounds may include ortho-cresol, para-cresol, meta-cresol or mixtures thereof. For example, xylenol compounds may include ortho-xylenol, meta-xylenol, para-xylenol or mixtures thereof. For example, resorcinol compounds may include 5-methylresorcinol, 2,5-dimethylresorcinol, 4,5-dimethylrescorcinol, and/or mixtures thereof. Phenolic compounds isolated from a formation fluid may be used in a variety of commercial applications. For example, phenolic compounds may be used in the manufacture of UV light stabilizers, color stabilizers, alkyl phenol resins, rubber softeners, bitumen mastics, wood impregnation materials, biocides, wood treating compounds, flame retardant additives, epoxy resins, tire resins, agricultural chemical additives, antioxidants, dyes, explosive primers, and polyurethane chain extenders.

In certain in situ conversion process embodiments, fluid produced from a formation (e.g., from oil shale) may include nitrogen-containing compounds. Formation fluid produced from the formation may contain less than 5 wt % nitrogen-containing compounds (when calculated on an elemental basis). In some embodiments, less than 3 wt % of a produced formation fluid may be nitrogen-containing compounds. In other embodiments, less than 1 wt % of the produced formation fluid may be nitrogen-containing compounds. Nitrogen-containing compounds may include, but are not limited to, substituted and unsubstituted cyclic nitrogen-containing compounds. Examples of substituted nitrogen-containing compounds include alkyl-substituted pyridines, alkyl-substituted quinolines, and/or alkyl-substituted indoles. Examples of unsubstituted nitrogen-containing compounds include pyridines, picolines, quinolines, acridines, pyrroles, and/or indoles. In some instances, certain nitrogen-containing compounds (e.g., pyridines, picolines, quinolines, acridines) may be valuable and therefore justify separation of the nitrogen-containing compounds from the produced formation fluid.

In certain embodiments, separation of the nitrogen-containing compounds from the produced formation fluid may produce extract oil that is rich in nitrogen-containing compounds and a raffinate that is rich in hydrocarbons. The hydrocarbons may be further processed to provide hydrocarbon compounds with economic value (e.g., ethylene, propylene, jet fuel, diesel fuel, and/or naphtha). Extract oil may include substituted and unsubstituted nitrogen-containing compounds. Conversion of substituted nitrogen-containing compounds in extract oil to unsubstituted nitrogen-containing compounds may increase the economic value of the extract oil. For example, alkyl substituted nitrogen-containing compounds may be dealkylated to form unsubstituted nitrogen-containing compounds. Alkyl substituted nitrogen-containing compounds (e.g., multi-ring compounds) may be oxidized to produce single-ring nitrogen-containing compounds. Alkyl substituted nitrogen-containing compounds may undergo dealkylation followed by oxidation to produce unsubstituted nitrogen-containing compounds. The ability to further process the nitrogen-containing compounds in formation fluid and/or extract oil may increase the economic value of the formation fluid and/or extract oil. Separated nitrogen-containing compounds may be utilized as corrosion inhibitors, as asphalt extenders, as solvents, as biocides, and/or in the production of resins, rubber accelerators, insecticides, water-proofing agents, and/or pharmaceuticals.

Figure 29:
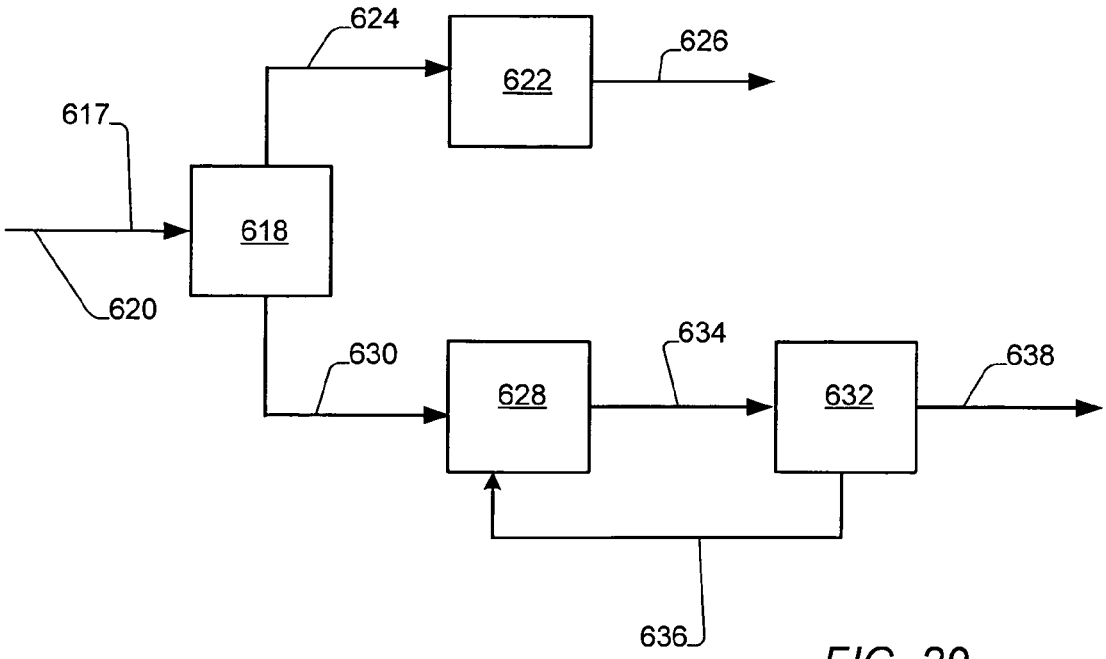
FIG. 29 depicts surface treatment units used to separate nitrogen-containing compounds from formation fluid.

In some embodiments, formation fluid may be provided to a nitrogen recovery unit directly after production from a formation. FIG. 29 depicts surface treatment units used to separate nitrogen-containing compounds from formation fluid. Formation fluid may include hydrocarbons of an average carbon number less than 30 and nitrogen-containing compounds. In certain embodiments, formation fluid may include hydrocarbons of an average carbon number less than 20 and nitrogen-containing compounds. Formation fluid 617 may enter nitrogen recovery unit 618 via conduit 620. Nitrogen recovery unit 618 may include, but is not limited to, extraction units, distillation units, dealkylation units, oxidation units and/or combinations thereof.

In certain embodiments, at least a portion of the formation fluid may be acid washed with an organic and/or an inorganic acid in nitrogen recovery unit 618 to produce at least two streams. The streams may be a raffinate stream and an extract oil stream. Organic acids used for acid washing may include, but are not limited to, formic acid, acetic acid, 1-methyl-2-pyrrolidinone, and/or halogen substituted organic acids (e.g., trifluoroacetic acid, trichloroacetic acid). Inorganic acids used for acid washing may include, but are not limited to, hydrochloric acid, sulfuric acid, or phosphoric acid. In some embodiments, sulfuric acid used in an extraction process may be produced from hydrogen sulfide gas produced during an in situ thermal conversion process of a hydrocarbon containing formation. Contact of acid with at least a portion of the formation fluid may be performed using agitation, cocurrent flow, crosscurrent flow, countercurrent flow, and/or any combination thereof. A contact temperature of the formation fluid with the acid may be maintained in a range from about 25° C. to about 50° C.

In some embodiments, a raffinate stream may enter purification unit 622 via conduit 624. A nitrogen concentration in the raffinate stream may be less than 5000 ppm by weight. In some embodiments, a nitrogen concentration in the raffinate stream may be less than 1000 ppm by weight. A raffinate stream may include hydrocarbons of a carbon number of less than 30. In some embodiments, a raffinate stream may include hydrocarbons of a carbon number less than 20. Methods of purification of a raffinate stream may include steam cracking, distillation, absorption, deabsorption, hydrotreating, and/or combinations thereof. Steam cracking of a raffinate stream may produce a hydrocarbon product stream. The hydrocarbon product stream may include hydrocarbons of an average carbon number ranging from 2 to 10. In some embodiments, an average carbon number of the components in a hydrocarbon product stream may range from 2 to 4 (e.g., ethylene, propylene, butylene). Low carbon number hydrocarbons (e.g., carbon number less than 4) may have increased economic value. The hydrocarbon product stream may exit purification unit 622 via conduit 626 and be transported to storage units, sold commercially, and/or transported to other processing units.

In certain embodiments, an extract oil stream may include nitrogen-containing compounds and spent inorganic acid. Neutralization of the spent inorganic acid in the extract oil stream may be performed by contacting the extract oil stream with a base (e.g., $NaHCO_3$). In some embodiments, a source of a neutralization base may be nahcolite produced from hot water recovery of nahcolite that is near oil shale formations. At least a portion of the neutralized extract oil stream may be separated into a nitrogen rich stream and a spent water stream.

In some embodiments, an extract oil stream may include nitrogen-containing compounds and spent organic acid. At least a portion of the extract oil may be separated into a nitrogen rich stream and a spent organic acid stream using generally known methods (e.g., distillation). In some embodiments, at least a portion of an organic acid stream separated from the extract oil stream may be recycled to a nitrogen recovery unit.

In some embodiments, at least a portion of the nitrogen rich stream may be sent directly to various processing units (e.g., distillation units, dealkylation units, and/or oxidation units). For example, a nitrogen rich stream may be sent to a distillation unit. In a distillation unit, pyridine, picolines, and/or other low molecular weight nitrogen-containing compounds may be separated from the nitrogen rich stream. In another example, a nitrogen rich stream may be sent directly to an oxidation unit. In the oxidation unit, nitrogen-containing compounds may be oxidized to produce carboxylated pyridine derivatives.

In certain embodiments, a nitrogen rich stream may include substituted nitrogen-containing compounds (e.g., alkyl-substituted pyridines, alkyl-substituted quinolines, alkyl-substituted acridines). Dealkylation of the alkyl-substituted nitrogen-containing compounds to unsubstituted nitrogen-containing compounds (e.g., pyridine, quinoline, and/or acridine) may increase the economic value of extract oil. A nitrogen rich stream may exit nitrogen recovery unit 618 and enter dealkylation unit 628 via conduit 630. In dealkylation unit 628, at least a portion of substituted nitrogen-containing compounds in the nitrogen rich stream may be dealkylated to produce unsubstituted nitrogen-containing compounds. Dealkylation of substituted nitrogen-containing compounds in dealkylation unit 628 may be performed under a variety of conditions (e.g., catalytic dealkylation, thermal dealkylation, or base catalyzed dealkylation) to produce a crude product stream. In some embodiments, dealkylation of substituted nitrogen-containing compounds may be performed in the presence of molecular hydrogen. Dealkylation in the presence of molecular hydrogen may be referred to as "hydrodealkylation." In certain embodiments, substituted nitrogen-containing compounds may be dealkylated in the presence of molecular hydrogen and steam. Dealkylation in the presence of steam and hydrogen may be referred to as "steam hydrodealkylation." In some embodiments, a source of hydrogen for dealkylation of substituted nitrogen-containing compounds may be hydrogen gas produced from an in situ thermal conversion process. In other embodiments, hydrogen may be obtained from other processing units (e.g., a reformer unit, an olefin cracker unit, etc.).

Any catalyst suitable for hydro-dealkylation and/or steam hydro-dealkylation of substituted nitrogen-containing compounds may be used in dealkylation unit 628. Metals incorporated in a dealkylation catalyst may be metals that promote dealkylation of substituted nitrogen-containing compounds without adsorbing the nitrogen-containing compounds. The metals incorporated in a dealkylation catalyst may be resistant to hydrogen sulfide. The metals may include metals of a zero oxidation state and/or higher oxidation states (e.g., metal oxides). Dealkylation catalysts may include metals from Group VIB, Group VIII, or Group IB of the Periodic Table. Examples of Group VIB metals include chromium, magnesium, molybdenum, and tungsten. Examples of Group VIII metals include cobalt and nickel. An example of a group IB metal is copper. An example of a metal oxide is nickel oxide. Metals may be incorporated in a non-acidic zeolite type matrix and/or in any suitable binder material.

A dealkylation catalyst may be contacted with a nitrogen rich extract stream in dealkylation unit 628 in the presence of hydrogen under a variety of conditions to produce a crude product stream. Dealkylation temperatures may range from about 225° C. to about 600° C. In some embodiments, dealkylation temperatures may range from about 500° C. to about 550° C. Dealkylation unit 628 may be operated at total pressures less than 100 psig.

A crude product stream produced in dealkylation unit 628 may include unsubstituted nitrogen-containing compounds and unreacted components. Isolation of the unsubstituted nitrogen-containing compounds from the crude product stream may be performed using generally known methods (e.g., distillation). For example, distillation of a crude product stream may produce two product streams, a pyridine stream and a quinoline product stream. The crude product stream may exit dealkylation unit 628 and enter purification unit 632 via conduit 634. Purification of the crude product stream may produce at least one or more streams including an unsubstituted single-ring nitrogen-containing compounds stream (e.g., pyridines), an unsubstituted multi-ring nitrogen-containing compounds stream (e.g., quinolines and/or acridines), and an unreacted components stream. In some embodiments, an unreacted components stream may be recycled to dealkylation unit 628 via conduit 636. Substituted and unsubstituted nitrogen-containing compounds may exit purification unit 632 via conduit 638 and be transported to storage units, sold commercially, and/or sent to other processing units.

In certain embodiments, an unsubstituted multi-ring nitrogen-containing compounds stream may be sent to other processing units (e.g., an oxidation unit) for further processing. For example, oxidation of quinoline may result in ring opening of the non-nitrogen-containing ring to form carboxylated pyridine (e.g., niacin). Subsequent decarboxylation of the carboxylated pyridine may be performed to produce pyridine. In other embodiments, carboxylated pyridine may be sold commercially and/or processed further to make commercially viable products. For example, niacin may be reacted with ammonia to produce niacinamide, a commercially available vitamin supplement. In certain embodiments, ammonia used in production of niacinamide may be produced from an in situ thermal conversion process.

In certain embodiments, an in situ thermal conversion process in a hydrocarbon containing formation may be controlled to increase production of nitrogen-containing compounds containing alkyl branches of a minimum size and/or with a minimum number of alkyl substituents. Minimizing the size of an alkyl branch and/or a number of alkyl substituents in nitrogen-containing compounds may reduce a cost of processing of the nitrogen-containing compounds and/or increase the value of the produced fluid.

In some embodiments, a hydrocarbon containing formation (e.g., an oil shale matrix) may contain sites that are basic in nature. The basic sites may promote (catalyze) dealkylation of nitrogen-containing compounds. For example, in a section of a formation at or above pyrolysis temperatures, hydrogen and steam may be present as pyrolysis byproducts in the formation. As formation fluids contact an oil shale matrix in the presence of the hydrogen and the steam, substituted nitrogen-containing compounds in the formation fluid may be dealkylated to produce unsubstituted nitrogen-containing compounds (e.g., pyridines, quinolines, and/or acridines). The resulting formation fluid that includes unsubstituted nitrogen-containing compounds may be produced from the formation and sent to recovery units.

In an embodiment, a method for treating a hydrocarbon containing formation in situ that contains nitrogen-containing compounds in situ may include providing a dealkylation catalyst to a section of the formation under certain conditions. For example, the dealkylation catalyst may be added through a heater well or production well located in or proximate a section of the formation at pyrolysis temperatures. Hydrogen and steam may be present as pyrolysis byproducts in a section of the formation. As formation fluid contacts the dealkylation catalyst in the presence of hydrogen and steam, dealkylation of substituted nitrogen-containing compounds in the formation fluid may occur to produce formation fluid with an increased concentration of unsubstituted nitrogen-containing compounds. The resulting formation fluid containing unsubstituted nitrogen-containing compounds may be produced from the formation and sent to recovery units.

Rotating magnet ranging may be used to monitor the distance between wellbores. Vector Magnetics LLC (Ithaca, N.Y.) uses one example of a rotating magnet ranging system. In rotating magnet ranging, a magnet rotates with a drill bit in one wellbore to generate a magnetic field. A magnetometer in another wellbore is used to sense the magnetic field produced by the rotating magnet. Data from the magnetometer can be used to measure the coordinates (x, y, and z) of the drill bit in relation to the magnetometer.

In some embodiments, magnetostatic steering may be used to form openings adjacent to a first opening. U.S. Pat. No. 5,541,517 issued to Hartmann et al. describes a method for drilling a wellbore relative to a second wellbore that has magnetized casing portions.

When drilling a wellbore, a magnet or magnets may be inserted into a first opening to provide a magnetic field used to guide a drilling mechanism that forms an adjacent opening or adjacent openings. The magnetic field may be detected by a 3-axis fluxgate magnetometer in the opening being drilled. A control system may use information detected by the magnetometer to determine and implement operation parameters needed to form an opening that is a selected distance away (e.g., parallel) from the first opening (within desired tolerances).

Various types of wellbores may be formed using magnetic tracking. For example, wellbores formed by magnetic tracking may be used for in situ conversion processes (i.e., heat source wellbores, production wellbores, injection wellbores, etc.) for steam assisted gravity drainage processes, the formation of perimeter barriers or frozen barriers (i.e., barrier wells or freeze wells), and/or for soil remediation processes. Magnetic tracking may be used to form wellbores for processes that require relatively small tolerances or variations in distances between adjacent wellbores. For example, freeze wells may need to be positioned parallel to each other with relatively little or no variance in parallel alignment to allow for formation of a continuous frozen barrier around a treatment area. In addition, vertical and/or horizontally positioned heater wells and/or production wells may need to be positioned parallel to each other with relatively little or no variance in parallel alignment to allow for substantially uniform heating and/or production from a treatment area in a formation. In an embodiment, a magnetic string may be placed in a vertical well (e.g., a vertical observation well). The magnetic string in the vertical well may be used to guide the drilling of a horizontal well such that the horizontal well passes the vertical well at a selected distance relative to the vertical well and/or at a selected depth in the formation.

In an embodiment, analytical equations may be used to determine the spacing between adjacent wellbores using measurements of magnetic field strengths. The magnetic field from a first wellbore may be measured by a magnetometer in a second wellbore. Analysis of the magnetic field strengths using derivations of analytical equations may determine the coordinates of the second wellbore relative to the first wellbore.

North and south poles may be placed along the z axis with a north pole placed at the origin and north and south poles placed alternately at constant separation L/2 out to $z=\pm\infty$, where z is the location along the z axis and L is the distance between consecutive north and consecutive south poles. Let all the poles be of equal strength P. The magnetic potential at position (r,z) is given by:

$$\Phi(r, z) = \frac{P}{4\pi}\sum_{n=-\infty}^{\infty}(-1)^n\{r^2 + (z - nL/2)^2\}^{-1/2}. \tag{3}$$

The radial and axial components of the magnetic field are given by:

$$B_r = -\frac{\partial\Phi}{\partial r} \tag{4}$$

and $$B_z = -\frac{\partial\Phi}{\partial z}. \tag{5}$$

EQN. 3 can be written in the form:

$$\Phi(r, z) = \frac{P}{2\pi L}f(2r/L, 2z/L) \tag{6}$$

with $$f(\alpha, \beta) = \sum_{n=-\infty}^{\infty}(-1)^n\{\alpha^2 + (\beta - n)^2\}^{-1/2}. \tag{7}$$

For values of $\alpha$ and $\beta$ in the ranges $\alpha\epsilon[0,\infty]$, $\beta\epsilon[-\infty,\infty]$, replacing n by −n in EQN. 7 yields the result:

$$f(\alpha,-\beta)=f(\alpha,\beta). \tag{8}$$

Therefore only positive $\beta$ may be used to evaluate f accurately. Furthermore:

$$f(\alpha,m+\beta)=(-1)^m f(\alpha,\beta), m=0, \pm1, \ldots \tag{9}$$

and $$f(\alpha,1-\beta)=-f(\alpha,\beta). \tag{10}$$

EQNS. 9 and 10 suggest the limit of $\beta\epsilon[0,½]$. The summation on the right-hand side of EQN. 7 converges to a finite answer for all $\alpha$ and $\beta$ except when $\alpha=0$ and $\beta$ is an integer. However, unless $\alpha$ is small, it converges too slowly for practical use in evaluating $f(\alpha,\beta)$. Thus, $\alpha$ is transformed to obtain a much more rapidly convergent expression. The transformation:

$$\{\alpha^2 + (\beta - n)^2\}^{-1/2} = \frac{2}{\pi}\int_0^{\infty} dk\{k^2 + \alpha^2 + (\beta - n)^2\}^{-1}, \tag{11}$$

can be used.

Substituting EQN. 11 into EQN. 10 and interchanging the summation and integration results in:

$$f(\alpha, \beta) = \int_0^{\infty} dk g(k, \alpha, \beta), \tag{12}$$

with $$g(k, \alpha, \beta) = \sum_{n=-\infty}^{\infty}(-1)^n\{k^2 + \alpha^2 + (\beta - n)^2\}^{-1}. \tag{13}$$

Further, it can be shown that g can be expressed in terms of hyperbolic and trigonometric functions. A simple special case is:

$$\begin{aligned} g(k, \alpha, 0) &= \sum_{n=-\infty}^{\infty}(-1)^n\{k^2 + \alpha^2 + n^2\}^{-1} \\ &= \frac{\pi}{\sqrt{k^2 + \alpha^2}\,\sinh\left(\pi\sqrt{k^2 + \alpha^2}\right)}. \end{aligned} \tag{14}$$

Substituting EQN. 14 into EQN. 12, making the change of variable $k=\alpha u$, expanding out the sin h function, and using the fact that:

$$\begin{aligned} K_0(z) &= \int_0^{\infty} dt \exp(-z\cosh t) \\ &= \int_0^{\infty} du(1 + u^2)^{-1/2}\exp\left\{-z(1 + u^2)^{1/2}\right\}, \end{aligned} \tag{15}$$

results in:

$$f(\alpha, 0) = 4\sum_{m=0}^{\infty} K_0\{(2m + 1)\pi\alpha\}. \tag{16}$$

To treat the general case, let:

$$\gamma^2=k^2+\alpha^2 \tag{17}$$

and use the identity:

$$\sum_{n=-\infty}^{\infty}(-1)^n\{\gamma^2+(\beta-n)^2\}^{-1}=\frac{1}{2\gamma}\sum_{n=-\infty}^{\infty}(-1)^n\left\{\frac{\gamma+i\beta}{n^2+(\gamma+i\beta)^2}+\frac{\gamma-i\beta}{n^2+(\gamma-i\beta)^2}\right\}. \tag{18}$$

EQN. 14 therefore may be generalized to:

$$g(k,\alpha,\beta)=\frac{\pi}{2\gamma}\left\{\frac{1}{\sinh\{\pi(\gamma+i\beta)\}}+\frac{1}{\sinh\{\pi(\gamma-i\beta)\}}\right\}, \tag{19}$$

and expanding out the hyperbolic sines as before results in:

$$f(\alpha,\beta)=4\sum_{m=0}^{\infty}K_0\{(2m+1)\pi\alpha\}\cos\{(2m+1)\pi\beta\}. \tag{20}$$

Substituting EQN. 20 back into EQN. 6 then yields:

$$\Phi(r,z)=\frac{2P}{\pi L}\sum_{m=0}^{\infty}K_0\{(2m+1)2\pi r/L\}\cos\{(2m+1)2\pi z/L\}. \tag{21}$$

The differentiations in EQNS. 4 and 5 may then be performed to give the following expressions for the field components:

$$B_r=\frac{4P}{L^2}\sum_{m=0}^{\infty}(2m+1)K_1\{(2m+1)2\pi r/L\}\cos\{(2m+1)2\pi z/L\} \tag{22}$$

and $$B_z=\frac{4P}{L^2}\sum_{m=0}^{\infty}(2m+1)K_0\{(2m+1)2\pi r/L\}\sin\{(2m+1)2\pi z/L\}. \tag{23}$$

For large arguments, the analytical functions have the following asymptotic form:

$$K_0(z),K_1(z)\sim\sqrt{\frac{\pi}{2z}}\exp(-z). \tag{24}$$

For sufficiently large r, then, EQNS. 22 and 23 may be approximated by:

$$B_r\sim\frac{2P}{L^2}\sqrt{\frac{L}{r}}\exp(-2\pi r/L)\cos(2\pi z/L) \tag{25}$$

and $$B_z\sim\frac{2P}{L^2}\sqrt{\frac{L}{r}}\exp(-2\pi r/L)\sin(2\pi z/L). \tag{26}$$

Figure 30:
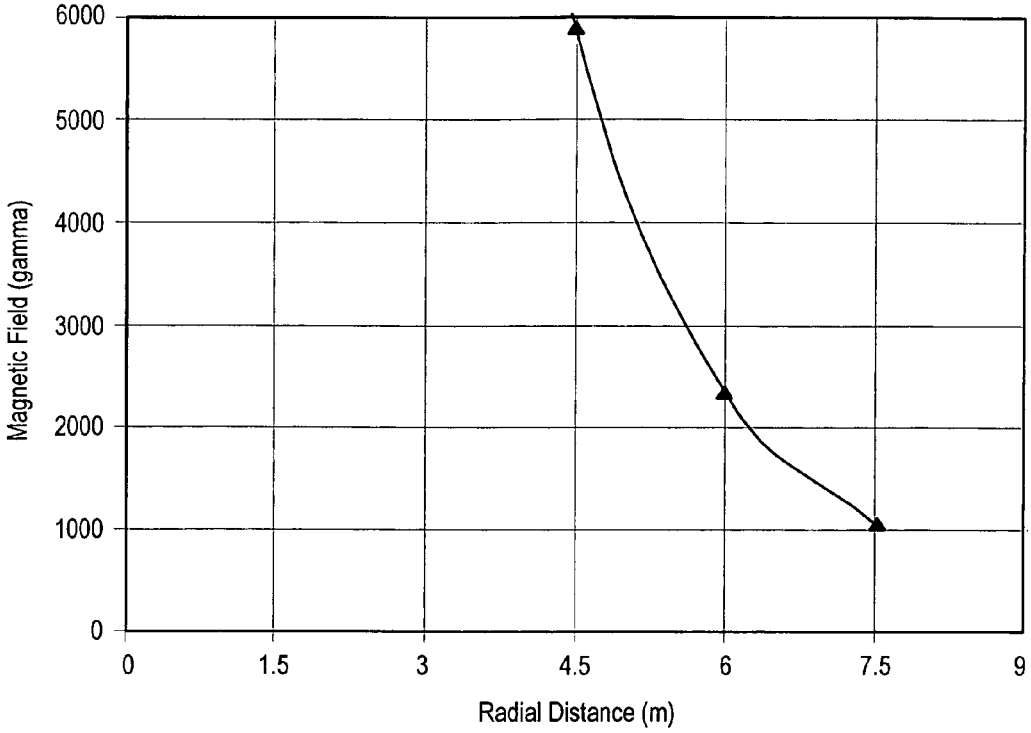
FIG. 30 depicts magnetic field strength versus radial distance using analytical calculations.

Thus, the magnetic field strengths $B_r$ and $B_z$ may be used to estimate the position of the second wellbore relative to the first wellbore by solving EQNS. 25 and 26 for r and z. FIG. 30 depicts magnetic field strength versus radial distance calculated using the above analytical equations. As shown in FIG. 30, the magnetic field strength drops off exponentially as the radial distance from the magnetic field source increases. The exponential functionality of magnetic field strengths, $B_r$ and $B_z$, with respect to r enables more accurate determinations of radial distances. Such improved accuracy may be a significant advantage when attempting to drill wellbores with substantially uniform spacings.

The magnets may be moved (e.g., by moving a magnetic string) with the magnetometer sensors stationary and multiple measurements may be taken to remove fixed magnetic fields (e.g., Earth's magnetic field, other wells, other equipment, etc.) from affecting the measurement of the relative position of the wellbores. In an embodiment, two or more measurements may be used to eliminate the effects of fixed magnetic fields such as the Earth's magnetic field and the fields from other casings. A first measurement may be taken at a first location. A second measurement may be taken at a second location L/4 from the first location. A third measurement may be taken at a third location L/2 from the first location. Because of sinusoidal variations along the z-axis, measurements at L/2 apart may be about 180° out of phase. At least two of the measurements (e.g., the first and third measurements) may be vectorially subtracted and divided by two to remove/reduce fixed magnetic field effects. Specifically, when this subtraction is done, the components attributable to fixed magnetic field effects, being constant, are removed. At the same time, the 180° out of phase components attributable to the magnets, being equal in strength but differing in sign, will add together when the subtraction is performed. Therefore the 180° out of phase components, after being subtracted from each other, are divided by two. Removing or reducing fixed magnetic field effects is a significant advantage in that it improves system accuracy.

At least two of the measurements may be used to determine the Earth's magnetic field strength, BE. The Earth's magnetic field strength along with measurements of inclination and azimuthal angle may be used to give a "normal" directional survey. Use of all three measurements may determine the azimuthal angle between the wellbores, the radial distance between wellbores, and the initial distance along the z-axis of the first measurement location.

Figure 31:
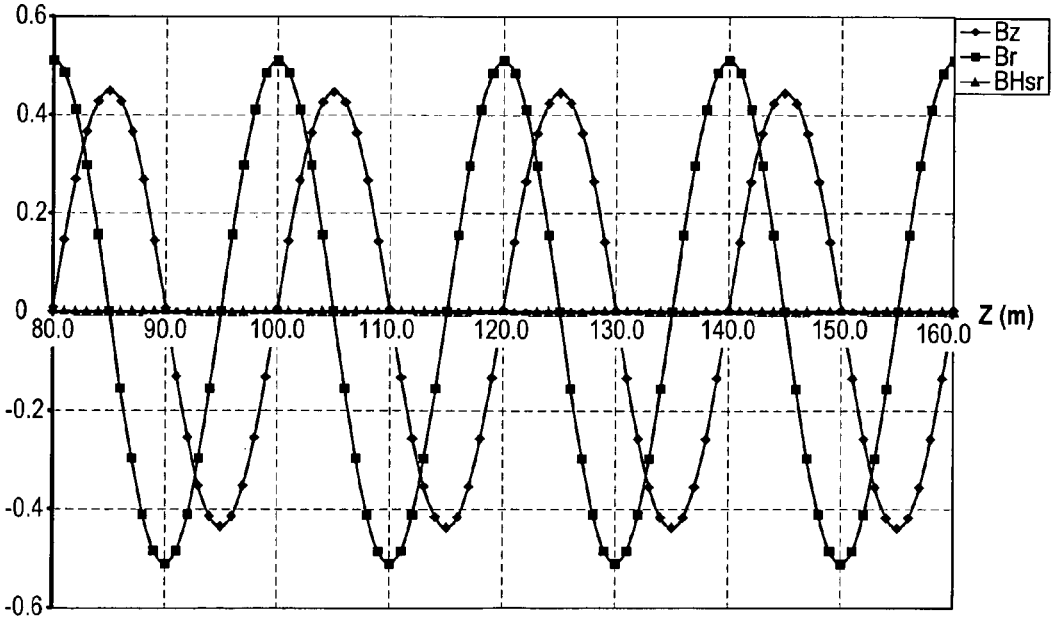
FIGS. 31, 32, and 33 show magnetic field components as a function of hole depth in neighboring observation wells.
Figure 32:
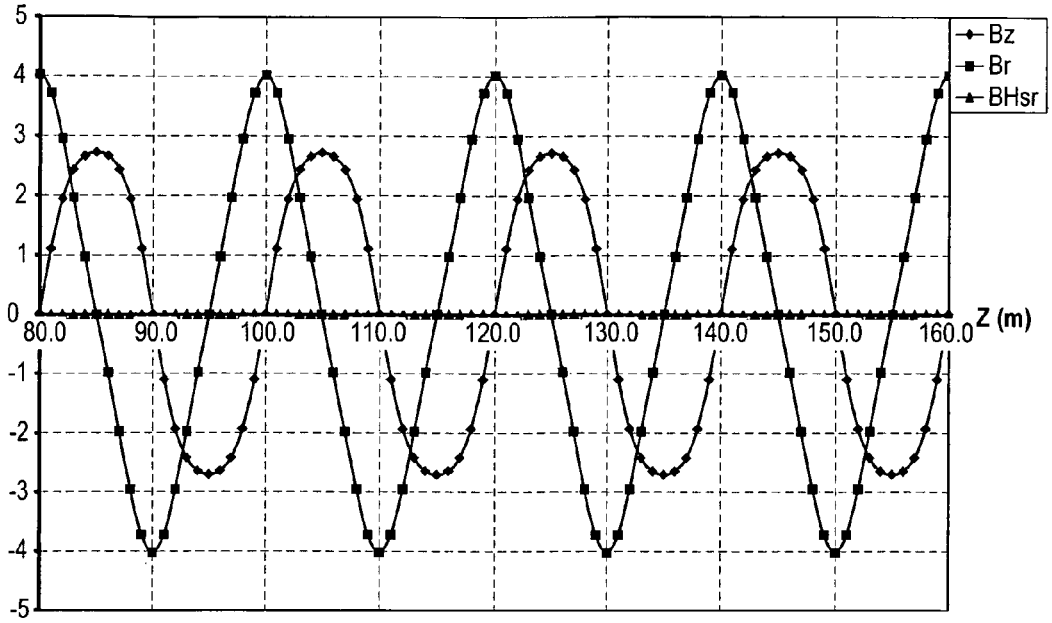
Figure 33:
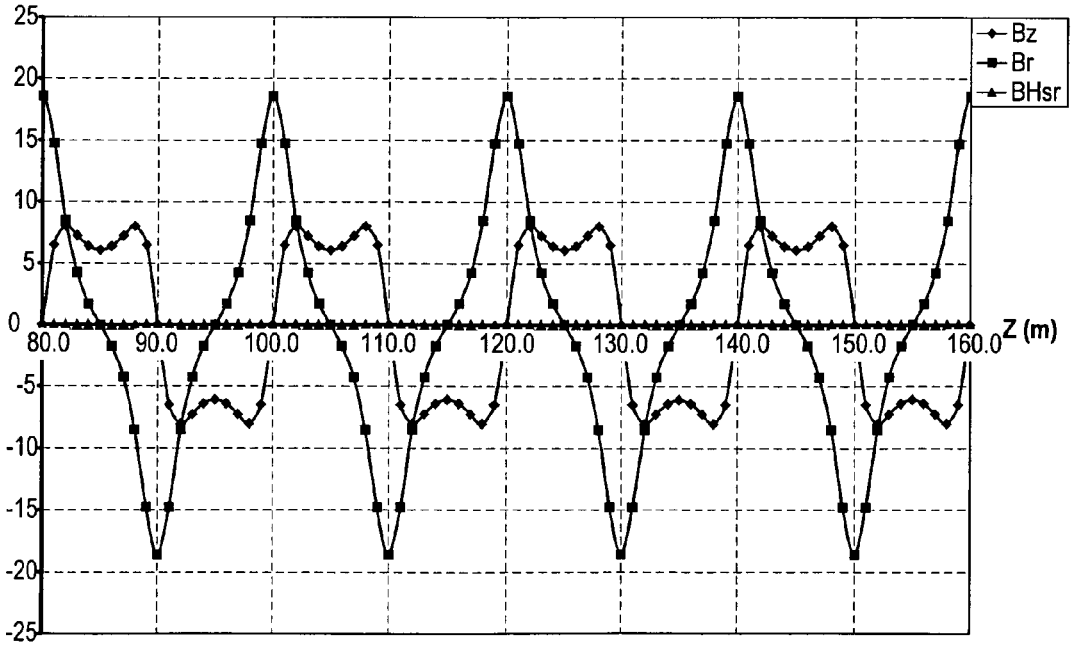

Simulations may be used to show the effects of spacing, L, on the magnetic field components produced from a wellbore with magnets and measured in a neighboring wellbore. FIGS. 31, 32, and 33 show the magnetic field components as a function of hole depth of neighboring observation wellbores. $B_z$ is the magnetic field component parallel to the lengths of the wellbores, $B_r$ is the magnetic field component in a perpendicular direction between the wellbores, and $B_{Hsr}$ is the angular magnetic field component between the wellbores. In FIGS. 31, 32, and 33, $B_{Hsr}$ is zero because there was no angular offset between the two wellbores. FIG. 31 shows the magnetic field components with a horizontal wellbore at 100 m depth and a neighboring observation wellbore at 90 m depth (i.e., 10 m wellbore spacing). The poles had a magnetic field strength of 1500 Gauss with a spacing, L, between the poles of 10 m. The poles were placed from 0 meters to 250 m along the wellbore with a positive pole at 80 m. FIG. 32 shows the magnetic field components with a horizontal wellbore at 100 m depth and a neighboring observation wellbore at 95 m depth (i.e., 5 m wellbore spacing). The $B_z$ component begins to flatten as the wellbore spacing decreases. FIG. 33 shows the magnetic field components with a horizontal wellbore at 100 m depth and a neighboring observation wellbore at 97.5 m depth (i.e., 2.5 m wellbore spacing). The $B_z$ component deviates more from the $B_r$ component as the spacing between wellbores is further decreased. FIGS. 31, 32, and 33 show that to be able to use the analytical solution to monitor the magnetic field components, the spacing between poles, L, should typically be less than or about equal to the spacing between wellbores.

Further simulations determined the effect of build-up on the magnetic components (with a maximum turning of the wellbore of about 10° for every 30 m). Two wellbores both followed each other at a constant distance. The wellbore with the magnets started at a set depth and magnet location, and built angle (no turning) as the wellbore was formed. The observation wellbore started at a depth 10 m from the wellbore with the magnets and offset 2 m from the magnet location, and also built angle but at a slightly faster rate to keep the separation distance about equal.

Figure 34:
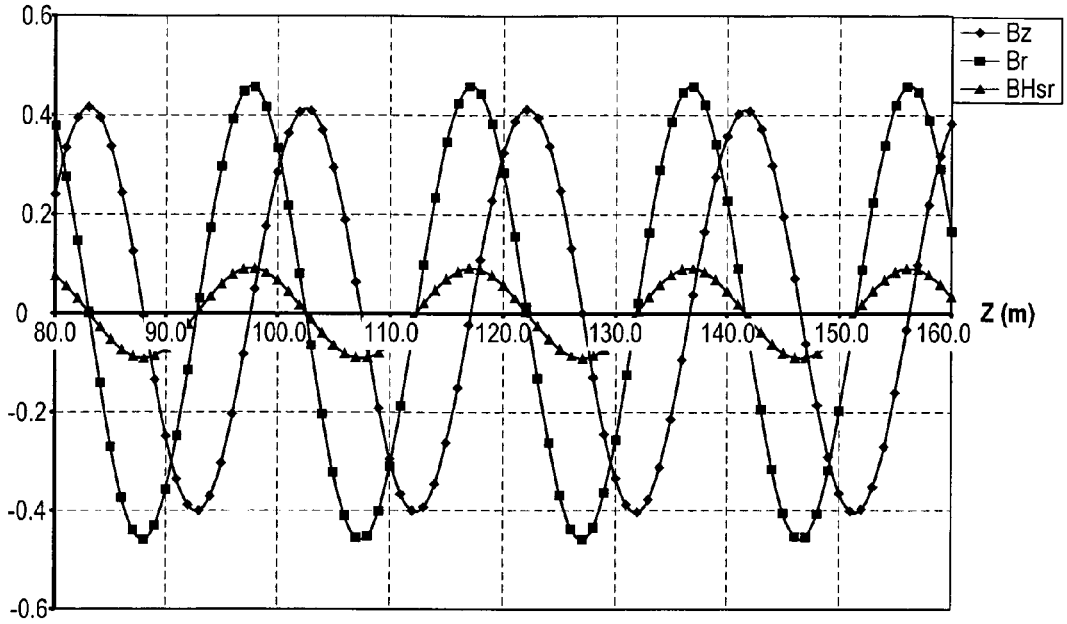
FIG. 34 shows magnetic field components for a build-up section of a wellbore.

FIG. 34 shows the magnetic field components with the wellbore with magnets built at 4° per every 30 m and the observation wellbore built at 4.095° per every 30 m to maintain the well spacing. FIG. 34 shows that the sine functions are only slightly skewed. The component maxima are no longer opposite the pole position (as shown in FIG. 31) because the wellbores are slightly offset and maintained at a constant distance.

Figure 35:
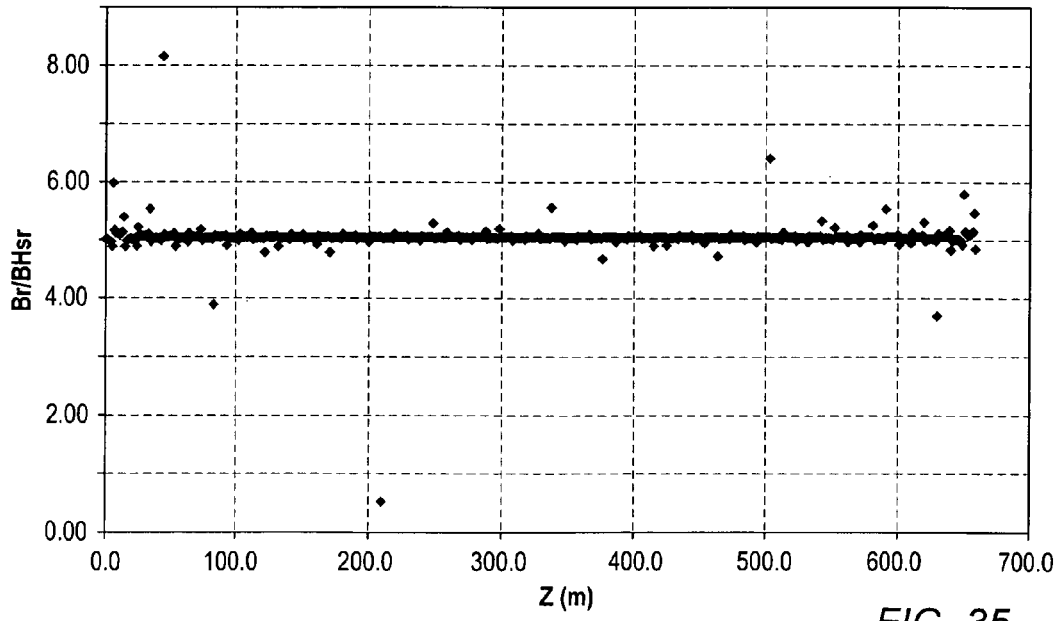
FIG. 35 depicts a ratio of magnetic field components for a build-up section of a wellbore.

FIG. 35 depicts the ratio of $B_r/B_{Hsr}$ from FIG. 34. In an ideal situation, the ratio should be 5, since the observation wellbore has a separation in a perpendicular direction of 10 m from the wellbore with the magnets and an offset of 2 m (Hsr direction). The excessive points are due to the fact that the data for the excessive points are taken at midpoints between the poles where both $B_r$ and $B_{Hsr}$ are zero.

Figure 36:
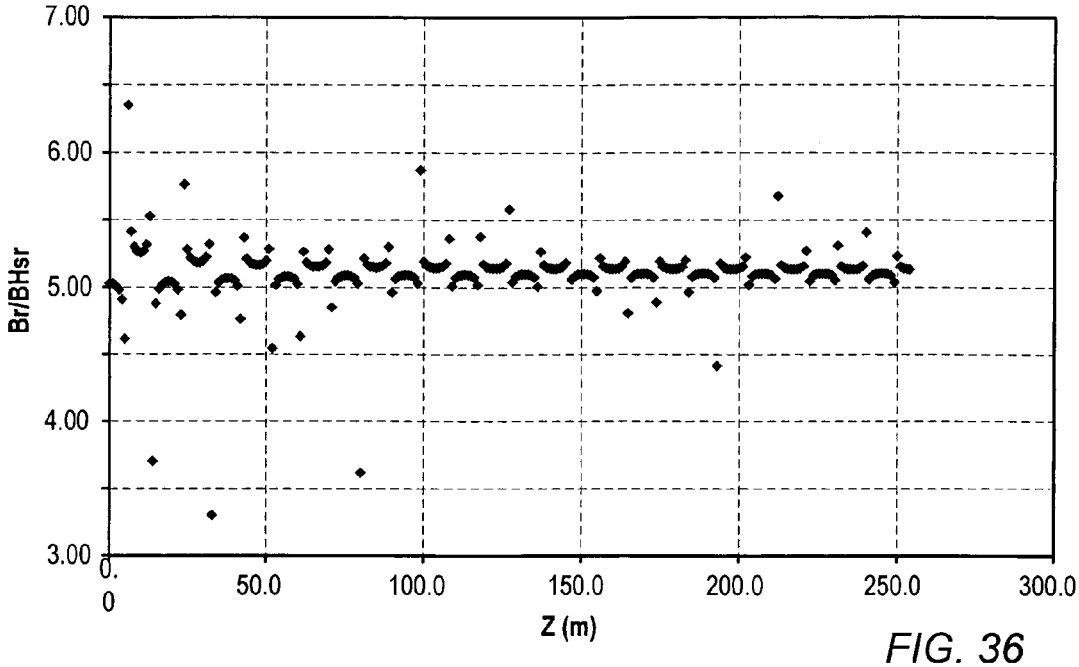
FIG. 36 depicts a ratio of magnetic field components for a build-up section of a wellbore.

FIG. 36 depicts the ratio of $B_r/B_{Hsr}$ with a build-up of 10° per every 30 m. The distance between wellbores was the same as in FIG. 35. FIG. 36 shows that the accuracy is still good for the high build-up rate. FIGS. 34-36 show that the accuracy of magnetic steering is still relatively good for build-up sections of wellbores.

Figure 37:
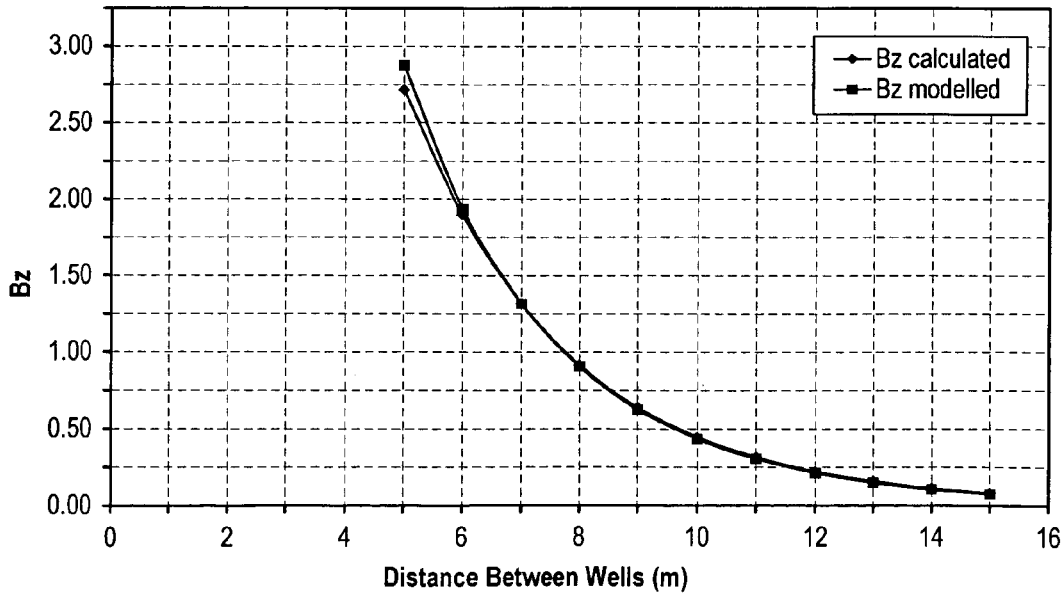
FIG. 37 depicts comparisons of magnetic field components determined from experimental data and magnetic field components modeled using analytical equations versus distance between wellbores.
Figure 38:
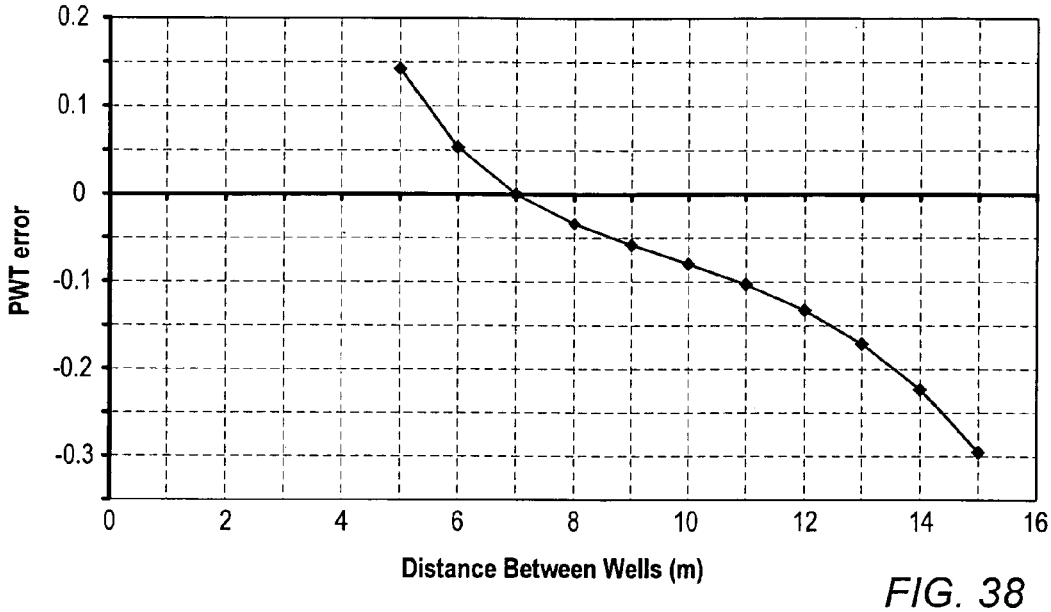
FIG. 38 depicts the difference between the two curves in FIG. 37.
Figure 39:
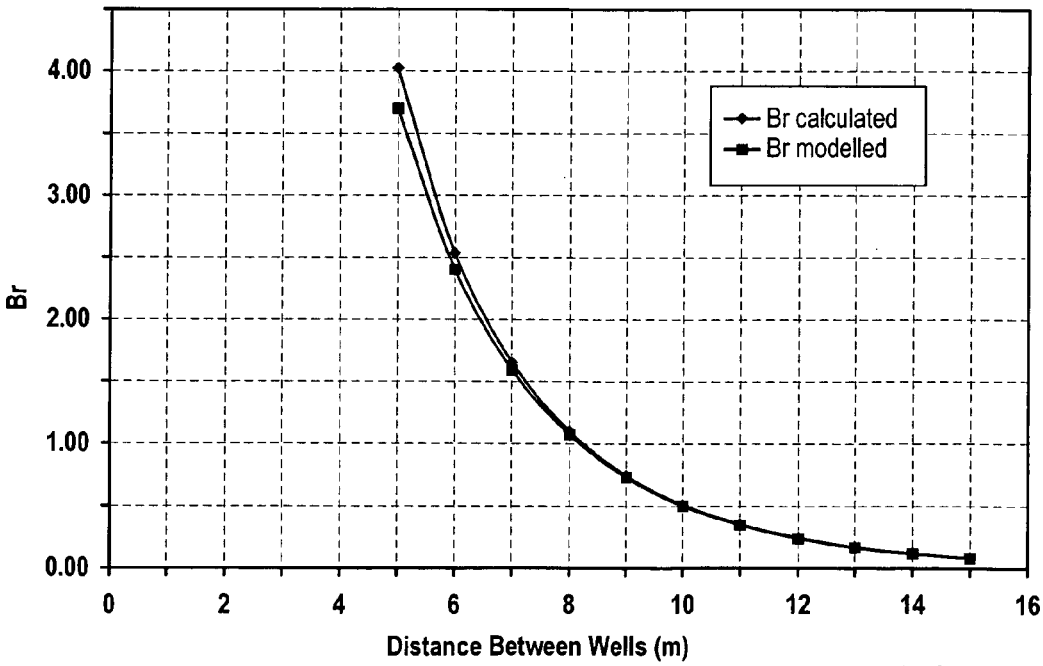
FIG. 39 depicts comparisons of magnetic field components determined from experimental data and magnetic field components modeled using analytical equations versus distance between wellbores.
Figure 40:
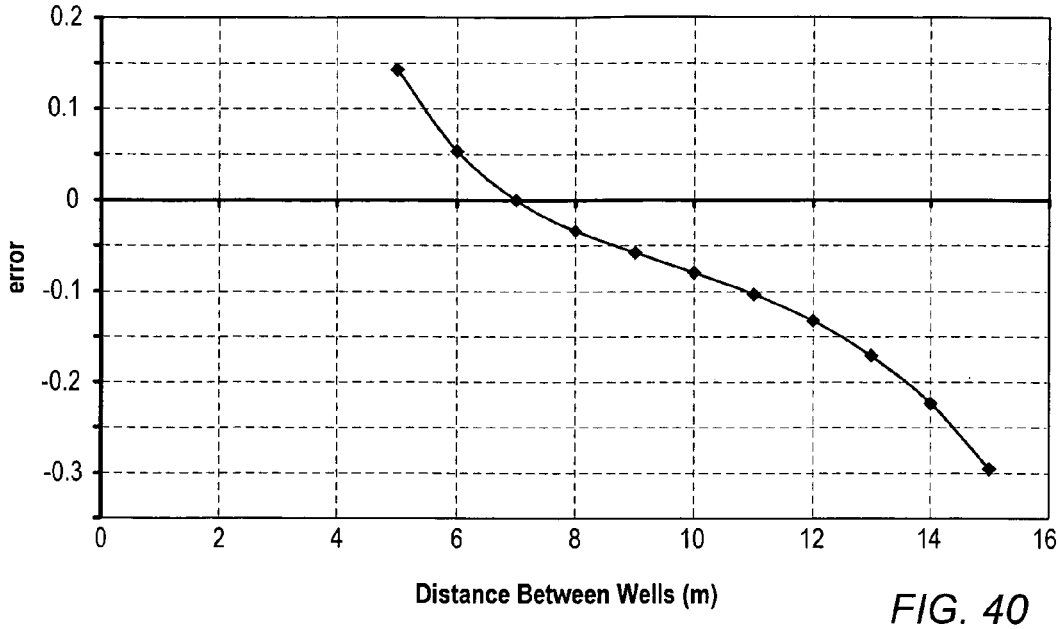
FIG. 40 depicts the difference between the two curves in FIG. 39.

FIG. 37 depicts comparisons of actual calculated magnetic field components versus magnetic field components modeled using analytical equations for two parallel wellbores with L=20 m separation between poles. FIG. 37 depicts the $B_z$ component as a function of distance between the wellbores where a perfect fit (i.e., the difference between modeling distance and actual distance is set at zero) is set at 7 m by adjusting the pole strengths, P. FIG. 38 depicts the difference between the two curves in FIG. 37. As shown in FIGS. 37 and 38, the variation between the modeled and actual distance is relatively small and may be predictable. FIG. 39 depicts the $B_r$ component as a function of distance between the wellbores with the fit used for the perfect fit of $B_z$ set at 7 m. FIG. 40 depicts the difference between the two curves in FIG. 39. FIGS. 37-40 show that the same accuracy exists using $B_z$ or $B_r$ to determine distance.

Figure 41:
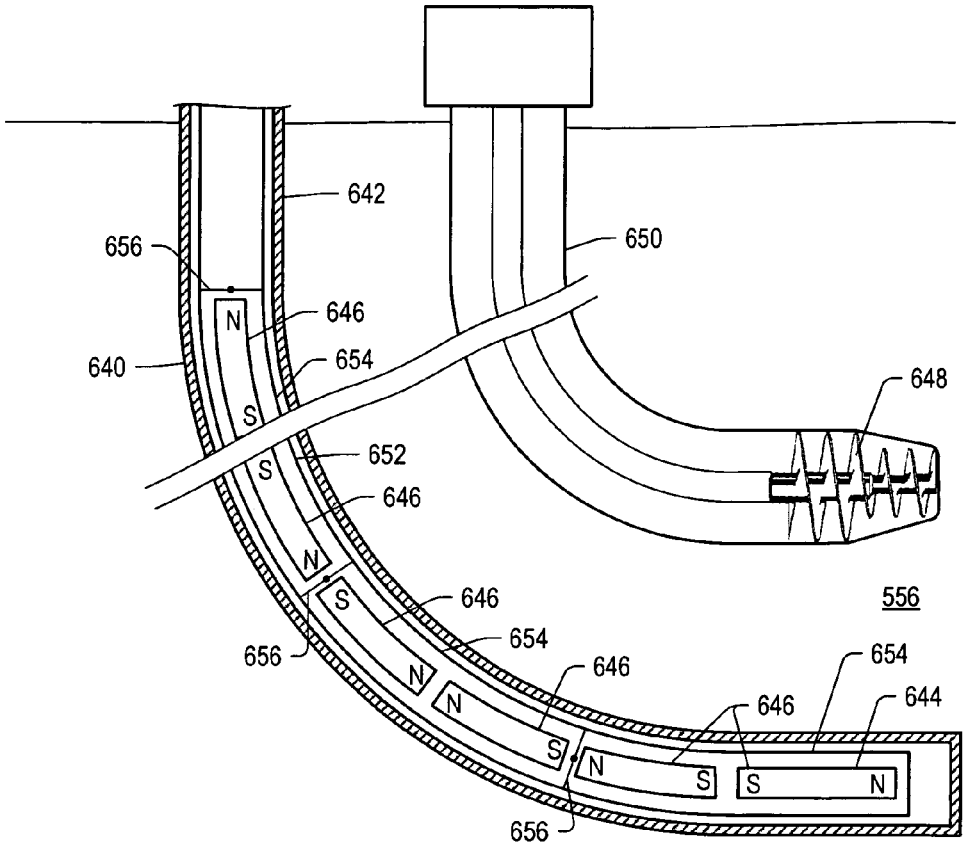
FIG. 41 depicts a schematic representation of an embodiment of a magnetostatic drilling operation.

FIG. 41 depicts a schematic representation of an embodiment of a magnetostatic drilling operation to form an opening that is an approximate desired distance away from (e.g., substantially parallel to) a drilled opening. Opening 640 may be formed in hydrocarbon layer 556. In some embodiments, opening 640 may be formed in any hydrocarbon containing formation, other types of subsurface formations, or for any subsurface application (e.g., soil remediation, solution mining, steam-assisted gravity drainage (SAGD), etc.). Opening 640 may be formed substantially horizontally in hydrocarbon layer 556. For example, opening 640 may be formed substantially parallel to a boundary (e.g., the surface) of hydrocarbon layer 556. Opening 640 may be formed in other orientations in hydrocarbon layer 556 depending on, for example, a desired use of the opening, formation depth, a formation type, etc. Opening 640 may include casing 642. In certain embodiments, opening 640 may be an open (or uncased) wellbore. In some embodiments, magnetic string 644 may be inserted into opening 640. Magnetic string 644 may be unwound from a reel into opening 640. In an embodiment, magnetic string 644 includes one or more magnet segments 646. In other embodiments, magnetic string 644 may include one or more movable permanent longitudinal magnets. A movable permanent longitudinal magnet may have a north and a south pole. Magnetic string 644 may have a longitudinal axis that is substantially parallel (e.g., within about 5% of parallel) or coaxial with a longitudinal axis of opening 640.

Magnetic strings may be moved (e.g., pushed and/or pulled) through an opening using a variety of methods. In an embodiment, a magnetic string may be coupled to a drill string and moved through the opening as the drill string moves through the opening. Alternatively, magnetic strings may be installed using coiled tubing. Some embodiments may include coupling a magnetic string to a tractor system that moves through the opening. For example, commercially available tractor systems from Welltec Well Technologies (Denmark) or Schlumberger Technology Co. (Houston, Tex.) may be used. In certain embodiments, magnetic strings may be pulled by cable or wireline from either end of an opening. In an embodiment, magnetic strings may be pumped through an opening using air and/or water. For example, a pig may be moved through an opening by pumping air and/or water through the opening and the magnetic string may be coupled to the pig.

In some embodiments, casing 642 may be a conduit. Casing 642 may be made of a material that is not significantly influenced by a magnetic field (e.g., non-magnetic alloy such as non-magnetic stainless steel (e.g., 304, 310, 316 stainless steel), reinforced polymer pipe, or brass tubing). The casing may be a conduit of a conductor-in-conduit heater, or it may be a perforated liner or casing. If the casing is not significantly influenced by a magnetic field, then the magnetic flux will not be shielded.

In other embodiments, the casing may be made of a ferromagnetic material (e.g., carbon steel). A ferromagnetic material may have a magnetic permeability greater than about 1. The use of a ferromagnetic material may weaken the strength of the magnetic field to be detected by drilling apparatus 648 in adjacent opening 650. For example, carbon steel may weaken the magnetic field strength outside of the casing (e.g., by a factor of 3 depending on the diameter, wall thickness, and/or magnetic permeability of the casing). Measurements may be made with the magnetic string inside the carbon steel casing (or other magnetically shielding casing) at the surface to determine the effective pole strengths of the magnetic string when shielded by the carbon steel casing. In certain embodiments, casing 642 may not be used (e.g., for an open wellbore). Casing 642 may not be magnetized, which allows the Earth's magnetic field to be used for other purposes (e.g., using a 3-axis magnetometer). Measurements of the magnetic field produced by magnetic string 644 in adjacent opening 650 may be used to determine the relative coordinates of adjacent opening 650 to opening 640.

In some embodiments, drilling apparatus 648 may include a magnetic guidance sensor probe. The magnetic guidance sensor probe may contain a 3-axis fluxgate magnetometer and a 3-axis inclinometer. The inclinometer is typically used to determine the rotation of the sensor probe relative to Earth's gravitational field (i.e., the "toolface angle"). A general magnetic guidance sensor probe may be obtained from Tensor Energy Products (Round Rock, Tex.). The magnetic guidance sensor may be placed inside the drilling string coupled to a drill bit. In certain embodiments, the magnetic guidance sensor probe may be located inside the drilling string of a river crossing rig.

Magnet segments 646 may be placed in conduit 652. Conduit 652 may be a threaded or seamless coiled tubular. Conduit 652 may be formed by coupling one or more sections 654. Sections 654 may include non-magnetic materials such as, but not limited to, stainless steel. In certain embodiments, conduit 652 is formed by coupling several threaded tubular sections. Sections 654 may have any length desired (e.g., the sections may have a standard length for threaded tubulars). Sections 654 may have a length chosen to produce magnetic fields with selected distances between junctions of opposing poles in magnetic string 644. The distance between junctions of opposing poles may determine the sensitivity of a magnetic steering method (i.e., the accuracy in determining the distance between adjacent wellbores). Typically, the distance between junctions of opposing poles is chosen to be on the same scale as the distance between adjacent wellbores (e.g., the distance between junctions may in a range of about 1 m to about 500 m or, in some cases, in a range of about 1 m to about 200 m).

In an embodiment, conduit 652 is a threaded stainless steel tubular (e.g., a Schedule 40, 304 stainless steel tubular with an outside diameter of about 7.3 cm (2.875 in.) formed from approximately 6 m (20 ft.) long sections 654). With approximately 6 m long sections 654, the distance between opposing poles will be about 6 m. In some embodiments, sections 654 may be coupled as the conduit is formed and/or inserted into opening 640. Conduit 652 may have a length between about 125 m and about 175 m. Other lengths of conduit 652 (e.g., less than about 125 m or greater than 175 m) may be used depending on a desired application of the magnetic string.

In an embodiment, sections 654 of conduit 652 may include two magnet segments 646. More or less than two segments may also be used in sections 654. Magnet segments 646 may be arranged in sections 654 such that adjacent magnet segments have opposing polarities (i.e., the segments are repelled by each other due to opposing poles (e.g., N-N) at the junction of the segments), as shown in FIG. 41. In an embodiment, one section 654 includes two magnet segments 646 of opposing polarities. The polarity between adjacent sections 654 may be arranged such that the sections have attracting polarities (i.e., the sections are attracted to each other due to attracting poles (e.g., S-N) at the junction of the sections), as shown in FIG. 41. Arranging the opposing poles approximate the center of each section may make assembly of the magnet segments in each section relatively easy. In an embodiment, the approximate centers of adjacent sections 654 have opposite poles. For example, the approximate center of one section may have north poles and the adjacent section (or sections on each end of the one section) may have south poles as shown in FIG. 41.

Fasteners 656 may be placed at the ends of sections 654 to hold magnet segments 646 in the sections. Fasteners 656 may include, but are not limited to, pins, bolts, or screws. Fasteners 656 may be made of non-magnetic materials. In some embodiments, ends of sections 654 may be closed off (e.g., end caps placed on the ends) to enclose magnet segments 646 in the sections. In certain embodiments, fasteners 656 may also be placed at junctions of opposing poles of adjacent magnet segments 646 to inhibit the adjacent segments from moving apart.

Figure 42:
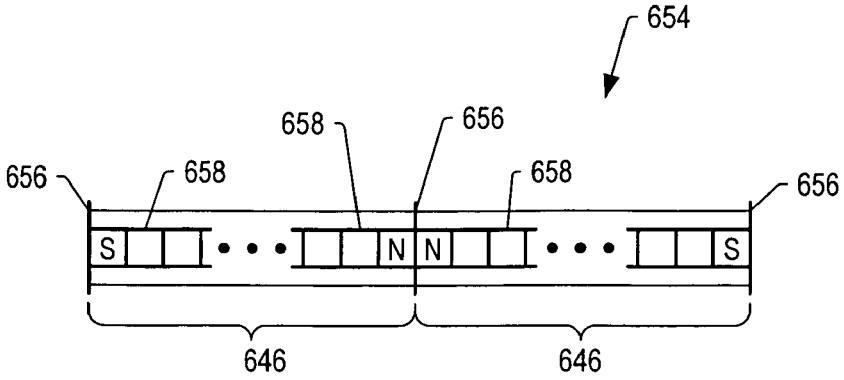
FIG. 42 depicts an embodiment of a section of a conduit with two magnet segments.

FIG. 42 depicts an embodiment of section 654 with two magnet segments 646 with opposing poles. Magnet segments 646 may include one or more magnets 658 coupled to form a single magnet segment. Magnet segments 646 and/or magnets 658 may be positioned in a linear array. Magnets 658 may be Alnico magnets or other types of magnets (e.g., neodymium iron or samarium cobalt) with sufficient magnetic strength to produce a magnetic field that can be sensed in a nearby wellbore. Alnico magnets are made primarily from alloys of aluminum, nickel and cobalt and may be obtained, for example, from Adams Magnetic Products Co. (Elmhurst, Ill.). Using permanent magnets in magnet segments 646 may reduce the infrastructure associated with magnetic tracking compared to using inductive coils or magnetic field producing wires (e.g., there is no need to provide a current and the infrastructure for providing current using permanent magnets). In an embodiment, magnets 658 are Alnico magnets about 6 cm in diameter and about 15 cm in length. Assembling a magnet segment from several individual magnets increases the strength of the magnetic field produced by the magnet segment. Increasing the strength of the magnetic field(s) produced by magnet segments may advantageously increase the maximum distance for sensing the magnetic field(s). In certain embodiments, the pole strength of a magnet segment may be between about 100 Gauss and about 2000 Gauss (e.g., about 1500 Gauss). In some embodiments, the pole strength of a magnet segment may be between about 1000 Gauss and about 2000 Gauss. Magnets 658 may be coupled with attracting poles coupled such that magnet segment 646 is formed with a south pole at one end and a north pole at a second end. In one embodiment, 40 magnets 658 of about 15 cm in length are coupled to form magnet segment 646 of about 6 m in length. Opposing poles of magnet segments 646 may be aligned proximate the center of section 654 as shown in FIGS. 41 and 42. Magnet segments 646 may be placed in section 654 and the magnet segments may be held in the section with fasteners 656. One or more sections 654 may be coupled as shown in FIG. 41, to form a magnetic string. In certain embodiments, un-magnetized magnet segments 646 may be coupled (e.g., glued) together inside sections 654. Sections 654 may be magnetized with a magnetizing coil after magnet segments 646 have been assembled and coupled (e.g., glued) together into the sections.

Figure 43:
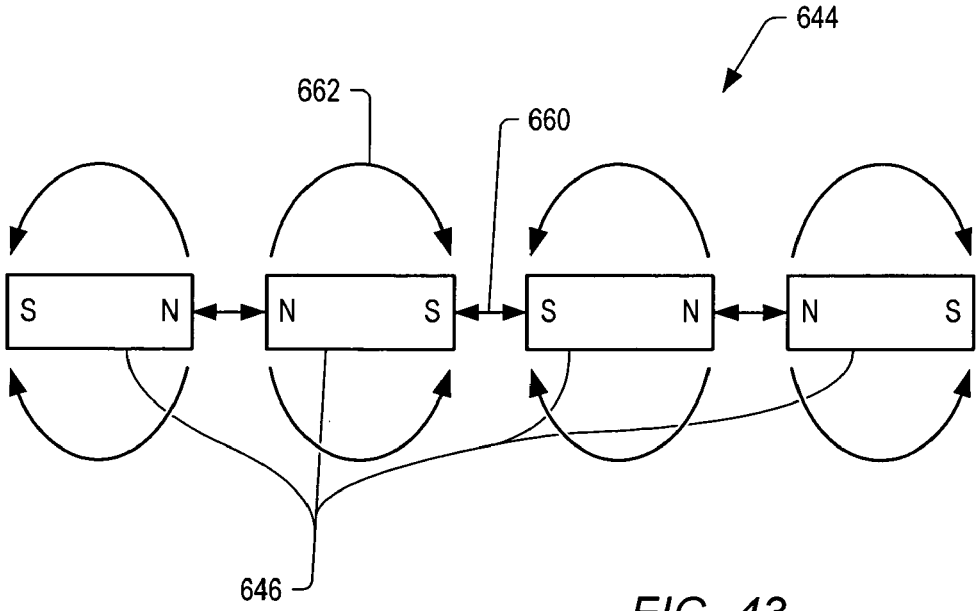
FIG. 43 depicts a schematic of a portion of a magnetic string.

FIG. 43 depicts a schematic of an embodiment of a portion of magnetic string 644. Magnet segments 646 may be positioned such that adjacent segments have opposing poles. In some embodiments, force may be applied to minimize distance 660 between magnet segments 646. Additional segments may be added to increase a length of magnetic string 644. In certain embodiments, magnet segments 646 may be located in sections 654, as shown in FIG. 41. Magnetic strings may be coiled after assembling. Installation of the magnetic string may include uncoiling the magnetic string. Coiling and uncoiling of the magnetic string may also be used to change position of the magnetic string relative to a sensor in a nearby wellbore (e.g., drilling apparatus 648 in opening 650 as shown in FIG. 41).

Magnetic strings may include multiple south-south and north-north opposing pole junctions. As shown in FIG. 43, the multiple opposing pole junctions may induce a series of magnetic fields 662. Alternating the polarity of portions in a magnetic string may provide a sinusoidal variation of the magnetic field along the length of the magnetic string. The magnetic field variations may allow for control of the desired spacing between drilled wellbores. In certain embodiments, a series of magnetic fields 662 may be sensed at greater distances than individual magnetic fields. Increasing the distance between opposing pole junctions in the magnetic string may increase the radial distance at which a magnetometer may detect a magnetic field. In some embodiments, the distance between opposing pole junctions in the magnetic string may be varied. For example, more magnets may be used in portions proximate Earth's surface than in portions positioned deeper in the formation.

In certain embodiments, the distance between junctions of opposing poles of the magnetic strings may be increased or decreased when the separation distance between two wellbores increases or decreases, respectively. Shorter distances between junctions of opposing poles increases the frequency of variations in the magnetic field, which may provide more guidance (i.e., better accuracy) to the drilling operation for smaller wellbore separation distances. Longer distances between junctions of opposing poles may be used to increase the overall magnetic field strength for larger wellbore separation distances. For example, a distance between junctions of opposing poles of about 6 m may induce a magnetic field sufficient to allow drilling of adjacent wellbores at distances of less than about 16 m. In certain embodiments, the spacing between junctions of opposing poles may be varied between about 3 m and about 24 m. In some embodiments, the spacing between junctions of opposing poles may be varied between about 0.6 m and about 60 m. The spacing between junctions of opposing poles may be varied to adjust the sensitivity of the drilling system (e.g., the allowed tolerance in spacing between adjacent wellbores).

In an embodiment, a magnetic string may be moved forward in a first opening while forming an adjacent second opening using magnetic tracking of the magnetic string. Moving the magnetic string forward while forming the adjacent second opening may allow shorter lengths of the magnetic string to be used. Using shorter lengths of magnetic string may be more economically favorable by reducing material costs.

In one embodiment, a junction of opposing poles in the magnetic string (e.g., the junction of opposing poles at the center of the magnetic string) in the first opening may be aligned with the magnetic sensor on a drilling string in the second opening. The second opening may be drilled forward using magnetic tracking of the magnetic string. The second opening may be drilled forward a distance of about L/2, where L is the spacing between junctions of opposing poles in the magnetic string. The magnetic string may then be moved forward a distance of about L/2. This process may be repeated until the second opening is formed at the desired length. The magnetic sensor may remain aligned with the center of the magnetic string during the drilling process. In some embodiments, the forward drilling and movement of the magnetic string may be done in increments of L/4.

In some embodiments, the strength of the magnets used may affect the strength of the magnetic field induced. In certain embodiments, a distance between junctions of opposing poles of about 6 m may induce a magnetic field sufficient to drill adjacent wellbores at distances of less than about 6 m. In other embodiments, a distance between junctions of opposing poles of about 6 m may induce a magnetic field sufficient to drill adjacent wellbores at distances of less than about 10 m.

A length of the magnetic string may be based on an economic balance between cost of the string and the cost of having to reposition the string during drilling. A string length may range from about 20 m to about 500 m. In an embodiment, a magnetic string may have a length of about 50 m. Thus, in some embodiments, the magnetic string may need to be repositioned if the openings being drilled are longer than the length of the string.

Figure 44:
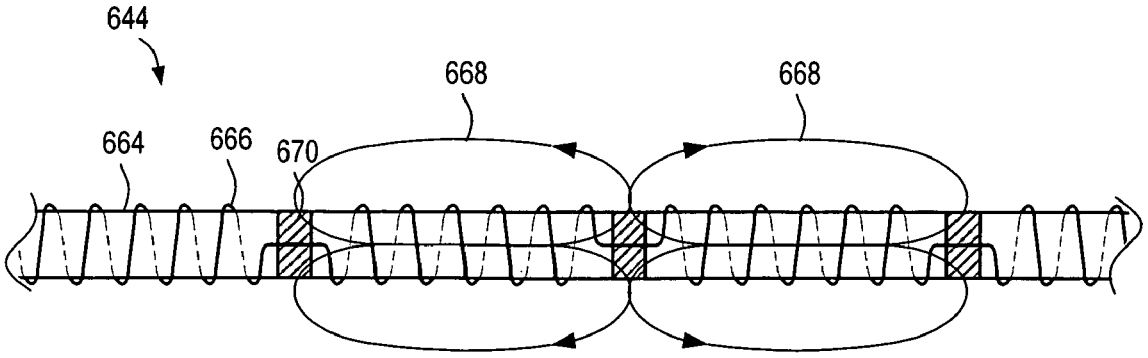
FIG. 44 depicts an embodiment of a magnetic string.

In some embodiments, a magnet may be formed by one or more inductive coils, solenoids, and/or electromagnets. FIG. 44 depicts an embodiment of a magnetic string. Magnetic string 644 may include core 664. Core 664 may be formed of ferromagnetic material (e.g., iron). Core 664 may be encircled by one or more coils 666. Coils 666 may be made of conductive material (e.g., copper). Coils 666 may include one continuous coil or several coils coupled together. In an embodiment, coils 666 are wound in one direction (e.g., clockwise) for a specific length and then the next specific length of coil is wound in a reverse direction (e.g., counterclockwise). The specific length of coil wound in one direction may be equal to L/2, where L is the spacing between opposing poles as described above. Winding sections of coil in different directions may produce magnetic fields 668, when an electrical current is provided to coils 666, that are oriented in opposite directions, thereby producing effective magnetic poles between the sections of coil. Alternating the directions of winding may also produce effective magnetic poles that are alternating between effective north poles and effective south poles along a length of core 664. Coupling section 670 may couple one or more sections of core 664 together. Coupling section 670 may include non-ferromagnetic material (e.g., fiberglass or polymer). Coupling section 670 may be used to separate the opposing magnetic poles.

An electrical current may be provided to coils 666 to produce one or more magnetic fields (e.g., a series of magnetic fields) along a length of core 664. The amount of electrical current provided to coils 666 may be adjusted to alter the strength of the produced magnetic fields. The strength of the produced magnetic fields may be altered to adjust for the desired distance between wellbores (i.e., a stronger magnetic field for larger distances between wellbores, etc.). In certain embodiments, a direct current (DC) may be provided to coils 666 in one direction for a specified time (e.g., about 5 seconds to about 10 seconds) and in a reverse direction for a specified time (e.g., about 5 seconds to about 10 seconds). Measurements of the produced magnetic field with electrical current flowing in each direction may be taken. These measurements may be used to subtract or remove fixed magnetic fields from the measurement of distance between wellbores.

When multiple wellbores are to be drilled around a center wellbore, the center wellbore may be drilled and magnetic strings may be placed in the center wellbore to guide the drilling of the other wellbores substantially surrounding the center wellbore. Cumulative errors in drilling may be limited by drilling neighboring wellbores guided by the magnetic string. Additionally, only wellbores using the magnetic string may include a nonmagnetic liner, which may be more expensive than typical liners.

As an example, in a seven spot pattern, a first wellbore may be formed at the center of the well pattern. A magnetic string may be placed in the first wellbore. The neighboring (or surrounding) six wellbores may be formed using the magnetic string in the first wellbore for guidance. After the seven spot pattern has been formed, additional wellbores may be formed by placing the magnetic string in one of the six surrounding wellbores and forming the nearest neighboring wellbores to the wellbore with the magnetic string. The process of forming nearest neighboring wellbores and moving the magnetic string to form successive neighboring wellbores may be repeated until a wellbore pattern has been formed for a hydrocarbon containing formation. Drilling as many nearest neighbor wellbores as possible from a single wellbore may reduce the cost and time associated with moving the magnetic string from wellbore to wellbore and/or installing multiple magnetic strings.

In an embodiment, the nearest neighboring wellbores to a previously formed wellbore are formed using magnetic steering with a magnetic string placed in the previously formed wellbore. The previously formed wellbore may have been formed by any standard drilling method (e.g., gyroscope, inclinometer, Earth's field magnetometer, etc.) or by magnetic steering from another previously formed wellbore. Forming nearest neighbor wellbores with magnetic steering may reduce the overall deviation between wellbores in a well pattern formed for a hydrocarbon containing formation. For example, the deviation between wellbores may be kept below about ±1 m. In some embodiments of formed heater wellbores, heat may be varied along the lengths of wellbores to compensate for any variations in spacing between heater wellbores.

Figure 45:
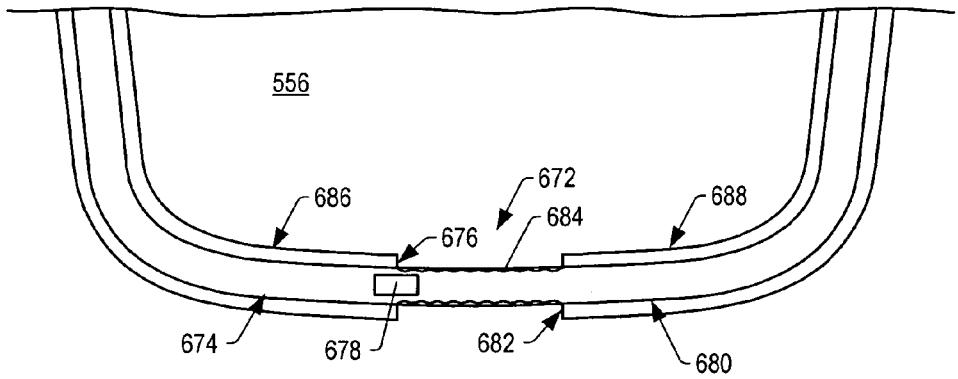
FIG. 45 depicts an embodiment of a wellbore with a first opening located at a first location on the Earth's surface and a second opening located at a second location on the Earth's surface.

FIG. 45 depicts an embodiment of a wellbore with a first opening located at a first location on the Earth's surface and a second opening located at a second location on the Earth's surface (e.g., "a relatively u-shaped wellbore"). Wellbore 672 depicted in FIG. 45 may be formed by a multiple step drilling method. First portion 674 may be initially formed in hydrocarbon layer 556 by typical wellbore drilling methods. First portion 674 may be substantially L-shaped so that distal end 676 of the portion in hydrocarbon layer 556 is substantially horizontal in the hydrocarbon layer. Magnetic source 678 may be placed at distal end 676 of first portion 674.

Magnetic source 678 may be used to guide the drilling of second portion 680 so that distal end 682 of the second portion is substantially aligned with distal end 676 of first portion 674. Drilling of second portion 680 may use magnetic steering techniques to align with magnetic source 678. After formation of first portion 674 and second portion 680, expandable conduit 684 may be used to couple the portions together. Expandable conduit 684 may be sealed to casing 686 of first portion 674 and casing 688 of second portion 680 so that a continuous wellbore (wellbore 672) with two openings at two locations on the Earth's surface is formed. Wellbore 672 may be, for example, substantially u-shaped.

In certain embodiments, first portion 674 and second portion 680 may have relatively steep entry angles (as shown in FIG. 45) into hydrocarbon layer 556. The steep entry angles may cost relatively little to drill. In some embodiments, relatively shallow entry angles may be used. In some embodiments, the horizontal portion of wellbore 672 may be between about 100 m and about 300 m below the surface (e.g., about 200 m below the surface). The horizontal sections of first portion 674 and second portion 680 may each be between about 500 m and about 1500 m in length (e.g., about 1000 m in length).

In certain embodiments, acoustic waves and their reflections may be used to determine the approximate location of a wellbore in a hydrocarbon layer (e.g., a coal layer). In some embodiments, logging while drilling (LWD), seismic while drilling (SWD), and/or measurement while drilling (MWD) techniques may be used to determine a location of a wellbore while the wellbore is being drilled.

In an embodiment, an acoustic source may be placed in a wellbore being formed in a hydrocarbon layer (e.g., the acoustic source may be placed at, near, or behind the drill bit being used to form the wellbore). The location of the acoustic source may be determined relative to one or more geological discontinuities (e.g., boundaries) of the formation (e.g., relative to the overburden and/or the underburden of the hydrocarbon layer). The approximate location of the acoustic source (i.e., the drilling string being used to form the wellbore) may be assessed while the wellbore is being formed in the formation. Monitoring of the location of the acoustic source, or drill bit, may be used to guide the forming of the wellbore so that the wellbore is formed at a desired distance from, for example, the overburden and/or the underburden of the formation. For example, if the location of the acoustic source drifts from a desired distance from the overburden or the underburden, then the forming of the wellbore may be adjusted to place the acoustic source at a selected distance from a geological discontinuity. In some embodiments, a wellbore may be formed at approximately a midpoint in the hydrocarbon layer between the overburden and the underburden of the formation (i.e., the wellbore may be placed along a midline between the overburden and the underburden of the formation).

Figure 46:
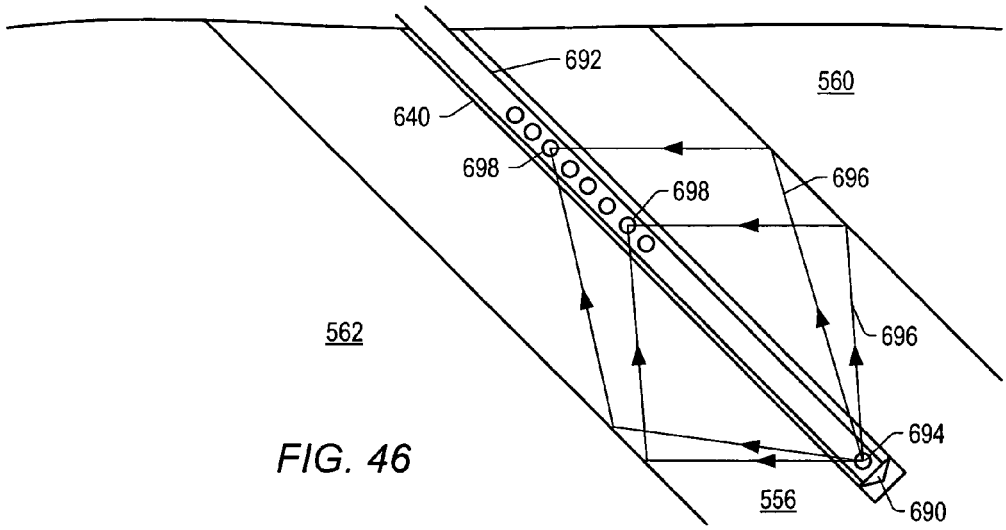
FIG. 46 depicts an embodiment for using acoustic reflections to determine a location of a wellbore in a formation.

FIG. 46 depicts an embodiment for using acoustic reflections to determine a location of a wellbore in a formation. Drill bit 690 may be used to form opening 640 in hydrocarbon layer 556. Drill bit 690 may be coupled to drill string 692. Acoustic source 694 may be placed at or near drill bit 690. Acoustic source 694 may be any source capable of producing an acoustic wave in hydrocarbon layer 556 (e.g., acoustic source 694 may be a monopole source or a dipole source that produces an acoustic wave with a frequency between about 2 kHz and about 10 kHz). Acoustic waves 696 produced by acoustic source 694 may be measured by one or more acoustic sensors 698. Acoustic sensors 698 may be placed in drill string 692. In an embodiment, 3 to 10 (e.g., 8) acoustic sensors 698 are placed in drill string 692. Acoustic sensors 698 may be spaced between about 5 cm and about 30 cm apart (e.g., about 15.2 cm apart). The spacing between acoustic sensors 698 and acoustic source 694 is typically between about 5 meters and about 30 meters (e.g., between about 9 meters and about 15 meters).

In an embodiment, acoustic sensors 698 may include one or more hydrophones (e.g., piezoelectric hydrophones) or other suitable acoustic sensing device. Hydrophones may be oriented at 90° intervals symmetrically around the axis of drill string 692. In certain embodiments, the hydrophones may be oriented such that respective hydrophones in each acoustic sensor 698 are aligned in similar directions. Drill string 692 may also include a magnetometer, an accelerometer, an inclinometer, and/or a natural gamma ray detector. Data at each acoustic sensor 698 may be recorded separately using, for example, computational software for acoustic reflection recording (e.g., BARS acquisition hardware/software available from Schlumberger Technology Co. (Houston, Tex.)). Data may be recorded at acoustic sensors 698 at an interval between about every 1 μsec and about every 50 μsec (e.g., about every 15 μsec).

Acoustic waves 696 produced by acoustic source 694 may reflect off of overburden 560, underburden 562, and/or other unconformities or geological discontinuities (e.g., fractures). The reflections of acoustic waves 696 may be measured by acoustic sensors 698. The intensities of the reflections of acoustic waves 696 may be used to assess or determine an approximate location of acoustic source 694 relative to overburden 560 and/or underburden 562. For example, the intensity of a signal from a boundary that is closer to the acoustic source may be somewhat greater than the intensity of a signal from a boundary further away from the acoustic source. In addition, the signal from a boundary that is closer to the acoustic source may be detected at an acoustic sensor at an earlier time than the signal from a boundary further away from the acoustic source.

Data acquired from acoustic sensors 698 may be processed to determine the approximate location of acoustic source 694 in hydrocarbon layer 556. In certain embodiments, data from acoustic sensors 698 may be processed using a computational system or other suitable system for analyzing the data. The data from acoustic sensors 698 may be processed by one or more methods to produce suitable results.

In one embodiment, acoustic waves 696 that are reflected from geological discontinuities (e.g., boundaries of the formation) are detected at two or more acoustic sensors 698. The reflected acoustic waves may arrive at the acoustic sensors later than refracted acoustic waves and/or with a different moveout across the array of acoustic sensors. The local wave velocity in the formation may be assessed, or known, from analysis of the arrival times of the refracted acoustic waves. Using the local wave velocity, the distance of a selected reflecting interface (i.e., geological discontinuity) may be assessed (e.g., computed) by assessing the appropriate arrival time for the reflection from the selected reflecting interface when the acoustic source and the acoustic sensor are not separated (i.e., zero offset), multiplying the assessed appropriate arrival time by the local wave velocity, and dividing the product by two. The zero offset arrival time may be assessed by applying normal moveout corrections for the assessed local wave velocity to the recorded waveforms of the acoustic waves at each acoustic sensor and stacking the corrected waveforms in a common reflection point gather. This process is generally known and commonly used in surface exploration reflection seismology.

The direction from which a particular acoustic wave originates (e.g., above or below opening 640) may be assessed with a knowledge of the angle of the opening, which may be provided by a wellbore survey, and an estimate of the dip of hydrocarbon layer 556, which may be made by a surface seismic section. If the opening dips with respect to the formation itself, an upcoming wave (i.e., a wave coming from below the opening) may be separated from a downgoing wave (i.e., a wave coming from above the opening) by the sign of the apparent velocities of the waves in a common acoustic sensor panel composed over a substantial length of the opening. For a formation with a uniform thickness and an opening with a distance from the top and bottom of the formation that does not substantially vary along a length of the opening being monitored, polarized detectors may be used to assess the direction from which an acoustic wave arrives at an acoustic sensor.

In certain embodiments, filtering of the data may enhance the quality of the data (e.g., removing external noises such as noise from drill bit 690). Frequency and/or apparent velocity filtering may be used to suppress coherent noises in the data collected from acoustic sensors. Coherent noises may include unwanted and intense noise from events such as earlier refracted arrivals, direct fluid waves, waves that may propagate in the drill sting or logging tool, and/or Stoneley waves. Data filtering may also include bandpass filtering, f-k dip filtering, wavelet-processing Wiener filtering, and/or wave separation filtering. Filtering may be used to reduce the effects of wellbore wave signal modes (e.g., compressional headwaves) in common shot, common receiver, and/or common offset modes. In some embodiments, filtering of the data may include accounting for the velocity of acoustic waves in the formation. The velocity of acoustic waves in the formation may be calculated or assessed by, for example, acoustic well logging and/or acoustic measurements on a core sample from the formation. The data may also be processed by binning, normal moveout, and/or stacking (e.g., prestack migration). In some embodiments, the data may be processed by binning, normal moveout, and/or stacking followed by a second stacking technique (e.g., poststack migration). Prestack migration and poststack migration may be based on the generalized Radon transform. In certain embodiments, results from processing the data may be displayed and/or analyzed following any method of processing the data so that the data may be monitored (e.g., for quality control purposes).

In an embodiment, processed data may be analyzed to provide feedback control to drill bit 690. A direction of drill bit 690 may be modified or adjusted if the location of acoustic source 694 varies from a desired spacing relative to geological discontinuities (e.g., overburden 560 and/or underburden 562) so that opening 640 may be formed at a desired location (e.g., at a desired spacing between the overburden and the underburden). For example, drill string 692 may include an inclinometer that is used to direct the forming (i.e., drilling) of opening 640. The direction of the inclinometer may be adjusted to compensate for variance of the location of acoustic source 694 from the desired location between overburden 560 and/or underburden 562. An advantage of using data from acoustic sensors 698 while drilling an opening in the formation may be the real-time monitoring of the location of drill bit 690 and/or adjusting the direction of drilling in real time. In some embodiments, opening 640 formed using acoustic data to control the location of the opening may be used as a guide opening for forming one or more additional openings in a formation (e.g., magnetic tracking of opening 640 may be used to form one or more additional openings).

In an embodiment, a hydrocarbon containing formation may be pre-surveyed before drilling to determine the lithology of the formation and/or the optimum geometry of acoustic sources and sensors. Pre-surveying the formation may include simulating refraction signals for compressional and/or shear waves, various reflection mode signals in a wellbore, mud wave signals, Stoneley wave signals (i.e., seam vibration), and other reflective or refractive wave signals in the formation. In one embodiment, reflected signals may be determined by three-dimensional (3-D) ray tracing (an example of 3-D ray tracing is available from Schlumberger Technology Co. (Houston, Tex.)). Simulating these signals may provide an estimate of the optimum parameters for operating sensors and analyzing sensor data. In addition, pre-surveying may include determining if acoustic waves can be measured and analyzed efficiently in a formation.

Figure 47:
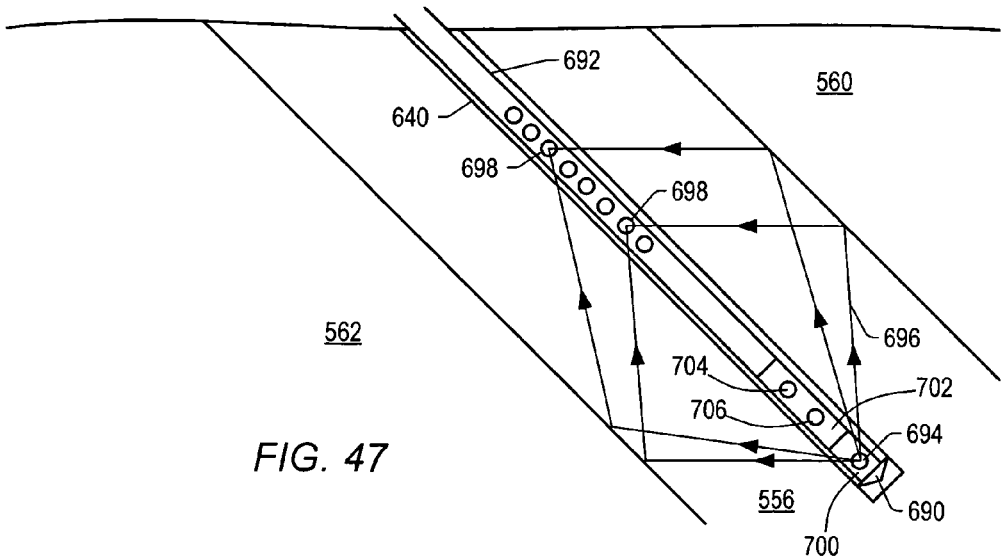
FIG. 47 depicts an embodiment for using acoustic reflections and magnetic tracking to determine a location of a wellbore in a formation.

FIG. 47 depicts an embodiment for using acoustic reflections and magnetic tracking to determine a location of a wellbore in a formation. Measurements of acoustic waves 696 may be used to assess an approximate location of opening 640 relative to geological discontinuities (e.g., overburden 560 and/or underburden 562). Magnetic tracking may be used to assess an approximate location of opening 640 relative to one or more additional wellbores in the formation. The combination of measurements of acoustic waves and magnetic tracking in a wellbore (e.g., opening 640) may increase the accuracy of placing the wellbore (e.g., the accuracy of drilling of the wellbore) in hydrocarbon layer 556 or any other subsurface formation or subsurface layer. Drill bit 690 may be used to form opening 640 in hydrocarbon layer 556. Drill bit 690 may be coupled to a turbine (e.g., a mud turbine) to turn the drill bit. The turbine may be located at or behind drill bit 690 in drill string 692. Non-magnetic section 700 may be located behind drill bit 690 in drill string 692. Non-magnetic section 700 may inhibit magnetic fields generated by drill bit 690 from being conducted along a length of drill string 692. In an embodiment, non-magnetic section 700 includes Monel®. In certain embodiments, acoustic source 694 may be placed in non-magnetic section 700. In other embodiments, acoustic source 694 may be placed in sections of drill string 692 behind non-magnetic section 700 (e.g., in probe section 702).

In an embodiment, drill string 692 may include probe section 702. Probe section 702 may include inclinometer 704

(e.g., a 3-axis inclinometer) and/or magnetometer 706 (e.g., a 3-axis fluxgate magnetometer). In an embodiment, magnetometer 706 may be used to determine a location of opening 640 relative to one or more additional openings in hydrocarbon layer 556. Inclinometer 704 may be used to assess the orientation and/or control the drilling angle of drill bit 690.

Acoustic sensors 698 may be located in drill string 692 behind probe section 702. In some embodiments, acoustic sensors 698 may be located in probe section 702. In some embodiments, acoustic sensors 698, probe section 702 (including inclinometer 704 and/or magnetometer 706), and acoustic source 694 may be located at other positions along a length of drill string 692.

Figure 48:
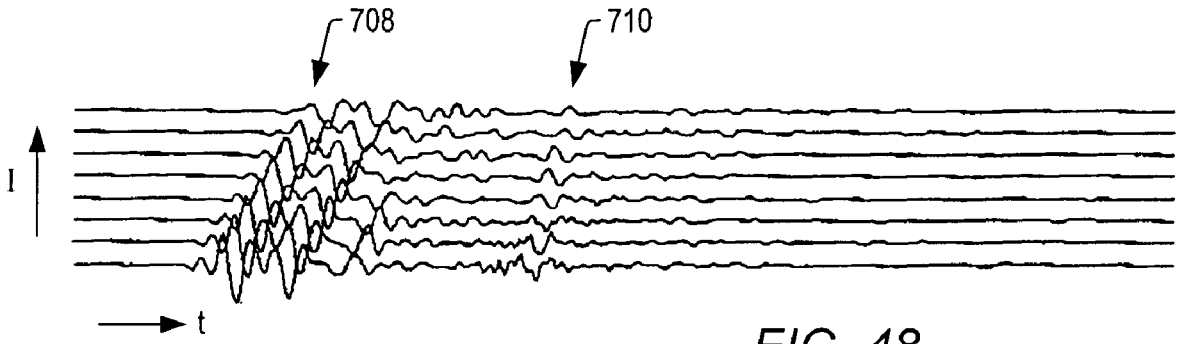
FIG. 48 depicts raw data obtained from an acoustic sensor in a formation.

FIG. 48 depicts signal intensity (I) versus time (t) for raw data obtained from an acoustic sensor in a formation. The raw data was taken for a single shot of an acoustic source in a horizontal wellbore in a coal seam. The coal seam had a thickness of about 30 feet (9.1 m). The acoustic source was separated from eight evenly spaced acoustic sensors by distances from 15 feet (4.6 m) to 18.5 feet (5.6 m). Four separate planar piezoelectric hydrophones were included in each acoustic sensor. The four hydrophones were oriented at 90° intervals symmetrically around the axis of the drilling string. The data shown in FIG. 48 is for a single hydrophone. The drilling string included a magnetometer and accelerometers, for determining the orientation of the drilling string and drill bit, and a natural gamma ray detector. The four hydrophones at each acoustic sensor were recorded separately using BARS acquisition hardware/software from Schlumberger Technology Co. (Houston, Tex.). A total of 32 512-sample traces were recorded at a 15 μsec sampling rate after firing the source.

The arrival times of P-wave refraction 708 and P-wave reflection 710 are indicated in FIG. 48. P-wave reflection 710 had a later arrival time than P-wave refraction 708. P-wave reflection 710 was assessed as a reflection event because the P-wave reflection arrived with a higher velocity than the refracted P-wave, which has the highest velocity possible for a direct arrival. Modeling of the P-wave velocity in the coal derived from P-wave refraction 708 arrival and the geometry of the acoustic devices indicated that the distance from the horizontal wellbore to the reflector producing the P-wave reflection was about 16 ft (4.9 m). This result indicated that the wellbore was within ±1 ft (0.3 m) of the center of the coal seam. Magnetic sensing of magnetic fields produced by a wireline placed in a second wellbore indicated that distance between the wellbores was approximately the desired distance of 20 ft (6.1 m).

In some hydrocarbon containing formations (e.g., in Green River oil shale), there may be one or more hydrocarbon layers characterized by a significantly higher richness than other layers in the formation. These rich layers tend to be relatively thin (typically about 0.2 m to about 0.5 m thick) and may be spaced throughout the formation. The rich layers generally have a richness of about 0.150 L/kg or greater. Some rich layers may have a richness greater than about 0.170 L/kg, greater than about 0.190 L/kg, or greater then about 0.210 L/kg. Other layers (i.e., relatively lean layers) of the formation may have a richness of about 0.100 L/kg or less and are generally thicker than rich layers. The richness and locations of layers may be determined, for example, by coring and subsequent Fischer assay of the core, density or neutron logging, or other logging methods.

Figure 49:
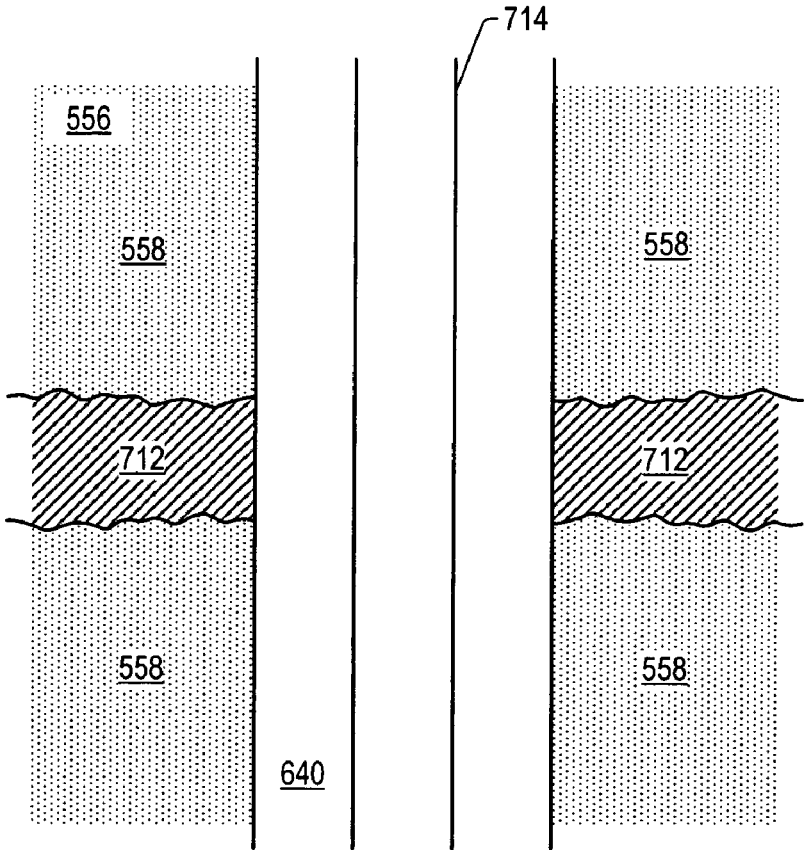
FIG. 49 depicts an embodiment of a heater in an open wellbore of a hydrocarbon containing formation with a rich layer.

FIG. 49 depicts an embodiment of a heater in an open wellbore of a hydrocarbon containing formation with a rich layer. Opening 640 may be located in hydrocarbon layer 556. Hydrocarbon layer 556 may include one or more rich layers 712. Relatively lean layers 558 in hydrocarbon layer 556 may have a lower richness than rich layers 712. Heater 714 may be placed in opening 640. In certain embodiments, opening 640 may be an open or uncased wellbore.

Rich layers 712 may have a lower initial thermal conductivity than other layers of the formation. Typically, rich layers 712 have a thermal conductivity 1.5 times to 3 times lower than the thermal conductivity of lean layers 558. For example, a rich layer may have a thermal conductivity of about $1.5\times10^{-3}$ cal/cm·sec·° C. while a lean layer of the formation may have a thermal conductivity of about $3.5\times10^{-3}$ cal/cm·sec·° C. In addition, rich layers 712 may have a higher thermal expansion coefficient than lean layers of the formation. For example, a rich layer of 57 gal/ton (0.24 L/kg) oil shale may have a thermal expansion coefficient of about $2.2\times10^{-2}$%/° C. while a lean layer of the formation of about 13 gal/ton (0.05 L/kg) oil shale may have a thermal expansion coefficient of about $0.63\times10^{-2}$%/° C.

Because of the lower thermal conductivity in rich layers 712, rich layers may cause "hot spots" on heaters during heating of the formation around opening 640. The "hot spots" may be generated because heat provided from the heater in opening 640 does not transfer into hydrocarbon layer 556 as readily as through rich layers 712 due to the lower thermal conductivity of the rich layers. Thus, the heat tends to stay at or near the wall of opening 640 during early stages of heating.

Material that expands from rich layers 712 into the wellbore may be significantly less stressed than material in the formation. Thermal expansion and pyrolysis may cause additional fracturing and exfoliation of hydrocarbon material that expands into the wellbore. Thus, after pyrolysis of expanded material in the wellbore, the expanded material may have an even lower thermal conductivity than pyrolyzed material in the formation. Under low stress, pyrolysis may cause additional fracturing and/or exfoliation of material, thus causing a decrease in thermal conductivity. The lower thermal conductivity may be caused by the lower stress placed on pyrolyzed materials that have expanded into the wellbore (i.e., pyrolyzed material that has expanded into the wellbore is no longer as stressed as the pyrolyzed material would be if the pyrolyzed material were still in the formation). This release of stress tends to lower the thermal conductivity of the expanded, pyrolyzed material.

After the formation of "hot spots" at rich layers 712, hydrocarbons in the rich layers will tend to expand at a much faster rate than other layers of the formation due to increased heat at the wall of the wellbore and the higher thermal expansion coefficient of the rich layers. Expansion of the formation into the wellbore may reduce radiant heat transfer to the formation. The radiant heat transfer may be reduced for a number of reasons, including, but not limited to, material contacting the heater, thus stopping radiant heat transfer; and reduction of wellbore radius which limits the surface area that radiant heat is able to transfer to. Reduction of radiant heat transfer may result in higher heater temperature adjacent to areas with reduced radiant heat transfer acceptance capability.

Rich layers 712 may expand at a much faster rate than lean layers because of the significantly lower thermal conductivity of rich layers and/or the higher thermal expansion coefficient of the rich layers. The expansion may apply significant pressure to a heater when the wellbore closes off against the heater. The wellbore closing off, or substantially closing off against the heater may also inhibit flow of fluids between layers of the formation. In some embodiments, fluids may become trapped in the wellbore because of the closing off or substantial closing off of the wellbore against the heater.

Figure 50:
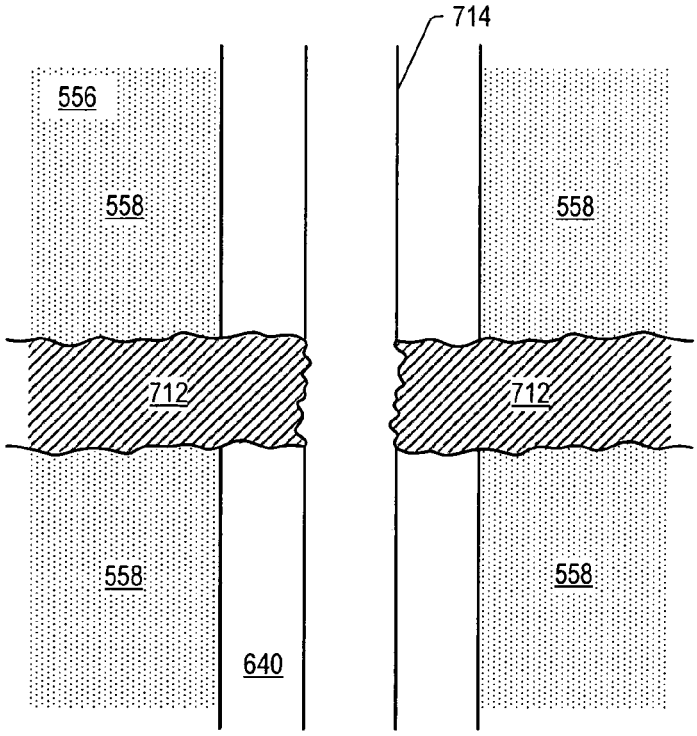
FIG. 50 depicts an embodiment of a heater in an open wellbore of a hydrocarbon containing formation with an expanded rich layer.

FIG. 50 depicts an embodiment of heater 714 in opening 640 with expanded rich layer 712. In some embodiments, opening 640 may be closed off by the expansion of rich layer 712, as shown in FIG. 50, (i.e., an annular space between the heater and wall of the opening may be closed off by expanded material). Closing off of the annulus of the opening may trap fluids between expanded rich layers in the opening. The trapping of fluids can increase pressures in the opening beyond desirable limits. In some circumstances, the increased pressure could cause fracturing of the formation or in the heater well that would allow fluid to unexpectedly be in communication with an opening from the formation. In some circumstances, the increased pressure may exceed a deformation pressure of the heater. Deformation of the heater may also be caused by the expansion of material from the rich layers against the heater. Deformation may also be caused by pressure buildup from gases trapped at an interface of expanded material and a heater. The trapped gases may increase in pressure due to heating, cracking, and/or pyrolysis. Deformation of the heater may cause the heater to shut down or fail. Thus, the expansion of material in rich layers may need to be reduced and/or deformation of a heater in the opening may need to be inhibited so that the heater operates properly.

A significant amount of the expansion of rich layers tends to occur during early stages of heating (e.g., often within the first 15 days or 30 days of heating at a heat injection rate of about 820 watts/meter). Typically, a majority of the expansion occurs below about 200° C. in the near wellbore region. For example, a 0.189 L/kg hydrocarbon containing layer will expand about 5 cm up to about 200° C. depending on factors such as, but not limited to, heating rate, formation stresses, and wellbore diameter. Methods for compensating for the expansion of rich layers of a formation may be focused on in the early stages of an in situ process. The amount of expansion during or after heating of the formation may be estimated or determined before heating of the formation begins. Thus, allowances may be made to compensate for the thermal expansion of rich layers and/or lean layers in the formation. The amount of expansion caused by heating of the formation may be estimated based on factors such as, but not limited to, measured or estimated richness of layers in the formation, thermal conductivity of layers in the formation, thermal expansion coefficients (e.g., linear thermal expansion coefficient) of layers in the formation, formation stresses, and expected temperature of layers in the formation.

Figure 51:
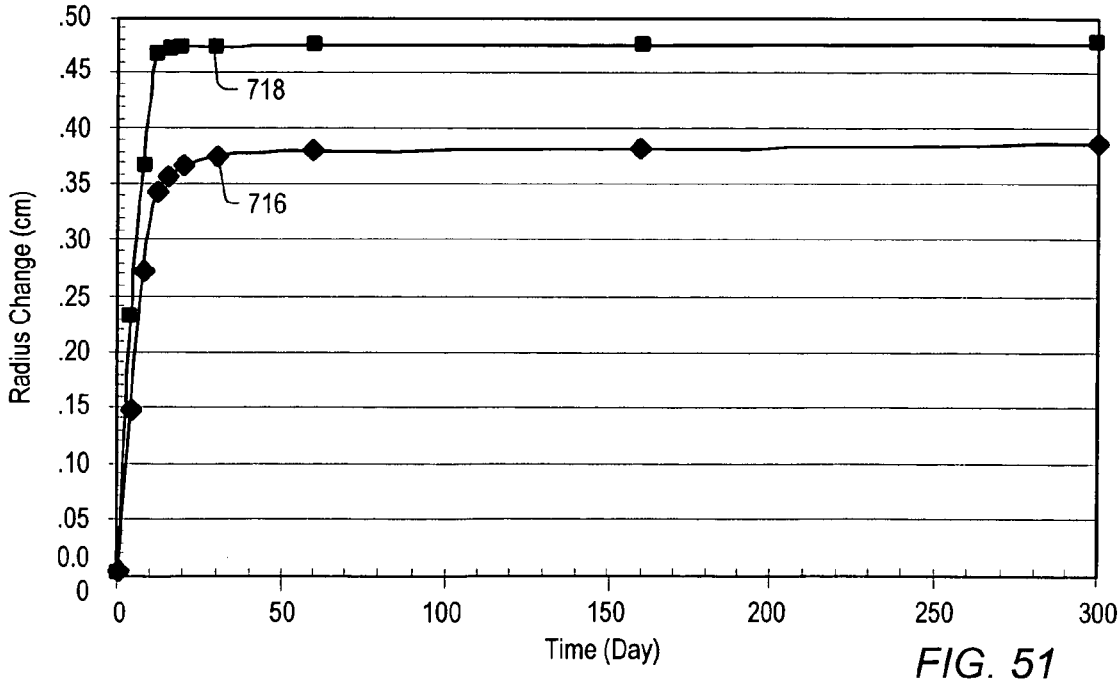
FIG. 51 depicts simulations of wellbore radius change versus time for heating of an oil shale.
Figure 52:
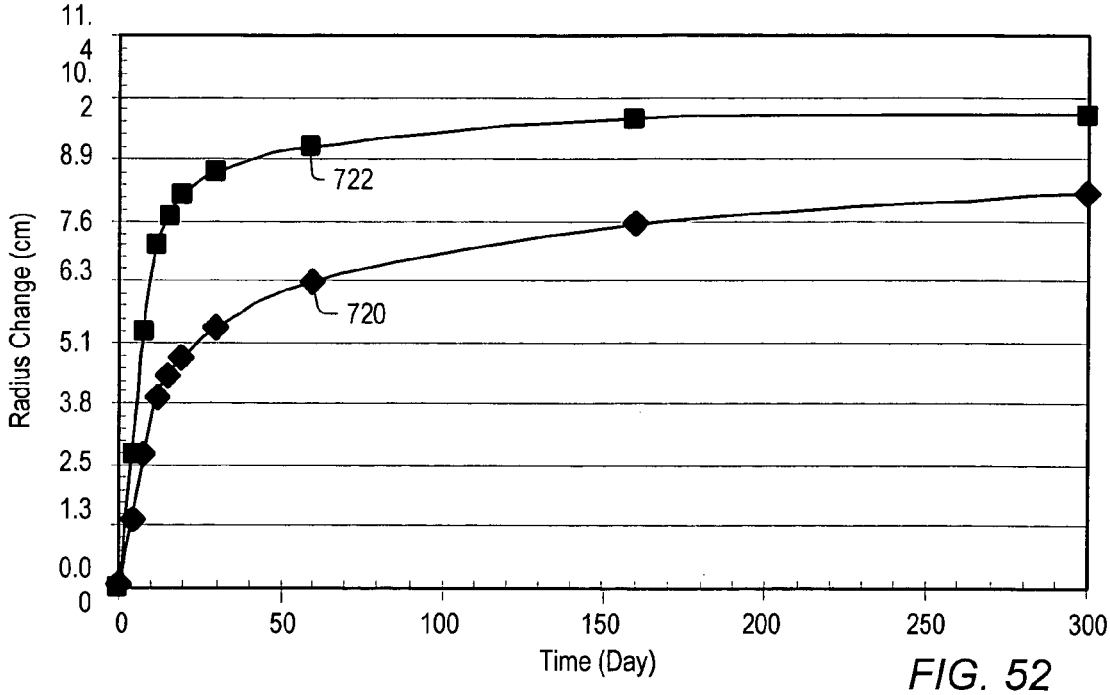
FIG. 52 depicts calculations of wellbore radius change versus time for heating of an oil shale in an open wellbore.

FIG. 51 depicts simulations (using a reservoir simulator (STARS) and a mechanical simulator (ABAQUS)) of wellbore radius change versus time for heating of a 20 gal/ton oil shale (0.084 L/kg oil shale) in an open wellbore for a heat output of 820 watts/meter (plot 716) and a heat output of 1150 watts/meter (plot 718). As shown in FIG. 51, the maximum expansion of a 20 gal/ton oil shale increases from about 0.38 cm to about 0.48 cm for increased heat output from 820 watts/meter to 1150 watts/meter. FIG. 52 depicts calculations of wellbore radius change versus time for heating of a 50 gal/ton oil shale (0.21 L/kg oil shale) in an open wellbore for a heat output of 820 watts/meter (plot 720) and a heat output of 1150 watts/meter (plot 722). As shown in FIG. 52, the maximum expansion of a 50 gal/ton oil shale increases from about 8.2 cm to about 10 cm for increased heat output from 820 watts/meter to 1150 watts/meter. Thus, the expansion of the formation depends on the richness of the formation, or layers of the formation, and the heat output to the formation.

In one embodiment, opening 640 may have a larger diameter to inhibit closing off of the annulus after expansion of rich layers 712, (as depicted in FIG. 49). A typical opening may have a diameter of about 16.5 cm. In certain embodiments, heater 714 may have a diameter of about 7.3 cm. Thus, about 4.6 cm of expansion of rich layers 712 will close off the annulus. If the diameter of opening 640 is increased to about 30 cm, then about 11.3 cm of expansion would be needed to close off the annulus. The diameter of opening 640 may be chosen to allow for a certain amount of expansion of rich layers 712. In some embodiments, a diameter of opening 640 may be greater than about 20 cm, greater than about 30 cm, or greater than about 40 cm. Larger openings or wellbores also may increase the amount of heat transferred from the heater to the formation by radiation. Radiative heat transfer may be more efficient for transfer of heat in the opening. The amount of expansion expected from rich layers 712 may be estimated based on richness of the layers. The diameter of opening 640 may be selected to allow for the maximum expansion expected from a rich layer so that a minimum space between a heater and the formation is maintained after expansion. Maintaining a minimum space between a heater and the formation may inhibit deformation of the heater caused by the expansion of material into the opening. In an embodiment, a desired minimum space between a heater and the formation after expansion may be at least about 0.25 cm, 0.5 cm, or 1 cm. In some embodiments, a minimum space may be at least about 1.25 cm or at least about 1.5 cm, and may range up to about 3 cm, about 4 cm, or about 5 cm.

Figure 53:
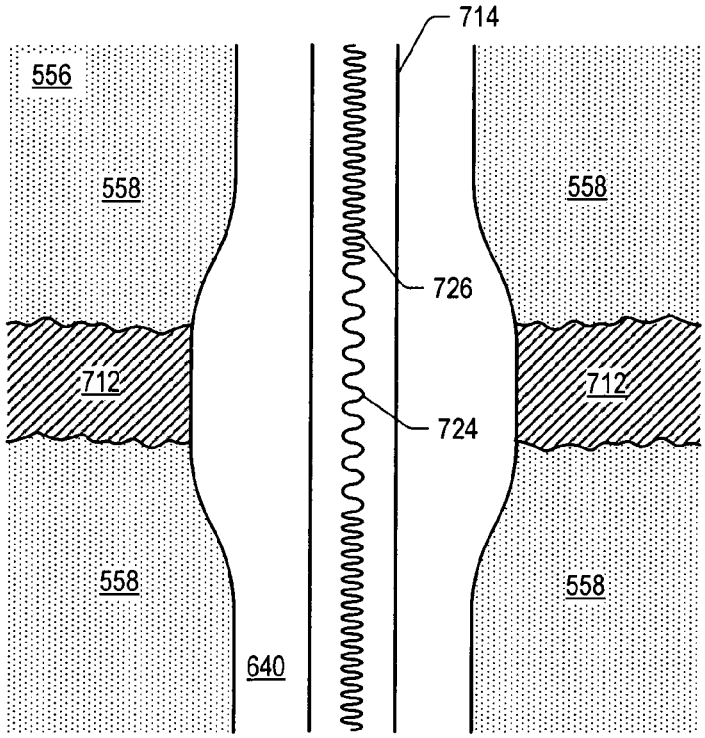
FIG. 53 depicts an embodiment of a heater in an open wellbore of a hydrocarbon containing formation with an expanded wellbore proximate a rich layer.

In some embodiments, opening 640 may be expanded proximate rich layers 712, as depicted in FIG. 53, to maintain a minimum space between a heater and the formation after expansion of the rich layers. Opening 640 may be expanded proximate rich layers by underreaming of the opening. For example, an eccentric drill bit, an expanding drill bit, or high-pressure water jet with abrasive particles may be used to expand an opening proximate rich layers. Opening 640 may be expanded beyond the edges of rich layers 712 so that some material from lean layers 558 is also removed. Expanding opening 640 with overlap into lean layers 558 may further allow for expansion and/or any possible indeterminations in the depth or size of a rich layer.

In another embodiment, heater 714 may include sections 724 that provide less heat output proximate rich layers 712 than sections 726 that provide heat to lean layers 558, as shown in FIG. 53. Section 724 may provide less heat output to rich layers 712 so that the rich layers are heated at a lower rate than lean layers 558. Providing less heat to rich layers 712 will reduce the wellbore temperature proximate the rich layers, thus reducing the total expansion of the rich layers. In an embodiment, heat output of sections 724 may be about one half of heat output from sections 726. In some embodiments, heat output of sections 724 may be less than about three quarters, less than about one half, or less than about one third of heat output of sections 726. Generally, a heating rate of rich layers 712 may be lowered to a heat output that limits the expansion of rich layers 712 so that a minimum space between heater 714 and rich layers 712 in opening 640 is maintained after expansion. Heat output from heater 714 may be controlled to provide lower heat output proximate rich layers. In some embodiments, heater 714 may be constructed or modified to provide lower heat output proximate rich layers. Examples of such heaters include heaters with temperature limiting characteristics, such as Curie temperature heaters, tailored heaters with less resistive sections proximate rich layers, etc.

In some embodiments, opening 640 may be reopened after expansion of rich layers 712 (e.g., after about 15 to 30 days of heating at 820 Watts/m). Material from rich layers 712 may be allowed to expand into opening 640 during heating of the formation with heater 714, as shown in FIG. 50. After expansion of material into opening 640, an annulus of the opening may be reopened, as shown in FIG. 49. Reopening the annulus of opening 640 may include over washing the opening after expansion with a drill bit or any other method used to remove material that has expanded into the opening.

In certain embodiments, pressure tubes (e.g., capillary pressure tubes) may be coupled to the heater at varying depths to assess if and/or when material from the formation has expanded and sealed the annulus. In some embodiments, comparisons of the pressures at varying depths may be used to determine when an opening should be reopened. In certain embodiments, an optical sensor (e.g., a fiber optic cable) may be employed that detects stresses from formation material that has expanded against a heater or conduit. Such optical sensors may utilize Brillioun scattering to simultaneously measure a stress profile and a temperature profile. These measurements may be used to control the heater temperature (e.g., reduce the heater temperature at or near locations of high stress) to inhibit deformation of the heater or conduit due to stresses from expanded formation material.

In certain embodiments, rich layers 712 and/or lean layers 558 may be perforated. Perforating rich layers 712 and/or lean layers 558 may allow expansion of material in these layers and inhibit or reduce expansion into opening 640. Small holes may be formed in rich layers 712 and/or lean layers 558 using perforation equipment (e.g., bullet or jet perforation). Such holes may be formed in both cased wellbores and open wellbores. These small holes may have diameters less than about 1 cm, less than about 2 cm, or less than about 3 cm. In some embodiments, larger holes may also be formed. These holes may be designed to provide, or allow, space for the formation to expand. The holes may also weaken the rock matrix of a formation so that if the formation does expand, the formation will exert less force. In some embodiments, the formation may be fractured instead of using a perforation gun.

Figure 54:
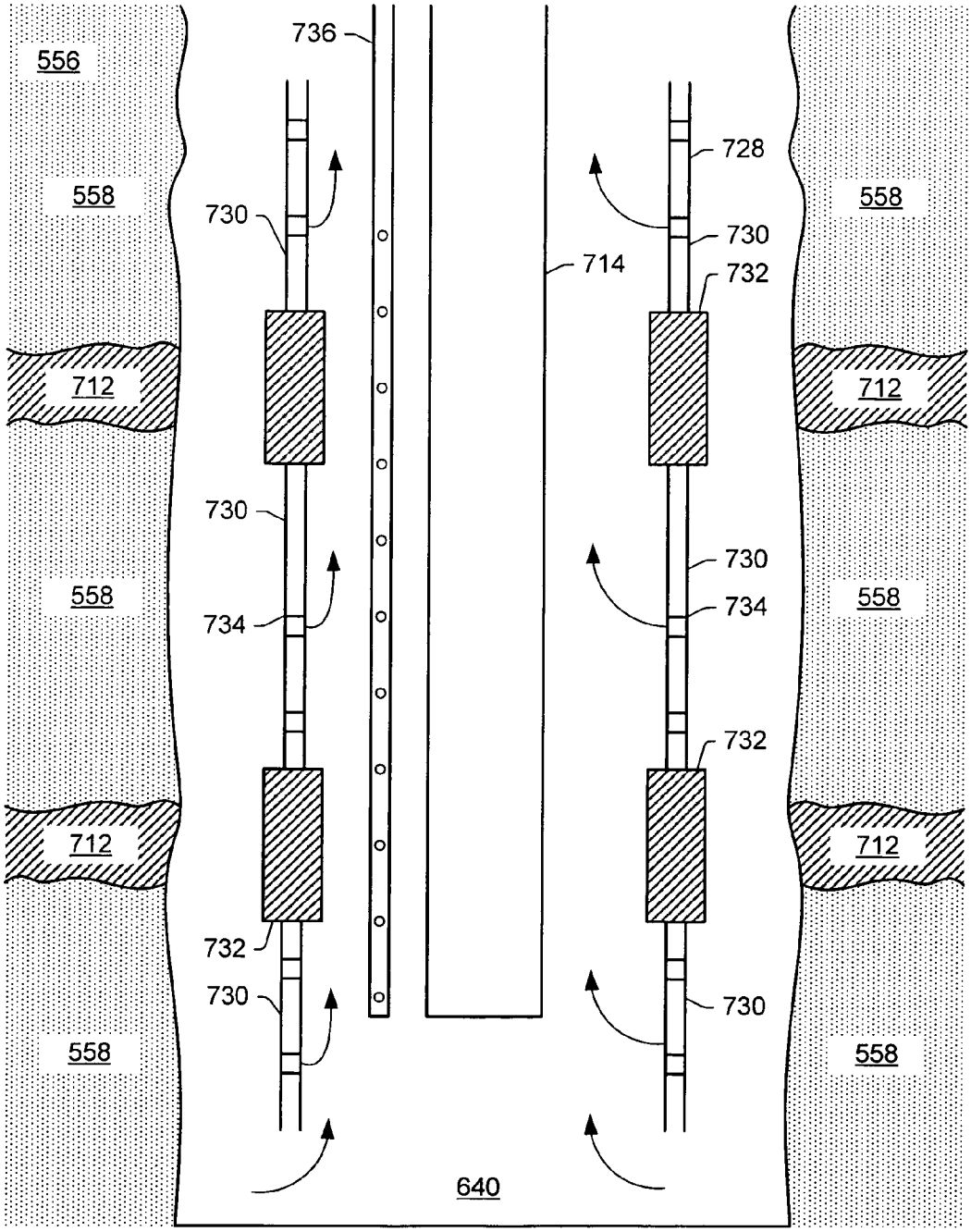
FIG. 54 depicts an embodiment of a heater in an open wellbore with a liner placed in the opening.

In certain embodiments, a liner or casing may be placed in an open wellbore to inhibit collapse of the wellbore during heating of the formation. FIG. 54 depicts an embodiment of a heater in an open wellbore with a liner placed in the opening. Liner 728 may be placed in opening 640 in hydrocarbon layer 556. Liner 728 may include first sections 730 and second sections 732. First sections 730 may be located proximate lean layers 558. Second sections 732 may be located proximate rich layers 712. Second sections 732 may be thicker than first sections 730. Additionally, second sections 732 may be made of a stronger material than first sections 730.

In one embodiment, first sections 730 are carbon steel with a thickness of about 2 cm and second sections 732 are Haynes® HR-120® (available from Haynes International Inc. (Kokomo, Ind.)) with a thickness of about 4 cm. The thicknesses of first sections 730 and second sections 732 may be varied between about 0.5 cm and about 10 cm. The thicknesses of first sections 730 and second sections 732 may be selected based upon factors such as, but not limited to, a diameter of opening 640, a desired thermal transfer rate from heater 714 to hydrocarbon layer 556, and/or a mechanical strength required to inhibit collapse of liner 728. Other materials may also be used for first sections 730 and second sections 732. For example, first sections 730 may include, but may not be limited to, carbon steel, stainless steel, aluminum, etc. Second sections 732 may include, but may not be limited to, 304H stainless steel, 316H stainless steel, 347H stainless steel, Incoloy® alloy 800H or Incoloy® alloy 800HT (both available from Special Metals Co. (New Hartford, N.Y.)), Inconel® 625, etc.

Figure 55:
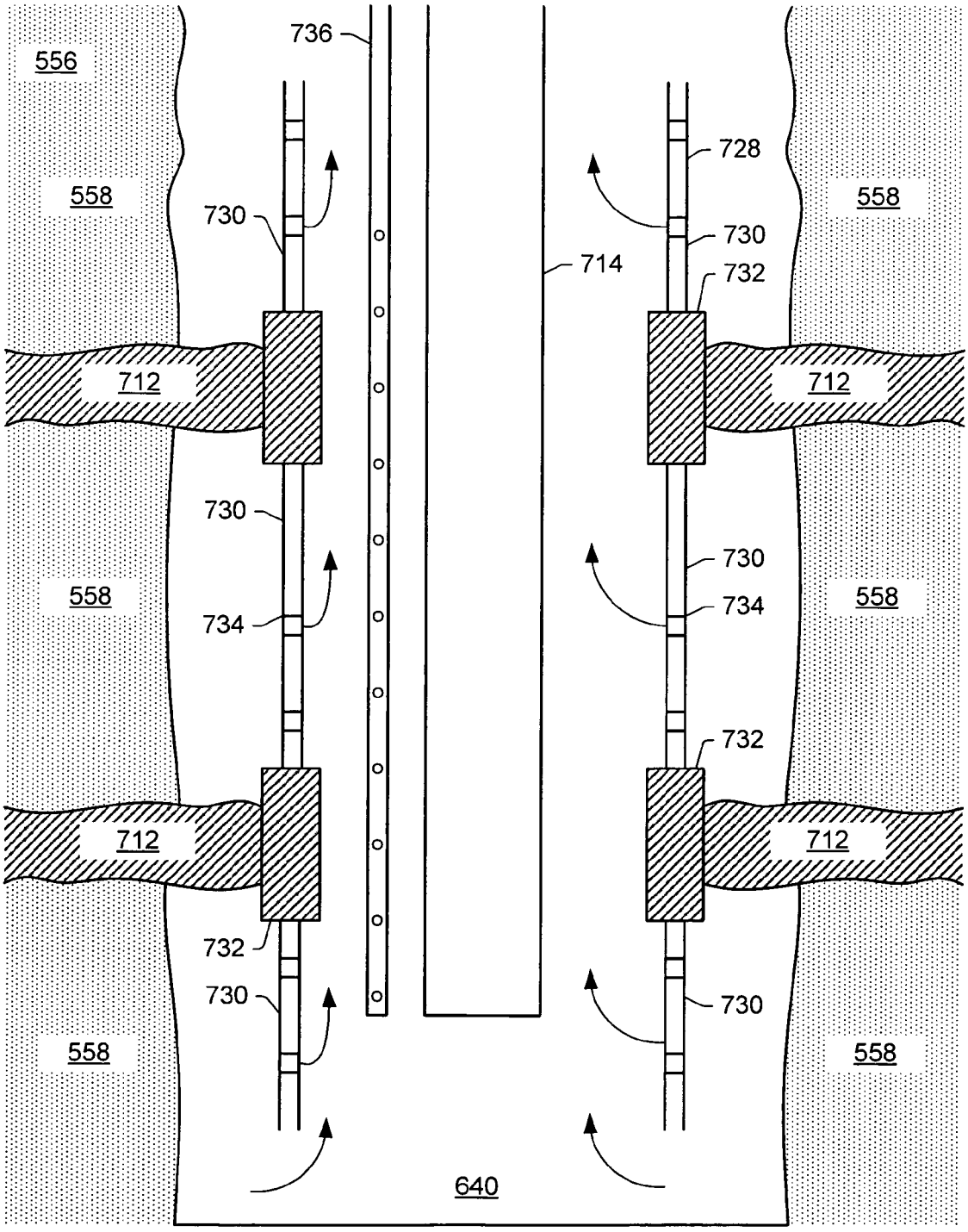
FIG. 55 depicts an embodiment of a heater in an open wellbore with a liner placed in the opening and the formation expanded against the liner.

FIG. 55 depicts an embodiment of a heater in an open wellbore with a liner placed in the opening and the formation expanded against the liner. Second sections 732 may inhibit material from rich layers 712 from closing off an annulus of opening 640 (between liner 728 and heater 714) during heating of the formation. Second sections 732 may have a sufficient strength to inhibit or slow down the expansion of material from rich layers 712. One or more openings 734 may be placed in liner 728 to allow fluids to flow from the annulus between liner 728 and the walls of opening 640 into the annulus between the liner and heater 714. Thus, liner 728 may maintain an open annulus between the liner and heater 714 during expansion of rich layers 712 so that fluids can continue to flow through the annulus. Maintaining a fluid path in opening 640 may inhibit a buildup of pressure in the opening. Second sections 732 may also inhibit closing off of the annulus between liner 728 and heater 714 so that hot spot formation is inhibited, thus allowing the heater to operate properly.

In some embodiments, conduit 736 may be placed inside opening 640 as shown in FIGS. 54 and 55. Conduit 736 may include one or more openings for providing a fluid to opening 640. In an embodiment, steam may be provided to opening 640. The steam may inhibit coking in openings 734 along a length of liner 728 such that openings are not clogged and fluid flow through the openings is maintained. Air may also be supplied through conduit to periodically decoke a plugged opening. In certain embodiments, conduit 736 may be placed inside liner 728. In other embodiments, conduit 736 may be placed outside liner 728. Conduit 736 may also be permanently placed in opening 640 or may be temporarily placed in the opening (e.g., the conduit may be spooled and unspooled into an opening). Conduit 736 may be spooled and unspooled into an opening so that the conduit can be used in more than one opening in a formation.

Figure 56:
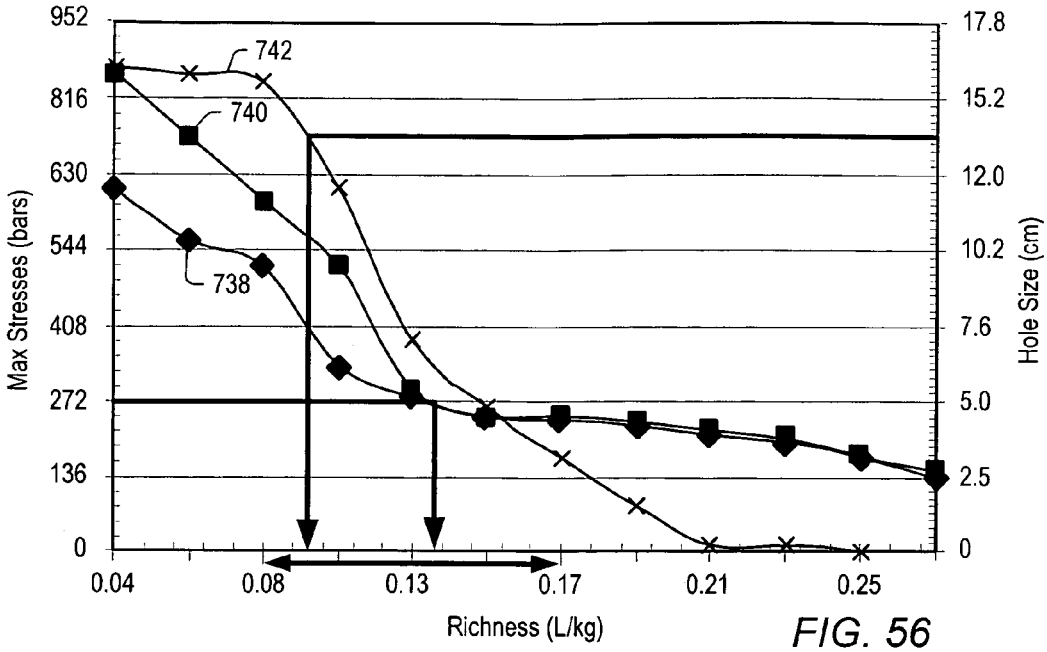
FIG. 56 depicts maximum radial stress, maximum circumferential stress, and hole size after 300 days versus richness for calculations of heating in an open wellbore.

FIG. 56 depicts maximum radial stress 738, maximum circumferential stress 740, and hole size 742 after 300 days versus richness for calculations of heating in an open wellbore. The calculations were done with a reservoir simulator (STARS) and a mechanical simulator (ABAQUS) for a 16.5 cm wellbore with a 14.0 cm liner placed in the wellbore and a heat output from the heater of 820 watts/meter. As shown in FIG. 56, maximum radial stress 738 and maximum circumferential stress 740 decrease with richness. Layers with a richness above about 22.5 gal/ton (0.095 L/kg) may expand to contact the liner. As the richness increases above about 32 gal/ton (0.13 L/kg), the maximum stresses begin to somewhat level out at a value of about 270 bars absolute or below. The liner may have sufficient strength to inhibit deformation at the stresses above richnesses of about 32 gal/ton. Between about 22.5 gal/ton richness and about 32 gal/ton richness, the stresses may be significant enough to deform the liner. Thus, the diameter of the wellbore, the diameter of the liner, the wall thickness and strength of the liner, the heat output, etc. may have to be adjusted so that deformation of the liner is inhibited and an open annulus is maintained in the wellbore for all richnesses of a formation.

Some formation layers may have material characteristics that lead to sloughing in a wellbore. For example, lean clay-rich layers of an oil shale formation may slough when heated. Sloughing is the shedding or casting off of formation material (e.g., rock) into the wellbore. Layers rich in expanding clays (e.g., smectites or illites) may have a high tendency for sloughing. Clays may reduce permeability in lean layers. When heat is rapidly provided to layers with reduced permeability, water and/or other fluids may be unable to escape from the layer. Water and/or other fluids that cannot escape the layer may build up pressure in the layer until the pressure causes a mechanical failure of material. This material failure occurs when the internal pressure exceeds the tensile strength of rock in the layer and produces sloughing.

Sloughing of material in a wellbore may lead to overheating, plugging, equipment deformation, and/or fluid flow problems in the wellbore. Sloughed material may catch or be trapped in or around a heater in a wellbore. For example, sloughed material may get trapped between a heater and the wall of the formation above an expanded rich layer that contacts or approaches the heater. The sloughed material may be loosely packed and have low thermal conductivity. Low thermal conductivity sloughed material may lead to overheating of the heater and/or slow heat transfer to the formation. Sloughed material in a hydrocarbon containing formation (e.g., an oil shale formation) may have an average particle diameter between about 1 mm and about 2.5 cm.

Volumes of a subsurface formation with very low permeability (e.g., about 10 μdarcy or less) may have a tendency to slough. For oil shale, these volumes are typically lean layers with clay contents of about 5% by volume or greater. The clay may be a smectite or illite clay. Material in volumes with very low permeability may rubbilize during heating of the subsurface formation. The rubbilization may be caused by expansion of clay bound water, other clay bound fluids, and/or gases in the rock matrix.

In an embodiment, a permeability of a volume (e.g., a zone) of a subsurface formation may be assessed. In certain embodiments, clay content of a zone of a subsurface formation may be assessed. The volume or zones of assessed permeability and/or clay content may be at or near a wellbore (e.g., within about 1 m of the wellbore). The permeability may be assessed by, for example, Stoneley wave attenuation acoustic logging. Clay content may be assessed by, for example, a pulsed neutron logging system (e.g., RST (Reservoir Saturation Tool) logging from Schlumberger Oilfield Services (Houston, Tex.)). The clay content may be assessed from the difference between density and neutron logs. If the assessment shows that one or more zones near a wellbore have a permeability below a selected value (e.g., about 10 μdarcy, about 20 μdarcy, or about 50 μdarcy) and/or a clay content above a selected value (e.g., about 5% by volume, about 3% by volume, or about 2% by volume), initial heating of the formation at or near the wellbore may be controlled to maintain the heating rate below a selected value. The selected heating rate may vary depending on type of formation, pattern of wellbores in the formation, type of heater used, spacing of wellbores in the formation, or other factors.

Initial heating may be maintained at or below the selected heating rate for a specified length of time. After a certain amount of time, the permeability at or near the wellbores may increase to a value such that sloughing is no longer likely to occur due to slow expansion of gases in the layer. Slower heating rates may allow time for water or other fluids to vaporize and escape a layer, inhibiting rapid pressure buildup in the layer. A slow initial heating rate may allow expanding water vapor and other fluids to create microfractures in the formation instead of wellbore failure as when the formation is heated rapidly. As a heat front moves away from a wellbore, the rate of temperature rise lessens. For example, the rate of temperature rise is typically greatly reduced at distances of about 1 foot (0.3 m) or greater from a wellbore. In certain embodiments, the heating rate of a subsurface formation at or near a wellbore (e.g., within about 1 m of the wellbore, within about 0.5 m of the wellbore, or within about 0.3 m of the wellbore) may be maintained below about 20° C./day for at least about 15 days. In some embodiments, the heating rate of a subsurface formation at or near a wellbore may be maintained below about 10° C./day for at least about 30 days. In some embodiments, the heating rate of a subsurface formation at or near a wellbore may be maintained below about 5° C./day for at least about 60 days. In some embodiments, the heating rate of a subsurface formation at or near a wellbore may be maintained below about 2° C./day for at least about 150 days.

In certain embodiments, a wellbore in a formation that has zones or areas that may lead to sloughing may be pretreated to inhibit sloughing during heating. A wellbore may be treated before a heater is placed in the wellbore. In some embodiments, a wellbore with a selected clay content may be treated with one or more clay stabilizers. For example, clay stabilizers may be added to a brine solution used during formation of a wellbore. Clay stabilizers may include, but are not limited to, lime or other calcium containing materials well known in the oilfield industry. In some embodiments, the use of halogen based clay stabilizers may be limited (or avoided) to reduce (or avoid) corrosion problems with a heater or other equipment used in the wellbore.

In certain embodiments, a wellbore may be treated by providing a controlled explosion in the wellbore. A controlled explosion may be provided along selected lengths or in selected sections of the wellbore. A controlled explosion may be provided by placing a controlled explosive system into a wellbore. A controlled explosion may be implemented by controlling the velocity of vertical propagation (i.e., along the longitudinal length of the wellbore) of the explosion in the wellbore. One example of a controlled explosive system is Primacord® explosive cord available from The Ensign-Bickford Company (Spanish Fork, Utah). A controlled explosive system may be set to explode along the selected lengths or selected sections of a wellbore. The explosive system may be controlled to limit the amount of explosion in the wellbore.

Figure 57:
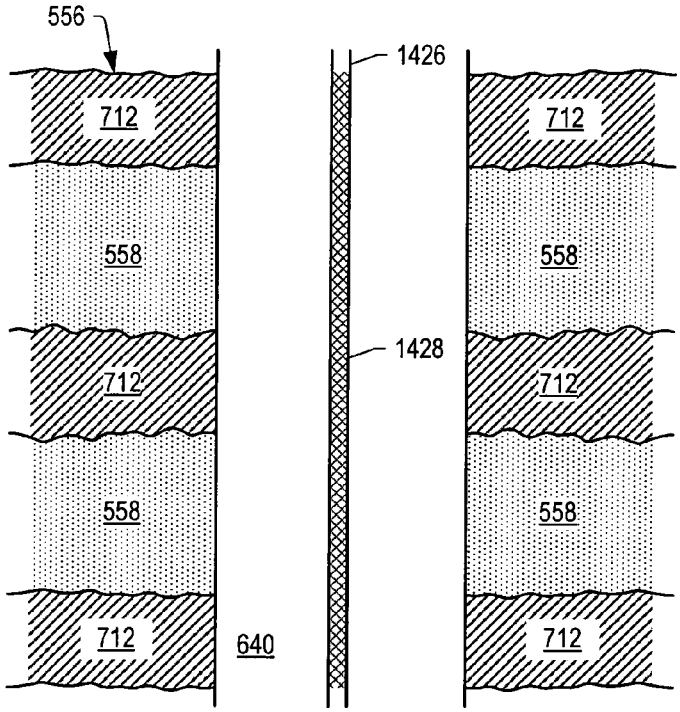
FIG. 57 depicts an embodiment for providing a controlled explosion in an opening.

FIG. 57 depicts an embodiment for providing a controlled explosion in an opening. Opening 640 may be formed in hydrocarbon layer 556. Explosive system 1426 may be placed in opening 640. In an embodiment, explosive system 1426 includes Primacord®. In certain embodiments, explosive system 1426 may have explosive section 1428. In some embodiments, explosive section 1428 may be located proximate layers with a relatively high clay content and/or layers with very low permeability that are to be heated (e.g., lean layers 558). Explosive section 1428 may be controllably exploded at or near the wellbore.

Figure 58:
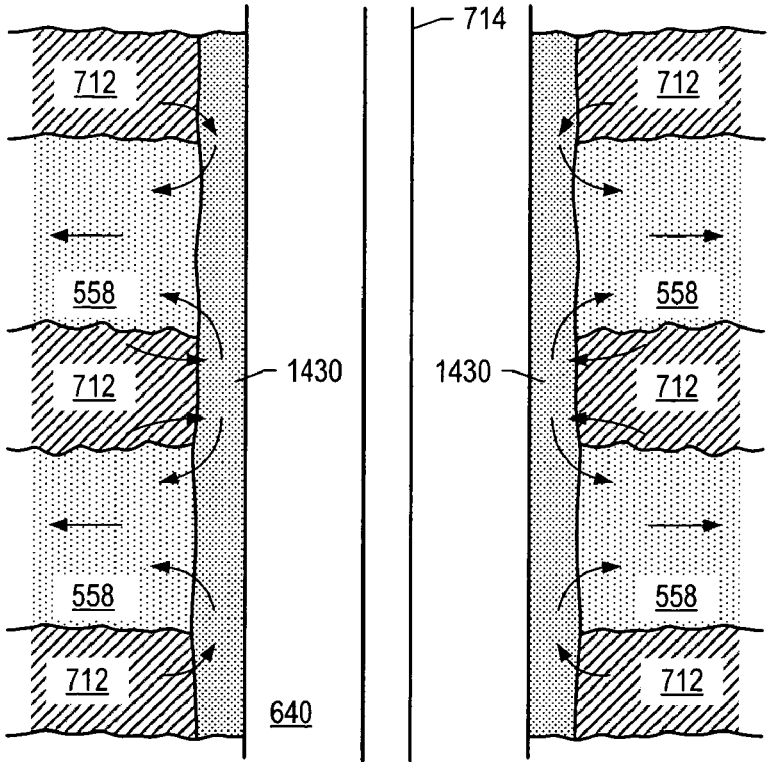
FIG. 58 depicts an embodiment of an opening after a controlled explosion in the opening.

FIG. 58 depicts an embodiment of an opening after a controlled explosion in the opening. A controlled explosion may increase the permeability of zones 1430. In certain embodiments, zones 1430 may have a width between about 0.1 m and about 2 m (e.g., about 0.3 m) extending outward from the wall of opening 640 into lean layers 558. The permeability of zones 1430 may be increased by microfracturing in the zones. After zones 1430 have been created, heater 714 may be installed in opening 640. In some embodiments, rubble formed by a controlled explosion in opening 640 may be removed (e.g., drilled out) before installing heater 714 in the opening. In some embodiments, opening 640 may be drilled deeper (e.g., drilled beyond a needed length) before initiating a controlled explosion. An overdrilled opening may allow rubble from the explosion to fall into the extra portion (e.g., the bottom) of the opening, and thus inhibit interference of rubble with a heater installed in the opening.

Providing a controlled explosion in a wellbore may create microfracturing and increase permeability in a near wellbore region of the formation. In an embodiment, a controlled explosion may create microfracturing with limited or no rubbilization of material in the formation. The increased permeability may allow gas release in the formation during early stages of heating. The gas release may inhibit buildup of gas pressure in the formation that may cause sloughing of material in the near wellbore region.

In certain embodiments, the increased permeability created by providing a controlled explosion may be advantageous in early stages of heating a formation. As shown by the arrows in FIG. 58, fluids produced in rich layers 712 from heat provided by heater 714 may flow from rich layers to lean layers 558 through zones 1430. An increased permeability of zones 1430 may facilitate flow from rich layers 712 to lean layers 558. Fluids in lean layers 558 may flow to a production wellbore or a lower temperature wellbore for production. This flow pattern may inhibit fluids from being overheated by heater 714. Overheating of fluids by heater 714 may lead to coking in or at opening 640. Zones 1430 may have widths that extend beyond a coking radius from a wall of opening 640 to allow fluids to flow coaxially or parallel to the opening at a distance outside the coking radius. Reducing heating of the fluids may also improve product quality by inhibiting thermal cracking and the production of olefins and other low quality products. More heat may be provided to hydrocarbon layer 556 at a higher rate by heater 714 during early stages of heating because formation fluids flow from zones 1430 and through lean layers 558.

Figure 59:
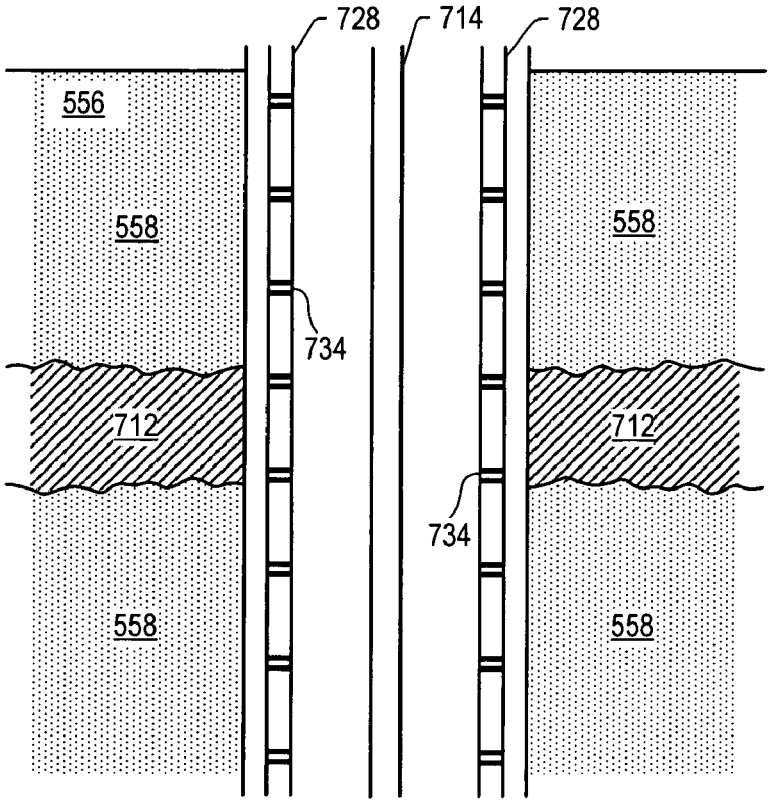
FIG. 59 depicts an embodiment of a liner in an opening.

In certain embodiments, a perforated liner (e.g., a perforated conduit) may be placed in a wellbore outside of a heater to inhibit sloughed material from contacting the heater. FIG. 59 depicts an embodiment of a liner in an opening. In an embodiment, liner 728 may be made of carbon steel or stainless steel. In some embodiments, liner 728 may inhibit expanded material from deforming heater 714. Liner 728 may have a diameter that is only slightly smaller than an initial diameter of opening 640. Liner 728 may have openings 734 that allow fluid to pass through the liner. Openings 734 may be, for example, slots or slits. Openings 734 may be sized so that fluids pass through liner 728 but sloughed material or other particles do not pass through the liner.

In some embodiments, liner 728 is selectively placed at or near layers that may lead to sloughing (e.g., rich layers 712). For example, layers with relatively low permeability (e.g., less than about 10 μdarcy) may lead to sloughing. In certain embodiments, liner 728 may be a screen, a wire mesh or other wire construction, and/or a deformable liner. For example, liner 728 may be an expandable tubular with openings 734. Liner 728 may be expanded with a mandrel or pig after installation of the liner into the opening. Liner 728 may deform or bend when the formation is heated, but sloughed material from the formation may be too large to pass through openings 734 in the liner.

Figure 60:
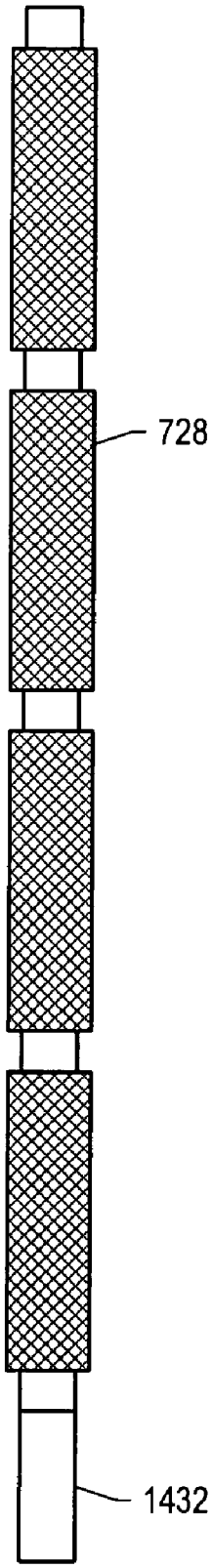
FIG. 60 depicts an embodiment of a liner in a stretched configuration.
Figure 61:
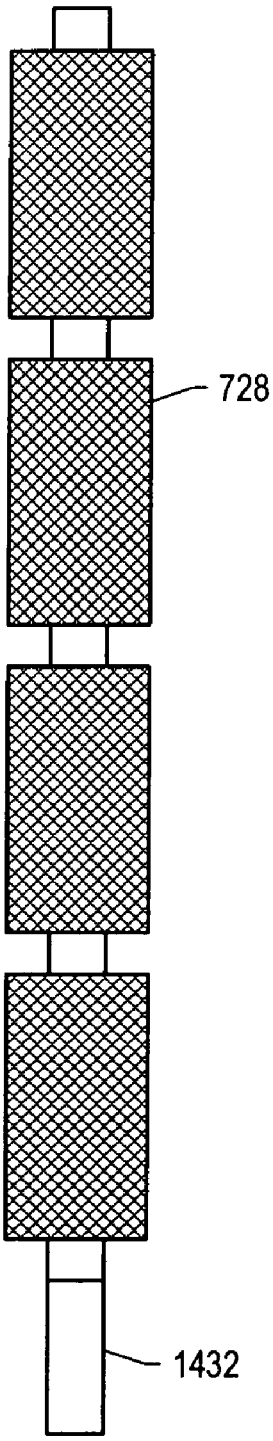
FIG. 61 depicts an embodiment of a liner in an expanded configuration.

In some embodiments, liner 728 may be an expandable screen installed in an opening in a stretched configuration. Liner 728 may be relaxed following installation. FIG. 60 depicts an embodiment of liner 728 in a stretched configuration. Liner 728 may have weight 1432 attached to a bottom of the liner. Weight 1432 may hang freely and provide tension to stretch liner 728. Weight 1432 may stop moving when the weight contacts a bottom surface (e.g., a bottom of an opening). In some embodiments, the weight may be released from the liner. With tension from weight 1432 removed, liner 728 may relax into an expanded configuration, as shown in FIG. 61.

In certain embodiments, a wellbore or opening may be sized such that sloughed material in the wellbore does not inhibit heating in the wellbore. A wellbore and a heater may be sized so that an annulus between the heater and the wellbore is small enough to inhibit particles of a selected size (e.g., a size of sloughed material) from freely moving (e.g., falling due to gravity) in the annulus. In some embodiments, selected portions of the annulus may be sized to inhibit particles from freely falling. In certain embodiments, an annulus between a heater and a wellbore may have a width less than about 2.5 cm, less than about 2 cm, or less than about 1.5 cm.

During early periods of heating a hydrocarbon containing formation, the formation may be susceptible to geomechanical motion. Geomechanical motion in the formation may cause deformation of existing wellbores in a formation. If significant deformation of wellbores occurs in a formation, equipment (e.g., heaters, conduits, etc.) in the wellbores may be deformed and/or damaged.

Figure 63:
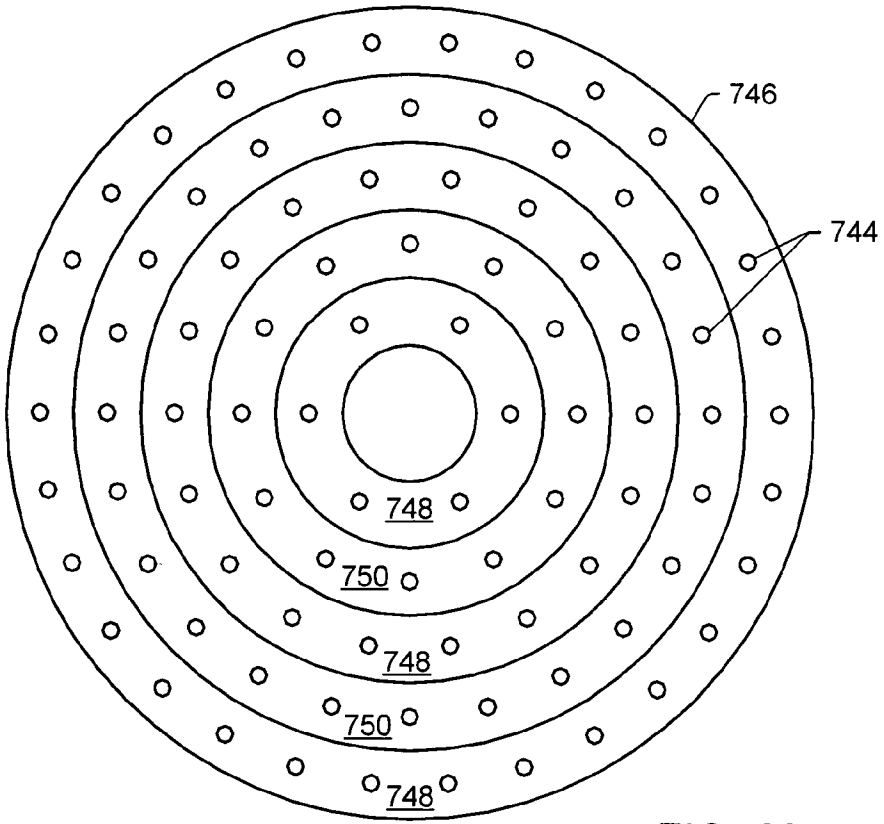
FIG. 63 depicts an embodiment of an aerial view of a pattern of heaters for heating a hydrocarbon containing formation.
Figure 62:
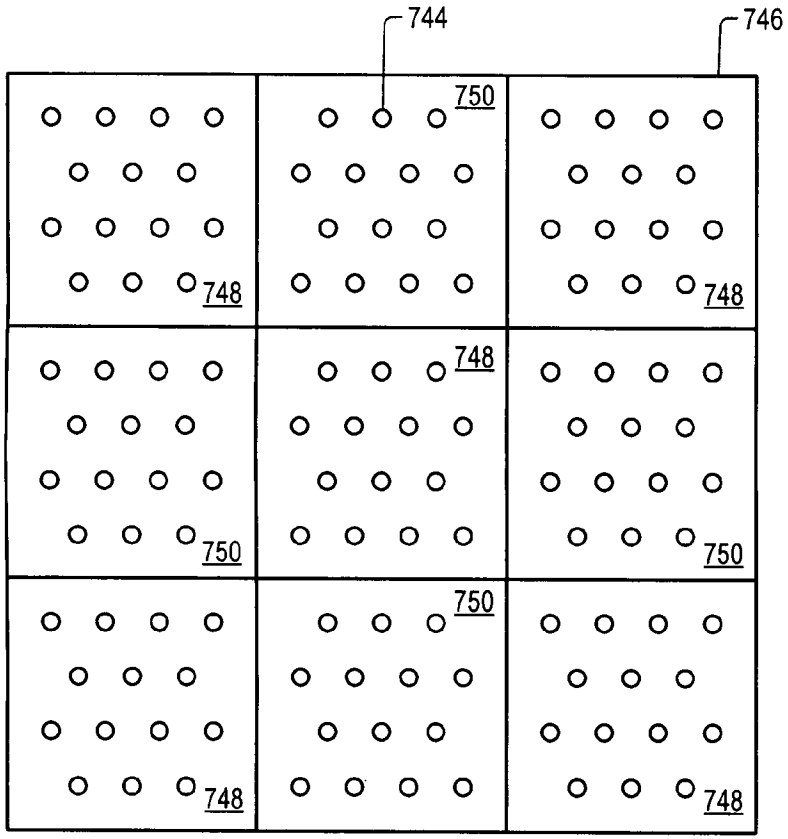
FIG. 62 depicts an embodiment of an aerial view of a pattern of heaters for heating a hydrocarbon containing formation.

Geomechanical motion is typically caused by heat provided from one or more heaters placed in a volume in the formation that results in thermal expansion of the volume. The thermal expansion of a volume may be defined by the equation:

$$\Delta r = r \times \Delta T \times \alpha; \tag{27}$$

where r is the radius of the volume (i.e., r is the length of the longest straight line in a footprint of the volume that has continuous heating, as shown in FIGS. 62 and 63), ΔT is the change in temperature, and α is the linear thermal expansion coefficient.

The amount of geomechanical motion generally increases as more heat is input into the formation. Geomechanical motion in the formation and wellbore deformation tend to increase as larger volumes of the formation are heated at a particular time. Therefore, if the volume heated at a particular time is maintained in selected size limits, the amount of geomechanical motion and wellbore deformation may be maintained below acceptable levels. Also, geomechanical motion in a first treatment area may be limited by heating a second treatment area and a third treatment area on opposite sides of the first treatment area. Geomechanical motion caused by heating the second treatment area may be offset by geomechanical motion caused by heating the third treatment area.

FIG. 62 depicts an embodiment of an aerial view of a pattern of heaters for heating a hydrocarbon containing formation. Heat sources 744 may be placed in formation 746. Heat sources 744 may be placed in a triangular pattern, as depicted in FIG. 62, or any other pattern as desired. Formation 746 may include one or more volumes 748, 750 to be heated. Volumes 748, 750 may be alternating volumes of formation 746 as depicted in FIG. 62. In some embodiments, heat sources 744 in volumes 748, 750 may be turned on, or begin heating, substantially simultaneously (i.e., heat sources 744 may be turned on within days or, in some cases, within 1 or 2 months of each other). Turning on all heat sources 744 in volumes 748, 750 may, however, cause significant amounts of geomechanical motion in formation 746. This geomechanical motion may deform the wellbores of one or more heat sources 744 and/or other wellbores in the formation. The outermost wellbores in formation 746 may be most susceptible to deformation. These wellbores may be more susceptible to deformation because geomechanical motion tends to be a cumulative effect, increasing from the center of a heated volume towards the perimeter of the heated volume.

FIG. 63 depicts an embodiment of an aerial view of another pattern of heaters for heating a hydrocarbon containing formation. Volumes 748, 750 may be concentric rings of volumes, as shown in FIG. 63. Heat sources 744 may be placed in a desired pattern or patterns in volumes 748, 750. In a concentric ring pattern of volumes 748, 750, the geomechanical motion may be reduced in the outer rings of volumes because of the increased circumference of the volumes as the rings move outward.

In other embodiments, volumes 748, 750 may have other footprint shapes and/or be placed in other shaped patterns. For example, volumes 748, 750 may have linear, curved, or irregularly shaped strip footprints. In some embodiments, volumes 750 may separate volumes 748 and thus be used to inhibit geomechanical motion in volumes 748 (i.e., volumes 750 may function as a barrier (e.g., a wall) to reduce the effect of geomechanical motion of one volume 748 on another volume 748).

In certain embodiments, heat sources 744 in volumes 748, 750, as shown in FIGS. 62 and 63, may be turned on at different times to avoid heating large volumes of the formation at one time and/or to reduce the effects of geomechanical motion. In one embodiment, heat sources 744 in volumes 748 may be turned on, or begin heating, at substantially the same time (i.e., within 1 or 2 months of each other). Heat sources 744 in volumes 750 may be turned off while volumes 748 are being heated. Heat sources 744 in volumes 750 may be turned on, or begin heating, a selected time after heat sources 744 in volumes 748 are turned on or begin heating. Providing heat to only volumes 748 for a selected period of time may reduce the effects of geomechanical motion in the formation during a selected period of time. During the selected period of time, some geomechanical motion may take place in volumes 748. The size, as well as shape and/or location, of volumes 748 may be selected to maintain the geomechanical expansion of the formation in these volumes below a maximum value. The maximum value of geomechanical expansion of the formation may be a value selected to inhibit deformation of one or more wellbores beyond a critical value of deformation (i.e., a point at which the wellbores are damaged or equipment in the wellbores is no longer useable).

The size, shape, and/or location of volumes 748 may be determined by simulation, calculation, or any suitable method for estimating the extent of geomechanical motion during heating of the formation. In one embodiment, simulations may be used to determine the amount of geomechanical motion that may take place in heating a volume of a formation to a predetermined temperature. The size of the volume of the formation that is heated to the predetermined temperature may be varied in the simulation until a size of the volume is found that maintains any deformation of a wellbore below a critical value.

Sizes of volumes 748, 750 may be represented by a footprint area on the surface of a volume and the depth of the portion of the formation contained in the volume. The sizes of volumes 748, 750 may be varied by varying footprint areas of the volumes. In an embodiment, the footprints of volumes 748, 750 may be less than about 10,000 square meters, less than about 6000 square meters, less than about 4000 square meters, or less than about 3000 square meters.

Expansion in a formation may be zone, or layer, specific. In some formations, layers or zones of the formation may have different thermal conductivities and/or different thermal expansion coefficients. For example, a hydrocarbon containing formation may have certain thin layers (e.g., layers having a richness above about 0.15 L/kg) that have lower thermal conductivities and higher thermal expansion coefficients than adjacent layers of the formation. The thin layers with low thermal conductivities and high thermal conductivities may lie in different horizontal planes of the formation. The differences in the expansion of thin layers may have to be accounted for in determining the sizes of volumes of the formation that are to be heated. Generally, the largest expansion may be from zones or layers with low thermal conductivities and/or high thermal expansion coefficients. In some embodiments, the size, shape, and/or location of volumes 748, 750 may be determined to accommodate expansion characteristics of low thermal conductivity and/or high thermal expansion layers.

In some embodiments, the size, shape, and/or location of volumes 750 may be selected to inhibit cumulative geomechanical motion from occurring in the formation. In certain embodiments, volumes 750 may have a volume sufficient to inhibit cumulative geomechanical motion from affecting spaced apart volumes 748. In one embodiment, volumes 750 may have a footprint area substantially similar to the footprint area of volumes 748. Having volumes 748, 750 of substantially similar size may establish a uniform heating profile in the formation.

In certain embodiments, heat sources 744 in volumes 750 may be turned on at a selected time after heat sources 744 in volumes 748 have been turned on. Heat sources 744 in volumes 750 may be turned on, or begin heating, within about 6 months (or within about 1 year or about 2 years) from the time heat sources 744 in volumes 748 begin heating. Heat sources 744 in volumes 750 may be turned on after a selected amount of expansion has occurred in volumes 748. In one embodiment, heat sources 744 in volumes 750 are turned on after volumes 748 have geomechanically expanded to or nearly to their maximum possible expansion. For example, heat sources 744 in volumes 750 may be turned on after volumes 748 have geomechanically expanded to greater than about 70%, greater than about 80%, or greater than about 90% of their maximum estimated expansion. The estimated possible expansion of a volume may be determined by a simulation, or other suitable method, as the expansion that will occur in a volume when the volume is heated to a selected average temperature. Simulations may also take into effect strength characteristics of a rock matrix. Strong expansion in a formation occurs up to typically about 200° C. Expansion in the formation is generally much slower from about 200° C. to about 350° C. At temperatures above retorting temperatures, there may be little or no expansion in the formation. In some formations, there may be compaction of the formation above retorting temperatures. The average temperature used to determine estimated expansion may be, for example, a maximum temperature that the volume of the formation is heated to during in situ treatment of the formation (e.g., about 325° C., about 350° C., etc.). Heating volumes 750 after significant expansion of volumes 748 occurs may reduce, inhibit, and/or accommodate the effects of cumulative geomechanical motion in the formation.

In some embodiments, heat sources 744 in volumes 750 may be turned on after heat sources 744 in volumes 748 at a time selected to maintain a relatively constant production rate from the formation. Maintaining a relatively constant production rate from the formation may reduce costs associated with equipment used for producing fluids and/or treating fluids produced from the formation (e.g., purchasing equipment, operating equipment, purchasing raw materials, etc.). In certain embodiments, heat sources 744 in volumes 750 may be turned on after heat sources 744 in volumes 748 at a time selected to enhance a production rate from the formation. Simulations, or other suitable methods, may be used to determine the relative time at which heat sources 744 in volumes 748 and heat sources 744 in volumes 750 are turned on to maintain a production rate, or enhance a production rate, from the formation.

Some embodiments of heaters may include switches (e.g., fuses and/or thermostats) that turn off power to a heater or portions of a heater when a certain condition is reached in the heater. In certain embodiments, a "temperature limited heater" may be used to provide heat to a hydrocarbon containing formation. A temperature limited heater generally refers to a heater that regulates heat output (e.g., reduces heat output) above a specified temperature without the use of external controls such as temperature controllers, power regulators, etc. Temperature limited heaters may be AC (alternating current) or modulated (e.g., "chopped") DC (direct current) electrical resistance heaters.

Temperature limited heaters may be more reliable than other heaters. Temperature limited heaters may be less apt to break down or fail due to hot spots in the formation. In some embodiments, temperature limited heaters may allow for substantially uniform heating of a formation. In some embodiments, temperature limited heaters may be able to heat a formation more efficiently by operating at a higher average temperature along the entire length of the heater. The temperature limited heater may be operated at the higher average temperature along the entire length of the heater because power to the heater does not have to be reduced to the entire heater (e.g., along the entire length of the heater), as is the case with typical heaters, if a temperature along any point of the heater exceeds, or is about to exceed, a maximum operating temperature of the heater. Heat output from portions of a temperature limited heater approaching a Curie temperature of the heater may automatically reduce (e.g., reduce without controlled adjustment of alternating current applied to the heater). The heat output may automatically reduce due to changes in electrical properties (e.g., electrical resistance) of portions of the temperature limited heater. Thus, more power may be supplied to the temperature limited heater during a greater portion of a heating process.

In the context of reduced heat output heating systems, apparatus, and methods, the term "automatically" means such systems, apparatus, and methods function in a certain way without the use of external control (e.g., external controllers such as a controller with a temperature sensor and a feedback loop). For example, a system including temperature limited heaters may initially provide a first heat output, and then provide a reduced amount of heat, near, at, or above a Curie temperature of an electrically resistive portion of the heater when the temperature limited heater is energized by an alternating current or a modulated direct current. A temperature limited heater may be energized by alternating current or modulated direct current supplied at a wellhead (e.g., wellhead 830 depicted in FIGS. 113 and 114). A wellhead may include a power source and other components (e.g., modulation components, transformers, etc.) used in supplying power to a heater.

Temperature limited heaters may be in configurations and/or may include materials that provide automatic temperature limiting properties for the heater at certain temperatures. For example, ferromagnetic materials may be used in temperature limited heater embodiments. Ferromagnetic material may self-limit temperature at or near a Curie temperature of the material to provide a reduced amount of heat at or near the Curie temperature when an alternating current is applied to the material. In certain embodiments, ferromagnetic materials may be coupled with other materials (e.g., non-ferromagnetic materials and/or highly conductive materials such as copper) to provide various electrical and/or mechanical properties. Some parts of a temperature limited heater may have a lower resistance (caused by different geometries and/or by using different ferromagnetic and/or non-ferromagnetic materials) than other parts of the temperature limited heater. Having parts of a temperature limited heater with various materials and/or dimensions may allow for tailoring a desired heat output from each part of the heater. Using ferromagnetic materials in temperature limited heaters may be less expensive and more reliable than using switches in temperature limited heaters.

Curie temperature is the temperature above which a magnetic material (e.g., a ferromagnetic material) loses its magnetic properties. In addition to losing magnetic properties above the Curie temperature, a ferromagnetic material may begin to lose its magnetic properties when an increasing electrical current is passed through the ferromagnetic material.

A heater may include a conductor that operates as a skin effect or proximity effect heater when alternating current or modulated direct current is applied to the conductor. The skin effect limits the depth of current penetration into the interior of the conductor. For ferromagnetic materials, the skin effect is dominated by the magnetic permeability of the conductor. The relative magnetic permeability of ferromagnetic materials is typically greater than 10 and may be greater than 50, 100, 500 or even 1000. As the temperature of the ferromagnetic material is raised above the Curie temperature and/or as an applied electrical current is increased, the magnetic permeability of the ferromagnetic material decreases substantially and the skin depth expands rapidly (e.g., as the inverse square root of the magnetic permeability). The reduction in magnetic permeability results in a decrease in the AC or modulated DC resistance of the conductor near, at, or above the Curie temperature and/or as an applied electrical current is increased. When the heater is powered by a substantially constant current source, portions of the heater that approach, reach, or are above the Curie temperature may have reduced heat dissipation. Sections of the heater that are not at or near the Curie temperature may be dominated by skin effect heating that allows the heater to have high heat dissipation due to a higher resistive load.

In some embodiments, a temperature limited heater (e.g., a Curie temperature heater) may be formed of a paramagnetic material. A paramagnetic material typically has a relative magnetic permeability that is greater than 1 and less than 10. Temperature limiting characteristics of a temperature limited heater formed of paramagnetic material may be significantly less pronounced than temperature limiting characteristics of a temperature limited heater formed of ferromagnetic material.

Curie temperature heaters have been used in soldering equipment, heaters for medical applications, and heating elements for ovens (e.g., pizza ovens). Some of these uses are disclosed in U.S. Pat. No. 5,579,575 to Lamome et al.; U.S. Pat. No. 5,065,501 to Henschen et al.; and U.S. Pat. No. 5,512,732 to Yagnik et al., all of which are incorporated by reference as if fully set forth herein. U.S. Pat. No. 4,849,611 to Whitney et al., which is incorporated by reference as if fully set forth herein, describes a plurality of discrete, spaced-apart heating units including a reactive component, a resistive heating component, and a temperature responsive component.

An advantage of using a temperature limited heater to heat a hydrocarbon containing formation is that the conductor may be chosen to have a Curie temperature in a desired range of temperature operation. The desired operating range may allow substantial heat injection into the formation while maintaining the temperature of the heater, and other equipment, below design temperatures (i.e., below temperatures that will adversely affect properties such as corrosion, creep, and/or deformation). The temperature limiting properties of the heater may inhibit overheating or burnout of the heater adjacent to low thermal conductivity "hot spots" in the formation. In some embodiments, a temperature limited heater may be able to lower or control heat output and/or withstand heat at temperatures above about 25° C., about 37° C., about 100° C., about 250° C., about 500° C., about 700° C., about 800° C., about 900° C., or higher, depending on the materials used in the heater.

A temperature limited heater may allow for more heat injection into a formation than constant wattage heaters because the energy input into the temperature limited heater does not have to be limited to accommodate low thermal conductivity regions adjacent to the heater. For example, in Green River oil shale there is a difference of at least 50% in the thermal conductivity of the lowest richness oil shale layers (less than about 0.04 L/kg) and the highest richness oil shale layers (greater than about 0.20 L/kg). When heating such a formation, substantially more heat may be transferred to the formation with a temperature limited heater than with a heater that is limited by the temperature at low thermal conductivity layers, which may be only about 0.3 m thick. Because heaters for heating hydrocarbon formations typically have long lengths (e.g., greater than 10 m, 100 m, 300 m, 1 km or more), the majority of the length of the heater may be operating below the Curie temperature while only a few portions are at or near the Curie temperature of the heater.

The use of temperature limited heaters may allow for efficient transfer of heat to a formation. The efficient transfer of heat may allow for reduction in time needed to heat a formation to a desired temperature. For example, in Green River oil shale, pyrolysis may require about 9.5 years to about 10 years of heating when using about a 12 m heater well spacing with conventional constant wattage heaters. For the same heater spacing, temperature limited heaters may allow a larger average heat output while maintaining heater equipment temperatures below equipment design limit temperatures. Pyrolysis in a formation may occur at an earlier time with the larger average heat output provided by temperature limited heaters. For example, in Green River oil shale, pyrolysis may occur in about 5 years using temperature limited heaters with about a 12 m heater well spacing. Temperature limited heaters may counteract hot spots due to inaccurate well spacing or drilling where heater wells come too close together. Temperature limited heaters may allow for increased power output over time for heaters that have been spaced too far apart, or limit power output for heaters that are spaced too close together.

Temperature limited heaters may be advantageously used in many other types of hydrocarbon containing formations. For example, in tar sands formations or relatively permeable formations containing heavy hydrocarbons, temperature limited heaters may be used to provide a controllable low temperature output for reducing the viscosity of fluids, mobilizing fluids, and/or enhancing the radial flow of fluids at or near the wellbore or in the formation. Temperature limited heaters may inhibit excess coke formation due to overheating of the near wellbore region of the formation.

The use of temperature limited heaters may eliminate or reduce the need to perform temperature logging and/or the need to use fixed thermocouples on the heaters to monitor potential overheating at hot spots. The temperature limited heater may eliminate or reduce the need for expensive temperature control circuitry.

A temperature limited heater may be deformation tolerant if localized movement of a wellbore results in lateral stresses on the heater that could deform its shape. Locations along a length of a heater at which the wellbore approaches or closes on the heater may be hot spots where a standard heater overheats and has the potential to burn out. These hot spots may lower the yield strength and creep strength of the metal, allowing crushing or deformation of the heater. The temperature limited heater may be formed with S curves (or other non-linear shapes) that accommodate deformation of the temperature limited heater without causing failure of the heater.

In some embodiments, temperature limited heaters may be more economical to manufacture or make than standard heaters. Typical ferromagnetic materials include iron, carbon steel, or ferritic stainless steel. Such materials may be inexpensive as compared to nickel-based heating alloys (such as nichrome, Kanthal, etc.) typically used in insulated conductor heaters. In one embodiment of a temperature limited heater, the heater may be manufactured in continuous lengths as an insulated conductor heater (e.g., a mineral insulated cable) to lower costs and improve reliability.

In some embodiments, a temperature limited heater may be placed in a heater well using a coiled tubing rig. A heater that can be coiled on a spool may be manufactured by using metal such as ferritic stainless steel (e.g., 409 stainless steel) that is welded using electrical resistance welding (ERW). To form a heater section, a metal strip from a roll is passed through a first former where it is shaped into a tubular and then longitudinally welded using ERW. The tubular is passed through a second former where a conductive strip (e.g., a copper strip) is applied, drawn down tightly on the tubular through a die, and longitudinally welded using ERW. A sheath may be formed by longitudinally welding a support material (e.g., steel such as 347H or 347HH) over the conductive strip material. The support material may be a strip rolled over the conductive strip material. An overburden section of the heater may be formed in a similar manner. In certain embodiments, the overburden section uses a non-ferromagnetic material such as 304 stainless steel or 316 stainless steel instead of a ferromagnetic material. The heater section and overburden section may be coupled together using standard techniques such as butt welding using an orbital welder. In some embodiments, the overburden section material (i.e., the non-ferromagnetic material) may be pre-welded to the ferromagnetic material before rolling. The pre-welding may eliminate the need for a separate coupling (i.e., butt welding) step. In an embodiment, a flexible cable (e.g., a furnace cable such as a MGT 1000 furnace cable) may be pulled through the center after forming the tubular heater. An end bushing on the flexible cable may be welded to the tubular heater to provide an electrical current return path. The tubular heater, including the flexible cable, may be coiled onto a spool before installation into a heater well. In an embodiment, a temperature limited heater may be installed using a coiled tubing rig. The coiled tubing rig may place the temperature limited heater in a deformation resistant container in a formation. The deformation resistant container may be placed in the heater well using conventional methods.

In an embodiment, a Curie heater includes a furnace cable inside a ferromagnetic conduit (e.g., a ¾" Schedule 80 446 stainless steel pipe). The ferromagnetic conduit may be clad with copper or another suitable conductive material. The ferromagnetic conduit may be placed in a deformation-tolerant conduit or deformation resistant container. The deformation-tolerant conduit may tolerate longitudinal deformation, radial deformation, and creep. The deformation-tolerant conduit may also support the ferromagnetic conduit and furnace cable. The deformation-tolerant conduit may be selected based on creep and/or corrosion resistance near or at the Curie temperature. In one embodiment, the deformation-tolerant conduit may be 1½" Schedule 80 347H stainless steel pipe (outside diameter of about 4.826 cm) or 1½" Schedule 160 347H stainless steel pipe (outside diameter of about 4.826 cm). The diameter and/or materials of the deformation-tolerant conduit may vary depending on, for example, characteristics of the formation to be heated or desired heat output characteristics of the heater. In certain embodiments, air may be removed from the annulus between the deformation-tolerant conduit and the clad ferromagnetic conduit. The space between the deformation-tolerant conduit and the clad ferromagnetic conduit may be flushed with a pressurized inert gas (e.g., helium, nitrogen, argon, or mixtures thereof). In some embodiments, the inert gas may include a small amount of hydrogen to act as a "getter" for residual oxygen. The inert gas may pass down the annulus from the surface, enter the inner diameter of the ferromagnetic conduit through a small hole near the bottom of the heater, and flow up inside the ferromagnetic conduit. Removal of the air in the annulus may reduce oxidation of materials in the heater (e.g., the nickel-coated copper wires of the furnace cable) to provide a longer life heater, especially at elevated temperatures. Thermal conduction between a furnace cable and the ferromagnetic conduit, and between the ferromagnetic conduit and the deformation-tolerant conduit, may be improved when the inert gas is helium. The pressurized inert gas in the annular space may also provide additional support for the deformation-tolerant conduit against high formation pressures.

In certain embodiments, a thermally conductive fluid (e.g., helium) may be placed inside a temperature limited heater to improve thermal conduction inside the heater. A thermally conductive fluid may be a fluid that has a higher thermal conductivity than air at 1 atm and a temperature of a heater (e.g., a temperature in an annulus of the heater). A thermally conductive fluid may include, but is not limited to, gases that are thermally conductive, electrically insulating, and radiantly transparent. For example, a thermally conductive fluid may include helium and/or hydrogen. Radiantly transparent gases may include gases with diatomic or single atoms that do not absorb a significant amount of infrared energy. A thermally conductive fluid may also be thermally stable. For example, a thermally conductive fluid may not thermally crack and form unwanted residue (e.g., coke from thermal cracking of methane).

A thermally conductive fluid may be placed inside a conductor, inside a conduit, and/or inside a jacket of a temperature limited heater. The thermally conductive fluid may be placed in a space between one or more components (e.g., conductor, conduit, jacket) of a temperature limited heater (i.e., in one or more annuli of the heater). In some embodiments, a thermally conductive fluid may be placed in a space between a temperature limited heater and a conduit (e.g., in the annulus between a deformation-tolerant conduit and the heater).

In certain embodiments, air and/or other fluid in a space (e.g., an annulus) may be displaced by a flow of a thermally conductive fluid during introduction of the thermally conductive fluid into the space. In some embodiments, air and/or other fluid may be removed (e.g., vacuumed or pumped out) from a space before introducing a thermally conductive fluid in the space. The thermally conductive fluid may be introduced in a specific volume and/or to a selected pressure in the space. A thermally conductive fluid may be introduced such that the space has at least a minimum volume percentage of thermally conductive fluid above a selected value. In certain embodiments, the space may have at least about 50% by volume of the thermally conductive fluid. In some embodiments, the space may have at least about 75% by volume or at least about 90% by volume of the thermally conductive fluid. Reducing the percentage of air in the space may also reduce the rate of oxidation of heater components in the space.

Placing a thermally conductive fluid inside a space of a temperature limited heater may increase thermal heat transfer in the space. The increased thermal heat transfer is caused by reducing a resistance to heat transfer in the space with the thermally conductive fluid. Reducing the resistance to heat transfer in the space may allow for increased power output from the heater to a subsurface formation. Reducing the resistance to heat transfer inside a space with a thermally conductive fluid may allow for smaller diameter electrical conductors (e.g., a smaller diameter inner conductor), a larger outer radius (e.g., a larger radius of a conduit or a jacket), and/or an increased annulus space width. Reducing the diameter of electrical conductors may reduce material costs. Increasing the outer radius of a conduit or a jacket and/or increasing the annulus space width may provide additional annular space. Additional annular space may accommodate deformation of the conduit and/or jacket without causing heater failure. Increasing the outer radius of a conduit or a jacket and/or increasing the annulus space width may provide additional annular space to protect components in the annulus (e.g., spacers and/or conduits).

As the annular width of a heater is increased, however, greater heat transfer is needed across the annular space to maintain good heat output properties for the heater. In some embodiments, especially for low temperature heaters, radiative heat transfer may be minimally effective in transferring heat across the annular space of the heater. Conductive heat transfer in the annular space may be important in such embodiments to maintain good heat output properties for the heater. A thermally conductive fluid may provide increased heat transfer across the annular space.

Calculations may be made to determine the effect of a thermally conductive fluid in an annulus of a heater. The equations below (EQNS. 28-38) may be used to relate a heater center rod temperature in a heated section to a conduit temperature adjacent to the heater center rod. In an example, the heater center rod is a 347H stainless steel tube with outer radius b. The conduit is also made of 347H stainless steel and has inner radius R. The center heater rod and the conduit are at uniform temperatures $T_H$ and $T_C$, respectively. $T_C$ is maintained constant and a constant heat rate, Q, per unit length is supplied to the center heater rod. $T_H$ is the value at which the rate of heat per unit length transferred to the conduit by conduction and radiation balances the rate of heat generated, Q. Conduction across the gap between the center heater rod and inner surface of the conduit may be assumed to take place in parallel with radiation across the gap. For simplicity, radiation across the gap is assumed to be radiation across a vacuum. The equations are thus:

$$Q=Q_C+Q_R; \tag{28}$$

where $Q_C$ and $Q_R$ represent the conductive and radiative components of the heat flux across the gap. Denoting the inner radius of the conduit by R, conductive heat transport satisfies the equation:

$$Q_c = -2\pi r k_g \frac{dT}{dr};\ b \le r \le R; \tag{29}$$

subject to the boundary conditions:

$$T(\mathrm{b})=T_H;\ T(R)=T_C. \tag{30}$$

The thermal conductivity of the gas in the gap, $k_g$, is well described by the equation:

$$k_g=a_g+b_gT \tag{31}$$

Substituting EQN. 31 into EQN. 29 and integrating subject to the boundary conditions in EQN. 30 gives:

$$\frac{Q_c}{2\pi}\ln(R/b) = k_g^{(eff)}(T_H - T_C); \tag{32}$$

with $$k_g^{(eff)} = a_g + \frac{1}{2}b_g(T_H + T_C). \tag{33}$$

The rate of radiative heat transport across the gap per unit length, $Q_R$, is given by:

$$Q_R = 2\pi\sigma b\epsilon_R\epsilon_{bR}\{T_H^4 - T_C^4\}; \tag{34}$$

$$\text{where } \epsilon_{bR} = \epsilon_b/\{\epsilon_R + (b/R)\epsilon_b(1-\epsilon_R)\}. \tag{35}$$

In EQNS. 33 and 34, $\epsilon_b$ and $\epsilon_R$ denote the emissivities of the center heater rod and inner surface of the conduit, respectively, and $\sigma$ is the Stefan-Boltzmann constant.

Substituting EQNS. 32 and 34 back into EQN. 28, and rearranging gives:

$$\frac{Q}{2\pi} = \frac{k_g^{eff}(T_H - T_C)}{\ln(R/b)} + \sigma b\varepsilon_R\varepsilon_{bR}\{T_H^4 - T_C^4\}. \tag{36}$$

To solve EQN. 36, t is denoted as the ratio of radiative to conductive heat flux across the gap:

$$t = \frac{\sigma b\varepsilon_R\varepsilon_{bR}\{T_H^2 - T_C^2\}(T_H - T_C)\ln(R/b)}{k_g^{(eff)}} \tag{37}$$

Then EQN. 36 can be written in the form:

$$\frac{Q}{2\pi} = \frac{k_g^{eff}(T_H - T_C)}{\ln(R/b)}\{1 + t\}. \tag{38}$$

EQNS 38 and 36 may be solved iteratively for $T_H$ given Q and $T_C$. The numerical values of the parameters $\sigma$, $a_g$, and $b_g$ are given in TABLE 11. A list of heater dimensions are given in TABLE 12. The emissivities $\epsilon_S$ and $\epsilon_a$ may be taken to be in the range 0.4-0.8.

TABLE 11

Material Parameters Used in the Calculations

| Parameter | $\sigma$ | $a_g$ (air) | $b_g$ (air) | $a_g$ (He) | $b_g$ (He) |
|---|---|---|---|---|---|
| Unit | $Wm^{-2}K^{-4}$ | $Wm^{-1}K^{-1}$ | $Wm^{-1}K^{-2}$ | $Wm^{-1}K^{-1}$ | $Wm^{-1}K^{-2}$ |
| Value | $5.67 \times 10^{-8}$ | 0.01274 | $5.493 \times 10^{-5}$ | 0.07522 | $2.741 \times 10^{-4}$ |

TABLE 12

Set of Heater Dimensions

| Dimension | Inches | Meters |
|---|---|---|
| Heater rod outer radius b | ½ × 0.75 | $9.525 \times 10^{-3}$ |
| Conduit inner radius R | ½ × 1.771 | $2.249 \times 10^{-2}$ |

Figure 64:
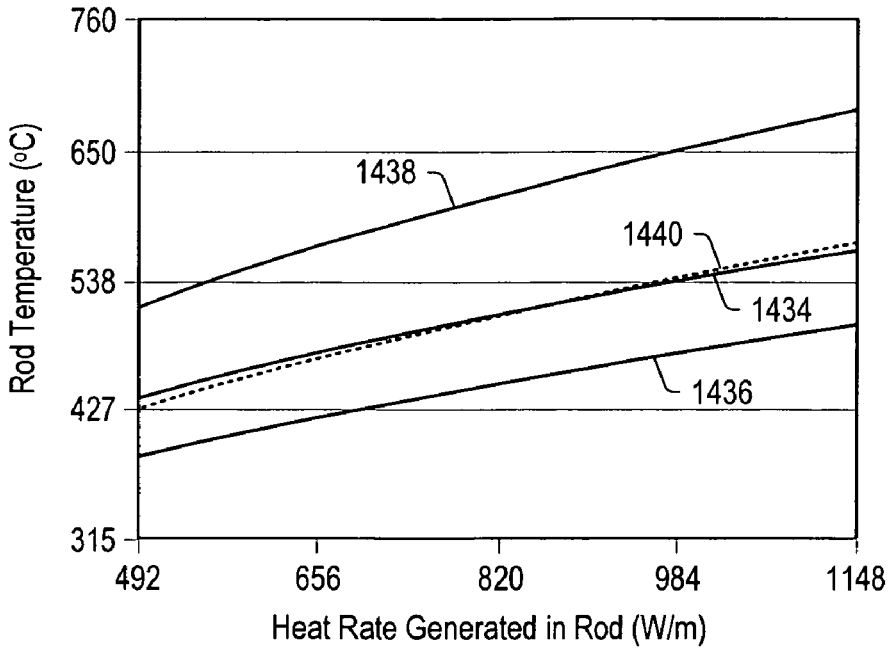
FIG. 64 shows heater rod temperature as a function of the power generated within a rod.
Figure 65:
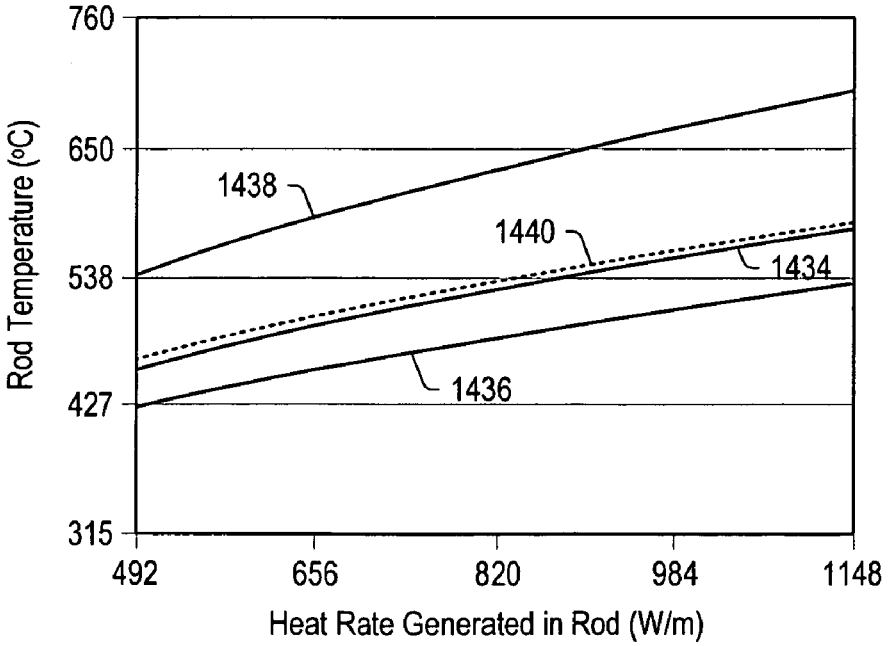
FIG. 65 shows heater rod temperature as a function of the power generated within a rod.
Figure 66:
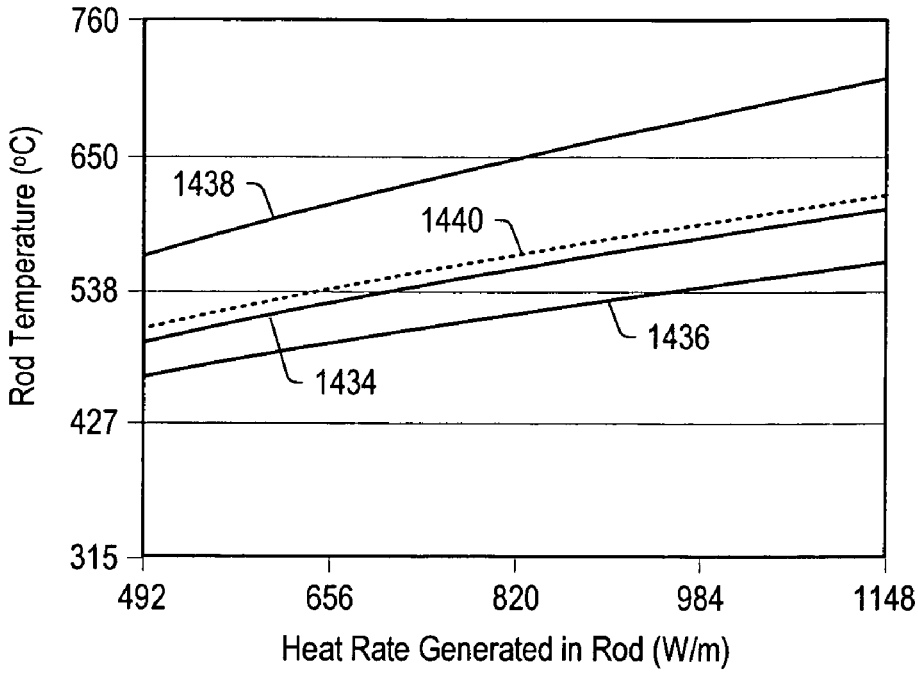
FIG. 66 shows heater rod temperature as a function of the power generated within a rod.
Figure 67:
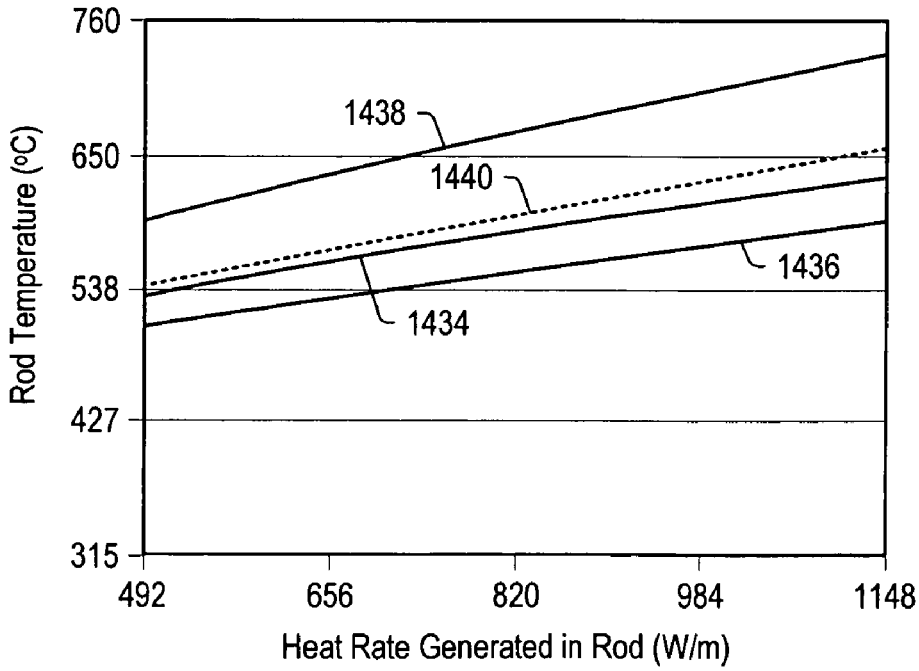
FIG. 67 shows heater rod temperature as a function of the power generated within a rod.
Figure 68:
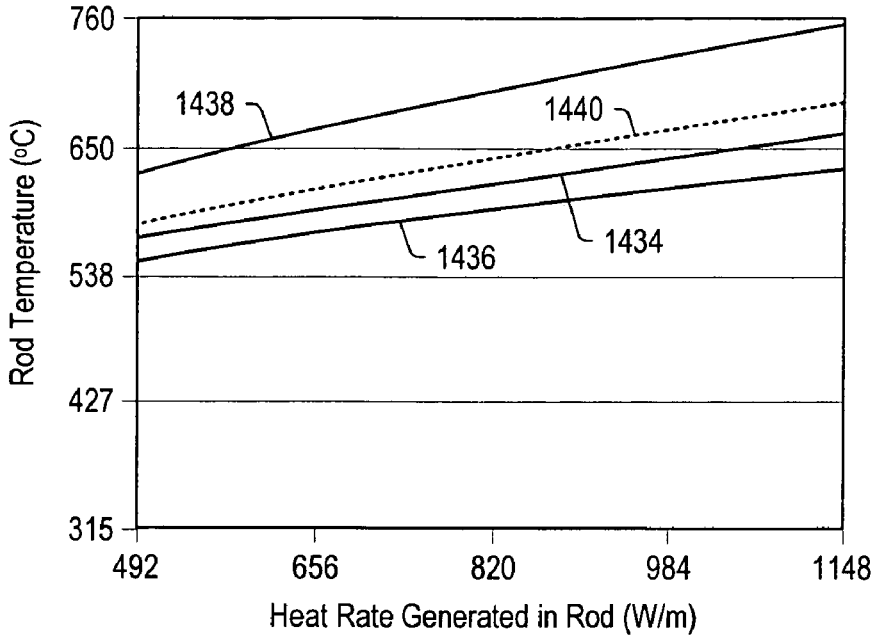
FIG. 68 shows heater rod temperature as a function of the power generated within a rod.
Figure 69:
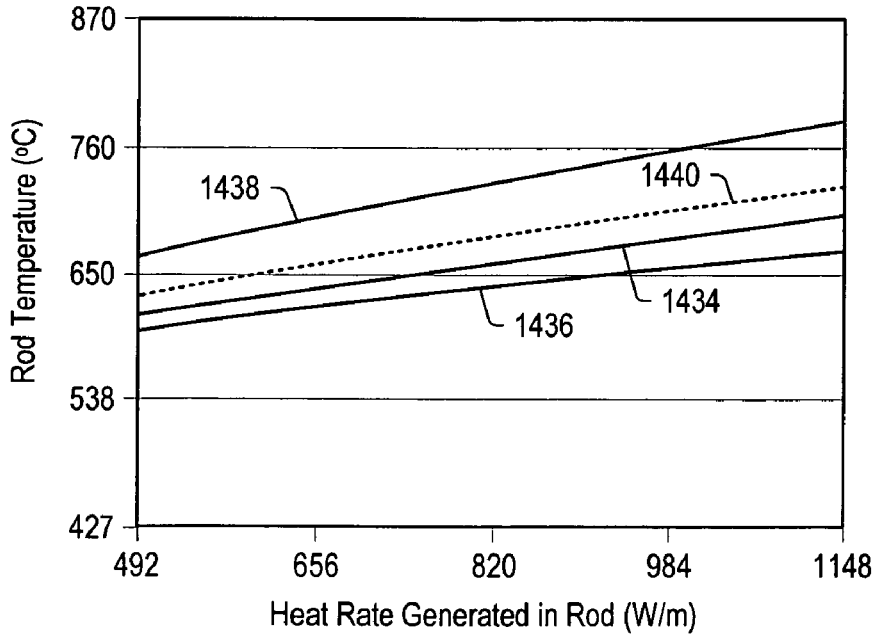
FIG. 69 shows heater rod temperature as a function of the power generated within a rod.
Figure 70:
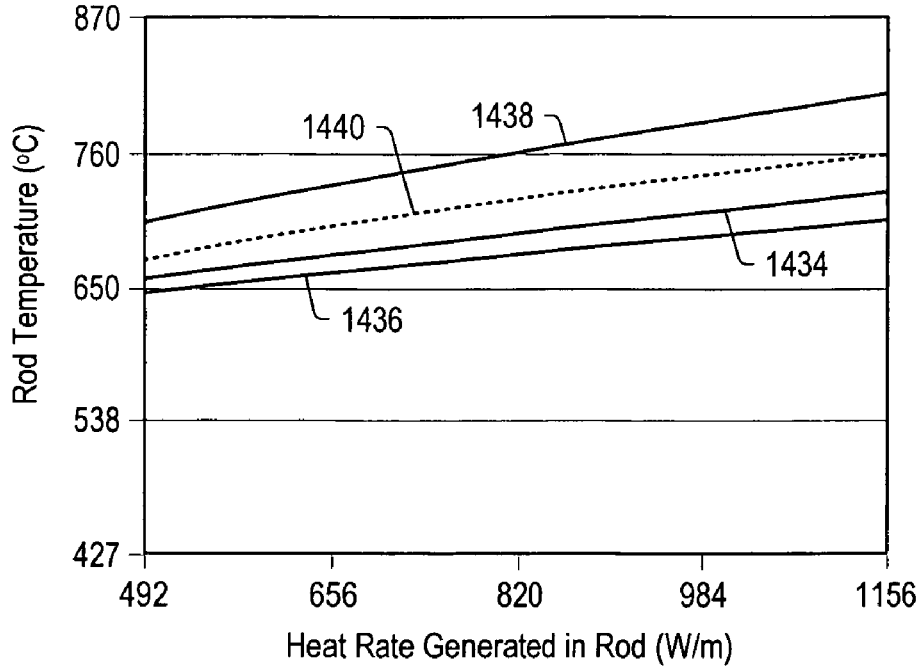
FIG. 70 shows heater rod temperature as a function of the power generated within a rod.
Figure 71:
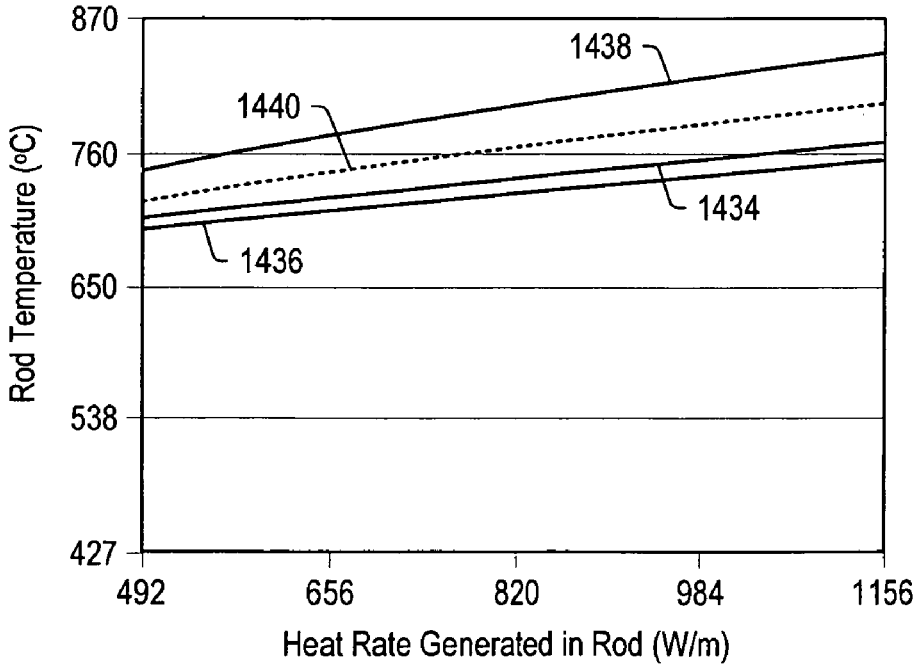
FIG. 71 shows heater rod temperature as a function of the power generated within a rod.
Figure 72:
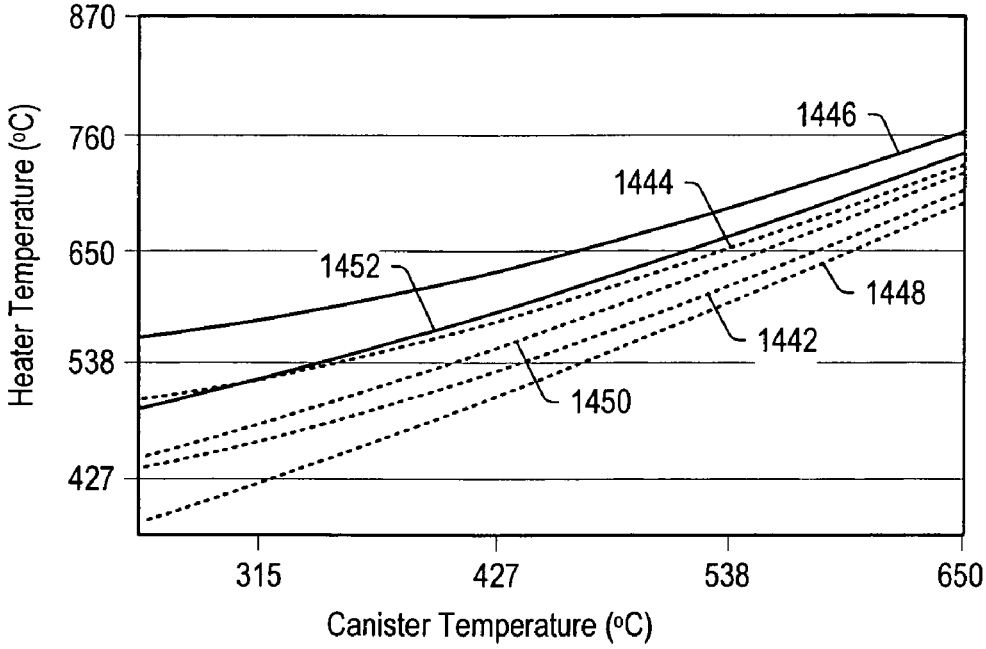
FIG. 72 shows a plot of center heater rod temperature versus conduit temperature for various heater powers with air or helium in the annulus.
Figure 73:
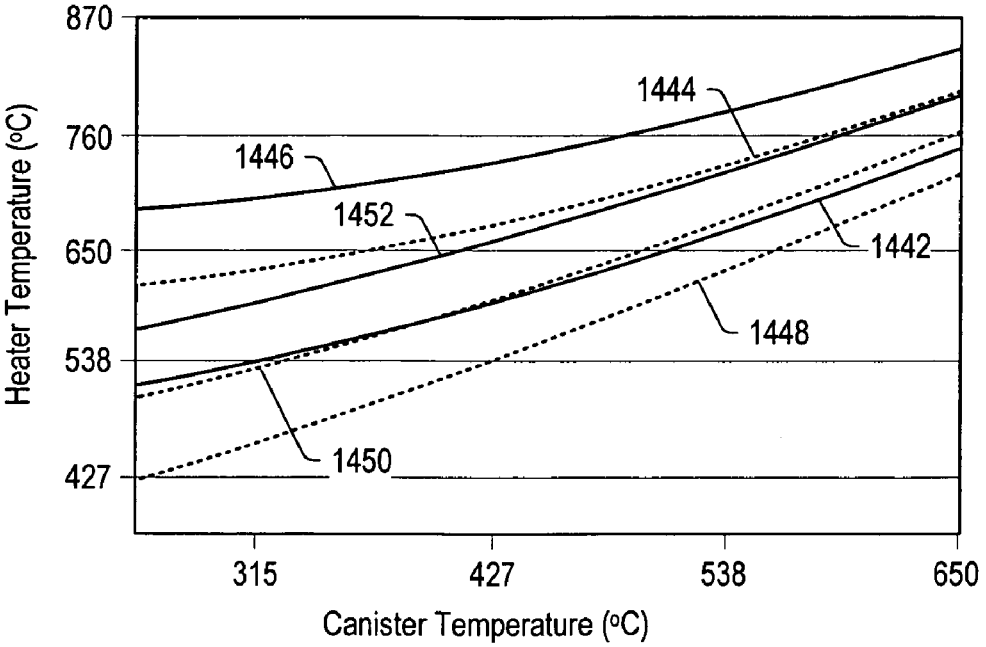
FIG. 73 shows a plot of center heater rod temperature versus conduit temperature for various heater powers with air or helium in the annulus.

FIG. 64 shows heater rod temperature as a function of the power generated within a rod for a base case in which both the rod and conduit emissivities were 0.8, and a low emissivity case in which the rod emissivity was lowered to 0.4. The conduit temperature was set at 500° F. (260° C.). Cases in which the annular space is filled with air and with helium are compared in FIG. 64. Plot 1434 is for the base case in air. Plot 1436 is for the base case in helium. Plot 1438 is for the low emissivity case in air. Plot 1440 is for the low emissivity case in helium. FIGS. 65-71 repeat the same cases for conduit temperatures of 600° F. (315° C.) to 1200° F. (649° C.) inclusive, with incremental steps of 100° F. in each figure. Note that the temperature scale in FIGS. 69-71 is offset by 200° F. (93° C.) with respect to the scale in FIGS. 64-68. FIG. 72 shows a plot of center heater rod (with 0.8 emissivity) temperature versus conduit temperature for various heater powers with air or helium in the annulus. FIG. 73 shows a plot of center heater rod (with 0.4 emissivity) temperature versus conduit temperature for various heater powers with air or helium in the annulus. Plots 1442 are for air and a heater power of 500 W/m. Plots 1444 are for air and a heater power of 833 W/m. Plots 1446 are for air and a heater power of 1167 W/m. Plots 1448 are for helium and a heater power of 500 W/m. Plots 1450 are for helium and a heater power of 833 W/m. Plots 1452 are for helium and a heater power of 1167 W/m.

In certain embodiments, a thermally conductive fluid located in a space (e.g., an annulus) may also be electrically insulating to inhibit arcing between conductors in a heater. Arcing across a space or gap may be a problem with longer heaters that require higher operating voltages. Arcing may be a problem with shorter heaters and/or at lower voltages depending on the operating conditions of the heater. Increasing the pressure of a fluid in the space may increase the spark gap breakdown voltage in the space and inhibit arcing across the space.

A pressure of a thermally conductive fluid in a space may be increased to a pressure between about 5 atm and about 500 atm. In an embodiment, the pressure of a thermally conductive fluid may be increased to greater than about 7 atm. In some embodiments, the pressure of a thermally conductive fluid may be increased to greater than about 10 atm. In certain embodiments, the pressure of a thermally conductive fluid needed to inhibit arcing across a space may depend on a temperature in the space. In a space of a heater, electrons may track along surfaces (e.g., insulators) in the space and lead to arcing or electrical degradation of a surface. A high pressure fluid in the space may inhibit electron tracking along surfaces in the space.

Figure 74:
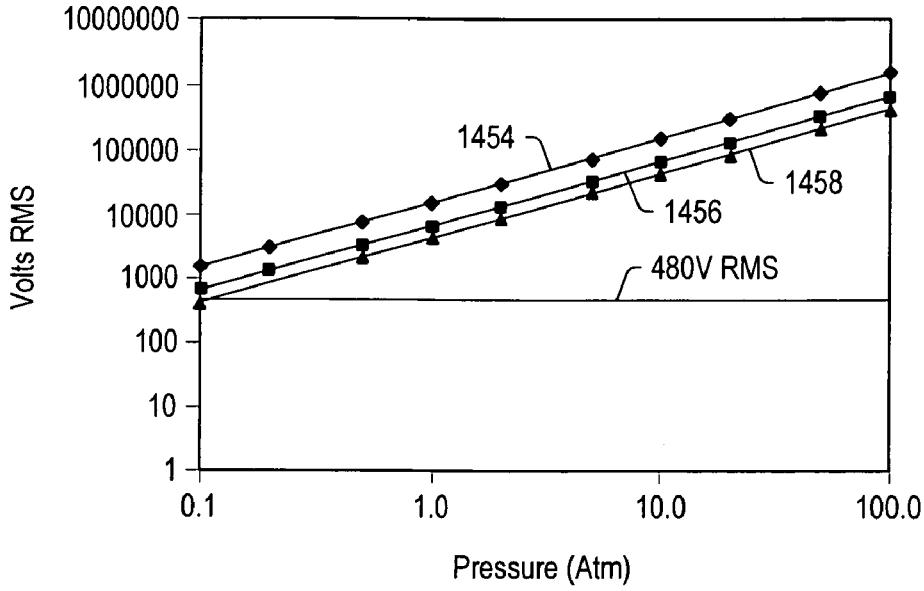
FIG. 74 depicts spark gap breakdown voltages versus pressure at different temperatures for a conductor-in-conduit heater with air in the annulus.
Figure 75:
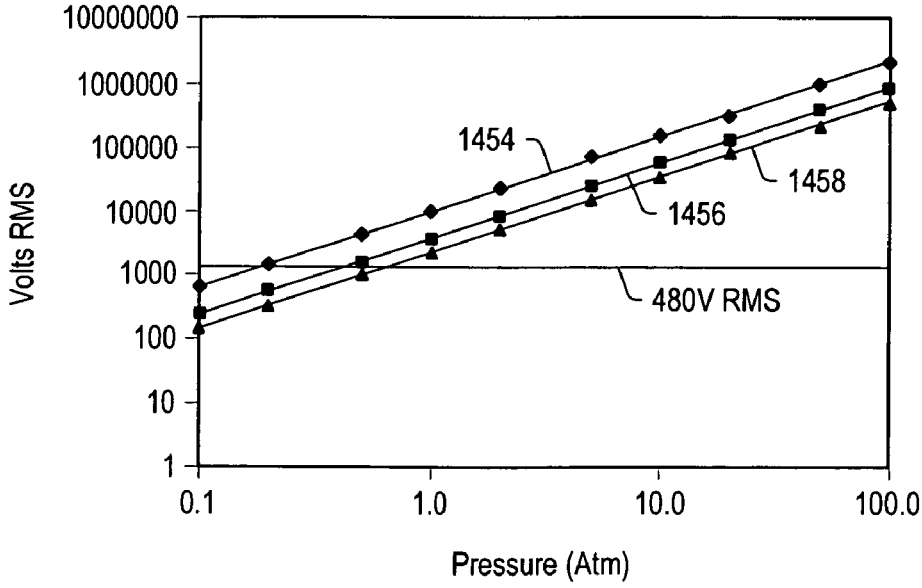
FIG. 75 depicts spark gap breakdown voltages versus pressure at different temperatures for a conductor-in-conduit heater with helium in the annulus.

FIG. 74 depicts spark gap breakdown voltages versus pressure at different temperatures for a conductor-in-conduit heater with air in the annulus. FIG. 75 depicts spark gap breakdown voltages versus pressure at different temperatures for a conductor-in-conduit heater with helium in the annulus. FIGS. 74 and 75 show breakdown voltages for a conductor-in-conduit heater with a 1" (2.5 cm) diameter center conductor and a 3" (7.6 cm) gap to the inner radius of the conduit. Plot 1454 is for a temperature of 300 K. Plot 1456 is for a temperature of 700 K. Plot 1458 is for a temperature of 1050 K. 480 V RMS is shown as a typical applied voltage. FIGS. 74 and 75 show that helium has a spark gap breakdown voltage smaller than the spark gap breakdown voltage for air at 1 atm. Thus, the pressure of helium may need to be increased to achieve spark gap breakdown voltages on the order of breakdown voltages for air.

Temperature limited heaters may be used for heating hydrocarbon formations including, but not limited to, oil shale formations, coal formations, tar sands formations, and heavy viscous oils. Temperature limited heaters may be used for remediation of contaminated soil. Temperature limited heaters may also be used in the field of environmental remediation to vaporize or destroy soil contaminants. Embodiments of temperature limited heaters may be used to heat fluids in a wellbore or sub-sea pipeline to inhibit deposition of paraffin or various hydrates. In some embodiments, a temperature limited heater may be used for solution mining of a subsurface formation (e.g., an oil shale or coal formation). In certain embodiments, a fluid (e.g., molten salt) may be placed in a wellbore and heated with a temperature limited heater to inhibit deformation and/or collapse of the wellbore. In some embodiments, the temperature limited heater may be attached to a sucker rod in the wellbore or be part of the sucker rod itself. In some embodiments, temperature limited heaters may be used to heat a near wellbore region to reduce near wellbore oil viscosity during production of high viscosity crude oils and during transport of high viscosity oils to the surface. In some embodiments, a temperature limited heater may enable gas lifting of a viscous oil by lowering the viscosity of the oil without coking the oil. Temperature limited heaters may be used in sulfur transfer lines to maintain temperatures between about 110° C. and about 130° C.

Certain embodiments of temperature limited heaters may be used in chemical or refinery processes at elevated temperatures that require control in a narrow temperature range to inhibit unwanted chemical reactions or damage from locally elevated temperatures. Some applications may include, but are not limited to, reactor tubes, cokers, and distillation towers. Temperature limited heaters may also be used in pollution control devices (e.g., catalytic converters, and oxidizers) to allow rapid heating to a control temperature without complex temperature control circuitry. Additionally, temperature limited heaters may be used in food processing to avoid damaging food with excessive temperatures. Temperature limited heaters may also be used in the heat treatment of metals (e.g., annealing of weld joints). Temperature limited heaters may also be used in floor heaters, cauterizers, and/or various other appliances. Temperature limited heaters may be used with biopsy needles to destroy tumors by raising temperatures in vivo.

Some embodiments of temperature limited heaters may be useful in certain types of medical and/or veterinary devices. For example, a temperature limited heater may be used to therapeutically treat tissue in a human or an animal. A temperature limited heater for a medical or veterinary device may have ferromagnetic material including a palladium-copper alloy with a Curie temperature of about 50° C. A high frequency (e.g., greater than about 1 MHz) may be used to power a relatively small temperature limited heater for medical and/or veterinary use.

A ferromagnetic alloy used in a Curie temperature heater may determine the Curie temperature of the heater. Curie temperature data for various metals is listed in "American Institute of Physics Handbook," Second Edition, McGraw-Hill, pages 5-170 through 5-176. A ferromagnetic conductor may include one or more of the ferromagnetic elements (iron, cobalt, and nickel) and/or alloys of these elements. In some embodiments, ferromagnetic conductors may include iron-chromium alloys that contain tungsten (e.g., HCM12A and SAVE12 (Sumitomo Metals Co., Japan) and/or iron alloys that contain chromium (e.g., Fe—Cr alloys, Fe—Cr—W alloys, Fe—Cr—V alloys, Fe—Cr—Nb alloys). Of the three main ferromagnetic elements, iron has a Curie temperature of about 770° C.; cobalt has a Curie temperature of about 1131° C.; and nickel has a Curie temperature of about 358° C. An iron-cobalt alloy has a Curie temperature higher than the Curie temperature of iron. For example, an iron alloy with 2% cobalt has a Curie temperature of about 800° C.; an iron alloy with 12% cobalt has a Curie temperature of about 900° C.; and an iron alloy with 20% cobalt has a Curie temperature of about 950° C. An iron-nickel alloy has a Curie temperature lower than the Curie temperature of iron. For example, an iron alloy with 20% nickel has a Curie temperature of about 720° C., and an iron alloy with 60% nickel has a Curie temperature of about 560° C.

Some non-ferromagnetic elements used as alloys may raise the Curie temperature of iron. For example, an iron alloy with 5.9% vanadium has a Curie temperature of about 815° C. Other non-ferromagnetic elements (e.g., carbon, aluminum, copper, silicon, and/or chromium) may be alloyed with iron or other ferromagnetic materials to lower the Curie temperature. Non-ferromagnetic materials that raise the Curie temperature may be combined with non-ferromagnetic materials that lower the Curie temperature and alloyed with iron or other ferromagnetic materials to produce a material with a desired Curie temperature and other desired physical and/or chemical properties. In some embodiments, the Curie temperature material may be a ferrite such as $NiFe_2O_4$. In other embodiments, the Curie temperature material may be a binary compound such as $FeNi_3$ or $Fe_3Al$.

Magnetic properties generally decay as the Curie temperature is approached. The "Handbook of Electrical Heating for Industry" by C. James Erickson (IEEE Press, 1995) shows a typical curve for 1% carbon steel (i.e., steel with 1% carbon by weight). The loss of magnetic permeability starts at temperatures above about 650° C. and tends to be complete when temperatures exceed about 730° C. Thus, the self-limiting temperature may be somewhat below an actual Curie temperature of a ferromagnetic conductor. The skin depth for current flow in 1% carbon steel is about 0.132 cm at room temperature and increases to about 0.445 cm at about 720° C. From about 720° C. to about 730° C., the skin depth sharply increases to over 2.5 cm. Thus, a temperature limited heater embodiment using 1% carbon steel may self-limit between about 650° C. and about 730° C.

Skin depth generally defines an effective penetration depth of alternating current or modulated direct current into a conductive material. In general, current density decreases exponentially with distance from an outer surface to a center along a radius of a conductor. The depth at which the current density is approximately 1/e of the surface current density is called the skin depth. For a solid cylindrical rod with a diameter much greater than the penetration depth, or for hollow cylinders with a wall thickness exceeding the penetration depth, the skin depth, δ, is:

$$\delta=1981.5*((\rho/(\mu*f))^{1/2}; \quad (39)$$

in which:

δ=skin depth in inches;

ρ=resistivity at operating temperature (ohm-cm);

μ=relative magnetic permeability; and f=frequency (Hz).

EQN. 39 is obtained from "Handbook of Electrical Heating for Industry" by C. James Erickson (IEEE Press, 1995). For most metals, resistivity (ρ) increases with temperature. The relative magnetic permeability generally varies with temperature and with current. Additional equations may be used to assess the variance of magnetic permeability and/or skin depth on both temperature and/or current. The dependence of μ on current arises from the dependence of μ on the magnetic field.

Materials used in a temperature limited heater may be selected to provide a desired turndown ratio. A turndown ratio for a temperature limited heater is the ratio of the lowest AC or modulated DC resistance just below the Curie temperature to the highest AC or modulated DC resistance just above the Curie temperature. Turndown ratios of at least 2:1, 3:1, 4:1, 5:1, or greater may be selected for temperature limited heaters. A selected turndown ratio may depend on a number of factors including, but not limited to, the type of formation in which the temperature limited heater is located (e.g., a higher turndown ratio may be used for an oil shale formation with large variations in thermal conductivity between rich and lean oil shale layers) and/or a temperature limit of materials used in the wellbore (e.g., temperature limits of heater materials). In some embodiments, a turndown ratio may be increased by coupling additional copper or another good electrical conductor to a ferromagnetic material (e.g., adding copper to lower the resistance above the Curie temperature).

A temperature limited heater may provide a minimum heat output (i.e., power output) below the Curie temperature of the heater. In certain embodiments, the minimum heat output may be at least about 400 W/m, about 600 W/m, about 700 W/m, about 800 W/m, or higher. The temperature limited heater may reduce the amount of heat output by a section of the heater when the temperature of the section of the heater approaches or is above the Curie temperature. The reduced amount of heat may be substantially less than the heat output below the Curie temperature. In some embodiments, the reduced amount of heat may be less than about 400 W/m, less than about 200 W/m, or may approach 100 W/m or less.

In some embodiments, a temperature limited heater may operate substantially independently of the thermal load on the heater in a certain operating temperature range. "Thermal load" is the rate that heat is transferred from a heating system to its surroundings. It is to be understood that the thermal load may vary with temperature of the surroundings and/or the thermal conductivity of the surroundings. In an embodiment, a temperature limited heater may operate at or above a Curie temperature of the heater such that the operating temperature of the heater does not vary by more than about 1.5° C. for a decrease in thermal load of about 1 W/m proximate to a portion of the heater. In some embodiments, the operating temperature of the heater may not vary by more than about 1° C., or by more than about 0.5° C. for a decrease in thermal load of about 1 W/m.

The AC or modulated DC resistance and/or the heat output of a temperature limited heater may decrease sharply above the Curie temperature due to the Curie effect. In certain embodiments, the value of the electrical resistance or heat output above or near the Curie temperature is less than about one-half of the value of electrical resistance or heat output at a certain point below the Curie temperature. In some embodiments, the heat output above or near the Curie temperature may be less than about 40%, 30%, 20% or less of the heat output at a certain point below the Curie temperature (e.g., about 30° C. below the Curie temperature, about 40° C. below the Curie temperature, about 50° C. below the Curie temperature, or about 100° C. below the Curie temperature). In certain embodiments, the electrical resistance above or near the Curie temperature may decrease to about 80%, 70%, 60%, or 50% of the electrical resistance at a certain point below the Curie temperature (e.g., about 30° C. below the Curie temperature, about 40° C. below the Curie temperature, about 50° C. below the Curie temperature, or about 100° C. below the Curie temperature).

In some embodiments, AC frequency may be adjusted to change the skin depth of a ferromagnetic material. For example, the skin depth of 1% carbon steel at room temperature is about 0.132 cm at 60 Hz, about 0.0762 cm at 180 Hz, and about 0.046 cm at 440 Hz. Since heater diameter is typically larger than twice the skin depth, using a higher frequency (and thus a heater with a smaller diameter) may reduce equipment costs. For a fixed geometry, a higher frequency results in a higher turndown ratio. The turndown ratio at a higher frequency may be calculated by multiplying the turndown ratio at a lower frequency by the square root of the higher frequency divided by the lower frequency. In some embodiments, a frequency between about 100 Hz and about 1000 Hz may be used (e.g., about 180 Hz). In some embodiments, a frequency between about 140 Hz and about 200 Hz may be used. In some embodiments, a frequency between about 400 Hz and about 600 Hz may be used (e.g., about 540 Hz).

To maintain a substantially constant skin depth until the Curie temperature of a heater is reached, the heater may be operated at a lower frequency when the heater is cold and operated at a higher frequency when the heater is hot. Line frequency heating is generally favorable, however, because there is less need for expensive components (e.g., power supplies that alter frequency). Line frequency is the frequency of a general supply of current. Line frequency is typically 60 Hz, but may be 50 Hz or another frequency depending on the source (e.g., the geographic location) for the supply of the current. Higher frequencies may be produced using commercially available equipment (e.g., solid state variable frequency power supplies). Transformers that can convert three-phase power to single-phase power with three times the frequency are commercially available. For example, high voltage three-phase power at 60 Hz may be transformed to single-phase power at 180 Hz and at a lower voltage. Such transformers may be less expensive and more energy efficient than solid state variable frequency power supplies. In certain embodiments, transformers that convert three-phase power to single-phase power may be used to increase the frequency of power supplied to a heater.

In certain embodiments, modulated DC (e.g., chopped DC) may be used for providing electrical power to a temperature limited heater. A DC modulator or DC chopper may be coupled to a DC power supply to provide an output of modulated direct current. In some embodiments, a DC power supply may include means for modulating DC. One example of a DC modulator is a DC-to-DC converter system. DC-to-DC converter systems are generally known in the art. DC is typically modulated or chopped into a desired waveform. A waveform for DC modulation may be, for example, a square-wave waveform. Other types of waveforms including, but not limited to, sinusoidal, deformed sinusoidal, deformed square-wave, triangular, and other regular or irregular waveforms may also be used.

A modulated DC waveform generally defines the frequency of the modulated DC. Thus, a modulated DC waveform may be selected to provide a desired modulated DC frequency. The shape and/or the rate of modulation (i.e., rate of chopping) of a modulated DC waveform may be varied to vary the modulated DC frequency. DC may be modulated at frequencies that are higher than generally available AC frequencies (e.g., line frequency or transformed line frequency). For example, modulated DC may be provided at frequencies greater than about 1000 Hz. Increasing the frequency of supplied current to higher values may advantageously increase the turndown ratio of a temperature limited heater.

In certain embodiments, a modulated DC waveform may be adjusted or altered to vary the modulated DC frequency. A DC modulator may be able to adjust or alter a modulated DC waveform at any time during use of a temperature limited heater and at high currents or voltages. Thus, modulated DC provided to a temperature limited heater may not be limited to a single frequency or even a small set of frequency values. Waveform selection using a DC modulator typically allows for a wide range of modulated DC frequencies and for discrete control of the modulated DC frequency. Thus, a modulated DC frequency may be more easily set at a distinct value whereas AC frequency is generally limited to incremental values of the line frequency. Discrete control of the modulated DC frequency may allow for more selective control over the turndown ratio of a temperature limited heater. Being able to selectively control a turndown ratio of a temperature limited heater may allow for a broader range of materials to be used in designing and constructing a temperature limited heater.

In an embodiment, electrical power for a temperature limited heater may initially be supplied using non-modulated DC or very low frequency modulated DC. Using non-modulated DC or very low frequency DC at earlier times of heating may reduce losses associated with higher frequencies. Non-modulated DC and/or very low frequency modulated DC may also be cheaper to use during initial heating times. After a selected temperature is reached in a temperature limited heater, modulated DC, higher frequency modulated DC, or AC may be used for providing electrical power to a temperature limited heater. For example, modulated DC, higher frequency modulated DC, or AC may be used as a temperature of a heater nears the Curie temperature of a ferromagnetic material in the heater so that the heater operates as a temperature limited heater.

In some embodiments, a modulated DC frequency or an AC frequency may be adjusted to compensate for changes in properties (e.g., subsurface conditions) of a temperature limited heater during use. Subsurface conditions may include, but are not limited to, temperature and pressure. For example, as a temperature of a temperature limited heater in a wellbore increases, it may be advantageous to increase the frequency of the current provided to the heater, thus increasing the turndown ratio of the heater. In an embodiment, a downhole temperature of a temperature limited heater in a wellbore may be assessed. The modulated DC frequency or the AC frequency provided to the temperature limited heater may be varied based on an assessed downhole condition or conditions.

In certain embodiments, the modulated DC frequency, or the AC frequency, may be varied to adjust a turndown ratio of a temperature limited heater. The turndown ratio may be adjusted to compensate for hot spots occurring along a length of a heater. For example, the turndown ratio may be increased because a temperature limited heater is getting too hot in certain locations. In some embodiments, the modulated DC frequency, or the AC frequency, may be varied to adjust a turndown ratio without assessing a subsurface condition.

At or near the Curie temperature of a material, a relatively small change in voltage may cause a relatively large change in current load. A relatively small change in voltage may produce problems in the power supplied to a temperature limited heater, especially at or near the Curie temperature. The problems may include, but are not limited to, reducing the power factor, tripping a circuit breaker, and/or blowing a fuse. In some cases, voltage changes may be caused by a change in the load of a temperature limited heater. In certain embodiments, an electrical current supply (e.g., a supply of modulated DC) may provide a relatively constant amount of current that does not substantially vary with changes in load of a temperature limited heater. In an embodiment, an electrical current supply may provide an amount of electrical current that remains within about 15% of a selected constant current value when a load of a temperature limited heater changes. In some embodiments, an electrical current supply may provide an amount of electrical current that remains within about 10%, within about 5%, or within about 2% of a selected constant current value when a load of a temperature limited heater changes.

Temperature limited heaters may generate an inductive load. An inductive load may be due to some applied electrical current being used by a ferromagnetic material to generate a magnetic field in addition to generating a resistive heat output. As downhole temperature changes in a temperature limited heater, the inductive load of a heater changes due to changes in the magnetic properties of ferromagnetic materials in the heater with temperature. The inductive load of a temperature limited heater may cause a phase shift between the current and the voltage applied to the heater.

A reduction in power applied to a temperature limited heater may be caused by a time lag in the current waveform (e.g., the current has a phase shift relative to the voltage due to an inductive load) and/or by distortions in the current waveform (e.g., distortions in the current waveform caused by introduced harmonics due to a load or another source). Thus, it may take more current to apply a selected amount of power due to phase shifting or waveform distortion. The ratio of actual power applied and the apparent power that would have been transmitted if the same current were in phase and undistorted is the power factor. The power factor is always less than or equal to 1. The power factor is 1 when there is no phase shift or distortion in the waveform.

Actual power applied to a heater due to a phase shift may be described by EQN. 40:

$$P=I\times V\times\cos(\theta); \tag{40}$$

in which P is the actual power applied to a heater; I is the applied current; V is the applied voltage; and θ is the phase angle difference between voltage and current. If there is no distortion in the waveform, then cos(θ) is equal to the power factor.

At higher frequencies (e.g., modulated DC frequencies greater than about 1000 Hz), the problem with phase shifting and/or distortion tends to be more pronounced. In certain embodiments, a capacitor may be used to compensate for phase shifting caused by an inductive load. A capacitive load may be used to balance an inductive load because current for capacitance is 180 degrees out of phase from current for the inductance. In some embodiments, a variable capacitor (e.g., a solid state switching capacitor) may be used to compensate for phase shifting caused by a varying inductive load. In an embodiment, a variable capacitor may be placed at a wellhead for a temperature limited heater. Placing the variable capacitor at the wellhead may allow the capacitance to be varied more easily in response to changes in the inductive load of a heater. In certain embodiments, a variable capacitor may be placed subsurface with a heater, subsurface within a heater, or as close to the heating conductor as possible to minimize line losses due to the capacitor. In some embodiments, a variable capacitor may be placed at a central location for a field of heater wells (i.e., one variable capacitor may be used for several heaters). In one embodiment, a variable capacitor may be placed at an electrical junction between a field of heaters and a utility supply of electricity (e.g., a line supply).

In certain embodiments, a variable capacitor may be used to maintain a power factor of a temperature limited heater (e.g., a power factor of the conductors in a temperature limited heater) above a selected value. In an embodiment, a variable capacitor may be used to maintain a power factor of a temperature limited heater above about 0.85. In some embodiments, a variable capacitor may be used to maintain a power factor of a temperature limited heater above about 0.9 or above about 0.95. In certain embodiments, the capacitance in a variable capacitor may be varied to maintain a power factor of a temperature limited heater above a selected value.

In some embodiments, a waveform (e.g., a modulated DC waveform) may be pre-shaped to compensate for phase shifting and/or harmonic distortion. A waveform may be pre-shaped by modulating the waveform into a specific shape. For example, a DC modulator may be programmed or designed to output a waveform of a particular shape. In certain embodiments, the pre-shaped waveform may be varied to compensate for changes in the inductive load of a heater (i.e., changes in the phase shift and/or the distortion). In certain embodiments, heater conditions (e.g., downhole temperature) may be assessed and used to determine a pre-shaped waveform. In some embodiments, a pre-shaped waveform may be determined through the use of a simulation or calculations based on a heater design. Simulations and/or heater conditions may also be used to determine the capacitance needed for a variable capacitor.

In some embodiments, a modulated DC waveform may modulate DC between 100% (full current load) and 0% (no current load). For example, a square-wave may modulate 100 A DC between 100% (100 A) and 0% (0 A). In some embodiments, a modulated DC waveform may modulate DC between other values of the current load (e.g., between 100% and 50% or between 75% and 25%). For example, a square-wave may modulate 100 A DC between 100% (100 A) and 50% (50 A). The lower current load (e.g., the 50% current load) may be defined as the base current load.

In some embodiments, electrical voltage and/or electrical current may be adjusted to change the skin depth of a ferromagnetic material. Increasing the voltage and/or decreasing the current may decrease the skin depth of a ferromagnetic material. A smaller skin depth may allow a heater with a smaller diameter to be used, thereby reducing equipment costs. In certain embodiments, the applied current may be at least about 1 amp, 10 amps, 70 amps, 100 amps, 200 amps, 500 amps, or greater. In some embodiments, alternating current may be supplied at voltages above about 200 volts, above about 480 volts, above about 650 volts, above about 1000 volts, above about 1500 volts, or higher.

In an embodiment, a temperature limited heater may include an inner conductor inside an outer conductor. The inner conductor and the outer conductor may be radially disposed about a central axis. The inner and outer conductors may be separated by an insulation layer. In certain embodiments, the inner and outer conductors may be coupled at the bottom of the heater. Electrical current may flow into the heater through the inner conductor and return through the outer conductor. One or both conductors may include ferromagnetic material.

An insulation layer may comprise an electrically insulating ceramic with high thermal conductivity, such as magnesium oxide, aluminum oxide, silicon dioxide, beryllium oxide, boron nitride, silicon nitride, etc. The insulating layer may be a compacted powder (e.g., compacted ceramic powder). Compaction may improve thermal conductivity and provide better insulation resistance. For lower temperature applications, polymer insulation made from, for example, fluoropolymers, polyimides, polyamides, and/or polyethylenes, may be used. In some embodiments, the polymer insulation may be made of perfluoroalkoxy (PFA) or polyetheretherketone (PEEK™). The insulating layer may be chosen to be substantially infrared transparent to aid heat transfer from the inner conductor to the outer conductor. In an embodiment, the insulating layer may be transparent quartz sand. The insulation layer may be air or a non-reactive gas such as helium, nitrogen, or sulfur hexafluoride. If the insulation layer is air or a non-reactive gas, there may be insulating spacers designed to inhibit electrical contact between the inner conductor and the outer conductor. The insulating spacers may be made of, for example, high purity aluminum oxide or another thermally conducting, electrically insulating material such as silicon nitride. The insulating spacers may be a fibrous ceramic material such as Nextel™ 312, mica tape, or glass fiber. Ceramic material may be made of alumina, alumina-silicate, alumina-borosilicate, silicon nitride, or other materials.

An insulation layer may be flexible and/or substantially deformation tolerant. For example, if the insulation layer is a solid or compacted material that substantially fills the space between the inner and outer conductors, the heater may be flexible and/or substantially deformation tolerant. Forces on the outer conductor can be transmitted through the insulation layer to the solid inner conductor, which may resist crushing. Such a heater may be bent, dog-legged, and spiraled without causing the outer conductor and the inner conductor to electrically short to each other. Deformation tolerance may be important if a wellbore is likely to undergo substantial deformation during heating of the formation.

In certain embodiments, the outer conductor may be chosen for corrosion and/or creep resistance. In one embodiment, austenitic (non-ferromagnetic) stainless steels such as 304H, 347H, 347HH, 316H, or 310H stainless steels may be used in the outer conductor. The outer conductor may also include a clad conductor. For example, a corrosion resistant alloy such as 800H or 347H stainless steel may be clad for corrosion protection over a ferromagnetic carbon steel tubular. If high temperature strength is not required, the outer conductor may be constructed from a ferromagnetic metal with good corrosion resistance (e.g., one of the ferritic stainless steels). In one embodiment, a ferritic alloy of 82.3% iron with 17.7% chromium (Curie temperature 678° C.) may provide desired corrosion resistance.

*The Metals Handbook*, vol. 8, page 291 (American Society of Materials (ASM)) shows a graph of Curie temperature of iron-chromium alloys versus the amount of chromium in the alloys. In some temperature limited heater embodiments, a separate support rod or tubular (made from, e.g., 347H stainless steel) may be coupled to a heater (e.g., a heater made from an iron/chromium alloy) to provide strength and/or creep resistance. The support material and/or the ferromagnetic material may be selected to provide a 100,000 hour creep-rupture strength of at least 3,000 psi (20.7 MPa) at about 650° C. In some embodiments, the 100,000 hour creep-rupture strength may be at least about 2,000 psi (13.8 MPa) at about 650° C. or at least about 1,000 psi at about 650° C. For example, 347H steel has a favorable creep-rupture strength at or above 650° C. In some embodiments, the 100,000 hour creep-rupture strength may range from about 1,000 psi (6.9 MPa) to about 6,000 psi (41.3 MPa) or more for longer heaters and/or higher earth or fluid stresses.

In an embodiment with an inner ferromagnetic conductor and an outer ferromagnetic conductor, the skin effect current path occurs on the outside of the inner conductor and on the inside of the outer conductor. Thus, the outside of the outer conductor may be clad with a corrosion resistant alloy, such as stainless steel, without affecting the skin effect current path on the inside of the outer conductor.

A ferromagnetic conductor with a thickness greater than the skin depth at the Curie temperature may allow a substantial decrease in AC resistance of the ferromagnetic material as the skin depth increases sharply near the Curie temperature. In certain embodiments (e.g., when not clad with a highly conducting material such as copper), the thickness of the conductor may be about 1.5 times the skin depth near the Curie temperature, about 3 times the skin depth near the Curie temperature, or even about 10 or more times the skin depth near the Curie temperature. If the ferromagnetic conductor is clad with copper, thickness of the ferromagnetic conductor may be substantially the same as the skin depth near the Curie temperature. In some embodiments, a ferromagnetic conductor clad with copper may have a thickness of at least about three-fourths of the skin depth near the Curie temperature.

In an embodiment, a temperature limited heater may include a composite conductor with a ferromagnetic tubular and a non-ferromagnetic, high electrical conductivity core. The non-ferromagnetic, high electrical conductivity core may reduce a required diameter of the conductor. For example, the conductor may be a composite 1.19 cm diameter conductor with a core of 0.575 cm diameter copper clad with a 0.298 cm thickness of ferritic stainless steel or carbon steel surrounding the core. A composite conductor may allow the electrical resistance of the temperature limited heater to decrease more steeply near the Curie temperature. As the skin depth increases near the Curie temperature to include the copper core, the electrical resistance may decrease very sharply.

A composite conductor may increase the conductivity of a temperature limited heater and/or allow the heater to operate at lower voltages. In an embodiment, a composite conductor may exhibit a relatively flat resistance versus temperature profile. In some embodiments, a temperature limited heater may exhibit a relatively flat resistance versus temperature profile between about 100° C. and about 750° C., or in a temperature range between about 300° C. and about 600° C. A relatively flat resistance versus temperature profile may also be exhibited in other temperature ranges by adjusting, for example, materials and/or the configuration of materials in a temperature limited heater.

In certain embodiments, the relative thickness of each material in a composite conductor may be selected to produce a desired resistivity versus temperature profile for a temperature limited heater. In an embodiment, the composite conductor may be an inner conductor surrounded by 0.127 cm thick magnesium oxide powder as an insulator. The outer conductor may be 304H stainless steel with a wall thickness of 0.127 cm. The outside diameter of the heater may be about 1.65 cm.

A composite conductor (e.g., a composite inner conductor or a composite outer conductor) may be manufactured by methods including, but not limited to, coextrusion, roll forming, tight fit tubing (e.g., cooling the inner member and heating the outer member, then inserting the inner member in the outer member, followed by a drawing operation and/or allowing the system to cool), explosive or electromagnetic cladding, arc overlay welding, longitudinal strip welding, plasma powder welding, billet coextrusion, electroplating, drawing, sputtering, plasma deposition, coextrusion casting, magnetic forming, molten cylinder casting (of inner core material inside the outer or vice versa), insertion followed by welding or high temperature braising, shielded active gas welding (SAG), and/or insertion of an inner pipe in an outer pipe followed by mechanical expansion of the inner pipe by hydroforming or use of a pig to expand and swage the inner pipe against the outer pipe. In some embodiments, a ferromagnetic conductor may be braided over a non-ferromagnetic conductor. In certain embodiments, composite conductors may be formed using methods similar to those used for cladding (e.g., cladding copper to steel). A metallurgical bond between copper cladding and base ferromagnetic material may be advantageous. Composite conductors produced by a coextrusion process that forms a good metallurgical bond (e.g., a good bond between copper and 446 stainless steel) may be provided by Anomet Products, Inc. (Shrewsbury, Mass.).

In an embodiment, two or more conductors may be joined to form a composite conductor by various methods (e.g., longitudinal strip welding) to provide tight contact between the conducting layers. In certain embodiments, two or more conducting layers and/or insulating layers may be combined to form a composite heater with layers selected such that the coefficient of thermal expansion decreases with each successive layer from the inner layer toward the outer layer. As the temperature of the heater increases, the innermost layer expands to the greatest degree. Each successive outwardly lying layer expands to a slightly lesser degree, with the outermost layer expanding the least. This sequential expansion may provide relatively intimate contact between layers for good electrical contact between layers.

In an embodiment, two or more conductors may be drawn together to form a composite conductor. In certain embodiments, a relatively malleable ferromagnetic conductor (e.g., iron such as 1018 steel) may be used to form a composite conductor. A relatively soft ferromagnetic conductor typically has a low carbon content. A relatively malleable ferromagnetic conductor may be useful in drawing processes for forming composite conductors and/or other processes that require stretching or bending of the ferromagnetic conductor. In a drawing process, the ferromagnetic conductor may be annealed after one or more steps of the drawing process. The ferromagnetic conductor may be annealed in an inert gas atmosphere to inhibit oxidation of the conductor. In some embodiments, oil may be placed on the ferromagnetic conductor to inhibit oxidation of the conductor during processing.

The diameter of a temperature limited heater may be small enough to inhibit deformation of the heater by a collapsing formation. In certain embodiments, the outside diameter of a temperature limited heater may be less than about 5 cm. In some embodiments, the outside diameter of a temperature limited heater may be less than about 4 cm, less than about 3 cm, or between about 2 cm and about 5 cm.

In heater embodiments described herein (including, but not limited to, temperature limited heaters, insulated conductor heaters, conductor-in-conduit heaters, and elongated member heaters), a largest transverse cross-sectional dimension of a heater may be selected to provide a desired ratio of the largest transverse cross-sectional dimension to wellbore diameter (e.g., initial wellbore diameter). The largest transverse cross-sectional dimension is the largest dimension of the heater on the same axis as the wellbore diameter (e.g., the diameter of a cylindrical heater or the width of a vertical heater). In certain embodiments, the ratio of the largest transverse cross-sectional dimension to wellbore diameter may be selected to be less than about 1:2, less than about 1:3, or less than about 1:4. The ratio of heater diameter to wellbore diameter may be chosen to inhibit contact and/or deformation of the heater by the formation (i.e., inhibit closing in of the wellbore on the heater) during heating. In certain embodiments, the wellbore diameter may be determined by a diameter of a drillbit used to form the wellbore.

In an embodiment, a wellbore diameter may shrink from an initial value of about 16.5 cm to about 6.4 cm during heating of a formation (e.g., for a wellbore in oil shale with a richness greater than about 0.12 L/kg). At some point, expansion of formation material into the wellbore during heating results in a balancing between the hoop stress of the wellbore and the compressive strength due to thermal expansion of hydrocarbon, or kerogen, rich layers. The hoop stress of the wellbore itself may reduce the stress applied to a conduit (e.g., a liner) located in the wellbore. At this point, the formation may no longer have the strength to deform or collapse a heater or a liner. For example, the radial stress provided by formation material may be about 12,000 psi (82.7 MPa) at a diameter of about 16.5 cm, while the stress at a diameter of about 6.4 cm after expansion may be about 3000 psi (20.7 MPa). A heater diameter may be selected to be less than about 3.8 cm to inhibit contact of the formation and the heater. A temperature limited heater may advantageously provide a higher heat output over a significant portion of the wellbore (e.g., the heat output needed to provide sufficient heat to pyrolyze hydrocarbons in a hydrocarbon containing formation) than a constant wattage heater for smaller heater diameters (e.g., less than about 5.1 cm).

In certain embodiments, a heater may be placed in a deformation resistant container. The deformation resistant container may provide additional protection for inhibiting deformation of a heater. The deformation resistant container may have a higher creep-rupture strength than a heater. In one embodiment, a deformation resistant container may have a creep-rupture strength of at least about 3000 psi (20.7 MPa) at 100,000 hours for a temperature of about 650° C. In some embodiments, the creep-rupture strength of a deformation resistant container may be at least about 4000 psi (27.7 MPa) at 100,000 hours or at least about 5000 psi (34.5 MPa) at 100,000 hours for a temperature of about 650° C. In an embodiment, a deformation resistant container may include one or more alloys that provide mechanical strength. For example, a deformation resistant container may include an alloy of iron, nickel, chromium, manganese, carbon, tantalum, and/or mixtures thereof (e.g., 347H steel, 800H steel, or Inconel® 625).

Figure 76:
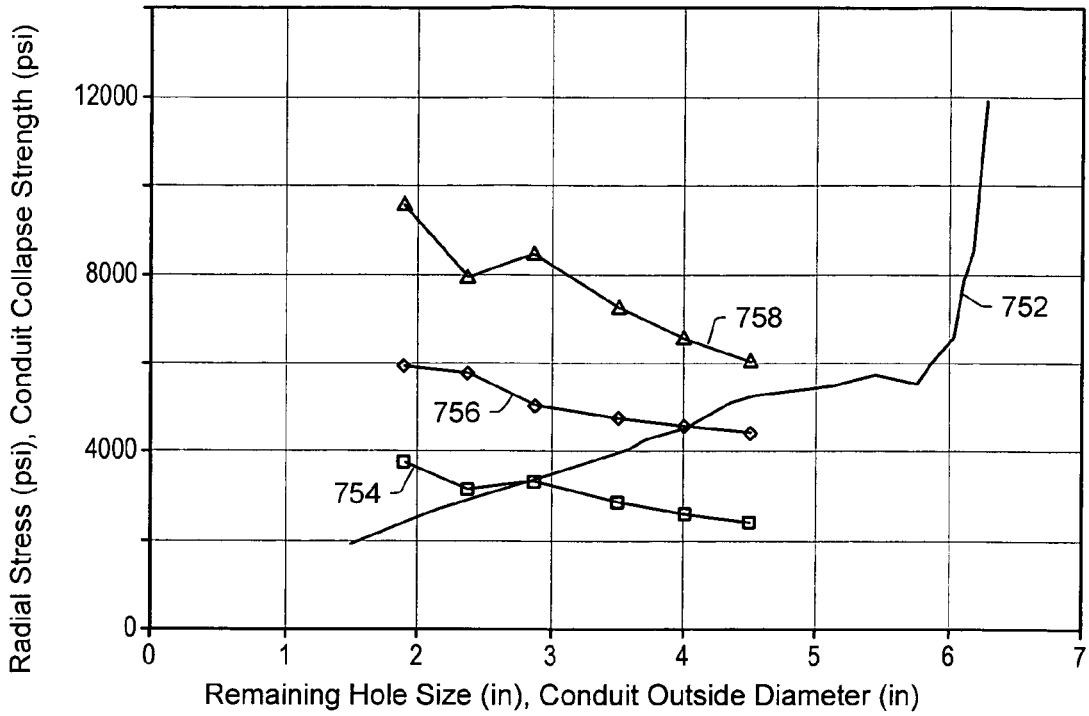
FIG. 76 depicts radial stress and conduit collapse strength versus remaining wellbore diameter and conduit outside diameter in an oil shale formation.

FIG. 76 depicts radial stress and conduit (e.g., a liner) collapse strength versus remaining wellbore diameter and conduit outside diameter in an oil shale formation. The calculations for radial stress were based on the properties of a 52 gal/ton per ton (0.21 L/kg) oil shale from the Green River. The heating rate was about 820 watts per meter. Plot 752 depicts maximum radial stress from the oil shale versus remaining diameter for an initial wellbore diameter of 6.5 inches (16.5 cm). Plot 754 depicts liner collapse strength versus liner outside diameter for Schedule 80 347H stainless steel pipe at 650° C. Plot 756 depicts liner collapse strength versus liner outside diameter for Schedule 160 347H stainless steel pipe at 650° C. Plot 758 depicts liner collapse strength versus liner outside diameter for Schedule XXH 347H stainless steel pipe at 650° C. Plots 754, 756, and 758 show that increasing the thickness of the liner increases the collapse strength. Plots 754, 756, and 758 indicate that a Schedule XXH 347H stainless steel liner may have sufficient collapse strength to withstand the maximum radial stress from the oil shale at 650° C. The conduit collapse strength should be greater than the maximum radial stress to inhibit deformation of the conduit.

Figure 77:
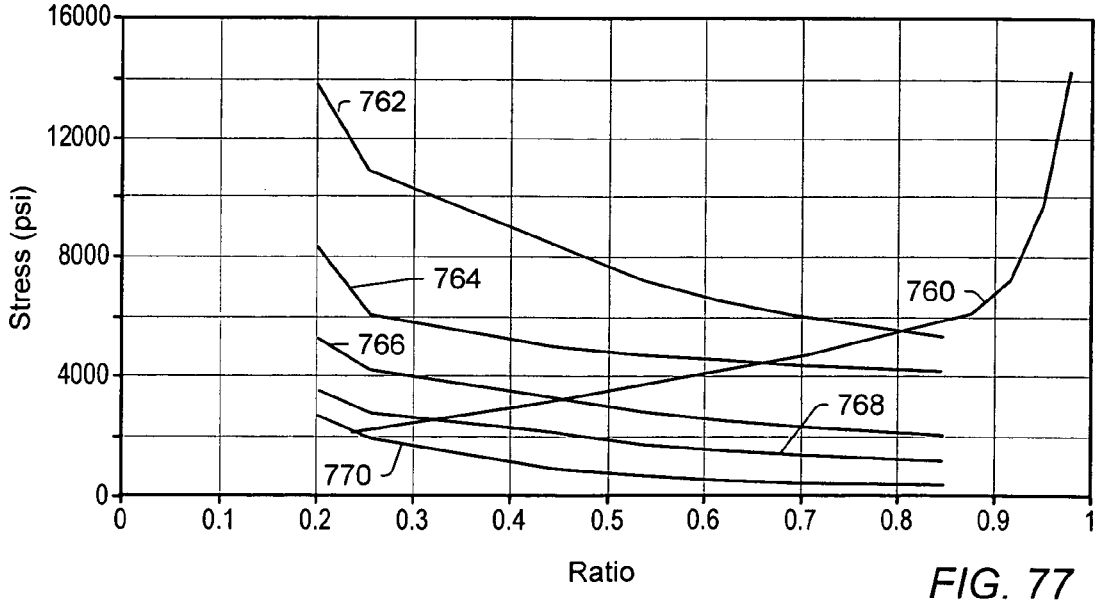
FIG. 77 depicts radial stress and conduit collapse strength versus a ratio of conduit outside diameter to initial wellbore diameter in an oil shale formation.

FIG. 77 depicts radial stress and conduit collapse strength versus a ratio of conduit outside diameter to initial wellbore diameter in an oil shale formation. Plot 760 depicts radial stress from the oil shale versus the ratio of conduit outside diameter to initial wellbore diameter. Plot 760 shows that the radial stress from the oil shale decreased rapidly from a ratio of 1 down to a ratio of about 0.85. Below a ratio of 0.8, the radial stress slowly decreased. Plot 762 depicts conduit collapse strength versus the ratio of conduit outside diameter to initial wellbore diameter for a Schedule XXH 347H stainless steel conduit. Plot 764 depicts conduit collapse strength versus the ratio of conduit outside diameter to initial wellbore diameter for a Schedule 160 347H stainless steel conduit. Plot 766 depicts conduit collapse strength versus the ratio of conduit outside diameter to initial wellbore diameter for a Schedule 80 347H stainless steel conduit. Plot 768 depicts conduit collapse strength versus the ratio of conduit outside diameter to initial wellbore diameter for a Schedule 40 347H stainless steel conduit. Plot 770 depicts conduit collapse strength versus the ratio of conduit outside diameter to initial wellbore diameter for a Schedule 10 347H stainless steel conduit. The plots in FIG. 77 show that below a ratio of conduit outside diameter to initial wellbore diameter of 0.75, a Schedule XXH 347H stainless steel conduit has sufficient collapse strength to withstand radial stress from the oil shale. FIG. 77 and other similar plots may be used to choose an initial wellbore diameter and the materials and outside diameter of a conduit so that deformation of the conduit may be inhibited.

Figure 78:
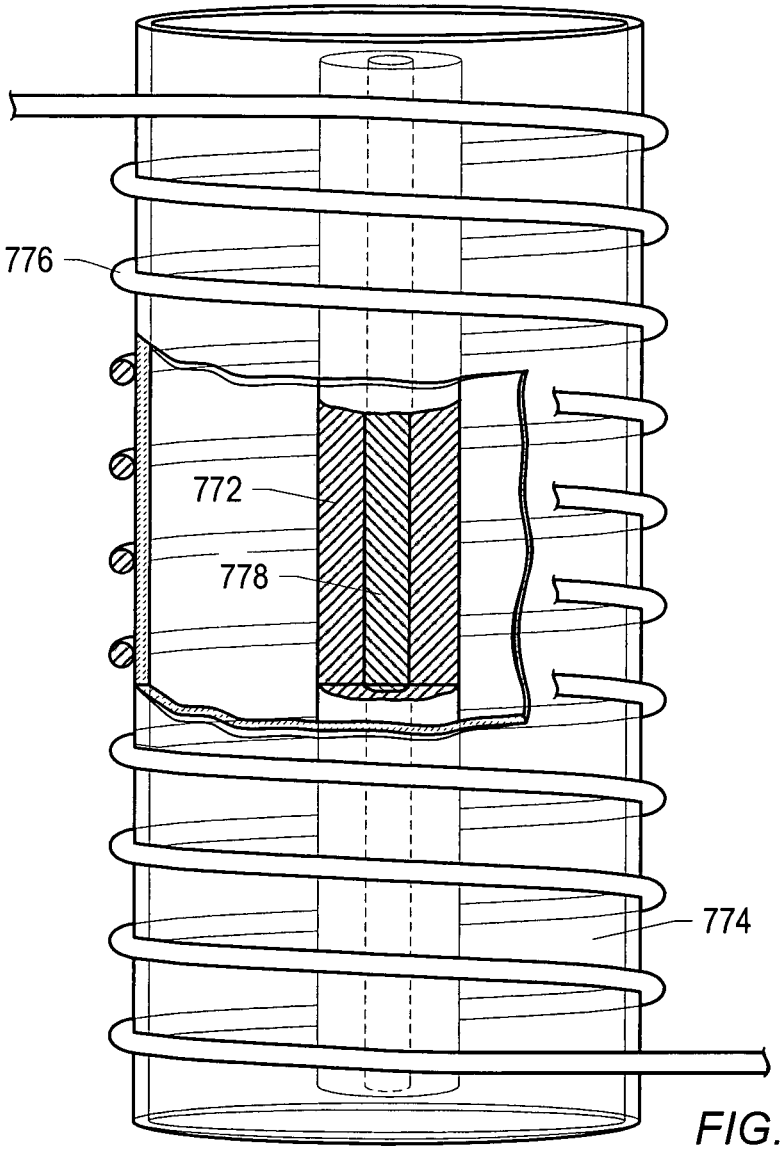
FIG. 78 depicts an embodiment of an apparatus for forming a composite conductor, with a portion of the apparatus shown in cross section.

FIG. 78 depicts an embodiment of an apparatus used to form a composite conductor. Ingot 772 may be a ferromagnetic conductor (e.g., iron or carbon steel). Ingot 772 may be placed in chamber 774. Chamber 774 may be made of materials that are electrically insulating and able to withstand temperatures of about 800° C. or higher. In one embodiment, chamber 774 is a quartz chamber. In some embodiments, an inert, or non-reactive, gas (e.g., argon or nitrogen with a small percentage of hydrogen) may be placed in chamber 774. In certain embodiments, a flow of inert gas may be provided to chamber 774 to maintain a pressure in the chamber. Induction coil 776 may be placed around chamber 774. An alternating current may be supplied to induction coil 776 to inductively heat ingot 772. Inert gas inside chamber 774 may inhibit oxidation or corrosion of ingot 772.

Inner conductor 778 may be placed inside ingot 772. Inner conductor 778 may be a non-ferromagnetic conductor (e.g., copper or aluminum) that melts at a lower temperature than ingot 772. In an embodiment, ingot 772 may be heated to a temperature above the melting point of inner conductor 778 and below the melting point of the ingot. Inner conductor 778 may melt and substantially fill the space inside ingot 772 (i.e., the inner annulus of the ingot). A cap may be placed at the bottom of ingot 772 to inhibit inner conductor 778 from flowing and/or leaking out of the inner annulus of the ingot. After inner conductor 778 has sufficiently melted to substantially fill the inner annulus of ingot 772, the inner conductor and the ingot may be allowed to cool to room temperature. Ingot 772 and inner conductor 778 may be cooled at a relatively slow rate to allow inner conductor 778 to form a good soldering bond with ingot 772. The rate of cooling may depend on, for example, the types of materials used for the ingot and the inner conductor.

In some embodiments, a composite conductor may be formed by tube-in-tube milling of dual metal strips, such as the process performed by Precision Tube Technology (Houston, Tex.). A tube-in-tube milling process may also be used to form cladding on a conductor (e.g., copper cladding inside carbon steel) or to form two materials into a tight fit tube-within-a-tube configuration.

Figure 79:
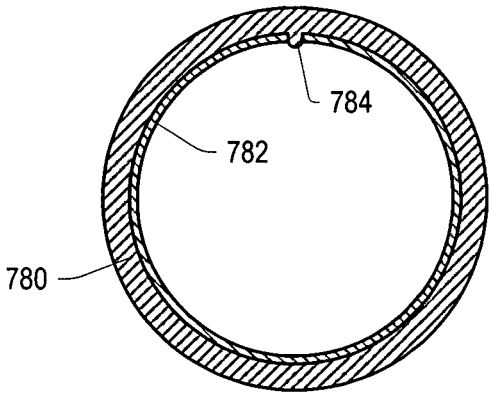
FIG. 79 depicts a cross-sectional representation of an embodiment of an inner conductor and an outer conductor formed by a tube-in-tube milling process.

FIG. 79 depicts a cross-section representation of an embodiment of an inner conductor and an outer conductor formed by a tube-in-tube milling process. Outer conductor 780 may be coupled to inner conductor 782. Outer conductor 780 may be weldable material such as steel. Inner conductor 782 may have a higher electrical conductivity than outer conductor 780. In an embodiment, inner conductor 782 may be copper or aluminum. Weld bead 784 may be formed on outer conductor 780.

In a tube-in-tube milling process, flat strips of material for the outer conductor may have a thickness substantially equal to the desired wall thickness of the outer conductor. The width of the strips may allow formation of a tube of a desired inner diameter. The flat strips may be welded end-to-end to form an outer conductor of a desired length. Flat strips of material for the inner conductor may be cut such that the inner conductor formed from the strips fit inside the outer conductor. The flat strips of inner conductor material may be welded together end-to-end to achieve a length substantially the same as the desired length of the outer conductor. The flat strips for the outer conductor and the flat strips for the inner conductor may be fed into separate accumulators. Both accumulators may be coupled to a tube mill. The two flat strips may be sandwiched together at the beginning of the tube mill.

The tube mill may form the flat strips into a tube-in-tube shape. After the tube-in-tube shape has been formed, a non-contact high frequency induction welder may heat the ends of the strips of the outer conductor to a forging temperature of the outer conductor. The ends of the strips then may be brought together to forge weld the ends of the outer conductor into a weld bead. Excess weld bead material may be cut off. In some embodiments, the tube-in-tube produced by the tube mill may be further processed (e.g., annealed and/or pressed) to achieve a desired size and/or shape. The result of the tube-in-tube process may be an inner conductor in an outer conductor, as shown in FIG. 79.

Figure 80:
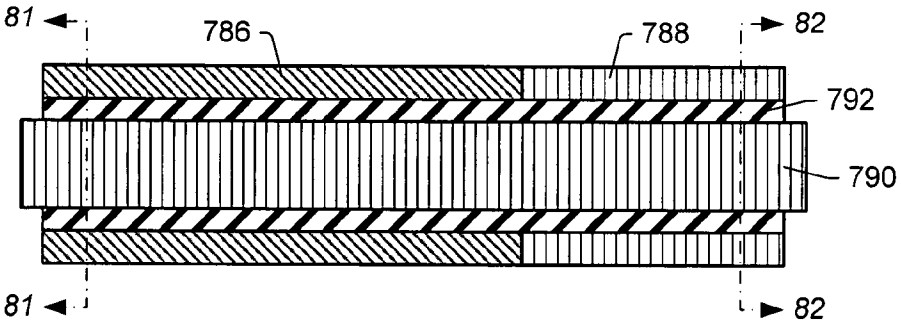
FIGS. 80, 81, and 82 depict cross-sectional representations of an embodiment of a temperature limited heater with an outer conductor having a ferromagnetic section and a non-ferromagnetic section.
Figure 82:
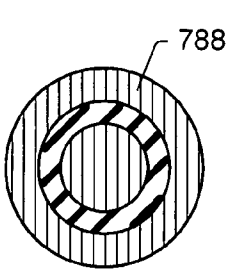
Figure 81:
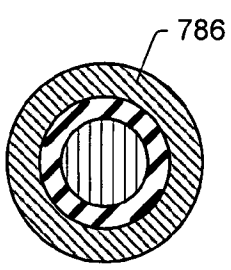

In certain embodiments described herein, temperature limited heaters are dimensioned to operate at a frequency of about 60 Hz AC. It is to be understood that dimensions of a temperature limited heater may be adjusted from those described herein in order for the temperature limited heater to operate in a similar manner at other AC frequencies or with modulated DC. FIG. 80 depicts a cross-sectional representation of an embodiment of a temperature limited heater with an outer conductor having a ferromagnetic section and a non-ferromagnetic section. FIGS. 81 and 82 depict transverse cross-sectional views of the embodiment shown in FIG. 80. In one embodiment, ferromagnetic section 786 may be used to provide heat to hydrocarbon layers in the formation. Non-ferromagnetic section 788 may be used in an overburden of the formation. Non-ferromagnetic section 788 may provide little or no heat to the overburden, thus inhibiting heat losses in the overburden and improving heater efficiency. Ferromagnetic section 786 may include a ferromagnetic material such as 409 stainless steel or 410 stainless steel. 409 stainless steel may be readily available as strip material. Ferromagnetic section 786 may have a thickness of about 0.3 cm. Non-ferromagnetic section 788 may be copper with a thickness of about 0.3 cm. Inner conductor 790 may be copper. Inner conductor 790 may have a diameter of about 0.9 cm. Electrical insulator 792 may be silicon nitride, boron nitride, magnesium oxide powder, or other suitable insulator material. Electrical insulator 792 may have a thickness of about 0.1 cm to about 0.3 cm.

Figure 83:
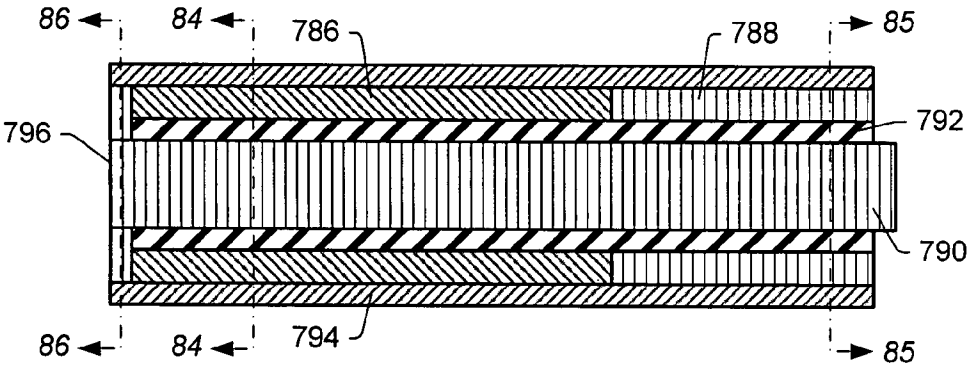
FIGS. 83, 84, 85, and 86 depict cross-sectional representations of an embodiment of a temperature limited heater with an outer conductor having a ferromagnetic section and a non-ferromagnetic section placed inside a sheath.
Figure 85:
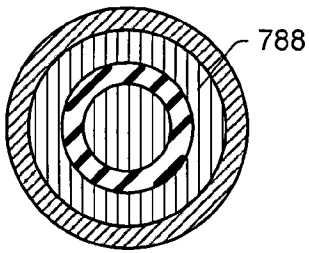
Figure 84:
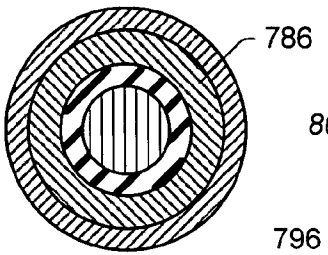
Figure 86:
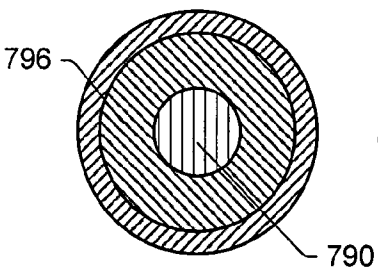

FIG. 83 depicts a cross-sectional representation of an embodiment of a temperature limited heater with an outer conductor having a ferromagnetic section and a non-ferromagnetic section placed inside a sheath. FIGS. 84, 85, and 86 depict transverse cross-sectional views of the embodiment shown in FIG. 83. Ferromagnetic section 786 may be 410 stainless steel with a thickness of about 0.6 cm. Non-ferromagnetic section 788 may be copper with a thickness of about 0.6 cm. Inner conductor 790 may be copper with a diameter of about 0.9 cm. Outer conductor 794 may include ferromagnetic material. Outer conductor 794 may provide some heat in the overburden section of the heater. Providing some heat in the overburden may inhibit condensation or refluxing of fluids in the overburden. Outer conductor 794 may be 409, 410, or 446 stainless steel with an outer diameter of about 3.0 cm and a thickness of about 0.6 cm. Electrical insulator 792 may be magnesium oxide powder with a thickness of about 0.3 cm. In some embodiments, electrical insulator 792 may be silicon nitride or boron nitride (e.g., hexagonal type boron nitride). Conductive section 796 may couple inner conductor 790 with ferromagnetic section 786 and/or outer conductor 794.

Figure 89:
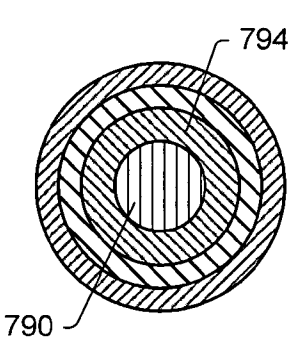
FIGS. 87, 88, and 89 depict cross-sectional representations of an embodiment of a temperature limited heater with a ferromagnetic outer conductor.
Figure 87:
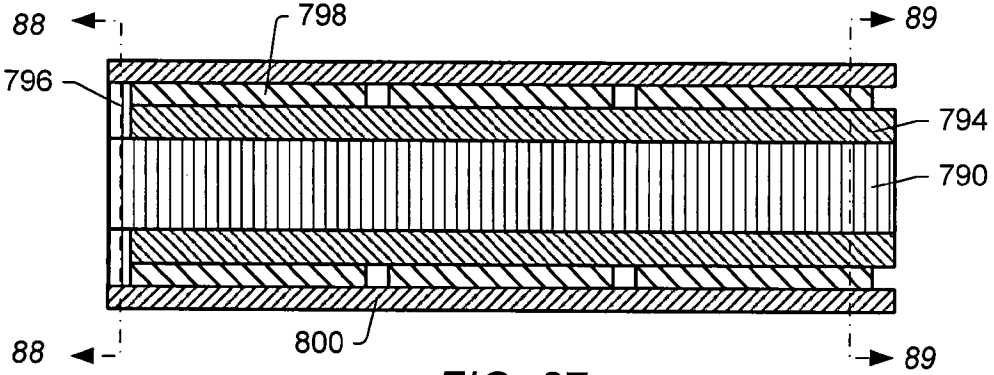
Figure 88:
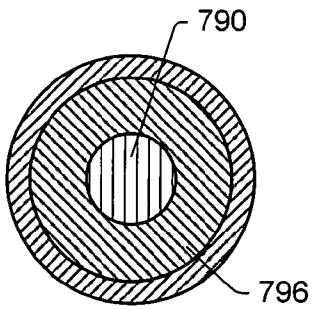

FIG. 87 depicts a cross-sectional representation of an embodiment of a temperature limited heater with a ferromagnetic outer conductor. The heater may be placed in a corrosion resistant jacket. A conductive layer may be placed between the outer conductor and the jacket. FIGS. 88 and 89 depict transverse cross-sectional views of the embodiment shown in FIG. 87. Outer conductor 794 may be a ¾" Schedule 80 446 stainless steel pipe. In an embodiment, conductive layer 798 is placed between outer conductor 794 and jacket 800. Conductive layer 798 may be a copper layer. Outer conductor 794 may be clad with conductive layer 798. In certain embodiments, conductive layer 798 may include one or more segments (e.g., conductive layer 798 may include one or more copper tube segments). Jacket 800 may be a 1¼" Schedule 80 347H stainless steel pipe or a 1½" Schedule 160 347H stainless steel pipe. In an embodiment, inner conductor 790 is 4/0 MGT-1000 furnace cable with stranded nickel-coated copper wire with layers of mica tape and glass fiber insulation. 4/0 MGT-1000 furnace cable is UL type 5107 (available from Allied Wire and Cable (Phoenixville, Pa.)). Conductive section 796 may couple inner conductor 790 and jacket 800. In an embodiment, conductive section 796 may be copper.

Figure 92:
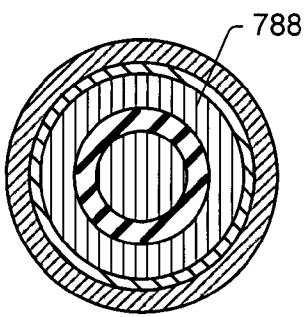
FIGS. 90, 91, and 92 depict cross-sectional representations of an embodiment of a temperature limited heater with an outer conductor.
Figure 90:
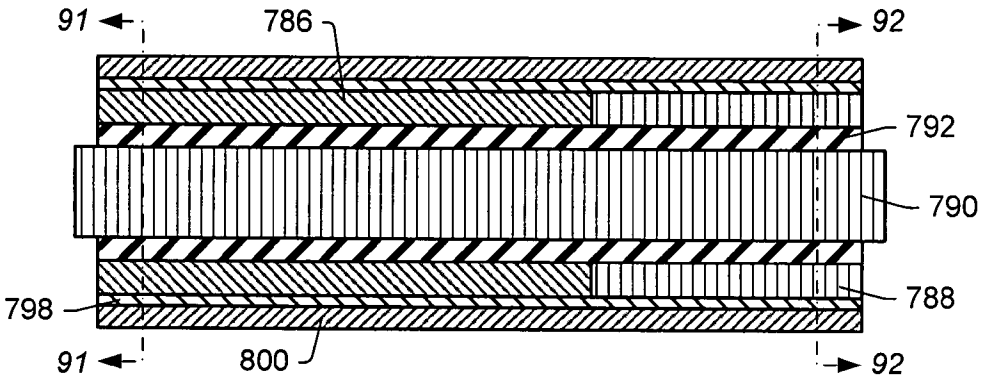
Figure 91:
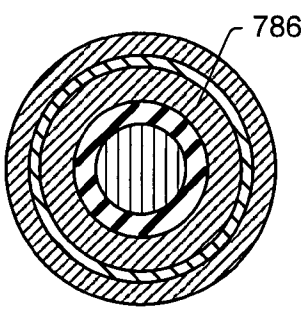

FIG. 90 depicts a cross-sectional representation of an embodiment of a temperature limited heater with an outer conductor. The outer conductor may include a ferromagnetic section and a non-ferromagnetic section. The heater may be placed in a corrosion resistant jacket. A conductive layer may be placed between the outer conductor and the jacket. FIGS. 91 and 92 depict transverse cross-sectional views of the embodiment shown in FIG. 90. Ferromagnetic section 786 may be 409, 410, or 446 stainless steel with a thickness of about 0.9 cm. Non-ferromagnetic section 788 may be copper with a thickness of about 0.9 cm. Ferromagnetic section 786 and non-ferromagnetic section 788 may be placed in jacket 800. Jacket 800 may be 304 stainless steel with a thickness of about 0.1 cm. Conductive layer 798 may be a copper layer. Electrical insulator 792 may be silicon nitride, boron nitride, or magnesium oxide with a thickness of about 0.1 to 0.3 cm. Inner conductor 790 may be copper with a diameter of about 1.0 cm.

In an embodiment, ferromagnetic section 786 may be 446 stainless steel with a thickness of about 0.9 cm. Jacket 800 may be 410 stainless steel with a thickness of about 0.6 cm. 410 stainless steel has a higher Curie temperature than 446 stainless steel. Such a temperature limited heater may "contain" current such that the current does not easily flow from the heater to the surrounding formation (i.e., the Earth) and/or to any surrounding water (e.g., brine in the formation). In this embodiment, current flows through ferromagnetic section 786 until the Curie temperature of the ferromagnetic section is reached. After the Curie temperature of ferromagnetic section 786 is reached, current flows through conductive layer 798. The ferromagnetic properties of jacket 800 (410 stainless steel) inhibit the current from flowing outside the jacket and "contain" the current. Jacket 800 may also have a thickness that provides strength to the temperature limited heater.

Figure 95:
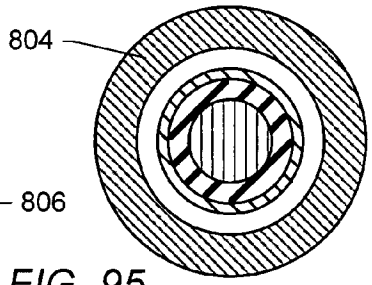
FIGS. 93, 94, 95, and 96 depict cross-sectional representations of an embodiment of a temperature limited heater.
Figure 96:
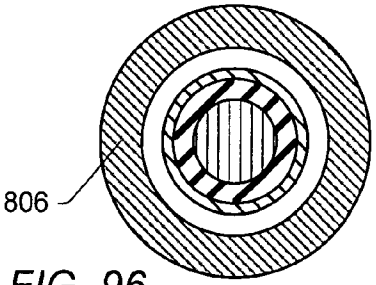
Figure 93:
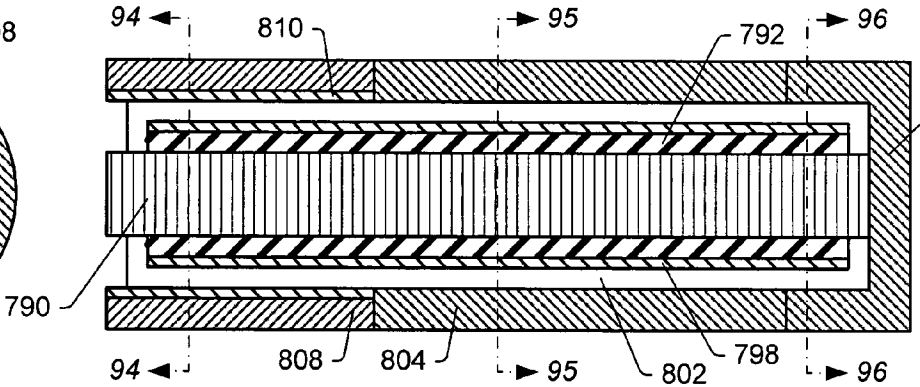
Figure 94:
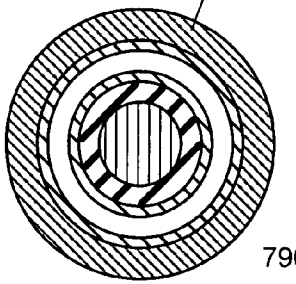

FIG. 93 depicts a cross-sectional representation of an embodiment of a temperature limited heater. The heating section of the temperature limited heater may include non-ferromagnetic inner conductors and a ferromagnetic outer conductor. The overburden section of the temperature limited heater may include a non-ferromagnetic outer conductor. FIGS. 94, 95, and 96 depict transverse cross-sectional views of the embodiment shown in FIG. 93. Inner conductor 790 may be copper with a diameter of about 1.0 cm. Electrical insulator 792 may be placed between inner conductor 790 and conductive layer 798. Electrical insulator 792 may be silicon nitride, boron nitride, or magnesium oxide with a thickness of about 0.1 cm to about 0.3 cm. Conductive layer 798 may be copper with a thickness of about 0.1 cm. Insulation layer 802 may be in the annulus outside of conductive layer 798. The thickness of the annulus may be about 0.3 cm. Insulation layer 802 may be quartz sand.

Heating section 804 may provide heat to one or more hydrocarbon layers in the formation. Heating section 804 may include ferromagnetic material such as 409 stainless steel or 410 stainless steel. Heating section 804 may have a thickness of about 0.9 cm. Endcap 806 may be coupled to an end of heating section 804. Endcap 806 may electrically couple heating section 804 to inner conductor 790 and/or conductive layer 798. Endcap 806 may be 304 stainless steel. Heating section 804 may be coupled to overburden section 808. Overburden section 808 may include carbon steel and/or other suitable support materials. Overburden section 808 may have a thickness of about 0.6 cm. Overburden section 808 may be lined with conductive layer 810. Conductive layer 810 may be copper with a thickness of about 0.3 cm.

Figure 99:
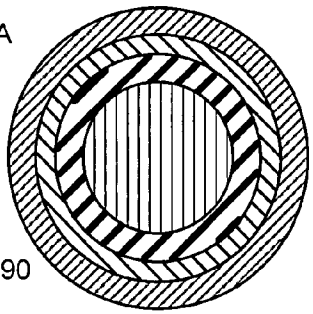
FIGS. 97, 98, and 99 depict cross-sectional representations of an embodiment of a temperature limited heater with an overburden section and a heating section.
Figure 97:
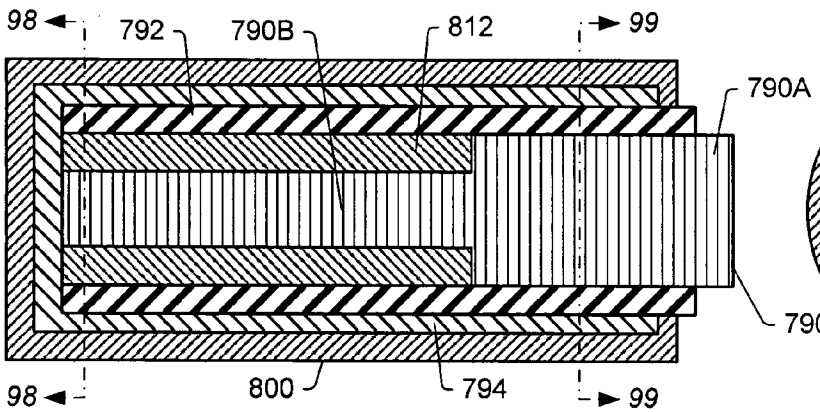
Figure 98:
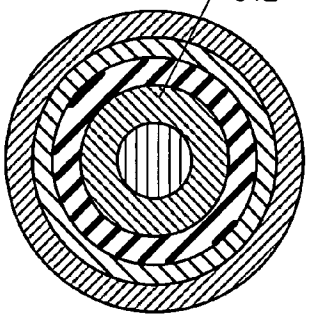

FIG. 97 depicts a cross-sectional representation of an embodiment of a temperature limited heater with an overburden section and a heating section. FIGS. 98 and 99 depict transverse cross-sectional views of the embodiment shown in FIG. 97. The overburden section may include portion 790A of inner conductor 790. Portion 790A may be copper with a diameter of about 1.3 cm. The heating section may include portion 790B of inner conductor 790. Portion 790B may be copper with a diameter of about 0.5 cm. Portion 790B may be placed in ferromagnetic conductor 812. Ferromagnetic conductor 812 may be 446 stainless steel with a thickness of about 0.4 cm. Electrical insulator 792 may be silicon nitride, boron nitride, or magnesium oxide with a thickness of about 0.2 cm. Outer conductor 794 may be copper with a thickness of about 0.1 cm. Outer conductor 794 may be placed in jacket 800. Jacket 800 may be 316H or 347H stainless steel with a thickness of about 0.2 cm.

Figure 100B:
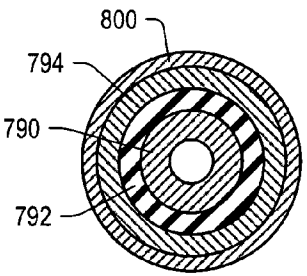
FIGS. 100A and 100B depict cross-sectional representations of an embodiment of a temperature limited heater.
Figure 100A:
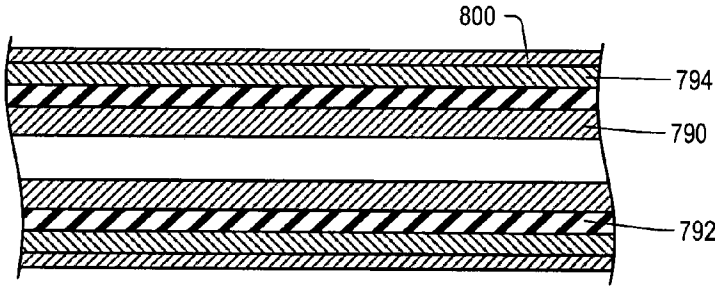

FIG. 100A and FIG. 100B depict cross-sectional representations of an embodiment of a temperature limited heater with a ferromagnetic inner conductor. Inner conductor 790 may be a 1" Schedule XXS 446 stainless steel pipe. In some embodiments, inner conductor 790 may include 409 stainless steel, 410 stainless steel, Invar 36, alloy 42-6, or other ferromagnetic materials. Inner conductor 790 may have a diameter of about 2.5 cm. Electrical insulator 792 may be silicon nitride, boron nitride, magnesium oxide (e.g., magnesium oxide powder), polymers, Nextel ceramic fiber, mica, or glass fibers. Outer conductor 794 may be copper or any other non-ferromagnetic material (e.g., aluminum). Outer conductor 794 may be coupled to jacket 800. Jacket 800 may be 304H, 316H, or 347H stainless steel. In this embodiment, a majority of the heat may be produced in inner conductor 790.

Figure 101B:
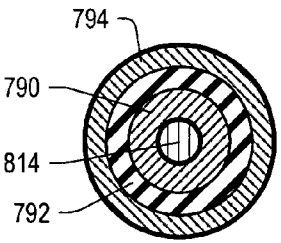
FIGS. 101A and 101B depict cross-sectional representations of an embodiment of a temperature limited heater.
Figure 101A:
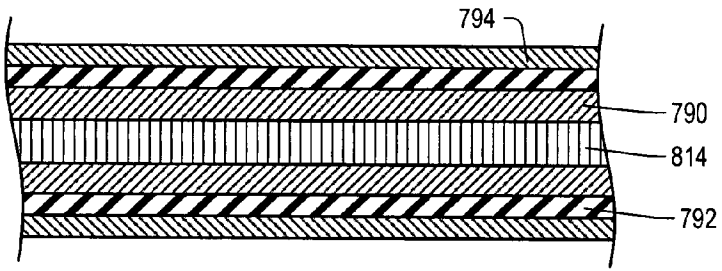

FIG. 101A and FIG. 101B depict cross-sectional representations of an embodiment of a temperature limited heater with a ferromagnetic inner conductor and a non-ferromagnetic core. Inner conductor 790 may include 446 stainless steel, 409 stainless steel, 410 stainless steel or other ferromagnetic materials. Core 814 may be tightly bonded inside inner conductor 790. Core 814 may be a rod of copper or other non-ferromagnetic material (e.g., aluminum). Core 814 may be inserted as a tight fit inside inner conductor 790 before a drawing operation. In some embodiments, core 814 and inner conductor 790 may be coextrusion bonded. Electrical insulator 792 may be magnesium oxide, silicon nitride, boron nitride, Nextel, mica, etc. Outer conductor 794 may be 347H stainless steel. A drawing or rolling operation to compact electrical insulator 792 may ensure good electrical contact between inner conductor 790 and core 814. In this embodiment, heat may be produced primarily in inner conductor 790 until the Curie temperature is approached. Resistance may then decrease sharply as alternating current penetrates core 814.

Figure 102B:
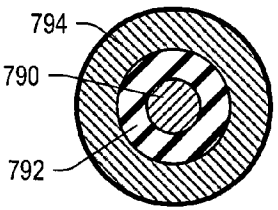
FIGS. 102A and 102B depict cross-sectional representations of an embodiment of a temperature limited heater.
Figure 102A:
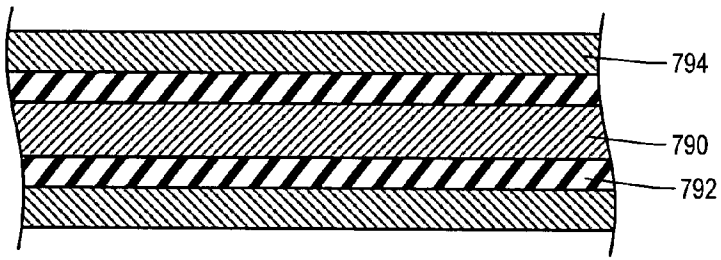

FIG. 102A and FIG. 102B depict cross-sectional representations of an embodiment of a temperature limited heater with a ferromagnetic outer conductor. Inner conductor 790 may be nickel-clad copper. Electrical insulator 792 may be silicon nitride, boron nitride, or magnesium oxide. Outer conductor 794 may be a 1" Schedule XXS carbon steel pipe. In this embodiment, heat may be produced primarily in outer conductor 794, resulting in a small temperature differential across electrical insulator 792.

Figure 103A:
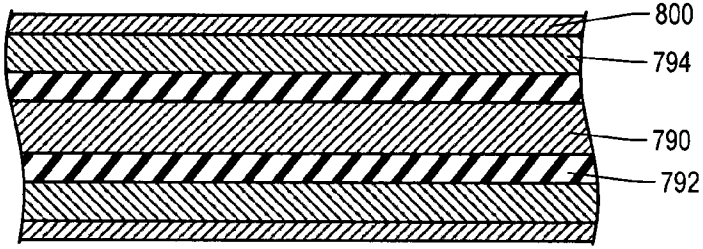
FIGS. 103A and 103B depict cross-sectional representations of an embodiment of a temperature limited heater.
Figure 103B:
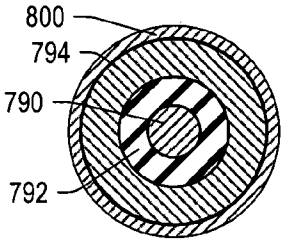

FIG. 103A and FIG. 103B depict cross-sectional representations of an embodiment of a temperature limited heater with a ferromagnetic outer conductor that is clad with a corrosion resistant alloy. Inner conductor 790 may be copper. Electrical insulator 792 may be silicon nitride, boron nitride, or magnesium oxide. Outer conductor 794 may be a 1" Schedule XXS 446 stainless steel pipe. Outer conductor 794 may be coupled to jacket 800. Jacket 800 may be made of corrosion resistant material (e.g., 347H stainless steel). Jacket 800 may provide protection from corrosive fluids in the borehole (e.g., sulfidizing and carburizing gases). In this embodiment, heat may be produced primarily in outer conductor 794, resulting in a small temperature differential across electrical insulator 792.

Figure 104A:
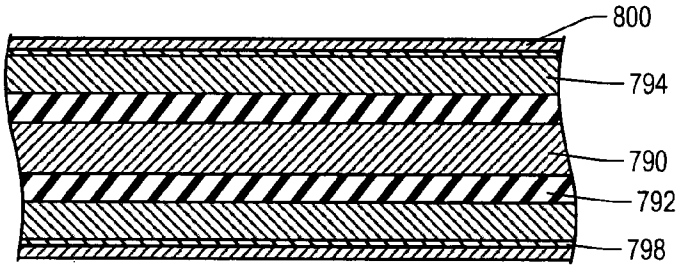
FIGS. 104A and 104B depict cross-sectional representations of an embodiment of a temperature limited heater.
Figure 104B:
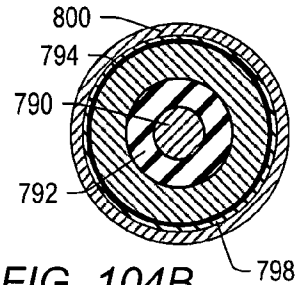

FIG. 104A and FIG. 104B depict cross-sectional representations of an embodiment of a temperature limited heater with a ferromagnetic outer conductor. The outer conductor may be clad with a conductive layer and a corrosion resistant alloy. Inner conductor 790 may be copper. Electrical insulator 792 may be silicon nitride, boron nitride, or magnesium oxide. Outer conductor 794 may be a 1" Schedule 80 446 stainless steel pipe. Outer conductor 794 may be coupled to jacket 800. Jacket 800 may be made from a corrosion resistant material (e.g., 347H stainless steel). In an embodiment, conductive layer 798 may be placed between outer conductor 794 and jacket 800. Conductive layer 798 may be a copper layer. In this embodiment, heat may be produced primarily in outer conductor 794, resulting in a small temperature differential across electrical insulator 792. Conductive layer 798 may allow a sharp decrease in the resistance of outer conductor 794 as the outer conductor approaches the Curie temperature. Jacket 800 may provide protection from corrosive fluids in the borehole (e.g., sulfidizing and carburizing gases).

Figure 105A:
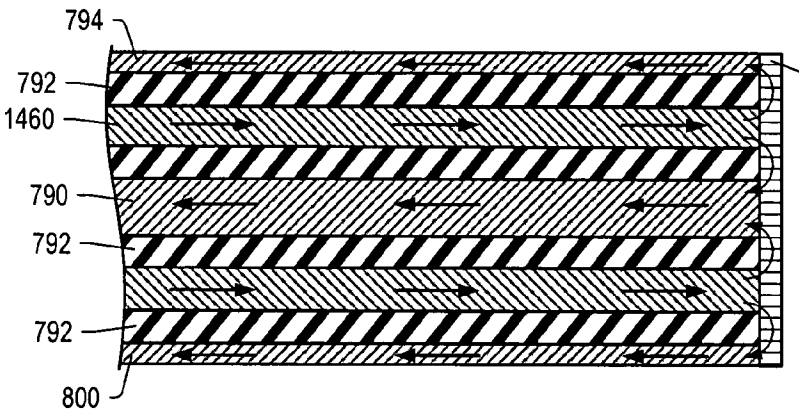
FIGS. 105A and 105B depict cross-sectional representations of an embodiment of a temperature limited heater.
Figure 105B:
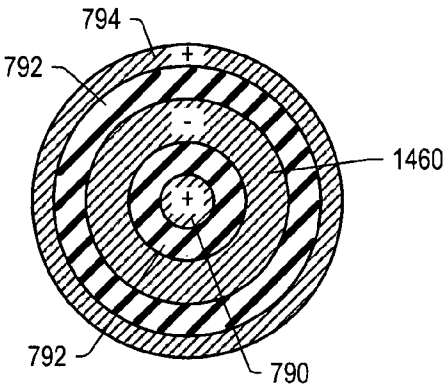

In an embodiment, a temperature limited heater may include triaxial conductors. FIG. 105A and FIG. 105B depict cross-sectional representations of an embodiment of a temperature limited heater with triaxial conductors. Inner conductor 790 may be copper or another highly conductive material. Electrical insulator 792 may be silicon nitride or boron nitride. Middle conductor 1460 may include ferromagnetic material (e.g., 446 stainless steel). In the embodiment of FIGS. 105A and 105B, outer conductor 794 may be separated from middle conductor 1460 by electrical insulator 792. Outer conductor 794 may include corrosion resistant, electrically conductive material (e.g., stainless steel). In some embodiments, electrical insulator 792 may be a space between conductors (e.g., an air gap or other gas gap) that electrically insulates the conductors (e.g., conductors 790, 794, and 1460 may be in a conductor-in-conduit-in-conduit arrangement)

In a temperature limited heater with triaxial conductors, such as depicted in FIGS. 105A and 105B, electrical current may propagate through two conductors in one direction and through the third conductor in an opposite direction. In FIGS. 105A and 105B, electrical current may propagate in through middle conductor 1460 in one direction and return through inner conductor 790 and outer conductor 794 in an opposite direction, as shown by the arrows in FIG. 105A and the +/− signs in FIG. 105B. In an embodiment, electrical current may be split approximately in half between inner conductor 790 and outer conductor 794. Splitting the electrical current between inner conductor 790 and outer conductor 794 causes current propagating through middle conductor 1460 to flow through both inside and outside skin depths of the middle conductor.

Current flows through both the inside and outside skin depths due to reduced magnetic field intensity from the current being split between the outer conductor and the inner conductor. Reducing the magnetic field intensity allows the skin depth of middle conductor 1460 to remain relatively small with the same magnetic permeability. Thus, the thinner inside and outside skin depths may produce an increased Curie effect compared to the same thickness of ferromagnetic material with only one skin depth. The thinner inside and outside skin depths may produce a sharper turndown than one single skin depth in the same ferromagnetic material. Splitting the current between outer conductor 794 and inner conductor 790 may allow a thinner middle conductor 1460 to produce the same Curie effect as a thicker middle conductor. In certain embodiments, the materials and thicknesses used for outer conductor 794, inner conductor 790 and middle conductor 1460 may have to be balanced to produce desired results in the Curie effect and turndown ratio of a triaxial temperature limited heater.

In some embodiments, a conductor (e.g., an inner conductor, an outer conductor, a ferromagnetic conductor) may be a composite conductor that includes two or more different materials. In certain embodiments, a composite conductor may include two or more ferromagnetic materials. In some embodiments, a composite ferromagnetic conductor includes two or more radially disposed materials. In certain embodiments, a composite conductor may include a ferromagnetic conductor and a non-ferromagnetic conductor. In some embodiments, a composite conductor may include a ferromagnetic conductor placed over a non-ferromagnetic core. Two or more materials may be used to obtain a relatively flat electrical resistivity versus temperature profile in a temperature region below the Curie temperature and/or a sharp decrease in the electrical resistivity at or near the Curie temperature (e.g., a relatively high turndown ratio). In some cases, two or more materials may be used to provide more than one Curie temperature for a temperature limited heater.

In certain embodiments, a composite electrical conductor may be formed using a billet coextrusion process. A billet coextrusion process may include coupling together two or more electrical conductors at relatively high temperatures (e.g., at temperatures that are near or above 75% of the melting temperature of a conductor). The electrical conductors may be drawn together at the relatively high temperatures. The drawn together conductors may then be cooled to form a composite electrical conductor made from the two or more electrical conductors. In some embodiments, the composite electrical conductor may be a solid composite electrical conductor. In certain embodiments, the composite electrical conductor may be a tubular composite electrical conductor.

In one embodiment, a copper core may be billet coextruded with a stainless steel conductor (e.g., 446 stainless steel). The copper core and the stainless steel conductor may be heated to a softening temperature in vacuum. At the softening temperature, the stainless steel conductor may be drawn over the copper core to form a tight fit. The stainless steel conductor and copper core may then be cooled to form a composite electrical conductor with the stainless steel surrounding the copper core.

Figure 106:
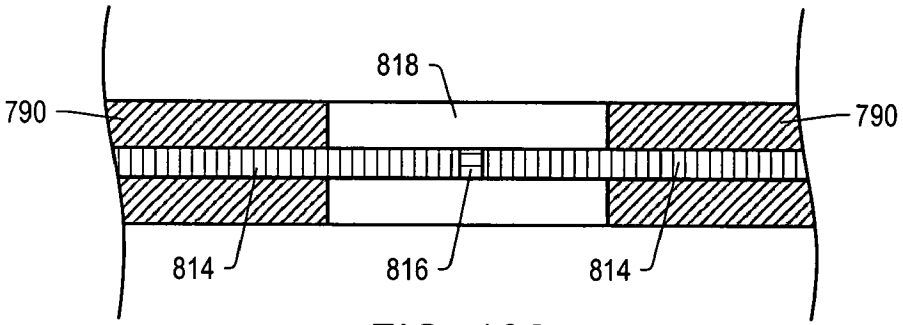
FIG. 106 depicts an embodiment of a coupled section of a composite electrical conductor.
Figure 107:
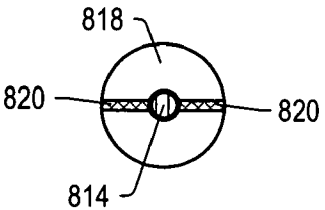
FIG. 107 depicts an end view of an embodiment of a coupled section of a composite electrical conductor.
Figure 108:
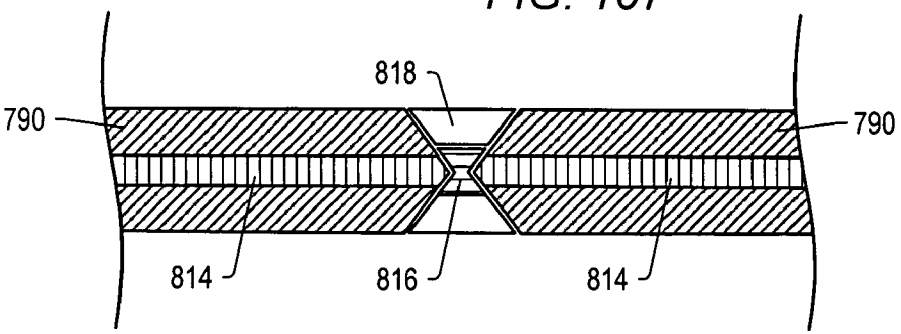
FIG. 108 depicts an embodiment for coupling together sections of a composite electrical conductor.

In some embodiments, a long, composite electrical conductor may be formed from several sections of composite electrical conductor. The sections of composite electrical conductor may be formed by a billet coextrusion process. The sections of composite electrical conductor may be coupled together using a welding process. FIGS. 106, 107, and 108 depict embodiments of coupled sections of composite electrical conductors. In FIG. 106, core 814 extends beyond the ends of inner conductor 790 in each section of a composite electrical conductor. In an embodiment, core 814 is copper and inner conductor 790 is 446 stainless steel. Cores 814 from each section of the composite electrical conductor may be coupled together by, for example, brazing the core ends together. Core coupling material 816 may couple the core ends together, as shown in FIG. 106. Core coupling material 816 may be, for example Everdur, a copper-silicon alloy material (e.g., an alloy with about 3% by weight silicon in copper).

Inner conductor coupling material 818 may couple inner conductors 790 from each section of the composite electrical conductor. Inner conductor coupling material 818 may be material used for welding sections of inner conductor 790 together. In certain embodiments, inner conductor coupling material 818 may be used for welding stainless steel inner conductor sections together. In some embodiments, inner conductor coupling material 818 is 304 stainless steel or 310 stainless steel. A third material (e.g., 309 stainless steel) may be used to couple inner conductor coupling material 818 to ends of inner conductor 790. The third material may be needed or desired to produce a better bond (e.g., a better weld) between inner conductor 790 and inner conductor coupling material 818. The third material may be non-magnetic to reduce the potential for a hot spot to occur at the coupling.

In certain embodiments, inner conductor coupling material 818 may surround the ends of cores 814 that protrude beyond the ends of inner conductors 790, as shown in FIG. 106. Inner conductor coupling material 818 may include one or more portions coupled together. Inner conductor coupling material 818 may be placed in a clam shell configuration around the ends of cores 814 that protrude beyond the ends of inner conductors 790, as shown in the end view depicted in FIG. 107. Coupling material 820 may be used to couple together portions (e.g., halves) of inner conductor coupling material 818. Coupling material 820 may be the same material as inner conductor coupling material 818 or another material suitable for coupling together portions of the inner conductor coupling material.

In some embodiments, a composite electrical conductor may include inner conductor coupling material 818 with 304 stainless steel or 310 stainless steel and inner conductor 790 with 446 stainless steel or another ferromagnetic material. In such an embodiment, inner conductor coupling material 818 may produce significantly less heat than inner conductor 790. The portions of the composite electrical conductor that include the inner conductor coupling material (e.g., the welded portions or "joints" of the composite electrical conductor) may remain at lower temperatures than adjacent material during application of applied electrical current to the composite electrical conductor. The reliability and durability of the composite electrical conductor may be increased by keeping the joints of the composite electrical conductor at lower temperatures.

FIG. 108 depicts an embodiment for coupling together sections of a composite electrical conductor. Ends of cores 814 and ends of inner conductors 790 are beveled to facilitate coupling together the sections of the composite electrical conductor. Core coupling material 816 may couple (e.g., braze) together the ends of each core 814. The ends of each inner conductor 790 may be coupled (e.g., welded) together with inner conductor coupling material 818. Inner conductor coupling material 818 may be 309 stainless steel or another suitable welding material. In some embodiments, inner conductor coupling material 818 is 309 stainless steel. 309 stainless steel may reliably weld to both an inner conductor having 446 stainless steel and a core having copper. Using beveled ends when coupling together sections of a composite electrical conductor may produce a reliable and durable coupling between the sections of composite electrical conductor. FIG. 108 depicts a weld formed between ends of sections that have beveled surfaces.

A composite electrical conductor may be used as a conductor in any electrical heater embodiment described herein. For example, a composite conductor may be used as a conductor in a conductor-in-conduit heater or an insulated conductor heater. In certain embodiments, a composite conductor may be coupled to a support member (e.g., a support conductor). A support member may be used to provide support to a composite conductor so that the composite conductor is not relied upon for strength at or near the Curie temperature. A support member may be useful for heaters of lengths greater than about 100 m. A support member may be a non-ferromagnetic member that has good high temperature creep strength. Examples of materials that may be used for a support member include, but are not limited to, Haynes® 625 alloy and Haynes® HR120® alloy (Haynes International, Kokomo, Ind.), Incoloy® 800H alloy and 347H alloy (Allegheny Ludlum Corp., Pittsburgh, Pa.). In some embodiments, materials in a composite conductor may be directly coupled (e.g., brazed or metallurgically bonded) to each other and/or a support member. Using a support member may decouple a ferromagnetic member from having to provide support for a heater, especially at or near the Curie temperature. Thus, a temperature limited heater may be designed with more flexibility in the selection of ferromagnetic materials.

Figure 109:
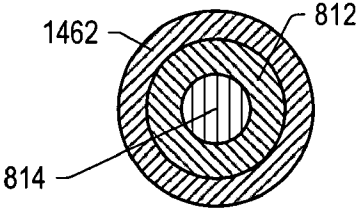
FIG. 109 depicts a cross-sectional representation of an embodiment of a composite conductor with a support member.

FIG. 109 depicts a cross-sectional representation of an embodiment of a composite conductor with a support member. In an embodiment, core 814 is surrounded by ferromagnetic conductor 812 and support member 1462. In an embodiment, core 814, ferromagnetic conductor 812, and support member 1462 may be directly coupled (e.g., brazed together or metallurgically bonded together (e.g., by vacuum high temperature coextrusion from Anomet Products, Inc.)). In one embodiment, core 814 is copper, ferromagnetic conductor 812 is 446 stainless steel, and support member 1462 is 347H alloy. In certain embodiments, support member 1462 may be a Schedule 80 pipe (e.g., a 0.75" Schedule 80 pipe). Support member 1462 may surround a composite conductor having ferromagnetic conductor 812 and core 814. Ferromagnetic conductor 812 and core 814 may be a composite conductor formed by, for example, a coextrusion process and obtained from Anomet Products, Inc. For example, the composite conductor may be a 0.75" (1.9 cm) outside diameter ferromagnetic conductor (e.g., 446 stainless steel) surrounding a 0.375" (0.95 cm) diameter core (e.g., copper). This composite conductor inside a ¾" Schedule 80 support member may produce a turndown ratio of about 1.7.

In certain embodiments, the diameter of core 814 may be adjusted relative to a constant outside diameter of ferromagnetic conductor 812 to adjust a turndown ratio of the heater. For example, the diameter of core 814 may be increased (e.g., to about 0.45" (1.14 cm) diameter) while maintaining the outside diameter of ferromagnetic conductor 812 at 0.75" to increase the turndown ratio of the heater to about 2.2.

Figure 110:
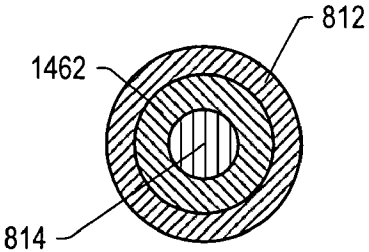
FIG. 110 depicts a cross-sectional representation of an embodiment of a composite conductor with a support member separating the conductors.

In some embodiments, conductors (e.g., core 814 and ferromagnetic conductor 812) in a composite conductor may be separated by support member 1462. FIG. 110 depicts a cross-sectional representation of an embodiment of a composite conductor with support member 1462 separating the conductors. In an embodiment, core 814 is copper with a diameter of about 0.375" (0.95 cm), support member 1462 is 347H alloy with an outside diameter of about 0.75" (1.9 cm), and ferromagnetic conductor 812 is 446 stainless steel with an outside diameter of about 1.05" (2.7 cm). Such a conductor may produce a turndown ratio of about 3 or greater. The embodiment depicted in FIG. 110 may have a higher creep strength relative to other support member embodiments depicted in FIGS. 109, 111, and 112.

Figure 111:
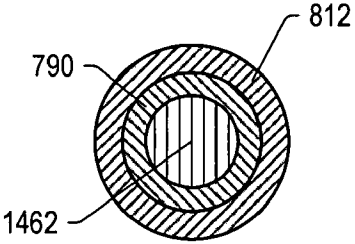
FIG. 111 depicts a cross-sectional representation of an embodiment of a composite conductor surrounding a support member.

In certain embodiments, support member 1462 may be located inside a composite conductor. FIG. 111 depicts a cross-sectional representation of an embodiment of a composite conductor surrounding support member 1462. Support member 1462 may be made of, for example, 347H alloy. Inner conductor 790 may be a non-ferromagnetic conductor (e.g., copper). Ferromagnetic conductor 812 may be 446 stainless steel. In an embodiment, support member 1462 is 0.5" (1.25 cm) diameter 347H alloy, inner conductor 790 is 0.75" (1.9 cm) outside diameter copper, and ferromagnetic conductor 812 is 1.05" (2.7 cm) outside diameter 446 stainless steel. Such a conductor may produce a turndown ratio substantially greater than about 3.

In some embodiments, a thickness of inner conductor 790, which may be copper, may be reduced to reduce the turndown ratio. For example, the diameter of support member 1462 may be increased to about 0.625" (1.6 cm) while maintaining the outside diameter of inner conductor 790 at about 0.75" (1.9 cm) to reduce the thickness of the conduit. This reduction in inner conductor 790 thickness results in a decreased turndown ratio. The turndown ratio, however, may still remain greater than about 3.

Figure 112:
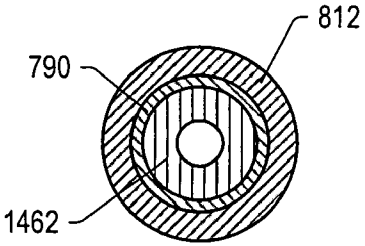
FIG. 112 depicts a cross-sectional representation of an embodiment of a composite conductor surrounding a conduit support member.

In an embodiment, support member 1462 may be a conduit or pipe inside inner conductor 790 and ferromagnetic conductor 812. FIG. 112 depicts a cross-sectional representation of an embodiment of a composite conductor surrounding support member 1462, which is a conduit. In an embodiment, support member 1462 may be 347H alloy with a 0.25" (0.63 cm) diameter hole in its center. In some embodiments, support member 1462 may be a preformed conduit. In certain embodiments, support member 1462 may be formed by having a dissolvable material (e.g., copper dissolvable by nitric acid) located inside the support member during formation of the composite conductor. The dissolvable material may be dissolved to form the hole after the conductor is assembled. In an embodiment, support member 1462 is 347H alloy with an inside diameter of about 0.25" (0.63 cm) and an outside diameter of about 0.62" (1.6 cm), inner conductor 790 is copper with an outside diameter of about 0.74" (1.8 cm), and ferromagnetic conductor 812 is 446 stainless steel with an outside diameter of about 1.05" (2.7 cm).

In an embodiment, a composite electrical conductor may be used as a conductor in a conductor-in-conduit heater. For example, a composite electrical conductor may be used as conductor 822 in FIGS. 113 and 114.

Figure 113:
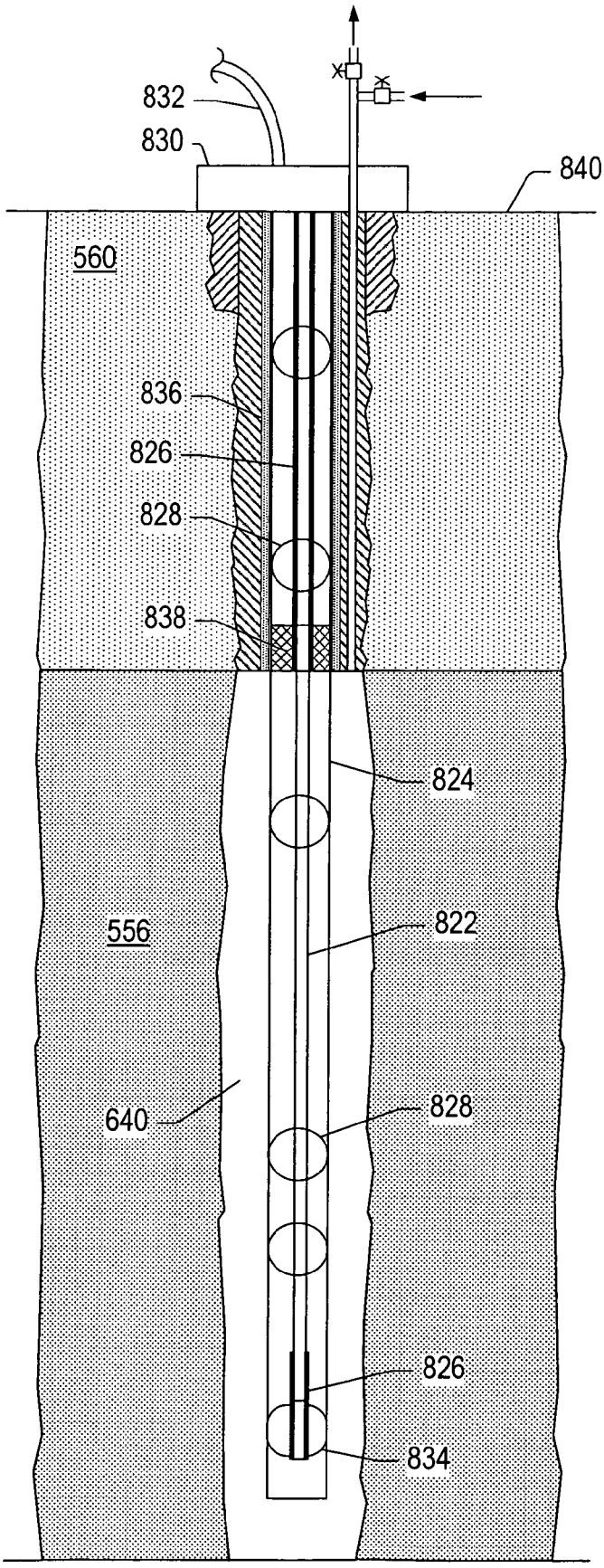
FIG. 113 depicts a cross-sectional representation of an embodiment of a conductor-in-conduit heat source.

FIG. 113 depicts a cross-sectional representation of an embodiment of a conductor-in-conduit heat source. Conductor 822 may be disposed in conduit 824. Conductor 822 may be a rod or conduit of electrically conductive material. Low resistance sections 826 may be present at both ends of conductor 822 to generate less heating in these sections. Low resistance section 826 may be formed by having a greater cross-sectional area of conductor 822 in that section, or the sections may be made of material having less resistance. In certain embodiments, low resistance section 826 includes a low resistance conductor coupled to conductor 822.

Conduit 824 may be made of an electrically conductive material. Conduit 824 may be disposed in opening 640 in hydrocarbon layer 556. Opening 640 has a diameter able to accommodate conduit 824.

Conductor 822 may be centered in conduit 824 by centralizers 828. Centralizers 828 may electrically isolate conductor 822 from conduit 824. Centralizers 828 may inhibit movement and properly locate conductor 822 in conduit 824. Centralizers 828 may be made of a ceramic material or a combination of ceramic and metallic materials. Centralizers 828 may inhibit deformation of conductor 822 in conduit 824. Centralizers 828 may be touching or spaced at intervals between approximately 0.1 m and approximately 3 m or more along conductor 822.

A second low resistance section 826 of conductor 822 may couple conductor 822 to wellhead 830, as depicted in FIG. 113. Electrical current may be applied to conductor 822 from power cable 832 through low resistance section 826 of conductor 822. Electrical current may pass from conductor 822 through sliding connector 834 to conduit 824. Conduit 824 may be electrically insulated from overburden casing 836 and from wellhead 830 to return electrical current to power cable 832. Heat may be generated in conductor 822 and conduit 824. The generated heat may radiate in conduit 824 and opening 640 to heat at least a portion of hydrocarbon layer 556.

Overburden casing 836 may be disposed in overburden 560. Overburden casing 836 may, in some embodiments, be surrounded by materials that inhibit heating of overburden 560. Low resistance section 826 of conductor 822 may be placed in overburden casing 836. Low resistance section 826 of conductor 822 may be made of, for example, carbon steel. Low resistance section 826 of conductor 822 may be centralized in overburden casing 836 using centralizers 828. Centralizers 828 may be spaced at intervals of approximately 6 m to approximately 12 m or, for example, approximately 9 m along low resistance section 826 of conductor 822. In a heat source embodiment, low resistance section 826 of conductor 822 is coupled to conductor 822 by a weld or welds. In other heat source embodiments, low resistance sections may be threaded, threaded and welded, or otherwise coupled to the conductor. Low resistance section 826 may generate little and/or no heat in overburden casing 836. Packing material 838 may be placed between overburden casing 836 and opening 640. Packing material 838 may inhibit fluid from flowing from opening 640 to surface 840.

Figure 114:
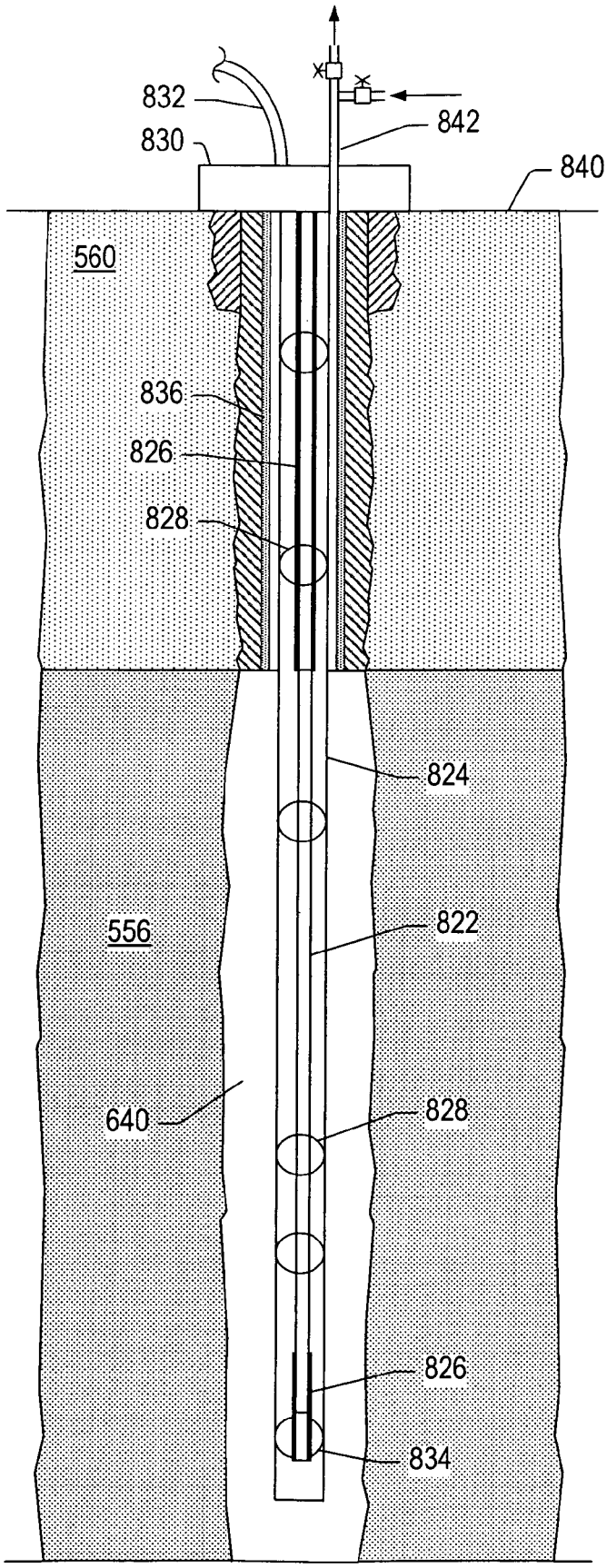
FIG. 114 depicts a cross-sectional representation of an embodiment of a removable conductor-in-conduit heat source.

FIG. 114 depicts a cross-sectional representation of an embodiment of a removable conductor-in-conduit heat source. Conduit 824 may be placed in opening 640 through overburden 560 such that a gap remains between the conduit and overburden casing 836. Fluids may be removed from opening 640 through the gap between conduit 824 and overburden casing 836. Fluids may be removed from the gap through conduit 842. Conduit 824 and components of the heat source included in the conduit that are coupled to wellhead 830 may be removed from opening 640 as a single unit. The heat source may be removed as a single unit to be repaired, replaced, and/or used in another portion of the formation.

Figure 115B:
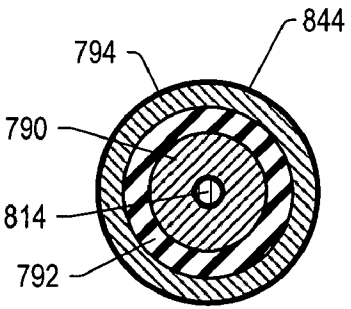
FIG. 115A and FIG. 115B depict an embodiment of an insulated conductor heater.
Figure 115A:
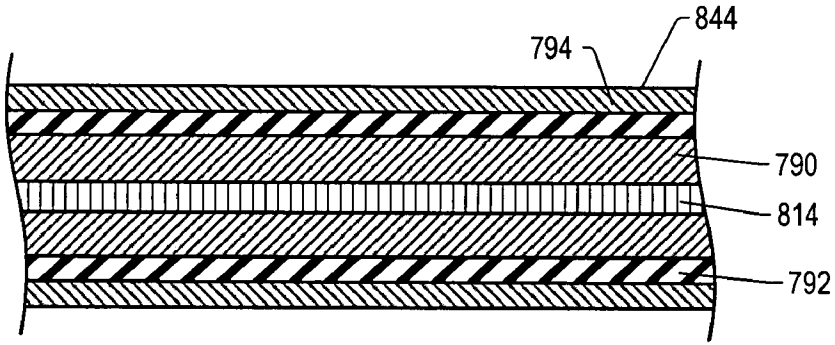

In certain embodiments, a composite electrical conductor may be used as a conductor in an insulated conductor heater. FIG. 115A and FIG. 115B depict an embodiment of an insulated conductor heater. Insulated conductor 844 may include core 814 and inner conductor 790. Core 814 and inner conductor 790 may be a composite electrical conductor. Core 814 and inner conductor 790 may be located within insulator 792. Core 814, inner conductor 790, and insulator 792 may be located inside outer conductor 794. Insulator 792 may be silicon nitride, boron nitride, magnesium oxide, or another suitable electrical insulator. Outer conductor 794 may be copper, steel, or any other electrical conductor.

In certain embodiments, insulator 792 may be a powdered insulator. In some embodiments, insulator 792 may be an insulator with a preformed shape (e.g., preformed half-shells). A composite electrical conductor having core 814 and inner conductor 790 may be placed inside the preformed insulator. Outer conductor 794 may be placed over insulator 792 by coupling (e.g., by welding or brazing) one or more longitudinal strips of electrical conductor together to form the outer conductor. The longitudinal strips may be placed over insulator 792 in a "cigarette wrap" method to couple the strips in a widthwise or radial direction (i.e., placing individual strips around the circumference of the insulator and coupling the individual strips to surround the insulator). The lengthwise ends of the cigarette wrapped strips may be coupled to lengthwise ends of other cigarette wrapped strips to couple the strips lengthwise along the insulated conductor.

Figure 116B:
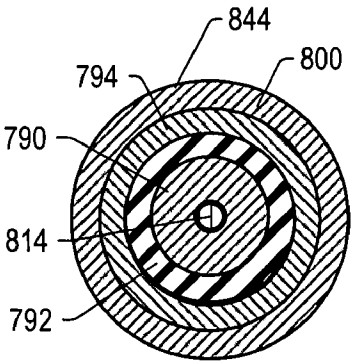
FIG. 116A and FIG. 116B depict an embodiment of an insulated conductor heater.
Figure 116A:
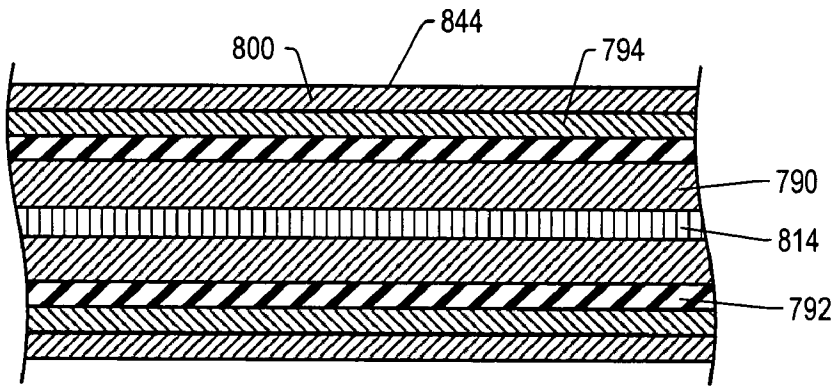

In some embodiments, jacket 800 may be located outside outer conductor 794, as shown in FIG. 116A and FIG. 116B. In some embodiments, jacket 800 may be stainless steel (e.g., 304 stainless steel) and outer conductor 794 may be copper. Jacket 800 may provide corrosion resistance for the insulated conductor heater. In some embodiments, jacket 800 and outer conductor 794 may be preformed strips that are drawn over insulator 792 to form insulated conductor 844.

Figure 117:
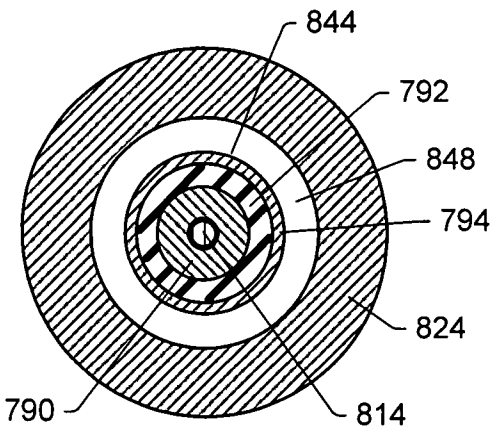
FIG. 117 depicts an embodiment of an insulated conductor located inside a conduit.

In certain embodiments, insulated conductor 844 may be located in a conduit that provides protection (e.g., corrosion and degradation protection) for the insulated conductor. FIG. 117 depicts an embodiment of an insulated conductor located inside a conduit. In FIG. 117, insulated conductor 844 is located inside conduit 824 with gap 848 separating the insulated conductor from the conduit.

In some embodiments, a composite electrical conductor may be used to achieve lower temperature heating (e.g., for heating fluids in a production well, heating a surface pipeline, or reducing the viscosity of fluids in a wellbore or near wellbore region). Varying the materials of the composite electrical conductor may be used to allow for lower temperature heating. In some embodiments, inner conductor 790 (as shown in FIGS. 106-117) may be made of materials with a lower Curie temperature than that of 446 stainless steel. For example, inner conductor 790 may be an alloy of iron and nickel. The alloy may have between about 30% by weight and about 42% by weight nickel with the rest being iron (e.g., a nickel/iron alloy such as Invar 36, which is about 36% by weight nickel in iron and has a Curie temperature of about 277° C.). In some embodiments, an alloy may be a three component alloy with, for example, chromium, nickel, and iron. For example, an alloy may have about 6% by weight chromium, 42% by weight nickel, and 52% by weight iron. An inner conductor made of these types of alloys may provide a heat output between about 250 watts per meter and about 350 watts per meter (e.g., about 300 watts per meter). A 2.5 cm diameter rod of Invar 36 has a turndown ratio of about 2 to 1 at the Curie temperature. Placing the Invar 36 alloy over a copper core may allow for a smaller rod diameter (e.g., less than 2.5 cm). A copper core may result in a high turndown ratio (e.g., greater than about 2 to 1). Insulator 792 may be made of a high performance polymer insulator (e.g., PFA, PEEK™) when used with alloys with a low Curie temperature (e.g., Invar 36) that is below the melting point or softening point of the polymer insulator.

For temperature limited heaters that include a copper core or copper cladding, the copper may be protected with a relatively diffusion-resistant layer (e.g., nickel). In some embodiments, a composite inner conductor may include iron clad over nickel clad over a copper core. The relatively diffusion-resistant layer may inhibit migration of copper into other layers of the heater including, for example, an insulation layer. In some embodiments, the relatively impermeable layer may inhibit deposition of copper in a wellbore during installation of the heater into the wellbore.

In one heater embodiment, an inner conductor may be a 1.9 cm diameter iron rod, an insulating layer may be 0.25 cm thick silicon nitride, boron nitride, or magnesium oxide, and an outer conductor may be 0.635 cm thick 347H or 347HH stainless steel. The heater may be energized at line frequency (e.g., 60 Hz) from a substantially constant current source. Stainless steel may be chosen for corrosion resistance in the gaseous subsurface environment and/or for superior creep resistance at elevated temperatures. Below the Curie temperature, heat may be produced primarily in the iron inner conductor. With a heat injection rate of about 820 watts/meter, the temperature differential across the insulating layer may be approximately 40° C. Thus, the temperature of the outer conductor may be about 40° C. cooler than the temperature of the inner ferromagnetic conductor.

In another heater embodiment, an inner conductor may be a 1.9 cm diameter rod of copper or copper alloy such as LOHM (about 94% copper and 6% nickel by weight), an insulating layer may be transparent quartz sand, and an outer conductor may be 0.635 cm thick 1% carbon steel clad with 0.25 cm thick 310 stainless steel. The carbon steel in the outer conductor may be clad with copper between the carbon steel and the stainless steel jacket. The copper cladding may reduce a thickness of carbon steel needed to achieve substantial resistance changes near the Curie temperature. Heat may be produced primarily in the ferromagnetic outer conductor, resulting in a small temperature differential across the insulating layer. When heat is produced primarily in the outer conductor, a lower thermal conductivity material may be chosen for the insulation. Copper or copper alloy may be chosen for the inner conductor to reduce the heat output from the inner conductor. The inner conductor may also be made of other metals that exhibit low electrical resistivity and relative magnetic permeabilities near 1 (i.e., substantially non-ferromagnetic materials such as aluminum and aluminum alloys, phosphor bronze, beryllium copper, and/or brass).

In some embodiments, a temperature limited heater may be a conductor-in-conduit heater. Ceramic insulators or centralizers may be positioned on the inner conductor. The inner conductor may make sliding electrical contact with the outer conduit in a sliding connector section. The sliding connector section may be located at or near the bottom of the heater.

Figure 118:
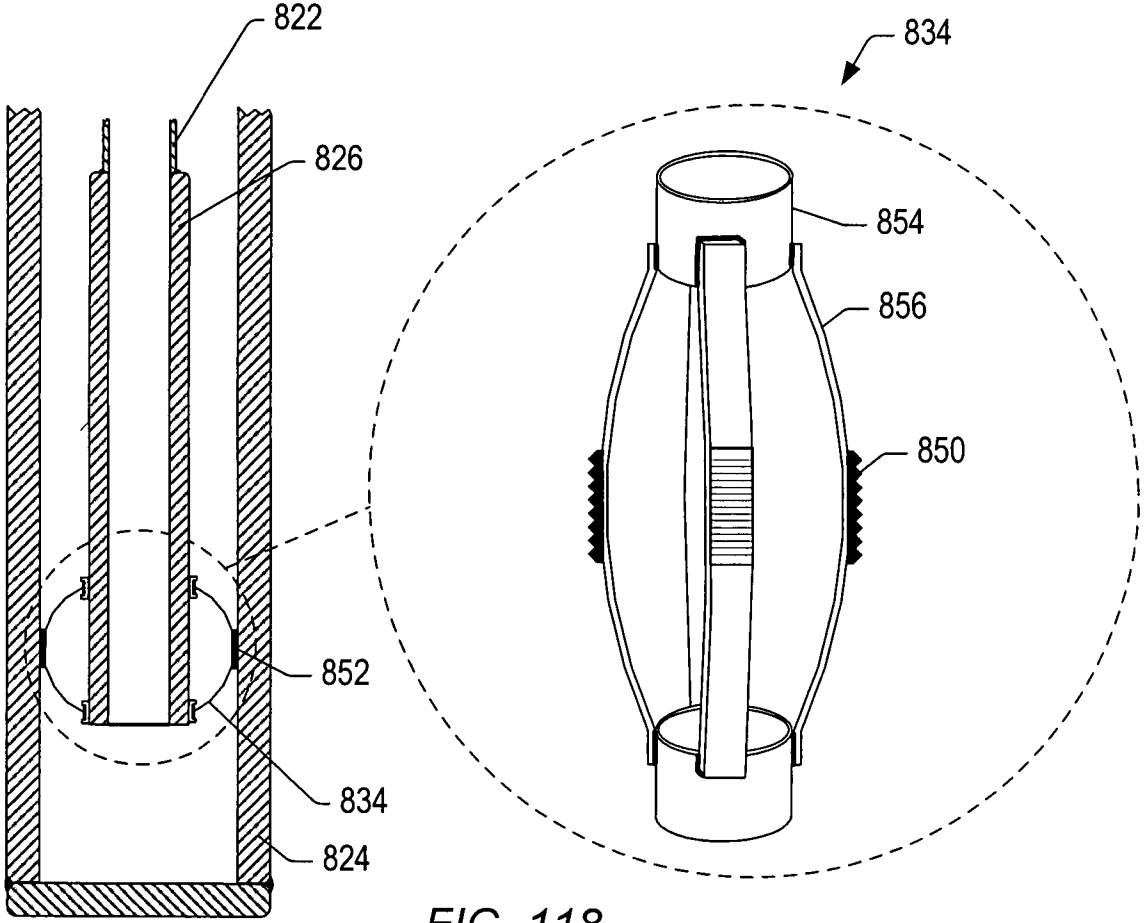
FIG. 118 depicts an embodiment of a sliding connector.

FIG. 118 depicts an embodiment of a sliding connector. Sliding connector 834 may be coupled near an end of conductor 822. Sliding connector 834 may be positioned near a bottom end of conduit 824. Sliding connector 834 may electrically couple conductor 822 to conduit 824. Sliding connector 834 may move during use to accommodate thermal expansion and/or contraction of conductor 822 and conduit 824 relative to each other. In some embodiments, sliding connector 834 may be attached to low resistance section 826 of conductor 822. The lower resistance of low resistance section 826 may allow the sliding connector to be at a temperature that does not exceed about 90° C. Maintaining sliding connector 834 at a relatively low temperature may inhibit corrosion of the sliding connector and promote good contact between the sliding connector and conduit 824.

Sliding connector 834 may include scraper 850. Scraper 850 may abut an inner surface of conduit 824 at point 852. Scraper 850 may include any metal or electrically conducting material (e.g., steel or stainless steel). Centralizer 854 may couple to conductor 822. In some embodiments, sliding connector 834 may be positioned on low resistance section 826 of conductor 822. Centralizer 854 may include any electrically conducting material (e.g., a metal or metal alloy). Spring bow 856 may couple scraper 850 to centralizer 854. Spring bow 856 may include any metal or electrically conducting material (e.g., copper-beryllium alloy). In some embodiments, centralizer 854, spring bow 856, and/or scraper 850 are welded together.

More than one sliding connector 834 may be used for redundancy and to reduce the current through each scraper 850. In addition, a thickness of conduit 824 may be increased for a length adjacent to sliding connector 834 to reduce heat generated in that portion of conduit. The length of conduit 824 with increased thickness may be, for example, approximately 6 m. In certain embodiments, electrical contact may be made between centralizer 854 and scraper 850 (shown in FIG. 118) on sliding connector 834 using an electrical conductor (e.g., a copper wire) that has a lower electrical resistance than spring bow 856. Electrical current may flow through the electrical conductor rather than spring bow 856 so that the spring bow has a longer lifetime.

In certain embodiments, centralizers (e.g., centralizers 828 depicted in FIGS. 113 and 114) may be made of silicon nitride ($Si_3N_4$). In some embodiments, silicon nitride may be gas pressure sintered reaction bonded silicon nitride. Gas pressure sintered reaction bonded silicon nitride can be made by sintering the silicon nitride at about 1800° C. in a 1,500 psi (10.3 MPa) nitrogen atmosphere to inhibit degradation of the silicon nitride during sintering. One example of a gas pressure sintered reaction bonded silicon nitride may be obtained from Ceradyne, Inc. (Costa Mesa, Calif.) as Ceralloy® 147-31N. Gas pressure sintered reaction bonded silicon nitride may be ground to a fine finish. The fine finish (i.e., very low surface porosity of the silicon nitride) may allow the silicon nitride to slide easily along metal surfaces and without picking up metal particles from the surfaces. Gas pressure sintered reaction bonded silicon nitride is a very dense material with high tensile strength, high flexural mechanical strength, and high thermal impact stress characteristics. Gas pressure sintered reaction bonded silicon nitride is an excellent high temperature electrical insulator. Gas pressure sintered reaction bonded silicon nitride has about the same leakage current at about 900° C. as alumina ($Al_2O_3$) at about 760° C. Gas pressure sintered reaction bonded silicon nitride has a thermal conductivity of about 25 watts per meter·K. The relatively high thermal conductivity may promote heat transfer away from the center conductor of a conductor-in-conduit heater.

Other types of silicon nitride such as, but not limited to, reaction-bonded silicon nitride or hot isostatically pressed silicon nitride may be used. Hot isostatic pressing may include sintering granular silicon nitride and additives at 15,000-30,000 psi (about 100-200 MPa) in nitrogen gas. Some silicon nitrides may be made by sintering silicon nitride with yttrium oxide or cerium oxide to lower the sintering temperature so that the silicon nitride does not degrade (e.g., release nitrogen) during sintering. However, adding other material to the silicon nitride may increase the leakage current of the silicon nitride at elevated temperatures compared to purer forms of silicon nitride.

Figure 119:
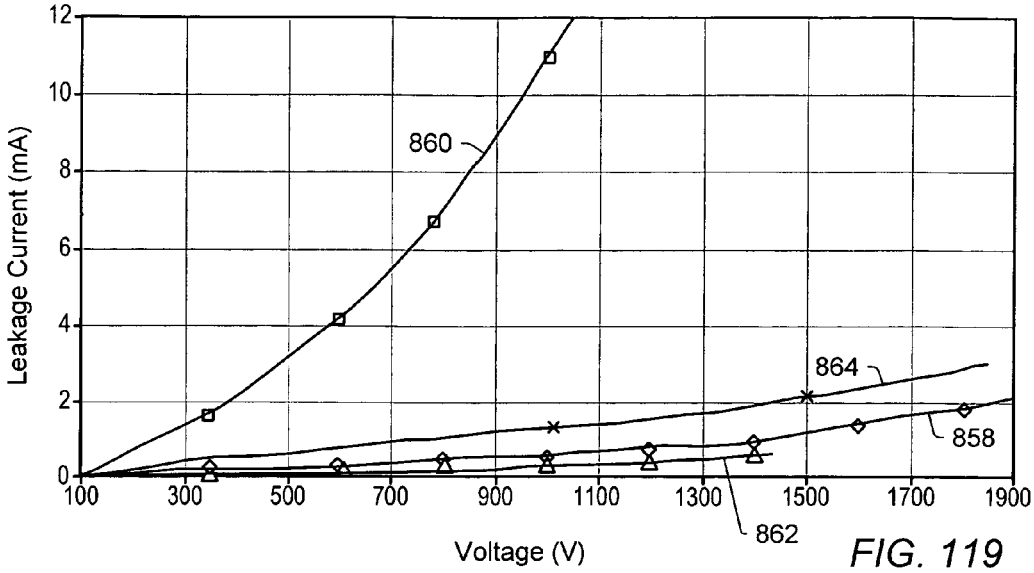
FIG. 119 depicts data of leakage current measurements versus voltage for alumina and silicon nitride centralizers at selected temperatures.

FIG. 119 depicts leakage current versus voltage for alumina and silicon nitride centralizers at selected temperatures. Leakage current was measured between a conductor and a conduit in a 3 foot (0.91 m) conductor-in-conduit section with two centralizers. The conductor-in-conduit was placed horizontally in a furnace. Plot 858 depicts data for alumina centralizers at a temperature of 760° C. Plot 860 depicts data for alumina centralizers at a temperature of 815° C. Plot 862 depicts data for gas pressure sintered reaction bonded silicon nitride centralizers at a temperature of 760° C. Plot 864 depicts data for gas pressure sintered reaction bonded silicon nitride at a temperature of 871° C. FIG. 119 shows that the leakage current of alumina increases substantially from 760° C. to 815° C. while the leakage current of gas pressure sintered reaction bonded silicon nitride remains relatively low from about 760° C. to 871° C.

Figure 120:
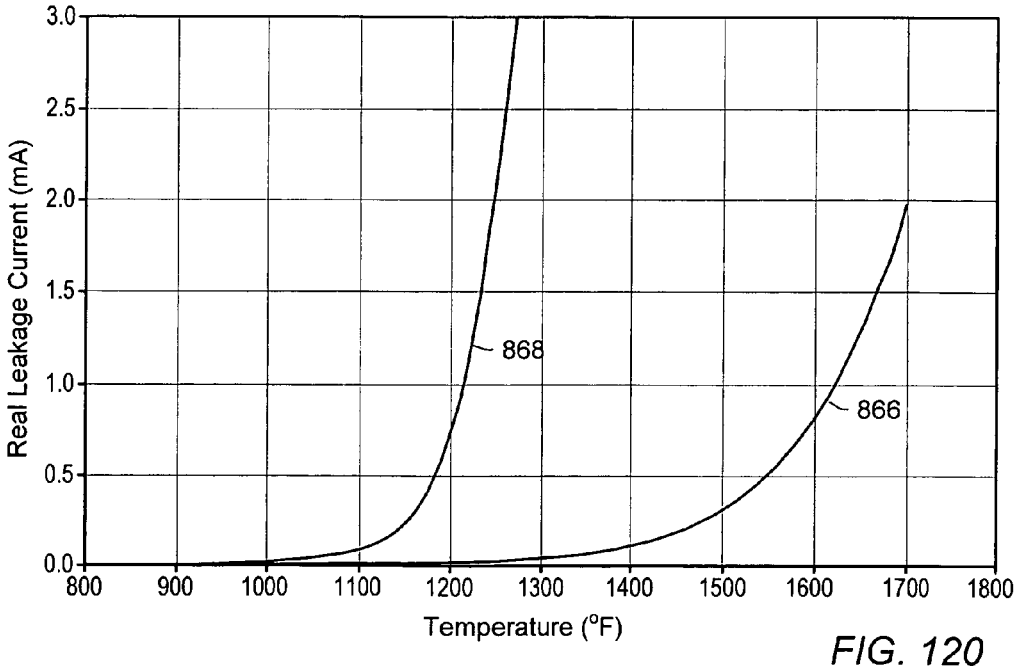
FIG. 120 depicts leakage current measurements versus temperature for two different types of silicon nitride.

FIG. 120 depicts leakage current versus temperature for two different types of silicon nitride. Plot 866 depicts leakage current versus temperature for highly polished, gas pressure sintered reaction bonded silicon nitride. Plot 868 depicts leakage current versus temperature for doped densified silicon nitride. FIG. 120 shows the improved leakage current versus temperature characteristics of gas pressure sintered reaction bonded silicon nitride versus doped silicon nitride.

Using silicon nitride centralizers may allow for smaller diameter and higher temperature heaters. A smaller gap may be needed between a conductor and a conduit because of the excellent electrical characteristics of the silicon nitride (e.g., low leakage current at high temperatures). Silicon nitride centralizers may allow higher operating voltages (e.g., up to at least about 2500 V) to be used in heaters due to the electrical characteristics of the silicon nitride. Operating at higher voltages may allow longer length heaters to be utilized (e.g., lengths up to at least about 1500 m at about 2500 V). In some embodiments, boron nitride may be used as a material for centralizers or other electrical insulators. Boron nitride is a better thermal conductor and has better electrical properties than silicon nitride. Boron nitride does not absorb water readily (i.e., is substantially non-hygroscopic). Boron nitride may be available in at least a hexagonal form and a face centered cubic form. A hexagonal crystalline formation may have several desired properties, including, but not limited to, a high thermal conductivity and a low friction coefficient.

Figure 121:
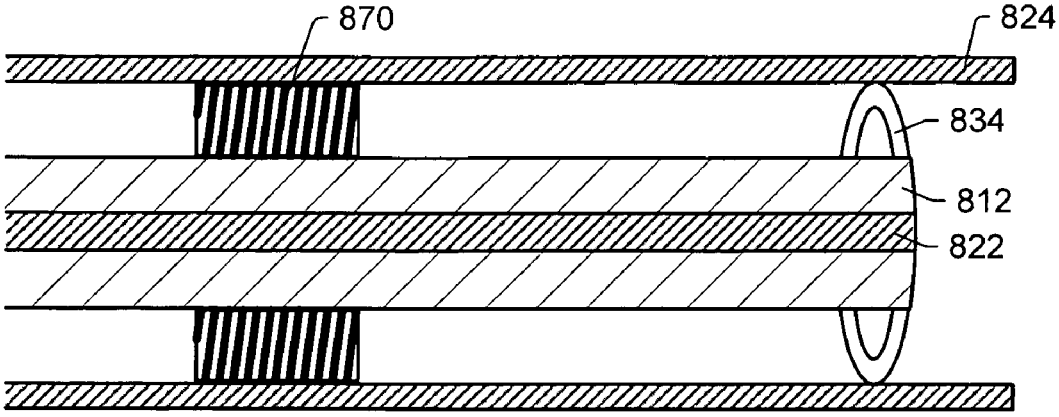
FIG. 121 depicts an embodiment of a conductor-in-conduit temperature limited heater.

FIG. 121 depicts an embodiment of a conductor-in-conduit temperature limited heater. Conductor 822 may be coupled to ferromagnetic conductor 812 (e.g., clad, coextruded, press fit, drawn inside). In some embodiments, ferromagnetic conductor 812 may be billet coextruded over conductor 822. Ferromagnetic conductor 812 may be coupled to the outside of conductor 822 so that alternating current propagates only through the skin depth of the ferromagnetic conductor at room temperature. Ferromagnetic conductor 812 may provide mechanical support for conductor 822 at elevated temperatures. Ferromagnetic conductor 812 may be iron, an iron alloy (e.g., iron with about 10% to about 27% by weight chromium for corrosion resistance and lower Curie temperature (e.g., 446 stainless steel)), or any other ferromagnetic material. In an embodiment, conductor 822 is copper and ferromagnetic conductor 812 is 446 stainless steel.

Conductor 822 and ferromagnetic conductor 812 may be electrically coupled to conduit 824 with sliding connector 834. Conduit 824 may be a non-ferromagnetic material such as, but not limited to, 347H stainless steel.

In one embodiment, conduit 824 is a 1½" Schedule 80 347H stainless steel pipe. In another embodiment, conduit 824 is a Schedule XXH 347H stainless steel pipe. One or more centralizers 870 may maintain the gap between conduit 824 and ferromagnetic conductor 812. In an embodiment, centralizer 870 is made of gas pressure sintered reaction bonded silicon nitride. Centralizer 870 may be held in position on ferromagnetic conductor 812 by one or more weld tabs located on the ferromagnetic conductor.

In certain embodiments, a conductor-in-conduit temperature limited heater may be used in lower temperature applications by using lower Curie temperature ferromagnetic materials. For example, a lower Curie temperature ferromagnetic material may be used for heating inside sucker pump rods. Heating sucker pump rods may be useful to lower the viscosity of fluids in the sucker pump or rod and/or to maintain a lower viscosity of fluids in the sucker pump rod. Lowering the viscosity of the oil may inhibit sticking of a pump used to pump the fluids. Fluids in the sucker pump rod may be heated up to temperatures less than about 250° C. or less than about 300° C. Temperatures need to be maintained below these values to inhibit coking of hydrocarbon fluids in the sucker pump system.

For lower temperature applications, ferromagnetic conductor 812 in FIG. 121 may be alloy 42-6 coupled to conductor 822. Conductor 822 may be copper. In one embodiment, ferromagnetic conductor 812 may be 1.9 cm outside diameter alloy 42-6 over copper conductor 822 with a 2:1 outside diameter to copper diameter ratio. In some embodiments, ferromagnetic conductor 812 may include other lower temperature ferromagnetic materials such as alloy 32, Invar 36, iron-nickel-chromium alloys, iron-nickel alloys, nickel alloys, or nickel-chromium alloys. Conduit 824 may be a hollow sucker rod made from carbon steel. The carbon steel or other material used in conduit 824 may confine alternating current to the inside of the conduit to inhibit stray voltages at the surface of the formation. Centralizer 870 may be made from gas pressure sintered reaction bonded silicon nitride. In some embodiments, centralizer 870 may be made from polymers such as PFA or PEEK™. In certain embodiments, polymer insulation may be clad along an entire length of the heater.

Figure 122:
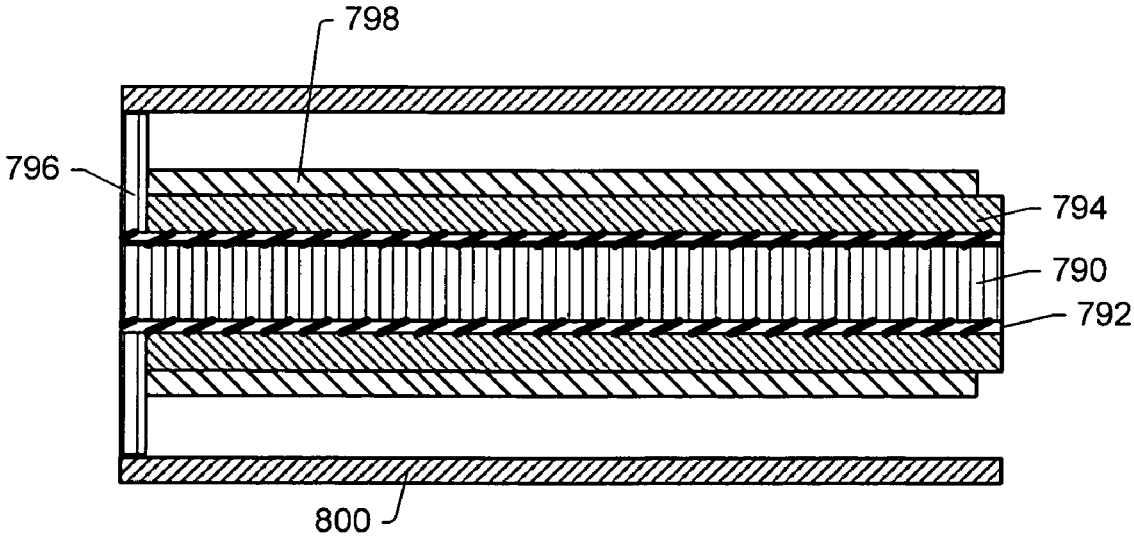
FIG. 122 depicts an embodiment of a temperature limited heater with a low temperature ferromagnetic outer conductor.

FIG. 122 depicts an embodiment of a temperature limited heater with a low temperature ferromagnetic outer conductor. Outer conductor 794 may be glass sealing alloy 42-6 (about 42.5% by weight nickel, about 5.75% by weight chromium, and the remainder iron). Alloy 42-6 has a relatively low Curie temperature of about 295° C. Alloy 42-6 may be obtained from Carpenter Metals (Reading, Pa.) or Anomet Products, Inc. In some embodiments, outer conductor 794 may include other compositions and/or materials to get various Curie temperatures (e.g., Carpenter Temperature Compensator "32" (Curie temperature of about 199° C.; available from Carpenter Metals) or Invar 36). In an embodiment, conductive layer 798 is coupled (e.g., clad, welded, or brazed) to outer conductor 794. Conductive layer 798 may be a copper layer. Conductive layer 798 may improve a turndown ratio of outer conductor 794. Jacket 800 may be a ferromagnetic metal such as carbon steel. Jacket 800 may protect outer conductor 794 from a corrosive environment. Inner conductor 790 may have electrical insulator 792. Electrical insulator 792 may be a mica tape winding with overlaid fiberglass braid. In an embodiment, inner conductor 790 and electrical insulator 792 are a 4/0 MGT-1000 furnace cable or 3/0 MGT-1000 furnace cable. 4/0 MGT-1000 furnace cable or 3/0 MGT-1000 furnace cable is available from Allied Wire and Cable (Phoenixville, Pa.). In some embodiments, a protective braid (e.g., stainless steel braid) may be placed over electrical insulator 792.

Conductive section 796 may electrically couple inner conductor 790 to outer conductor 794 and/or jacket 800. In some embodiments, jacket 800 may touch or electrically contact conductive layer 798 (e.g., if the heater is placed in a horizontal configuration). If jacket 800 is a ferromagnetic metal such as carbon steel (with a Curie temperature above the Curie temperature of outer conductor 794), current will propagate only on the inside of the jacket. Thus, the outside of the jacket remains electrically safe during operation. In some embodiments, jacket 800 may be drawn down (e.g., swaged down in a die) onto conductive layer 798 so that a tight fit is made between the jacket and the conductive layer. The heater may be spooled as coiled tubing for insertion into a wellbore. In other embodiments, an annular space may be present between conductive layer 798 and jacket 800, as depicted in FIG. 122.

Figure 123:
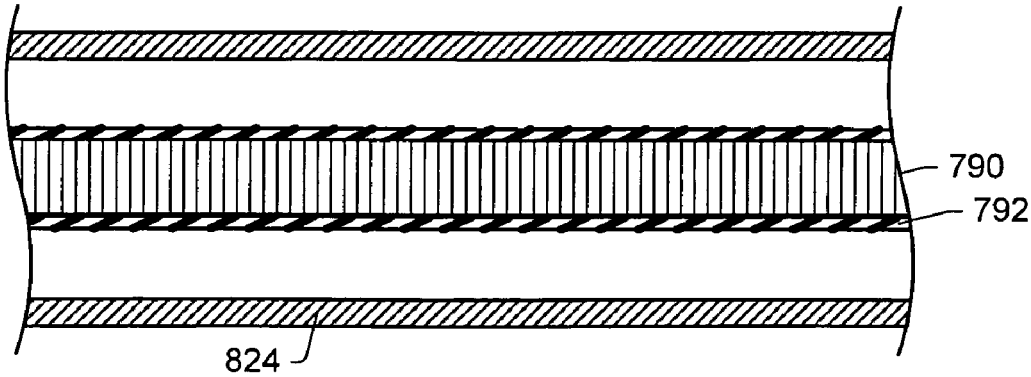
FIG. 123 depicts an embodiment of a temperature limited conductor-in-conduit heater.

FIG. 123 depicts an embodiment of a temperature limited conductor-in-conduit heater. Conduit 824 may be a hollow sucker rod made of a ferromagnetic metal such as alloy 42-6, alloy 32, Invar 36, iron-nickel-chromium alloys, iron-nickel alloys, nickel alloys, or nickel-chromium alloys. Inner conductor 790 may have electrical insulator 792. Electrical insulator 792 may be a mica tape winding with overlaid fiberglass braid. In an embodiment, inner conductor 790 and electrical insulator 792 are a 4/0 MGT-1000 furnace cable or 3/0 MGT-1000 furnace cable. In some embodiments, polymer insulations may be used for lower temperature Curie heaters. In certain embodiments, a protective braid (e.g., stainless steel braid) may be placed over electrical insulator 792. Conduit 824 may have a wall thickness that is greater than the skin depth at the Curie temperature (e.g., about 2 to 3 times the skin depth at the Curie temperature). In some embodiments, a more conductive conductor may be coupled to conduit 824 to increase the turndown ratio of the heater.

Figure 124:
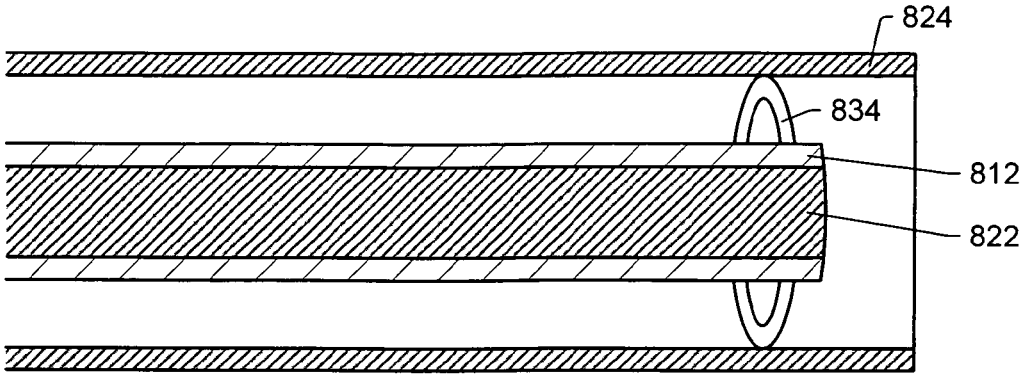
FIG. 124 depicts a cross-sectional representation of an embodiment of a conductor-in-conduit temperature limited heater.

FIG. 124 depicts a cross-sectional representation of an embodiment of a conductor-in-conduit temperature limited heater. Conductor 822 may be coupled (e.g., clad, coextruded, press fit, drawn inside) to ferromagnetic conductor 812. A metallurgical bond between conductor 822 and ferromagnetic conductor 812 may be favorable. Ferromagnetic conductor 812 may be coupled to the outside of conductor 822 so that alternating current propagates through the skin depth of the ferromagnetic conductor at room temperature. Conductor 822 may provide mechanical support for ferromagnetic conductor 812 at elevated temperatures. Ferromagnetic conductor 812 may be iron, an iron alloy (e.g., iron with about 10% to about 27% by weight chromium for corrosion resistance (446 stainless steel)), or any other ferromagnetic material. In one embodiment, conductor 822 is 304 stainless steel and ferromagnetic conductor 812 is 446 stainless steel. Conductor 822 and ferromagnetic conductor 812 may be electrically coupled to conduit 824 with sliding connector 834. Conduit 824 may be a non-ferromagnetic material such as austentitic stainless steel.

Figure 125:
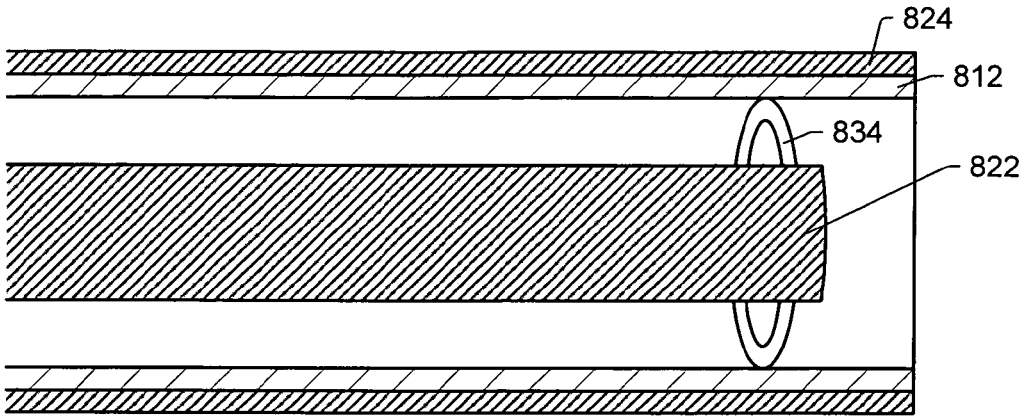
FIG. 125 depicts a cross-sectional representation of an embodiment of a conductor-in-conduit temperature limited heater.

FIG. 125 depicts a cross-sectional representation of an embodiment of a conductor-in-conduit temperature limited heater. Conduit 824 may be coupled to ferromagnetic conductor 812 (e.g., clad, press fit, or drawn inside of the ferromagnetic conductor). Ferromagnetic conductor 812 may be coupled to the inside of conduit 824 to allow alternating current to propagate through the skin depth of the ferromagnetic conductor at room temperature. Conduit 824 may provide mechanical support for ferromagnetic conductor 812 at elevated temperatures. Conduit 824 and ferromagnetic conductor 812 may be electrically coupled to conductor 822 with sliding connector 834.

Figure 126:
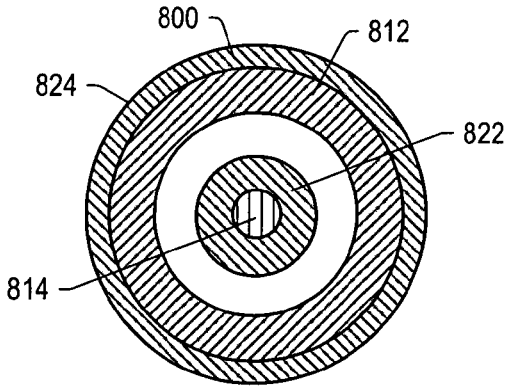
FIG. 126 depicts a cross-sectional view of an embodiment of a conductor-in-conduit temperature limited heater.

FIG. 126 depicts a cross-sectional view of an embodiment of a conductor-in-conduit temperature limited heater. Conductor 822 may surround core 814. In an embodiment, conductor 822 is 347H stainless steel and core 814 is copper. Conductor 822 and core 814 may be formed together as a composite conductor. Conduit 824 may include ferromagnetic conductor 812. In an embodiment, ferromagnetic conductor 812 may be Sumitomo HCM12A or 446 stainless steel. Ferromagnetic conductor 812 may have a Schedule XXH thickness so that the conductor is inhibited from deforming. In certain embodiments, conduit 824 may also include jacket 800. Jacket 800 may include corrosion resistant material that inhibits electrons from flowing away from the heater and into a subsurface formation at higher temperatures (e.g., temperatures near the Curie temperature of ferromagnetic conductor 812). For example, jacket 800 may be about a 0.4 cm thick sheath of 410 stainless steel. Inhibiting electrons from flowing to the formation may increase the safety of using a heater in a subsurface formation.

Figure 127:
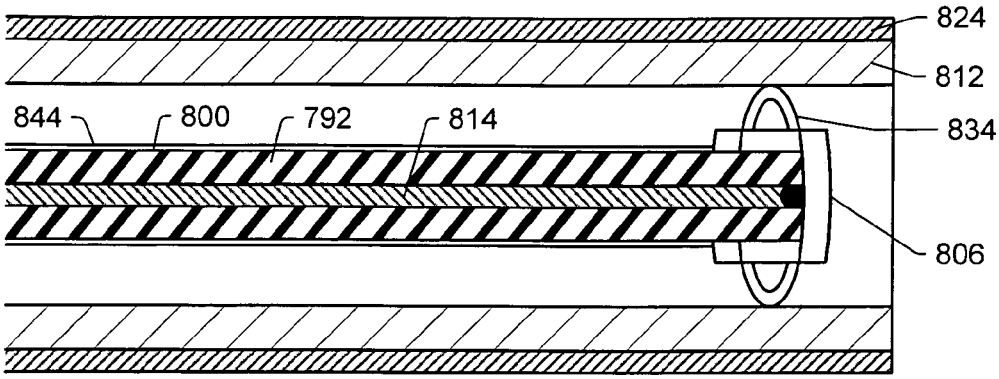
FIG. 127 depicts a cross-sectional representation of an embodiment of a conductor-in-conduit temperature limited heater with an insulated conductor.

FIG. 127 depicts a cross-sectional representation of an embodiment of a conductor-in-conduit temperature limited heater with an insulated conductor. Insulated conductor 844 may include core 814, electrical insulator 792, and jacket 800. Jacket 800 may be made of a corrosion resistant material (e.g., stainless steel). Endcap 806 may be placed at an end of insulated conductor 844 to couple core 814 to sliding connector 834. Endcap 806 may be made of non-corrosive, electrically conducting materials such as nickel or stainless steel. Endcap 806 may be coupled to the end of insulated conductor 844 by any suitable method (e.g., welding, soldering, braising). Sliding connector 834 may electrically couple core 814 and endcap 806 to ferromagnetic conductor 812. Conduit 824 may provide support for ferromagnetic conductor 812 at elevated temperatures.

Figure 128:
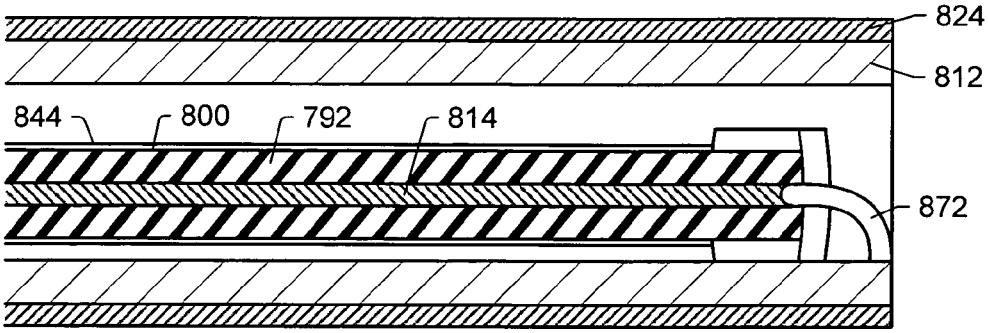
FIG. 128 depicts a cross-sectional representation of an embodiment of an insulated conductor-in-conduit temperature limited heater.

FIG. 128 depicts a cross-sectional representation of an embodiment of an insulated conductor-in-conduit temperature limited heater. Insulated conductor 844 may include core 814, electrical insulator 792, and jacket 800. Insulated conductor 844 may be coupled to ferromagnetic conductor 812 with connector 872. Connector 872 may be made of non-corrosive, electrically conducting materials such as nickel or stainless steel. Connector 872 may be coupled to insulated conductor 844 and coupled to ferromagnetic conductor 812 using suitable methods for electrically coupling (e.g., welding, soldering, braising). Insulated conductor 844 may be placed along a wall of ferromagnetic conductor 812. Insulated conductor 844 may provide mechanical support for ferromagnetic conductor 812 at elevated temperatures. In some embodiments, other structures (e.g., a conduit) may be used to provide mechanical support for ferromagnetic conductor 812.

Figure 129:
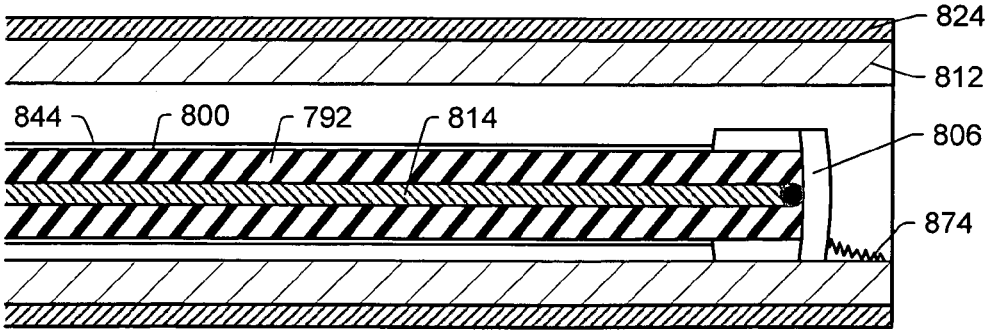
FIG. 129 depicts a cross-sectional representation of an embodiment of an insulated conductor-in-conduit temperature limited heater.

FIG. 129 depicts a cross-sectional representation of an embodiment of an insulated conductor-in-conduit temperature limited heater. Insulated conductor 844 may be coupled to endcap 806. Endcap 806 may be coupled to coupling 874. Coupling 874 may electrically couple insulated conductor 844 to ferromagnetic conductor 812. Coupling 874 may be a flexible coupling. For example, coupling 874 may include flexible materials (e.g., braided wire). Coupling 874 may be made of non-corrosive materials such as nickel, stainless steel, and/or copper.

Figure 130:
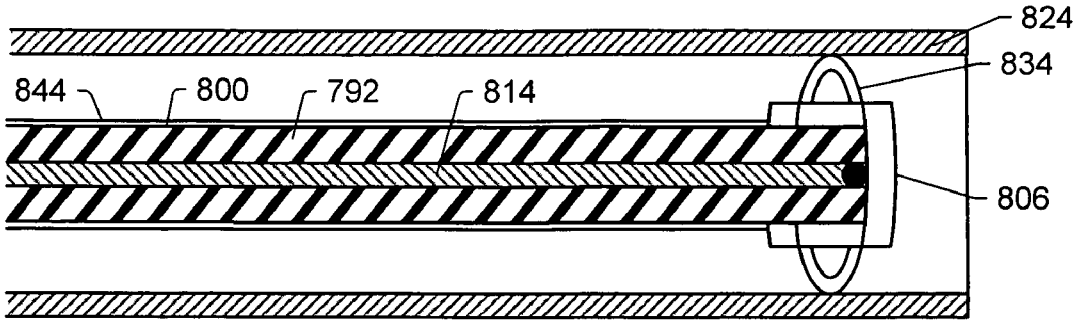
FIG. 130 depicts a cross-sectional representation of an embodiment of a conductor-in-conduit temperature limited heater with an insulated conductor.

FIG. 130 depicts a cross-sectional representation of an embodiment of a conductor-in-conduit temperature limited heater with an insulated conductor. Insulated conductor 844 may include core 814, electrical insulator 792, and jacket 800. Jacket 800 may be made of a highly electrically conductive material (e.g., copper). Core 814 may be made of a lower temperature ferromagnetic material such as such as alloy 42-6, alloy 32, Invar 36, iron-nickel-chromium alloys, iron-nickel alloys, nickel alloys, or nickel-chromium alloys. In certain embodiments, the materials of jacket 800 and core 814 may be reversed so that the jacket is the ferromagnetic conductor and the core is the highly conductive portion of the heater. Ferromagnetic material used in jacket 800 or core 814 may have a thickness greater than the skin depth at the Curie temperature (e.g., about 2 to 3 times the skin depth at the Curie temperature). Endcap 806 may be placed at an end of insulated conductor 844 to couple core 814 to sliding connector 834. Endcap 806 may be made of non-corrosive, electrically conducting materials such as nickel or stainless steel. Conduit 824 may be a hollow sucker rod made from, for example, carbon steel.

Figure 131:
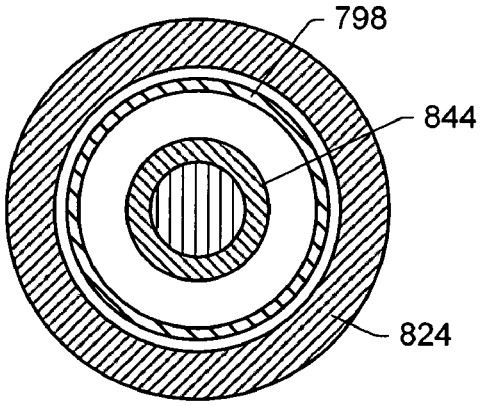
FIGS. 131 and 132 depict cross-sectional views of an embodiment of a temperature limited heater that includes an insulated conductor.
Figure 132:
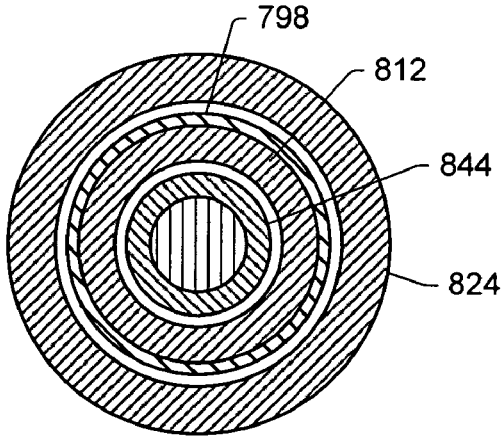

FIGS. 131 and 132 depict cross-sectional views of an embodiment of a temperature limited heater that includes an insulated conductor. FIG. 131 depicts a cross-sectional view of an embodiment of an overburden section of the temperature limited heater. The overburden section may include insulated conductor 844 placed in conduit 824. Conduit 824 may be 1¼" Schedule 80 carbon steel pipe internally clad with copper in the overburden section. Insulated conductor 844 may be a mineral insulated cable or polymer insulated cable. Conductive layer 798 may be placed in the annulus between insulated conductor 844 and conduit 824. Conductive layer 798 may be approximately 2.5 cm diameter copper tubing. The overburden section may be coupled to the heating section of the heater. FIG. 132 depicts a cross-sectional view of an embodiment of a heating section of the temperature limited heater. Insulated conductor 844 in the heating section may be a continuous portion of insulated conductor 844 in the overburden section. Ferromagnetic conductor 812 may be coupled to conductive layer 798. In certain embodiments, conductive layer 798 in the heating section may be copper drawn over ferromagnetic conductor 812 and coupled to conductive layer 798 in overburden section. Conduit 824 may include a heating section and an overburden section. These two sections may be coupled together to form conduit 824. The heating section may be 1¼" Schedule 80 347H stainless steel pipe. An end cap, or other suitable electrical connector, may couple ferromagnetic conductor 812 to insulated conductor 844 at a lower end of the heater (i.e., the end farthest from the overburden section).

Figure 133:
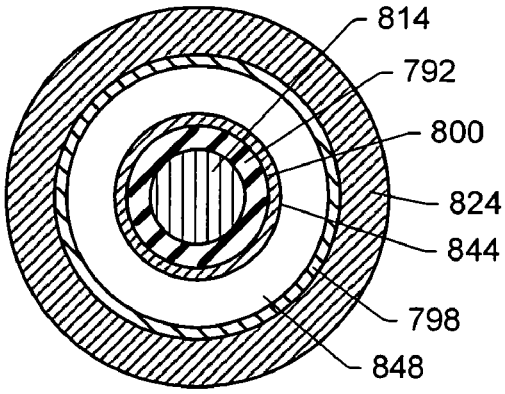
FIGS. 133 and 134 depict cross-sectional views of an embodiment of a temperature limited heater that includes an insulated conductor.
Figure 134:
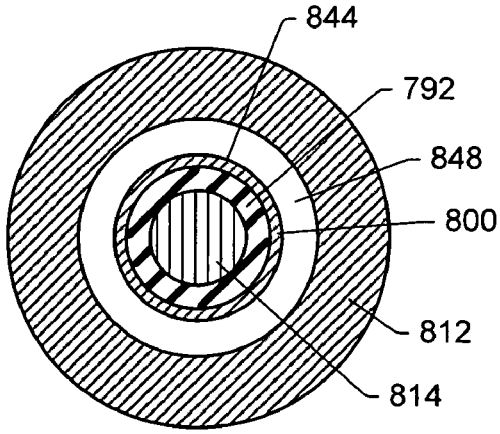

FIGS. 133 and 134 depict cross-sectional views of an embodiment of a temperature limited heater that includes an insulated conductor. FIG. 133 depicts a cross-sectional view of an embodiment of an overburden section of the temperature limited heater. Insulated conductor 844 may include core 814, electrical insulator 792, and jacket 800. Insulated conductor 844 may have a diameter of about 1.5 cm. Core 814 may be copper. Electrical insulator 792 may be silicon nitride, boron nitride, or magnesium oxide. Jacket 800 may be copper in the overburden section to reduce heat losses. Conduit 824 may be 1" Schedule 40 carbon steel in the overburden section. Conductive layer 798 may be coupled to conduit 824. Conductive layer 798 may be copper with a thickness of about 0.2 cm to reduce heat losses in the overburden section. Gap 848 may be an annular space between insulated conductor 844 and conduit 824. FIG. 134 depicts a cross-sectional view of an embodiment of a heating section of the temperature limited heater. Insulated conductor 844 in the heating section may be coupled to insulated conductor 844 in the overburden section. Jacket 800 in the heating section may be made of a corrosion resistant material (e.g., 825 stainless steel). Ferromagnetic conductor 812 may be coupled to conduit 824 in the overburden section. Ferromagnetic conductor 812 may be Schedule 160 409, 410, or 446 stainless steel pipe. Gap 848 may be between ferromagnetic conductor 812 and insulated conductor 844. An end cap, or other suitable electrical connector, may couple ferromagnetic conductor 812 to insulated conductor 844 at a distal end of the heater (i.e., the end farthest from the overburden section).

In certain embodiments, a temperature limited heater may include a flexible cable (e.g., a furnace cable) as the inner conductor. For example, the inner conductor may be a 27% nickel-clad or stainless steel-clad stranded copper wire with four layers of mica tape surrounded by a layer of ceramic and/or mineral fiber (e.g., alumina fiber, aluminosilicate fiber, borosilicate fiber, or aluminoborosilicate fiber). A stainless steel-clad stranded copper wire furnace cable may be available from Anomet Products, Inc. (Shrewsbury, Mass.). The inner conductor may be rated for applications at temperatures of 1000° C. or higher. The inner conductor may be pulled inside a conduit. The conduit may be a ferromagnetic conduit (e.g., a ¾" Schedule 80 446 stainless steel pipe). The conduit may be covered with a layer of copper, or other electrical conductor, with a thickness of about 0.3 cm or any other suitable thickness. The assembly may be placed inside a support conduit (e.g., a 1¼" Schedule 80 347H or 347HH stainless steel tubular). The support conduit may provide additional creep-rupture strength and protection for the copper and the inner conductor. For uses at temperatures greater than about 1000° C., the inner copper conductor may be plated with a more corrosion resistant alloy (e.g., Incoloy® 825) to inhibit oxidation. In some embodiments, the top of the temperature limited heater may be sealed to inhibit air from contacting the inner conductor.

In some embodiments, a ferromagnetic conductor of a temperature limited heater may include a copper core (e.g., a 1.27 cm diameter copper core) placed inside a first steel conduit (e.g., a 1½" Schedule 80 347H or 347HH stainless steel pipe). A second steel conduit (e.g., a 1" Schedule 80 446 stainless steel pipe) may be drawn down over the first steel conduit assembly. The first steel conduit may provide strength and creep resistance while the copper core may provide a high turndown ratio.

In some embodiments, a ferromagnetic conductor of a temperature limited heater (e.g., a center or inner conductor of a conductor-in-conduit temperature limited heater) may include a heavy walled conduit (e.g., an extra heavy wall 410 stainless steel pipe). The heavy walled conduit may have a diameter of about 2.5 cm. The heavy walled conduit may be drawn down over a copper rod. The copper rod may have a diameter of about 1.3 cm. The resulting heater may include a thick ferromagnetic sheath (i.e., the heavy walled conduit with, for example, about a 2.6 cm outside diameter after drawing) containing the copper rod. The heater may have a turndown ratio of about 8:1. The thickness of the heavy walled conduit may be selected to inhibit deformation of the heater. A thick ferromagnetic conduit may provide deformation resistance while adding minimal expense to the cost of the heater.

In another embodiment, a temperature limited heater may include a substantially U-shaped heater with a ferromagnetic cladding over a non-ferromagnetic core (in this context, the "U" may have a curved or, alternatively, orthogonal shape). A U-shaped, or hairpin, heater may have insulating support mechanisms (e.g., polymer or ceramic spacers) that inhibit the two legs of the hairpin from electrically shorting to each other. In some embodiments, a hairpin heater may be installed in a casing (e.g., an environmental protection casing). The insulators may inhibit electrical shorting to the casing and may facilitate installation of the heater in the casing. The cross section of the hairpin heater may be, but is not limited to, circular, elliptical, square, or rectangular.

Figure 135:
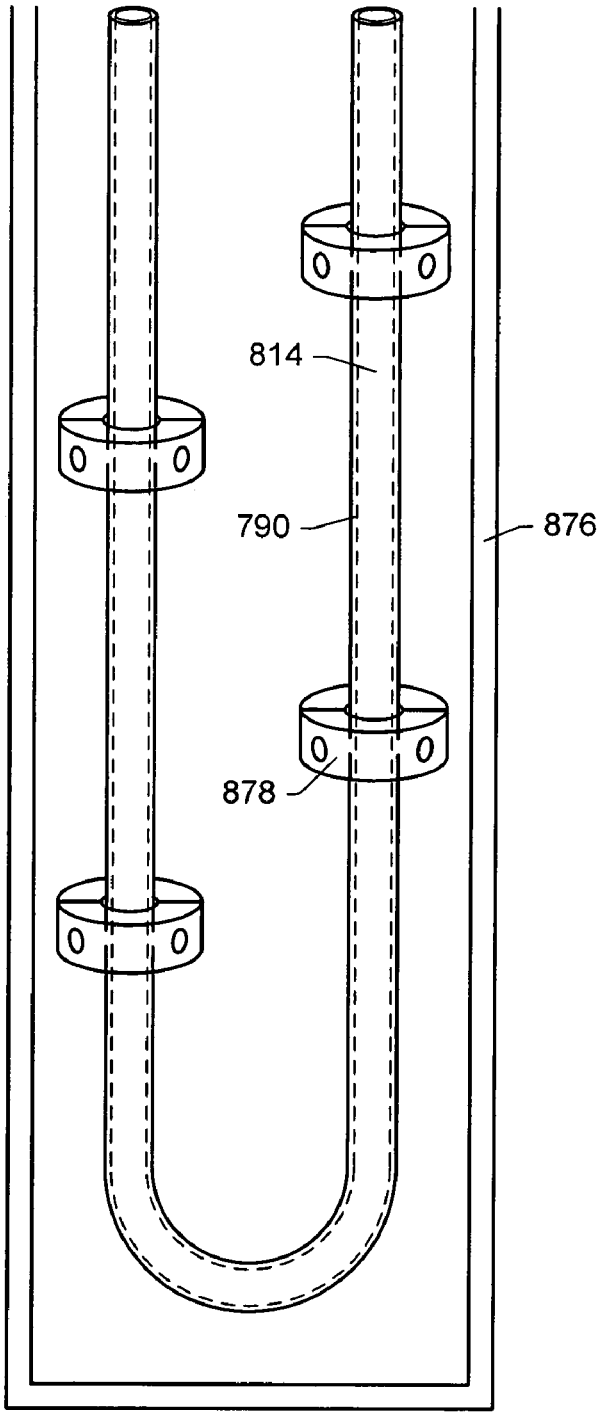
FIG. 135 depicts a schematic of an embodiment of a temperature limited heater.

FIG. 135 depicts an embodiment of a temperature limited heater with a hairpin inner conductor. Inner conductor 790 may be placed in a hairpin configuration with two legs coupled by a substantially U-shaped section at or near the bottom of the heater. Current may enter inner conductor 790 through one leg and exit through the other leg. Inner conductor 790 may be, but is not limited to, ferritic stainless steel, carbon steel, or iron. Core 814 may be placed inside inner conductor 790. In certain embodiments, inner conductor 790 may be clad to core 814. Core 814 may be a copper rod. The legs of the heater may be insulated from each other and from casing 876 by spacers 878. Spacers 878 may be alumina spacers (e.g., about 90% to about 99.8% alumina) or silicon nitride spacers. Weld beads or other protrusions may be placed on inner conductor 790 to maintain a location of spacers 878 on the inner conductor. In some embodiments, spacers 878 may include two sections that are fastened together around inner conductor 790. Casing 876 may be an environmentally protective casing made of, for example, stainless steel.

In certain embodiments, a temperature limited heater may incorporate curves, bends or waves in a relatively straight heater to allow thermal expansion and contraction of the heater without overstressing materials in the heater. When a cool heater is heated or a hot heater is cooled, the heater expands or contracts in proportion to the change in temperature and the coefficient of thermal expansion of materials in the heater. For long straight heaters that undergo wide variations in temperature during use and are fixed at more than one point in the wellbore (e.g., due to mechanical deformation of the wellbore), the expansion or contraction may cause the heater to bend, kink, and/or pull apart. Use of an "S" bend or other curves, bends, or waves in the heater at intervals in the heated length may provide a spring effect and allow the heater to expand or contract more gently so that the heater does not bend, kink, or pull apart.

Figure 136:
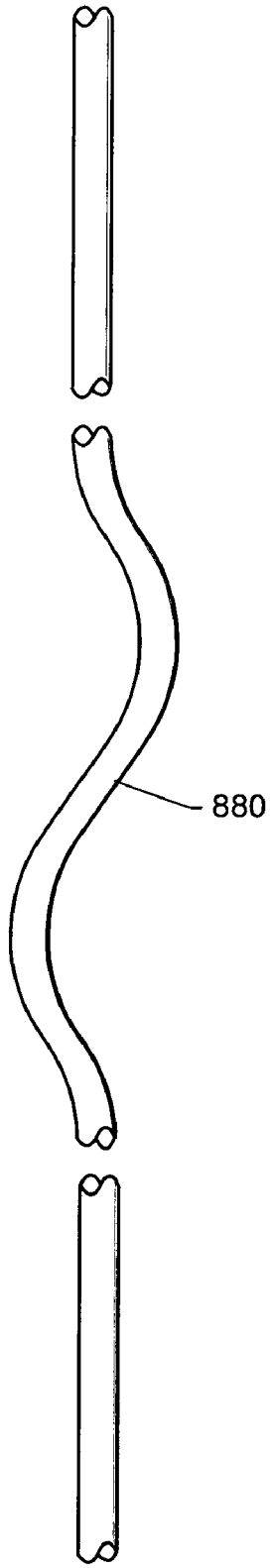
FIG. 136 depicts an embodiment of an "S" bend in a heater.

A 310 stainless steel heater subjected to about 500° C. temperature change may shrink/grow approximately 0.85% of the length of the heater with this temperature change. Thus, a length of about 3 m of a heater would contract about 2.6 cm when it cools through 500° C. If a long heater were affixed at about 3 m intervals, such a change in length could stretch and, possibly, break the heater. FIG. 136 depicts an embodiment of an "S" bend in a heater. The additional material in the "S" bend may allow for thermal contraction or expansion of heater 880 without damage to the heater.

In some embodiments, a temperature limited heater may include a sandwich construction with both current supply and current return paths separated by an insulator. The sandwich heater may include two outer layers of conductor, two inner layers of ferromagnetic material, and a layer of insulator between the ferromagnetic layers. The cross-sectional dimensions of the heater may be optimized for mechanical flexibility and spoolability. The sandwich heater may be formed as a bimetallic strip that is bent back upon itself. The sandwich heater may be inserted in a casing, such as an environmental protection casing. The sandwich heater may be separated from the casing with an electrical insulator.

A heater may include a section that passes through an overburden. In some embodiments, the portion of the heater in the overburden may not need to supply as much heat as a portion of the heater adjacent to hydrocarbon layers that are to be subjected to in situ conversion. In certain embodiments, a substantially non-heating section of a heater may have limited or no heat output. A substantially non-heating section of a heater may be located adjacent to layers of the formation (e.g., rock layers, non-hydrocarbon layers, or lean layers) that remain advantageously unheated. A substantially non-heating section of a heater may include a copper or aluminum conductor instead of a ferromagnetic conductor. In some embodiments, a substantially non-heating section of a heater may include a copper or copper alloy inner conductor. A substantially non-heating section may also include a copper outer conductor clad with a corrosion resistant alloy. In some embodiments, an overburden section may include a relatively thick ferromagnetic portion to inhibit crushing.

In certain embodiments, a temperature limited heater may provide some heat to the overburden portion of a heater well and/or production well. Heat supplied to the overburden portion may inhibit formation fluids (e.g., water and hydrocarbons) from refluxing or condensing in the wellbore. Refluxing fluids may use a large portion of heat energy supplied to a target section of the wellbore, thus limiting heat transfer from the wellbore to the target section.

A temperature limited heater may be constructed in sections that are coupled (e.g., welded) together. The sections may be about 10 m long. Construction materials for each section may be chosen to provide a selected heat output for different parts of the formation. For example, an oil shale formation may contain layers with highly variable richnesses. Providing selected amounts of heat to individual layers, or multiple layers with similar richnesses, may improve heating efficiency of the formation and/or inhibit collapse of the wellbore. A splice section may be formed between the sections, for example, by welding the inner conductors, filling the splice section with an insulator, and then welding the outer conductor. Alternatively, the heater may be formed from larger diameter tubulars and drawn down to a desired length and diameter. A boron nitride, silicon nitride, magnesium oxide, or other type of insulation layer may be added by a weld-fill-draw method (starting from metal strip) or a fill-draw method (starting from tubulars) well known in the industry in the manufacture of mineral insulated heater cables. The assembly and filling can be done in a vertical or a horizontal orientation. The final heater assembly may be spooled onto a large diameter spool (e.g., about 1 m or more in diameter) and transported to a site of a formation for subsurface deployment. Alternatively, the heater may be assembled on site in sections as the heater is lowered vertically into a wellbore.

A temperature limited heater may be a single-phase heater or a three-phase heater. In a three-phase heater embodiment, a heater may have a delta or a wye configuration. Each of the three ferromagnetic conductors in a three-phase heater may be inside a separate sheath. A connection between conductors may be made at the bottom of the heater inside a splice section. The three conductors may remain insulated from the sheath inside the splice section.

Figure 137:
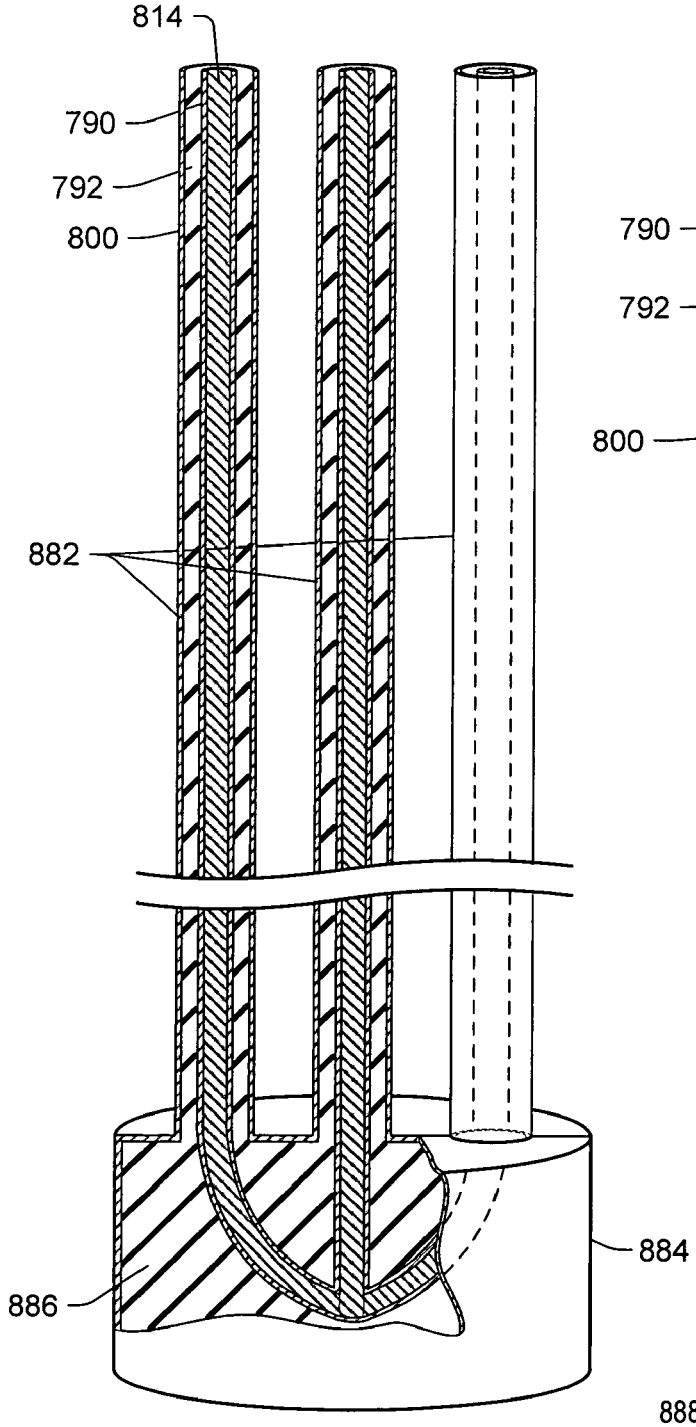

FIG. 137 depicts an embodiment of a three-phase temperature limited heater with ferromagnetic inner conductors. Each leg 882 may have inner conductor 790, core 814, and jacket 800. Inner conductors 790 may be ferritic stainless steel or 1% carbon steel. Inner conductors 790 may have core 814. Core 814 may be copper. Each inner conductor 790 may be coupled to its own jacket 800. Jacket 800 may be a sheath made of a corrosion resistant material (e.g., 304H stainless steel). Electrical insulator 792 may be placed between inner conductor 790 and jacket 800. Inner conductor 790 may be ferritic stainless steel or carbon steel with an outside diameter of about 1.14 cm and a thickness of about 0.445 cm. Core 814 may be a copper core with a 0.25 cm diameter. Each leg 882 of the heater may be coupled to terminal block 884. Terminal block 884 may be filled with insulation material 886 and have an outer surface of stainless steel. Insulation material 886 may, in some embodiments, be silicon nitride, boron nitride, magnesium oxide or other suitable electrically insulating material. Inner conductors 790 of legs 882 may be coupled (e.g., welded) in terminal block 884. Jackets 800 of legs 882 may be coupled (e.g., welded) to an outer surface of terminal block 884. Terminal block 884 may include two halves coupled together around the coupled portions of legs 882.

In an embodiment, the heated section of a three-phase heater may be about 245 m long. The three-phase heater may be wye connected and operated at a current of about 150 A. The resistance of one leg of the heater may increase from about 1.1 ohms at room temperature to about 3.1 ohms at about 650° C. The resistance of one leg may decrease rapidly above about 720° C. to about 1.5 ohms. The voltage may increase from about 165 V at room temperature to about 465 V at 650° C. The voltage may decrease rapidly above about 720° C. to about 225 V. The heat output per leg may increase from about 102 watts/meter at room temperature to about 285 watts/meter at 650° C. The heat output per leg may decrease rapidly above about 720° C. to about 1.4 watts/meter. Other embodiments of inner conductor 790, core 814, jacket 800, and/or electrical insulator 792 may be used in the three-phase temperature limited heater shown in FIG. 137. Any embodiment of a single-phase temperature limited heater may be used as a leg of a three-phase temperature limited heater.

In some three-phase heater embodiments, three ferromagnetic conductors may be separated by an insulation layer inside a common outer metal sheath. The three conductors may be insulated from the sheath or the three conductors may be connected to the sheath at the bottom of the heater assembly. In another embodiment, a single outer sheath or three outer sheaths may be ferromagnetic conductors and the inner conductors may be non-ferromagnetic (e.g., aluminum, copper, or a highly conductive alloy). Alternatively, each of the three non-ferromagnetic conductors may be inside a separate ferromagnetic sheath, and a connection between the conductors may be made at the bottom of the heater inside a splice section. The three conductors may remain insulated from the sheath inside the splice section.

Figure 138:
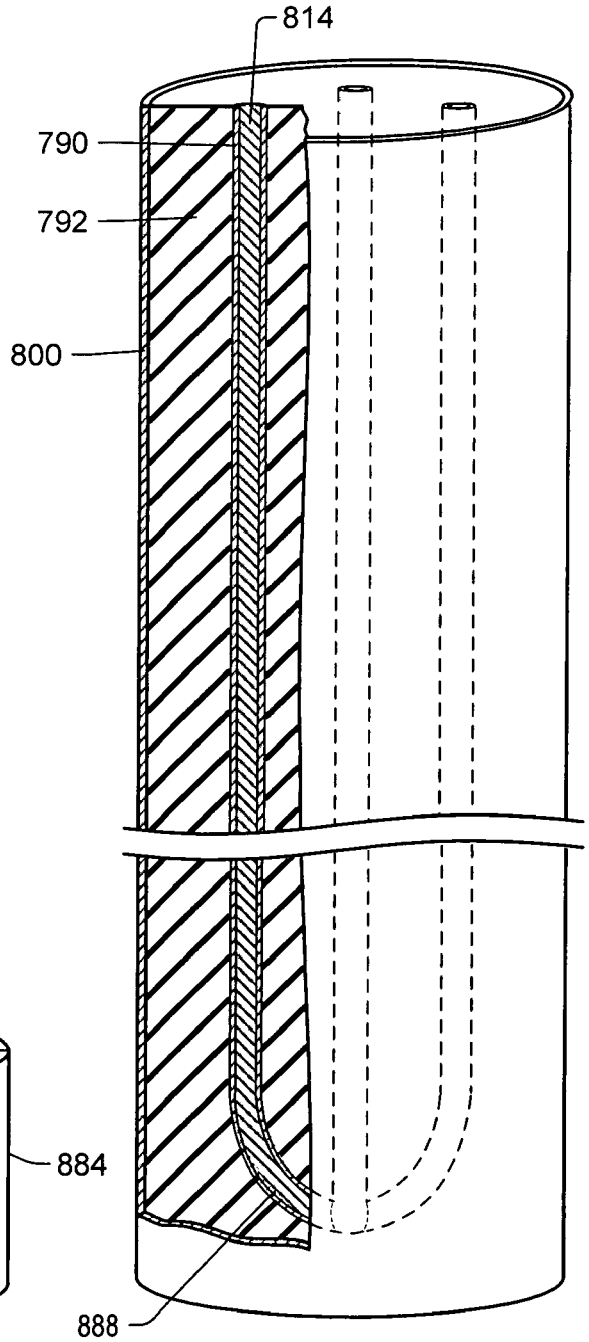

FIG. 138 depicts an embodiment of a three-phase temperature limited heater with ferromagnetic inner conductors in a common jacket. Inner conductors 790 may be placed in electrical insulator 792. Inner conductors 790 and electrical insulator 792 may be placed in a single jacket 800. Jacket 800 may be a sheath made of corrosion resistant material (e.g., stainless steel). Jacket 800 may have an outside diameter of between about 2.5 cm and about 5 cm (e.g., about 3.1 cm (1.25 inches) or about 3.8 cm (1.5 inches)). Inner conductors 790 may be coupled at or near the bottom of the heater at termination 888. Termination 888 may be a welded termination of inner conductors 790. Inner conductors 790 may be coupled in a wye configuration.

Figure 139:
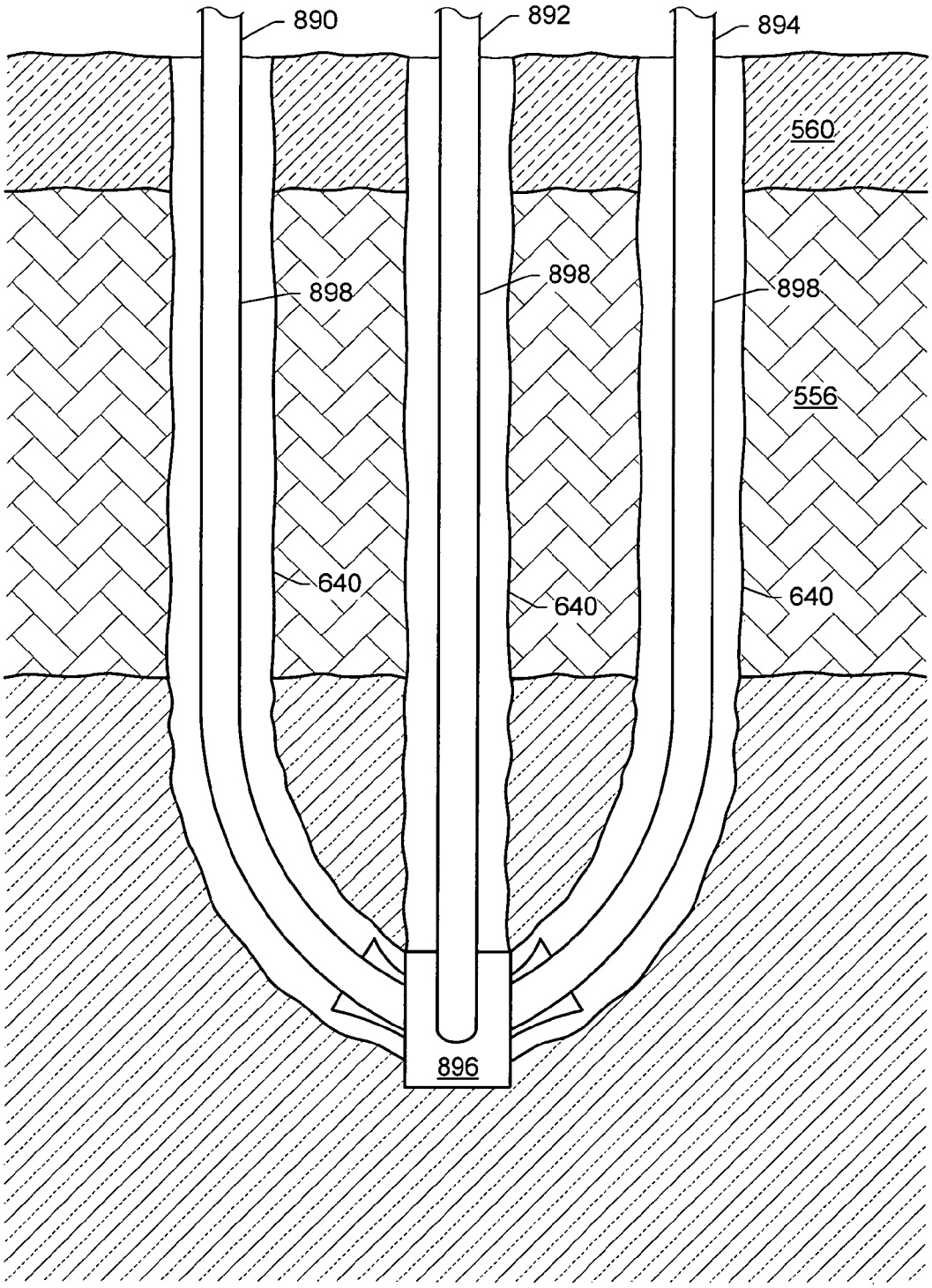

In some embodiments, a three-phase heater may include three legs that are located in separate wellbores. The legs may be coupled in a common contacting section (e.g., a central wellbore). FIG. 139 depicts an embodiment of temperature limited heaters coupled together in a three-phase configuration. Each leg 890, 892, 894 may be located in separate openings 640 in hydrocarbon layer 556. Each leg 890, 892, 894 may include heating element 898. Each leg 890, 892, 894 may be coupled to single contacting element 896 in one opening 640. Contacting element 896 may electrically couple legs 890, 892, 894 together in a three-phase configuration. Contacting element 896 may be located in, for example, a central opening in the formation. Contacting element 896 may be located in a portion of opening 640 below hydrocarbon layer 556 (e.g., an underburden). In certain embodiments, magnetic tracking of a magnetic element located in a central opening (e.g., opening 640 with leg 892) may be used to guide the formation of the outer openings (e.g., openings 640 with legs 890 and 894) so that the outer openings intersect the central opening. The central opening may be formed first using standard wellbore drilling methods. Contacting element 896 may include funnels, guides, or catchers for allowing each leg to be inserted into the contacting element.

In some embodiments, a temperature limited heater may include a single ferromagnetic conductor with current returning through the formation. The heating element may be a ferromagnetic tubular (e.g., 446 stainless steel (with 25% chromium and a Curie temperature above about 620° C.) clad over 304H, 316H, or 347HH stainless steel) that extends through the heated target section and makes electrical contact to the formation in an electrical contacting section. The electrical contacting section may be located below a heated target section (e.g., in an underburden of the formation). In an embodiment, the electrical contacting section may be a section about 60 m deep with a larger diameter wellbore. The tubular in the electrical contacting section may be a high electrical conductivity metal. The annulus in the electrical contacting section may be filled with a contact material/solution such as brine or other materials that enhance electrical contact with the formation (e.g., metal beads, hematite). The electrical contacting section may be located in a low resistivity brine saturated zone to maintain electrical contact through the brine. In the electrical contacting section, the tubular diameter may also be increased to allow maximum current flow into the formation with lower heat dissipation in the fluid. Current may flow through the ferromagnetic tubular in the heated section and heat the tubular.

Figure 140:
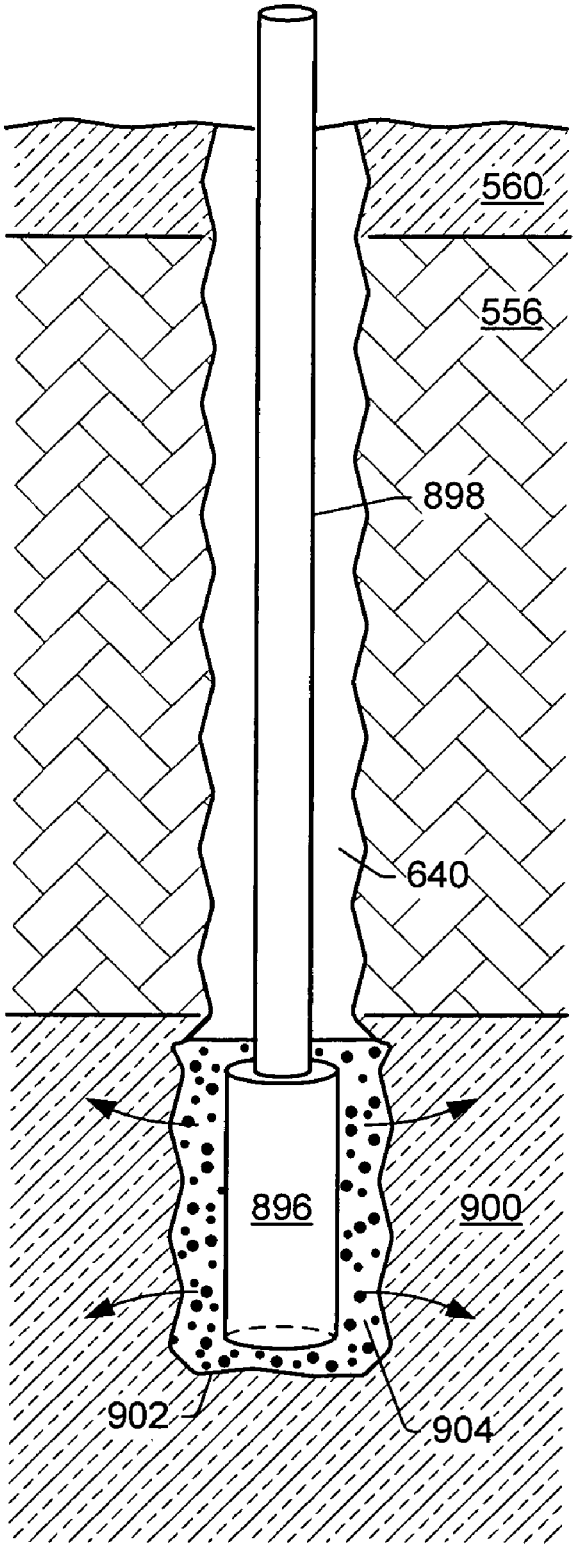

FIG. 140 depicts an embodiment of a temperature limited heater with current return through the formation. Heating element 898 may be placed in opening 640 in hydrocarbon layer 556. Heating element 898 may be a 446 stainless steel clad over a 304H stainless steel tubular that extends through hydrocarbon layer 556. Heating element 898 may be coupled to contacting element 896. Contacting element 896 may have a higher electrical conductivity than heating element 898. Contacting element 896 may be placed in electrical contacting section 900, located below hydrocarbon layer 556. Contacting element 896 may make electrical contact with the earth in electrical contacting section 900. Contacting element 896 may be placed in contacting wellbore 902. Contacting element 896 may have a diameter between about 10 cm and about 20 cm (e.g., about 15 cm). The diameter of contacting element 896 may be sized to increase contact area between contacting element 896 and contact solution 904. The contact area may be increased by increasing the diameter of contacting element 896. Increasing the diameter of contacting element 896 may increase the contact area without adding excessive cost to installation and use of the contacting element, contacting wellbore 902, and/or contact solution 904.

Increasing the diameter of contacting element 896 may allow sufficient electrical contact to be maintained between the contacting element and electrical contacting section 900. Increasing the contact area may also inhibit evaporation or boiling off of contact solution 904.

Contacting wellbore 902 may be, for example, a section about 60 m deep with a larger diameter wellbore than opening 640. The annulus of contacting wellbore 902 may be filled with contact solution 904. Contact solution 904 may be brine or other material that enhances electrical contact with electrical contacting section 900. In some embodiments, electrical contacting section 900 is a low resistivity brine saturated zone that maintains electrical contact through the brine. Contacting wellbore 902 may be under-reamed to a larger diameter (e.g., a diameter between about 25 cm and about 50 cm) to allow maximum current flow into electrical contacting section 900 with low heat output. Current may flow through heating element 898, boiling moisture from the wellbore, and heating until the heat output reduces near or at the Curie temperature.

In an embodiment, three-phase temperature limited heaters may be made with current connection through the formation. Each heater may include a single Curie temperature heating element with an electrical contacting section in a brine saturated zone below a heated target section. In an embodiment, three such heaters may be connected electrically at the surface in a three-phase wye configuration. The heaters may be deployed in a triangular pattern from the surface. In certain embodiments, the current returns through the earth to a neutral point between the three heaters. The three-phase Curie heaters may be replicated in a pattern that covers the entire formation.

Figure 141:
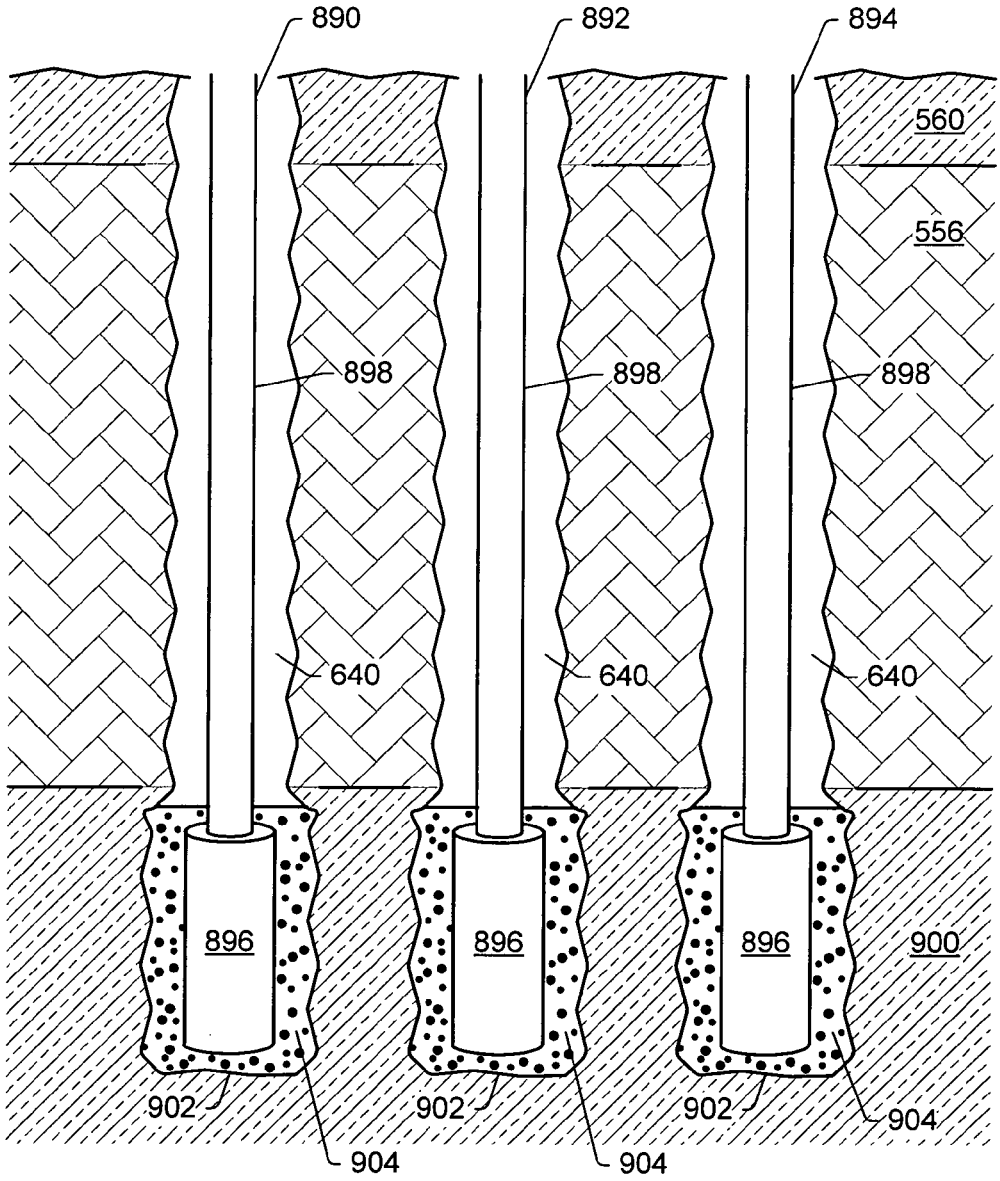
Figure 142:
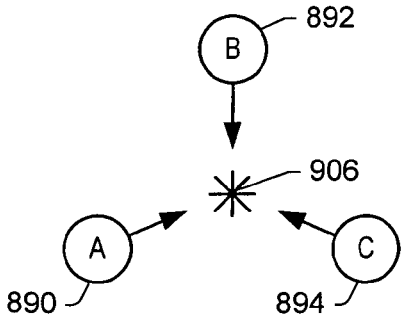
Figure 143:
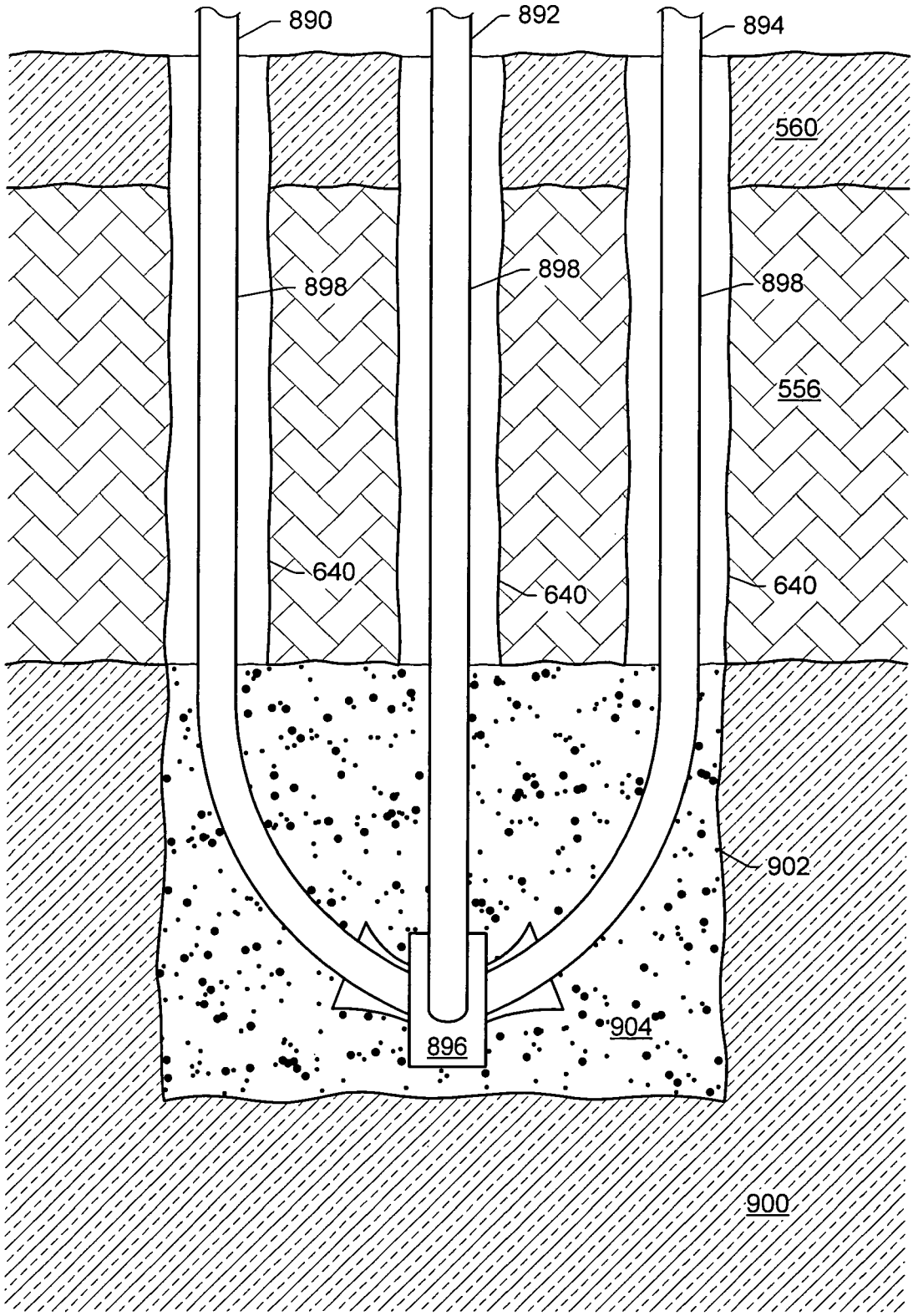

FIG. 141 depicts an embodiment of a three-phase temperature limited heater with current connection through the formation. Legs 890, 892, 894 may be placed in the formation. Each leg 890, 892, 894 may have heating element 898 that is placed in opening 640 in hydrocarbon layer 556. Each leg may have contacting element 896 placed in contact solution 904 in contacting wellbore 902. Each contacting element 896 may be electrically coupled to electrical contacting section 900 through contact solution 904. Legs 890, 892, 894 may be connected in a wye configuration that results in a neutral point in electrical contacting section 900 between the three legs. FIG. 142 depicts an aerial view of the embodiment of FIG. 141 with neutral point 906 shown positioned centrally among legs 890, 892, 894. FIG. 143 depicts an embodiment of a three-phase temperature limited heater with a common current connection through the formation. In FIG. 143, each leg 890, 892, 894 couples to a single contacting element 896 in a single contacting wellbore 902. Contacting element 896 may include funnels, guides, or catchers for allowing each leg to be inserted into the contacting element.

A section of heater through a high thermal conductivity zone may be tailored to deliver more heat dissipation in the high thermal conductivity zone. Tailoring of the heater may be achieved by changing cross-sectional areas of the heating elements (e.g., by changing ratios of copper to iron), and/or using different metals in the heating elements. Thermal conductance of the insulation layer may also be modified in certain sections to control the thermal output to raise or lower the apparent Curie temperature zone.

In an embodiment, a temperature limited heater may include a hollow core or hollow inner conductor. Layers forming the heater may be perforated to allow fluids from the wellbore (e.g., formation fluids, water) to enter the hollow core. Fluids in the hollow core may be transported (e.g., pumped) to the surface through the hollow core. In some embodiments, a temperature limited heater with a hollow core or hollow inner conductor may be used as a heater/production well or a production well.

In certain embodiments, a temperature limited heater may be utilized for heavy oil applications (e.g., treatment of relatively permeable formations or tar sands formations). A temperature limited heater may provide a relatively low Curie temperature so that a maximum average operating temperature of the heater is less than 350° C., 300° C., 250° C., 225° C., 200° C., or 150° C. In an embodiment (e.g., for a tar sands formation), a maximum temperature of the heater may be less than about 250° C. to inhibit olefin generation and production of other cracked products. In some embodiments, a maximum temperature of the heater above about 250° C. may be used to produce lighter hydrocarbon products. For example, the maximum temperature of the heater may be at or less than about 500° C.

A heater may heat a wellbore (e.g., a production wellbore) and the surrounding portions of a formation so that a temperature of the wellbore is less than a temperature that causes degradation of the fluid flowing through the wellbore. Heat from a temperature limited heater may reduce the viscosity of crude oil in or near the wellbore. In certain embodiments, heat from a temperature limited heater may mobilize fluids in or near the wellbore and/or enhance the radial flow of fluids to the wellbore. In some embodiments, reducing the viscosity of crude oil may allow or enhance gas lifting of heavy oil or intermediate gravity oil (about 12° to about 20° API gravity oil) from the wellbore. In certain embodiments, the viscosity of oil in the formation is greater than about 50 cp. Large amounts of natural gas may have to be utilized to provide gas lift of oil with viscosities above about 50 cp. Reducing the viscosity of oil at or near a wellbore in the formation to a viscosity of about 30 cp or less may lower the amount of natural gas needed to lift oil from the formation. In some embodiments, reduced viscosity oil may be produced by other methods (e.g., pumping).

The rate of production of oil from a formation may be increased by raising the temperature at or near a wellbore to reduce the viscosity of the oil in the formation. In certain embodiments, the rate of production of oil from a formation may be increased by about 2 times, about 3 times, or greater over standard cold production (i.e., no external heating of formation during production). Certain formations may be more economically viable for enhanced oil production using a temperature limited heater in a production well. Formations that have a cold production rate between about 0.05 $m^3$/(day per meter of wellbore length) and about 0.20 $m^3$/(day per meter of wellbore length) may have significant improvements in production rate using a temperature limited heater in the production wellbore to reduce the viscosity of oil at or near the wellbore. In some formations, production wells up to about 775 m in length may be used (e.g., production wells may be between about 450 m and about 775 m in length). Thus, a significant increase in production may be achieved in some formations. A temperature limited heater in a production wellbore may be used in formations where the cold production rate is not between about 0.05 $m^3$/(day per meter of wellbore length) and about 0.20 $m^3$/(day per meter of wellbore length), but may not be as economically viable. For example, higher cold production rates may not be significantly increased while lower production rates may not be increased to an economic value.

Using a temperature limited heater to reduce the viscosity of oil at or near a production well may inhibit problems associated with heating the oil in the formation due to hot spots. Hot spots may be caused by portions of the formation expanding against or collapsing on the heater. In some embodiments, a heater may have low spots from sagging over long heater distances. These low spots may sit in heavy oil or bitumen that collects in lower portions of a wellbore. At these low spots, the heater may develop hot spots due to coking of the heavy oil or bitumen. In some embodiments, lighter oil may collect at higher spots along a heater due to the weight of the oil. These higher spots may also produce hot spots due to coking of the lighter oil. Using a temperature limited heater may inhibit overheating of a heater at these hot spots and provide more uniform heating along a length of a well.

In some embodiments, oil or bitumen may coke in a perforated liner or screen in a heater/production wellbore (e.g., coke may form between a heater and a liner or between the liner and the formation). Oil or bitumen may also coke in a toe section of a heel and toe heater/production wellbore, as shown in FIG. 150. A temperature limited heater may limit a temperature of a heater/production wellbore below a coking temperature to inhibit coking in the well so that production in the wellbore does not plug up.

Figure 144:
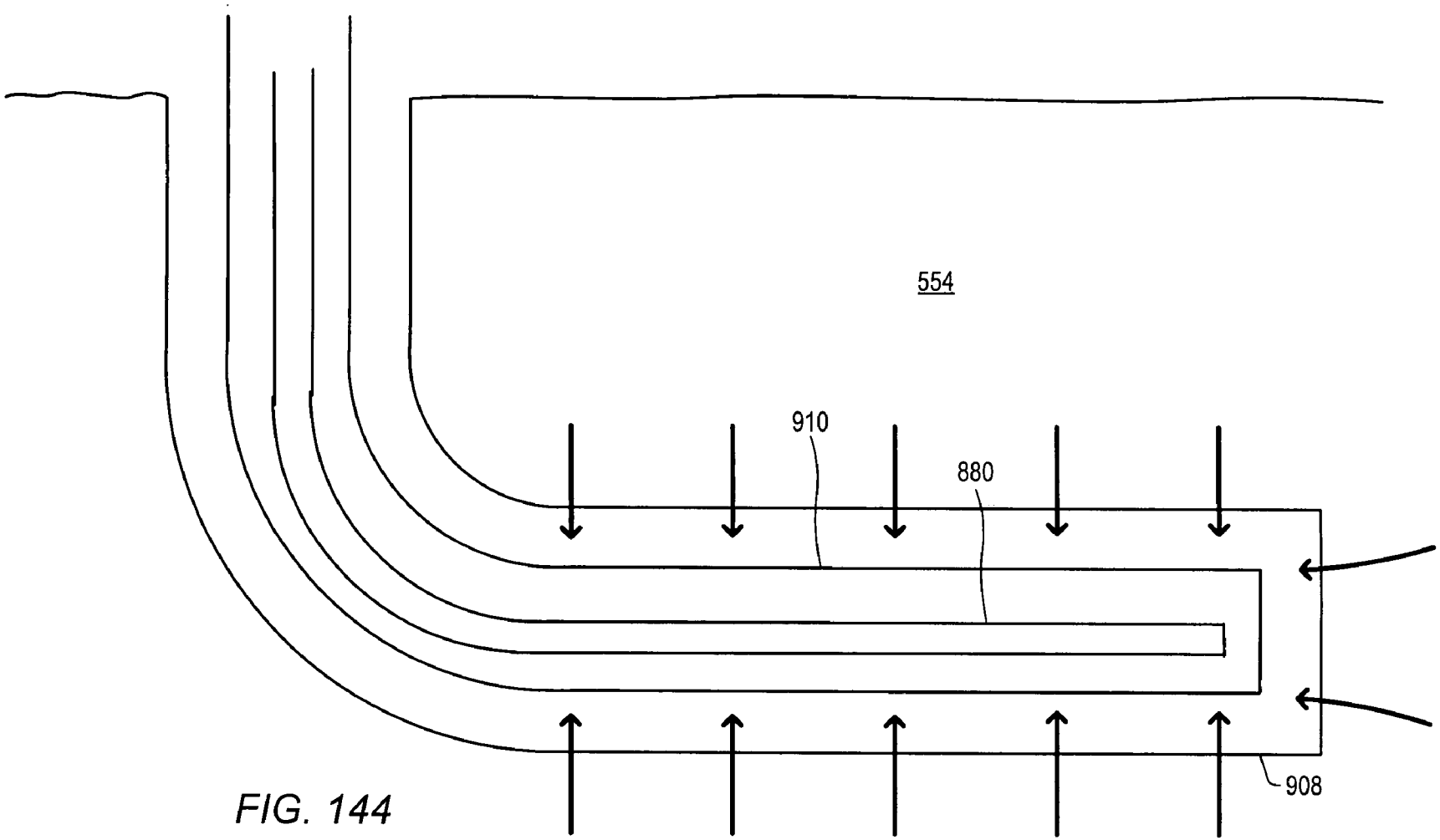

FIG. 144 depicts an embodiment for heating and producing from a formation with a temperature limited heater in a production wellbore. Production conduit 910 may be located in wellbore 908. In certain embodiments, a portion of wellbore 908 may be located substantially horizontally in formation 554. In some embodiments, the wellbore may be located substantially vertically in the formation. In an embodiment, wellbore 908 is an open wellbore (i.e., uncased wellbore). In some embodiments, the wellbore may have a casing or walls that have perforations or openings to allow fluid to flow into the wellbore.

Production conduit 910 may be made from carbon steel or more corrosion resistant materials (e.g., stainless steel). Production conduit 910 may include apparatus and mechanisms for gas lifting or pumping produced oil to the surface. For example, production conduit 910 may include gas lift valves used in a gas lift process. Examples of gas lift control systems and valves are disclosed in U.S. Pat. No. 6,715,550 to Vinegar et al. and U.S. Patent Application Publication Nos. 2002-0036085 to Bass et al. and 2003-0038734 to Hirsch et al., each of which is incorporated by reference as if fully set forth herein. Production conduit 910 may include one or more openings (e.g., perforations) to allow fluid to flow into the production conduit. In certain embodiments, the openings in production conduit 910 may be in a portion of the production conduit that remains below the liquid level in wellbore 908. For example, the openings may be in a horizontal portion of production conduit 910.

Figure 145:
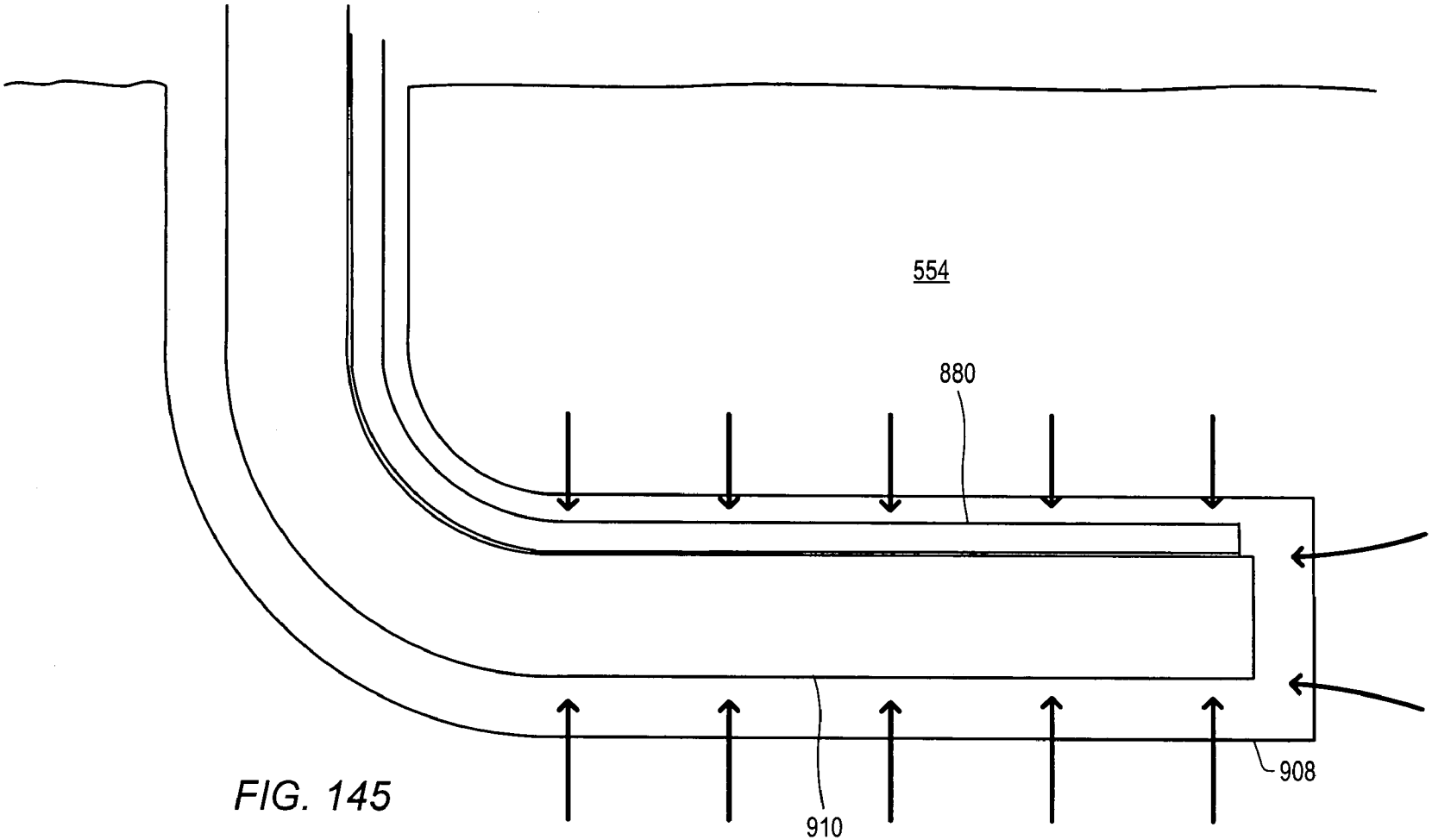

Heater 880 may be located in production conduit 910, as shown in FIG. 144. In some embodiments, heater 880 may be located outside production conduit 910, as shown in FIG. 145 (e.g., the heater may be coupled (strapped) to the production conduit). In some embodiments, more than one heater (e.g., two or three heaters) may be placed about the production conduit 910. The use of more than one heater may reduce bowing or flexing of the production conduit caused by heating on only one side of the production conduit. In an embodiment, heater 880 is a temperature limited heater. Heater 880 may provide heat to reduce the viscosity of fluid (e.g., oil or hydrocarbons) in and near wellbore 908. In an embodiment, heater 880 may provide a maximum temperature of about 250° C. or less. For example, heater 880 may include ferromagnetic materials such as Carpenter Temperature Compensator "32", alloy 42-6, Invar 36, or other iron-nickel or iron-nickel-chromium alloys. In certain embodiments, nickel or nickel-chromium alloys may be used in heater 880. In some embodiments, heater 880 may include a composite conductor with a more highly conductive material (e.g., copper) on the inside the heater to improve the turndown ratio of the heater. Heat from heater 880 may heat fluids in or near wellbore 908 to reduce the viscosity of the fluids and increase a production rate through production conduit 910.

In certain embodiments, portions of heater 880 above the liquid level in wellbore 908 (e.g., the vertical portion of the wellbore depicted in FIGS. 144 and 145) may have a lower maximum temperature than portions of the heater located below the liquid level. For example, portions of heater 880 above the liquid level in wellbore 908 may have a maximum temperature of about 100° C. while portions of the heater located below the liquid level have a maximum temperature of about 250° C. In certain embodiments, such a heater may include two or more ferromagnetic sections with different Curie temperatures to achieve the desired heating pattern. Providing less heat to portions of wellbore 908 above the liquid level and closer to the surface may save energy.

In certain embodiments, heater 880 may be electrically isolated on the heater's outside surface and allowed to move freely in production conduit 910. For example, heater 880 may include a furnace cable inner conductor. In some embodiments, electrically insulating centralizers may be placed on the outside of heater 880 to maintain a gap between production conduit 910 and the heater. Centralizers may be made of alumina, gas pressure sintered reaction bonded silicon nitride, or boron nitride, other electrically insulating and thermally resistant material, and/or combinations thereof. In some embodiments, heater 880 may be electrically coupled to production conduit 910 so that an electrical circuit is completed with the production conduit. For example, an alternating current voltage may be applied to heater 880 and production conduit 910 so that alternating current flows down the outer surface of the heater and returns to a wellhead on the inside surface of the production conduit. Heater 880 and production conduit 910 may include ferromagnetic materials so that the alternating current is confined substantially to a skin depth on the outside of the heater and/or a skin depth on the inside of the production conduit. A sliding connector may be located at or near the bottom of production conduit 910 to electrically couple the production conduit and heater 880.

In some embodiments, heater 880 may be cycled (i.e., turned on and off) so that fluids produced through production conduit 910 are not overheated. In an embodiment, heater 880 may be turned on for a specified amount of time until a temperature of fluids in or near wellbore 908 reaches a desired temperature (e.g., the maximum temperature of the heater). During the heating time (e.g., about 10 days, about 20 days, or about 30 days), production through production conduit 910 may be stopped to allow fluids in the formation to "soak" and obtain a reduced viscosity. After heating is turned off or reduced, production through production conduit 910 may be started and fluids from the formation may be produced without excess heat being provided to the fluids. During production, fluids in or near wellbore 908 will cool down without heat from heater 880 being provided. When the fluids reach a temperature at which production significantly slows down, production may be stopped and heater 880 may be turned back on to reheat the fluids. This process may be repeated until a desired amount of production is reached. In some embodiments, some heat at a lower temperature may be provided to maintain a flow of the produced fluids. For example, low temperature heat (e.g., about 100° C.) may be provided in the upper portions of wellbore 908 to keep fluids from cooling to a lower temperature.

Figure 146:
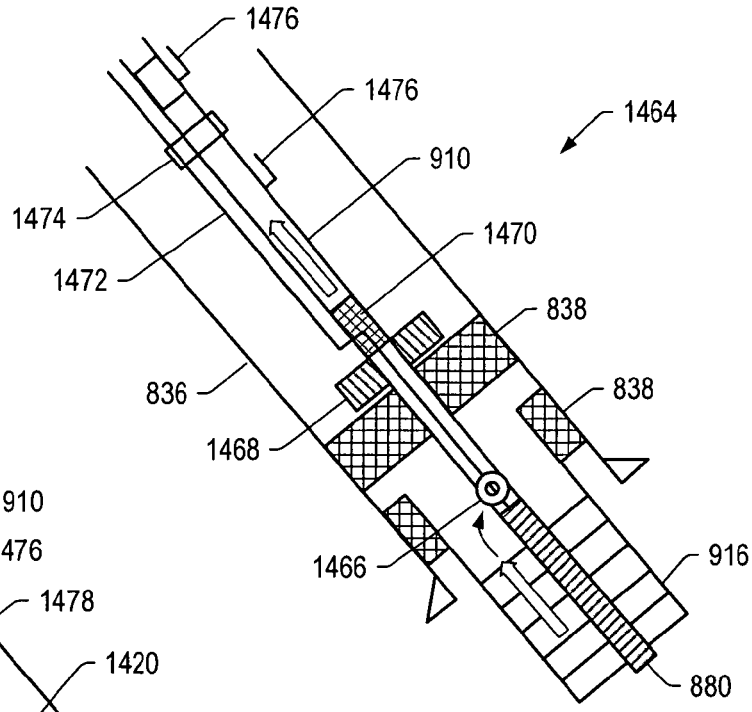

FIG. 146 depicts an embodiment of a heating/production assembly that may be located in a wellbore for gas lifting.

Heating/production assembly 1464 may be located in a wellbore in a formation (e.g., wellbore 908 depicted in FIGS. 144 and 145). Production conduit 910 may be located inside casing 836. In an embodiment, production conduit 910 may be coiled tubing (e.g., 2⅜" (about 6 cm) diameter coiled tubing). Casing 836 may have a diameter between about 4" (about 10 cm) and about 10" (about 25 cm) (e.g., a diameter of about 5.5" (about 14 cm) or about 7" (about 18 cm)). Heater 880 may be coupled to an end of production conduit 910. In some embodiments, heater 880 may be located inside production conduit 910. In some embodiments, heater 880 may be a resistive portion of production conduit 910. In some embodiments, heater 880 may be coupled to a length of production conduit 910.

Opening 1466 may be located at or near a junction of heater 880 and production conduit 910. In some embodiments, opening 1466 may be a slot or a slit in production conduit 910. In some embodiments, opening 1466 may include more than one opening in production conduit 910. Opening 1466 may allow production fluids to flow into production conduit 910 from a wellbore. Perforated casing 916 may allow fluids to flow into the heating/production assembly 1464. In certain embodiments, perforated casing 916 is a wire wrapped screen. In one embodiment, perforated casing 916 is a 3.5" (about 9 cm) diameter wire wrapped screen.

Perforated casing 916 may be coupled to casing 836 with packing material 838. Packing material 838 may inhibit fluids from flowing into casing 836 from outside perforated casing 916. Packing material 838 may also be placed inside casing 836 to inhibit fluids from flowing up the annulus between the casing and production conduit 910. Seal assembly 1468 may be used to seal production conduit 910 to packing material 838. Seal assembly 1468 may fix a position of production conduit 910 along a length of a wellbore. In some embodiments, seal assembly 1468 may allow for unsealing of production conduit 910 so that the production conduit and heater 880 may be removed from the wellbore.

Feedthrough 1470 may be used to feedthrough lead-in cable 1472 to supply power to heater 880. Lead-in cable 1472 may be secured to production conduit 910 with clamp 1474. In some embodiments, lead-in cable 1472 may pass through packing material 838 using a separate feedthrough.

A lifting gas (e.g., methane) may be provided to the annulus between production conduit 910 and casing 836. Valves 1476 may be located along a length of production conduit 910 to allow gas to enter the production conduit and provide for gas lifting of fluids in the production conduit. The lifting gas may mix with fluids in production conduit 910 to lower a density of the fluids and allow for gas lifting of the fluids out of the formation. In certain embodiments, valves 1476 are located in an overburden section of a formation so that gas lifting is provided in the overburden section. In some embodiments, fluids may be produced through the annulus between production conduit 910 and casing 836 and a lifting gas may be supplied through valves 1476.

In an embodiment, fluids may be produced using a pump coupled to production conduit 910. The pump may be a submersible pump (e.g., an electric submersible pump). In some embodiments, a heater may be coupled to production conduit 910 to maintain a reduced viscosity of fluids in the production conduit and/or the pump.

In certain embodiments, an additional conduit (e.g., an additional coiled tubing conduit) may be placed in the formation. Sensors may be placed in the additional conduit. For example, a production logging tool may be placed in the additional conduit to identify locations of producing zones and/or assess flowrates. In some embodiments, a temperature sensor (e.g., a distributed temperature sensor or an optical sensor) may be placed in the additional conduit to determine a subsurface temperature profile.

Figure 147:
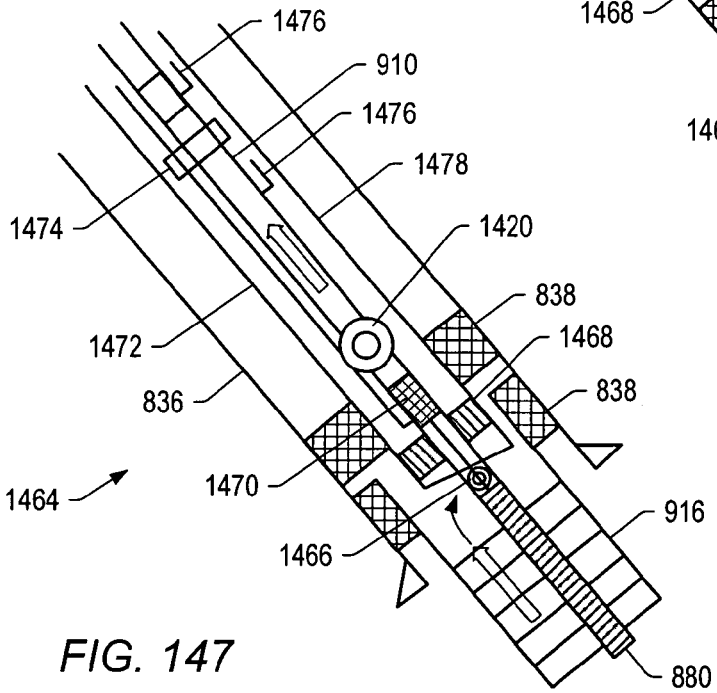

Some embodiments of a heating/production assembly may be used in (i.e., retrofitted for) a well that preexists (e.g., a preexisting production well). An example of a heating/production assembly that may be used in a preexisting well is depicted in FIG. 147. Some preexisting wells (e.g., preexisting production wells) may include a pump. A pump in a preexisting well may be left in a heating/production well retrofitted with a heating/production assembly.

FIG. 147 depicts an embodiment of a heating/production assembly that may be located in a wellbore for gas lifting. In FIG. 147, production conduit 910 may be located in outside production conduit 1478. In an embodiment, outside production conduit 1478 is a 4.5" (about 11.4 cm) diameter production tubing. Casing 836 may have a diameter of about 9.6" (about 24.4 cm). Perforated casing 916 may have a diameter of about 4.5" (about 11.4 cm). Seal assembly 1468 may seal production conduit 910 inside outside production conduit 1478. In an embodiment, pump 1420 is a jet pump (e.g., a bottomhole assembly jet pump).

Figure 148:
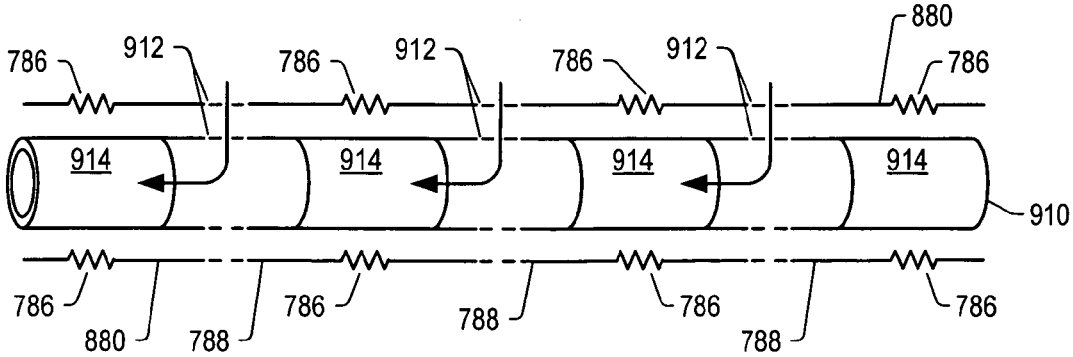

In some embodiments, heat may be inhibited from transferring into production conduit 910. FIG. 148 depicts an embodiment of production conduit 910 and heaters 880 that inhibit heat transfer into the production conduit. Heaters 880 may be coupled to production conduit 910. Heaters 880 may include ferromagnetic sections 786 and non-ferromagnetic sections 788. Ferromagnetic sections 786 may provide heat at a temperature that reduces the viscosity of fluids in or near a wellbore. Non-ferromagnetic sections 788 may provide little or no heat. In certain embodiments, ferromagnetic sections 786 and non-ferromagnetic sections 788 may be about 6 m in length. In some embodiments, ferromagnetic sections 786 and non-ferromagnetic sections 788 may be between about 3 m and 12 m in length. In certain embodiments, non-ferromagnetic sections 788 may include perforations 912 to allow fluids to flow to production conduit 910. In some embodiments, heater 880 may be positioned so that perforations are not needed to allow fluids to flow to production conduit 910.

Production conduit 910 may have perforations 912 to allow fluid to enter the production conduit. Perforations 912 may coincide with non-ferromagnetic sections 788 of heater 880. Sections of production conduit 910 that coincide with ferromagnetic sections 786 may include insulation conduit 914. Insulation conduit 914 may be a vacuum insulated tubular. For example, insulation conduit 914 may be a vacuum insulated production tubular available from Oil Tech Services, Inc. (Houston, Tex.). Insulation conduit 914 may inhibit heat transfer into production conduit 910 from ferromagnetic sections 786. Limiting the heat transfer into production conduit 910 may reduce heat loss and/or inhibit overheating of fluids in the production conduit. In an embodiment, heater 880 may provide heat along an entire length of the heater and production conduit 910 may include insulation conduit 914 along an entire length of the production conduit.

In certain embodiments, more than one wellbore 908 may be used to produce heavy oils from a formation using a temperature limited heater. FIG. 149 depicts an end view of an embodiment with wellbores 908 located in hydrocarbon layer 556. A portion of wellbores 908 may be placed substantially horizontally in a triangular pattern in hydrocarbon layer 556. In certain embodiments, wellbores 908 may have a spacing of about 30 m to about 60 m. Wellbores 908 may include production conduits and heaters as described in the embodiments of FIGS. 144 and 145. Fluids may be heated and produced through wellbores 908 at an increased production rate above a cold production rate for the formation. Production may continue for a selected time (e.g., about 5 years to about 10 years) until heat produced from each of wellbores 908 begins to overlap (i.e., superposition of heat begins). At such a time, heat from lower wellbores (e.g., wellbores 908 near the bottom of hydrocarbon layer 556) may be continued, reduced, or turned off while production is continued. Production in upper wellbores (e.g., wellbores 908 near the top of hydrocarbon layer 556) may be stopped so that fluids in the hydrocarbon layer drain towards the lower wellbores. In some embodiments, power may be increased to the upper wellbores and the temperature raised above the Curie temperature to increase the heat injection rate. Draining fluids in the formation in such a process may increase total hydrocarbon recovery from the formation.

In an embodiment, a temperature limited heater may be used in a horizontal heater/production well. The temperature limited heater may provide selected amounts of heat to the "toe" and the "heel" of the horizontal portion of the well. More heat may be provided to the formation through the toe than through the heel, creating a "hot portion" at the toe and a "warm portion" at the heel. Formation fluids may be formed in the hot portion and produced through the warm portion, as shown in FIG. 150.

FIG. 150 depicts an embodiment of a heater well for selectively heating a formation. Heat source 508 may be placed in opening 640 in hydrocarbon layer 556. In certain embodiments, opening 640 may be a substantially horizontal opening in hydrocarbon layer 556. Perforated casing 916 may be placed in opening 640. Perforated casing 916 may provide support that inhibits hydrocarbon and/or other material in hydrocarbon layer 556 from collapsing into opening 640. Perforations in perforated casing 916 may allow for fluid flow from hydrocarbon layer 556 into opening 640. Heat source 508 may include hot portion 918. Hot portion 918 may be a portion of heat source 508 that operates at higher heat output than adjacent portions of the heat source. For example, hot portion 918 may output between about 650 watts per meter and about 1650 watts per meter. Hot portion 918 may extend from a "heel" of the heat source to the end of the heat source (i.e., the "toe" of the heat source). The heel of a heat source is the portion of the heat source closest to the point at which the heat source enters a hydrocarbon layer. The toe of a heat source is the end of the heat source furthest from the entry of the heat source into a hydrocarbon layer.

In an embodiment, heat source 508 may include warm portion 920. Warm portion 920 may be a portion of heat source 508 that operates at lower heat outputs than hot portion 918. For example, warm portion 920 may output between about 30 watts per meter and about 1000 watts per meter. Warm portion 920 may be located closer to the heel of heat source 508. In certain embodiments, warm portion 920 may be a transition portion (i.e., a transition conductor) between hot portion 918 and overburden portion 922. Overburden portion 922 may be located in overburden 560. Overburden portion 922 may provide a lower heat output than warm portion 920. For example, overburden portion 922 may output between about 10 watts per meter and about 90 watts per meter. In some embodiments, overburden portion 922 may provide as close to no heat (0 watts per meter) as possible to overburden 560. Some heat, however, may be used to maintain fluids produced through opening 640 in a vapor phase in overburden 560.

In certain embodiments, hot portion 918 of heat source 508 may heat hydrocarbons to high enough temperatures to result in coke 924 forming in hydrocarbon layer 556. Coke 924 may occur in an area surrounding opening 640. Warm portion 920 may be operated at lower heat outputs such that coke does not form at or near the warm portion of heat source 508. Coke 924 may extend radially from opening 640 as heat from heat source 508 transfers outward from the opening. At a certain distance, however, coke 924 no longer forms because temperatures in hydrocarbon layer 556 at the certain distance will not reach coking temperatures. The distance at which no coke forms may be a function of heat output (watts per meter from heat source 508), type of formation, hydrocarbon content in the formation, and/or other conditions in the formation.

The formation of coke 924 may inhibit fluid flow into opening 640 through the coking. Fluids in the formation may, however, be produced through opening 640 at the heel of heat source 508 (i.e., at warm portion 920 of the heat source) where there is no coke formation. The lower temperatures at the heel of heat source 508 may reduce the possibility of increased cracking of formation fluids produced through the heel. Fluids may flow in a horizontal direction through the formation more easily than in a vertical direction. Typically, horizontal permeability in a relatively permeable formation (e.g., a tar sands formation) is about 5 to 10 times greater than vertical permeability. Thus, fluids may flow along the length of heat source 508 in a substantially horizontal direction. Producing formation fluids through opening 640 may be possible at earlier times than producing fluids through production wells in hydrocarbon layer 556. The earlier production times through opening 640 may be possible because temperatures near the opening increase faster than temperatures further away due to conduction of heat from heat source 508 through hydrocarbon layer 556. Early production of formation fluids (e.g., production through opening 640 with heat source 508) may be used to maintain lower pressures in hydrocarbon layer 556 during start-up heating of the formation (i.e., before production begins at production wells in the formation). Lower pressures in the formation may increase liquid production from the formation. In addition, producing formation fluids through opening 640 may reduce the number of production wells needed in the formation.

In some embodiments, a temperature limited heater may be used to heat a surface pipeline such as a sulfur transfer pipeline. For example, a surface sulfur pipeline may be heated to a temperature of about 100° C., about 110° C., or about 130° C. to inhibit solidification of fluids in the pipeline. Higher temperatures in the pipeline (e.g., above about 130° C.) may induce undesirable degradation of fluids in the pipeline.

FIG. 151 depicts electrical resistance versus temperature at various applied electrical currents for a 446 stainless steel rod with a diameter of 2.5 cm and a 410 stainless steel rod with a diameter of 2.5 cm. Both rods had a length of 1.8 m. Curves 926-932 depict resistance profiles as a function of temperature for the 446 stainless steel rod at 440 amps AC (curve 926), 450 amps AC (curve 928), 500 amps AC (curve 930), and 10 amps DC (curve 932). Curves 934-940 depict resistance profiles as a function of temperature for the 410 stainless steel rod at 400 amps AC (curve 934), 450 amps AC (curve 936), 500 amps AC (curve 938), 10 amps DC (curve 940). For both rods, the resistance gradually increased with temperature until the Curie temperature was reached. At the Curie temperature, the resistance fell sharply. Above the Curie temperature, the resistance decreased slightly with increasing temperature. Both rods show a trend of decreasing resistance with increasing AC current. Accordingly, the turndown ratio decreased with increasing current. In contrast, the resistance gradually increased with temperature through the Curie temperature with an applied DC current.

FIG. 152 shows resistance profiles as a function of temperature at various applied electrical currents for a copper rod contained in a conduit of Sumitomo HCM12A (a high strength 410 stainless steel). The Sumitomo conduit had a diameter of 5.1 cm, a length of 1.8 m, and a wall thickness of about 0.1 cm. Curves 942-952 show that at all applied currents (942: 300 amps AC; 944: 350 amps AC; 946: 400 amps AC; 948: 450 amps AC; 950: 500 amps AC; 952: 550 amps AC), resistance increased gradually with temperature until the Curie temperature was reached. At the Curie temperature, the resistance fell sharply. As the current increased, the resistance decreased, resulting in a smaller turndown ratio.

FIG. 153 depicts electrical resistance versus temperature at various applied electrical currents for a temperature limited heater. The temperature limited heater included a 4/0 MGT-1000 furnace cable inside an outer conductor of ¾" Schedule 80 Sandvik (Sweden) 4C54 (446 stainless steel) with a 0.30 cm thick copper sheath welded onto the outside of the Sandvik 4C54 and a length of 1.8 m. Curves 954 through 972 show resistance profiles as a function of temperature for AC applied currents ranging from 40 amps to 500 amps (954: 40 amps; 956: 80 amps; 958: 120 amps; 960: 160 amps; 962: 250 amps; 964: 300 amps; 966: 350 amps; 968: 400 amps; 970: 450 amps; 972: 500 amps). FIG. 154 depicts the raw data for curve 968. FIG. 155 depicts the data for selected curves 964, 966, 968, 970, 972, and 974. At lower currents (below 250 amps), the resistance increased with increasing temperature up to the Curie temperature. At the Curie temperature, the resistance fell sharply. At higher currents (above 250 amps), the resistance decreased slightly with increasing temperature up to the Curie temperature. At the Curie temperature, the resistance fell sharply. Curve 974 shows resistance for an applied DC electrical current of 10 amps. Curve 974 shows a steady increase in resistance with increasing temperature, with little or no deviation at the Curie temperature.

FIG. 156 depicts power versus temperature at various applied electrical currents for a temperature limited heater. The temperature limited heater included a 4/0 MGT-1000 furnace cable inside an outer conductor of ¾" Schedule 80 Sandvik (Sweden) 4C54 (446 stainless steel) with a 0.30 cm thick copper sheath welded onto the outside of the Sandvik 4C54 and a length of 1.8 m. Curves 976-984 depict power versus temperature for AC applied currents of 300 amps to 500 amps (976: 300 amps; 978: 350 amps; 980: 400 amps; 982: 450 amps; 984: 500 amps). Increasing the temperature gradually decreased the power until the Curie temperature was reached. At the Curie temperature, the power decreased rapidly.

FIG. 157 depicts electrical resistance versus temperature at various applied electrical currents for a temperature limited heater. The temperature limited heater includes a copper rod with a diameter of 1.3 cm inside an outer conductor of 1" Schedule 80 410 stainless steel pipe with a 0.15 cm thick copper Everdur welded sheath over the 410 stainless steel pipe and a length of 1.8 m. Curves 986-996 show resistance profiles as a function of temperature for AC applied currents ranging from 300 amps to 550 amps (986: 300 amps; 988: 350 amps; 990: 400 amps; 992: 450 amps; 994: 500 amps; 996: 550 amps). For these AC applied currents, the resistance gradually increases with increasing temperature up to the Curie temperature. At the Curie temperature, the resistance falls sharply. In contrast, curve 998 shows resistance for an applied DC electrical current of 10 amps. This resistance shows a steady increase with increasing temperature, and little or no deviation at the Curie temperature.

FIG. 158 depicts data of electrical resistance versus temperature for a solid 2.54 cm diameter, 1.8 m long 410 stainless steel rod at various applied electrical currents. Curves 1000, 1002, 1004, 1006, and 1008 depict resistance profiles as a function of temperature for the 410 stainless steel rod at 40 amps AC (curve 1006), 70 amps AC (curve 1008), 140 amps AC (curve 1000), 230 amps AC (curve 1002), and 10 amps DC (curve 1004). For the applied AC currents of 140 amps and 230 amps, the resistance increased gradually with increasing temperature until the Curie temperature was reached. At the Curie temperature, the resistance fell sharply. In contrast, the resistance showed a gradual increase with temperature through the Curie temperature for an applied DC current.

FIG. 159 depicts data of electrical resistance versus temperature for a composite 1.9 cm, 1.8 m long alloy 42-6 rod with a copper core (the rod has an outside diameter to copper diameter ratio of 2:1) at various applied electrical currents. Curves 1010, 1012, 1014, 1016, 1018, 1020, 1022, and 1024 depict resistance profiles as a function of temperature for the copper cored alloy 42-6 rod at 300 amps AC (curve 1010), 350 amps AC (curve 1012), 400 amps AC (curve 1014), 450 amps AC (curve 1016), 500 amps AC (curve 1018), 550 amps AC (curve 1020), 600 amps AC (curve 1022), and 10 amps DC (curve 1024). For the applied AC currents, the resistance decreased gradually with increasing temperature until the Curie temperature was reached. As the temperature approaches the Curie temperature, the resistance decreased more sharply. In contrast, the resistance showed a gradual increase with temperature for an applied DC current.

FIG. 160 depicts data of power output versus temperature for a composite 1.9 cm, 1.8 m long alloy 42-6 rod with a copper core (the rod has an outside diameter to copper diameter ratio of 2:1) at various applied electrical currents. Curves 1026, 1028, 1030, 1032, 1034, 1036, 1038, and 1040 depict power as a function of temperature for the copper cored alloy 42-6 rod at 300 amps AC (curve 1026), 350 amps AC (curve 1028), 400 amps AC (curve 1030), 450 amps AC (curve 1032), 500 amps AC (curve 1034), 550 amps AC (curve 1036), 600 amps AC (curve 1038), and 10 amps DC (curve 1040). For the applied AC currents, the power decreased gradually with increasing temperature until the Curie temperature was reached. As the temperature approaches the Curie temperature, the power decreased more sharply. In contrast, the power showed a relatively flat profile with temperature for an applied DC current.

FIG. 161 depicts data for values of skin depth versus temperature for a solid 2.54 cm diameter, 1.8 m long 410 stainless steel rod at various applied AC electrical currents. The skin depth was calculated using EQN. 41:

$$\delta = R_1 - R_1 \times (1 - (1/R_{AC}/R_{DC}))^{1/2}; \quad (41)$$

where $\delta$ is the skin depth, $R_1$ is the radius of the cylinder, $R_{AC}$ is the AC resistance, and $R_{DC}$ is the DC resistance. In FIG. 161, curves 1042-1060 show skin depth profiles as a function of temperature for applied AC electrical currents over a range of about 50 amps to 500 amps (1042: 50 amps; 1044: 100 amps; 1046: 150 amps; 1048: 200 amps; 1050: 250 amps; 1052: 300 amps; 1054: 350 amps; 1056: 400 amps; 1058: 450 amps; 1060: 500 amps). For each applied AC electrical current, the skin depth gradually increased with increasing temperature up to the Curie temperature. At the Curie temperature, the skin depth increased sharply.

FIG. 162 depicts temperature versus time for a temperature limited heater. The temperature limited heater was a 1.83 m long heater that included a copper rod with a diameter of about 1.3 cm inside a 1" Schedule XXH 410 stainless steel pipe and a 0.13" copper sheath. The heater was placed in an oven for heating. Alternating current was applied to the heater when the heater was in the oven. The current was increased over about two hours and reached a relatively constant value of about 400 amps for the remainder of the time. Temperature of the stainless steel pipe was measured at three points at about 0.46 m intervals along the length of the heater. Curve 1062 depicts the temperature of the pipe at a point about 0.46 m inside the oven and closest to the lead-in portion of the heater. Curve 1064 depicts the temperature of the pipe at a point about 0.46 m from the end of the pipe and furthest from the lead-in portion of the heater. Curve 1066 depicts the temperature of the pipe at about a center point of the heater. The point at the center of the heater was further enclosed in a 0.3 m section of 2.5 cm thick Fiberfrax® insulation. The insulation was used to create a low thermal conductivity section on the heater (i.e., a section where heat transfer to the surroundings is slowed or inhibited (a "hot spot")). The low thermal conductivity section could represent, for example, a rich layer in a hydrocarbon containing formation (e.g., an oil shale formation). The temperature of the heater increased with time as shown by curves 1066, 1064, and 1062. Curves 1066, 1064, and 1062 show that the temperature of the heater increased to about the same value for all three points along the length of the heater. The resulting temperatures were substantially independent of the added Fiberfrax® insulation. Thus, the temperature limited heater did not exceed the selected temperature limit in the presence of a low thermal conductivity section.

FIG. 163 depicts temperature versus log time data for a 2.5 cm solid 410 stainless steel rod and a 2.5 cm solid 304 stainless steel rod. At a constant applied AC electrical current, the temperature of each rod increased with time. Curve 1068 shows data for a thermocouple placed on an outer surface of the 304 stainless steel rod and under a layer of insulation. Curve 1070 shows data for a thermocouple placed on an outer surface of the 304 stainless steel rod without a layer of insulation. Curve 1072 shows data for a thermocouple placed on an outer surface of the 410 stainless steel rod and under a layer of insulation. Curve 1074 shows data for a thermocouple placed on an outer surface of the 410 stainless steel rod without a layer of insulation. A comparison of the curves shows that the temperature of the 304 stainless steel rod (curves 1068 and 1070) increased more rapidly than the temperature of the 410 stainless steel rod (curves 1072 and 1074). The temperature of the 304 stainless steel rod (curves 1068 and 1070) also reached a higher value than the temperature of the 410 stainless steel rod (curves 1072 and 1074). The temperature difference between the non-insulated section of the 410 stainless steel rod (curve 1074) and the insulated section of the 410 stainless steel rod (curve 1072) was less than the temperature difference between the non-insulated section of the 304 stainless steel rod (curve 1070) and the insulated section of the 304 stainless steel rod (curve 1068). The temperature of the 304 stainless steel rod was increasing at the termination of the experiment (curves 1068 and 1070) while the temperature of the 410 stainless steel rod had leveled out (curves 1072 and 1074).

A numerical simulation (FLUENT) was used to compare operation of temperature limited heaters with three turndown ratios. The simulation was done for heaters in an oil shale formation (Green River oil shale). Simulation conditions were:

- 61 m length conductor-in-conduit Curie heaters (center conductor (2.54 cm diameter), conduit outer diameter 7.3 cm)
- downhole heater test field richness profile for an oil shale formation
- 16.5 cm (6.5 inch) diameter wellbores at 9.14 m spacing between wellbores on triangular spacing
- 200 hours power ramp-up time to 820 watts/m initial heat injection rate
- constant current operation after ramp up
- Curie temperature of 720.6° C. for heater
- formation will swell and touch the heater canisters for oil shale richnesses greater than 0.14 L/kg (35 gals/ton)

FIG. 164 displays temperature of a center conductor of a conductor-in-conduit heater as a function of formation depth for a Curie temperature heater with a turndown ratio of 2:1. Curves 1076-1098 depict temperature profiles in the formation at various times ranging from 8 days after the start of heating to 675 days after the start of heating (1076: 8 days, 1078: 50 days, 1080: 91 days, 1082: 133 days, 1084: 216 days, 1086: 300 days, 1088: 383 days, 1090: 466 days, 1092: 550 days, 1094: 591 days, 1096: 633 days, 1098: 675 days). At a turndown ratio of 2:1, the Curie temperature of 720.6° C. was exceeded after about 466 days in the richest oil shale layers. FIG. 165 shows the corresponding heater heat flux through the formation for a turndown ratio of 2:1 along with the oil shale richness profile (curve 1100). Curves 1102-1134 show the heat flux profiles at various times from 8 days after the start of heating to 633 days after the start of heating (1102: 8 days; 1104: 50 days; 1106: 91 days; 1108: 133 days; 1110: 175 days; 1112: 216 days; 1114: 258 days; 1116: 300 days; 1118: 341 days; 1120: 383 days; 1122: 425 days; 1124: 466 days; 1126: 508 days; 1128: 550 days; 1130: 591 days; 1132: 633 days; 1134: 675 days). At a turndown ratio of 2:1, the center conductor temperature exceeded the Curie temperature in the richest oil shale layers.

FIG. 166 displays heater temperature as a function of formation depth for a turndown ratio of 3:1. Curves 1136-1158 show temperature profiles through the formation at various times ranging from 12 days after the start of heating to 703 days after the start of heating (1136: 12 days; 1138: 33 days; 1140: 62 days; 1142: 102 days; 1144: 146 days; 1146: 205 days; 1148: 271 days; 1150: 354 days; 1152: 467 days; 1154: 605 days; 1156: 662 days; 1158: 703 days). At a turndown ratio of 3:1, the Curie temperature was approached after about 703 days. FIG. 167 shows the corresponding heater heat flux through the formation for a turndown ratio of 3:1 along with the oil shale richness profile (curve 1160). Curves 1162-1182 show the heat flux profiles at various times from 12 days after the start of heating to 605 days after the start of heating (1162: 12 days, 1164: 32 days, 1166: 62 days, 1168: 102 days, 1170: 146 days, 1172: 205 days, 1174: 271 days, 1176: 354 days, 1178: 467 days, 1180: 605 days, 1182: 749 days). The center conductor temperature never exceeded the Curie temperature for the turndown ratio of 3:1. The center conductor temperature also showed a relatively flat temperature profile for the 3:1 turndown ratio.

FIG. 168 shows heater temperature as a function of formation depth for a turndown ratio of 4:1. Curves 1184-1204 show temperature profiles through the formation at various times ranging from 12 days after the start of heating to 467 days after the start of heating (1184: 12 days; 1186: 33 days; 1188: 62 days; 1190: 102 days, 1192: 147 days; 1194: 205 days; 1196: 272 days; 1198: 354 days; 1200: 467 days; 1202: 606 days, 1204: 678 days). At a turndown ratio of 4:1, the Curie temperature was not exceeded even after 678 days. The center conductor temperature never exceeded the Curie temperature for the turndown ratio of 4:1. The center conductor showed a temperature profile for the 4:1 turndown ratio that was somewhat flatter than the temperature profile for the 3:1 turndown ratio. The simulations show that the heater temperature stays at or below the Curie temperature for a longer time at higher turndown ratios. For this oil shale richness profile, a turndown ratio of greater than 3:1 may be desirable.

Simulations have been performed to compare the use of temperature limited heaters and non-temperature limited heaters in an oil shale formation. Simulation data was produced for conductor-in-conduit heaters placed in 16.5 cm (6.5 inch) diameter wellbores with 12.2 m (40 feet) spacing between heaters using one or more of the analytical equations set forth herein, a formation simulator (e.g., STARS), and a near wellbore simulator (e.g., ABAQUS). Standard conductor-in-conduit heaters included 304 stainless steel conductors and conduits. Temperature limited conductor-in-conduit heaters included a metal with a Curie temperature of 760° C. for conductors and conduits. Results from the simulations are depicted in FIGS. 169-171.

FIG. 169 depicts heater temperature at the conductor of a conductor-in-conduit heater versus depth of the heater in the formation for a simulation after 20,000 hours of operation. Heater power was set at about 820 watts/meter until 760° C. was reached, and the power was reduced to inhibit overheating. Curve 1206 depicts the conductor temperature for standard conductor-in-conduit heaters. Curve 1206 shows that a large variance in conductor temperature and a significant number of hot spots developed along the length of the conductor. The temperature of the conductor had a minimum value of about 490° C. Curve 1208 depicts conductor temperature for temperature limited conductor-in-conduit heaters. As shown in FIG. 169, temperature distribution along the length of the conductor was more controlled for the temperature limited heaters. In addition, the operating temperature of the conductor was about 730° C. for the temperature limited heaters. Thus, more heat input would be provided to the formation for a similar heater power using temperature limited heaters.

FIG. 170 depicts heater heat flux versus time for the heaters used in the simulation for heating oil shale. Curve 1210 depicts heat flux for standard conductor-in-conduit heaters. Curve 1212 depicts heat flux for temperature limited conductor-in-conduit heaters. As shown in FIG. 170, heat flux for the temperature limited heaters was maintained at a higher value for a longer period of time than heat flux for standard heaters. The higher heat flux may provide more uniform and faster heating of the formation.

FIG. 171 depicts accumulated heat input versus time for the heaters used in the simulation for heating oil shale. Curve 1214 depicts accumulated heat input for standard conductor-in-conduit heaters. Curve 1216 depicts accumulated heat input for temperature limited conductor-in-conduit heaters. As shown in FIG. 171, accumulated heat input for the temperature limited heaters increased faster than accumulated heat input for standard heaters. The faster accumulation of heat in the formation using temperature limited heaters may decrease the time needed for retorting the formation. Onset of retorting of an oil shale formation may begin around an average accumulated heat input of $1.1\times10^8$ kJ/meter. This value of accumulated heat input is reached around 5 years for temperature limited heaters and between 9 and 10 years for standard heaters.

FIGS. 172-176 depict estimated properties of temperature limited heaters based on analytical equations. The estimated properties in FIGS. 172-176 were calculated using a value for the magnetic permeability that did not vary with current for low values of the current. FIG. 172 shows DC resistivity versus temperature for a 1% carbon steel temperature limited heater. The resistivity increased with temperature from about 20 microohm-cm at about 0° C. to about 120 microohm-cm at about 725° C.

FIG. 173 shows magnetic permeability versus temperature for a 1% carbon steel temperature limited heater. The magnetic permeability decreased rapidly at temperatures over about 650° C. The metal was substantially non-magnetic above about 750° C.

FIG. 174 shows skin depth versus temperature for a 1% carbon steel temperature limited heater at 60 Hz. The skin depth increased from about 0.13 cm at about 0° C. to about 0.445 cm at about 720° C. due to the increase in DC resistivity. The sharp increase in skin depth above 720° C. (greater than 2.5 cm) is due to a decrease in magnetic permeability near the Curie temperature.

FIG. 175 shows AC resistance for a 244 m long, 1" Schedule XXS carbon steel pipe versus temperature at 60 Hz. AC resistance increased by a factor of about two from room temperature to about 650° C. due to the competing changes in resistivity and skin depth with temperature. Above about 720° C., the sharp decrease in AC resistance was due to a decrease in magnetic permeability near the Curie temperature.

FIG. 176 shows heater power versus temperature for a 244 m long, 1" Schedule XXS carbon steel pipe at 600 A (constant) and 60 Hz. The power increased by a factor of about two from room temperature to about 650° C., but then decreased sharply above about 650° C. due to a decrease in magnetic permeability near the Curie temperature. This decrease in power near the Curie temperature results in self-limiting of the heater such that elevated temperatures of the heater above about the Curie temperature do not occur.

FIGS. 177-179 depict AC resistance versus temperature for various conductors as calculated using analytical equations including equations such as, for example, EQN. 39. The results depicted in FIGS. 177, 178, and 179 were calculated for a magnetic permeability that did not vary with current. Generally, the AC resistance of a conductor in a heater is indicative of the heat output (power) of the heater for a constant current (power=$(\text{current})^2\times(\text{resistance})$). FIG. 177 depicts AC resistance versus temperature for a 1.5 cm diameter iron conductor with a length of 244 m. Curve 1218 shows that the AC resistance steadily increased with temperature (which is typical for most metals) and began to decrease as the temperature neared the Curie temperature. The AC resistance decreased sharply above the Curie temperature (i.e., above about 740° C.).

FIG. 178 depicts AC resistance versus temperature for a 1.5 cm diameter composite conductor of iron and copper with a length of 244 m. Curve 1220 depicts AC resistance versus temperature for a 0.25 cm diameter copper core inside an iron conductor with an outside diameter of 1.5 cm. Curve 1222 depicts AC resistance versus temperature for a 0.5 cm diameter copper core inside an iron conductor with an outside diameter of 1.5 cm. The alternating current at about room temperature travels through the skin depth of the iron conductor. As shown in FIG. 178, increasing the diameter of the copper core, which decreased the thickness of the iron conductor for the same outside diameter, reduced the temperature at which the AC resistance began to decrease. The alternating current may begin to flow through the larger copper core at lower temperatures because of the smaller thickness of the iron conductor.

FIG. 179 depicts AC resistance versus temperature for a 1.3 cm diameter composite conductor of iron and copper with a length of 244 m and AC resistance versus temperature for the 1.5 cm diameter composite conductor of iron and copper with a length of 244 m (curve 1222) from FIG. 178. Curve 1224 depicts AC resistance versus temperature for a 0.3 cm diameter copper core inside a 0.5 cm thick iron conductor. As shown in FIG. 179, the 1.3 cm diameter composite conductor with a 0.3 cm (curve 1224) has a relatively flat resistance profile from about 200° C. to about 600° C. This relatively flat resistance profile may provide a desired heat output profile for use in heating a hydrocarbon containing formation or other subsurface formation. A desired heater for heating a hydrocarbon containing formation may increase the heat output to a relatively constant level at low temperature and then maintain the relatively constant heat output level over a large temperature range. Such a heater may quickly and uniformly heat a hydrocarbon containing formation.

A heater with the resistance profile of curve 1222 (i.e., the resistance slowly decreases with temperature above a certain temperature) may be used in certain embodiments for heating subsurface formations. For example, a heater may be needed to provide more heat output at lower temperatures to heat a formation with significant amounts of water. A heater that provides more heat output at lower temperatures may be used to remove the water without providing excess heat to portions of the formation that do not contain significant amounts of water.

Analytical solutions for the AC conductance of ferromagnetic materials may be used to predict the behavior of ferromagnetic material and/or other materials during heating of a formation. The AC conductance of a wire of uniform circular cross section made of ferromagnetic materials may be solved for analytically. For a wire of radius b, the magnetic permeability, electric permittivity, and electrical conductivity of the wire may be denoted by $\mu$, $\epsilon$, and $\sigma$, respectively. The parameter, $\mu$, is treated as a constant (i.e., independent of the magnetic field strength).

Maxwell's Equations are:

$$\underline{\nabla}\cdot\underline{B}=0; \tag{42}$$

$$\underline{\nabla}\times\underline{E}+\partial\underline{B}/\partial t=0; \tag{43}$$

$$\underline{\nabla}\cdot\underline{D}=\rho; \tag{44}$$

$$\text{and } \underline{\nabla}\times\underline{H}-\partial\underline{D}/\partial t=\underline{J}. \tag{45}$$

The constitutive equations for the wire are:

$$\underline{D}=\epsilon\underline{E},\ \underline{B}=\mu\underline{H},\ \underline{J}=\sigma\underline{E}. \tag{46}$$

Substituting EQN. 46 into EQNS. 42-45, setting $\rho=0$, and writing:

$$\underline{E}(r,t)=\underline{E}_S(\underline{r})e^{j\omega t} \tag{47}$$

$$\text{and } \underline{H}(r,t)=\underline{H}_S(\underline{r})e^{j\omega t}, \tag{48}$$

the following equations are obtained:

$$\underline{\nabla}\cdot\underline{H}_S=0; \tag{49}$$

$$\underline{\nabla}\times\underline{E}_S+j\mu\omega\underline{H}_S=0; \tag{50}$$

$$\underline{\nabla}\cdot\underline{E}_S=0; \tag{51}$$

$$\text{and } \underline{\nabla}\times\underline{H}_S-j\omega\epsilon\underline{E}_S=\sigma\underline{E}_S. \tag{52}$$

Note that EQN. 51 follows on taking the divergence of EQN. 52. Taking the curl of EQN. 50, using the fact that for any vector function $\underline{F}$:

$$\underline{\nabla}\times\underline{\nabla}\times\underline{F}=\underline{\nabla}(\underline{\nabla}\cdot\underline{F})-\nabla^2\underline{F}, \tag{53}$$

and applying EQN. 49, it is deduced that:

$$\nabla^2\underline{E}_S-C^2\underline{E}_S=0, \tag{54}$$

$$\text{where } C^2=j\omega\mu\sigma_{eff}, \tag{55}$$

$$\text{with } \sigma_{eff}=\sigma+j\omega\epsilon. \tag{56}$$

For a cylindrical wire, it is assumed that:

$$\underline{E}_S=E_S(r)\hat{k}, \tag{57}$$

which means that $E_S(r)$ satisfies the equation:

$$\frac{1}{r}\frac{\partial}{\partial r}\left(r\frac{\partial E_S}{\partial r}\right)-C^2E_S=0. \tag{58}$$

The general solution of EQN. 58 is:

$$E_S(r)=AI_0(Cr)+BK_0(Cr). \tag{59}$$

B must vanish as $K_0$ is singular at r=0, and so it is deduced that:

$$E_S(r)=E_S(b)\frac{I_0(Cr)}{I_0(Cb)}=|E_S(r)|e^{i\phi(r)}. \tag{60}$$

The power output in the wire per unit length (P) is given by:

$$P=\frac{1}{2}\int_0^b dr2\pi r\sigma|E_S|^2, \tag{61}$$

and the mean current squared ($<I^2>$) is given by:

$$\begin{aligned}<I^2>&=\frac{1}{2}\left|\int_0^b dr2\pi rJ_S\right|^2\\&=\frac{1}{2}\left|\int_0^b dr2\pi r\sigma E_S\right|^2.\end{aligned} \tag{62}$$

EQNS. 61 and 62 may be used to obtain an expression for the effective resistance per unit length (R) of the wire. This gives:

$$\begin{aligned}R\equiv P/<I^2>&=\frac{\int_0^b drr\sigma|E_S|^2}{2\pi\left|\int_0^b drr\sigma E_S\right|^2}\\&=\frac{\int_0^b drr|E_S|^2}{2\pi\sigma\left|\int_0^b drrE_S\right|^2},\end{aligned} \tag{63}$$

with the second term on the right-hand side of EQN. 63 holding for constant $\sigma$.

C may be expressed in terms of its real part ($C_R$) and its imaginary part ($C_I$) so that:

$$C=C_R+iC_I. \tag{64}$$

An approximate solution for $C_R$ may be obtained. $C_R$ may be chosen to be positive. The quantities below may also be needed:

$$|C|=\{C_R^2+C_I^2\}^{1/2} \tag{65}$$

$$\text{and } \gamma\equiv C/|C|=\gamma_R+i\gamma_I. \tag{66}$$

A large value of Re(z) gives:

$$I_0(z) = \frac{e^z}{\sqrt{2\pi z}}\{1 + O[z^{-1}]\}. \tag{67}$$

This means that:

$$E_S(r) \cong E_S(b)e^{-\gamma\xi}, \tag{68}$$

$$\text{with } \xi = |C|(b-r). \tag{69}$$

Substituting EQN. 68 into EQN. 63 yields the approximate result:

$$R = \frac{|C|/2}{2\pi a\sigma\gamma_R} = \frac{|C|^2/\{2C_R\}}{2\pi b\sigma}. \tag{70}$$

EQN. 70 may be written in the form:

$$R = 1/(2\pi b\delta\sigma), \tag{71}$$

$$\text{with } \delta = 2C_R/|C|^2 \cong \sqrt{2/(\omega\mu\sigma)}. \tag{72}$$

$\delta$ is known as the skin depth, and the approximate form in EQN. 72 arises on replacing $\sigma_{eff}$ by $\sigma$.

The expression in EQN. 68 may be obtained directly EQN. 58. Transforming to the variable $\xi$ gives:

$$\frac{1}{1-\varepsilon\xi}\frac{\partial}{\partial\xi}\left((1-\varepsilon\xi)\frac{\partial E_S}{\partial\xi}\right) - \gamma^2 E_S = 0, \tag{73}$$

with $$\varepsilon = 1/(a|C|). \tag{74}$$

The solution of EQN. 73 can be written as:

$$E_S = \sum_{k=0}^{\infty} E_S^{(k)}\varepsilon^k, \tag{75}$$

with $$\frac{\partial^2 E_S^{(0)}}{\partial\xi^2} - \gamma^2 E_S^{(0)} = 0 \tag{76}$$

and $$\frac{\partial^2 E_S^{(m)}}{\partial\xi^2} - \gamma^2 E_S^{(m)} = \sum_{k=1}^{m} \xi^{k-1}\frac{\partial E_S^{m-k}}{\partial\xi}; m = 1, 2, \ldots \tag{77}$$

The solution of EQN. 76 is:

$$E_S^{(0)} = E_S(a)e^{-\gamma\xi}, \tag{78}$$

and solutions of EQN. 77 for successive m may also be readily written down. For instance:

$$E_S^{(1)} = \tfrac{1}{2}E_S(a)\xi e^{-\gamma\xi}. \tag{79}$$

The AC conductance of a composite wire having ferromagnetic materials may also be solved for analytically. In this case, the region $0 \leqq r < a$ may be composed of material 1 and the region $a < r \leqq b$ may be composed of material 2. $E_{S1}(r)$ and $E_{S2}(r)$ may denote the electrical fields in the two regions, respectively. This gives:

$$\frac{1}{r}\frac{\partial}{\partial r}\left(r\frac{\partial E_{S1}}{\partial r}\right) - C_1^2 E_{S1} = 0;\ 0 \le r < a \tag{80}$$

and $$\frac{1}{r}\frac{\partial}{\partial r}\left(r\frac{\partial E_{S2}}{\partial r}\right) - C_2^2 E_{S2} = 0;\ a < r \le b, \tag{81}$$

with $$C_k = j\omega\mu_k\sigma_{effk};\ k = 1, 2 \tag{82}$$

and $$\sigma_{effk} = \sigma_k + j\omega\varepsilon_k;\ k = 1, 2. \tag{83}$$

The solutions of EQNS. 80 and 81 satisfy the boundary conditions:

$$E_{S1}(a) = E_{S2}(a) \tag{84}$$

$$\text{and } H_{S1}(a) = H_{S2}(a) \tag{85}$$

and take the form:

$$E_{S1}(r) = A_1 I_0(C_1 r) \tag{86}$$

$$\text{and } E_{S2}(r) = A_2 I_0(C_2 r) + B_2 K_0(C_2 r) \tag{87}$$

Using EQN. 50, the boundary condition in EQN. 85 may be expressed in terms of the electric field as:

$$\frac{1}{\mu_1}\frac{\partial E_{S1}}{\partial r}\bigg|_{r=a} = \frac{1}{\mu_2}\frac{\partial E_{S2}}{\partial r}\bigg|_{r=a}. \tag{88}$$

Applying the two boundary conditions in EQNS. 84 and 88 allows $E_{S1}(r)$ and $E_{S2}(r)$ to be expressed in terms of the electric field at the surface of the wire $E_{S2}(b)$. EQN. 84 yields:

$$A_1 I_0(C_1 a) = A_2 I_0(C_2 a) + B_2 K_0(C_2 a), \tag{89}$$

while EQN. 88 gives:

$$A_1\tilde{C}_1 I_1(C_1 a) = \tilde{C}_2\{A_2 I_1(C_2 a) - B_2 K_1(C_2 a)\}. \tag{90}$$

Writing EQN. 90 uses the fact that:

$$I_1(z) = \frac{d}{dz}I_0(z);\ K_1(z) = -\frac{d}{dz}K_0(z) \tag{91}$$

and introduces the quantities:

$$\tilde{C}_1 \equiv C_1/\mu_1;\ \tilde{C}_2 \equiv C_2/\mu_2. \tag{92}$$

Solving EQN. 89 for $A_2$ and $B_2$ in terms of $A_1$ obtains:

$$A_2 = A_1\frac{\tilde{C}_2 I_0(C_1 a)K_1(C_2 a) + \tilde{C}_1 I_1(C_1 a)K_0(C_2 a)}{\tilde{C}_2\{I_0(C_2 a)K_1(C_2 a) + I_1(C_2 a)K_0(C_2 a)\}}; \tag{93}$$

and $$B_2 = A_1\frac{\tilde{C}_2 I_0(C_1 a)I_1(C_2 a) - \tilde{C}_1 I_1(C_1 a)I_0(C_2 a)}{\tilde{C}_2\{I_0(C_2 a)K_1(C_2 a) + I_1(C_2 a)K_0(C_2 a)\}}. \tag{94}$$

Power output per unit length and AC resistance of a composite wire may be solved for similarly to the method used for the uniform wire. In some cases, if the skin depth of the conductor is small in comparison to the radius of the wire, the functions containing $C_2$ may become large and may be replaced by exponentials. However, as the temperature nears the Curie temperature, a full solution may be required.

The dependence of μ on B may be treated iteratively by solving the above equations first with a constant μ to determine B. Then the known B versus H curves for the ferromagnetic material may be used to iterate for the exact value of μ in the equations.

FIG. 180 depicts AC resistance versus temperature using the derived analytical equations. The AC resistance has been calculated for a composite wire (244 m long, outside diameter of 1.52 cm) with a copper core (outside diameter of 0.25 cm) and a carbon steel outer layer (thickness of 0.635 cm). FIG. 180 shows that the AC resistance for this composite wire begins to decrease above about 647° C. and then decreases sharply above about 716° C.

Analytical equations may be used to determine the relative magnetic permeability as a function of magnetic field and/or a rod diameter as a function of heat flux and τ. τ may be the ratio of AC to DC resistance of a heater at a given temperature T and power rating per unit length Q. Then:

$$\tau=R_{AC}/R_{DC}=a^2/\{a^2-(a-\delta_{eff})^2\}; \tag{95}$$

where a is the radius of the rod and where the effective skin depth $\delta_{eff}$ is given by:

$$\delta_{eff}=\sqrt{\frac{2\rho}{\omega\mu_0\mu_r^{eff}}}. \tag{96}$$

The quantities appearing on the right-hand side of EQN. 96 are the DC resistivity, ρ, the angular frequency, ω=2πf, the permeability in vacuo, $\mu_0$, and an effective relative magnetic permeability, $\mu_r^{eff}$. This latter quantity depends on magnetic field H and temperature T.

Note that EQN. 95 may be rearranged to read:

$$\delta_{eff}/a=1-(1-\tau^{-1})^{1/2}. \tag{97}$$

The power delivered per unit length of heater is given by:

$$Q=I^2R_{AC}/L=I^2\tau\rho/(\pi a^2). \tag{98}$$

Note that the magnetic field at the heater surface H is related to the current by:

$$H=I/(2\pi a). \tag{99}$$

Substituting EQN. 99 into EQN. 98 and rearranging, the following equation may be obtained:

$$H^2\tau=Q/(4\pi\rho). \tag{100}$$

Similarly, substituting EQN. 96 into EQN. 95 and rearranging gives:

$$a=\{1-(1-\tau^{-1})^{1/2}\}^{-1}\{2/(\omega\mu_0)\}^{1/2}\{\rho/\mu_r^{eff}\}^{1/2}. \tag{101}$$

The following can be written:

$$\omega=2\pi f=\pi/30\ s^{-1}\ (60\ Hz); \tag{102}$$

$$\mu_0=4\pi\times10^{-7}\ \Omega s/m; \tag{103}$$

and the following can be set:

$$\rho=\rho_{\mu\Omega cm}\times10^{-8}\ \Omega m;\ \text{and} \tag{104}$$

$$Q=Q_{W/ft}/0.3048\ W/m; \tag{105}$$

where $\rho_{\mu\Omega cm}$ denotes the DC resistivity of the heater core expressed in μΩcm and $Q_{W/ft}$ is the heat flux per unit length expressed in W/ft. The following results may be obtained for the magnetic field H and the core radius a:

$$H=51.096\{Q_{W/ft}/(\rho_{\mu\Omega cm}\tau)\}^{1/2}\ A/cm;\ \text{and} \tag{106}$$

$$a=0.6457\{1-(1-\tau^{-1})^{1/2}\}^{-1}(\rho_{\mu\Omega cm}/\mu_r^{eff})^{1/2}\ cm. \tag{107}$$

Below the Curie point and with fields high enough to saturate the material, expect:

$$\mu_r^{eff}=1+M_S(T)/H. \tag{108}$$

In a regime where the magnetization is approaching saturation and the effective permeability is falling from its maximum value, the following relation yields a good description of the relation between $\mu_r^{eff}$ and H:

$$\mu_r^{eff}=CH^{-\beta}; \tag{109}$$

with β close to but less than unity. Substituting EQN. 106 into EQN. 109, and the latter into EQN. 107 obtains:

$$a=0.6497(51.096)^{\beta/2}\{1-(1-\tau^{-1})^{1/2}\}^{-1}\tau^{-\beta/4}\rho_{\mu\Omega cm}^{(1/2-\beta/4)}Q_{W/ft}^{\beta/4}/C^{1/2}\ (cm). \tag{110}$$

Expressing EQN. 110 in terms of a diameter D in inches, multiply EQN. 110 by 2/2.54 to yield:

$$D=0.5116(51.096)^{\beta/2}\{1-(1-\tau^{-1})^{1/2}\}^{-1}\tau^{-\beta/4}\rho_{\mu\Omega cm}^{(1/2-\beta/4)}Q_{W/ft}^{\beta/4}/C^{1/2}\ (in). \tag{111}$$

The above equations may be used to determine plots of relative magnetic permeability versus magnetic field for several materials. Example materials are 446SS (Curie point temperature of 604° C.), 410SS (Curie point temperature of 727° C.), and the alloy Invar 36 (36% Ni in Fe, with a Curie point temperature of 279° C.). Plots of data of measured values of the relative magnetic permeability versus magnetic field for these materials are shown in FIG. 181 and in FIG. 182, where curves that fit to the form in EQN. 109 are also depicted. Values of the parameters C and β are tabulated in TABLE 13 below. TABLE 13 lists values of the coefficients appearing in EQN. 109 for three materials depicted in FIGS. 181 and 182.

TABLE 13

| Material | C $(A/m)^{\beta}$ | β |
|---|---|---|
| 446SS | 6736 | 0.8 |
| 410SS | 10770 | 0.9 |
| Invar 36 | 4005 | 0.8387 |

In FIG. 181, curve 1226 is data for 446SS at 371° C.; curve 1228 is data for 446SS at 538° C.; curve 1230 is a curve fit calculated for 446SS using EQN. 109; curve 1232 is data for 410SS at 538° C.; curve 1234 is data for 410SS at 677° C.; and curve 1236 is a curve fit calculated for 410SS using EQN. 109. In FIG. 182, curve 1238 is data for Invar 36 at ambient temperature and curve 1240 is a curve fit calculated for Invar 36 using EQN. 109.

FIG. 183 depicts the rod diameter required as a function of heat flux to obtain a τ of 2 for each of the three materials above using EQN. 110 and data from TABLE 13. Curve 1242 is for Invar 36 at ambient temperature; curve 1244 is for 446SS at 538° C.; and curve 1246 is for 410SS at 677° C. The values of C in TABLE 13 are for a surface field on a rod for 446SS and 410SS and for a uniform magnetizing field for Invar 36. An equivalent surface field for Invar 36 may be twice the value of the uniform magnetizing field, C, shown for Invar 36 in TABLE 13. The equivalent surface field value is used in FIG. 183.

Bench-top measurements have been made for 2.54 cm, 3.18 cm, and 3.81 cm diameter 410SS rods. FIG. 184 shows the $\mu_r^{eff}$ versus H curves for these three sizes of rod. Curve 1248 is data for 3.81 cm rod, curve 1250 is data for 3.18 cm rod, curve 1252 is data for 2.54 cm rod, and curve 1254 is calculated from EQN. 109 for a 2.54 cm rod. The data curves coincide closely with the curve for calculations using EQN. 109, derived for the 2.54 cm rod. Thus, predictions may be made about the behavior of larger rods. Inverting EQNS. 107, 109, and 106 obtains:

$$\mu_r^{eff}=\rho_{\mu\Omega cm}\{0.5116/[D\{1-(1-\tau^{-1})^{0.5}\}]\}^2; \quad (112)$$

$$H=(C/\mu_r^{eff})^{1/\beta}; \text{ and} \quad (113)$$

$$Q_{W/ft}=0.000383\rho_{\mu\Omega cm}\tau H^2. \quad (114)$$

A $\tau$ versus Q curve for a heater with a given diameter may then obtained by choosing a value of $\tau$ and then entering it and the values of the heater diameter and DC resistivity successively into EQNS. 112-114 to yield the value of $Q_{W/ft}$. A comparison of the results of carrying out this procedure with measured values is shown in FIG. 185, which depicts $\tau$ versus heat flux ($\tau$ versus Q). Curve 1256 is data for a 3.81 cm rod, curve 1258 is data for a 3.18 cm rod, curve 1260 is data for a 2.54 cm rod, curve 1262 is the prediction using EQNS. 112-114 for a 2.54 cm rod, curve 1264 is the prediction using EQNS. 112-114 for a 3.18 cm rod, and curve 1266 is the prediction using EQNS. 112-114 for a 3.81 cm rod. FIG. 185 shows excellent results for the 3.18 cm rod and relatively good results for the 3.81 cm rod.

In some embodiments, a temperature limited heater positioned in a wellbore may heat steam that is provided to the wellbore. The heated steam may be introduced into a portion of a formation. In certain embodiments, the heated steam may be used as a heat transfer fluid to heat a portion of a formation. In an embodiment, the temperature limited heater includes ferromagnetic material with a selected Curie temperature. The use of a temperature limited heater may inhibit a temperature of the heater from increasing beyond a maximum selected temperature (e.g., at or about the Curie temperature). Limiting the temperature of the heater may inhibit potential burnout of the heater. The maximum selected temperature may be a temperature selected to heat the steam to above or near 100% saturation conditions, superheated conditions, or supercritical conditions. Using a temperature limited heater to heat the steam may inhibit overheating of the steam in the wellbore. Steam introduced into a formation may be used for synthesis gas production, to heat the hydrocarbon containing formation, to carry chemicals into the formation, to extract chemicals from the formation, and/or to control heating of the formation.

A portion of a formation where steam is introduced or that is heated with steam may be at significant depths below the surface (e.g., greater than about 1000 m, about 2500, or about 5000 m below the surface). If steam is heated at the surface of a formation and introduced to the formation through a wellbore, a quality of the heated steam provided to the wellbore at the surface may have to be relatively high to accommodate heat losses to a wellbore casing and/or the overburden as the steam travels down the wellbore. Heating the steam in the wellbore may allow the quality of the steam to be significantly improved before the steam is introduced to the formation. A temperature limited heater positioned in a lower section of the overburden and/or adjacent to a target zone of the formation may be used to controllably heat steam to improve the quality of the steam.

A temperature limited heater positioned in a wellbore may be used to heat the steam to above or near 100% saturation conditions or superheated conditions. In some embodiments, a temperature limited heater may heat the steam so that the steam is above or near supercritical conditions. The static head of fluid above the temperature limited heater may facilitate producing 100% saturation, superheated, and/or supercritical conditions in the steam. Supercritical or near supercritical steam may be used to strip hydrocarbon material and/or other materials from the formation. In certain embodiments, steam introduced into a formation may have a high density (e.g., a specific gravity of about 0.8 or above). Increasing the density of the steam may improve the ability of the steam to strip hydrocarbon material and/or other materials from the formation.

A downhole heater assembly may include 5, 10, 20, 40, or more heaters coupled together. For example, a heater assembly may include between 10 and 40 heaters. Heaters in a downhole heater assembly may be coupled in series. In some embodiments, heaters in a heater assembly may be spaced from about 7.6 m to about 30.5 m apart. For example, heaters in a heater assembly may be spaced about 15 m apart. Spacing between heaters in a heater assembly may be a function of heat transfer from the heaters to the formation. For example, a spacing between heaters may be chosen to limit temperature variation along a length of a heater assembly to acceptable limits. A heater assembly may advantageously provide substantially uniform heating over a relatively long length of an opening in a formation. Heaters in a heater assembly may include, but are not limited to, electrical heaters (e.g., insulated conductor heaters, conductor-in-conduit heaters, pipe-in-pipe heaters), flameless distributed combustors, natural distributed combustors, and/or oxidizers. In some embodiments, heaters in a downhole heater assembly may include only oxidizers.

FIG. 186 depicts a schematic of an embodiment of downhole oxidizer assembly 1268 including oxidizers 1270. In some embodiments, oxidizer assembly 1268 may include oxidizers 1270 and flameless distributed combustors. Oxidizer assembly 1268 may be lowered into an opening in a formation and positioned as desired. In some embodiments, a portion of the opening in the formation may be substantially parallel to the surface of the Earth. In some embodiments, the opening of the formation may be otherwise angled with respect to the surface of the Earth. In an embodiment, the opening may include a significant vertical portion and a portion otherwise angled with respect to the surface of the Earth. In certain embodiments, the opening may be a branched opening. Oxidizer assemblies may branch from common fuel and/or oxidizer conduits in a central portion of the opening.

Fuel 1272 may be supplied to oxidizers 1270 through fuel conduit 1274. In some embodiments, fuel conduit 1274 may include a catalytic surface (e.g., a catalytic inner surface) to decrease an ignition temperature of fuel 1272. Oxidizing fluid 1276 may be supplied to oxidizer assembly 1268 through oxidizer conduit 1278. In some embodiments, fuel conduit 1274 and/or oxidizers 1270 may be positioned concentrically, or substantially concentrically, in oxidizer conduit 1278. In some embodiments, fuel conduit 1274 and/or oxidizers 1270 may be arranged other than concentrically with respect to oxidizer conduit 1278. In certain branched opening embodiments, fuel conduit 1274 and/or oxidizer conduit 1278 may have a weld or coupling to allow placement of oxidizer assemblies 1268 in branches of the opening.

An ignition source may be positioned in or proximate oxidizers 1270 to initiate combustion. In some embodiments, an ignition source may heat the fuel and/or the oxidizing fluid supplied to a particular heater to a temperature sufficient to support ignition of the fuel. The fuel may be oxidized with the oxidizing fluid in oxidizers 1270 to generate heat. Oxidation products may mix with oxidizing fluid downstream of the first oxidizer in oxidizer conduit 1278. Exhaust gas 1280 may include unreacted oxidizing fluid and unreacted fuel as well as oxidation products. In some embodiments, a portion of exhaust gas 1280, may be provided to downstream oxidizer 1270. In some embodiments, a portion of exhaust gas 1280 may return to the surface through outer conduit 1282. As the exhaust gas returns to the surface through outer conduit 1282, heat from exhaust gas 1280 may be transferred to the formation. Returning exhaust gas 1280 through outer conduit 1282 may provide substantially uniform heating along oxidizer assembly 1268 due to heat from the exhaust gas integrating with the heat provided from individual oxidizers of the oxidizer assembly. In some embodiments, oxidizing fluid 1276 may be introduced through outer conduit 1282 and exhaust gas 1280 may be returned through oxidizer conduit 1278. In certain embodiments, heat integration may occur along an extended vertical portion of an opening.

Fuel supplied to an oxidizer assembly may include, but is not limited to, hydrogen, methane, ethane, and/or other hydrocarbons. In certain embodiments, fuel used to initiate combustion may be enriched to decrease the temperature required for ignition. In some embodiments, hydrogen ($H_2$) or other hydrogen rich fluids may be used to enrich fuel initially supplied to the oxidizers. After ignition of the oxidizers, enrichment of the fuel may be stopped.

After oxidizer ignition, steps may be taken to reduce coking of fuel in the fuel conduit. For example, steam may be added to the fuel to inhibit coking in the fuel conduit. In some embodiments, the fuel may be methane that is mixed with steam in a molar ratio of up to 1:1. In some embodiments, coking may be inhibited by decreasing a residence time of fuel in the fuel conduit. In some embodiments, coking may be inhibited by insulating portions of the fuel conduit that pass through high temperature zones proximate oxidizers.

A velocity of fuel flow in downstream oxidizers in an oxidizer assembly may be lower than a velocity of fuel flow in upstream oxidizers in the oxidizer assembly. In some embodiments, a velocity of fuel flowing through a fuel conduit may be increased by providing a carrier gas (e.g., carbon dioxide or exhaust gas from an upstream oxidizer) to the fuel conduit. In certain embodiments, a venturi device may be positioned in a fuel conduit proximate an oxidizer (e.g., slightly upstream of an oxidizer) to increase a velocity of fuel flow to the oxidizer. FIG. 187 depicts a schematic representation of an embodiment of venturi device 1284 coupled to fuel conduit 1274. One or more openings in fuel conduit 1274 and venturi device 1284 may pull oxidizing fluid 1276 from oxidizer conduit 1278 through at least a portion of the venturi device, increasing a flow rate of fuel/oxidizing fluid mixture to oxidizer 1270. In some embodiments, a single venturi device may be used in an oxidizer assembly. In certain embodiments, more than one venturi device may be used in an oxidizer assembly (e.g., one venturi device for every three oxidizers, or one venturi device for every oxidizer after the tenth oxidizer). Venturi devices in an oxidizer assembly may promote even fuel flow from the fuel conduit to the oxidizers along the length of the fuel conduit.

In some embodiments, oxidizers in an oxidizer assembly may be used concurrently. In some embodiments, one or more oxidizers may be in use while other oxidizers are allowed to cool. In certain embodiments, oxidizers in an oxidizer assembly may undergo alternate heating and cooling cycles. Valves coupled to a fuel conduit may regulate fuel supply to one or more oxidizers in an oxidizer assembly. In some embodiments, a control valve coupled to a fuel conduit may allow fuel from the fuel conduit to enter one or more oxidizers. FIG. 188 depicts a schematic representation of an embodiment of a portion of oxidizer assembly 1268 including valve 1286 coupled to fuel conduit 1274. Oxidizer assembly 1268 may include one or more valves 1286. In an embodiment, valve 1286 is positioned upstream of oxidizer 1270. In some embodiments, as shown in FIG. 189, valve 1286 may be positioned in oxidizer 1270.

Valve 1286 may control fuel flow to one or more oxidizers 1270. For example, valve 1286 may control fuel flow to five oxidizers 1270. In some embodiments, valve 1286 may open automatically (e.g., the valve may be self-regulating). For example, when oxidizers 1270 upstream from valve 1286 are ignited and start to produce heat, the valve may open such that fuel is allowed to flow to one or more oxidizers downstream of the valve. Thus, oxidizers 1270 may be ignited sequentially from an upstream end to a downstream end of an oxidizer assembly.

In some embodiments, a valve activated by thermal expansion may be used to control fuel supply to an oxidizer (e.g., to inhibit overheating of the oxidizer). A thermal expansion valve may be positioned upstream of the oxidizer to inhibit overheating of the valve. A thermal expansion valve may include, for example, bimetallic or ferromagnetic material. In some embodiments, a valve that automatically closes or opens at or near a selected temperature may be used to control fuel flow to one or more oxidizers in an oxidizer assembly.

FIG. 190 depicts an embodiment of valve 1286 including ferromagnetic member 1288, plug 1290, and springs 1292. In some embodiments, ferromagnetic member 1288 may be a permanent magnet that is able to attract plug 1290. Springs 1292 coupled to plug 1290 may pull the plug into a seated position to restrict fuel flow into line 1296. Ferromagnetic member 1288 may be positioned proximate plug 1290 (e.g., opposite seat 1294). The force constant of springs 1292 and the magnetic strength of ferromagnetic member 1288 may be chosen such that the ferromagnetic member holds plug 1290 out of seat 1294 to allow fuel 1272 to flow into line 1296 when the temperature of the ferromagnetic member is below the Curie temperature of the ferromagnetic member (i.e., when the magnetic strength of ferromagnetic member 1288 is high). As the temperature increases and approaches, becomes, or exceeds the Curie temperature of ferromagnetic member 1288, the magnetic strength of the ferromagnetic member decreases such that the force from springs 1292 pulls plug 1290 into seat 1294 to restrict or close off flow of fuel 1272 through valve 1286 into line 1296. Valve 1286 may act reversibly. For example, as a temperature of ferromagnetic member 1288 falls below the Curie temperature, valve 1286 may reopen as the force of attraction between the ferromagnetic member and plug 1290 exceeds the pulling force of springs 1292 on the plug. In some embodiments, springs 1292 may be configured to push plug 1290 into a seated position. In some embodiments, member 1288 may be a magnet and plug 1290 may be ferromagnetic.

Oxidizing fluid supplied to an oxidizer assembly may include, but is not limited to, air, oxygen enriched air, and/or hydrogen peroxide. Depletion of oxygen in oxidizing fluid may occur toward a terminal end of an oxidizer assembly. In an embodiment, a flow of oxidizing fluid may be increased (e.g., by using compression to provide excess oxidizing fluid) such that sufficient oxygen is present for operation of the terminal oxidizer. In some embodiments, oxidizing fluid may be enriched by increasing an oxygen content of the oxidizing fluid prior to introduction of the oxidizing fluid to the oxidizers. Oxidizing fluid may be enriched by methods including, but not limited to, adding oxygen to the oxidizing fluid, adding an additional oxidant such as hydrogen peroxide to the oxidizing fluid (e.g., air) and/or flowing oxidizing fluid through a membrane that allows preferential diffusion of oxygen.

FIG. 191 depicts a schematic representation of an embodiment of a membrane that allows preferential diffusion of oxygen positioned upstream of oxidizers in an oxidizer assembly to enhance oxygen content of the oxidizing fluid. In an embodiment, the membrane may be located in an aboveground portion of the oxidizer conduit to facilitate access to the membrane. As shown in FIG. 191, oxidizing fluid 1276 may flow through membrane 1298. In some embodiments, oxidizing fluid 1276 may be heated to increase a diffusion rate of oxygen through the membrane. For example, heat may be transferred from exhaust gas 1280 to oxidizing fluid 1276 in heat exchanger 1300. Increasing a temperature of oxidizing fluid 1276 may increase a diffusion rate of oxygen through membrane 1298. The heating of oxidizing fluid 1276 may be limited such that a temperature of the oxidizing fluid does not exceed operational limits of membrane 1298. For example, a temperature of heated oxidizing fluid 1276 may be kept below about 350° C. Preferential diffusion of oxygen through membrane 1298 may increase the oxygen content of enriched oxidizing fluid 1302 delivered to oxidizer assembly 1268. In some embodiments, depleted oxidizing fluid 1304 may be vented to the atmosphere.

A variety of gas oxidizers may be used in downhole oxidizer assemblies. U.S. Pat. No. 3,050,123 to Scott, which is incorporated by reference as if fully set forth herein, describes a gas fired oil-well oxidizer for initiating combustion in thermal recovery processes. U.S. Pat. No. 2,902,270 to Solomonsson et al., which is incorporated by reference as if fully set forth herein, describes a heating member including three substantially concentric tubes.

FIG. 192 depicts a cross-sectional representation of an embodiment of an oxidizer that may be used in a downhole oxidizer assembly. Oxidizer 1270 may include a perforated shell. The perforated shell may be tapered at its upstream end to provide a gas-tight fit with fuel conduit 1274. Fuel conduit 1274 may be insulated proximate oxidizer 1270. In some embodiments, a diameter of fuel conduit 1274 may range from about 0.64 cm to about 2.54 cm. In certain embodiments, a diameter of fuel conduit 1274 may range from about 0.95 cm to about 1.9 cm. In some embodiments, a diameter of the fuel conduit may vary along a length of the fuel conduit. A diameter of the conduit may be greater near an entry point into the oxidizer assembly. The diameter of the fuel conduit may be reduced towards a terminal end of the oxidizer assembly. A variable diameter fuel conduit may compensate for fuel used at various oxidizers of the oxidizer assembly.

Fuel orifices 1306 in fuel conduit 1274 may allow fuel 1272 to enter mixing chamber 1308. Fuel orifices 1306 may be sized to inhibit clogging while allowing fuel 1272 to flow into mixing chamber 1308 at a minimum desired velocity. In certain embodiments, fuel orifices 1306 may be critical flow orifices.

Oxidizing fluid 1276 may flow through oxidizer conduit 1278 along a length of an oxidizer assembly. In some embodiments, oxidizer conduit 1278 may have a diameter of about 5 cm to about 15 cm. In certain embodiments, oxidizer conduit 1278 may have a diameter of about 7.5 cm. Oxidizing fluid 1276 may enter mixing chamber 1308 through oxidizer orifices 1310 in mixing chamber 1308. Mixing of fuel and oxidizing fluid may be achieved in mixing chamber 1308. In some embodiments, static mixers 1312 may be located in mixing chamber 1308 to promote mixing of fuel 1272 and oxidizing fluid 1276. Static mixers 1312 may include one or more distributor plates and/or vanes. Mixing chamber 1308 may be of sufficient length to allow thorough mixing of fuel 1272 and oxidizing fluid 1276. In some embodiments, a length of mixing chamber 1308 may be from about 12.7 cm to about 50.8 cm. In some embodiments, a length of mixing chamber 1308 may be about 25.4 cm.

Ignition source 1314 may be positioned near an end of mixing chamber 1308. Opening 1316, depicted in FIG. 193, may allow placement of ignition source 1314 in oxidizer 1270. A size and/or position of opening 1316 may be chosen to accommodate a variety of ignition sources. In some embodiments, ignition source 1314 may be an electrical ignition source. As shown in FIG. 192, cable 1318 may be used to provide current to an electrical ignition source. Cable 1318 may be positioned outside fuel conduit 1274 and/or outside oxidizer 1270. In some embodiments, a shared cable may be used to provide current to several electrical ignition sources in an oxidizer assembly. In certain embodiments, multiple cables may be used to provide current to several electrical ignition sources in an oxidizer assembly. For example, current may be provided to each electrical ignition source with a separate cable. An oxidizer assembly may include termination 1320 for an electrical ignition source. Termination 1320 may be proximate opening 1316, shown in FIG. 193. In some embodiments, termination 1320 may be a mineral insulated cable.

In some embodiments, an electrical ignition source (e.g., a spark plug) may provide sparking with voltages less than about 3000 V. In certain embodiments, an electrical ignition source may provide sparking with voltages less than about 1000 V (i.e., low voltage sparking). Low voltage sparking may allow ignition over a longer distance than higher voltage sparking. In certain embodiments, separate wiring may be required for each low voltage sparking ignition source.

In some embodiments, an electrical ignition source may be a glow plug. In certain embodiments, a glow plug may be a low voltage glow plug. A low voltage glow plug may operate at voltages less than about 1000 V (e.g., less than about 630 V). In some embodiments, a low voltage glow plug may operate at less than about 120 V (e.g., between about 10 V and about 120 V). In certain embodiments, a low voltage glow plug may operate at 110 V and 5 A.

In some embodiments, a glow plug may be a catalytic glow plug. A catalytic glow plug may initiate oxidation of fuel at a lower temperature than a non-catalytic glow plug. In some embodiments, a glow plug may include ferromagnetic material (e.g., 60% Co-40% Fe with a high positive temperature coefficient of resistance). A maximum temperature obtainable by the glow plug due to resistive heating of ferromagnetic material may be self-limiting above the Curie temperature of the ferromagnetic material. For example, when a glow plug containing ferromagnetic material heats up to about the Curie temperature of the ferromagnetic material, electrical heating of the glow plug is effectively disabled. The temperature of the glow plug may increase beyond the Curie temperature due to heat generated by the oxidizer. If the hot glow plug cools down to about the Curie temperature of the ferromagnetic material or below the Curie temperature (e.g., if the oxidizer flames out), the glow plug may resume functioning as an ignition source.

FIG. 194 depicts an embodiment of ignition system 1322 positioned in a cross-sectional representation of an oxidizer. Ignition system 1322 may be positioned in guide tube 1324. Ignition system 1322 may include glow plug 1326, insulator 1328, transition piece 1330, follower 1332, and cable 1334. Glow plug 1326 may be a Kyocera glow available from Kyocera Corporation (Kyoto, Japan). A length of ignition system 1322 from an end of follower 1332 to an end of glow plug 1326 may be about 5 cm to about 20 cm. In an embodiment, a length of ignition system 1322 from an end of follower 1332 to an end of glow plug 1326 may be about 9.14 cm. Insulator 1328 may be a ceramic insulator made of alumina, boron nitride, silicon nitride, or other ceramic material. When electricity is supplied to ignition system 1322 through cable 1334, a tip of glow plug 1326 may reach a temperature sufficient to ignite a fuel and oxidizing fluid mixture in oxidizer 1270. Cable 1334 may be a mineral insulated cable. A weld (e.g., a gas tungsten argon weld) may be formed where an outer metal layer of cable 1334 enters follower 1332.

FIG. 195 depicts a cross-sectional representation of an embodiment of transition piece 1330. Transition piece 1330 may include ground wire 1336, ceramic 1338, guide tube 1340, and metal body 1342. Ground wire 1336 may electrically couple metal body 1342 to a first terminal of a glow plug. Guide tube 1340 may allow a conductor of a cable to be electrically coupled to a second terminal of the glow plug. Guide tube 1340 and ground wire 1336 may be welded to terminals of the glow plug (e.g., using gas tungsten argon welding). In some embodiments, metal body 1342 may include threading 1344. Threading 1344 may mate with threading of a follower. In some embodiments, the metal body may be coupled to the follower by a crush fit, friction fit, interference fit, or other type of coupling.

FIG. 196 depicts a cross-sectional representation of ignition system 1322 without a cable. Ignition system 1322 without a cable may be assembled and treated (e.g., fired) prior to insertion of a cable. Preform 1346 may be positioned between follower 1332 and transition piece 1330. Preform 1346 may be made of alumina, silicon nitride, boron nitride, or other ceramic material. Preform 1346 may direct a conductor of a cable to guide tube 1340 of transition piece 1330 when the conductor is being coupled to glow plug 1326. Preform 1346 may support the conductor and inhibit the conductor from establishing an electrical connection with follower 1332 or transition piece 1330. Guide tube 1340 may direct the conductor of the cable to a terminal of glow plug 1326. When preform 1346 is positioned between follower 1332 and transition piece 1330, the follower may be welded to the transition piece. Insulator 1328 may electrically isolate glow plug 1326. Insulator 1328 may be coupled to transition piece 1330 and glow plug 1326 using high temperature cement 1348.

In some embodiments, a temperature limited heater may be used in combination with a combustion heater or oxidizer (e.g., a downhole oxidizer, a natural distributed combustor, and/or flameless distributed combustor). The temperature limited heater may be used to help maintain combustion in the combustion heater. A temperature limited heater may be used to control the temperature of the combustion heater by providing more or less heat inside or outside a certain temperature range. In some embodiments, a temperature limited heater may be an ignition source for combustion in a combustion heater (e.g., for a downhole oxidizer). In certain embodiments, a temperature limited heater may maintain a minimum temperature above an auto-ignition temperature of a combustion mixture (e.g., fuel and air) being provided to a combustion heater. The temperature limited heater may maintain the minimum temperature without overheating.

FIG. 197 depicts an embodiment of a downhole oxidizer heater with temperature limited heater ignition sources. Conduit 1350 may be placed in a heater wellbore or in any subsurface opening. Fuel conduit 1274 may be located inside conduit 1350. Conduit 1350 and fuel conduit 1274 may be made of non-corrosive materials such as stainless steel. Oxidizers 1270 may be placed along a length of fuel conduit 1274. Oxidizers 1270 may be spaced at distances of about 15 m. Orifices 1352 may be located proximate oxidizers 1270 to allow fuel 1272 from fuel conduit 1274 to mix with oxidizing fluid 1276 at each oxidizer. Insulated conductor 844 may be coupled to fuel conduit 1274.

FIG. 198 depicts an embodiment of insulated conductor 844. Insulated conductor 844 may include igniter sections 1354. Igniter sections 1354 may be located proximate oxidizers 1270, as shown in FIG. 197. An alternating current may be applied to insulated conductor 844 to produce heat in igniter sections 1354 of the insulated conductor. Igniter sections 1354 may include ferromagnetic conductor 812 inside core 814. Other sections of insulated conductor 844 may include only core 814. Core 814 may be copper. Ferromagnetic conductor 812 may include ferromagnetic material with a Curie temperature of about 980° C. (e.g., a 40% iron, 60% cobalt alloy). Igniter sections 1354 may be about 0.6 m in length with about 15 m spacing between the igniter sections. Core 814 may be enclosed in electrical insulator 792. Electrical insulator 792 may be, but is not limited to, silicon nitride, boron nitride, and/or magnesium oxide. Jacket 800 may be made of a non-corrosive material (e.g., 310 stainless steel).

In some embodiments, an ignition source with temperature limited heaters may include a cable with igniter sections. FIG. 199 depicts an embodiment of insulated conductor 844 with igniter sections 1354. Igniter sections 1354 may be between about 5 cm and about 30 cm in length. Igniter sections 1354 may be spliced into insulated conductor 844. Insulated conductor 844 may be coupled to a fuel conduit in an oxidizer assembly. Igniter sections 1354 may be located proximate oxidizers in an oxidizer assembly. A spacing between igniter sections 1354 may be substantially the same as a spacing between oxidizers in an oxidizer assembly. Insulated conductor 844 may include core 814. Core 814 may be enclosed in electrical insulator 792. Electrical insulator 792 may be, but is not limited to, silicon nitride, boron nitride, and/or magnesium oxide. Core 814 may be made of a material able to withstand high temperatures. In some embodiments, core 814 may be copper or nickel. In some embodiments, core 814 may include a combination of one or more materials. In some embodiments, lead-in or coupling sections to core 814 not subjected to high temperatures may be made of another material (e.g., copper). Jacket 800 may be made of a non-corrosive material (e.g., 310 stainless steel).

Igniter section 1354 may include igniter element 1358. Igniter element 1358 may be electrically coupled to core 814 and jacket 800 in a parallel heater configuration. In an embodiment, igniter element 1358 may include ferromagnetic material. In some embodiments, igniter element 1358 may be a cobalt-iron alloy, with a percentage of cobalt ranging from about 50% to about 100%. Ferromagnetic material for igniter section 1354 may be chosen such that the magnetic transformation temperature of the ferromagnetic material is near an ignition temperature of a fuel/oxidizing fluid mixture in use. For example, igniter element 1358 may be made from an alloy of about 40% iron and about 60% cobalt, with a magnetic transformation temperature of about 980° C. The electrical resistivity of a 40%-iron/60%-cobalt alloy may increase from about 4 microohm-cm at room temperature to about 105 microohm-cm at 980° C. In some embodiments, a heater with one or more igniter sections 1354 may be used to provide heat to a portion of a hydrocarbon containing formation.

A voltage may be applied to insulated conductor 844 to produce heat in igniter sections 1354 of the insulated conductor, which acts as a bus bar. As the magnetic transformation temperature of igniter elements 1358 is approached, resistance of the igniter elements increases sharply (e.g., by a factor of about 4 to a factor of about 10). Thus, power to igniter elements 1358 is reduced and temperatures of the igniter elements are limited at about the magnetic transformation temperature of the igniter elements. Limiting power applied to igniter elements 1358 may prolong a lifetime of the igniter elements. In certain embodiments, current limiter section 1356 may be added in series with igniter element 1358. Current limiter section 1356 may be a section of relatively constant resistivity wire (e.g., nichrome wire). Current limiter section 1356 may protect igniter element 1358 when the igniter element is first energized while still cold.

In some embodiments, an ignition source may include a mechanical ignition source. A mechanical ignition source may advantageously eliminate a need for cables and/or wires from the surface to provide electrical current to an oxidizer assembly. FIG. 200 depicts a schematic representation of an embodiment of mechanical ignition source 1360. Mechanical ignition source 1360 may include a device driven by a fluid (e.g., air or fuel gas) that rotates or moves and creates a spark or sparks when it rotates or moves. In some embodiments, the mechanical ignition source may be a flint stone. Fluid 1362 may be provided to mechanical ignition source 1360 through tubing 1364. Tubing 1364 may have branches 1366 with orifices 1368. Fluid 1362 from tubing 1364 may flow through branches 1366 and out orifices 1368 to drive mechanical ignition source 1360. Mechanical ignition source 1360 may be positioned proximate oxidizer 1270 in an oxidizer assembly such that sparks from the ignition source ignite a fuel/oxidizing fluid mixture in the oxidizer. In some embodiments, fluid supplied to the mechanical ignition sources may be blocked using a valve, valves, or other mechanisms after ignition of the oxidizers. The fluid supplied to the mechanical ignition sources may be unblocked if needed. Blocking the fluid supplied to the mechanical ignition sources may allow for use of the mechanical ignition sources only when the mechanical ignition sources are needed.

Mechanical ignition source 1360 may be constructed from materials designed to withstand downhole operating conditions (e.g., temperatures of about 800° C.). In certain embodiments, mechanical ignition source 1360 may operate only when a temperature of the oxidizer falls below a set temperature. For example, mechanical ignition source 1360 may include a ferromagnetic material, such that the mechanical ignition source operates only below the Curie temperature of the ferromagnetic material. Limiting motion of mechanical ignition source 1360 to times when the mechanical ignition source is needed may extend a lifetime of the mechanical ignition source.

In some embodiments, an oxidizer assembly may include a generator that generates a source of electrical power. Fluid flow (e.g., air flow and/or fuel flow) may drive the generator. In certain embodiments, the generator may include blades that rotate and generate electricity. The generator may be self-contained. Power generated in the generator along the oxidizer assembly may be used to provide current to electrical ignition sources (e.g., glow plugs) in the oxidizer assembly without requiring power cables from the surface. The generator may be constructed from materials designed to withstand downhole operating conditions (e.g., temperatures of about 800° C.).

In some embodiments, an ignition source for an oxidizer of a oxidizer assembly may include a pilot light. A pilot light may require a low flow of fuel and oxidizer. In some embodiments, the oxidizer may be taken from the oxidizer supply for the oxidizer assembly.

In some embodiments, a fireball, flame front, or fireflood propelled through the wellbore may be used to ignite oxidizers of an oxidizer assembly. In some embodiments, the fireball, flame front, or fireflood may be sent forward through the wellbore to the first oxidizer of the oxidizer assembly so that the fireball, flame front or fireflood travels towards the last oxidizer of the oxidizer assembly. In some embodiments, the fireball, flame front or fireflood may be propelled from proximate the last oxidizer of the oxidizer assembly so that the fireball or fireflood travels towards the first oxidizer.

In certain embodiments, fuel may be reacted with catalytic material (e.g., palladium, platinum, or other known oxidation catalysts) to provide an ignition source in a downhole oxidizer assembly. The catalyst material may be, but is not limited to molybdenum, molybdenum oxides, nickel, nickel oxides, vanadium, vanadium oxides, chromium, chromium oxides, manganese, manganese oxides, palladium, palladium oxides, platinum, platinum oxides, rhodium, rhodium oxides, iridium, iridium oxides, or combinations thereof. FIG. 201 depicts catalytic material 1370 proximate oxidizer 1270 in a downhole oxidizer assembly. Tubing 1364 may supply fuel 1272 (e.g., $H_2$) through branches 1366 to one or more orifices 1368 proximate catalytic material 1370. The fuel supplied to catalytic material 1370 may react with the catalytic material at ambient or close to downhole conditions. Fuel supplied to catalytic material 1370 may cause the catalytic material to glow or flame. The content and quantity of the fuel supplied to the catalytic material may be controlled to inhibit development of a flame. A flame may be inhibited to prevent equipment and catalyst degradation due to excessive heat. Glowing catalytic material 1370 may ignite a mixture in oxidizer 1270 proximate the catalytic material. In some embodiments, oxidizers and catalytic material 1370 may be placed in series along a fuel conduit in an oxidizer assembly in any order. Fuel supplied to the catalytic material may be controlled by a valve or valve system so that fuel is supplied to the catalytic material only when the fuel is needed.

FIG. 202 depicts an embodiment of catalytic igniter system 1372. Catalytic igniter system 1372 may include oxidant line 1374, fuel line 1376, manifold 1378, coaxial tubing 1380, mixing zone 1382, shield 1384, and/or catalytic material 1370. In an embodiment, oxidant line 1374 and fuel line 1376 may be 0.48 cm tubing. Oxidant line 1374 may carry air or another oxidizing fluid. Fuel line 1376 may carry hydrogen or another fuel. In certain embodiments, an oxidizing fluid to fuel ratio may range from about 0.8 to 2. In an embodiment, an oxidizing fluid to fuel ratio may be about 1.2 (e.g., 0.156 L/s air and 0.127 L/s hydrogen). Manifold 1378 may direct fuel down a center conduit (e.g., a 0.48 cm center conduit) and oxidant in an annulus between the center conduit and an outer conduit (e.g., a 0.79 cm outer conduit). The oxidant and fuel may mix in mixing zone 1382 before flowing to catalytic material 1370. Catalytic material 1370 may be a packed bed in shield 1384. The packed bed of catalytic material 1370 may be from about 0.64 cm to about 5 cm long. Shield 1384 may have openings that allow reaction product to exit from catalytic igniter system 1372.

FIG. 203 depicts a cross-sectional representation of an embodiment of oxidizer 1270. Oxidizer 1270 may include igniter guide tube 1386. Catalytic igniter system 1372, depicted in FIG. 202, may be positioned in igniter guide tube 1386. In some embodiments, shield 1384, which encloses the catalytic material of the catalytic igniter system, may extend beyond an end of igniter guide tube 1386. When oxidizer and fuel are supplied through oxidant line 1374 and fuel line 1376, a temperature of shield 1384 may rise to a temperature sufficient to initialize combustion of a fuel and oxidizing fluid mixture supplied to oxidizer 1270. Fuel may be supplied to oxidizer 1270 through fuel conduit 1274. Oxidizing fluid may enter oxidizer 1270 through oxidizer orifices 1310.

In some embodiments, a pyrophoric fluid (e.g., triethylaluminum) may be used to ignite an oxidizing fluid/fuel mixture in an oxidizer. Pyrophoric fluids may include, but are not limited to, triethylaluminum, silane, and disilane. Pyrophoric fluid may be delivered proximate one or more oxidizers in an oxidizer assembly through tubing (e.g., tubing 1364 depicted in FIG. 201). The pyrophoric fluid may spontaneously combust in the oxidizing fluid and serve as an ignition source for the oxidizers.

In some embodiments, an exploding pellet (ABB Gas Technology; Bergen, Norway) may be used as an ignition source for oxidizers in a downhole oxidizer assembly. A pellet launching system may be used to launch an exploding pellet along the downhole oxidizer assembly. The pellet launching system may be operated manually or automatically. An automatically operated pellet launching system may include a magazine. In some embodiments, a pellet from a pellet launching system may have a mechanical design with a metallic body. In certain embodiments, a pellet may have an electronic design with a non-metallic body.

In some embodiments, a pellet launching system may be used to supply an ignition source to oxidizers of an oxidizer assembly. A pellet launching system may launch an explosive pellet into a downhole oxidizer assembly. An explosive pellet may include a powder mix selected to deliver sparks of a desired intensity and burning time to one or more oxidizers in the oxidizer assembly. A pellet launching system may use air or other gas to push an explosive pellet through tubing to a point of ignition. The pellet may be self-activating. A point of ignition may be a marker along a length of the tubing. For example, a point of ignition for a pellet with a metallic body may be a magnet. A point of ignition for a pellet with a non-magnetic body may be a sensor. In some embodiments, an oxidizer assembly may include one point of ignition toward an upstream end of the oxidizer assembly (e.g., upstream of the first oxidizer). In certain embodiments, more than one ignition point may be included along a length of an oxidizer assembly (e.g., an ignition point may be located proximate each oxidizer).

As a pellet passes an ignition point, the ignition point may trigger explosion of the pellet. Explosion of the pellet may produce a shower of sparks. The sparks may be at a very high temperature. The flow of sparks may be directionally controlled (e.g., flow into tubing designed to guide the sparks) proximate one or more oxidizers in an oxidizer assembly. FIG. 204 depicts tubing 1364 with ignition points 1388. Tubing 1364 and branches 1366 may guide sparks toward oxidizer 1270. Sparks may ignite a fuel/oxidizing fluid mixture in oxidizer 1270. In some embodiments, one pellet may be exploded to provide a long-lasting shower of sparks for all oxidizers in a downhole oxidizer assembly. In certain embodiments, a pellet may be triggered to ignite two or more oxidizers in a downhole oxidizer assembly. In some embodiments, a separate pellet may be triggered for each oxidizer in a downhole oxidizer assembly. In some embodiments, spent pellets may be collected in a collector unit positioned proximate a terminal end of a downhole oxidizer assembly.

As depicted in FIG. 193, oxidizer 1270 may have constriction 1390 to increase a velocity of fuel/oxidizing fluid mixture as the fuel/oxidizing fluid mixture flows downstream of ignition source 1314. Ignition source 1314 may initiate combustion of the fuel/oxidizing fluid mixture as the mixture flows past the ignition source. In some embodiments, an inner surface of oxidizer 1270 (e.g., an inner surface of the oxidizer proximate an end of mixing chamber 1308) may include a catalyst to lower an ignition temperature of the fuel. Screen 1392 may inhibit the flame from being extinguished by providing expansion room for the combustion products. In some embodiments, the flame may reside substantially in screen 1392. Screen 1392 may have a larger diameter than mixing chamber 1308. In certain embodiments (e.g., the embodiment depicted in FIG. 192), screen 1392 may have substantially the same diameter as mixing chamber 1308. Openings 1394 in screen 1392 may provide pressure relief by allowing flow of fuel/oxidizing fluid from oxidizer 1270 to oxidizer conduit 1278. In certain embodiments, oxidizing fluid 1276 from oxidizer conduit 1278 may enter screen 1392 through openings 1394.

Oxidizers in an oxidizer assembly may be designed such that a flow velocity of exhaust gas does not exceed a velocity of the flame issuing from the oxidizer, thereby extinguishing the flame. Increasing an area through which exhaust gas exits from a downstream end of an oxidizer may decrease a flow velocity of the exhaust gas from the oxidizer. In some embodiments, a diameter of a downstream portion of an oxidizer may exceed a diameter of an upstream portion of the oxidizer to maintain the flow velocity of exhaust gas exiting the oxidizer above a minimum desired level without exceeding the flame velocity. In some embodiments, as shown in FIG. 193, a diameter of screen 1392 may exceed a diameter of mixing chamber 1308. In some embodiments, a diameter of a screen may increase toward a downstream end of oxidizer (e.g., a screen may be bell-shaped). In some embodiments, openings in a screen may provide an increased area for exhaust gas to escape from the downstream end of the oxidizer. A number, size, and/or shape of openings in a screen may be selected such that the oxidizer flame is not extinguished by the flow of the exhaust gas from the oxidizer.

A length of an oxidizer assembly may be limited by successive depletion of oxygen in oxidizing fluid supplied to oxidizers along the length of the oxidizer assembly. In some embodiments, two or more oxidizing lines and/or fuel lines may enter into a wellbore. The fuel and/or oxidizer supplied by the lines may be used at various locations along a length of the oxidizer assembly. An operational length of an oxidizer assembly may be extended by including a terminal oxidizer with different operating characteristics than other oxidizers in the assembly. The terminal oxidizer may be operated to combust as much fuel as possible. In some embodiments, a terminal oxidizer may have larger fuel orifices than other oxidizers in an oxidizer assembly. As shown in FIG. 205, a distance between terminal oxidizer 1396 and adjacent oxidizer 1270 in oxidizer assembly 1268 may exceed a distance between other adjacent oxidizers in the oxidizer assembly. In certain embodiments, a peak temperature of terminal oxidizer 1396 may exceed an operating temperature of oxidizers 1270 in oxidizer assembly 1268. Higher peak temperatures may be acceptable in terminal oxidizer 1396 because there may be no downstream components to protect from higher temperatures.

In some embodiments, a terminal oxidizer may be a catalytic oxidizer. A catalytic oxidizer may operate with a lower oxygen concentration than other oxidizers in an oxidizer assembly. In certain embodiments, an oxidizer with a higher duty than other oxidizers in the assembly may be placed in a terminal position. A terminal oxidizer with a higher duty may deplete the oxygen content of the oxidizing fluid below a concentration required for other oxidizers in the assembly to operate, thus extending an operational length of the oxidizer assembly.

Alternative conduit configurations may not result in oxygen depletion toward a terminal end of an oxidizer assembly. In some embodiments, oxidizing fluid may be delivered to an oxidizer assembly through more than one oxidizer conduit. In certain embodiments, oxidizer conduits of differing lengths may be wound helically around a fuel conduit. Helically wound oxidizer conduits may deliver oxidizing fluid to one or more oxidizers along a length of the oxidizer assembly without depletion of oxygen toward the terminal end of the oxidizer assembly (e.g., staged injection).

In some embodiments, a fuel conduit and an oxidizer conduit may be substantially parallel. U.S. Pat. No. 2,890,754 to Hoffstrom et al., which is incorporated by reference as if fully set forth herein, describes a conduit with a baffle that separates a flow of oxidizing fluid from a flow of fuel. Parallel fuel and oxidizer conduits may be used to deliver fuel and oxidizing fluid in stoichiometric amounts to each oxidizer. With a parallel conduit arrangement, fuel and/or oxidizing fluid supplied to an oxidizer may not be mixed with exhaust gas from one or more upstream oxidizers. Using parallel fuel and oxidizing fluid conduits may allow for an oxidizer assembly of a relatively long length.

In some embodiments, a wellbore that an oxidizer assembly is located in may have a first opening at a first location on the Earth's surface and a second opening located at a second location on the Earth's surface (e.g., the wellbore may be a relatively u-shaped wellbore). In some embodiments of an oxidizer assembly that is placed in a u-shaped wellbore, fuel flow and oxidizing fluid flow may be directed in the same direction (e.g., from the first opening towards the second opening). In some embodiments of an oxidizer assembly that is placed in a u-shaped wellbore, fuel flow and oxidizing fluid flow may be directed in opposite directions. For example, fuel flow may be directed from the first opening to the second opening, while oxidizing fluid flow is directed from the second opening to the first opening. In some embodiments, fuel may be introduced in separate lines from both the first opening and the second opening. Using two fuel lines may improve fuel distribution along the length of the oxidizer assembly.

FIG. 206 depicts a schematic representation of a portion of downhole oxidizer assembly 1268 with substantially parallel fuel and oxidizer conduits. Oxidizers 1270 may be positioned between fuel conduit 1274 and oxidizer conduit 1278. A flow of oxidizing fluid 1276 through oxidizer conduit 1278 and a flow of fuel 1272 through fuel conduit 1274 may be controlled (e.g., with valves) such that a stoichiometric air to fuel ratio is provided to each oxidizer 1270 of oxidizer assembly 1268. Air 1398 may be provided to the oxidizer assembly through inner conduit 1400. Air 1398 provided to oxidizer assembly 1268 through inner conduit 1400 may promote a uniform temperature along the oxidizer assembly through convective flow. Air 1398 provided to oxidizer assembly 1268 through inner conduit 1400 may inhibit contact of oxidizers 1270 with surfaces proximate the oxidizers. Exhaust gas 1280 from oxidizer assembly 1268 may heat the formation and return to the surface between inner conduit 1400 and outer conduit 1282.

In some embodiments, fuel conduit 1274 may include a valve (e.g., a self-regulating valve) to control fuel flow to one or more oxidizers 1270 in oxidizer assembly 1268. FIG. 207 depicts a schematic representation of a portion of downhole oxidizer assembly 1268 with substantially parallel fuel and oxidizer conduits. Oxidizer assembly 1268 may include one or more valves 1286 coupled to fuel conduit 1274. In an embodiment, valve 1286 is positioned upstream of oxidizer 1270. In some embodiments, valve 1286 may be positioned in oxidizer 1270. Valve 1286 may control fuel flow to one or more oxidizers 1270. For example, valve 1286 may control fuel flow to five oxidizers 1270. In some embodiments, valve 1286 may be opened automatically (e.g., the valve may be self-regulating). For example, when oxidizers 1270 upstream from valve 1286 are ignited and start to produce heat, the valve may open such that fuel is allowed to flow to one or more oxidizers downstream of the valve.

In certain embodiments, parameters may be monitored along selected portions of a length of a heater assembly. Monitored parameters may allow determination of temperature, pressure, strain, and/or gas composition along the selected length. In some embodiments, monitored parameters may allow a control system to be established. The control system may operate the heater assembly. In certain embodiments, a heater assembly may be controlled and/or monitored during start-up to minimize a possibility of downhole deflagration and/or detonation. Individual fixed sensors for monitoring pressures may include one or more cables for the sensors. A large number of cables proximate a heater assembly may interfere with operation of a heater assembly. A fiber optic array system that continuously monitors parameters along a length of a heater assembly may reduce a number of cables and/or sensors positioned proximate the heater assembly. Continuously monitoring a temperature profile over a length of a downhole heater assembly may allow more effective control of the heater assembly than temperature measurements made at specific locations with fixed thermocouples. A temperature profile over a length of the heater assembly may allow measurement of peak heater temperatures not detected by thermocouples in fixed locations.

In some embodiments, a fiber optic system including an optical sensor may be used to continuously monitor parameters (e.g., temperature, pressure, and/or strain) along a portion and/or the entire length of a heater assembly. In certain embodiments, an optical sensor may be used to monitor composition of gas at one or more locations along the optical sensor. An optical sensor may include, but is not limited to, a high temperature rated optical fiber (e.g., a single mode fiber or a multimode fiber) or fiber optic cable. A Sensornet DTS system (Sensornet; London, U.K.) includes an optical fiber that may be used to monitor temperature along a length of a heater assembly. A Sensornet DTS system includes an optical fiber than may be used to monitor temperature and strain (and/or pressure) at the same time along a length of a heater assembly.

In some embodiments, an optical sensor may be used to monitor stress along a conduit (e.g., a liner, a portion of a heater) in an opening in a formation. For example, the optical sensor may be positioned near the conduit in the opening in the formation. As the formation is heated, an effective diameter of the opening may decrease. As an effective diameter of the opening decreases, walls of the opening may close in on the conduit and/or the optical sensor. Stress and temperature along one or more portions of the optical sensor may be monitored during heating of the formation. In certain embodiments, when stress and/or temperature along one or more portions of the optical sensor array reaches a particular value, heat input into the formation may be decreased to inhibit constriction of the opening in the formation. Thus, selectively limiting heat input into the formation may inhibit overstress of the conduit. In some embodiments, stress and temperature data may be obtained (e.g., in a test wellbore) and then used to design heating systems that inhibit expansion of material in the formation (e.g., temperature limited heaters) and/or withstand stresses from expansion of material in the formation (e.g., a deformation resistant container or liner).

An optical sensor may provide faster response times (i.e., more immediate feedback) than fixed thermocouples, pressure sensors, and/or strain sensors. Fast response times of the optical sensor may allow better monitoring and/or control of a downhole heater. Better monitoring and/or control of a downhole heater may allow more efficient operation of a downhole heater assembly by providing more immediate knowledge of heater status. In some embodiments, fast response times of an optical sensor used to monitor a downhole heater assembly may allow use of a predictive control system (e.g., a feed forward system).

In some embodiments, an optical sensor may be protected from exposure to a downhole environment. For example, a downhole environment may include high temperatures, gas emissions, and/or chemical emissions from oxidizers that may diminish performance of the optical sensor. Temperatures in a downhole environment during heating may range from about 500° C. to about 1000° C. High temperatures may damage the optical sensor. Emissions from downhole oxidizers may coat the optical sensor and obscure light from entering and/or exiting the optical sensor. Vibration of a heater assembly in a downhole environment may interfere in signal transmission and/or damage the optical sensor.

In some embodiments, an optical sensor used to monitor temperature, strain, and/or pressure may be coated and/or clad with a reflective material to contain a signal or signals transmitted down the optical sensor. The coating or cladding may be formed of a material that is able to withstand conditions in a downhole environment. For example, a gold cladding may allow an optical sensor to be used in downhole environments up to temperatures of about 700° C. In some embodiments, an optical sensor may be coated with nickel cladding. For example, an optical sensor may be dipped in or run through a bath of liquid nickel. The coated optical sensor may then be allowed to cool to secure the nickel cladding. In some embodiments, an optical sensor may be coated with gold, copper, nickel, and/or alloys thereof.

In some embodiments, an optical sensor used to monitor temperature, strain, and/or pressure may be protected by positioning, at least partially, the optical sensor in a protective sleeve (e.g., an enclosed tube) resistant to conditions in a downhole environment. In certain embodiments, a protective sleeve may be a small stainless steel tube (e.g., about 0.35 cm or less in diameter). In some embodiments, an open-ended sleeve may be used to allow determination of gas composition at the surface and/or at the terminal end of an oxidizer assembly. An optical sensor may be pre-installed in a protective sleeve and coiled on a reel. The sleeve may be uncoiled from the reel and coupled to a heater assembly. In some embodiments, an optical sensor in a protective sleeve may be lowered into a section of the formation with a heater assembly.

In some embodiments, a fiber optic system may include one or more instruments located at the surface to receive and/or transmit signals to the optical sensor. In some embodiments, data from the instruments may be transmitted by the instrument and recorded by a central distributed control system (DCS). The central distributed control system may provide feedback control to adjust parameters (e.g., change fuel flow supply to an oxidizer, adjust voltage output for an electrical heater, shut down an oxidizer, activate an ignition source for an oxidizer) and/or to shut down a heater assembly. For example, a Brillouin scattering, Bragg grating, or a Raman system located at the surface may be used in conjunction with an optical time domain reflectomer (OTDR) to determine a temperature profile along a fiber optic cable. The OTDR may inject short, intense laser pulses into the optical sensor. Backscattering and reflection of light through the optical sensor may be measured as a function of time. Characteristics of the reflected light may be analyzed to determine a profile along a length of the fiber optic cable. Data from the Brillouin scattering, Bragg grating, and/or Raman system may be transmitted to and recorded by a central DCS. The central distributed control system may provide feedback control to adjust parameters and/or to shut down a heater assembly. A Brillouin system may be used to monitor parameters at smaller distances between scattering points (e.g., distances of about 15 cm) than a Bragg grating system. Thus, a Brillouin system may be more useful for monitoring parameters along a heater assembly.

In certain embodiments, continuously monitoring parameter profiles along a length of a heater assembly may be used as feedback to initiate changes in operating parameters. Parameters may be monitored and analyzed to determine an appropriate course of action for the observed conditions. For example, fuel and/or oxidizing fluid supplied to an oxidizer of a multi-oxidizer heater assembly may be changed based on temperature profiles across the oxidizer and/or the temperature profiles of one or more adjacent oxidizers. As a temperature near an oxidizer approaches and/or exceeds a maximum pre-determined temperature, the flow of fuel and/or oxidizing fluid supply to the oxidizer may be rapidly decreased or discontinued to change the temperature at the specific oxidizer. If a selected temperature differential is not achieved across an oxidizer in a pre-determined time, or if a temperature differential indicates that the oxidizer flame has been extinguished, the oxidizer may be ignited or re-ignited. In some embodiments, parameters may be transmitted to a central DCS. The central DCS may also record the parameters. The DCS may provide feedback control to adjust parameters and/or initiate a shutdown of a heater assembly.

As a downhole heater assembly undergoes heating and cooling, thermal expansion and contraction of the assembly may occur. In some embodiments, continuously monitoring a temperature profile over a length of a heater assembly may allow positions of individual heaters to be traced as the heater assembly expands and/or contracts. For a downhole heater assembly including oxidizers, monitoring a temperature profile over a length of the downhole oxidizer assembly may allow rapid detection of hot spots and/or cold spots proximate the oxidizers. Continuous monitoring along a length of the oxidizer assembly may indicate shifting of hot spots and/or cold spots during a heating process.

In some embodiments, mechanical failures may be prevented by monitoring temperature and/or pressure profiles of one or more heaters in a heater assembly. For example, a temperature decrease and/or a pressure increase over time near a specific oxidizer of a multi-oxidizer heater assembly may indicate mechanical problems at the specific oxidizer (e.g., carbonaceous deposits in heater orifices). Fuel flow to the specific oxidizer may be altered and/or discontinued to inhibit failure of the specific oxidizer. In some embodiments, flow of air and/or fuel to the specific oxidizer or to a group of oxidizers that include the specific oxidizer may be affected. In some embodiments, the entire heater assembly may be shut down. The ability to shut down a heater assembly if potential failure conditions are indicated may increase a lifespan of the heater assembly and/or increase operational safety of the heater assembly.

FIG. 208 depicts a schematic representation of an embodiment of a downhole oxidizer assembly coupled to a fiber optic system. Fuel 1272 may be provided to fuel conduit 1274. In some embodiments, steam 1402 may be provided to fuel conduit 1274 to inhibit coking. Fuel conduit 1274 and one or more oxidizers 1270 may be positioned in oxidizer conduit 1278. Oxidizing fluid 1276 may flow through oxidizer conduit 1278 to react with fuel 1272 supplied by fuel conduit 1274. A high temperature rated fiber optic cable protected by sleeve 1404 may be positioned proximate the downhole oxidizer assembly.

Temperatures monitored by the fiber optic cable may depend upon positioning of sleeve 1404. Sleeve 1404 may be positioned in an annulus between two conduits (e.g., between an oxidizer conduit and an outer conduit) or between a conduit and an opening in the formation. In an embodiment, sleeve 1404 with enclosed fiber optic cable may be positioned along an outer surface of fuel conduit 1274, proximate oxidizers 1270. In some embodiments, sleeve 1404 with enclosed fiber optic cable may be positioned inside fuel conduit 1274. In certain embodiments, sleeve 1404 with enclosed fiber optic cable may be wrapped spirally near one or more oxidizers 1270 and/or around fuel conduit 1274 or oxidizer conduit 1278 to enhance resolution. Average temperatures measured along the outer surfaces of fuel conduit 1274 proximate oxidizers 1270 may range from about 550° C. to about 760° C. Proximate oxidizers 1270, a maximum temperature measured inside fuel conduit 1274 may reach about 1000° C.

Fiber optic system 1406 may include an ODTR coupled to the fiber optic cable. In some embodiments, fiber optic system 1406 may include a Brillouin system and/or Raman system. Data from the fiber optic system may be transmitted to distributed control system 1408. Distributed control system 1408 may provide feedback control to valves 1410 for regulating flow of fuel 1272 and/or oxidizing fluid 1276 to oxidizers 1270. In some embodiments, exhaust gas 1280 may enter exhaust monitor 1412. Data from exhaust monitor 1412 may be supplied to distributed control system 1408. Data from exhaust monitor 1412 may be communicated to distributed control system 1408 and used to achieve a cost effective flow of fuel 1272 and/or oxidizing fluid 1276 to oxidizers 1270.

In certain embodiments, sleeve 1358 may be placed down a hollow conductor of a conductor-in-conduit heater. FIG. 209 depicts an embodiment of sleeve 1358 in a conductor-in-conduit heater. Conductor 822 may be a hollow conductor. Sleeve 1358 may be placed inside conductor 822. Sleeve 1358 may be moved to a position inside conductor 822 by providing a pressurized fluid (e.g., a pressurized inert gas) into the conductor to move the sleeve along a length of the conductor. Sleeve 1358 may have a plug 1480 located at an end of the sleeve so that the sleeve may be moved by the pressurized fluid. Plug 1480 may be of a diameter slightly smaller than an inside diameter of conductor 822 so that the plug is allowed to move along the inside of the conductor. In some embodiments, plug 1480 may have small openings to allow some fluid to flow past the plug. Conductor 822 may have an open end or a closed end with openings at the end to allow pressure release from the end of the conductor so that sleeve 1358 and plug 1480 can move along the inside of the conductor. In certain embodiments, sleeve 1358 may be placed inside any hollow conduit or conductor in any type of heater.

Using a pressurized fluid to position sleeve 1358 inside conductor 822 allows for selected positioning of the sleeve. The pressure of the fluid used to move sleeve 1358 inside conductor 822 may be set to move the sleeve a selected distance in the conductor so that the sleeve is positioned as desired. In certain embodiments, sleeve 1358 may be removable from conductor 822 so that the sleeve can be repaired and/or replaced.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. In addition, it is to be understood that features described herein independently may, in certain embodiments, be combined.

What is claimed is:

1. A method for producing methane from a hydrocarbon formation, comprising:

dewatering a first treatment area isolated by a plurality of freeze wells;

dewatering a second treatment area isolated by a plurality of freeze wells, wherein a first impermeable hydrocarbon layer is between the second treatment area and the first treatment area, and wherein the first treatment area, the impermeable layer, and the second treatment area are at least partially horizontally displaced from each other;

storing at least a portion of the water from the second treatment area in the first treatment area; and removing methane from the second treatment area.

2. The method of claim 1, wherein the first treatment area is subjected to an in situ conversion process prior to receiving water from the second treatment area.

3. The method of claim 1, wherein the second treatment area comprises a deep coal seam.

4. The method of claim 1, further comprising injecting carbon dioxide in the second treatment area to displace methane from the formation so that that the methane can be removed from the formation through production wells.

5. The method of claim 1, further comprising injecting carbon dioxide in the second treatment area to control pressure within the second treatment area.

6. The method of claim 1, further comprising injecting carbon dioxide in the second treatment area to maintain pressure in the second treatment area above a pressure outside of the second treatment area to inhibit ingress of fluids into the second treatment area.

7. The method of claim 1, further comprising sequestering carbon dioxide in the second treatment area.

8. The method of claim 1, wherein isolating the second treatment area with a plurality of freeze wells increases methane production by at least 40% relative to producing methane from the second treatment area without isolation.

9. The method of claim 1, wherein the first impermeable layer has a permeability of less than 0.1 millidarcy.

10. The method of claim 1, wherein at least two of the plurality of freeze wells isolating the second treatment area are arranged in a stacked pattern.

11. The method of claim 1, wherein at least two of the plurality of freeze wells isolating the second treatment area are arranged in a triangle pattern.

12. The method of claim 1, wherein at least a portion in the water in the first treatment area freezes to form a barrier.

13. The method of claim 1, further comprising allowing heat to transfer to at least a portion of the first treatment area from heaters located in the impermeable layer; and producing hydrocarbons from the first treatment area.

14. The method of claim 1, further comprising allowing heat to transfer to at least a portion of the second treatment area from heaters located in the second treatment area, the heaters being arranged in a staggered pattern.

15. The method of claim 1, further comprising allowing heat to transfer to at least a portion of the second treatment area from heaters located in the second treatment area, the heaters being arranged in a staggered X pattern.

16. The method of claim 1, further comprising dewatering a third treatment area isolated by a plurality of freeze wells, wherein a second impermeable layer is between the second treatment area and the third treatment area; storing at least a portion of the water from the third treatment area in the second treatment area; and removing methane from the third treatment area, and wherein the second treatment area, the second impermeable layer and the third treatment area are at least partially horizontally displaced from each other.

17. The method of claim 16, wherein at least two of the plurality of freeze wells isolating the third treatment area are arranged in a stacked pattern.

18. The method of claim 16, further comprising allowing heat to transfer to at least a portion of the third treatment area from heaters located in the third treatment area, the heaters being arranged in a W pattern.

* * * * *